US007742019B2

(12) United States Patent
Takahara

(10) Patent No.: US 7,742,019 B2
(45) Date of Patent: Jun. 22, 2010

(54) DRIVE METHOD OF EL DISPLAY APPARATUS

(75) Inventor: Hiroshi Takahara, Osaka (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 612 days.

(21) Appl. No.: 10/511,437

(22) PCT Filed: Mar. 6, 2003

(86) PCT No.: PCT/JP03/02598

§ 371 (c)(1),
(2), (4) Date: Oct. 25, 2004

(87) PCT Pub. No.: WO03/091979

PCT Pub. Date: Nov. 6, 2003

(65) Prior Publication Data

US 2005/0168490 A1 Aug. 4, 2005

(30) Foreign Application Priority Data

Apr. 26, 2002 (JP) ..... 2002-127532
Apr. 26, 2002 (JP) ..... 2002-127637
Sep. 26, 2002 (JP) ..... 2002-282013

(51) Int. Cl.
*G09G 5/10* (2006.01)

(52) U.S. Cl. ..... 345/76; 345/690

(58) Field of Classification Search ..... 345/690, 345/76

See application file for complete search history.

(56) References Cited

U.S. PATENT DOCUMENTS 5,414,443 A * 5/1995 Kanatani et al. ..... 345/95
5,623,278 A * 4/1997 Okada et al. ..... 345/95
5,952,789 A 9/1999 Stewart et al.
5,990,629 A * 11/1999 Yamada et al. ..... 315/169.3
6,105,045 A * 8/2000 Kurabayashi et al. ..... 715/201
6,169,532 B1 * 1/2001 Sumi et al. ..... 345/98
6,219,113 B1 4/2001 Takahara
6,326,938 B1 12/2001 Ishida et al.
6,351,255 B1 2/2002 Ishizuka et al.
6,369,786 B1 4/2002 Suzuki
6,373,454 B1 4/2002 Knapp et al.
6,501,466 B1 * 12/2002 Yamagishi et al. ..... 345/204
6,522,319 B1 * 2/2003 Yamazaki ..... 345/103
6,583,775 B1 * 6/2003 Sekiya et al. ..... 345/76
6,628,355 B1 9/2003 Takahara
6,633,274 B1 * 10/2003 Yokota et al. ..... 345/100

(Continued)

FOREIGN PATENT DOCUMENTS

CN 1294375 A 5/2001
EP 0 883 191 A2 12/1998
EP 1 094 436 A2 4/2001
EP 1 102 234 A2 5/2001
EP 1 130 565 A1 9/2001
EP 1 282 104 A1 2/2003

(Continued)

*Primary Examiner*—Bipin Shalwala
*Assistant Examiner*—Afroza Y Chowdhury
(74) *Attorney, Agent, or Firm*—Oblon, Spivak, McClelland, Maier & Neustadt, L.L.P.

(57) ABSTRACT

A drive method of an EL display apparatus that includes a switching element that turns on and off a current path between a driver transistor and an EL element. The drive method aggregates image data input to the EL display apparatus, and determines a period to turn off the switching element according to an amount of the aggregate data. With the method, suppression of peak current and expansion of contrast and so on is realized.

14 Claims, 176 Drawing Sheets

U.S. PATENT DOCUMENTS

| | | | | |
|---|---|---|---|---|
| 6,765,549 | B1 * | 7/2004 | Yamazaki et al. | 345/80 |
| 6,771,243 | B2 * | 8/2004 | Hirohata | 345/89 |
| 6,800,871 | B2 * | 10/2004 | Matsuda et al. | 257/30 |
| 6,900,788 | B2 * | 5/2005 | Yamazaki | 345/103 |
| 6,909,409 | B2 * | 6/2005 | Tanada | 345/51 |
| 7,133,013 | B2 * | 11/2006 | Kamezaki et al. | 345/98 |
| 7,161,573 | B1 * | 1/2007 | Takatori et al. | 345/96 |
| 7,176,872 | B2 * | 2/2007 | Kuriki | 345/98 |
| 7,180,513 | B2 | 2/2007 | Tsuge | |
| 7,321,353 | B2 * | 1/2008 | Tsuda et al. | 345/99 |
| 2001/0048106 | A1 | 12/2001 | Tanada | |
| 2002/0050962 | A1 | 5/2002 | Kasai | |
| 2002/0180673 | A1 * | 12/2002 | Tsuda et al. | 345/87 |
| 2005/0030264 | A1 * | 2/2005 | Tsuge et al. | 345/76 |
| 2005/0041002 | A1 * | 2/2005 | Takahara et al. | 345/76 |
| 2005/0057580 | A1 * | 3/2005 | Yamano et al. | 345/690 |
| 2005/0168490 | A1 | 8/2005 | Takahara | |
| 2005/0168491 | A1 * | 8/2005 | Takahara et al. | 345/690 |
| 2005/0180083 | A1 | 8/2005 | Takahara et al. | |
| 2006/0279260 | A1 | 12/2006 | Tsuge | |
| 2007/0080905 | A1 | 4/2007 | Takahara | |
| 2007/0085781 | A1 | 4/2007 | Chung et al. | |
| 2007/0120784 | A1 | 5/2007 | Tsuge | |
| 2007/0126667 | A1 | 6/2007 | Nakamura et al. | |

FOREIGN PATENT DOCUMENTS

| | | | |
|---|---|---|---|
| JP | 63-290413 | | 11/1988 |
| JP | 6-314977 | | 11/1994 |
| JP | 06-332397 | | 12/1994 |
| JP | 10-232649 | | 9/1998 |
| JP | 10-319908 | | 12/1998 |
| JP | 11-3048 | | 1/1999 |
| JP | 11-143429 | | 6/1999 |
| JP | 11-282420 | | 10/1999 |
| JP | 11-311970 | | 11/1999 |
| JP | 2001-42822 | | 2/2001 |
| JP | 2001-42822 | A | 2/2001 |
| JP | 2001-092370 | A | 4/2001 |
| JP | 2001-147659 | A | 5/2001 |
| JP | 2001-147666 | | 5/2001 |
| JP | 2001-210122 | A | 8/2001 |
| JP | 2001-282176 | | 10/2001 |
| JP | 2001-290441 | | 10/2001 |
| JP | 2001-306031 | A | 11/2001 |
| JP | 2002-40990 | A | 2/2002 |
| JP | 2002-278514 | | 9/2002 |
| JP | 2002-297096 | | 10/2002 |
| JP | 2003-108065 | A | 4/2003 |
| JP | 2003-114644 | A | 4/2003 |
| JP | 2003-114645 | | 4/2003 |
| JP | 2003-150104 | | 5/2003 |
| JP | 2003-150109 | A | 5/2003 |
| JP | 2003-150118 | A | 5/2003 |
| JP | 2005-266735 | A | 9/2005 |
| KR | 10-0548799 | | 5/1999 |
| KR | 1999-0077738 | | 10/1999 |
| KR | 2000-0033177 | | 6/2000 |
| KR | 2001-0070173 | | 7/2001 |
| KR | 2001-0078229 | | 8/2001 |
| KR | 2001-0098894 | | 11/2001 |
| KR | 2002-0018262 | | 3/2002 |
| KR | 2002-0025984 | | 4/2002 |
| KR | 2002-0029317 | | 4/2002 |
| KR | 2002-0069488 | | 9/2002 |
| KR | 2003-0000146 | | 1/2003 |
| KR | 2003-0025185 | | 3/2003 |
| KR | 10-2007-0015828 | | 2/2007 |
| WO | WO 98/48403 | | 10/1998 |
| WO | WO 99/50817 | | 10/1999 |
| WO | 99/65011 | | 12/1999 |
| WO | WO 99/65012 | | 12/1999 |
| WO | 01/06484 | | 1/2001 |
| WO | WO 01/37249 | A2 | 5/2001 |
| WO | 01/75852 | | 10/2001 |
| WO | WO 01/91095 | A1 | 11/2001 |
| WO | 03/027998 | | 4/2003 |

* cited by examiner

Gate signal line 17a
1F
1H
Vgh
Vgl
Time t

Gate signal line 17b
1F/N
Vgh
Vgl
Time t

Emission brightness
N·B
0
Time t

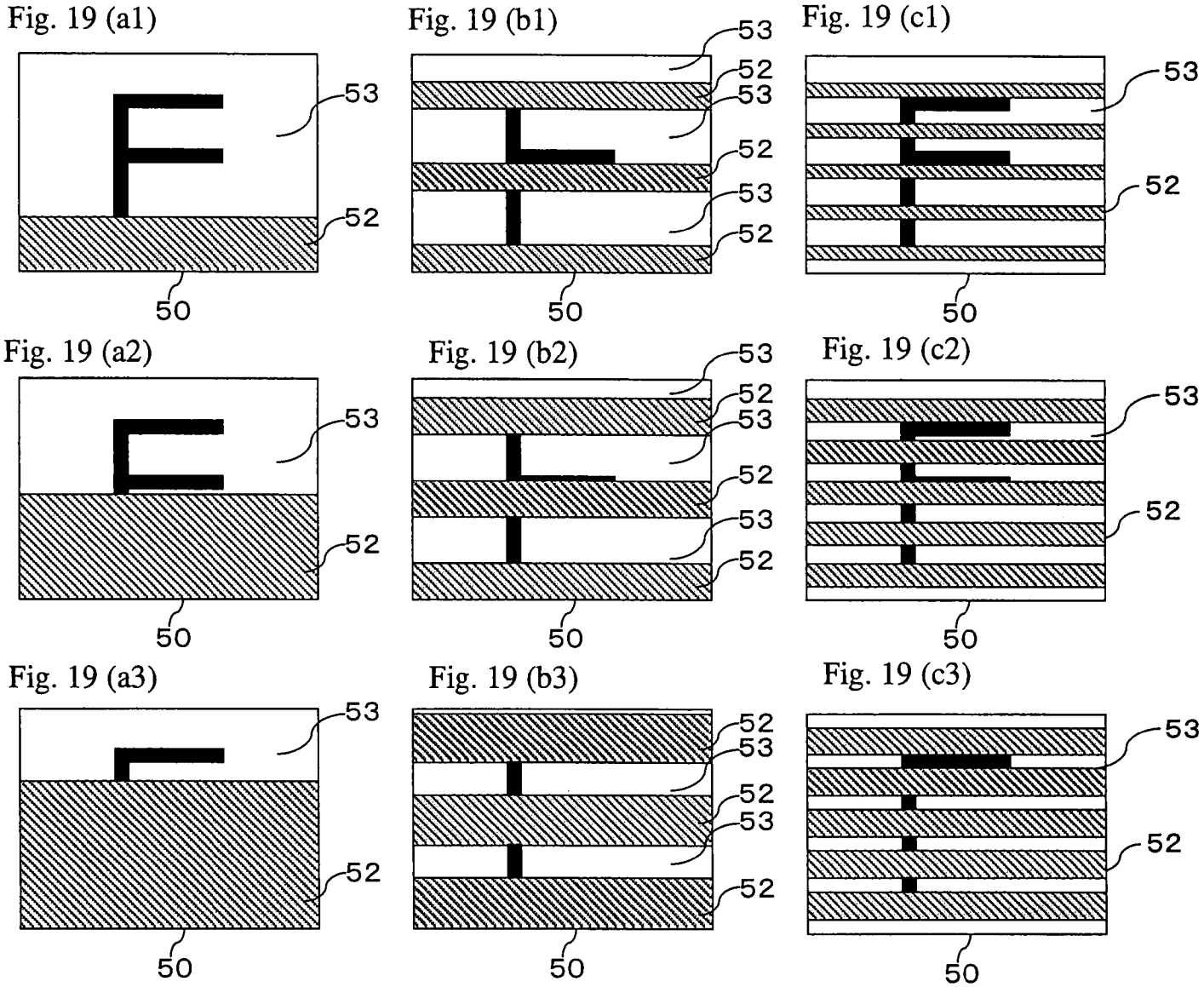
Fig. 19 (a1)
Fig. 19 (a2)
Fig. 19 (a3)
Fig. 19 (b1)
Fig. 19 (b2)
Fig. 19 (b3)
Fig. 19 (c1)
Fig. 19 (c2)
Fig. 19 (c3)
50
52
53

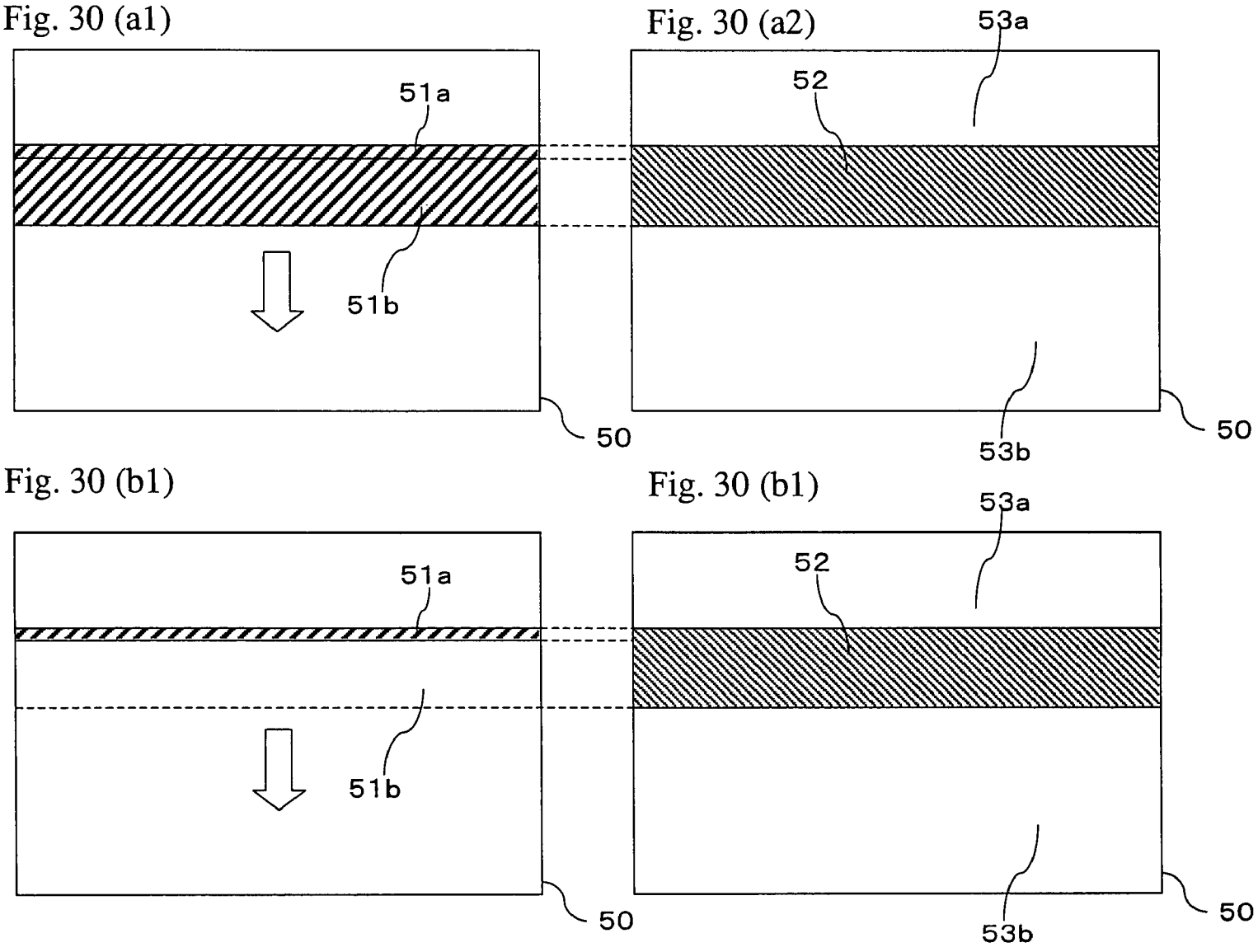
Fig. 30 (a1)
Fig. 30 (a2)
Fig. 30 (b1)
Fig. 30 (b1)
50
50
50
50
51a
51b
52
53a
53b

PRIOR ART

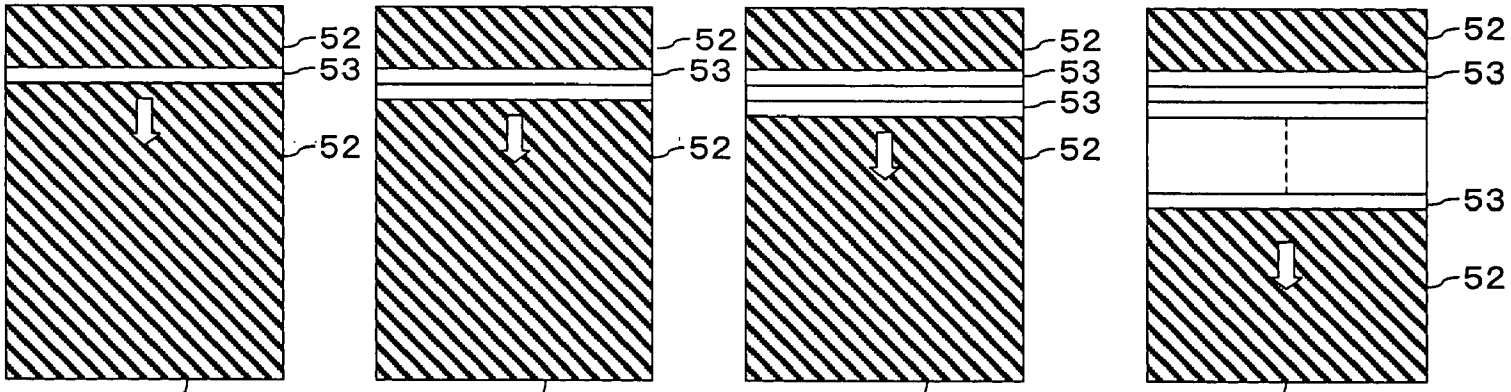
Fig. 82 (a1)
Fig. 82 (a2)
Fig. 82 (a3)
Fig. 82 (an)
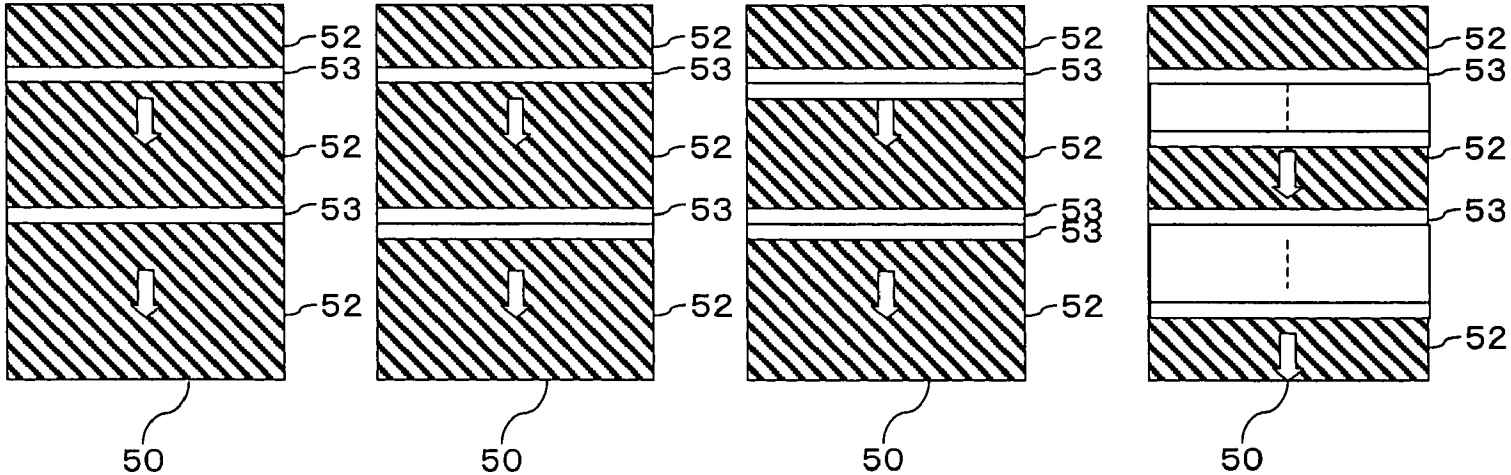
Fig. 82 (b1)
Fig. 82 (b2)
Fig. 82 (b3)
Fig. 82 (bn)

50
52
53

Error diffusion
FRC

Fig. 103

| Frame (field) number | 1 | 2 | 3 | 4 | 5 | 6 | 7 | 8 | 9 | 10 | 11 | 12 |
|---|---|---|---|---|---|---|---|---|---|---|---|---|
| APL level | 228 | 220 | 218 | 216 | 212 | 210 | 192 | 198 | 182 | 168 | 192 | 182 |
| Corresponding duty ratio | 8 /64 | 9 /64 | 9 /64 | 10 /64 | 9 /64 | 10 /64 | 11 /64 | 11 /64 | 12 /64 | 14 /64 | 11 /64 | 12 /64 |
| Processed duty ratio | 8 /64 | 8 /64 | 9 /64 | 9 /64 | 9 /64 | 10 /64 | 10 /64 | 11 /64 | 12 /64 | 12 /64 | 11 /64 | 12 /64 |

Fig. 106

| | 1−1 | 1−2 | 1−3 | 1−4 | 2−1 |
|---|---|---|---|---|---|
| 128/1024→132/1024 | 128/1024 | 129/1024 | 130/1024 | 131/1024 | 132/1024 |
| 128/1024→130/1024 | 128/1024 | 128/1024 | 129/1024 | 129/1024 | 130/1024 |
| 128/1024→136/1024 | 128/1024 | 130/1024 | 132/1024 | 134/1024 | 136/1024 |

Fig. 107

| | 1 | 2 | 3 | 4 | 5 | 6 | 7 | 8 |
|---|---|---|---|---|---|---|---|---|
| A | 30.0/256 | 30.2/256 | 30.4/256 | 30.6/256 | 30.8/256 | 31.0/256 | 31.2/256 | 31.4/256 |
| B | 30.0/256 | 30.0/256 | 30.4/256 | 30.4/256 | 30.8/256 | 30.8/256 | 31.2/256 | 31.2/256 |
| C | 30.2/256 | 30.5/256 | 30.0/256 | 30.5/256 | 31.0/256 | 30.5/256 | 31.0/256 | 31.5/256 |

Moving picture

Intermediate movie
(semi-movie)

Still picture

OEV2
H
L
Gate signal line 17b
Vgh
Vgl

OEV2
H
L
Gate signal line 17b
Vgh
Vgl

OEV2
H
L
Gate signal line 17b
Vgh
Vgl

OEV2
H
L
Gate signal line 17b
Vgh
Vgl

Fig. 110

0 Still picture

1 Semi-movie

2 Moving picture

| Frame | 1 | 2 | 3 | 4 | 5 | 6 | 7 | 8 | 9 | 10 | 11 | 12 |
|---|---|---|---|---|---|---|---|---|---|---|---|---|
| Movie/still picture level | 0 | 0 | 0 | 1 | 1 | 2 | 2 | 2 | 2 | 1 | 0 | 0 |
| No. of divisions | 1 | 1 | 1 | 10 | 10 | 30 | 50 | 50 | 50 | 30 | 1 | 1 |
| Duty ratio | 4/9 | 5/9 | 5/9 | 4/9 | 4/9 | 8/9 | 8/9 | 7/9 | 6/9 | 3/9 | 3/9 | 4/9 |

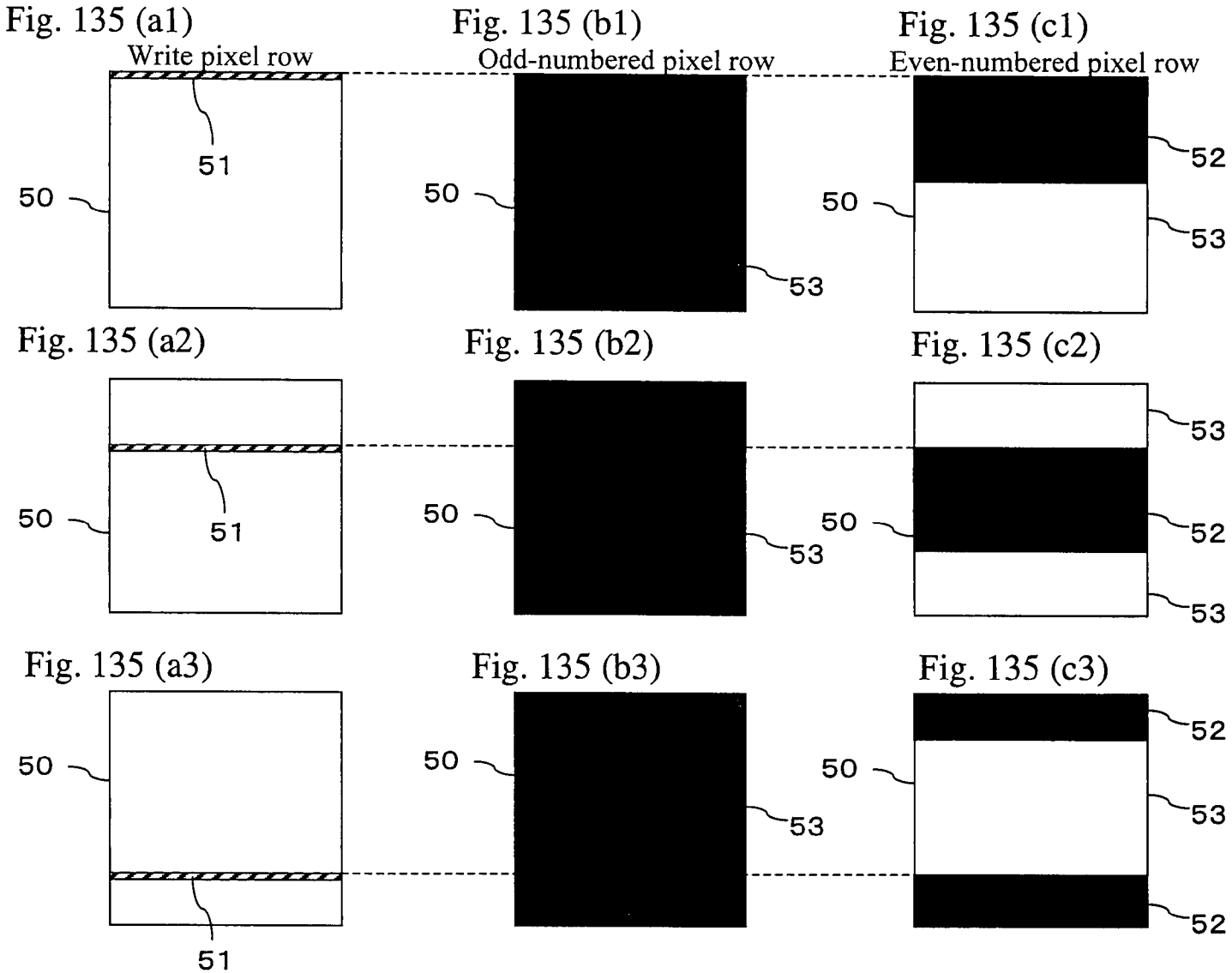
Fig. 135 (a1)
Write pixel row
51
50
Fig. 135 (b1)
Odd-numbered pixel row
53
50
Fig. 135 (c1)
Even-numbered pixel row
52
53
50
Fig. 135 (a2)
51
50
Fig. 135 (b2)
53
50
Fig. 135 (c2)
53
52
53
50
Fig. 135 (a3)
51
50
Fig. 135 (b3)
53
50
Fig. 135 (c3)
52
53
52
50

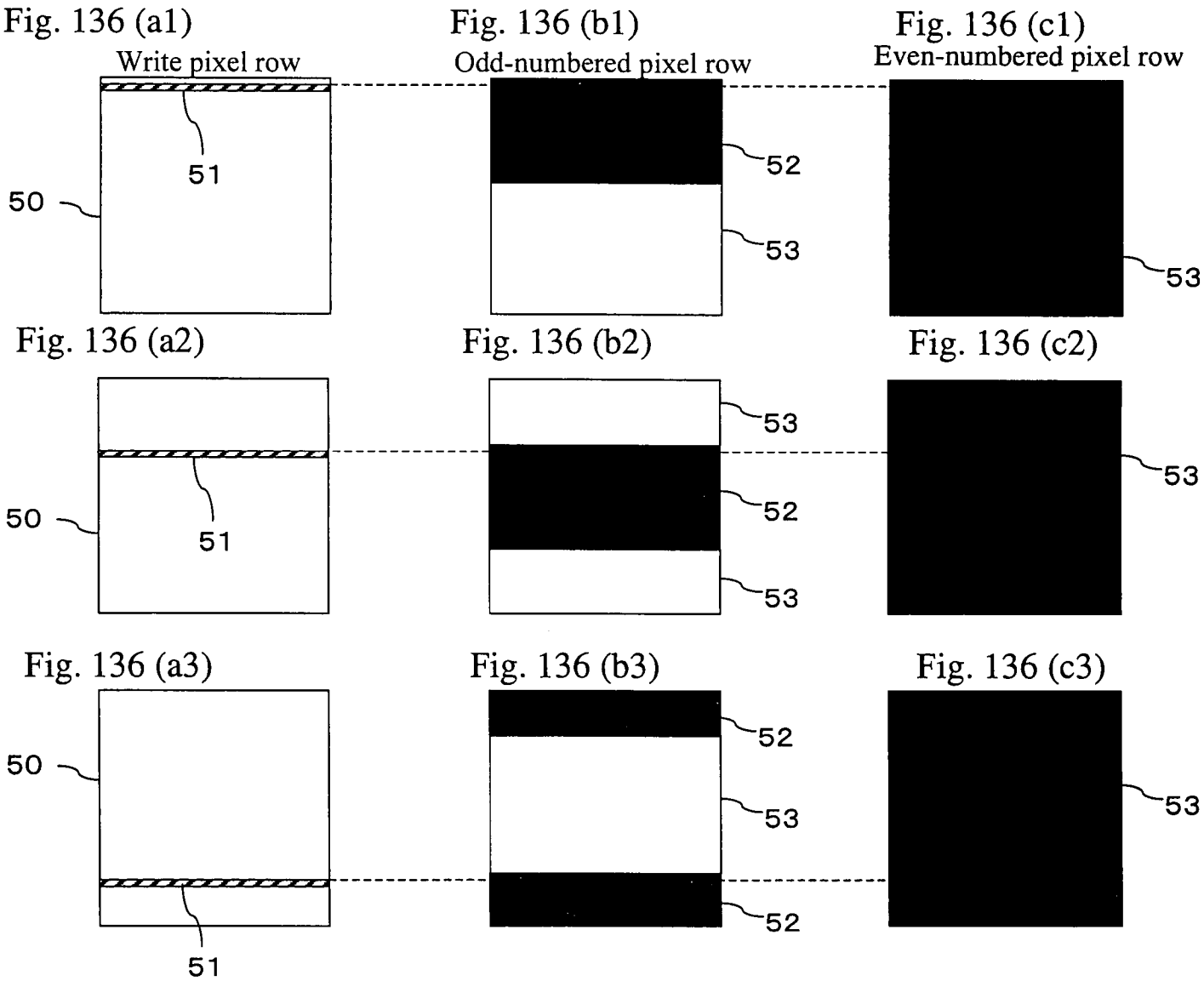
Fig. 136 (a1)
Write pixel row
51
50
Fig. 136 (b1)
Odd-numbered pixel row
52
53
Fig. 136 (c1)
Even-numbered pixel row
53
Fig. 136 (a2)
51
50
Fig. 136 (b2)
53
52
53
Fig. 136 (c2)
53
Fig. 136 (a3)
51
50
Fig. 136 (b3)
52
53
52
Fig. 136 (c3)
53

(a1)
(a2)
(a3)
(b1)
(b2)
(b3)
50
51a
51b

Gate signal line 17b

Gate signal line 17b

Gate signal line 17b

DRIVE METHOD OF EL DISPLAY APPARATUS

TECHNICAL FIELD

The present invention relates to a self-luminous display panel such as an EL display panel which employs organic or inorganic electroluminescent (EL) elements as well as to a drive circuit (IC) for the display panel. Also, it relates to an information display apparatus and the like which employ the EL display panel, a drive method for the EL display panel, and the drive circuit for the EL display panel.

BACKGROUND ART

Generally, active-matrix display apparatus display images by arranging a large number of pixels in a matrix and controlling the light intensity of each pixel according to a video signal. For example, if liquid crystals are used as an electrochemical substance, the transmittance of each pixel changes according to a voltage written into the pixel. With active-matrix display apparatus which employ an organic electroluminescent (EL) material as an electrochemical substance, emission brightness changes according to current written into pixels.

In a liquid crystal display panel, each pixel works as a shutter, and images are displayed as a backlight is blocked off and revealed by the pixels or shutters. An organic EL display panel is of a self-luminous type in which each pixel has a light-emitting element. Consequently, organic EL display panels have the advantages of being more viewable than liquid crystal display panels, requiring no backlighting, having high response speed, etc.

Brightness of each light-emitting element (pixel) in an organic EL display panel is controlled by an amount of current. That is, organic EL display panels differ greatly from liquid crystal display panels in that light-emitting elements are driven or controlled by current.

A construction of organic EL display panels can be either a simple-matrix type or active-matrix type. It is difficult to implement a large high-resolution display panel of the former type although the former type is simple in structure and inexpensive. The latter type allows a large high-resolution display panel to be implemented, but involves a problem that it is a technically difficult control method and is relatively expensive. Currently, active-matrix type display panels are developed intensively. In the active-matrix type display panel, current flowing through the light-emitting elements provided in each pixel is controlled by thin-film transistors (transistors) installed in the pixels.

Such an organic EL display panel of an active-matrix type is disclosed in Japanese Patent Laid-Open No. 8-234683. An equivalent circuit for one pixel of the display panel is shown in FIG. 46. A pixel 16 consists of an EL element 15 which is a light-emitting element, a first transistor 11*a*, a second transistor 11*b*, and a storage capacitance 19. The light-emitting element 15 is an organic electroluminescent (EL) element. According to the present invention, the transistor 11*a* which supplies (controls) current to the EL element 15 is referred to as a driver transistor 11. A transistor, such as the transistor 11*b* shown in FIG. 46, which operates as a switch is referred to as a switching transistor 11.

The organic EL element 15, in many cases, may be referred to as an OLED (organic light-emitting diode) because of its rectification. In FIG. 46 or the like, a diode symbol is used for the light-emitting element 15.

Incidentally, the light-emitting element 15 according to the present invention is not limited to an OLED. It may be of any type as long as its brightness is controlled by the amount of current flowing through the element 15. Examples include an inorganic EL element, a white light-emitting diode consisting of a semiconductor, atypical light-emitting diode, and a light-emitting transistor. Rectification is not necessarily required of the light-emitting element 15. Bidirectional diodes are also available. The EL element 15 according to the present invention may be any of the above elements.

In the example of FIG. 46, a source terminal (S) of the P-channel transistor 11*a* is designated as Vdd (power supply potential) and a cathode of the EL element 15 is connected to ground potential (Vk). On the other hand, an anode is connected to a drain terminal (D) of the transistor 11*a*. Besides, a gate terminal of the P-channel transistor 11*b* is connected to a gate signal line 17*a*, a source terminal is connected to a source signal line 18, and a drain terminal is connected to the storage capacitance 19 and a gate terminal (G) of the P-channel transistor 11*a*.

To drive the pixel 16, a video signal which represents brightness information is first applied to the source signal line 18 with the gate signal line 17*a* selected. Then, the transistor 11*b* conducts, the storage capacitance 19 is charged or discharged, and gate potential of the transistor 11*a* matches the potential of the video signal. When the gate signal line 17*a* is deselected, the transistor 11*a* is turned off and the transistor 11*b* is cut off electrically from the source signal line 18. However, the gate potential of the transistor 11*a* is maintained stably by the storage capacitance (capacitor) 19. Current delivered to the EL element 15 via the transistor 11*a* depends on gate-source voltage Vgs of the transistor 11*a* and the EL element 15 continues to emit light at an intensity which corresponds to the amount of current supplied via the transistor 11*d*.

Incidentally, the entire disclosure of the above document is incorporated herein in its entirety.

Since liquid crystal display panels are not self-luminous devices, there is a problem that they cannot display images without backlighting. Also, there has been a problem that a certain thickness is required to provide a backlight, which makes the display panel thicker. Besides, to display colors on a liquid crystal display panel, color filters must be used. Therefore, there has been a problem of the lowered usability of light. Also, there has been the problem of narrow color reproduction range.

Organic EL display panels are made of low-temperature polysilicon transistor arrays. However, since organic EL elements use current to emit light, there has been a problem that variations in the characteristics of the transistors will cause display irregularities.

The display irregularities can be reduced using current programming of pixels. For current programming, a current-driven driver circuit is required. However, with a current-driven driver circuit, variations will also occur in transistor elements which compose a current output stage. This in turn causes variations in gradation output currents from output terminals, making it impossible to display images properly.

DISCLOSURE OF THE INVENTION

To achieve this object, a driver circuit for an EL display panel (EL display apparatus) according to the present invention comprises a plurality of transistors which output unit currents and produces an output current by varying the number of transistors. Also, the driver circuit is characterized by comprising a multi-stage current mirror circuit. A transistor group which delivers signals via voltages is formed densely. Also, signals are delivered between the transistor group and current mirror circuit group via currents. Besides, reference currents are produced by a plurality of transistors.

A first invention of the present invention is a drive method of an EL display apparatus that comprises a switching element which turns on and off a current path between a driver transistor and an EL element, in each pixel, characterized in that the drive method comprises the steps of:

aggregating image data or data equivalent to image data; and turning off the switching element for a longer period if the aggregated data is large in amount than if the aggregated data is small in amount.

A second invention of the present invention is an EL display apparatus comprising:

a display panel in which EL elements are formed in a matrix; and a source driver circuit which supplies programming current to the display panel, characterized in that the source driver circuit comprises an output stage which has a plurality of unit current elements and a variable circuit which controls current flowing from the unit current elements.

A third invention of the present invention is a drive method of an EL display apparatus that comprises a moving-picture detection circuit which detects moving pictures and a feature extraction circuit which extracts features of video images, characterized in that the drive method of the EL display apparatus comprises:

a first step of changing the number of selected pixel rows depending on output data from the moving-picture detection circuit; and a second step of changing the number of selected pixel rows depending on output data from the feature extraction circuit.

A fourth invention of the present invention is an EL display apparatus which controls brightness of a screen using a ratio between non-display and display areas on the screen, characterized in that the EL display apparatus comprises:

the display area in which EL elements and driver transistors that drive the EL elements are formed in a matrix;

gate signal lines which transmit voltages that turn on and off the EL elements in each pixel row;

a gate driver circuit which drives the gate signal lines;

an aggregation circuit which aggregates image data or data equivalent to image data; and a conversion circuit which converts aggregation results produced by the aggregation circuit into a start pulse signal for the gate driver circuit.

A fifth invention of the present invention is a control method of an EL display apparatus which controls brightness of a screen using a ratio between non-display and display areas on the screen, characterized by generating a delay time when changing the ratio between the non-display and display areas on the screen from a first ratio to a second ratio.

A sixth invention of the present invention is the drive method of an EL display apparatus according to the fifth invention of the present invention, characterized in that the display area/(the non-display area+the display area on the screen) is from 1/16 to 1/1 both inclusive.

A seventh invention of the present invention is an EL display apparatus comprising:

a display panel in which each pixel contains a capacitor, an EL element, and a P-channel driver transistor which supplies current to the EL element and pixels are arranged in a matrix; and a source driver circuit which supplies programming current to the display panel, characterized in that the source driver circuit comprises an output stage which has an N-channel unit transistor that outputs a plurality of unit currents.

An eighth invention of the present invention is the EL display apparatus according to the seventh invention of the present invention, characterized in that if capacitance of a capacitor is Cs (pF) and one pixel occupies an area of S (square μm), a condition $500/S \leqq Cs \leqq 20000/S$ is satisfied.

A ninth invention of the present invention is the EL display apparatus according to the seventh invention of the present invention, characterized in that if pixel size is A (square mm) and predetermined white raster display brightness is B (nt), where the programming current I (μA) from the source driver circuit satisfies a condition $(A \times B)/20 \leqq I \leqq (A \times B)$.

A tenth invention of the present invention is the EL display apparatus according to the seventh invention of the present invention, characterized in that if the number of gradations is K and size of the unit transistor is S t(square μm), conditions $40 \leqq K/\sqrt{(St)}$ and $St \leqq 300$ are satisfied.

An eleventh invention of the present invention is the EL display apparatus according to the seventh invention of the present invention, characterized in that if the number of gradations is K, if channel length of the unit transistor is L (μm), and if channel width is W (μm), a condition $(\sqrt{(K/16)}) \leqq L/W \leqq (\sqrt{(K/16)}) \times 20$ is satisfied.

A twelfth invention of the present invention is an EL display apparatus comprising:

a first EL display panel which has a first display screen;

a second EL display panel which has a second display screen; and a flexible board which connects source signal lines of the first EL display panel with source signal lines of the second EL display panel, characterized in that if channel width of driver transistors which drive pixels is W (μm) and channel length is L (μm), W/L differs between the driver transistor which drives pixels in the first display screen and the driver transistor which drives pixels in the second display screen.

BRIEF DESCRIPTION OF THE DRAWINGS

FIG. 19 is an explanatory diagram illustrating a drive method of a display apparatus according to the present invention;

FIG. 30 is an explanatory diagram illustrating a drive method of a display apparatus according to the present invention;

FIG. 82 is an explanatory diagram illustrating a drive method of a display apparatus according to the present invention;

FIG. 103 is an explanatory diagram illustrating a drive method of a display panel according to the present invention;

FIG. 106 is an explanatory diagram illustrating a drive method of a display panel according to the present invention;

FIG. 107 is an explanatory diagram illustrating a drive method of a display panel according to the present invention;

FIG. 110 is an explanatory diagram illustrating a drive method of a display panel according to the present invention;

FIG. 120 is an explanatory diagram illustrating a drive circuit of a display apparatus according to the present invention;

FIG. 121 is an explanatory diagram illustrating a drive circuit of a display apparatus according to the present invention;

FIG. 122 is an explanatory diagram illustrating a drive circuit of a display apparatus according to the present invention;

FIG. 123 is an explanatory diagram illustrating a drive circuit of a display apparatus according to the present invention;

FIG. 124 is an explanatory diagram illustrating a drive circuit of a display apparatus according to the present invention;

FIG. 125 is an explanatory diagram illustrating a display apparatus according to the present invention;

FIG. 126 is an explanatory diagram illustrating a display apparatus according to the present invention;

FIG. 127 is an explanatory diagram illustrating a drive method of a display panel according to the present invention;

FIG. 128 is an explanatory diagram illustrating a drive method of a display panel according to the present invention;

FIG. 129 is an explanatory diagram illustrating a drive method of a display panel according to the present invention;

FIG. 130 is an explanatory diagram illustrating a drive method of a display panel according to the present invention;

FIG. 131 is an explanatory diagram illustrating a drive method of a display panel according to the present invention;

Figure 132:
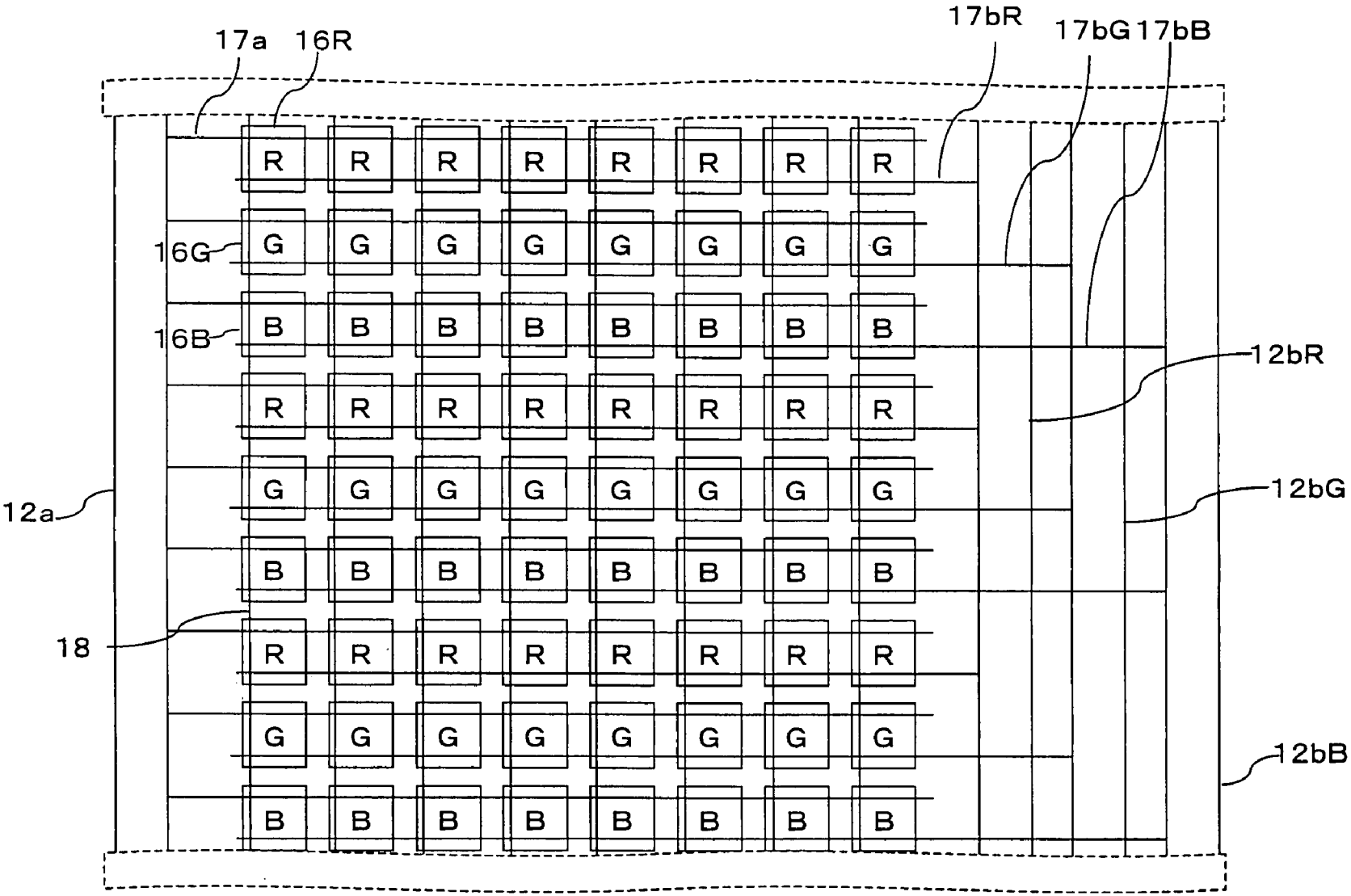
Figure 133:
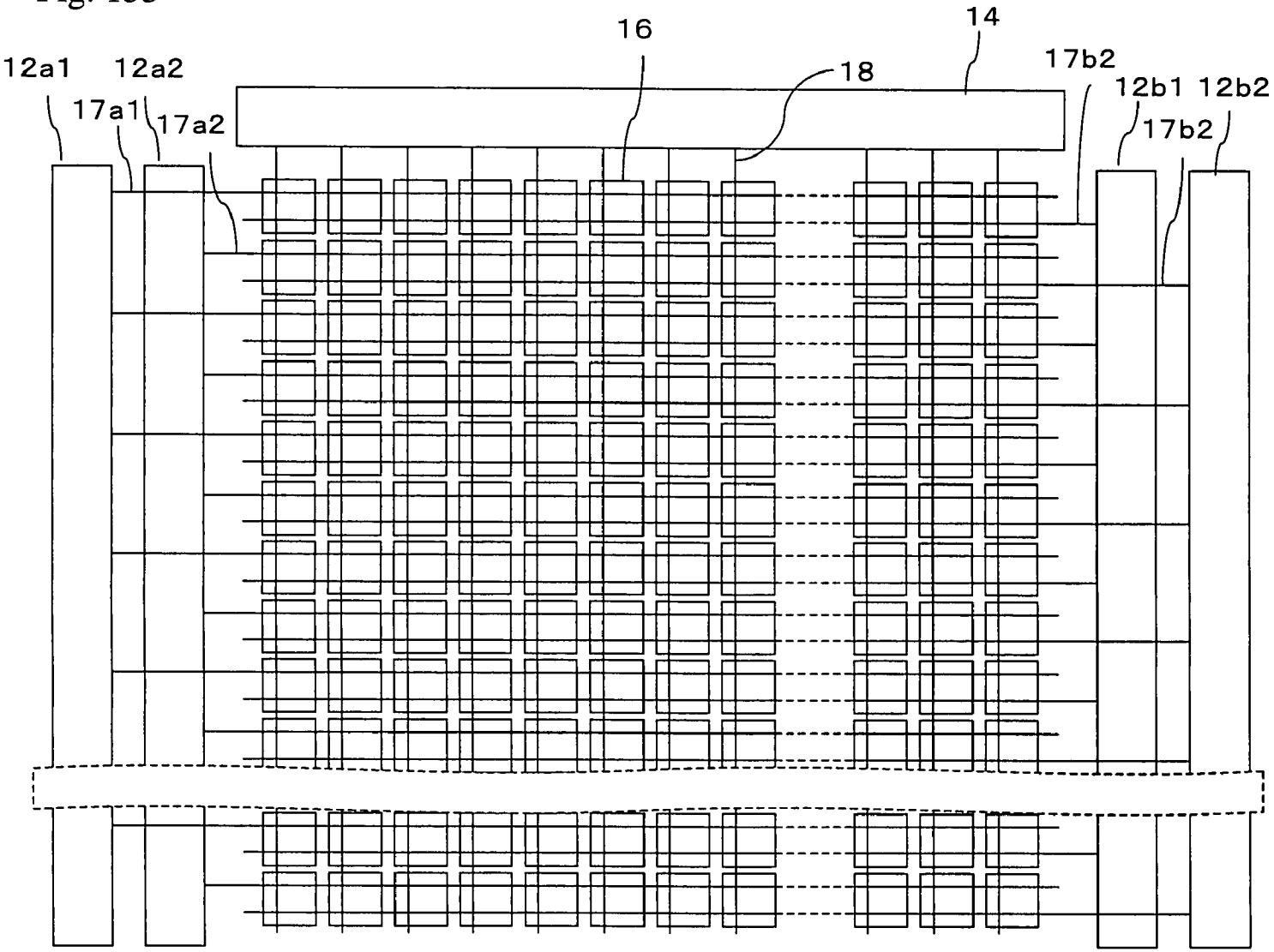
Figure 134A:
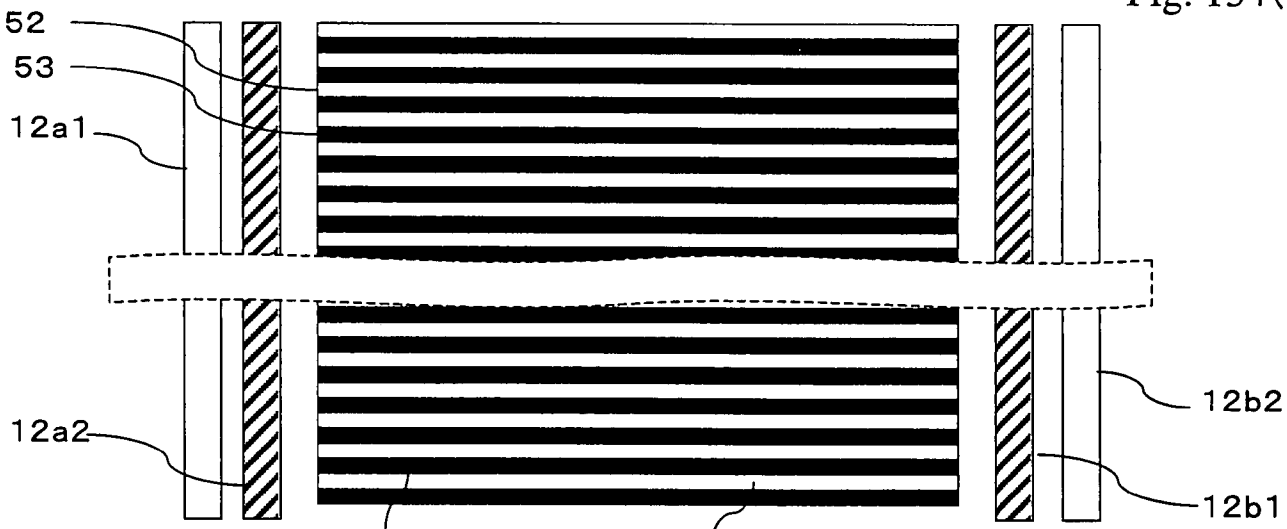
Figure 134B:
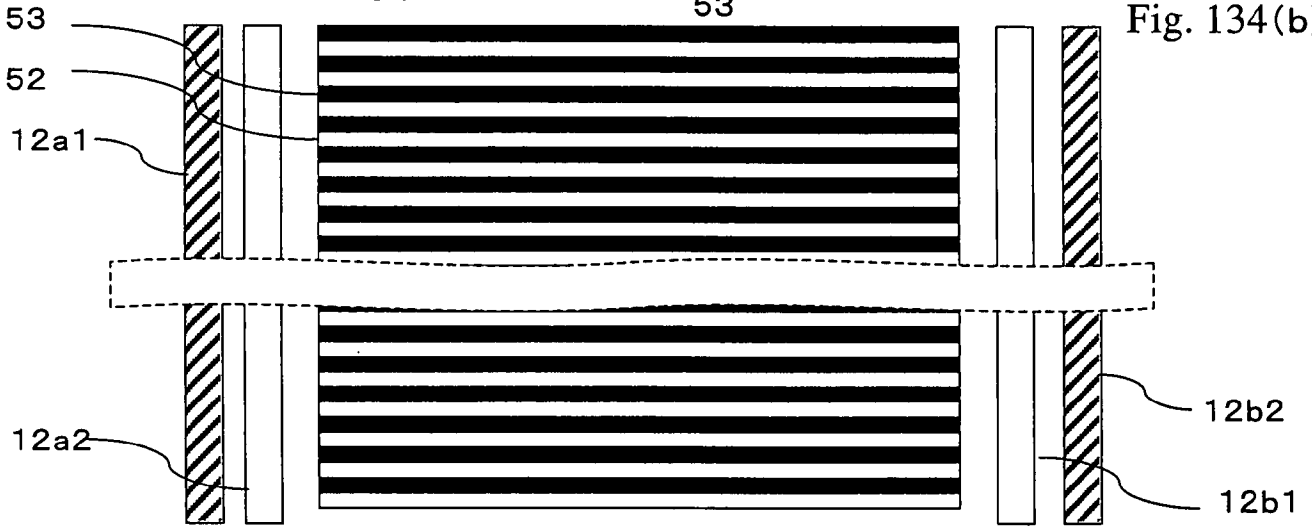
Figure 137:
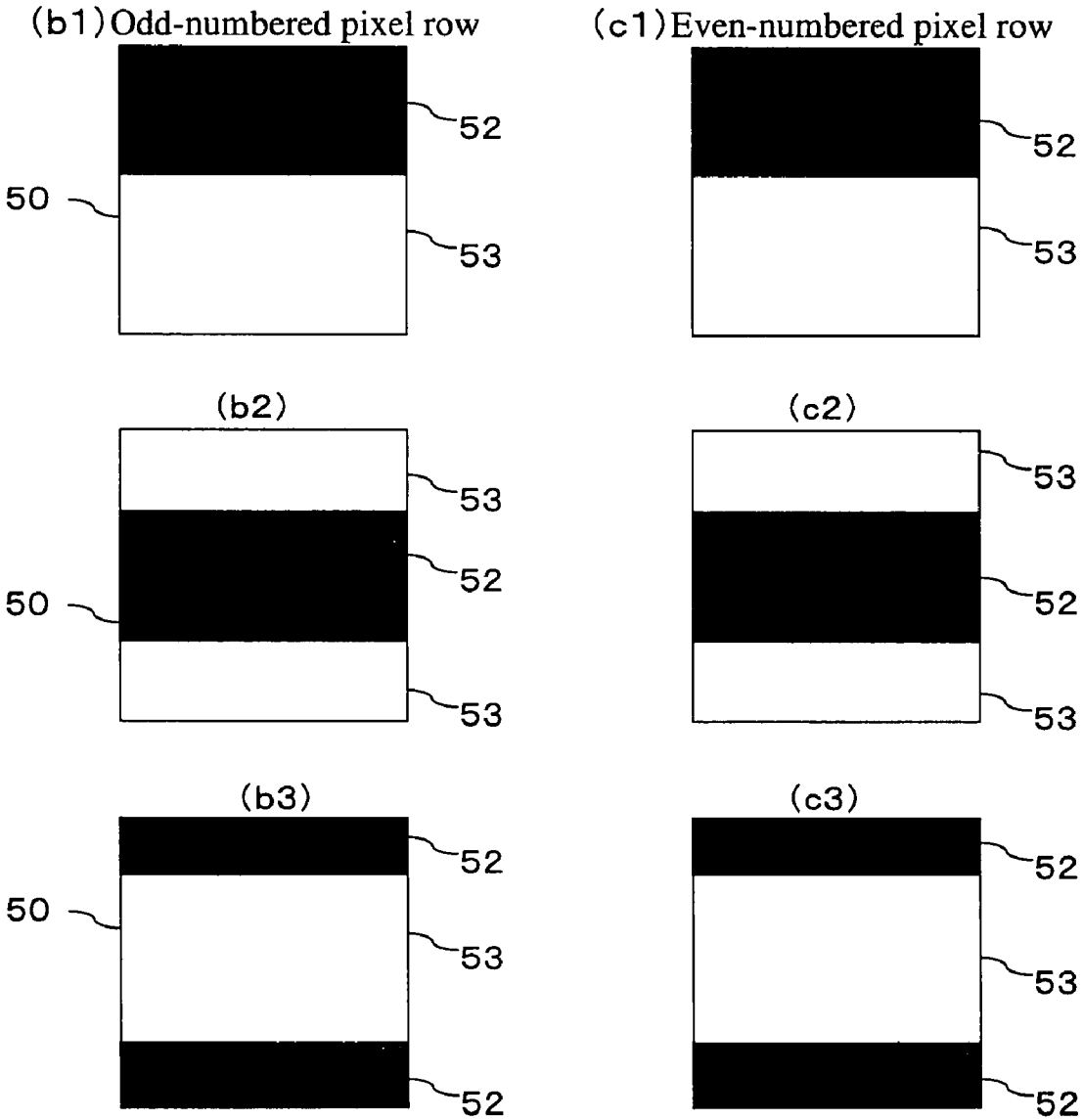
Figure 138:
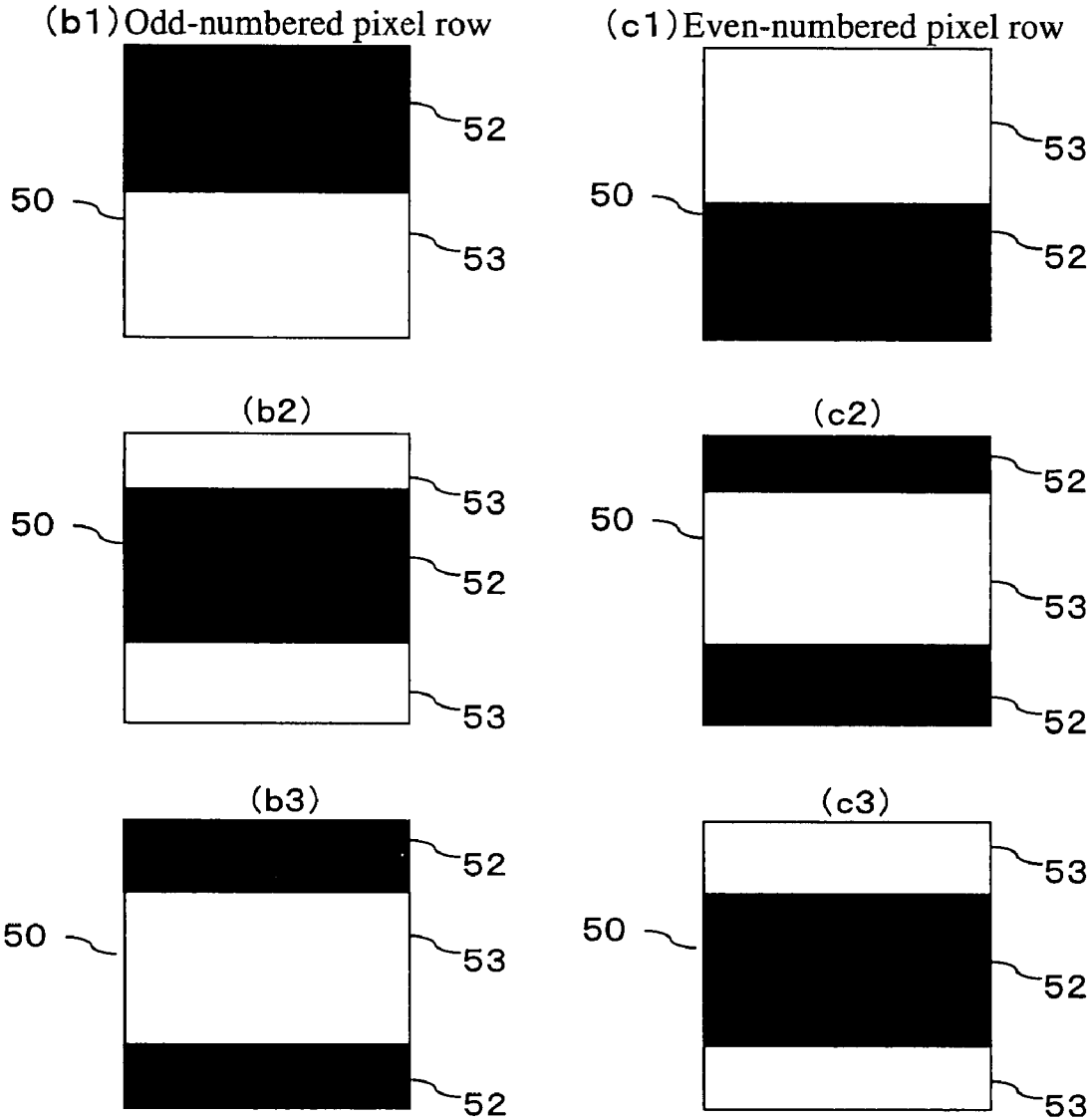
Figure 139:
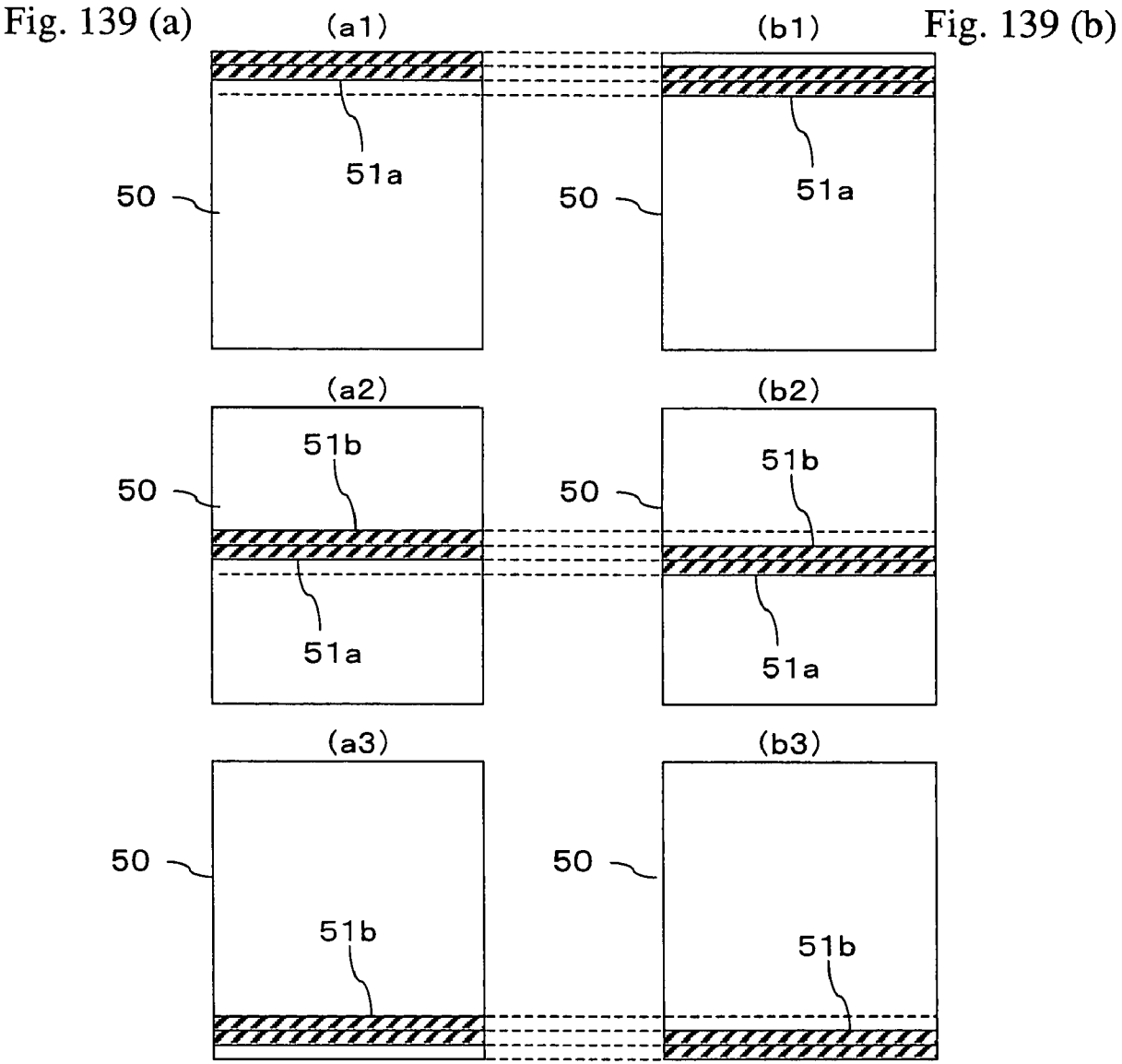
Figure 140:
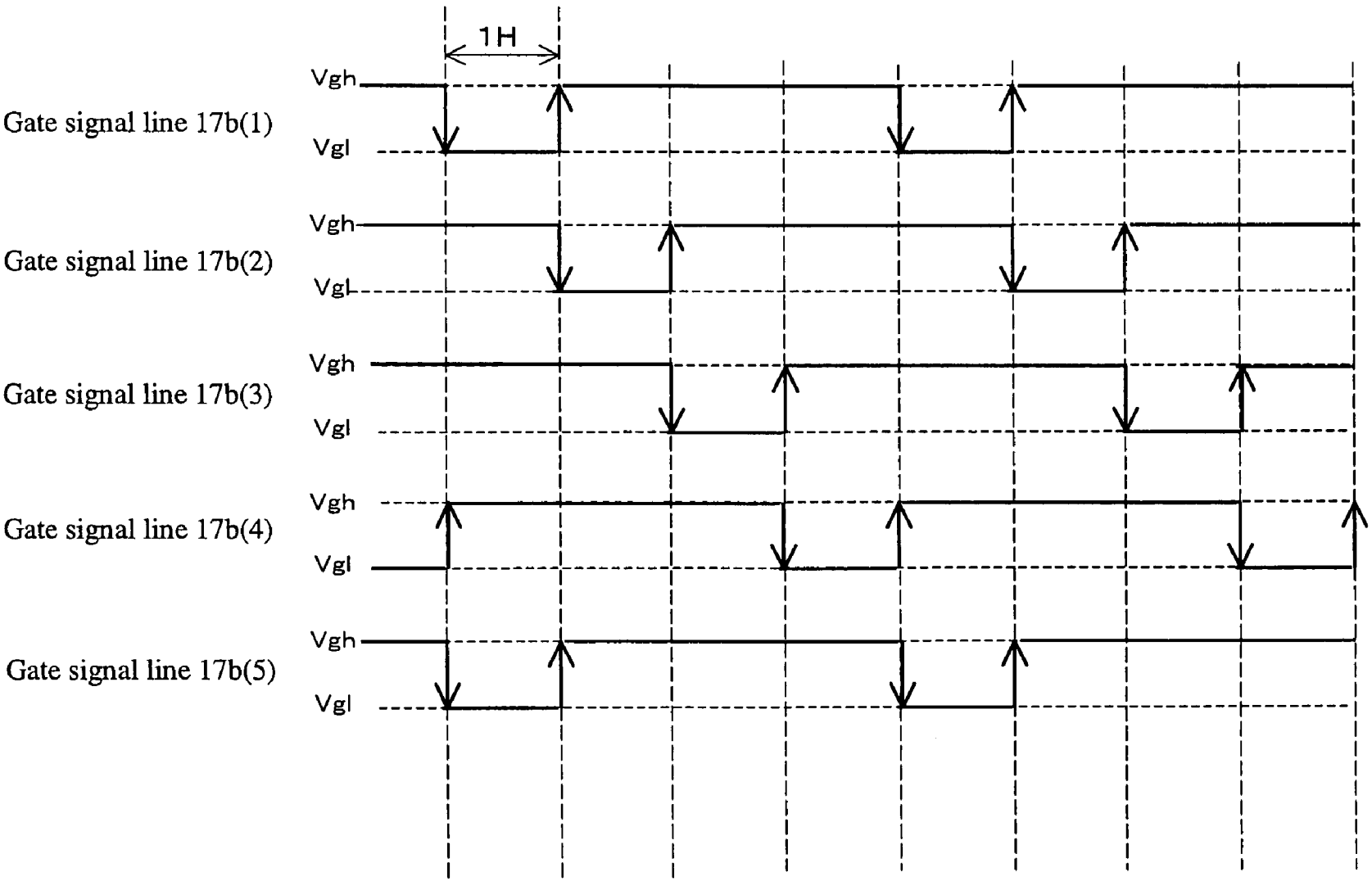
Figure 141:
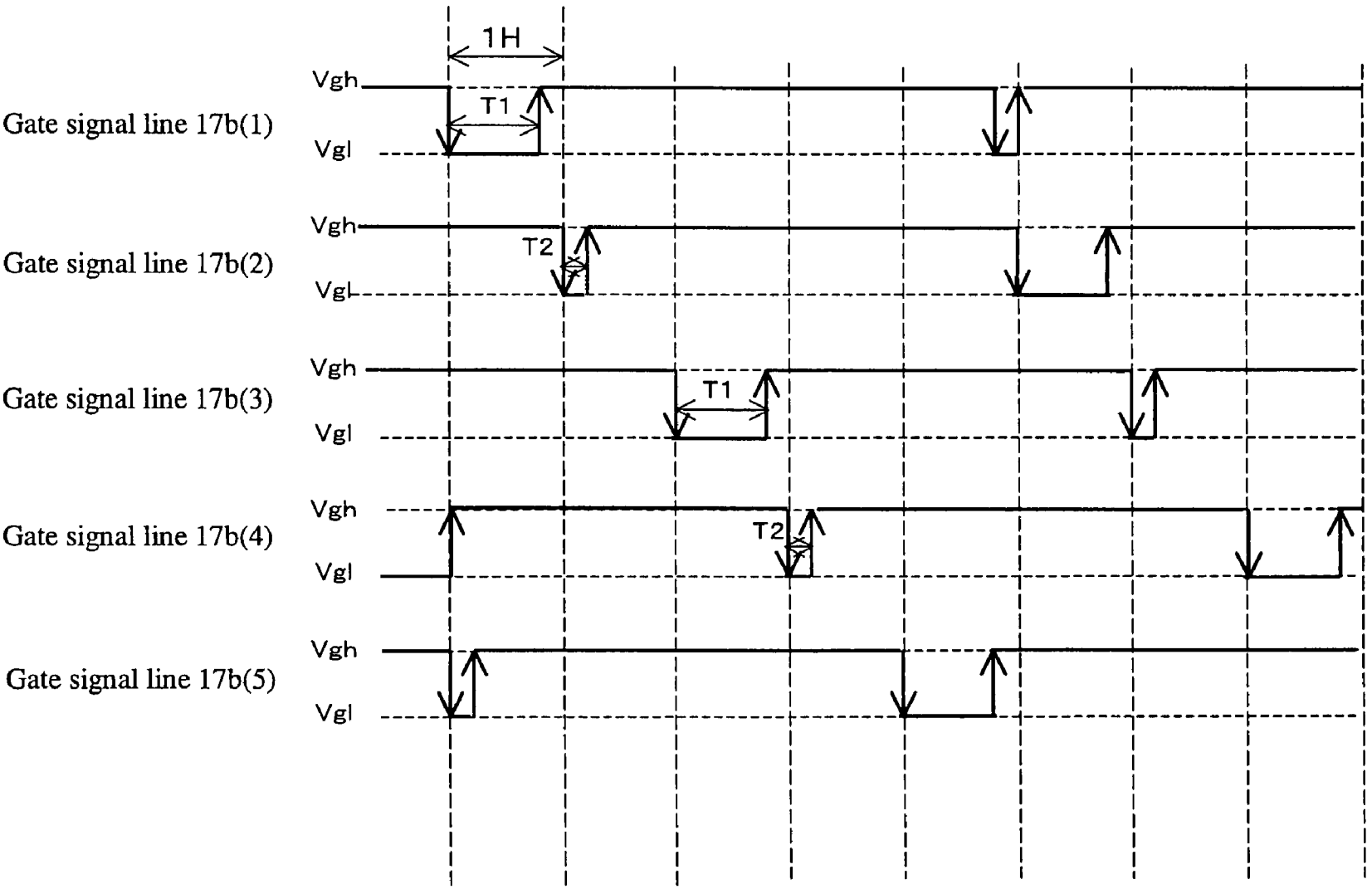
Figure 142:
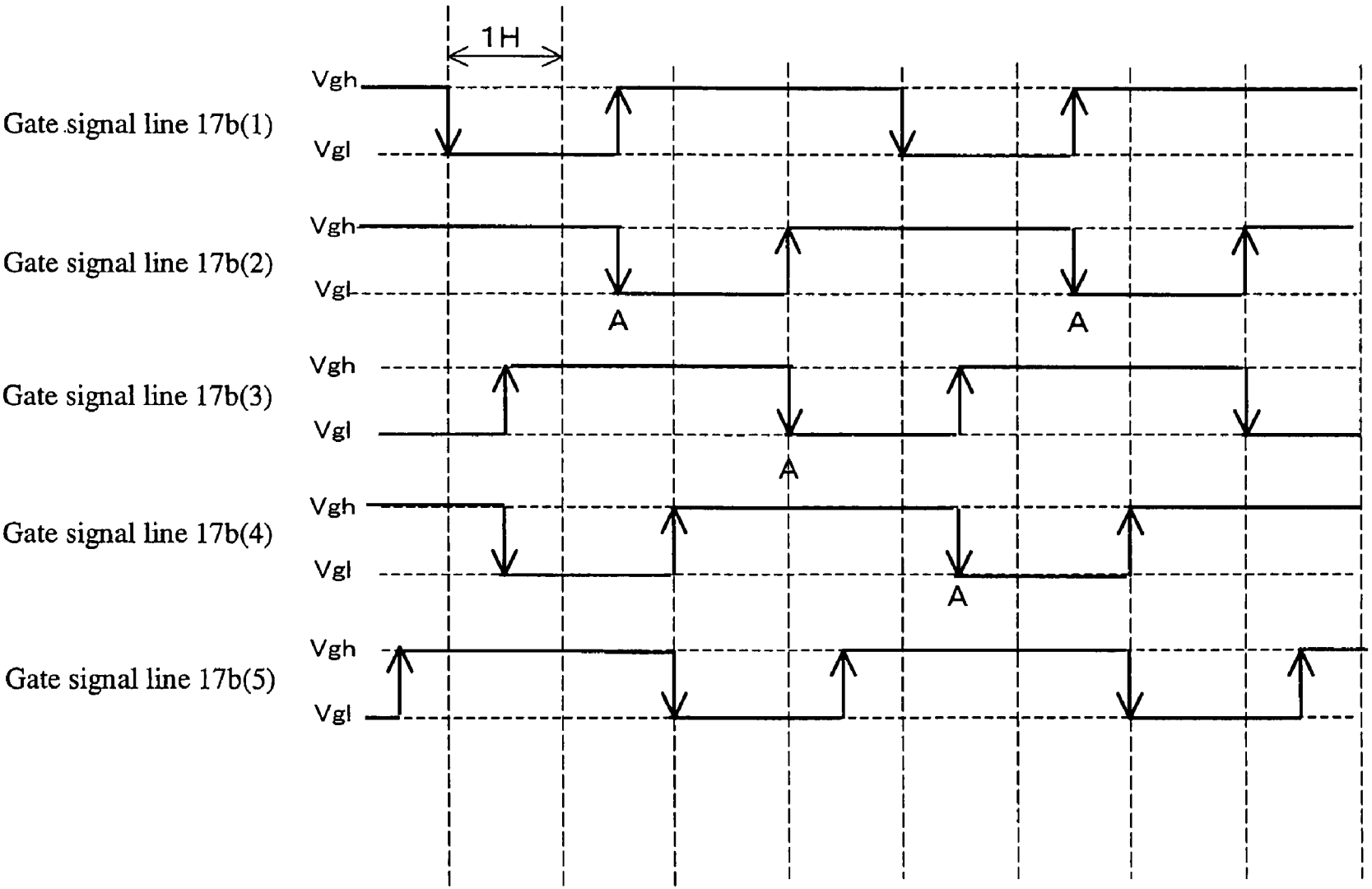
Figure 143:
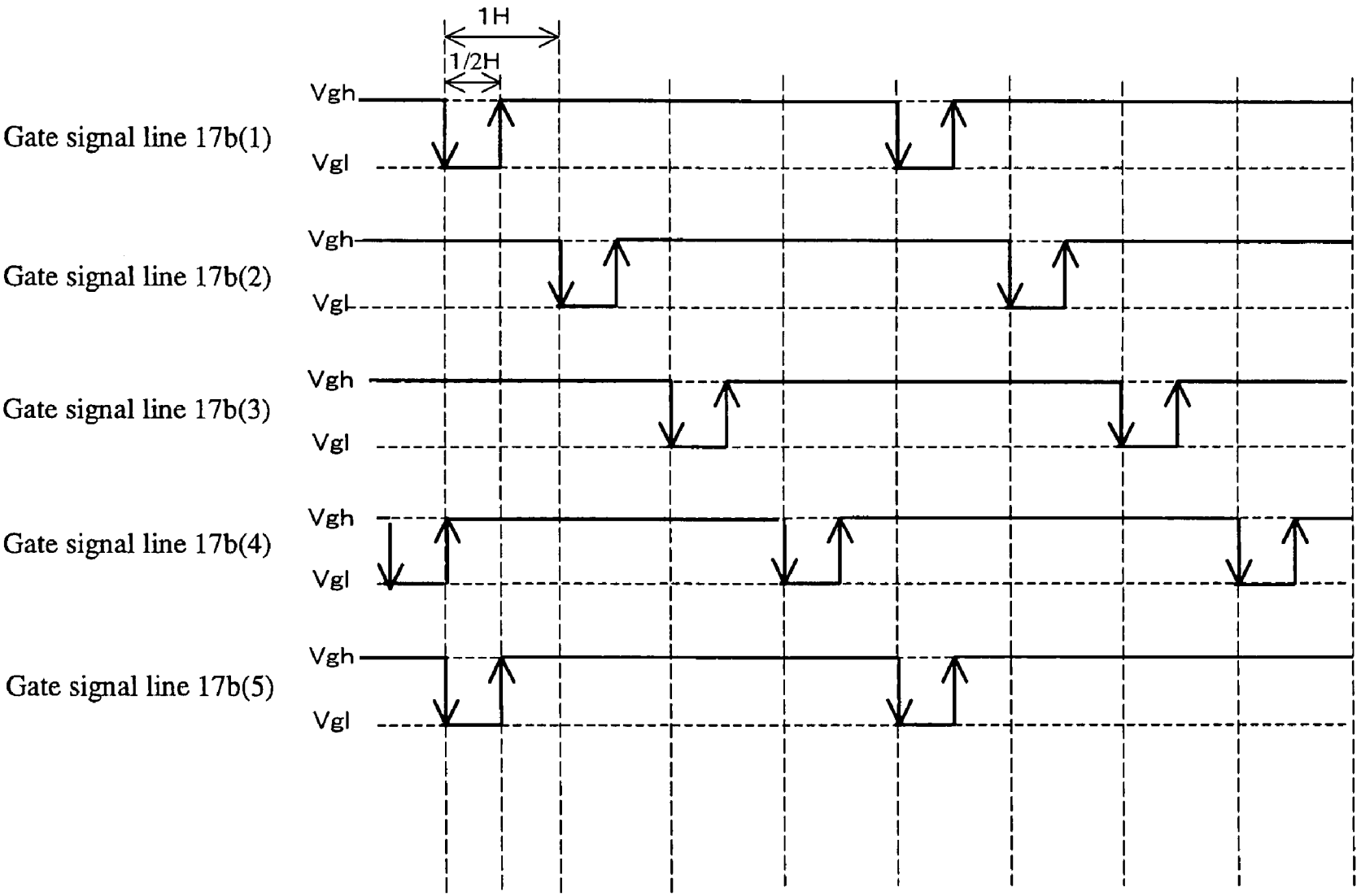
Figure 144:
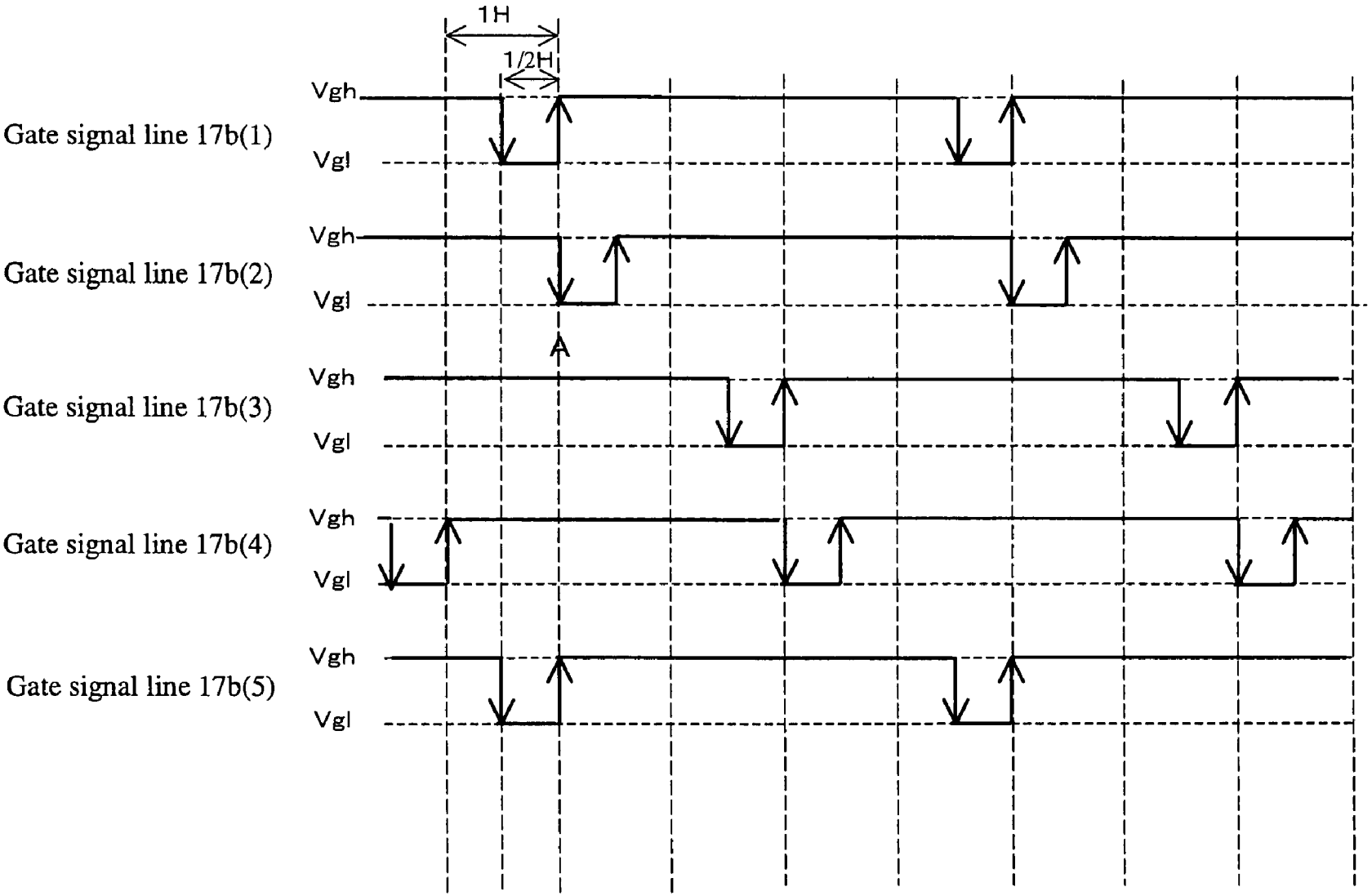
Figure 145:
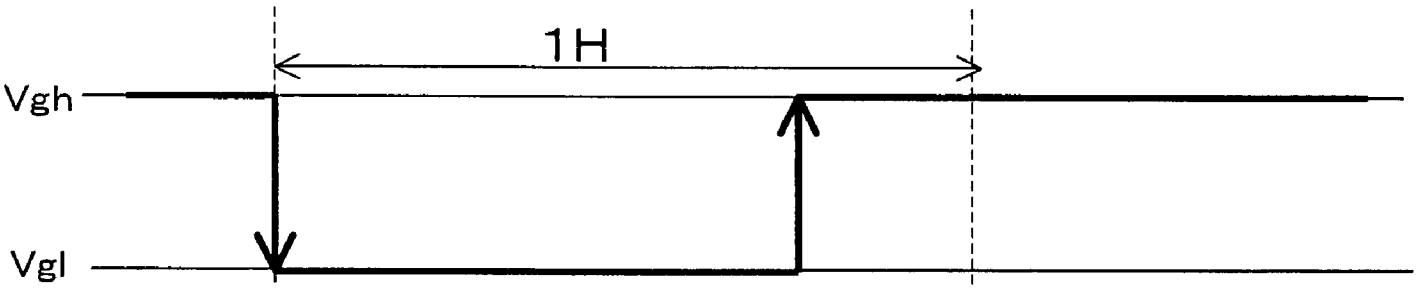
Figure 145:
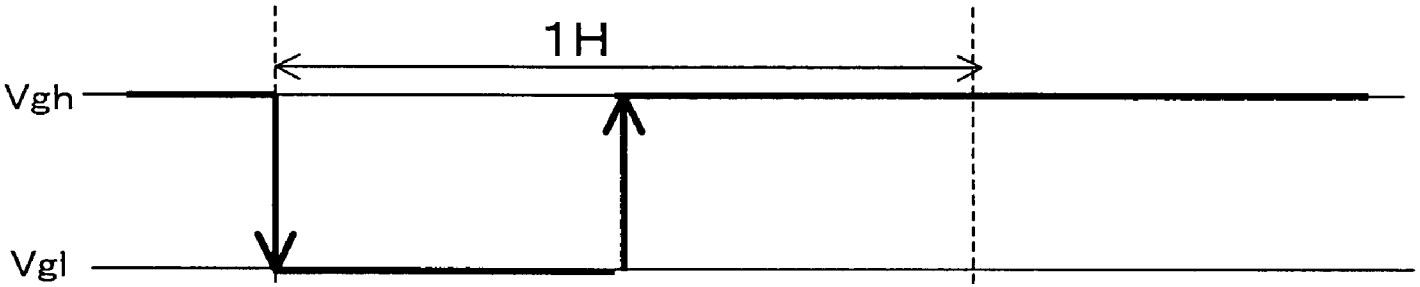
Figure 145:
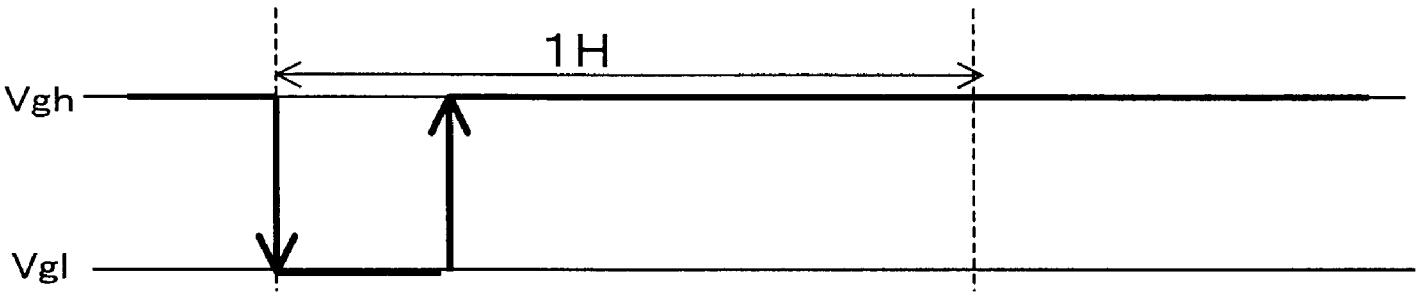
Figure 146:
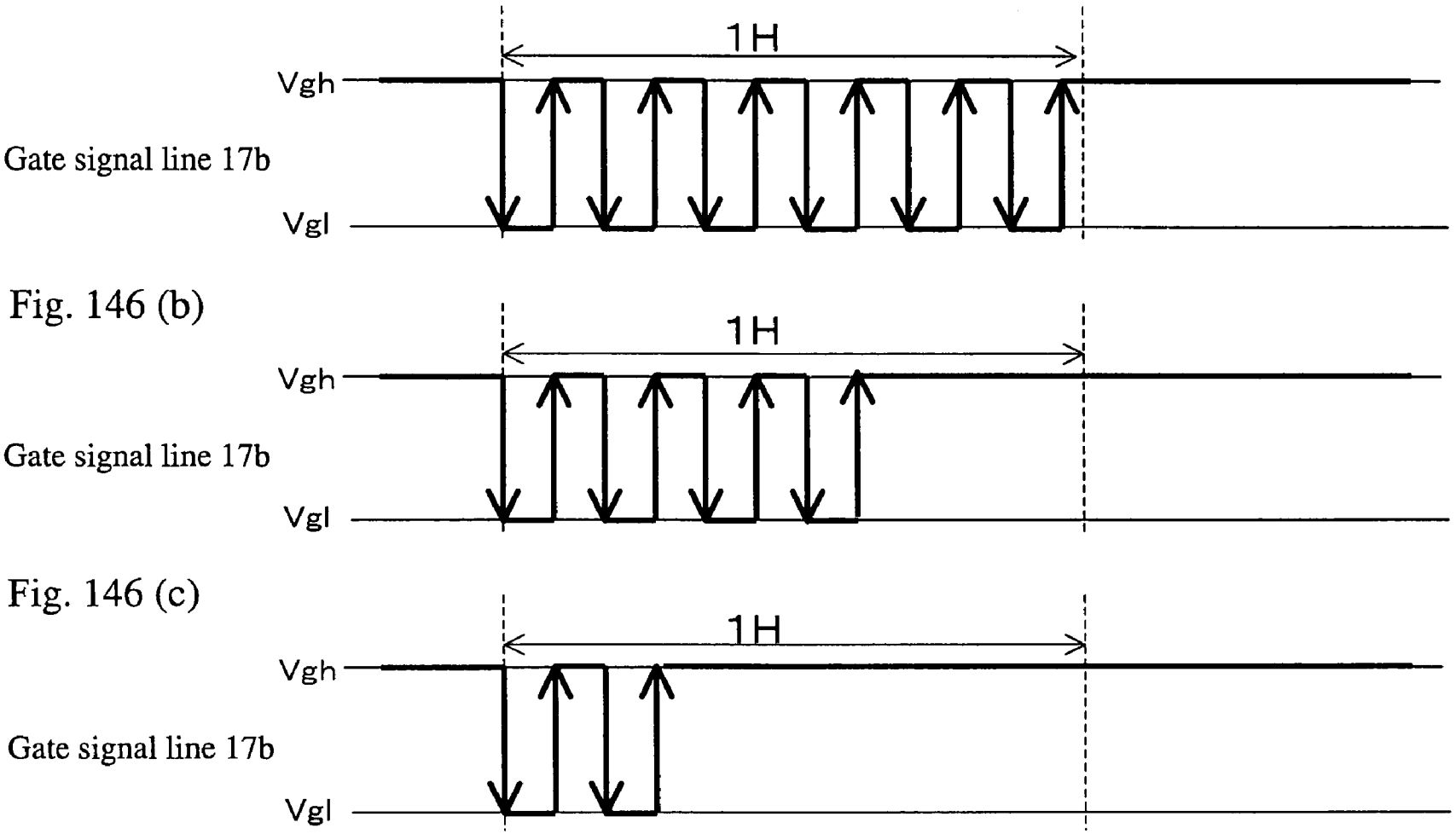
Figure 147:
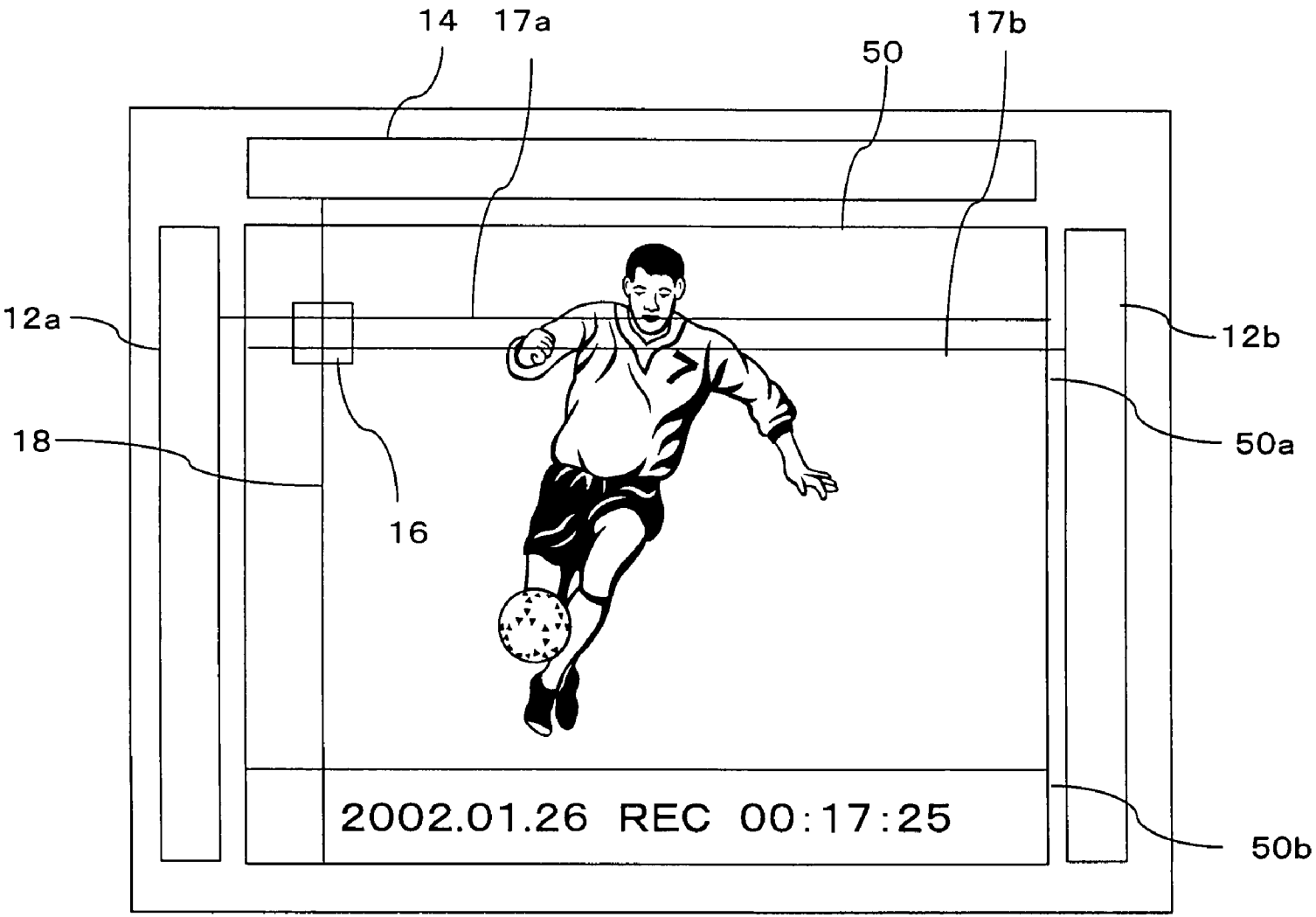
Figure 148:
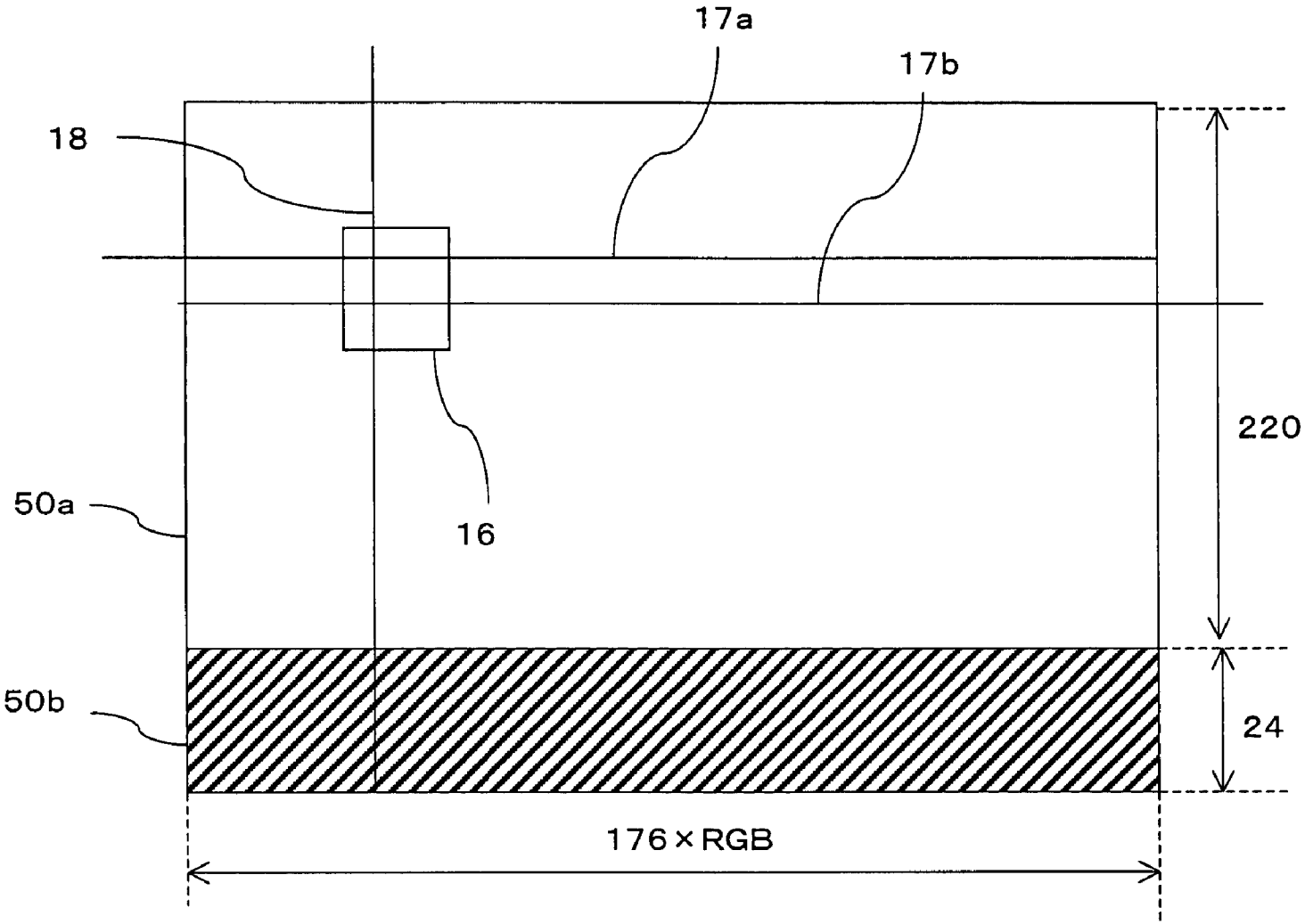
Figure 149:
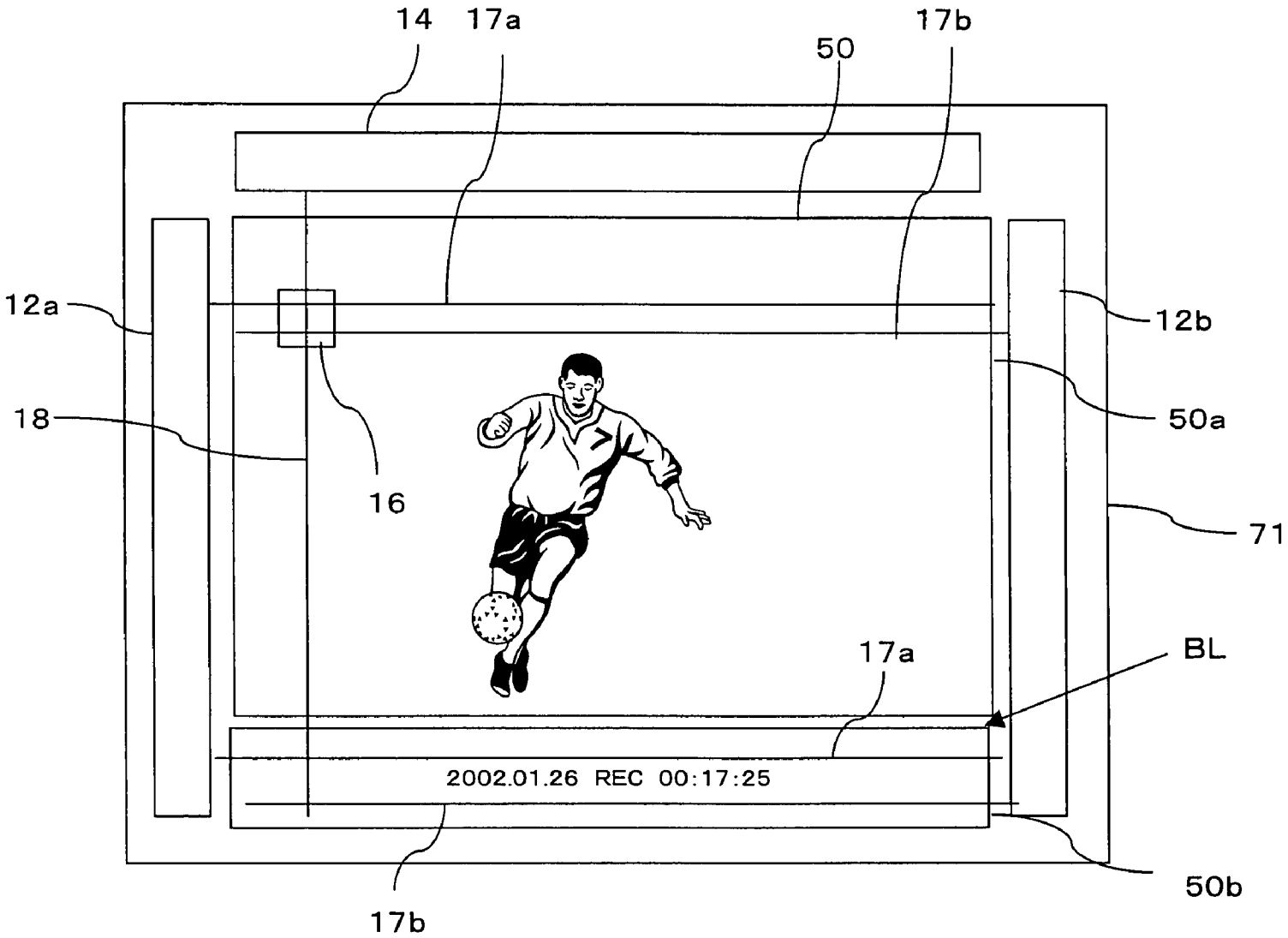
Figure 150B:
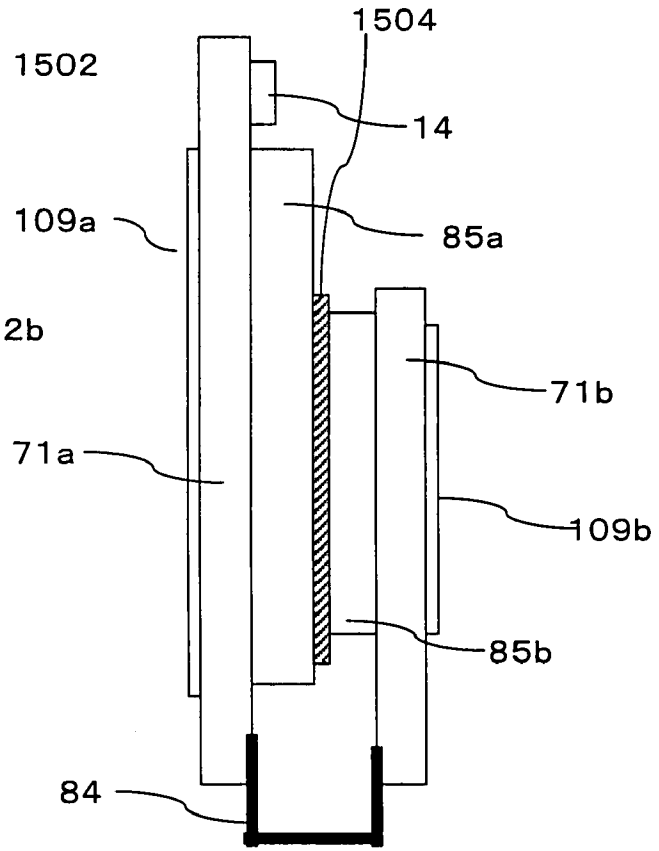
Figure 150A:
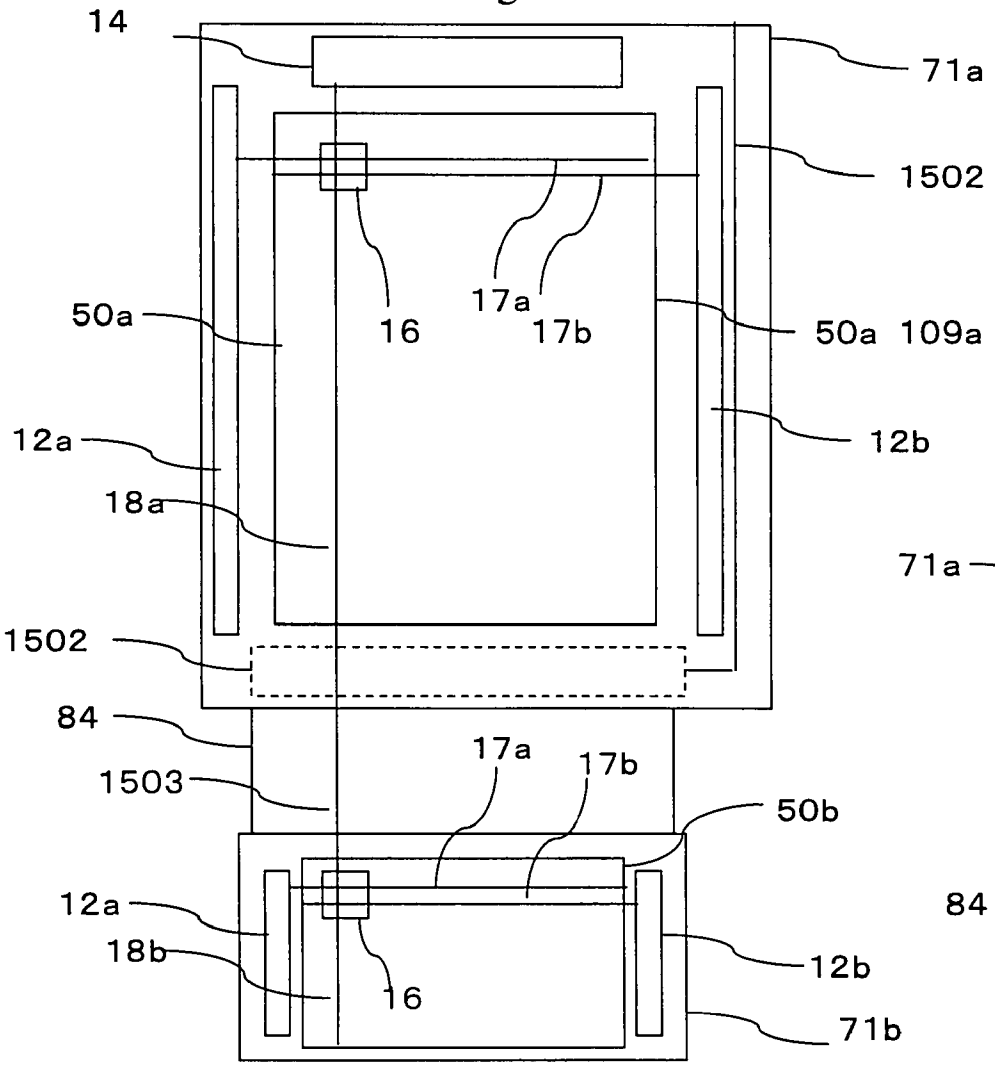
Figure 151:
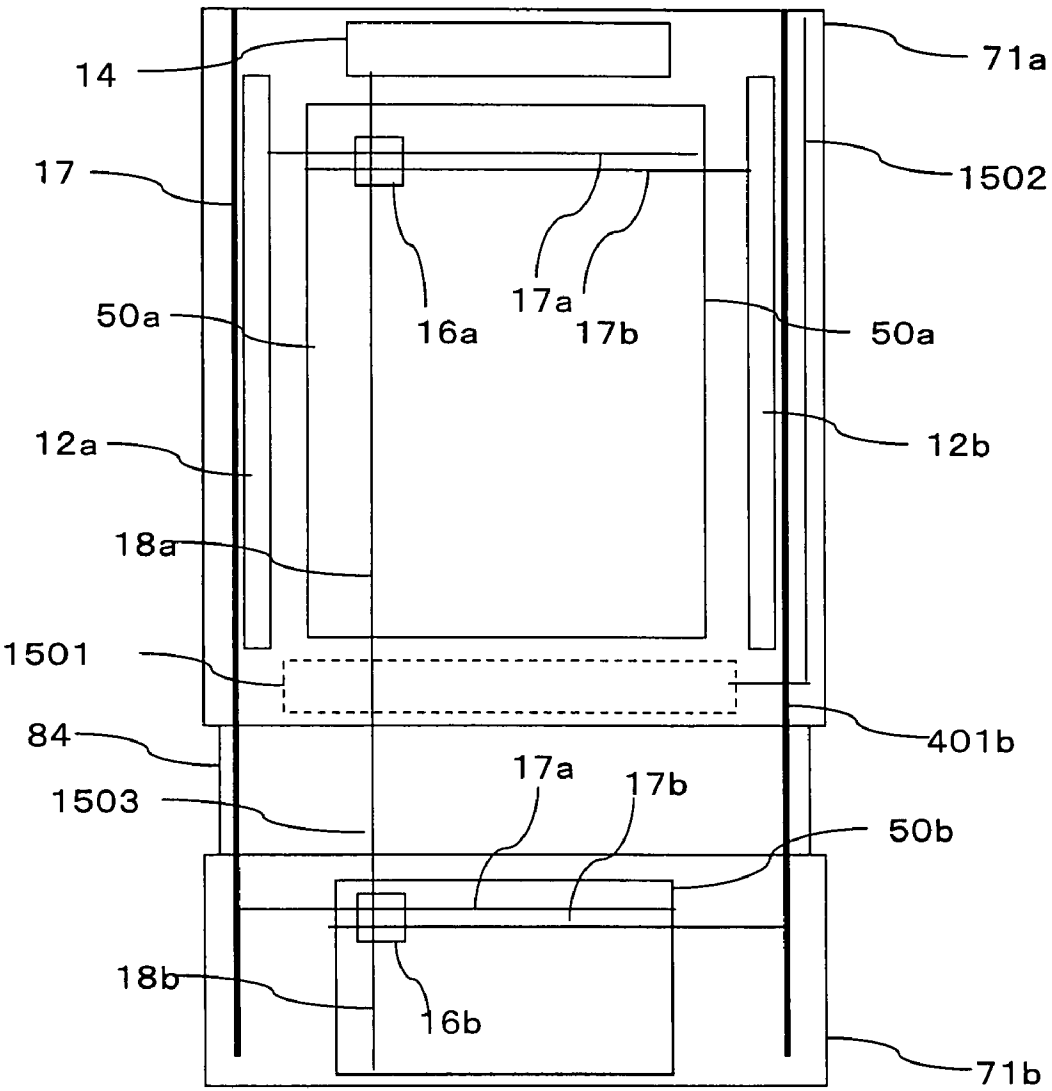
Figure 152:
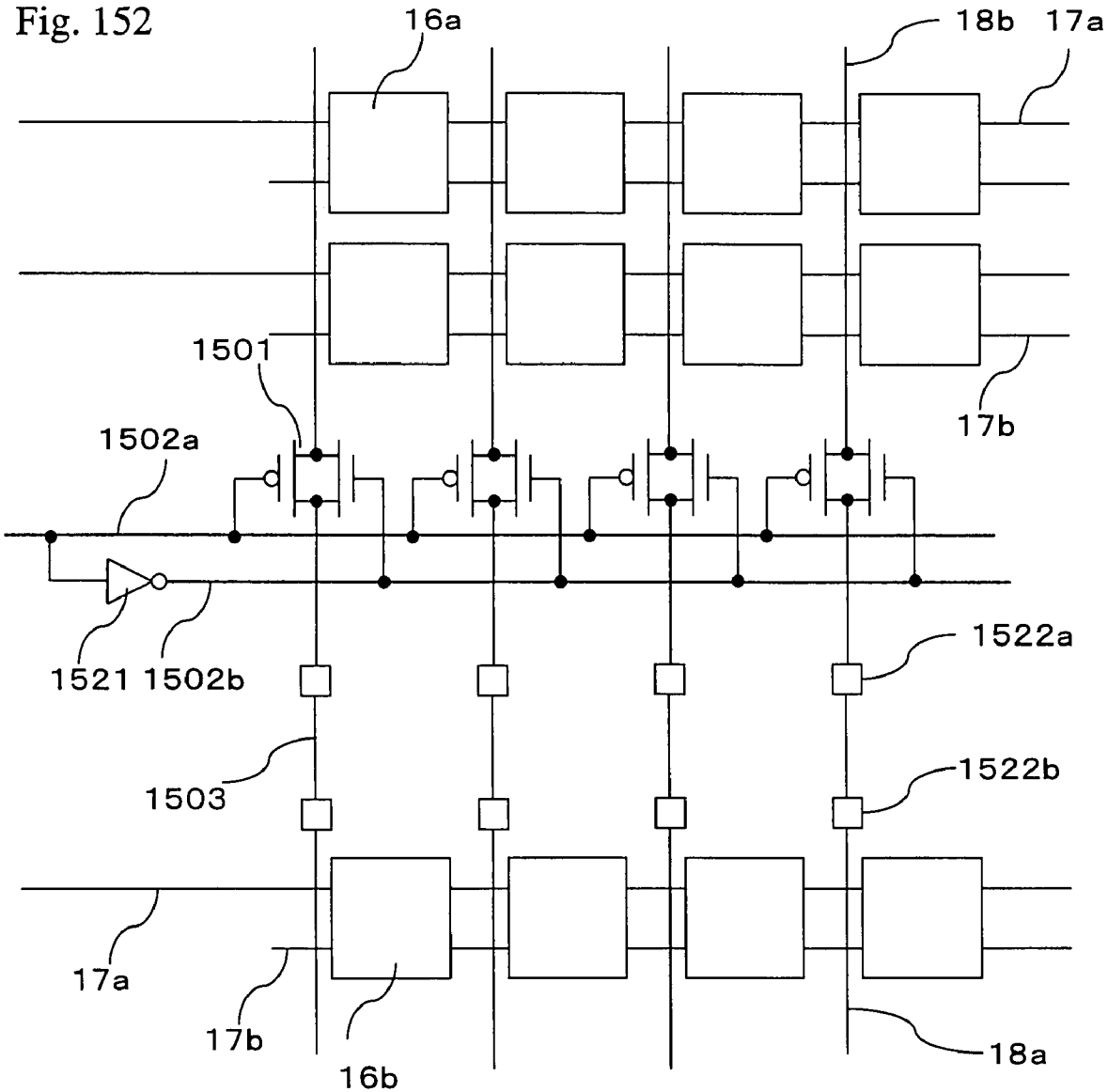
Figure 153:
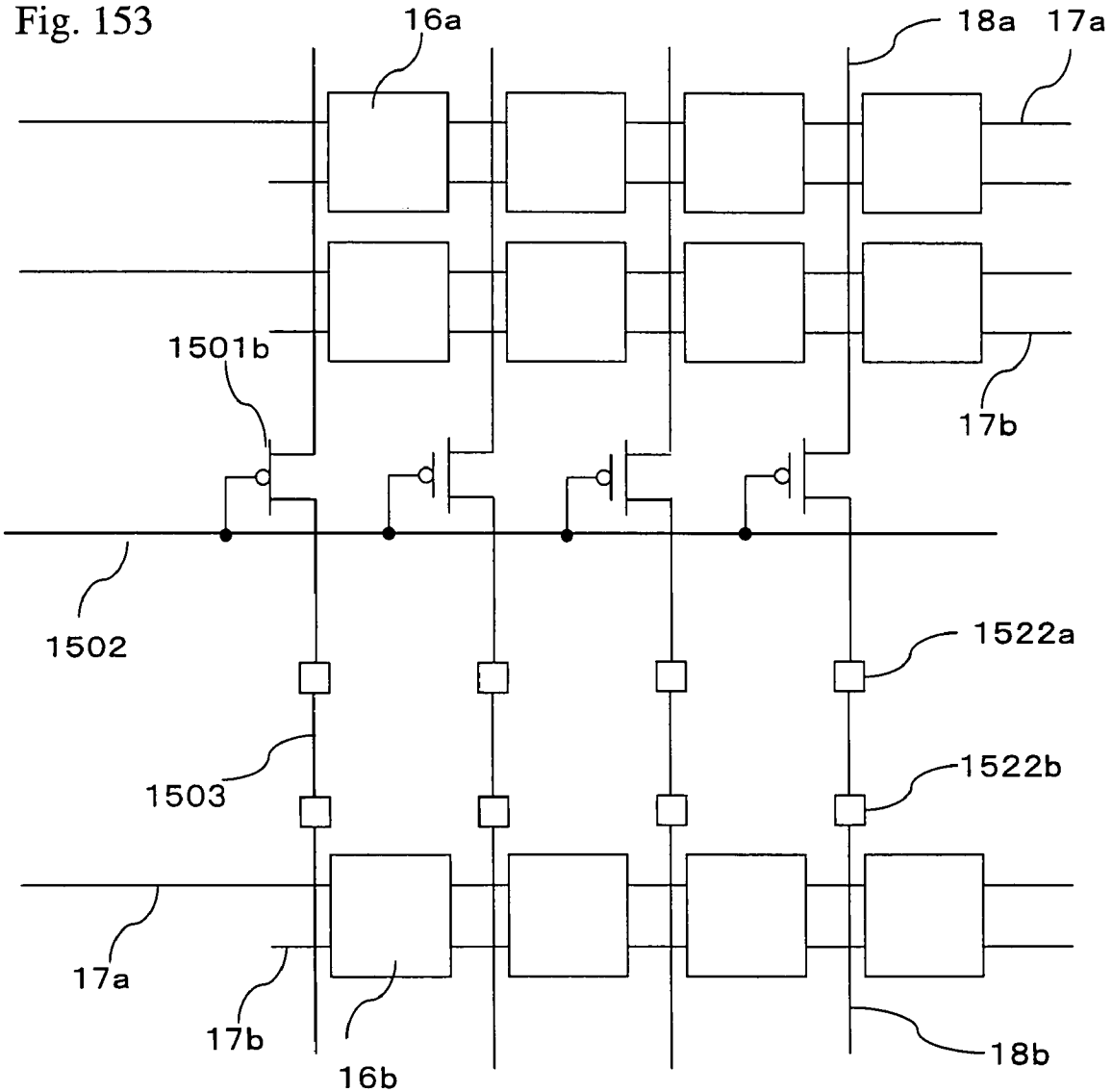
Figure 154:
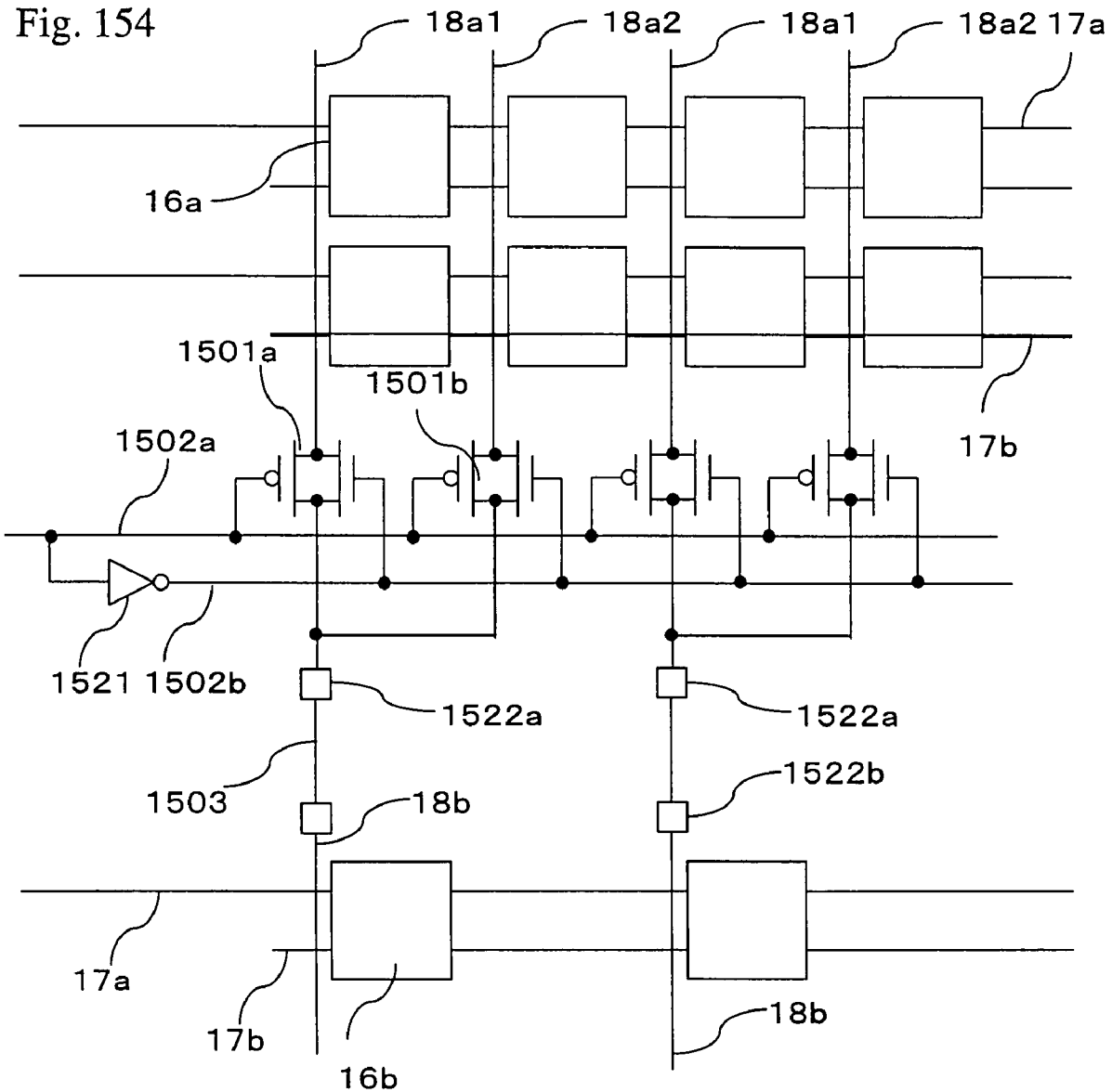
Figure 155:
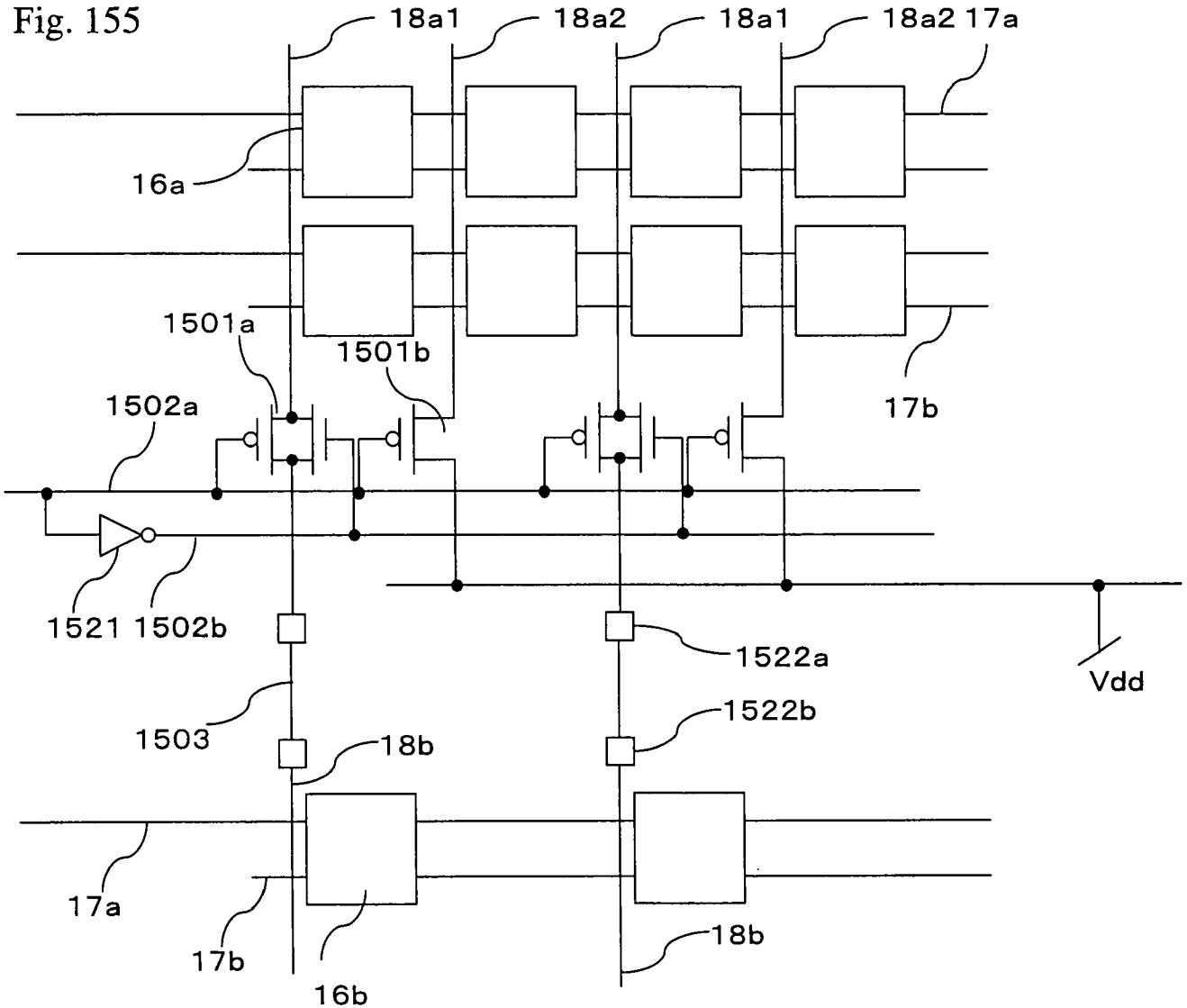
Figure 156:
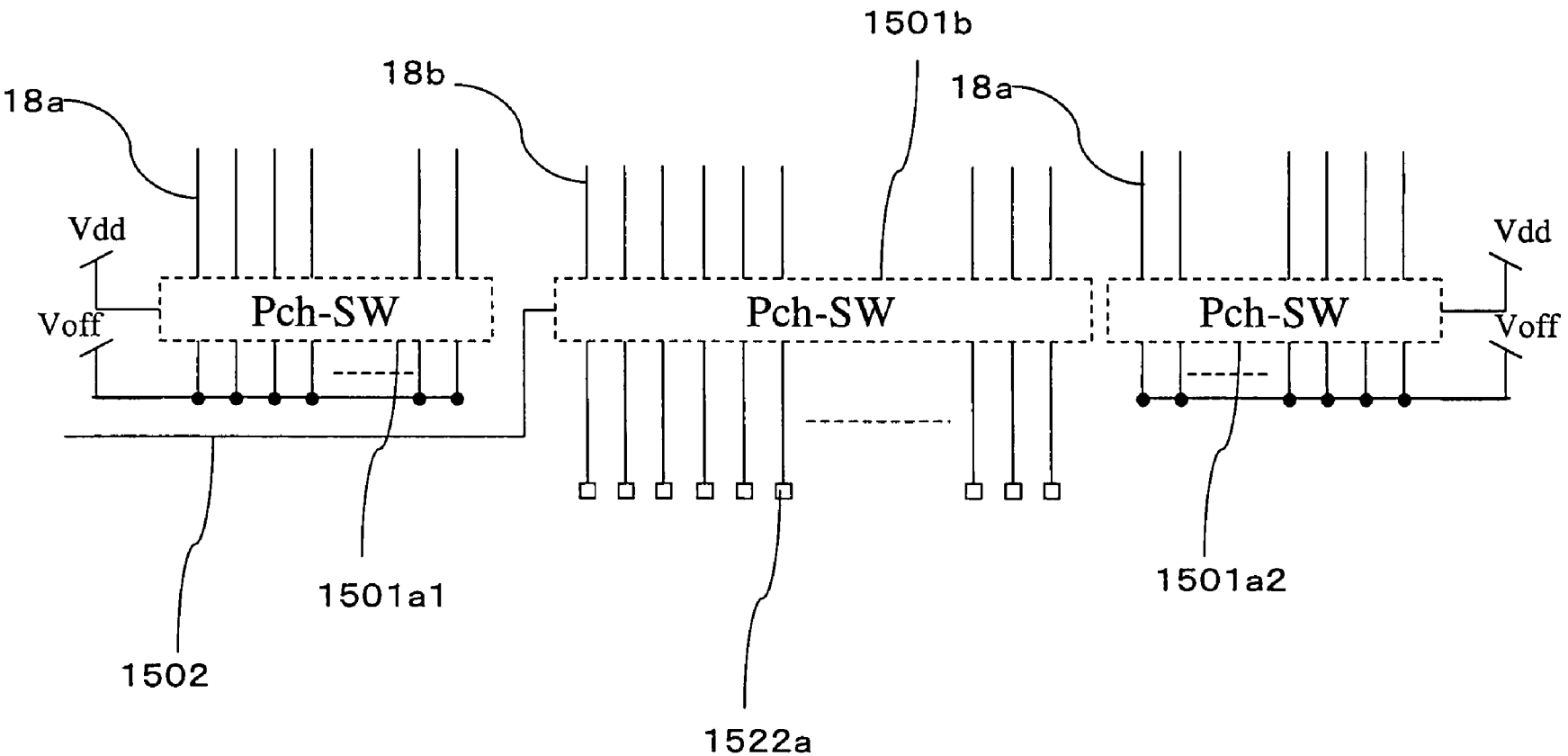
Figure 157:
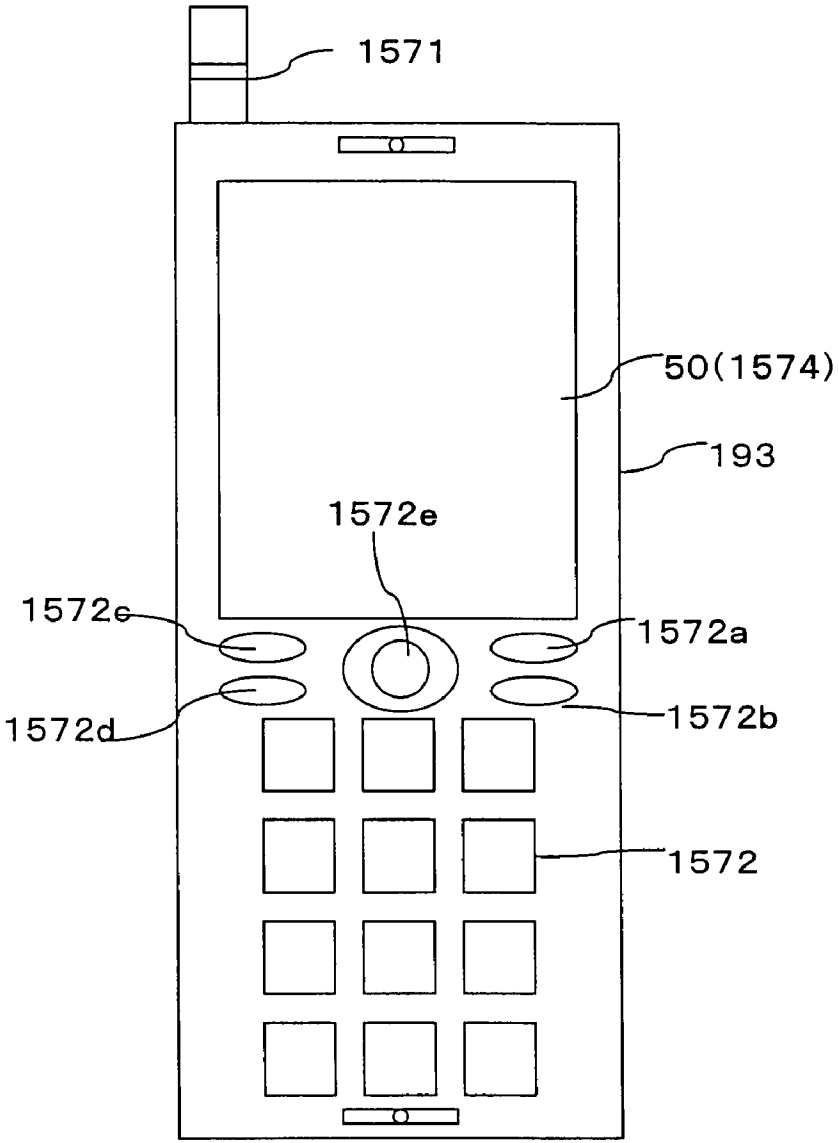
Figure 158:
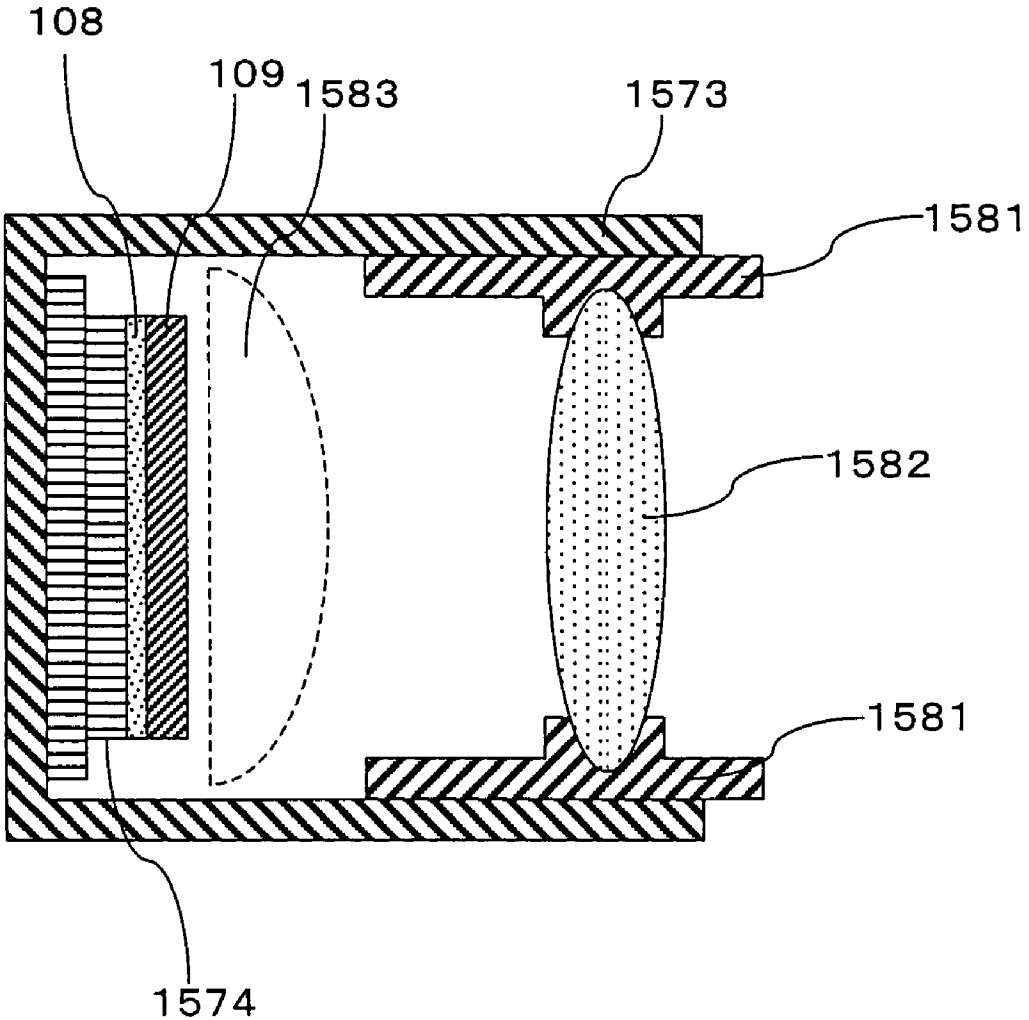
Figure 159:
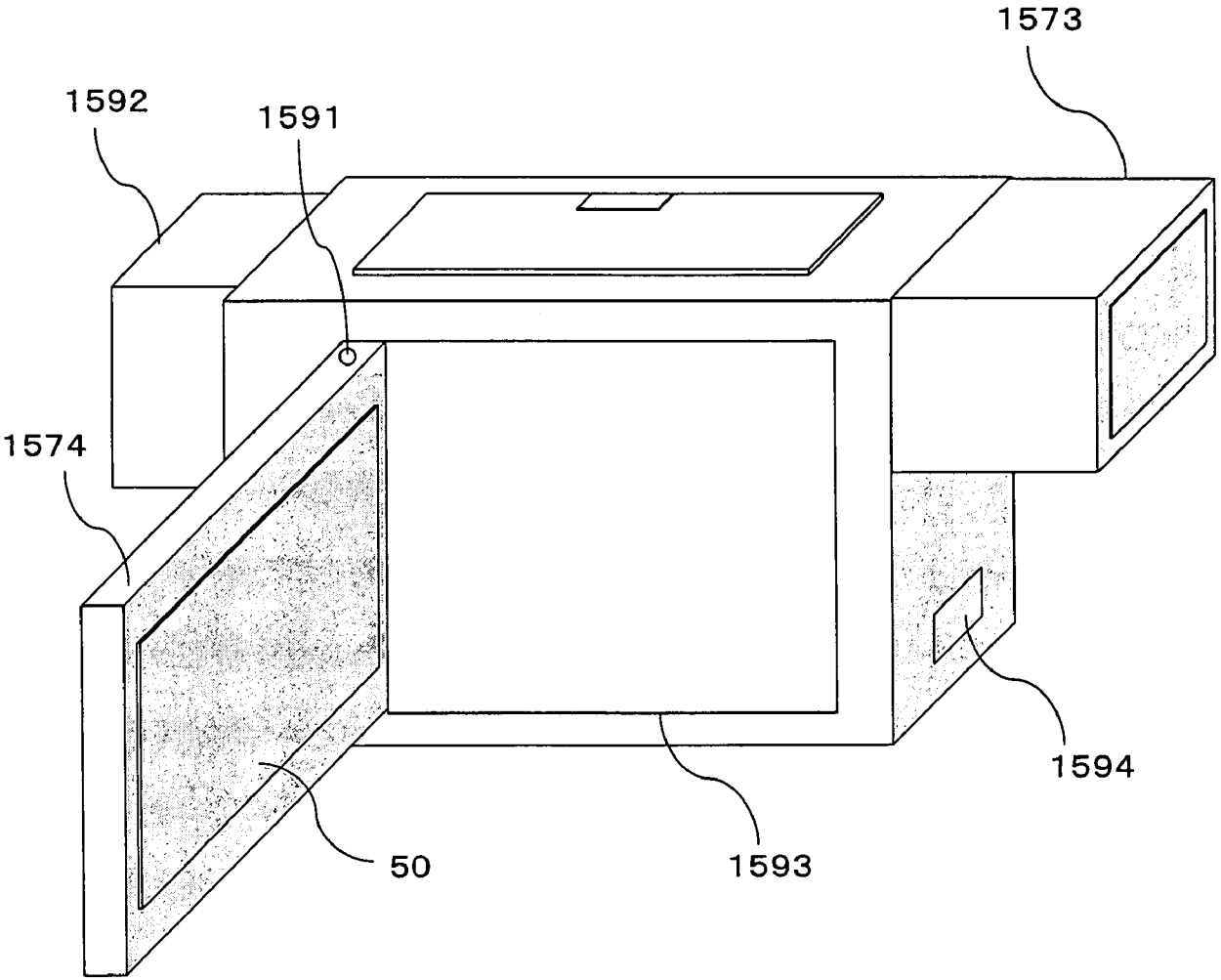
Figure 160:
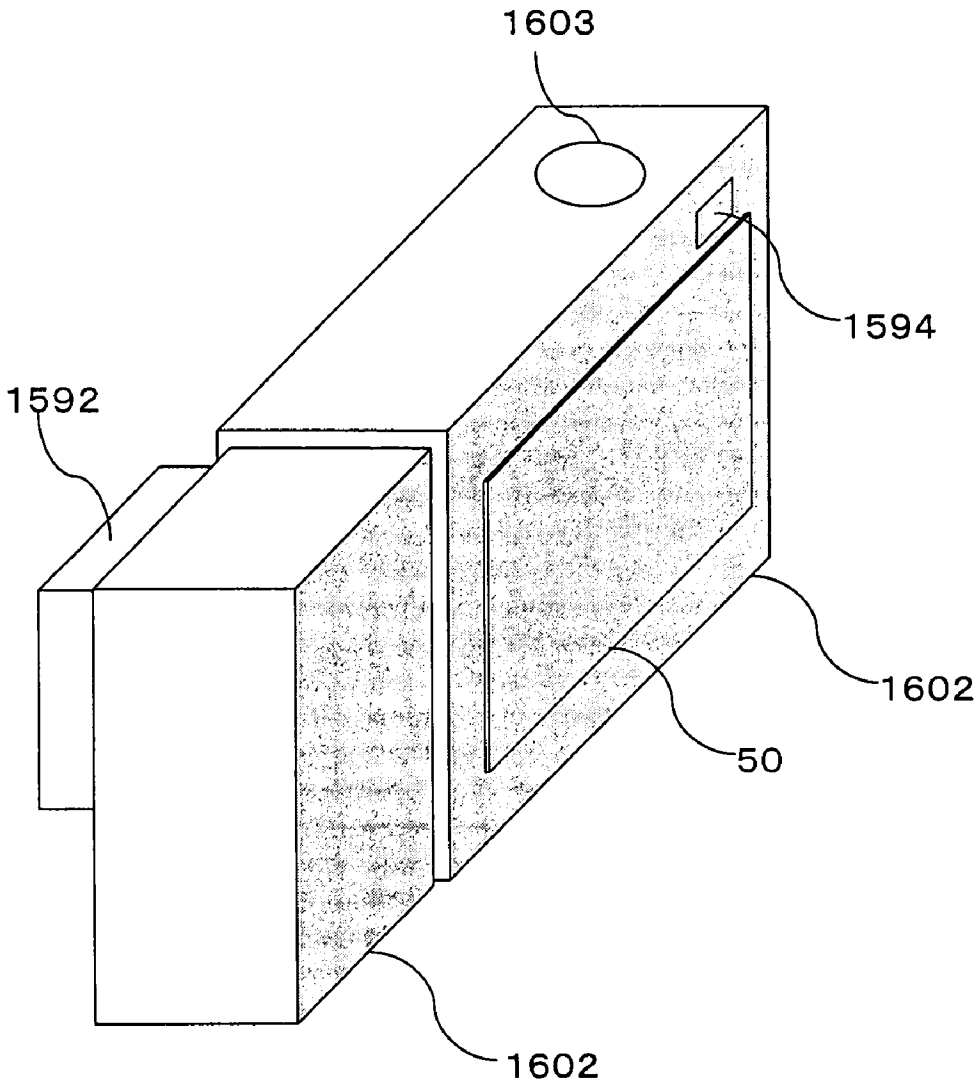
Figure 161:
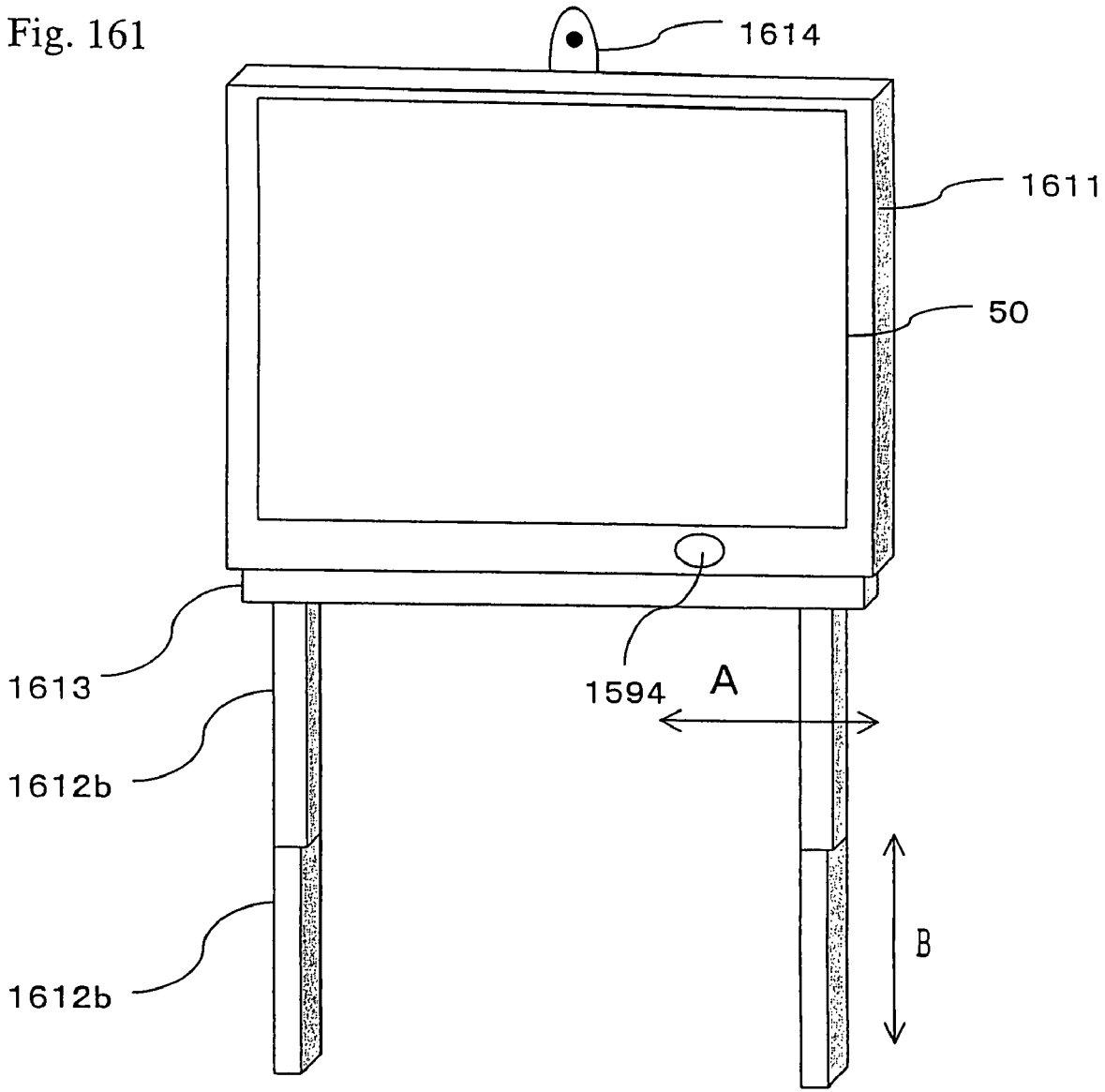
Figure 162:
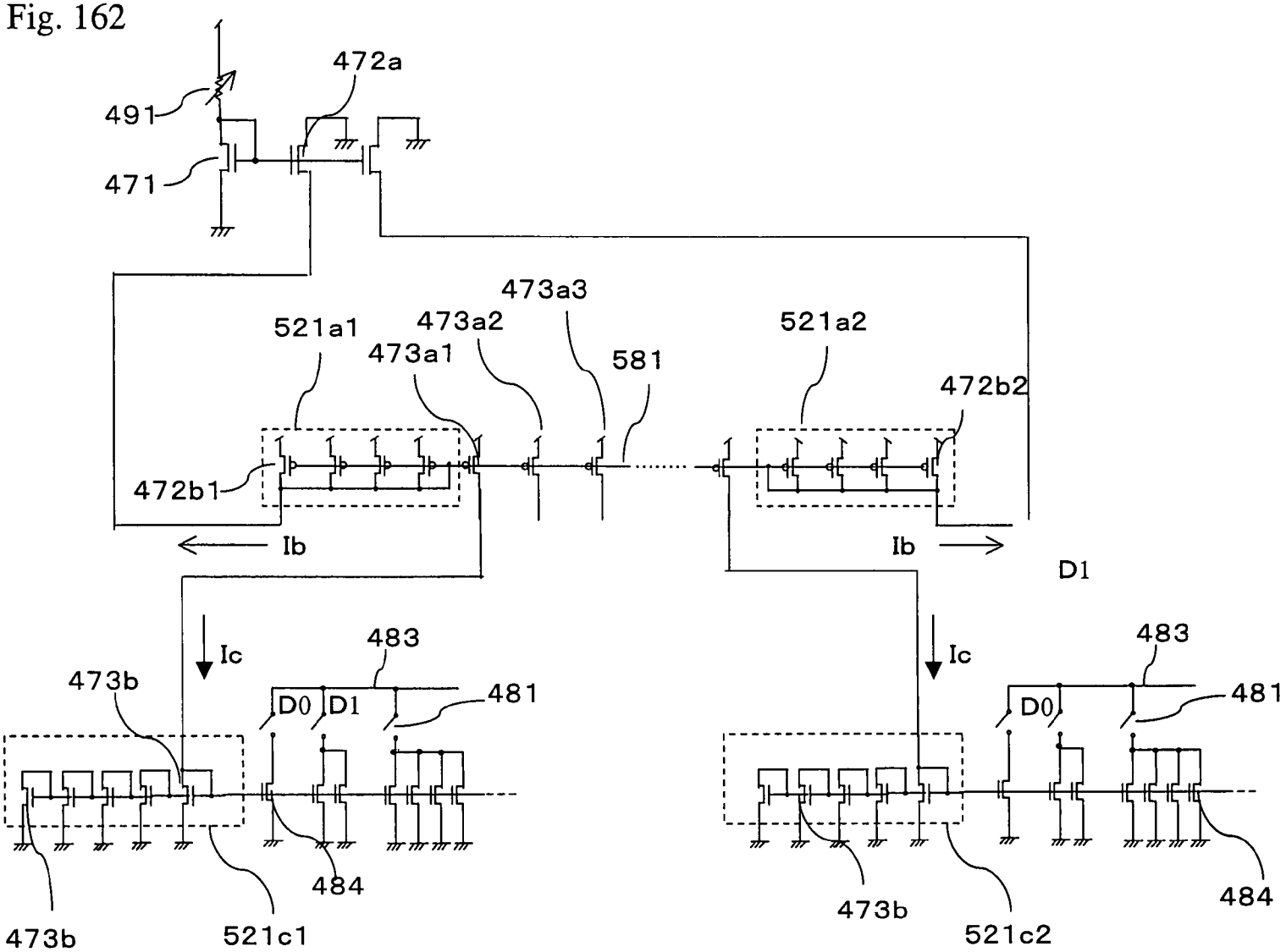
Figure 163:
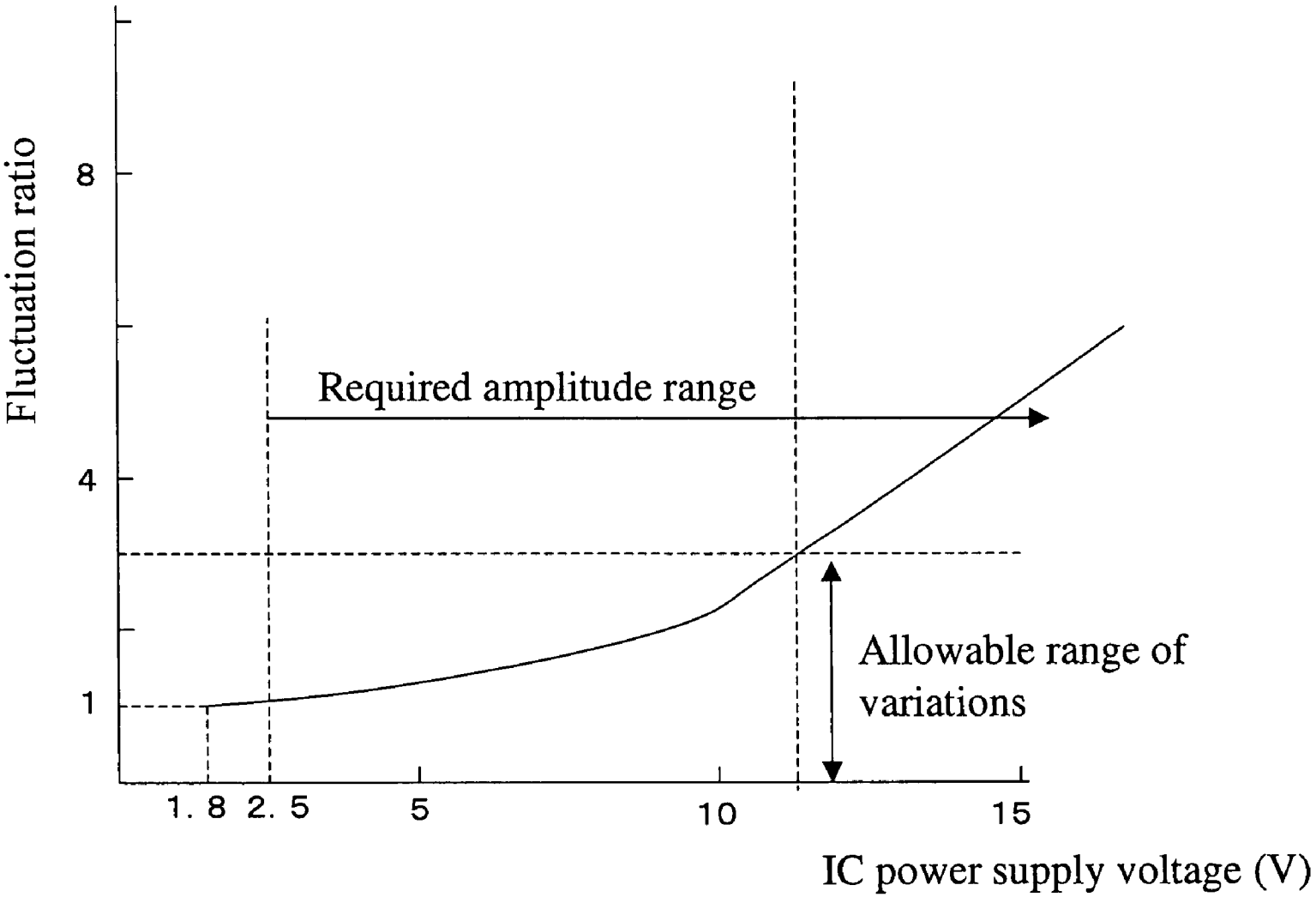
Figure 164:
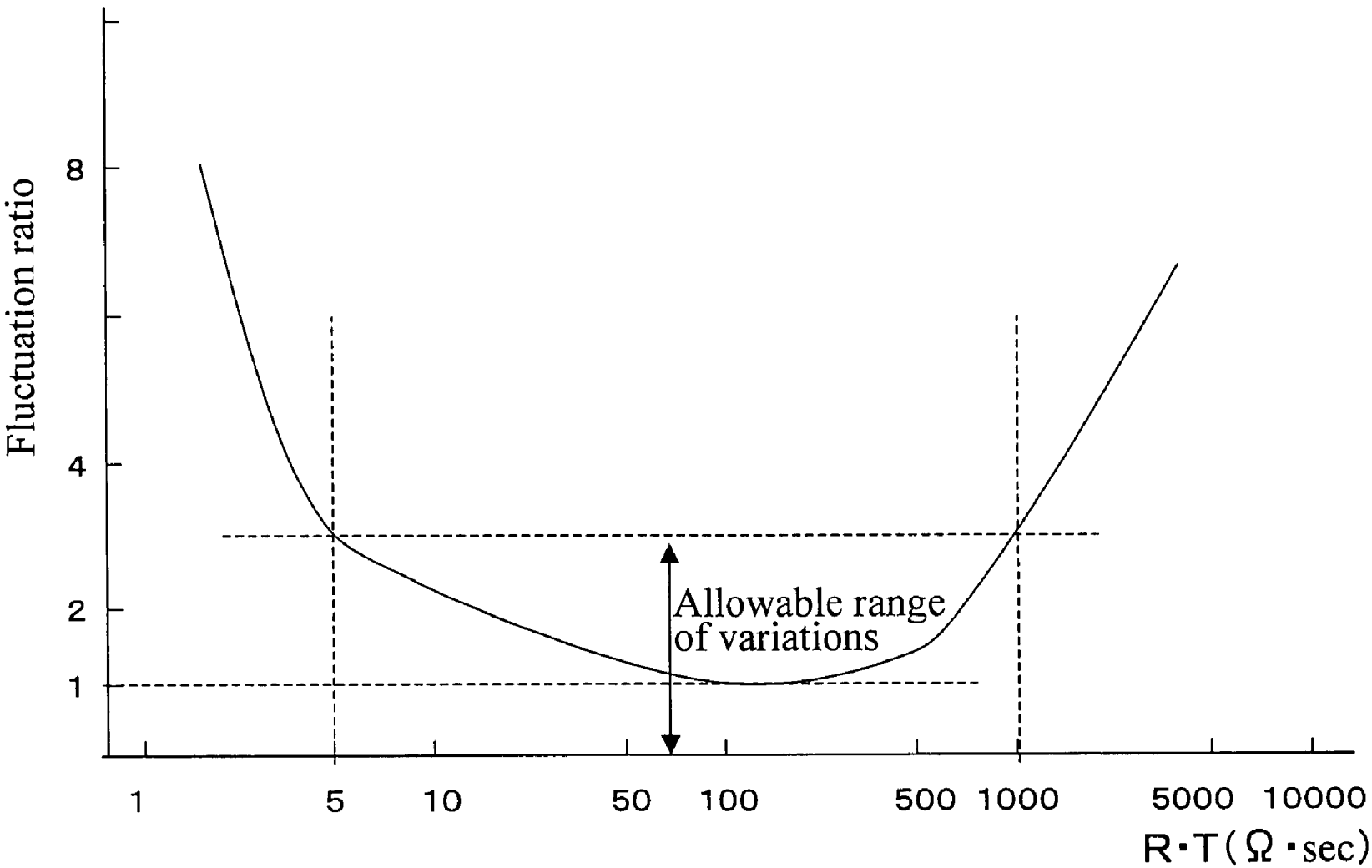
Figure 165:
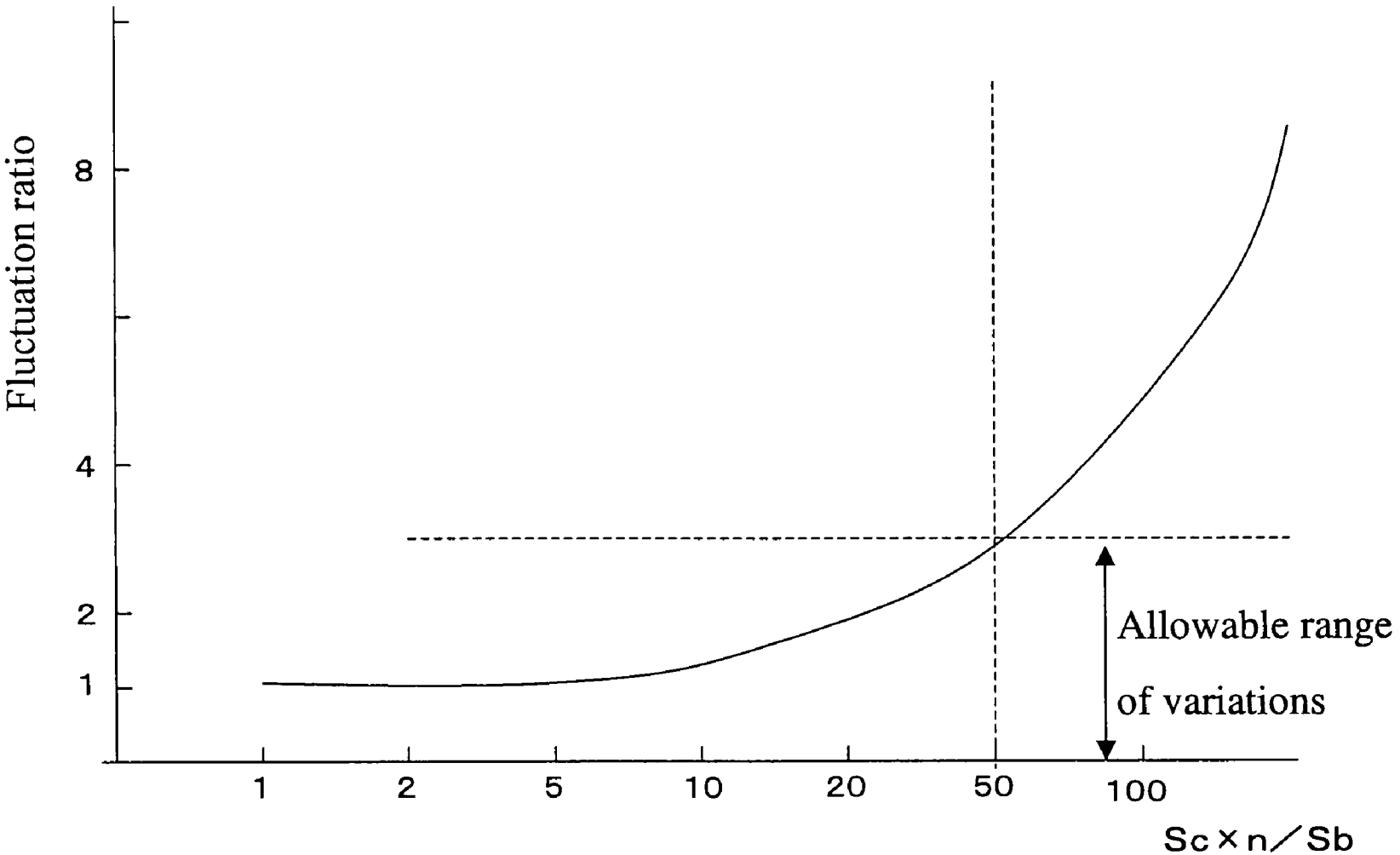
Figure 166:
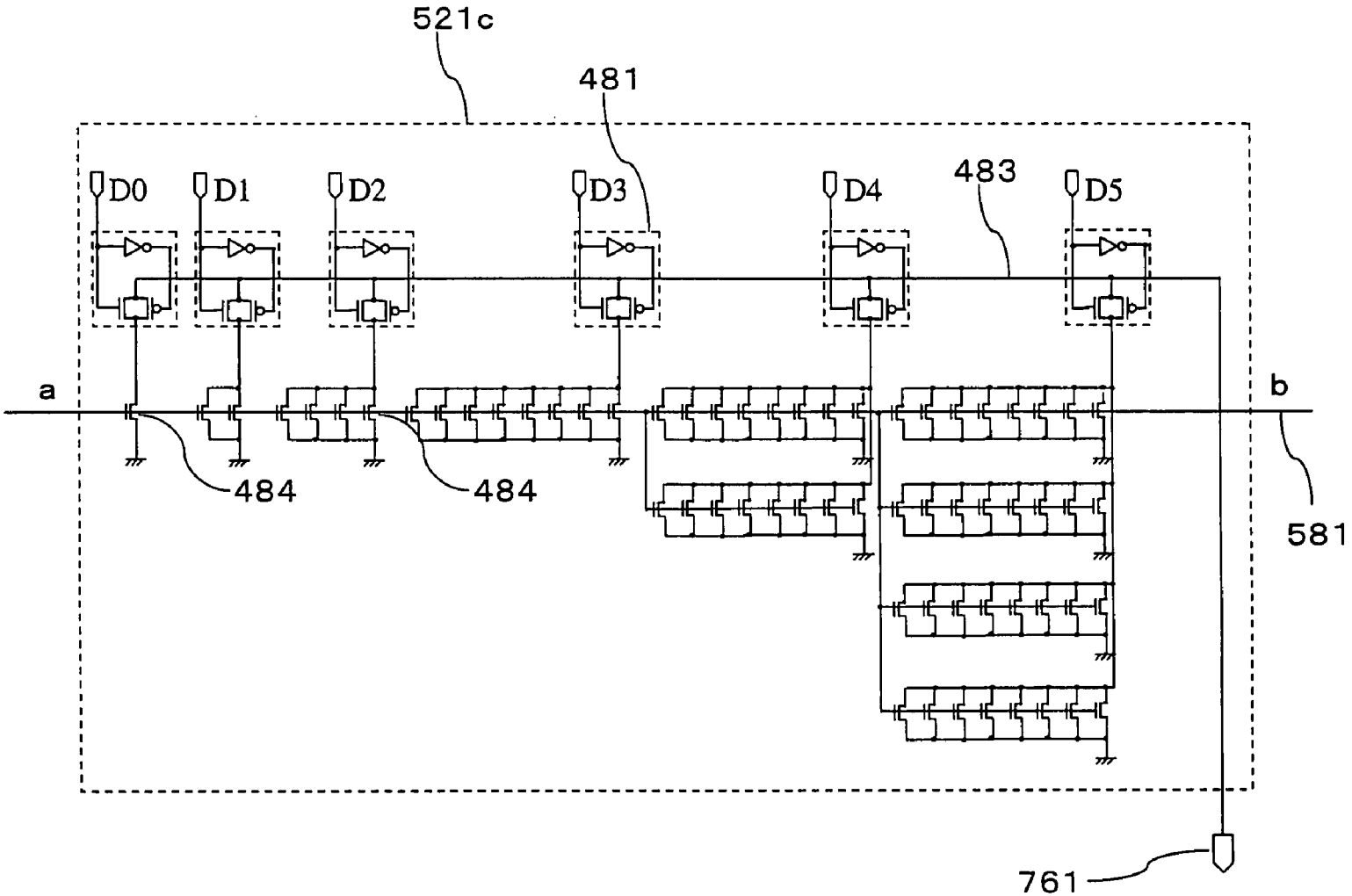
Figure 167:
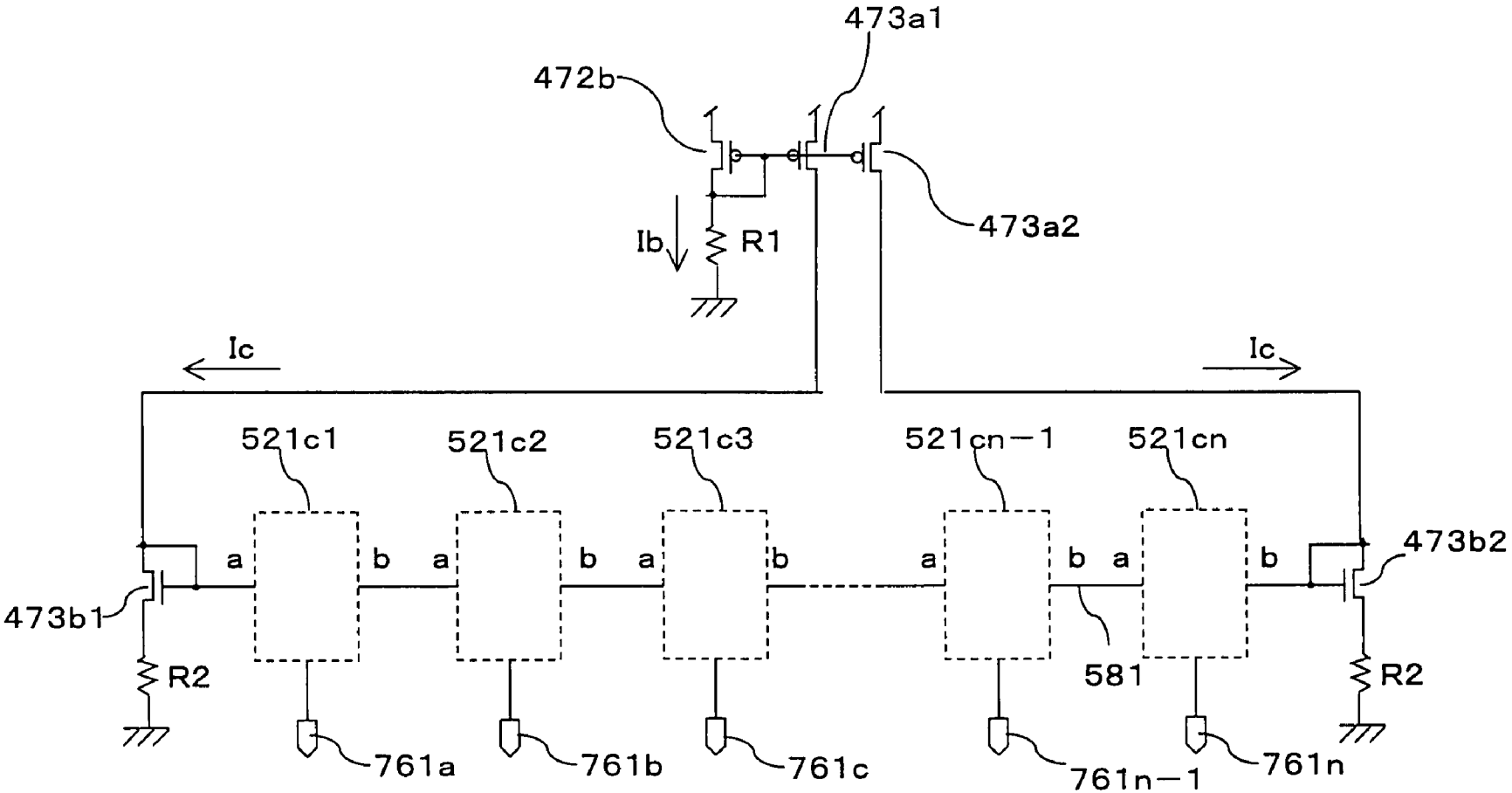
Figure 168:
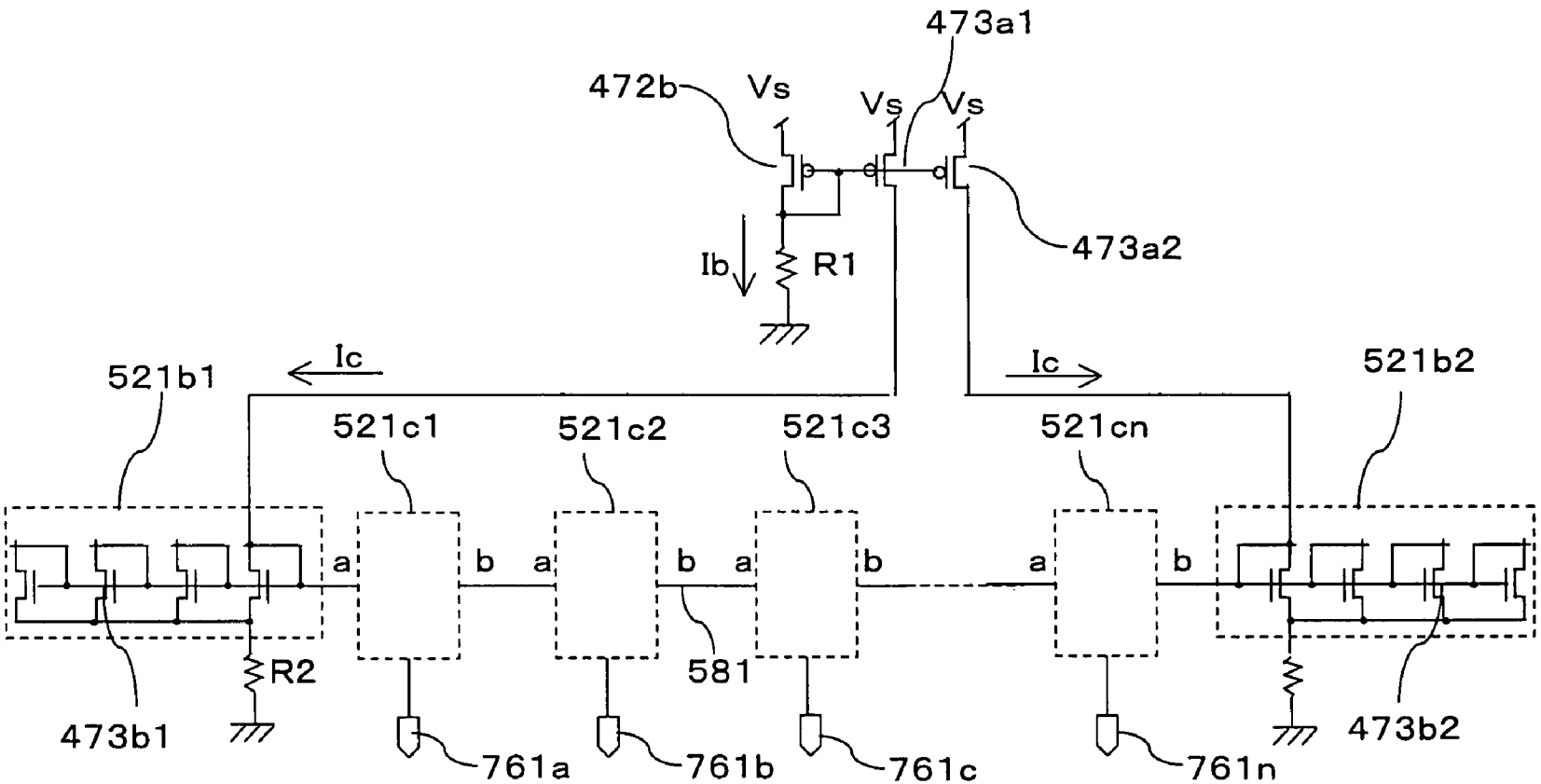
Figure 169:
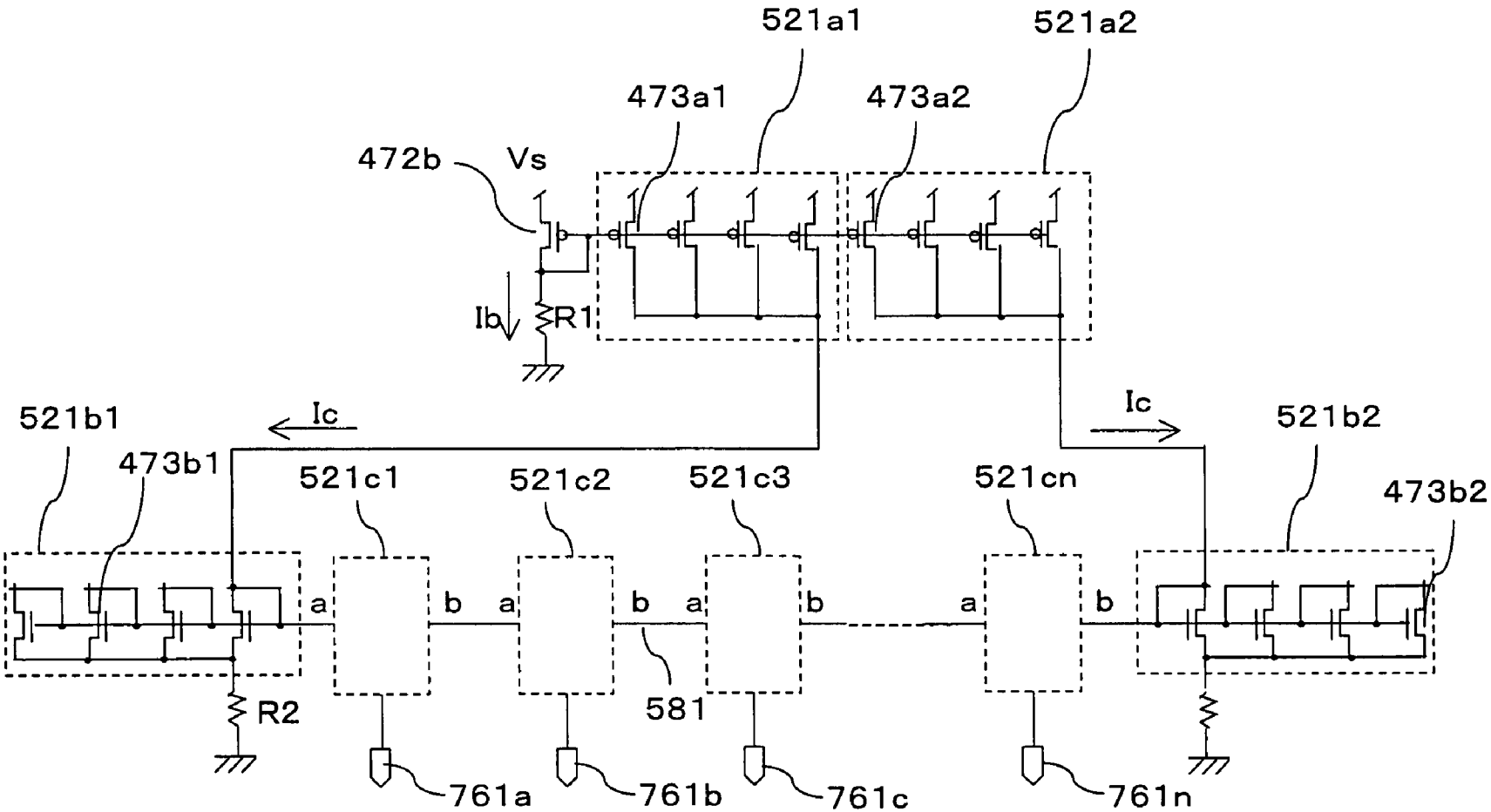
Figure 170:
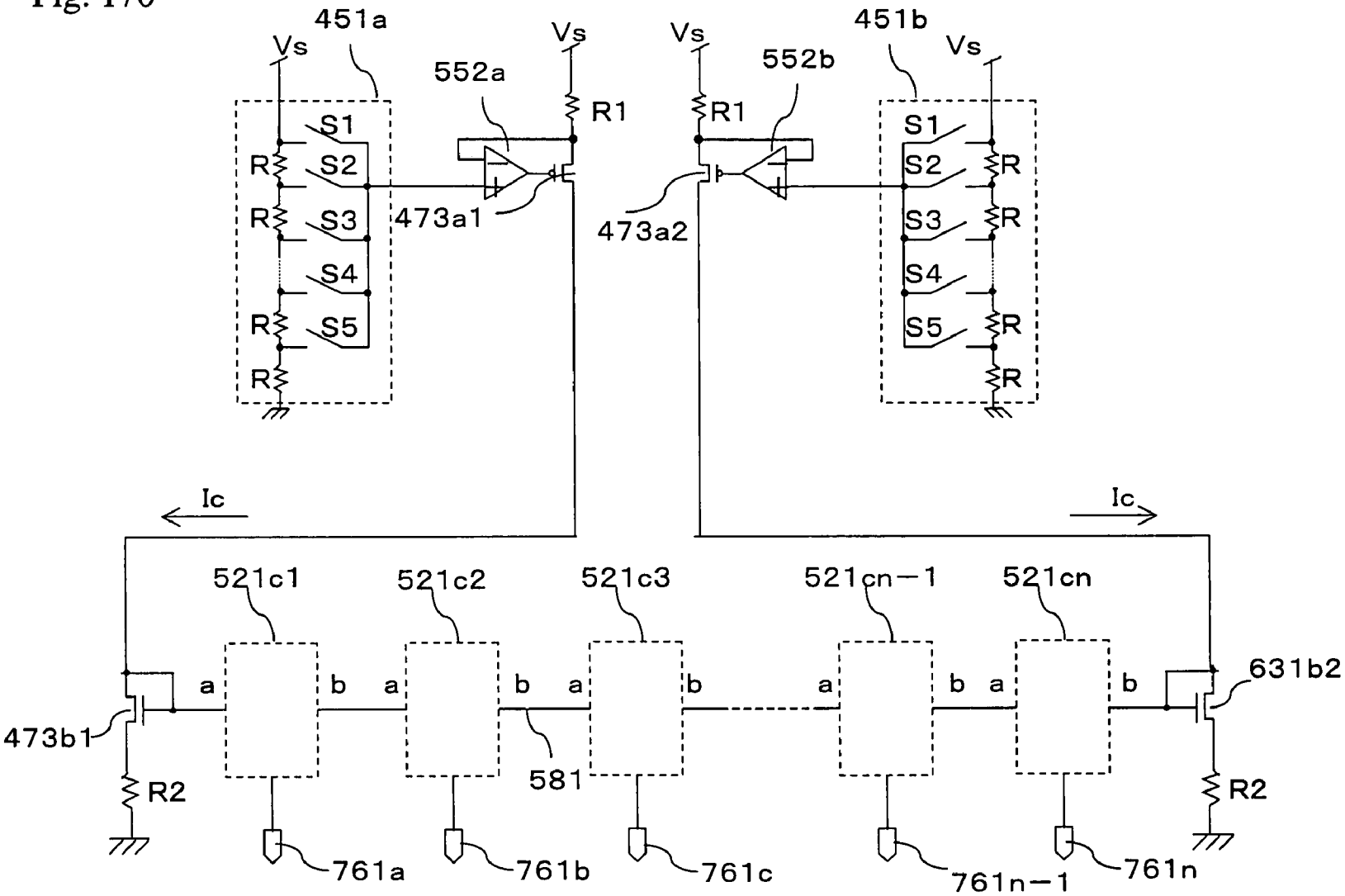
Figure 171:
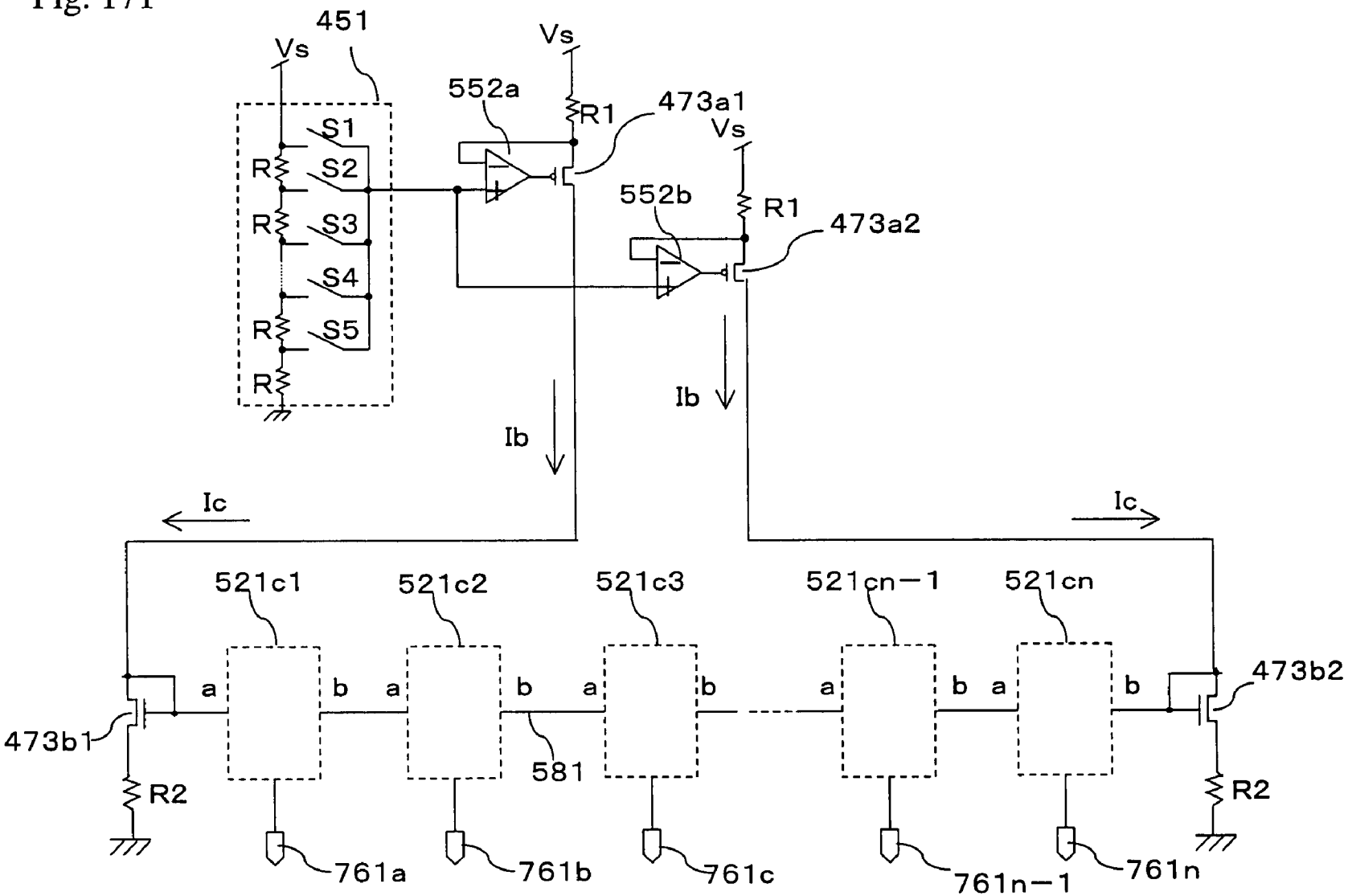
Figure 172:
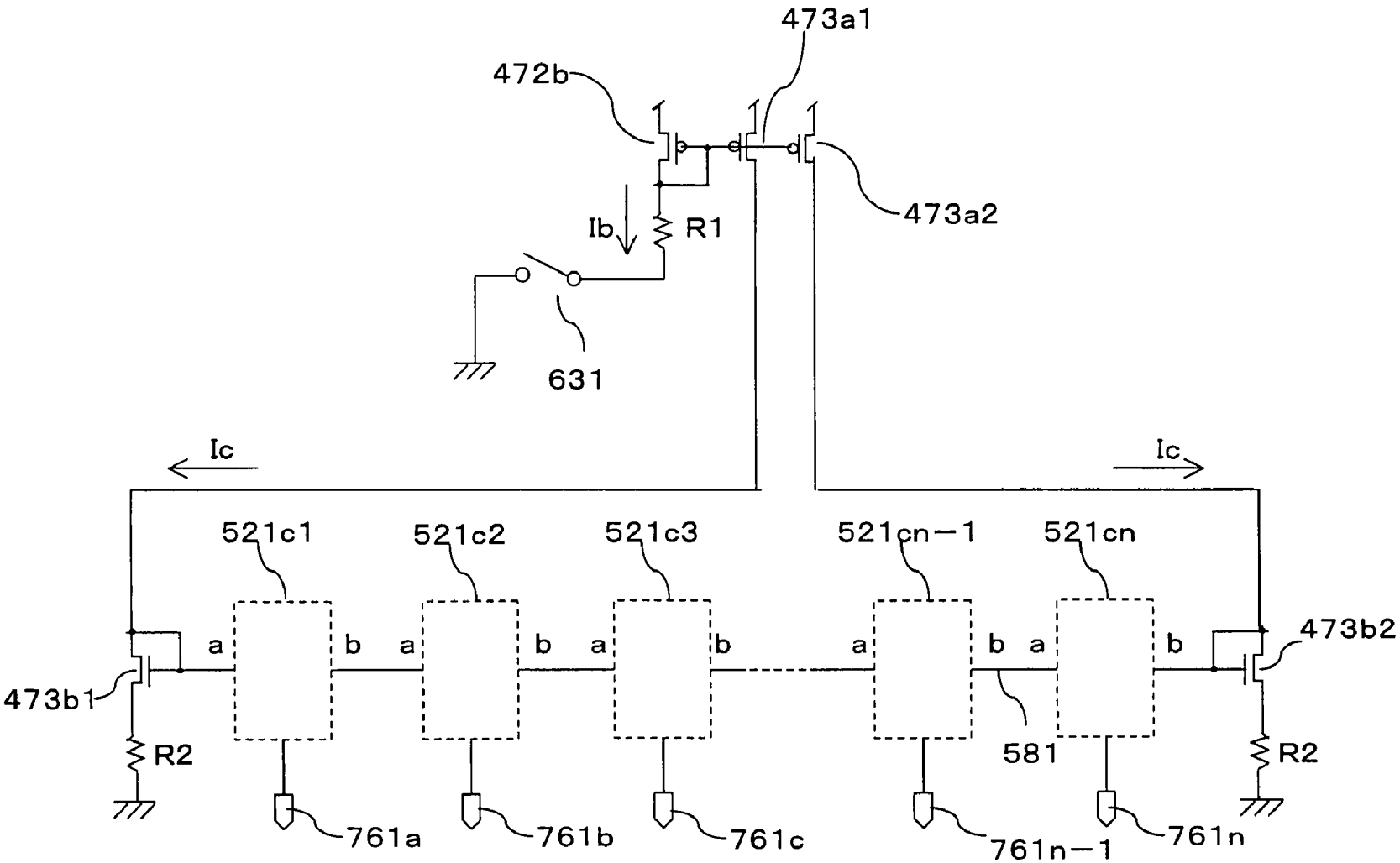
Figure 173:
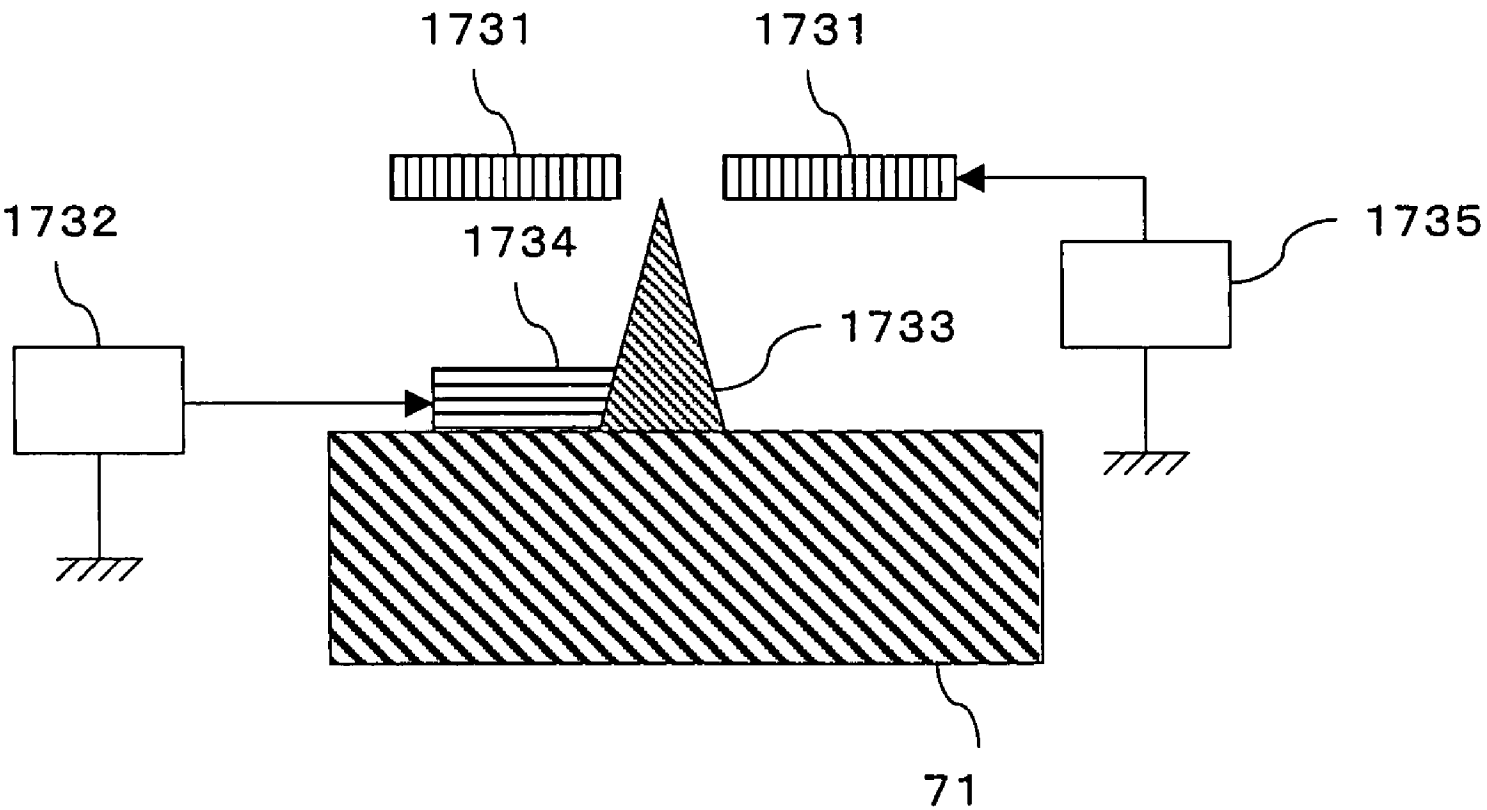
Figure 174:
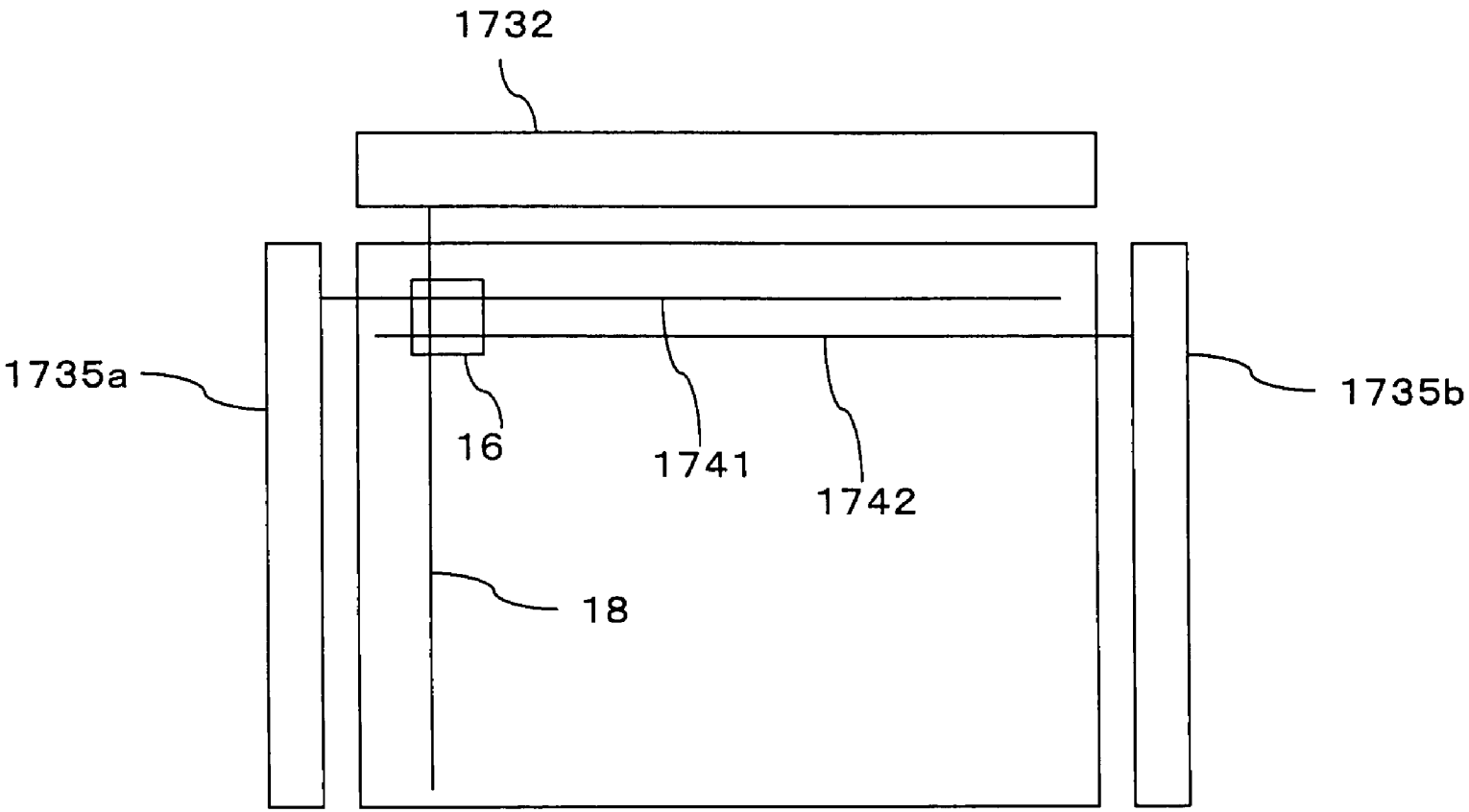
Figure 175:
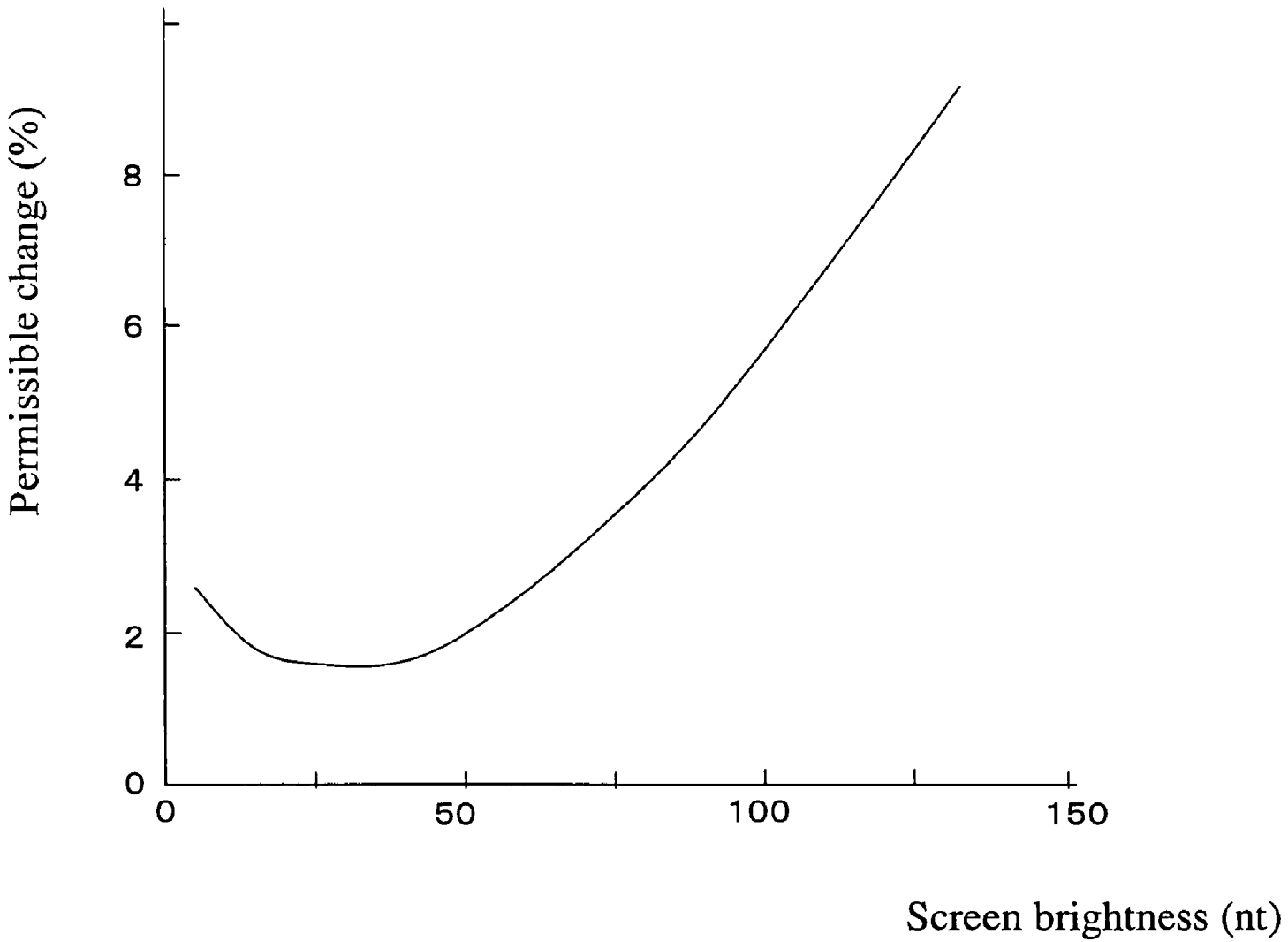
Figure 176:
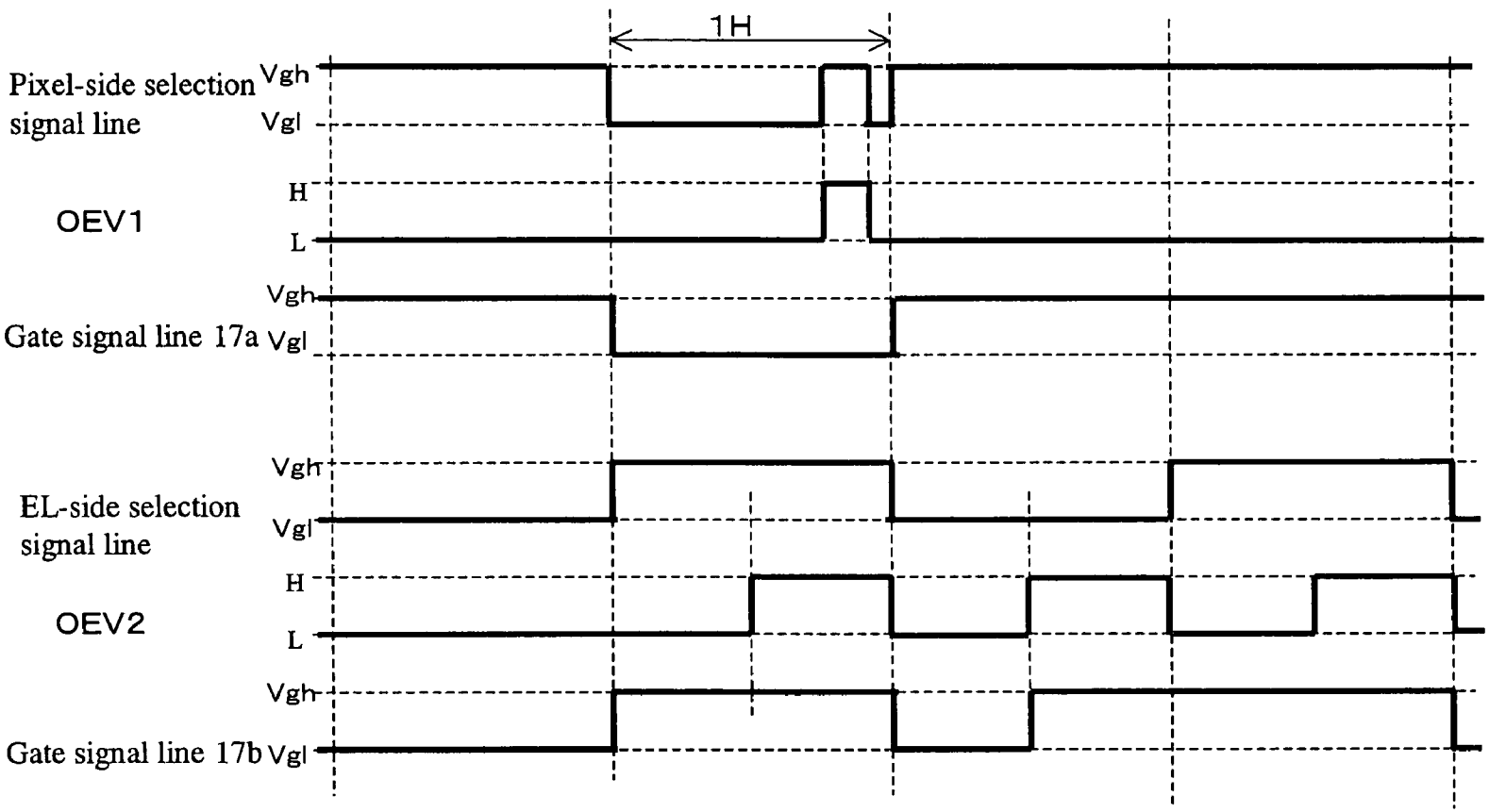
Figure 176:
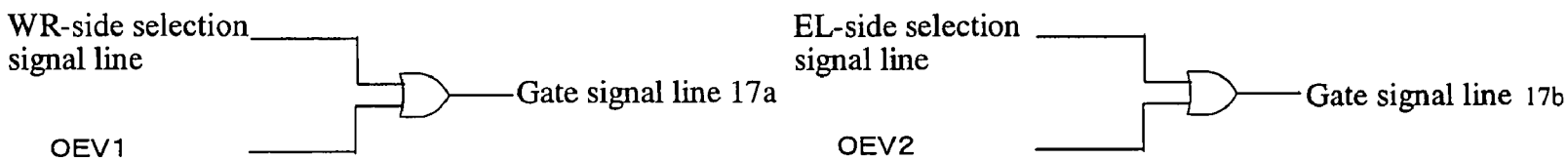

FIG. 132 is an explanatory diagram illustrating a display apparatus according to the present invention;

FIG. 133 is an explanatory diagram illustrating a display apparatus according to the present invention;

FIG. 134 is an explanatory diagram illustrating a drive method of a display panel according to the present invention;

FIG. 135 is an explanatory diagram illustrating a drive method of a display panel according to the present invention;

FIG. 136 is an explanatory diagram illustrating a drive method of a display panel according to the present invention;

FIG. 137 is an explanatory diagram illustrating a drive method of a display panel according to the present invention;

FIG. 138 is an explanatory diagram illustrating a drive method of a display panel according to the present invention;

FIG. 139 is an explanatory diagram illustrating a drive method of a display panel according to the present invention;

FIG. 140 is an explanatory diagram illustrating a drive method of a display panel according to the present invention;

FIG. 141 is an explanatory diagram illustrating a drive method of a display panel according to the present invention;

FIG. 142 is an explanatory diagram illustrating a drive method of a display panel according to the present invention;

FIG. 143 is an explanatory diagram illustrating a drive method of a display panel according to the present invention;

FIG. 144 is an explanatory diagram illustrating a drive method of a display panel according to the present invention;

FIG. 145 is an explanatory diagram illustrating a drive method of a display panel according to the present invention;

FIG. 146 is an explanatory diagram illustrating a drive method of a display panel according to the present invention;

FIG. 147 is an explanatory diagram illustrating a display apparatus according to the present invention;

FIG. 148 is an explanatory diagram illustrating a display apparatus according to the present invention;

FIG. 149 is an explanatory diagram illustrating a display apparatus according to the present invention;

FIG. 150 is an explanatory diagram illustrating a display apparatus according to the present invention;

FIG. 151 is an explanatory diagram illustrating a display apparatus according to the present invention;

FIG. 152 is an explanatory diagram illustrating a display apparatus according to the present invention;

FIG. 153 is an explanatory diagram illustrating a display apparatus according to the present invention;

FIG. 154 is an explanatory diagram illustrating a display apparatus according to the present invention;

FIG. 155 is an explanatory diagram illustrating a display apparatus according to the present invention;

FIG. 156 is an explanatory diagram illustrating a display apparatus according to the present invention;

FIG. 157 is an explanatory diagram illustrating a display apparatus according to the present invention;

FIG. 158 is an explanatory diagram illustrating a display apparatus according to the present invention;

FIG. 159 is an explanatory diagram illustrating a display apparatus according to the present invention;

FIG. 160 is an explanatory diagram illustrating a display apparatus according to the present invention;

FIG. 161 is an explanatory diagram illustrating a display apparatus according to the present invention;

FIG. 162 is an explanatory diagram illustrating a display apparatus according to the present invention;

FIG. 163 is an explanatory diagram illustrating a source driver IC according to the present invention;

FIG. 164 is an explanatory diagram illustrating a source driver IC according to the present invention;

FIG. 165 is an explanatory diagram illustrating a source driver IC according to the present invention;

FIG. 166 is an explanatory diagram illustrating a source driver IC according to the present invention;

FIG. 167 is an explanatory diagram illustrating a source driver IC according to the present invention;

FIG. 168 is an explanatory diagram illustrating a source driver IC according to the present invention;

FIG. 169 is an explanatory diagram illustrating a source driver IC according to the present invention;

FIG. 170 is an explanatory diagram illustrating a source driver IC according to the present invention;

FIG. 171 is an explanatory diagram illustrating a source driver IC according to the present invention;

FIG. 172 is an explanatory diagram illustrating a source driver IC according to the present invention;

FIG. 173 is an explanatory diagram illustrating a display apparatus according to the present invention;

FIG. 174 is an explanatory diagram illustrating a display apparatus according to the present invention;

FIG. 175 is an explanatory diagram illustrating a source driver IC according to the present invention;

FIG. 176 is an explanatory diagram illustrating a source driver IC according to the present invention.

DESCRIPTION OF SYMBOLS

11 Transistor (thin-film transistor)
12 Gate driver IC (circuit)
14 Source driver IC (circuit)
15 EL (element) (light-emitting element)
16 Pixel
17 Gate signal line
18 Source signal line
19 Storage capacitance (additional capacitor, additional capacitance)
50 Display screen
51 Write pixel (row)
52 Non-display pixel (non-display area, non-illuminated area)
53 Display pixel (display area, illuminated area)
61 Shift register
62 Inverter
63 Output buffer
71 Array board (display panel)
72 Laser irradiation range (laser spot)
73 Positioning marker
74 Glass substrate (array board)
81 Control IC (circuit)
82 Power supply IC (circuit)
83 Printed board

84 Flexible board
85 Sealing lid
86 Cathode wiring
87 Anode wiring (Vdd)
88 Data signal line
89 Gate control signal line
101 Bank (rib)
102 Interlayer insulating film
104 Contact connector
105 Pixel electrode
106 Cathode electrode
107 Desiccant
108 λ/4 plate
109 Polarizing plate
111 Thin encapsulation film
271 Dummy pixel (row)
341 Output stage circuit
371 OR circuit
401 Illumination control line
471 Reverse bias line
472 Gate potential control line
451 Electronic regulator circuit
452 SD (source-drain) short circuit of a transistor
471, 472, 473 Current source (transistor)
481 Switch (on/off means)
484 Current source (unit transistor)
483 Internal wiring
491 Electronic regulator
521 Transistor group
531 Resister
532 Decoder circuit
533 Level shifter circuit
541 Padder circuit
551 D/A converter
552 Operational amplifier
562 Inverter
581 Gate wiring
631 Sleep switch (reference current on/off means)
651 Counter
652 NOR
653 AND
654 Current output circuit
655 Switch
671 Coincidence circuit
681 Input/output pad
691 Reference current circuit
692 Current control circuit
701 Temperature detection means
702 Temperature control circuit
711 Unit gate output circuit
1121 Coil (transformer)
1122 Control circuit
1123 Diode
1124 Capacitor
1125 Resister
1126 Transistor
1131 Switching circuit (analog switch)
1251 Output switching circuit
1252 Changeover switch
1501 Analog switch
1502 Switch control line
1503 Connection wiring
1504 Cushioning sheet (plate)
1521 Inverter
1522 Connection terminal
1571 Antenna
1572 Key
1573 Housing
1574 Display panel
1581 Eye ring
1582 Magnifying lens
1583 Convex lens
1591 Supporting point (pivot point)
1592 Taking lens
1593 Storage section
1594 Switch
1601 Body
1602 Photographic section
1603 Shutter switch
1611 Mounting frame
1612 Leg
1613 Mount
1614 Fixed part
1731 Control electrode
1732 Video signal circuit
1733 Electron emission protuberance
1734 Holding circuit
1735 On/off control circuit
1741 Selection signal line
1742 On/off signal line

BEST MODE FOR CARRYING OUT THE INVENTION

Some parts of drawings herein are omitted and/or enlarged/reduced herein for ease of understanding and/or illustration. For example, in a sectional view of a display panel shown in FIG. 11, a thin encapsulation film 111 and the like are shown as being fairly thick. On the other hand, in FIG. 10, a sealing lid 85 is shown as being thin. Some parts are omitted. For example, although the display panel according to the present invention requires a phase film such as a circular polarizing plate to prevent reflection, the phase film is omitted in drawings herein. This also applies to the drawings below. Besides, the same or similar forms, materials, functions, or operations are denoted by the same reference numbers or characters.

Incidentally, what is described with reference to drawings or the like can be combined with other examples or the like even if not noted specifically. For example, a touch panel or the like can be attached to a display panel in FIG. 8 to provide an information display apparatus shown in FIGS. 157 and 159 to 161. Also, a magnifying lens 1582 can be mounted to configure a view finder (see FIG. 58) used for a video camera (see FIG. 159, etc.) or the like. Also, drive methods described with reference to FIGS. 4, 15, 18, 21, 23, 29, 30, 35, 36, 40, 41, 44, 100, etc. can be applied to any display apparatus or display panel according to the present invention.

Also, thin-film transistors are cited herein as driver transistors 11 and switching transistors 11, this is not restrictive. Thin-film diodes (TFDs) or ring diodes may be used instead. Also, the present invention is not limited to thin-film elements, and transistors formed on silicon wafers may also be used. In that case, an array board 71 can be made of a silicon wafer. Needless to say, FETs, MOS-FETs, MOS transistors, or bipolar transistors may also be used. They are basically, thin-film transistors. It goes without saying that the present invention may also use varistors, thyristors, ring diodes, photodiodes, phototransistors, or PLZT elements. That is, the transistor element 11, gate driver circuit 12, and source driver circuit 14 according to the present invention can use any of the above elements.

Figure 10:
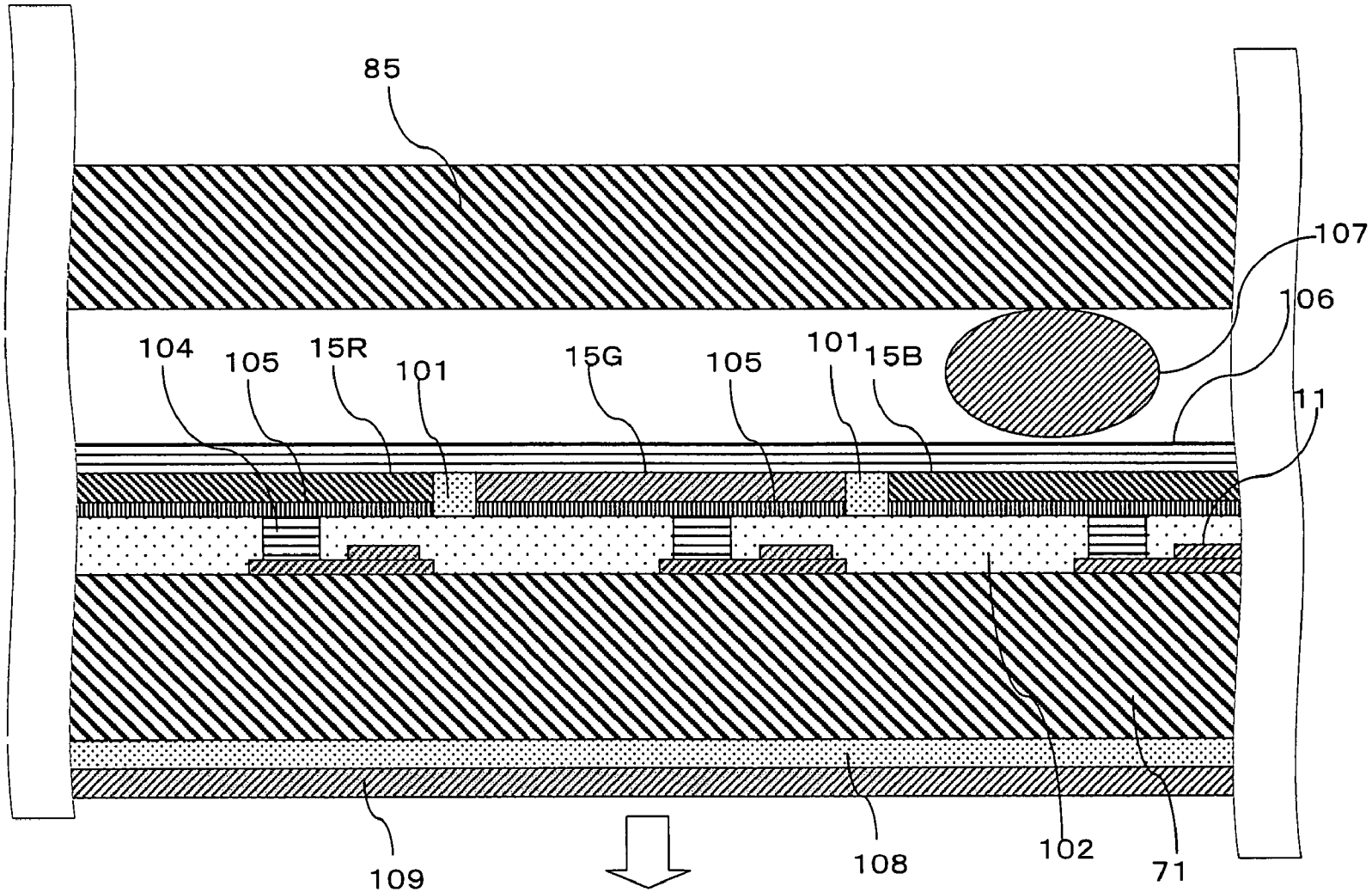
FIG. 10 is a sectional view of a display panel according to the present invention.

An EL panel according to the present invention will be described below with reference to drawings. As shown in FIG. 10, an organic EL display panel consists of a glass substrate (array board) 71, transparent electrodes 105 formed as pixel electrodes, at least one organic functional layer (EL layer) 15, and a metal electrode (reflective film) (cathode) 106, which are stacked one on top of another, where the organic functional layer consists of an electron transport layer, light-emitting layer, positive hole transport layer, etc. The organic functional layer (EL layer) 15 emits light when a positive voltage is applied to the anode or transparent electrodes (pixel electrodes) 105 and a negative voltage is applied to the cathode or metal electrode (reflective electrode) 106, i.e. when a direct current is applied between the transparent electrodes 105 and metal electrode 106.

Preferably, the metal electrode 106 is made of metal with a small work function, such as lithium, silver, aluminum, magnesium, indium, copper, or an alloy thereof. In particular, it is preferable to use, for example, an Al—Li alloy. The transparent electrodes 105 may be made of, conductive materials with a large work function such as ITO, or gold and the like. If gold is used as an electrodematerial, the electrodes become translucent. Incidentally, IZO or other material may be used instead of ITO. This also applies to other pixel electrodes 105.

Incidentally, a desiccant 107 is placed in a space between the sealing lid 85 and array board 71. This is because the organic EL film 15 is vulnerable to moisture. The desiccant 107 absorbs water penetrating a sealant and thereby prevents deterioration of the organic EL film 15.

Figure 11:
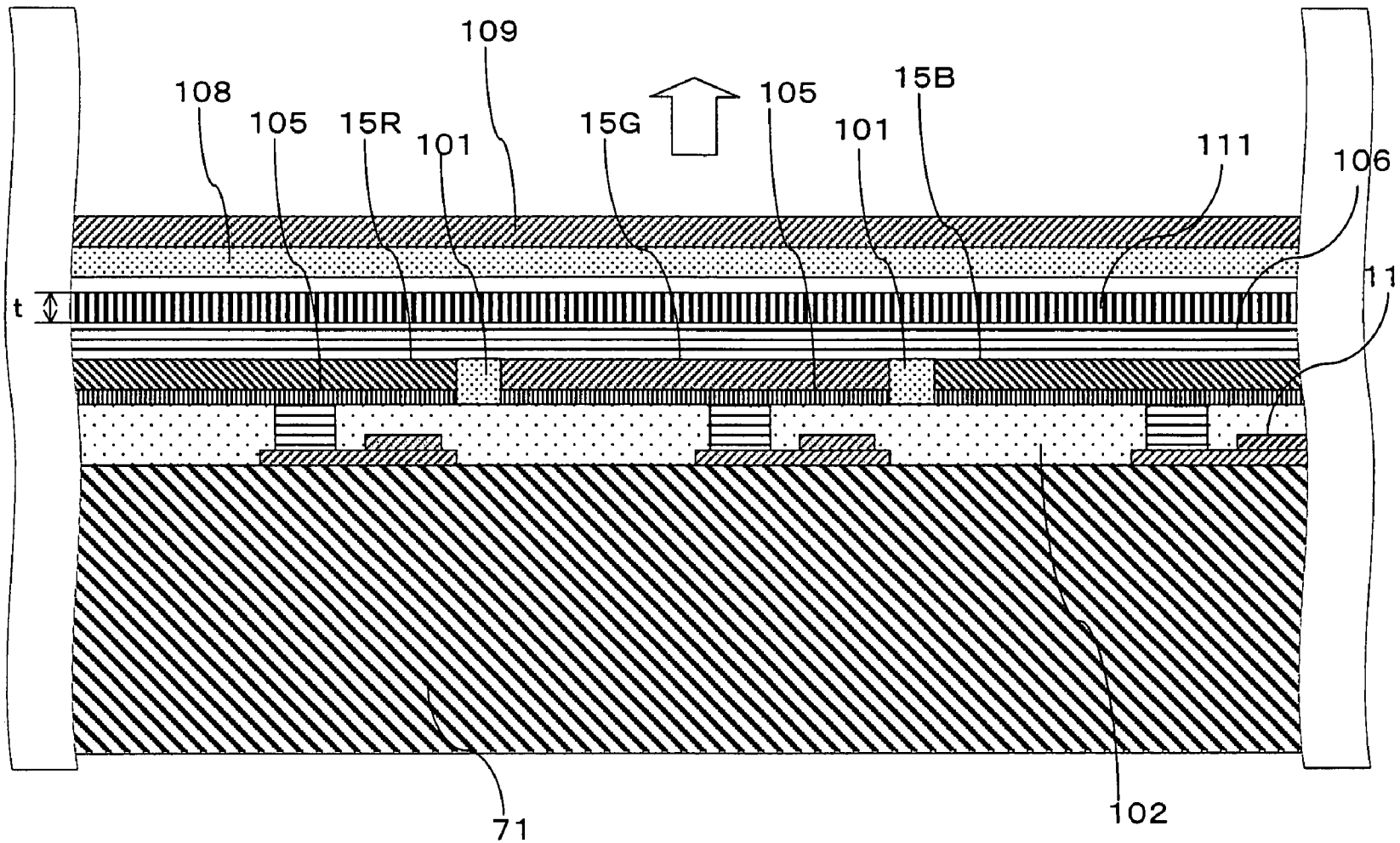
FIG. 11 is a sectional view of a display panel according to the present invention.

Although the glass lid 85 is used for sealing in FIG. 10, the film 111 (this may be a thin film, i.e., a thin encapsulation film) may be used for sealing as shown in FIG. 11. The encapsulation film (thin encapsulation film) 111 may be, for example, an electrolytic capacitor film on which DLC (diamond-like carbon) is vapor-deposited. This film features extremely low moisture penetration (high moisture resistance) It is used as the thin encapsulation film 111. Also, it goes without saying that DLC (diamond-like carbon) film may be vapor-deposited directly on a surface of the metal electrode 106. Besides, the thin encapsulation film may be formed by laminating thin resin films and metal films.

Desirably, film thickness of the thin film is such that n·d is equal to or less than main emission wavelength λ of the EL element 15 (where n is the refraction factor of the thin film and d is the film thickness of the thin film; if two or more thin films are laminated, n·d of each thin film is calculated and the results are summed). By satisfying this condition, it is possible to more than double the efficiency of light extraction from the EL element 15 compared to when a glass substrate is used for sealing. Also, an alloy, mixture, or laminate of aluminum and silver may be used.

A technique which uses a thin encapsulation film 111 for sealing instead of a sealing lid 85 as described above is called thin film encapsulation. In the case of "underside extraction (see FIG. 10; light is extracted in the direction of the arrow in FIG. 10)" in which light is extracted from the side of the array board 71, thin film encapsulation involves forming an EL film and then forming an aluminum electrode which will serve as a cathode on the EL film. Then, a resin layer is formed as a cushioning layer on the aluminum layer. An organic material such as acrylic or epoxy may be used for a cushioning layer. Suitable film thickness is from 1 μm to 10 μm (both inclusive). More preferably, the film thickness is from 2 μm to 6 μm (both inclusive). The encapsulation film 111 is formed on the cushioning film layer. Without the cushioning film, structure of the EL film would be deformed by stress, resulting in streaky defects. As described above, the thin encapsulation film 111 may be made, for example, of DLC (diamond-like carbon) or an electrolytic capacitor of a laminar structure (structure consisting of thin dielectric films and aluminum films vapor-deposited alternately).

In the case of "topside extraction (see FIG. 11; light is extracted in the direction of the arrow in FIG. 11)" in which light is extracted from the side of the EL layer 15, thin film encapsulation involves forming the EL film 15 and then forming an Ag—Mg film 20 angstrom (inclusive) to 300 angstrom thick on the EL film 15 to serve as a cathode (anode) A transparent electrode such as ITO is formed on the film to reduce resistance. Then, a resin layer is formed as a cushioning layer on the electrode film. A thin encapsulation film 111 is formed on the cushioning film.

Half the light produced by the organic EL layer 15 is reflected by the metal electrode 106 and emitted through the array board 71. However, the metal electrode 106 reflects extraneous light, resulting in glare, which lowers display contrast. To deal with this situation, a λ/4 phase plate 108 and polarizing plate (polarizing film) 109 are placed on the array board 71. These are generally called circular polarizing plates (circular polarizing sheets).

Incidentally, if the pixels are reflective electrodes, the light produced by the organic EL layer 15 is emitted upward. Thus, needless to say, the phase plate 108 and polarizing plate 109 are placed on the side from which light is emitted. Reflective pixels can be obtained by making pixel electrodes 105 from aluminum, chromium, silver, or the like. Also, by providing projections (or projections and depressions) on a surface of the pixel electrodes 105, it is possible to increase an interface with the organic EL layer 15, and thereby increase the light-emitting area, resulting in improved light-emission efficiency. Incidentally, the reflective film which serves as the cathode 106 (anode 105) is made as a transparent electrode. If reflectance can be reduced to 30% or less, no circular polarizing plate is required. This is because glare is reduced greatly. Light interference is reduced as well.

Preferably, LDD (low doped drain) structure is used for the transistors 11. The EL elements will be described herein taking organic EL elements (known by various abbreviations including OEL, PEL, PLED, OLED) 15 as an example, but this is not restrictive and inorganic EL elements may be used as well.

An organic EL display panel of active-matrix type must satisfy two conditions: that it is capable of selecting a specific pixel and give necessary display information and that it is capable of passing current through the EL element throughout one frame period.

Figure 46:
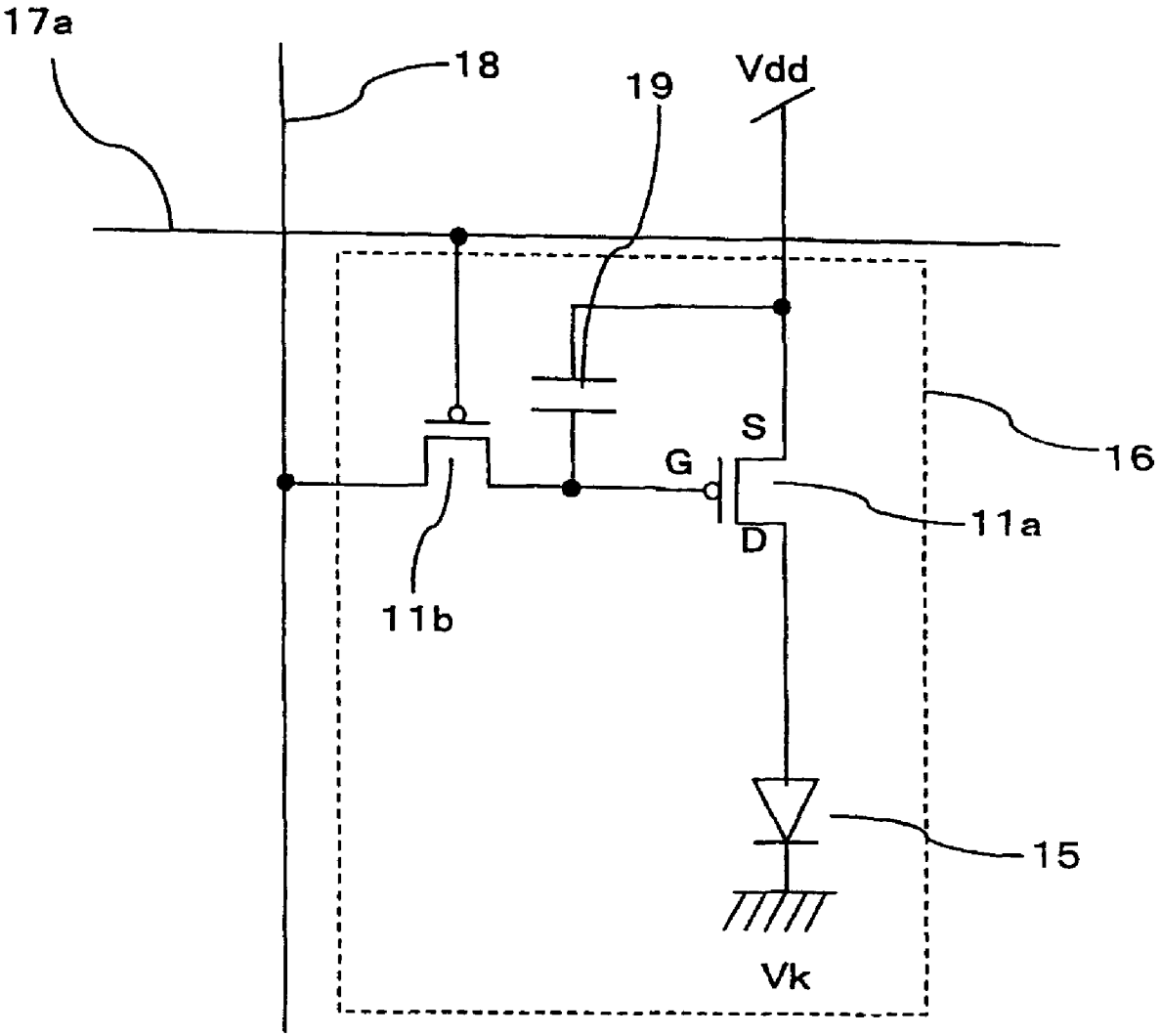
FIG. 46 is an explanatory diagram illustrating a drive method of a display apparatus according to the present invention.

To satisfy the two conditions, in a conventional organic EL pixel configuration shown in FIG. 46, a switching transistor is used as a first transistor 11*b* to select the pixel and a driver transistor is used as a second transistor 11*a* to supply current to an EL element (EL film) 15.

To display a gradation using this configuration, a voltage corresponding to the gradation must be applied the gate of the driver transistor 11*a*. Consequently, variations in a turn-on current of the driver transistor 11*a* appear directly in display.

The turn-on current of a transistor is extremely uniform if the transistor is monocrystalline. However, in the case of a low-temperature polycrystalline transistor formed on an inexpensive glass substrate by low-temperature polysilicon technology at a temperature not higher than 450, its threshold varies in a range of ±0.2 V to 0.5 V. The turn-on current flowing through the driver transistor 11*a* varies accordingly, causing display irregularities. The irregularities are caused not only by variations in the threshold voltage, but also by mobility of the transistor and thickness of a gate insulating film. Characteristics also change due to degradation of the transistor 11.

This phenomenon is not limited to low-temperature polysilicon technologies, and can occur in transistors formed on semiconductor films grown in solid-phase (CGS) by high-temperature polysilicon technology at a process temperature of 450 degrees (centigrade) or higher. Besides, the phenomenon can occur in organic transistors and amorphous silicon transistors.

As described below, the present invention provides a configuration or scheme which can accommodate the above technologies. Description will be given herein mainly of transistors produced by the low-temperature polysilicon technology.

In a method which displays gradations by the application of voltage as shown in FIG. 46, device characteristics must be controlled strictly to obtain a uniform display. However, current low-temperature polycrystalline polysilicon transistors or the like cannot satisfy a specification which prescribes that variations be kept within a predetermined range.

Figure 1:
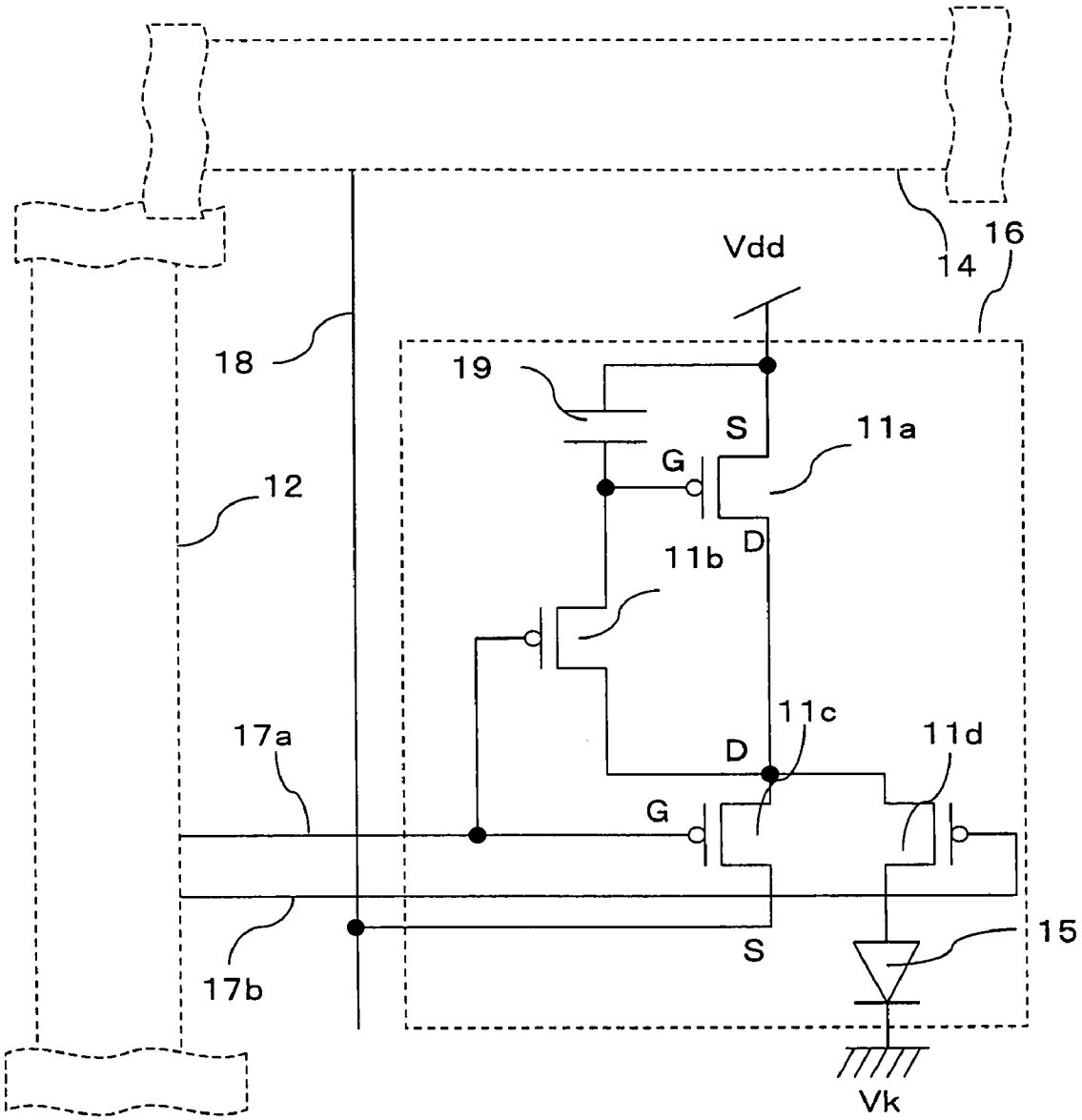
FIG. 1 is a block diagram of a pixel in a display panel according to the present invention.

Each pixel structure in an EL display panel according to the present invention comprises at least four transistors 11 and an EL element as shown concretely in FIG. 1. Pixel electrodes are configured to overlap with a source signal line. Specifically, the pixel electrodes 105 are formed on an insulating film or planarized acrylic film formed on the source signal line 18 for insulation. A structure in which pixel electrodes overlap with at least part of the source signal line 18 is known as a high aperture (HA) structure. This reduces unnecessary light interference and allows proper light emission.

When the gate signal line (first scanning line) 17*a* is activated (a turn-on voltage is applied), a current to be passed through the EL element 15 is delivered from the source driver circuit 14 via the driver transistor 11*a* and switching transistor 11*c* of the EL element 15. Also, upon activation of (application of a turn-on voltage to) the gate signal line 17*a*, the transistor 11*b* opens to cause a short circuit between gate and drain of the transistor 11*a* and gate voltage (or drain voltage) of the transistor 11*a* is stored in a capacitor (storage capacitance, additional capacitance) 19 connected between the gate and drain of the transistor 11*a* (see FIG. 3(*a*)).

Preferably, the capacitor (storage capacitance) 19 should be from 0.2 pF to 2 pF both inclusive. More preferably, the capacitor (storage capacitance) 19 should be from 0.4 pF to 1.2 pF both inclusive. The capacity of the capacitor 19 is determined taking pixel size into consideration. If the capacity needed for a single pixel is Cs (pF) and an area (rather than an aperture ratio) occupied by the pixel is Sp (square μm), a condition $500/Sp \leqq Cs \leqq 2000/Sp$, and more preferably a condition $1000/Sp \leqq Cs \leqq 10000/Sp$ should be satisfied. Since gate capacity of the transistor is small, Cs as referred to here is the capacity of the storage capacitance (capacitor) 19 alone.

Figure 3B:
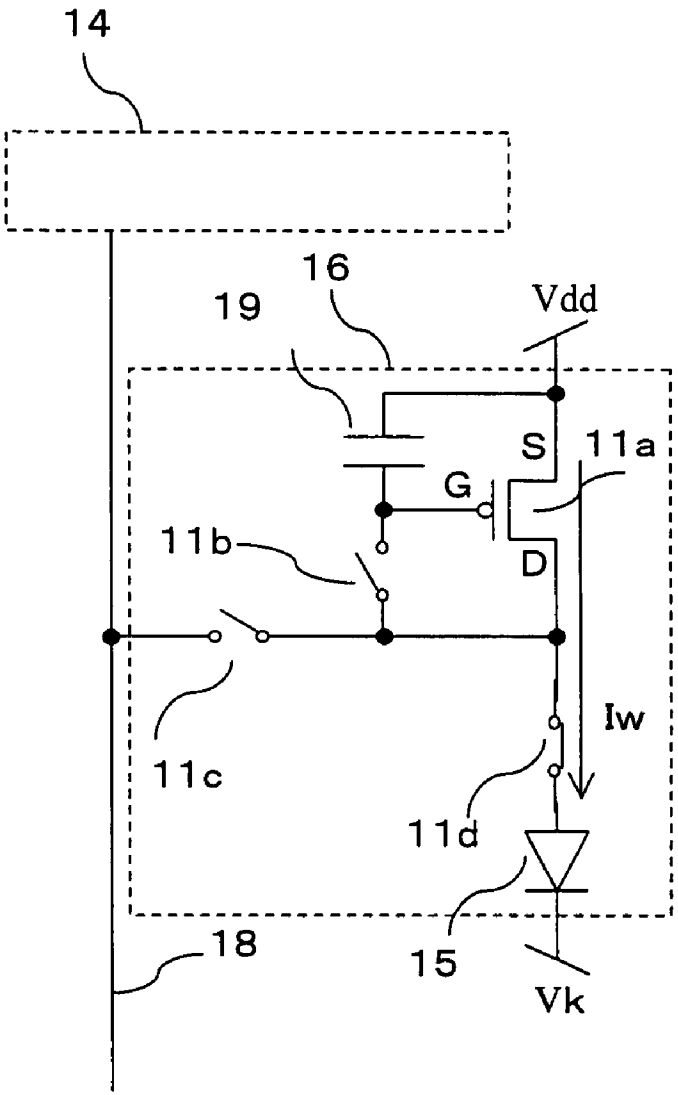
FIG. 3 is an explanatory diagram illustrating operation of a display panel according to the present invention.
Figure 3A:
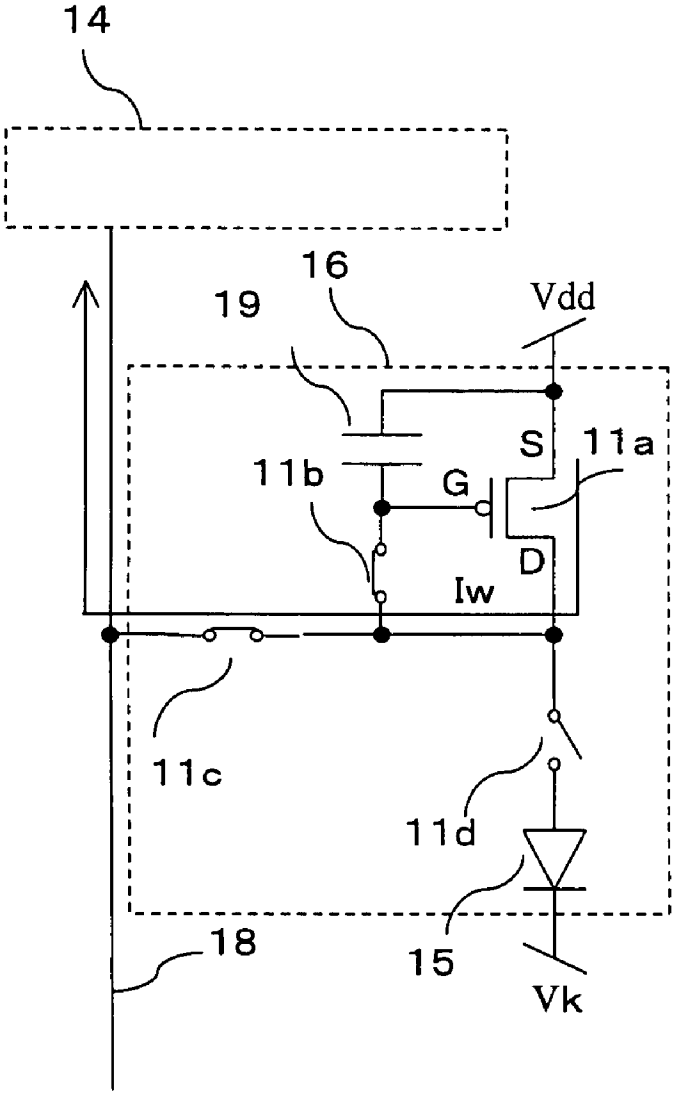

The gate signal line 17*a* is deactivated (a turn-off voltage is applied), a gate signal line 17*b* is activated, and a current path is switched to a path which includes the first transistor 11*a*, a transistor 11*d* connected to the EL element 15, and the EL element 15 to deliver the stored current to the EL element 15 (see FIG. 3(*b*)).

In this circuit, a single pixel contains four transistors 11. The gate of the transistor 11*a* is connected to the source of the transistor 11*b*. The gates of the transistors 11*b* and 11*c* are connected to the gate signal line 17*a*. The drain of the transistor 11*b* is connected to the source of the transistor 11*c* and source of the transistor 11*d*. The drain of the transistor 11*c* is connected to the source signal line 18. The gate of the transistor 11*d* is connected to the gate signal line 17*b* and the drain of the transistor 11*d* is connected to the anode electrode of the EL element 15.

Incidentally, all the transistors in FIG. 1 are P-channel transistors. Compared to N-channel transistors, P-channel transistors have more or less lower mobility, but they are preferable because they are more resistant to voltage and degradation. However, the EL element according to the present invention is not limited to P-channel transistors and the present invention may employ N-channel transistors alone. Also, the present invention may employ both N-channel and P-channel transistors.

Optimally, P-channel transistors should be used for all the transistors 11 composing pixels as well as for the built-in gate driver circuits 12. By composing an array solely of P-channel transistors, it is possible to reduce the number of masks to 5, resulting in low costs and high yields.

To facilitate understanding of the present invention, the configuration of the EL element according to the present invention will be described below with reference to FIG. 3. The EL element according to the present invention is controlled using two timings. The first timing is the one when required current values are stored. Turning on the transistor 11*b* and transistor 11*c* with this timing provides an equivalent circuit shown in FIG. 3(*a*). A predetermined current Iw is applied from signal lines. This makes the gate and drain of the transistor 11*a* connected, allowing the current Iw to flow through the transistor 11*a* and transistor 11*c*. Thus, the gate-source voltage of the transistor 11*a* is such that allows I1 to flow.

The second timing is the one when the transistor 11*b* and transistor 11*c* are closed and the transistor 11*d* is opened. The equivalent circuit available at this time is shown in FIG. 3(*b*). The source-gate voltage of the transistor 11*a* is maintained. In this case, since the transistor 11*a* always operates in a saturation region, the current Iw remains constant.

Figure 5:
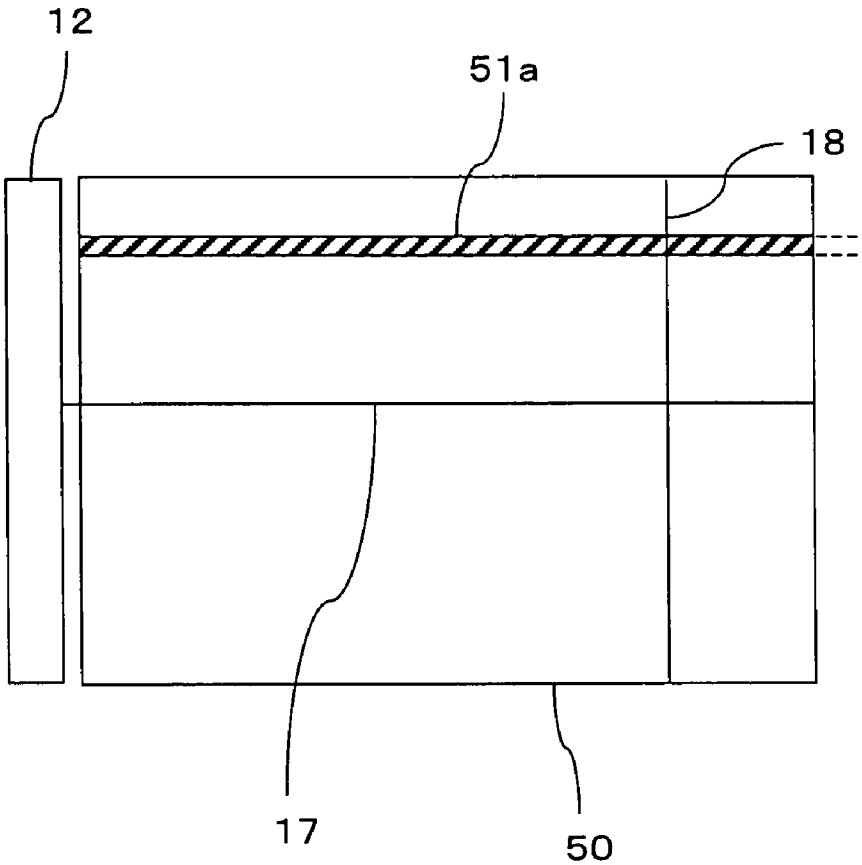
FIG. 5 is an explanatory diagram illustrating a drive method of a display apparatus according to the present invention.
Figure 5:
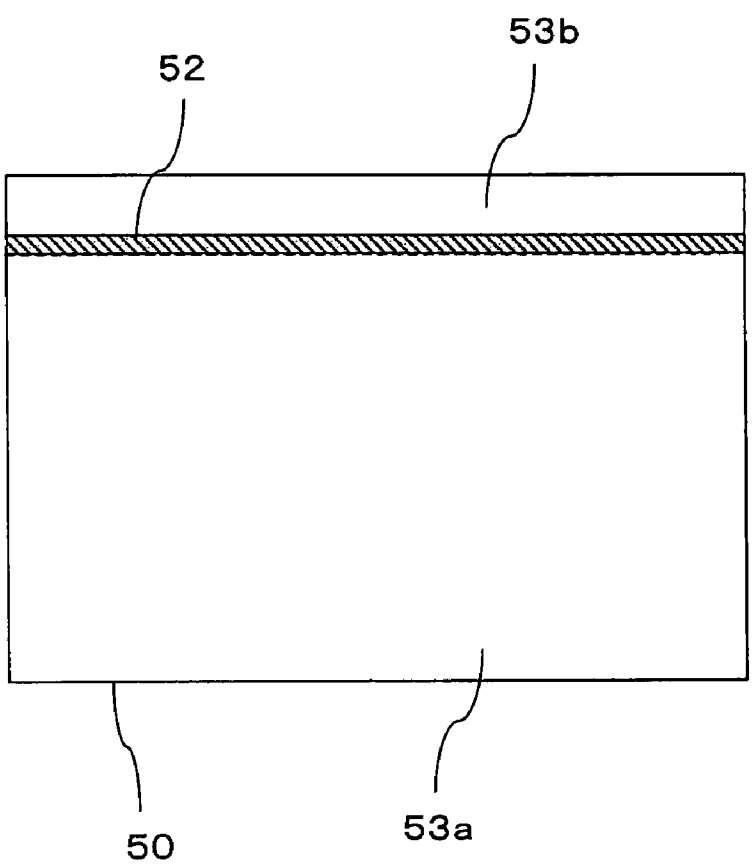

Results of this operation are shown in FIG. 5. Specifically, reference numeral 51*a* in FIG. 5(*a*) denotes a pixel (row) (write pixel row) programmed with current at a certain time point in a display screen 50. The pixel row 51*a* is non-illuminated (non-display pixel (row)) as illustrated in FIG. 5(*b*). Other pixels (rows) are display pixels (rows) 53 (current flows through the EL elements 15 of the pixels 16 in the display area 53, causing the EL elements 15 to emit light).

In the pixel configuration in FIG. 1, the programming current Iw flows through the source signal line 18 during current programming as shown in FIG. 3(*a*). The current Iw flows through the transistor 11*a* and voltage is set (programmed) in the capacitor 19 in such a way as to maintain the current Iw. At this time, the transistor 11*d* is open (off).

During a period when the current flows through the EL element 15, the transistors 11*c* and 11*b* turn off and the transistor 11*d* turns on as shown in FIG. 3(*b*). Specifically, a turn-off voltage (Vgh) is applied to the gate signal line 17*a*, turning off the transistors 11*b* and 11*c*. On the other hand, a turn-on voltage (Vgl) is applied to the gate signal line 17*b*, turning on the transistor 11*d*.

Figure 4:
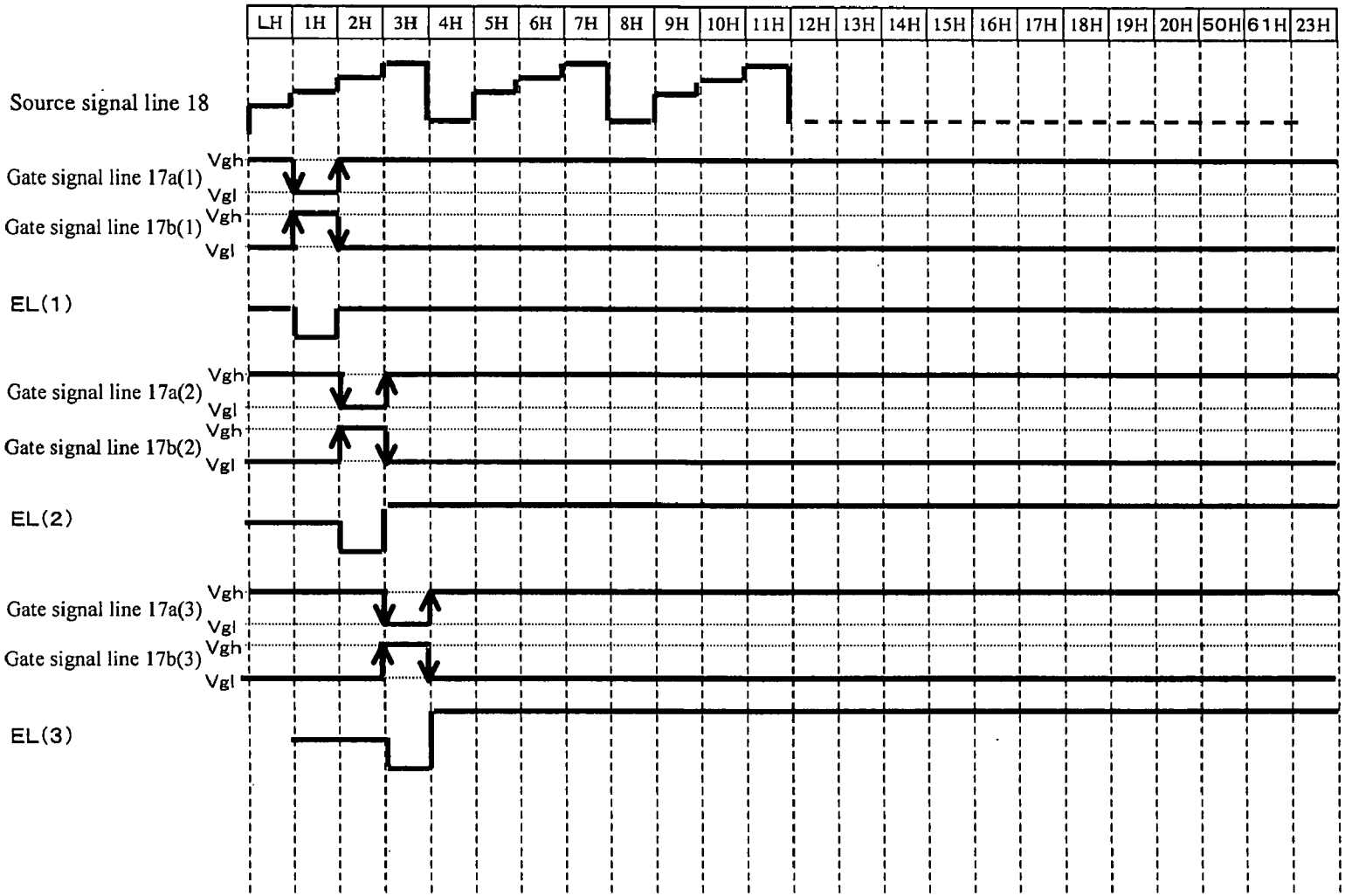
FIG. 4 is an explanatory diagram illustrating operation of a display panel according to the present invention.

A timing chart is shown in FIG. 4. The subscripts in brackets in FIG. 4 (e.g., (1)) indicate pixel row numbers. Specifically, a gate signal line 17*a* (1) denotes a gate signal line 17*a* in a pixel row (1). Also, *H (where "*" is an arbitrary symbol or numeral and indicates a horizontal scanning line number) in the top row in FIG. 4 indicates a horizontal scanning period. Specifically, 1 H is a first horizontal scanning period. Incidentally, the items (1 H number, 1-H cycle, order of pixel row numbers, etc.) described above are intended to facilitate explanation and are not intended to be restrictive.

As can be seen from FIG. 4, in each selected pixel row (it is assumed that the selection period is 1 H), when a turn-on voltage is applied to the gate signal line 17*a*, a turn-off voltage is applied to the gate signal line 17*b*. During this period, no current flows through the EL element 15 (non-illuminated). In non-selected pixel rows, a turn-off voltage is applied to the gate signal line 17*a* and a turn-on voltage is applied to the gate signal line 17*b*. During this period, a current flows through the EL element 15 (illuminated).

Incidentally, the gate of the transistor 11*a* and gate of the transistor 11*c* are connected to the same gate signal line 17*a*. However, the gate of the transistor 11*a* and gate of the transistor 11*c* may be connected to different gate signal lines 17 (see FIG. 32). Then, one pixel will have three gate signal lines (two in the configuration in FIG. 1). By controlling ON/OFF timing of the gate of the transistor 11*b* and ON/OFF timing of the gate of the transistor 11*c* separately, it is possible to further reduce variations in the current value of the EL element 15 due to variations in the transistor 11*a*.

By sharing the gate signal line 17*a* and gate signal line 17*b* and using different conductivity types (N-channel and P-channel) for the transistors 11*c* and 11*d*, it is possible to simplify the drive circuit and improve the aperture ratio of pixels.

With this configuration, a write paths from signal lines are turned off according to operation timing of the present invention That is, when a predetermined current is stored, an accurate current value is not stored in a capacitance (capacitor) between the source (S) and gate (G) of the transistor 11*a* if a current path is branched. By using different conductivity types for the transistors 11*c* and 11*d* and controlling their thresholds, it is possible to ensure that when scanning lines are switched, the transistor 11*d* is turned on after the transistor 11*c* is turned off.

In that case, however, since the thresholds of the transistors must be controlled accurately, it is necessary to pay attention to processes. The circuit described above can be implemented using four transistors at the minimum, but even if more than four transistors including a transistor 11*e* are cascaded for more accurate timing control or for reduction of mirror effect (described later), the principle of operation is the same. By adding the transistor 11*e*, it is possible to deliver programming current to the EL element 15 more precisely via the transistor 11*c*.

Figure 2:
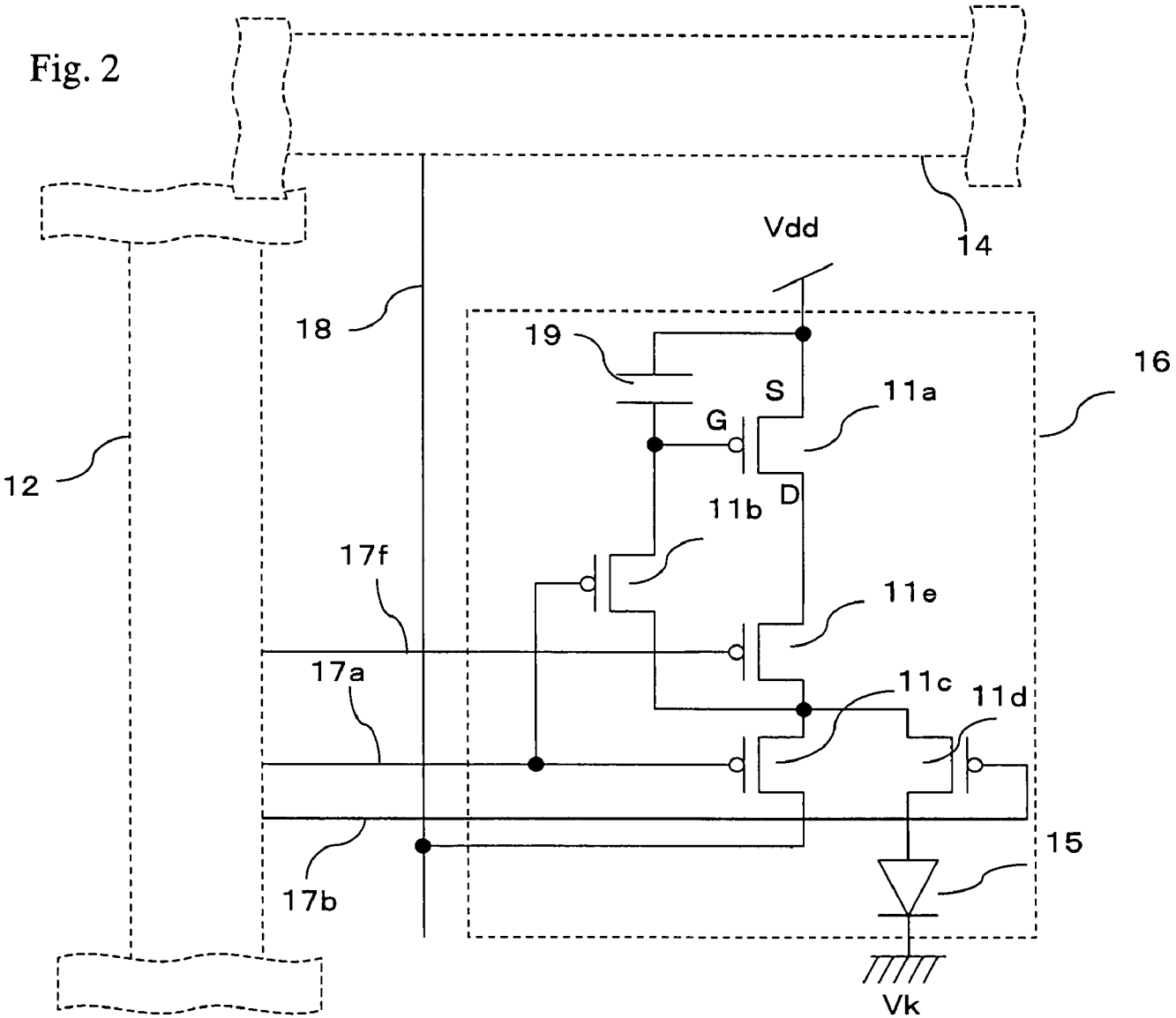
FIG. 2 is a block diagram of a pixel in a display panel according to the present invention.
Figure 113:
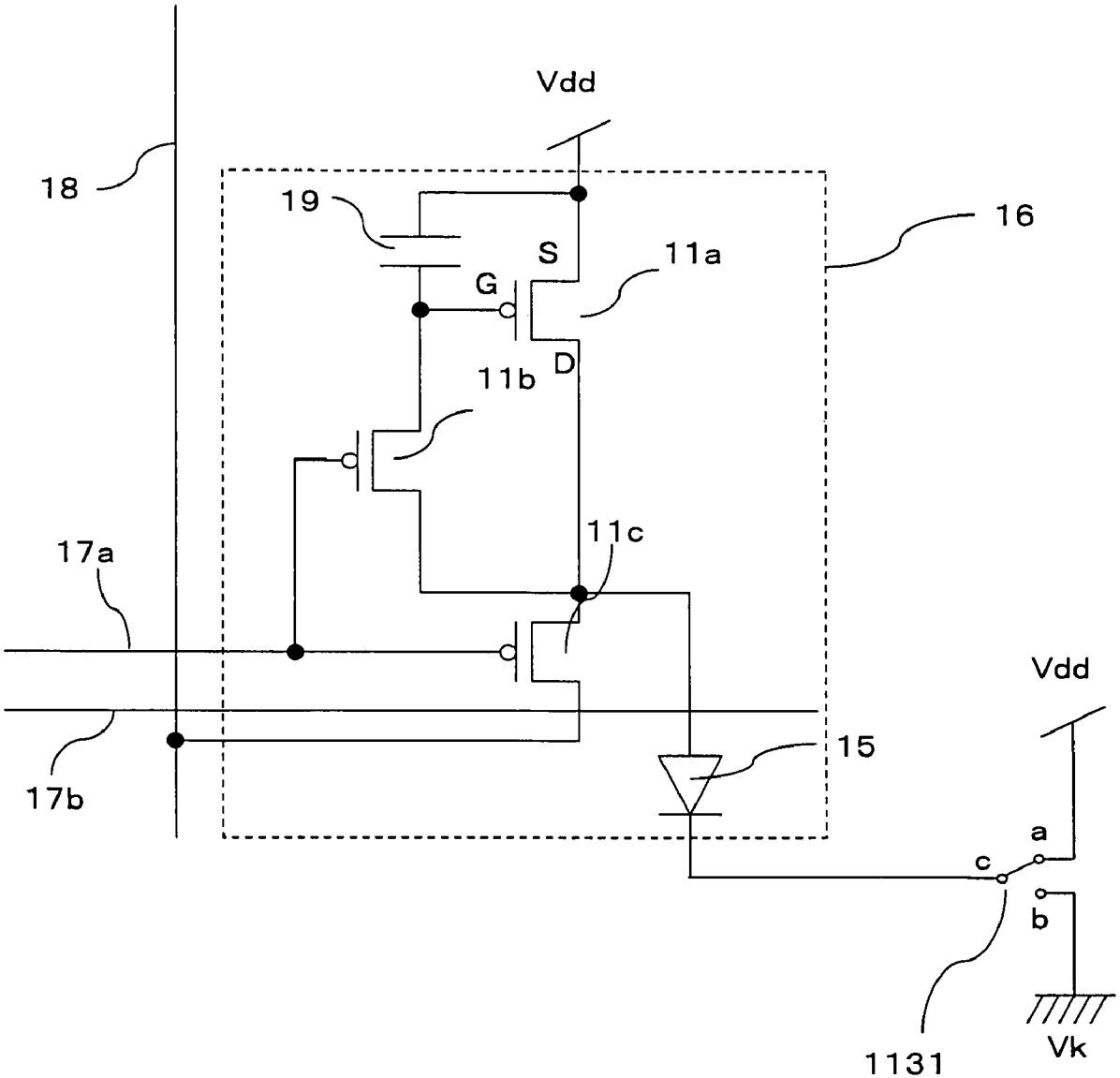
FIG. 113 is a block diagram of a pixel in a display panel according to the present invention.

Incidentally, the pixel configuration according to the present invention is not limited to those shown in FIGS. 1 and 2. For example, pixels may be configured as shown in FIG. 113. FIG. 113 lacks the transistor 11*d* unlike the configuration in FIG. 1. Instead, a changeover switch 1131 is formed or placed. The switch 11*d* in FIG. 1 functions to turn on and off (pass and shut off) the current delivered from the driver transistor 11*a* to the EL element 15. As also described in subsequent examples, the on/off control function of the transistor 11*d* constitutes an important part of the present invention. The configuration in FIG. 113 achieves the on/off function without using the transistor 11*d*.

In FIG. 113, a terminal a of the changeover switch 1131 is connected to anode voltage Vdd. Incidentally, the voltage applied to the terminal a is not limited to the anode voltage Vdd. It may be any voltage that can turn off the current flowing through the EL element 15.

A terminal b of the changeover switch 1131 is connected to cathode voltage (indicated as ground in FIG. 113). Incidentally, the voltage applied to the terminal b is not limited to the cathode voltage. It may be any voltage that can turn on the current flowing through the EL element 15.

A terminal c of the changeover switch 1131 is connected with a cathode terminal of the EL element 15. Incidentally, the changeover switch 1131 may be of any type as long as it has a capability to turn on and off the current flowing through the EL element 15. Thus, its installation location is not limited to the one shown in FIG. 113 and the switch may be located anywhere on the path through which current is delivered to the EL element 15. Also, the switch is not limited by its functionality as long as the switch can turn on and off the current flowing through the EL element 15. In short, the present invention can have any pixel configuration as long as switching means capable of turning on and off the current flowing through the EL element 15 is installed on the current path for the EL element 15.

Also, the term "off" here does not mean a state in which no current flows, but it means a state in which the current flowing through the EL element 15 is reduced to below normal. The items mentioned above also apply to other configurations of the present invention.

The changeover switch 1131 will require no explanation because it can be implemented easily by a combination of P-channel and N-channel transistors. For example, it can be implemented by two circuits of analog switches. Of course, the switch 1131 can be constructed of only P-channel or N-channel transistors because it only turns off the current flowing through the EL element 15.

When the switch 1131 is connected to the terminal a, the Vdd voltage is applied to the cathode terminal of the EL element 15. Thus, current does not flow through the EL element 15 regardless of the voltage state of voltage held by the gate terminal G of the driver transistor 11*a*. Consequently, the EL element 15 is non-illuminated.

When the switch 1131 is connected to the terminal b, the GND voltage is applied to the cathode terminal of the EL element 15. Thus, current flows through the EL element 15 according to the state of voltage held by the gate terminal G of the driver transistor 11*a*. Consequently, the EL element 15 is illuminated.

Thus, in the pixel configuration shown in FIG. 113, no switching transistor 11*d* is formed between the driver transistor 11*a* and the EL element 15. However, it is possible to control the illumination of the EL element 15 by controlling the switch 1131.

Figure 116:
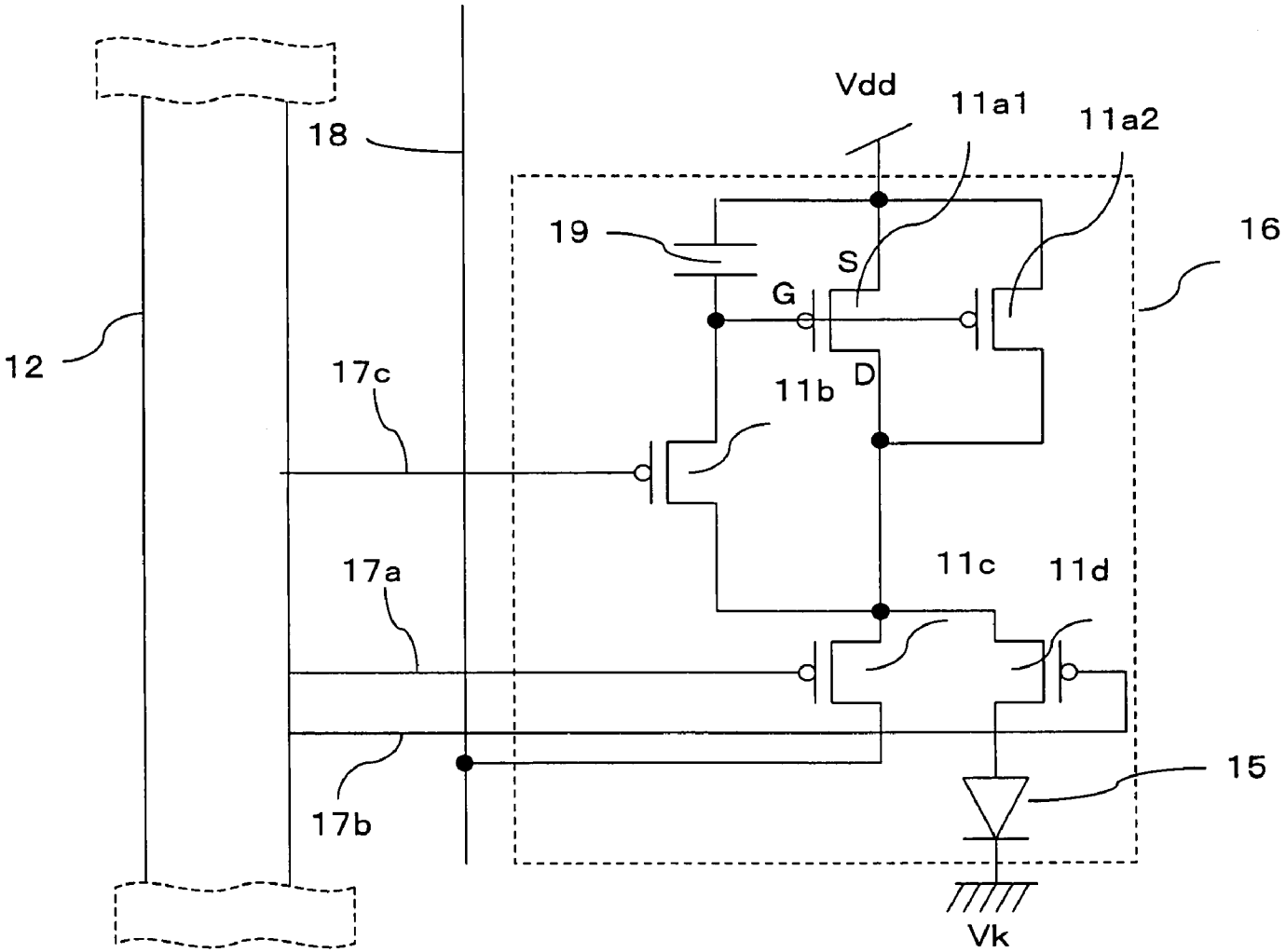
FIG. 116 is a block diagram of a pixel in a display panel according to the present invention.

In the pixel configurations shown in FIGS. 1, 2, etc., one pixel contains one driver transistor 11*a*. However, the present invention is not limited to this and one pixel may contain two or more driver transistors 11*a*. An example is shown in FIG. 116, where one pixel contains two driver transistors 11*a*1 and 11*a*2, whose gate terminals are connected to a common capacitor 19. By using a plurality of driver transistors 11*a*, it is possible to reduce variations in programming current. The other part of the configuration is the same as those shown in FIG. 1 and the like, and thus description thereof will be omitted.

In FIGS. 1 and 2, the current outputted by the driver transistor 11*a* is passed through the EL element 15 and turned on and off by the switching transistor 11*d* formed between the driver transistor 11*a* and the EL element 15. However, the present invention is not limited to this. For example, another configuration is illustrated in FIG. 117.

Figure 117:
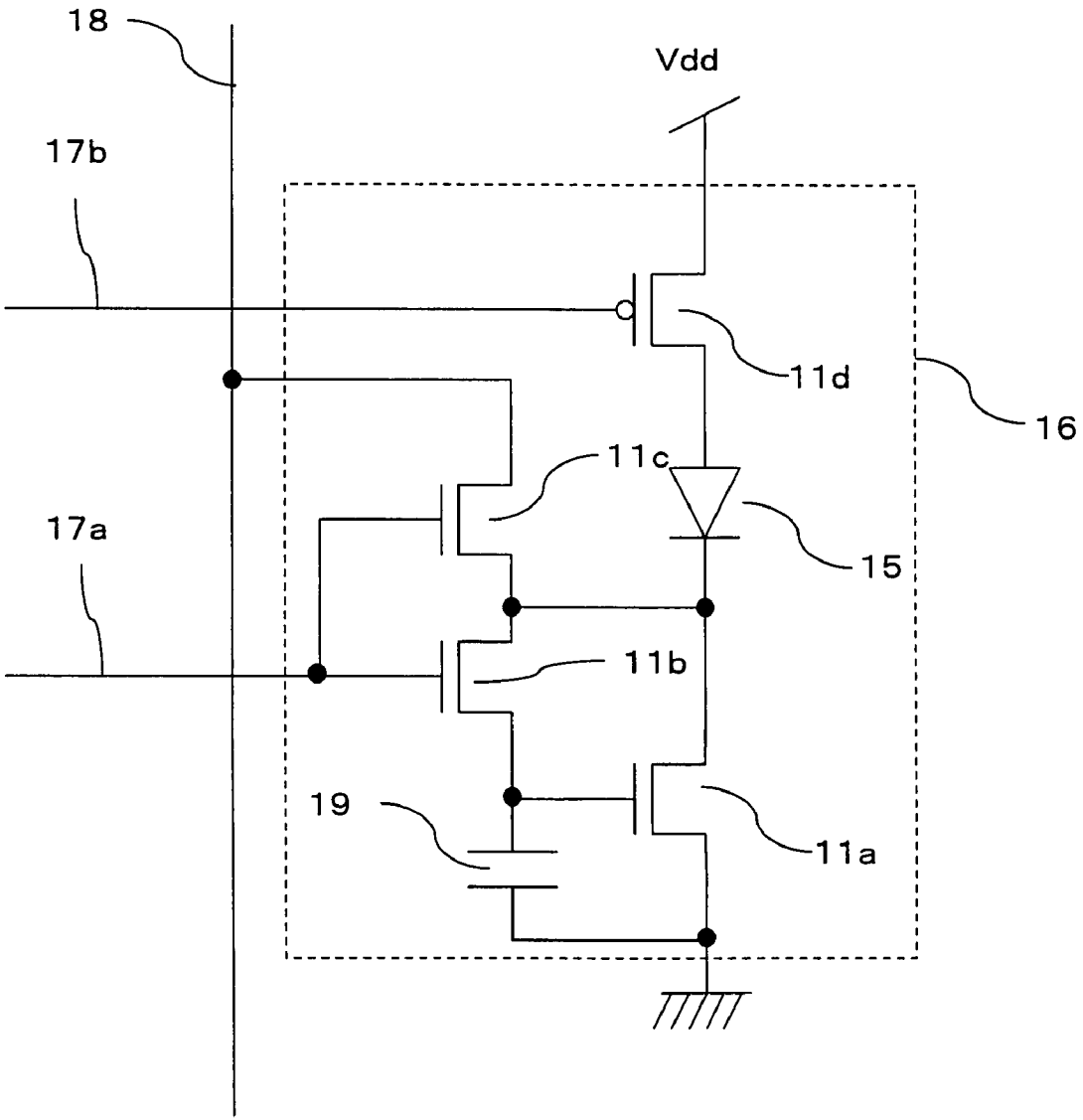
FIG. 117 is a block diagram of a pixel in a display panel according to the present invention.

In the example shown in FIG. 117, the current delivered to the EL element 15 is controlled by the driver transistor 11*a*. The current flowing through the EL element 15 is turned on and off by the switching element 11*d* placed between the Vdd terminal and EL element 15. Thus, according to the present invention, the switching element 11*d* may be placed anywhere as long as it can control the current flowing through the EL element 15.

Variations in the characteristics of the transistor 11*a* are correlated to the transistor size. To reduce the variations in the characteristics, preferably the channel length of the first transistor 11*a* is from 5 μm to 100 μm (both inclusive). More preferably, it is from 10 μm to 50 μm (both inclusive). This is probably because a long channel length L increases grain boundaries contained in the channel, reducing electric fields, and thereby suppressing kink effect.

Thus, according to the present invention, circuit means which controls the current flowing through the EL element 15 is constructed, formed, or placed on the path along which current flows into the EL element 15 and the path along which current flows out of the EL element 15 (i.e., the current path for the EL element 15).

Figure 114:
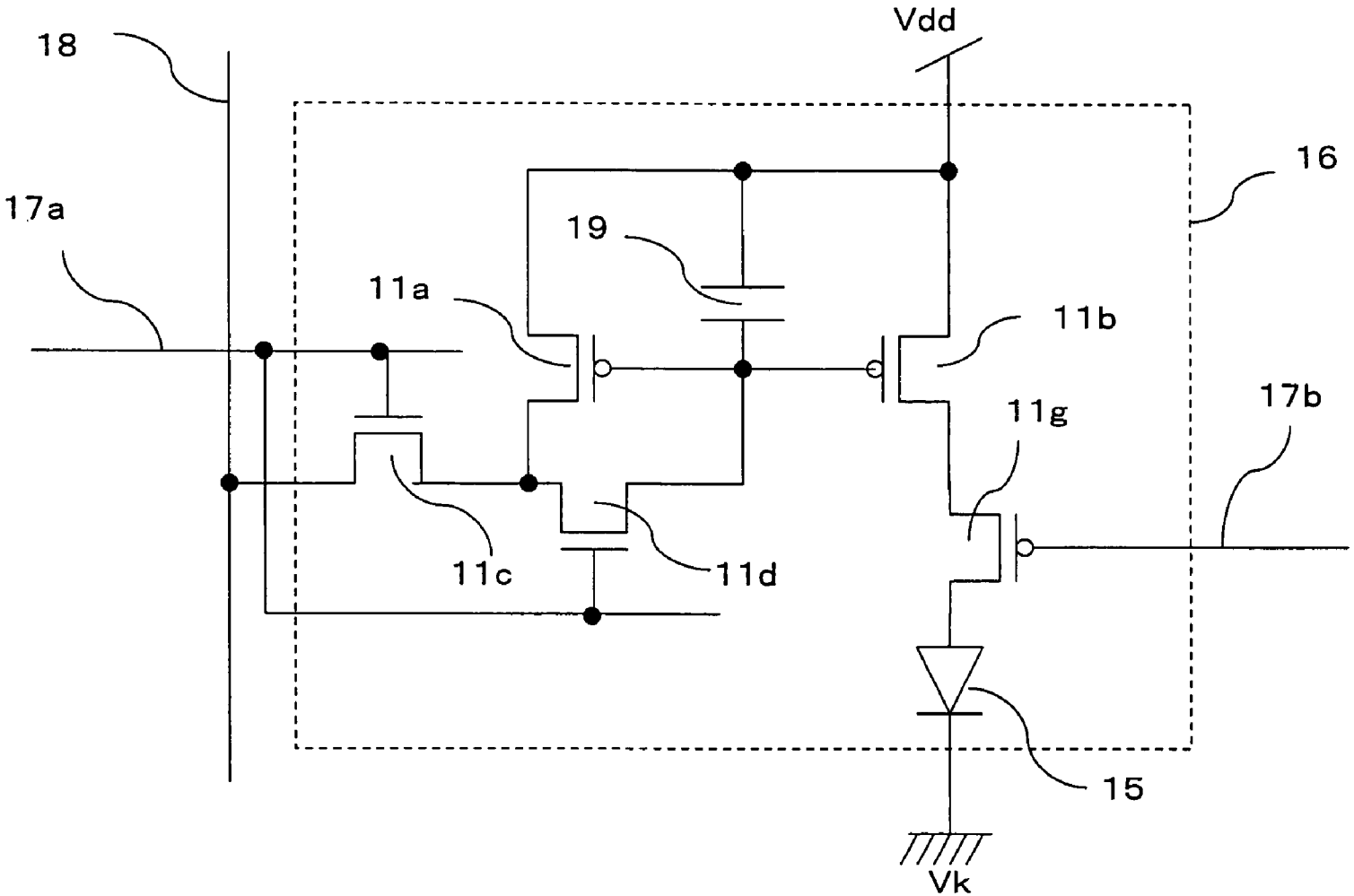
FIG. 114 is a block diagram of a pixel in a display panel according to the present invention.

Even in the case of current mirroring, a type of current programming, by forming or placing a transistor 11*g* as a switching element between the driver transistor 11*b* and EL element 15 as shown in FIG. 114, it is possible to turn on and off (control) the current flowing through the EL element 15. Of course, the transistor 11*g* may be substituted with the switch 1131 in FIG. 113.

Figure 115:
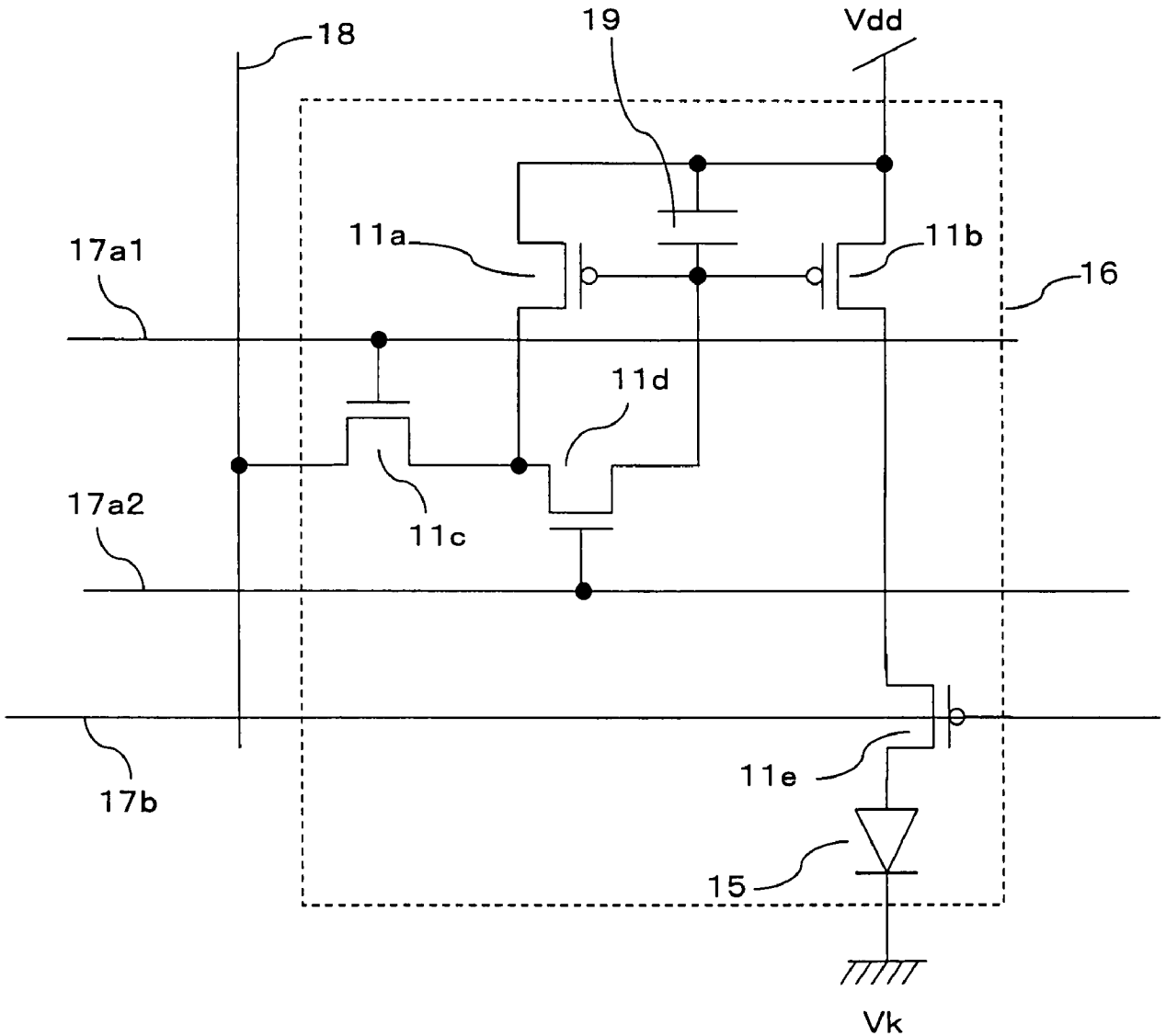
FIG. 115 is a block diagram of a pixel in a display panel according to the present invention.

Incidentally, although the switching transistors 11*d* and 11*c* in FIG. 114 are connected to a single gate signal line 17*a*, the switching transistor 11*c* may be controlled by a gate signal line 17*a*1 and the switching transistor 11*d* may be controlled by a gate signal line 17*a*2 as shown in FIG. 115. The configuration in FIG. 115 makes pixel 16 control more versatile.

Figure 42B:
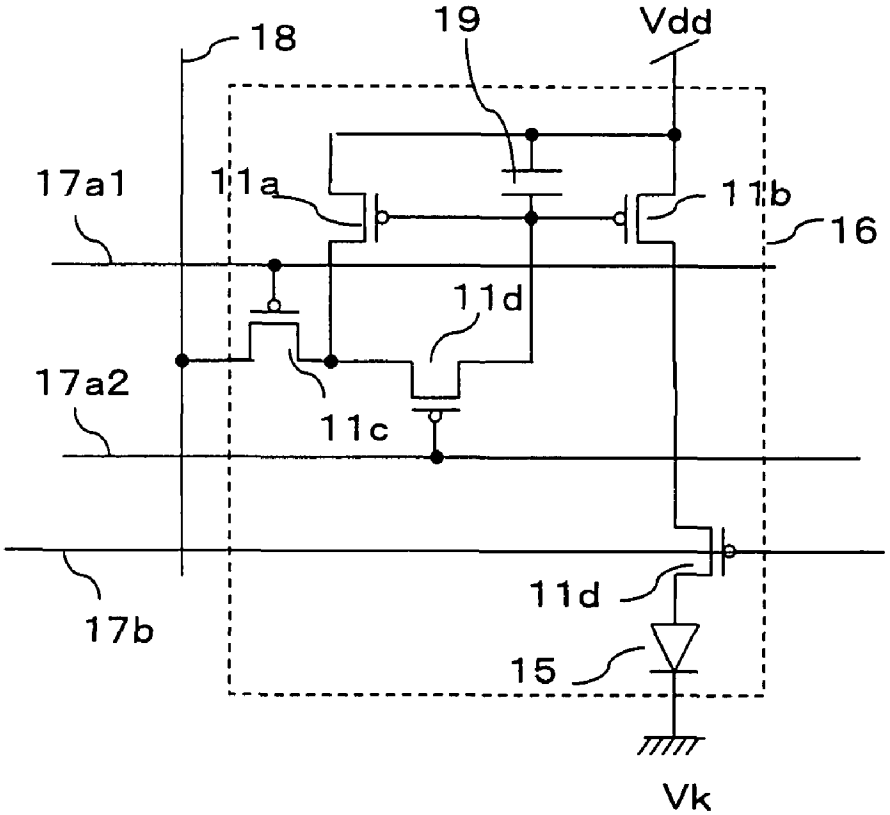
FIG. 42 is a block diagram of a pixel in a display panel according to the present invention.
Figure 42A:
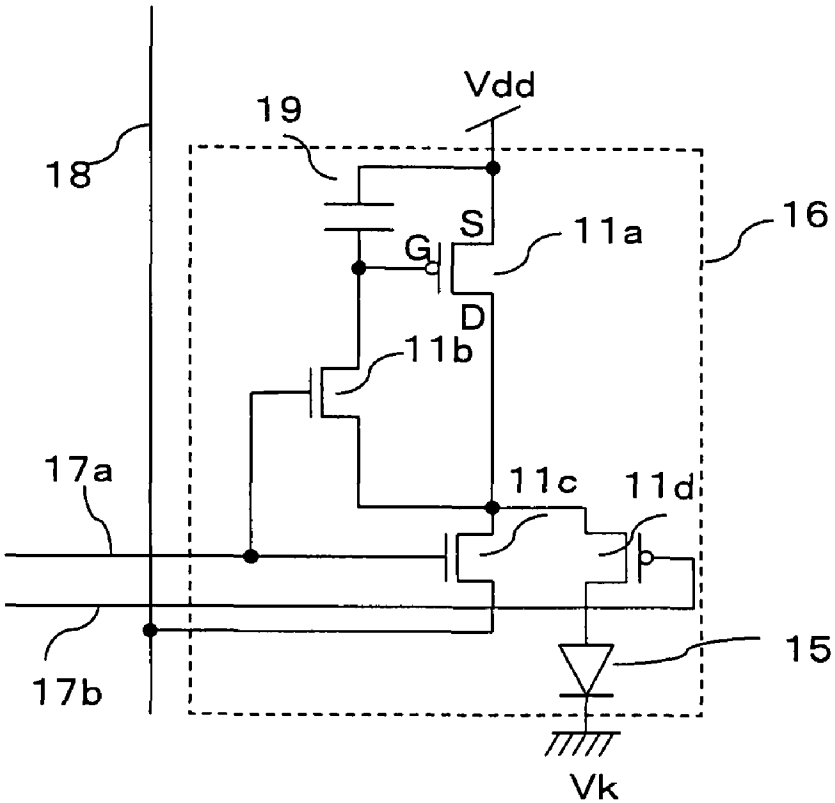

As shown in FIG. 42(*a*), the transistors 11*b* and 11*c* may be N-channel transistors. Also, as shown in FIG. 42(*b*), the transistors 11*c* and 11*d* may be P-channel transistors.

An object of the present invention is to propose a circuit configuration in which variations in transistor characteristics do not affect display. Four or more transistors are required for that. When determining circuit constants using transistor characteristics, it is difficult to determine appropriate circuit constants unless the characteristics of the four transistors are not consistent. Both thresholds of transistor characteristics and mobility of the transistors vary depending on whether the channel direction is horizontal or vertical with respect to the longitudinal axis of laser irradiation. Incidentally, variations are more of the same in both cases. However, the mobility and average threshold vary between the horizontal direction and vertical direction. Thus, it is desirable that all the transistors in a pixel have the same channel direction.

Also, if the capacitance value of the storage capacitance 19 is Cs and the turn-off current value of the second transistor 11*b* is Ioff, preferably the following equation is satisfied.

$$3<Cs/Ioff<24$$

More preferably the following equation is satisfied.

$$6<Cs/Ioff<18$$

By setting the turn-off current of the transistor 11*b* to 5 pA or less, it is possible to reduce changes in the current flowing through the EL to 2% or less. This is because when leakage current increases, electric charges stored between the gate and source (across the capacitor) cannot be held for one field with no voltage applied. Thus, the larger the storage capacity of the capacitor 19, the larger the permissible amount of the turn-off current. By satisfying the above equation, it is possible to reduce fluctuations in current values between adjacent pixels to 2% or less.

Also, preferably transistors composing an active matrix are p-channel polysilicon thin-film transistors and the transistor 11*b* is a dual-gate or multi-gate transistor. As high an ON/OFF ratio as possible is required of the transistor 11*b*, which acts as a source-drain switch for the transistor 11*a*. By using a dual-gate or multi-gate structure for the transistor 11*b*, it is possible to achieve a high ON/OFF ratio.

The semiconductor films composing the transistors 11 in the pixel 16 are generally formed by laser annealing in low-temperature polysilicon technology. Variations in laser annealing conditions result in variations in transistor 11 characteristics. However, if the characteristics of the transistors 11 in the pixel 16 are consistent, it is possible to drive the pixel using current programming such as the one shown in FIG. 1 so that a predetermined current will flow through the EL element 15. This is an advantage lacked by voltage programming. Preferably the laser used is an excimer laser.

Incidentally, the semiconductor film formation according to the present invention is not limited to the laser annealing method. The present invention may also use a heat annealing method and a method which involves solid-phase (CGS) growth. Besides, the present invention is not limited to the low-temperature polysilicon technology and may use high-temperature polysilicon technology. Also, the semiconductor films may be formed by amorphous silicon technology.

Figure 7:
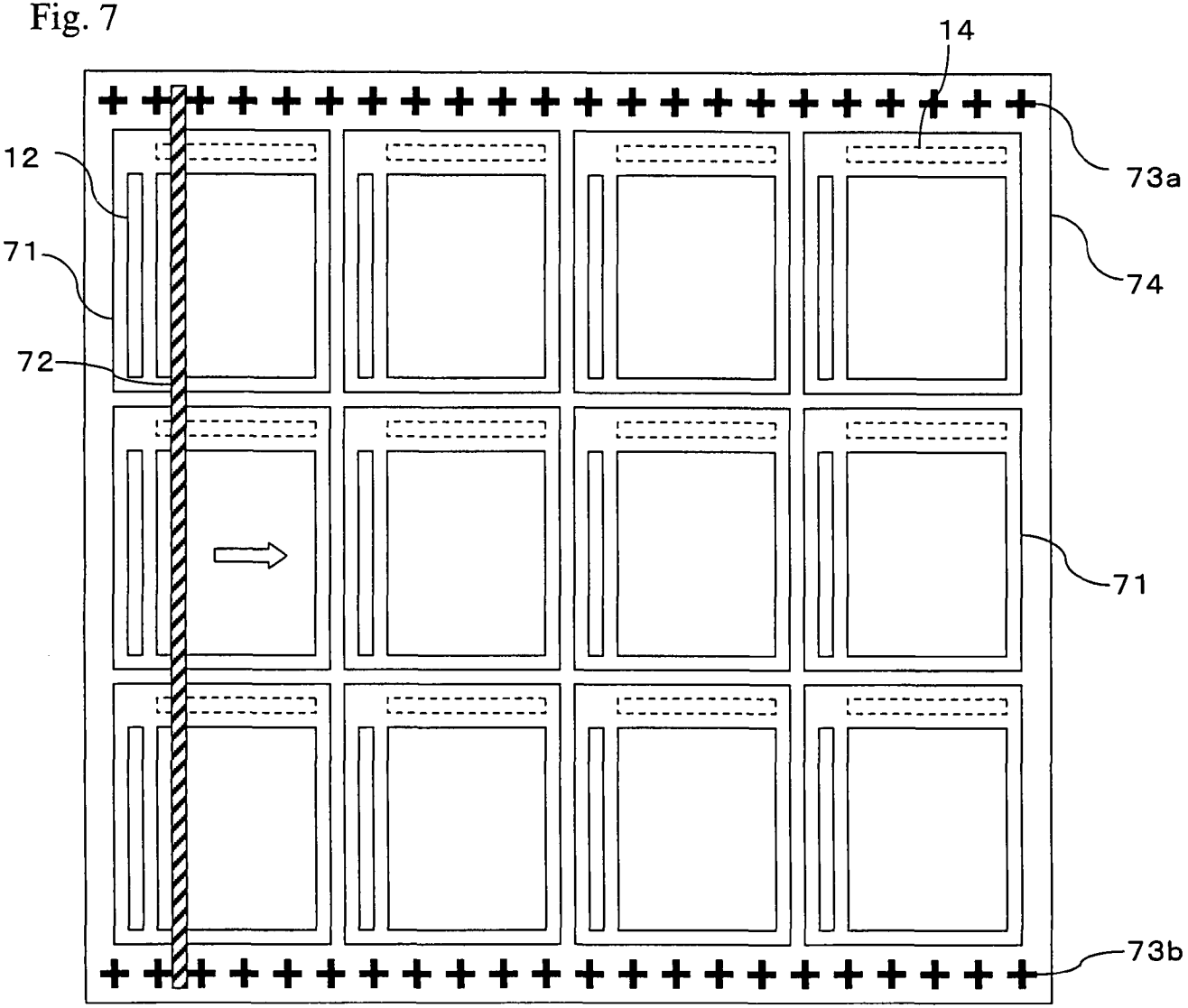
FIG. 7 is an explanatory diagram illustrating a manufacturing method of a display panel according to the present invention.

To deal with this problem, the present invention moves a laser spot (laser irradiation range) 72 in parallel to the source signal line 18 as shown in FIG. 7. Also, the laser spot 72 is moved in such a way as to align with one pixel row. Of course, the number of pixel rows is not limited to one. For example, laser may be shot by treating RGB in FIG. 55 (three pixel columns in this case) as a single pixel 16. Also, laser may be directed at two or more pixels at a time. Needless to say, moving laser irradiation ranges may overlap (it is usual for moving laser irradiation ranges to overlap).

Pixels are constructed in such a way that three pixels of RGB will form a square shape. Thus, each of the R, G, B pixels has oblong shape. Consequently, by performing annealing using an oblong laser spot 72, it is possible to eliminate variations in the characteristics of the transistors 11 within each pixel. Also, the characteristics (mobility, Vt, S value, etc.) of the transistors 11 connected to the same source signal line 18 can be made uniform (i.e., although the transistors 11 connected to adjacent source signal lines 18 may differ in characteristics, the characteristics of the transistors 11 connected to the same source signal line can be made almost equal).

In the configuration shown in FIG. 7, three panels are placed lengthwise within the length of the laser spot 72. An annealing apparatus which emits the laser spot 72 recognizes positioning markers 73*a* and 73*b* on a glass substrate 74 (automatic positioning based on pattern recognition) and moves the laser spot 72. The positioning markers 73 are recognized by a pattern recognition apparatus. The annealing apparatus (not shown) recognizes the positioning markers 73 and determines the location of the pixel column (makes the laser irradiation range 72 parallel to the source signal line 18). It emits the laser spot 72 in such a way as to overlap with the location of each pixel column for sequential annealing.

Preferably, the laser annealing method (which involves emitting a linear laser spot in parallel to the source signal line 18) described with reference to FIG. 7 is used for current programming of an organic EL display panel, in particular. This is because the transistors 11 placed in the direction parallel to the source signal line have the same characteristics (the characteristics of the pixel transistors adjacent in the longitudinal direction are quite similar to each other). This reduces changes in the voltage level of the source signal lines when the pixels are driven by current, and thus reduces the chances of insufficient write current.

For example, in the case of white raster display, since almost the same current is passed through the transistors 11*a* in adjacent pixels, the current outputted from the source driver IC 14 does not have significant amplitude changes. If the transistors 11*a* in FIG. 1 have the same characteristics and the currents used for current programming of pixels have the same value within the pixel column, the potential of the source signal line 18 during the current programming is constant. Thus, no potential fluctuation occurs in the source signal line 18. If the transistors 11*a* connected to the same source signal line 18 have almost the same characteristics, there should be no significant potential fluctuation in the source signal line 18. This is also true to other current-programmable pixel configurations such as the one shown in FIG. 38 (thus, it is preferable to use the manufacturing method shown in FIG. 7).

Figure 27B:
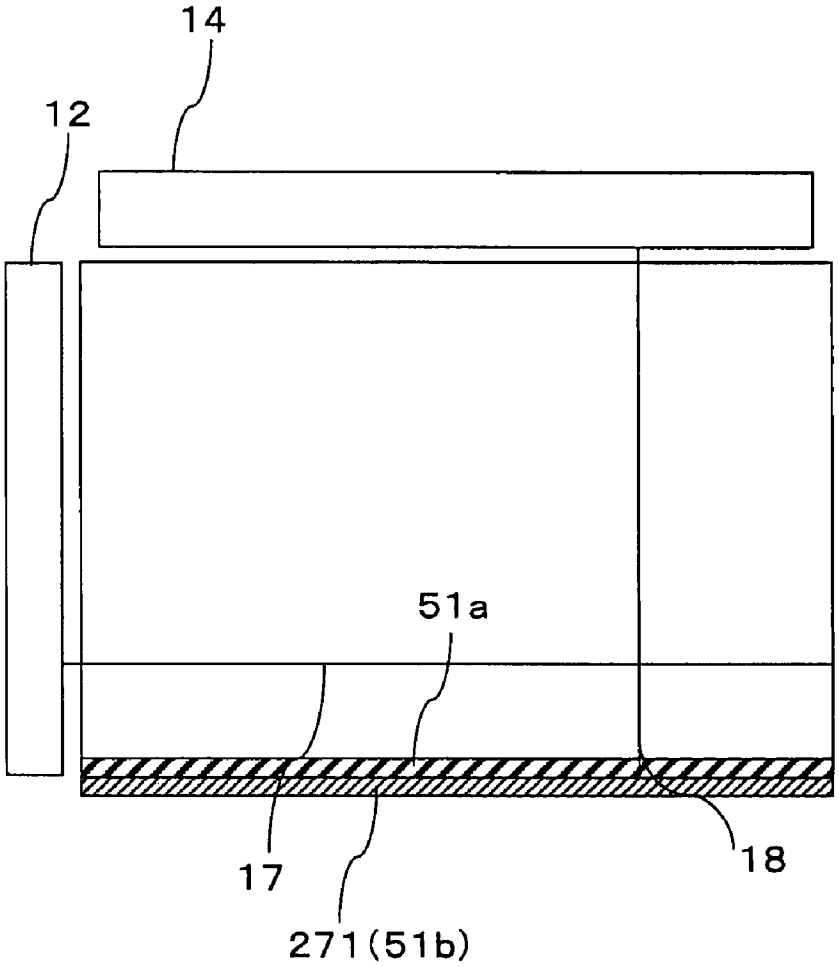
FIG. 27 is an explanatory diagram illustrating a drive method of a display apparatus according to the present invention.
Figure 27A:
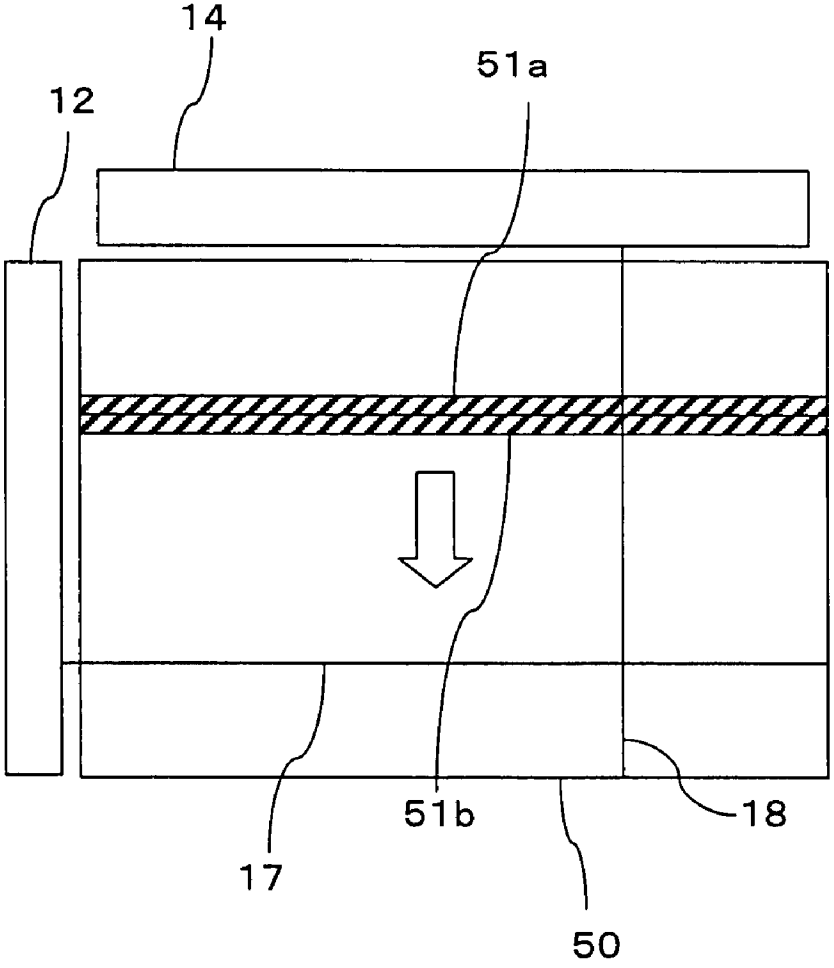

A method which involves programming two or more pixel rows simultaneously and which are described with reference to FIG. 27, 30, etc. can achieve a uniform image display (because the method is not prone to display irregularities due mainly to variations in transistor characteristics). In the case of FIG. 27, etc., since a plurality of pixel rows are selected simultaneously, if the transistors in adjacent pixel rows are uniform, irregularities in the characteristics of the transistors placed in the lengthwise direction can be absorbed by the source driver circuit 14.

Incidentally, although an IC chip is illustrated in FIG. 7 as being stacked on the source driver circuit 14, this is not restrictive and it goes without saying that the source driver circuit 14 may be formed in the same process as the pixel 16.

The present invention, in particular, ensures that a voltage threshold Vth2 of the driver transistor 11*b* will not fall below a voltage threshold Vth1 of the corresponding driver transistor 11*a* in the pixel. For example, gate length L2 of the transistor 11*b* is made longer than gate length L1 of the transistor 11*a* so that Vth2 will not fall below Vth1 even if process parameters of these thin-film transistors change. This makes it possible to suppress subtle current leakage.

Figure 38:
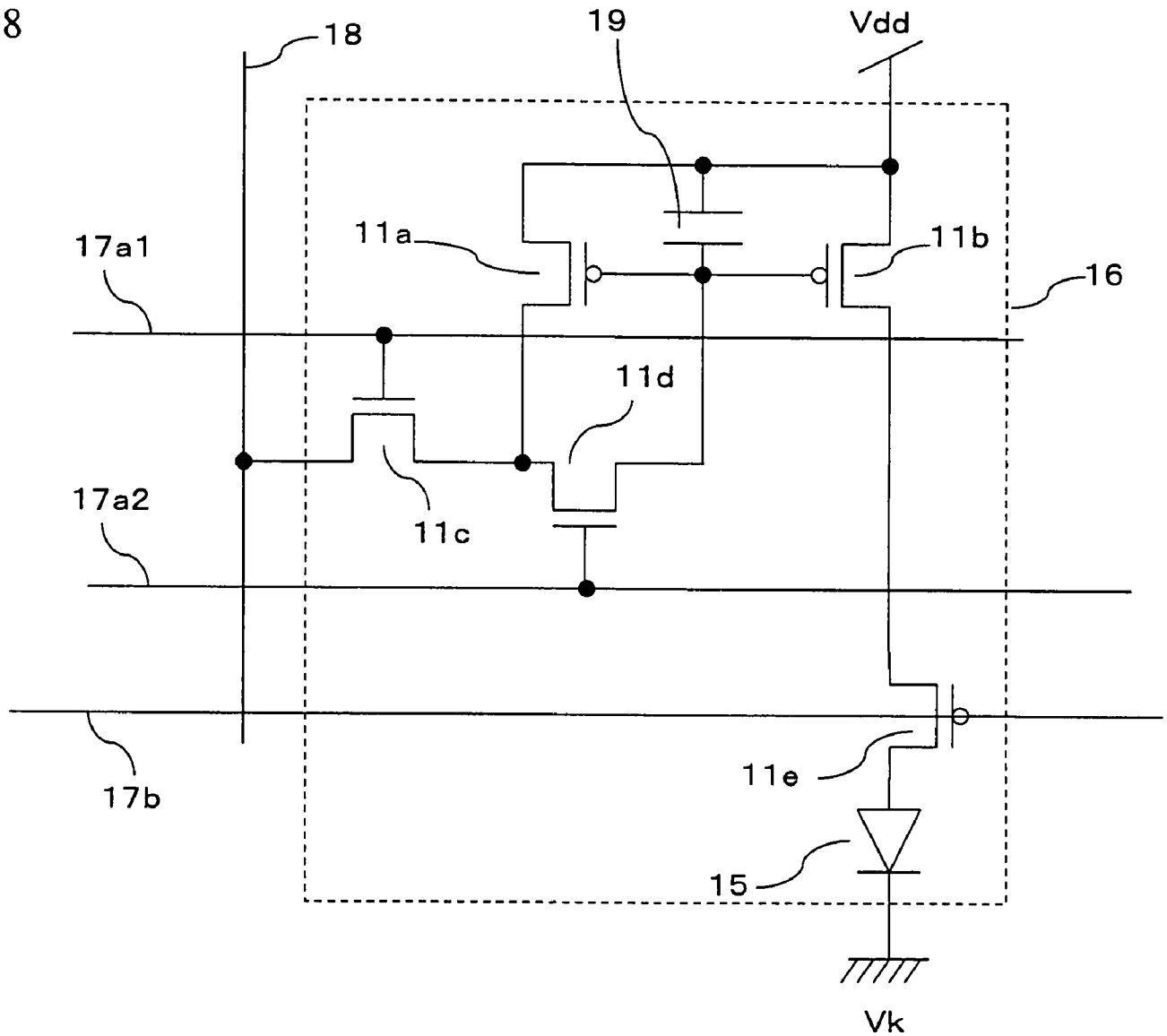
FIG. 38 is a block diagram of a pixel in a display panel according to the present invention.

Incidentally, the items mentioned above also apply to pixel configuration of a current mirror shown in FIG. 38. The pixel in FIG. 38 consists of a driver transistor 11*a* through which a signal current flows, a driver transistor 11*b* which controls drive current flowing through a light-emitting element such as an EL element 15, a transistor 11*c* which connects or disconnects a pixel circuit and data line "data" by controlling a gate signal line 17*a*1, a switching transistor 11*d* which shorts the gate and drain of the transistor 11*a* during a write period by controlling a gate signal line 17*a*2, a capacitance C19 which holds gate-source voltage of the transistor 11*a* after application of voltage, the EL element 15 serving as a light-emitting element, etc.

In FIG. 38, the transistors 11*c* and 11*d* are N-channel transistors and other transistors are P-channel transistors, but this is only exemplary and are not restrictive. A capacitance Cs has its one end connected to the gate of the transistor 11*a*, and the other end to Vdd (power supply potential), but it may be connected to any fixed potential instead of Vdd. The cathode (negative pole) of the EL element 15 is connected to the ground potential.

Figure 6:
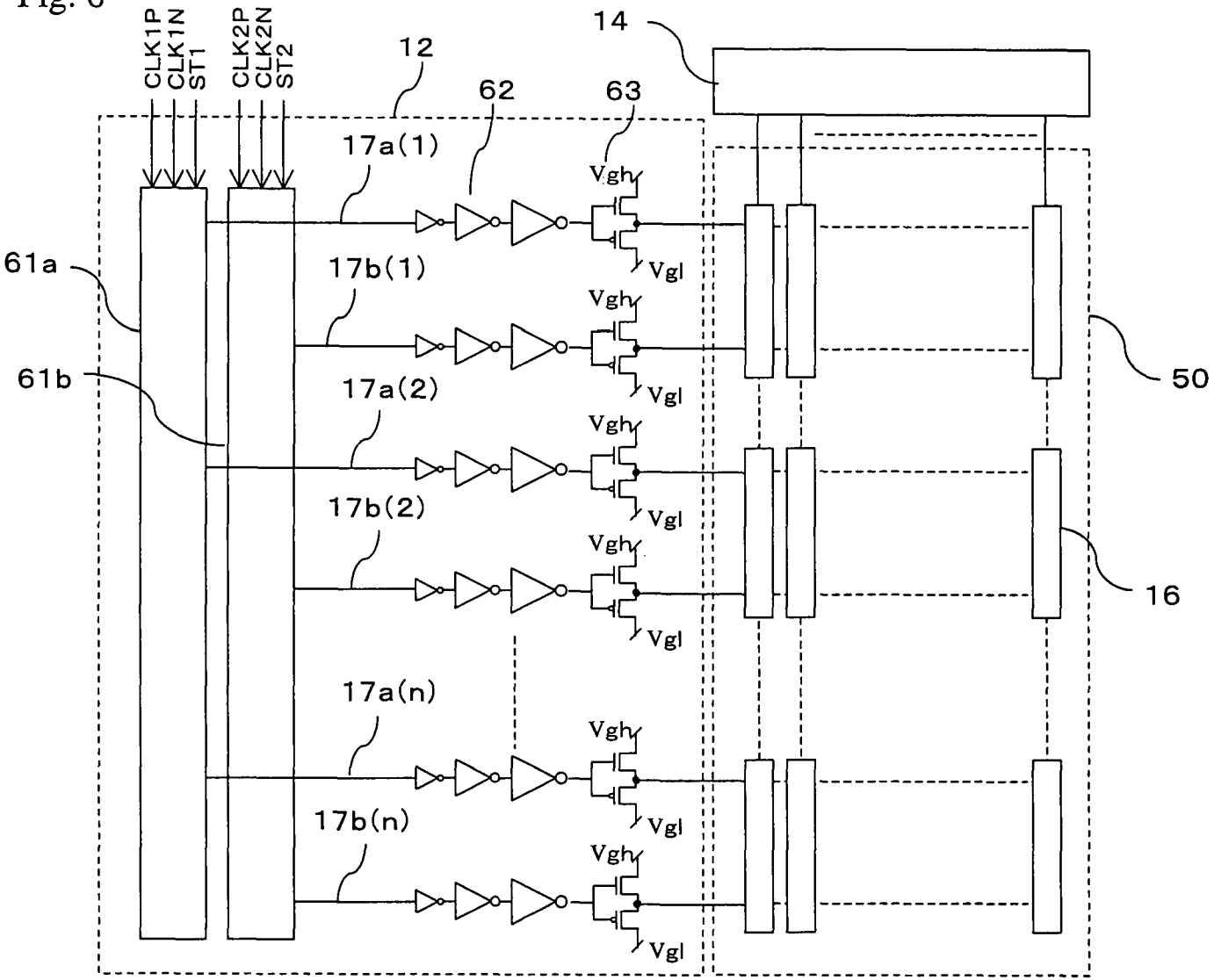
FIG. 6 is a block diagram of a display apparatus according to the present invention.

Next, the EL display panel or EL display apparatus of the present invention will be described. FIG. 6 is an explanatory diagram which mainly illustrates a circuit of the EL display apparatus. Pixels 16 are arranged or formed in a matrix. Each pixel 16 is connected with a source driver circuit 14 which outputs current for use in current programming of the pixel. In an output stage of the source driver circuit 14 are current mirror circuits (described later) corresponding to the bit count of a video signal. For example, if 64 gradations are used, 63 current mirror circuits are formed on respective source signal lines so as to apply desired current to the source signal lines 18 when an appropriate number of current mirror circuits is selected (see FIG. 48).

Incidentally, the minimum output current of one current mirror circuit is from 10 nA to 50 nA (both inclusive). Preferably, the minimum output current of the current mirror circuit should be from 15 nA to 35 nA (both inclusive) to secure accuracy of the transistors composing the current mirror circuit in the source driver IC 14.

Besides, a precharge or discharge circuit is incorporated to charge or discharge the source signal line 18 forcibly. Preferably, voltage (current) output values of the precharge or discharge circuit which charges or discharges the source signal line 18 forcibly can be set separately for R, G, and B. This is because the thresholds of the EL element 15 differ among R, G, and B (regarding the precharge circuit refer to FIGS. 65 and 67 and its explanation).

Organic EL elements are known to have heavy temperature dependence (temperature characteristics). To adjust changes in emission brightness caused by the temperature characteristics, reference current is adjusted (varied) in an analog fashion by adding nonlinear elements such as thermistors or posistors to the current mirror circuits to vary output current and adjusting the changes due to the temperature characteristics with the thermistors or the like.

According to the present invention, the source driver circuit 14 is made of a semiconductor silicon chip and connected with a terminal on the source signal line 18 of the array board 71 by chip-on-glass (COG) technology. The source driver circuit 14 can be mounted not only by the COG technology. It is also possible to mount the source driver circuit 14 by chip-on-film (COF) technology and connect it to the signal lines of the display panel. Regarding the driver IC, it may be made of three chips by constructing a power supply IC 82 separately.

On the other hand, the gate driver circuit 12 is formed by low-temperature polysilicon technology. That is, it is formed in the same process as the transistors in pixels. This is because the gate driver circuit 12 has a simpler internal structure and lower operating frequency than the source driver circuit 14. Thus, it can be formed easily even by low-temperature polysilicon technology and allows bezel width to be reduced. Of course, it is possible to construct the gate driver circuit 12 from a silicon chip and mount it on the array board 71 using the COG technology. Also, switching elements such as pixel transistors as well as gate drivers may be formed by high-temperature polysilicon technology or may be formed of an organic material (organic transistors).

The gate driver circuit 12 incorporates a shift register circuit 61*a* for a gate signal line 17*a* and a shift register circuit 61*b* for a gate signal line 17*b*. The shift register circuits 61 are controlled by positive-phase and negative-phase clock signals (CLKxP and CLKxN) and a start pulse (STx) (see FIG. 6). Besides, it is preferable to add an enable (ENABL) signal which controls output and non-output from the gate signal line and an up-down (UPDWN) signal which turns a shift direction upside down. Also, it is preferable to install an output terminal to ensure that the start pulse is shifted by the shift register and is outputted. Incidentally, shift timings of the shift registers are controlled by a control signal from a control IC 81. Also, the gate driver circuit 12 incorporates a level shift circuit which level-shifts external data.

Since the shift register circuits 61 have small buffer capacity, they cannot drive the gate signal lines 17 directly. Therefore, at least two or more inverter circuits 62 are formed between each shift register circuit 61 and an output gate 63 which drives the gate signal line 17.

The same applies to cases in which the source driver circuit 14 is formed on the array board 71 by polysilicon technology such as low-temperature polysilicon technology. A plurality of inverter circuits are formed between an analog switching gate such as a transfer gate which drives the source signal line 18 and the shift register of the source driver circuit 14. The following matters (shift register output and output stages which drive signal lines (inverter circuits placed between output stages such as output gates or transfer gates)) are common to the gate driver circuit and source driver circuit.

For example, although the output from the source driver circuit 14 is shown in FIG. 6 as being connected directly to the source signal line 18, actually the output from the shift register of the source driver is connected with multiple stages of inverter circuits, and the inverter outputs are connected to analog switching gates such as transfer gates.

The inverter circuit 62 consists of a P-channel MOS transistor and N-channel MOS transistor. As described earlier, the shift register circuit 61 of the gate driver circuit 12 has its output end connected with multiple stages of inverter circuits 62 and the final output is connected to the output gate 63. Incidentally, the inverter circuit 62 may be composed solely of P-channel MOS transistors. In that case, however, the circuit may be configured simply as a gate circuit rather than an inverter.

Figure 8:
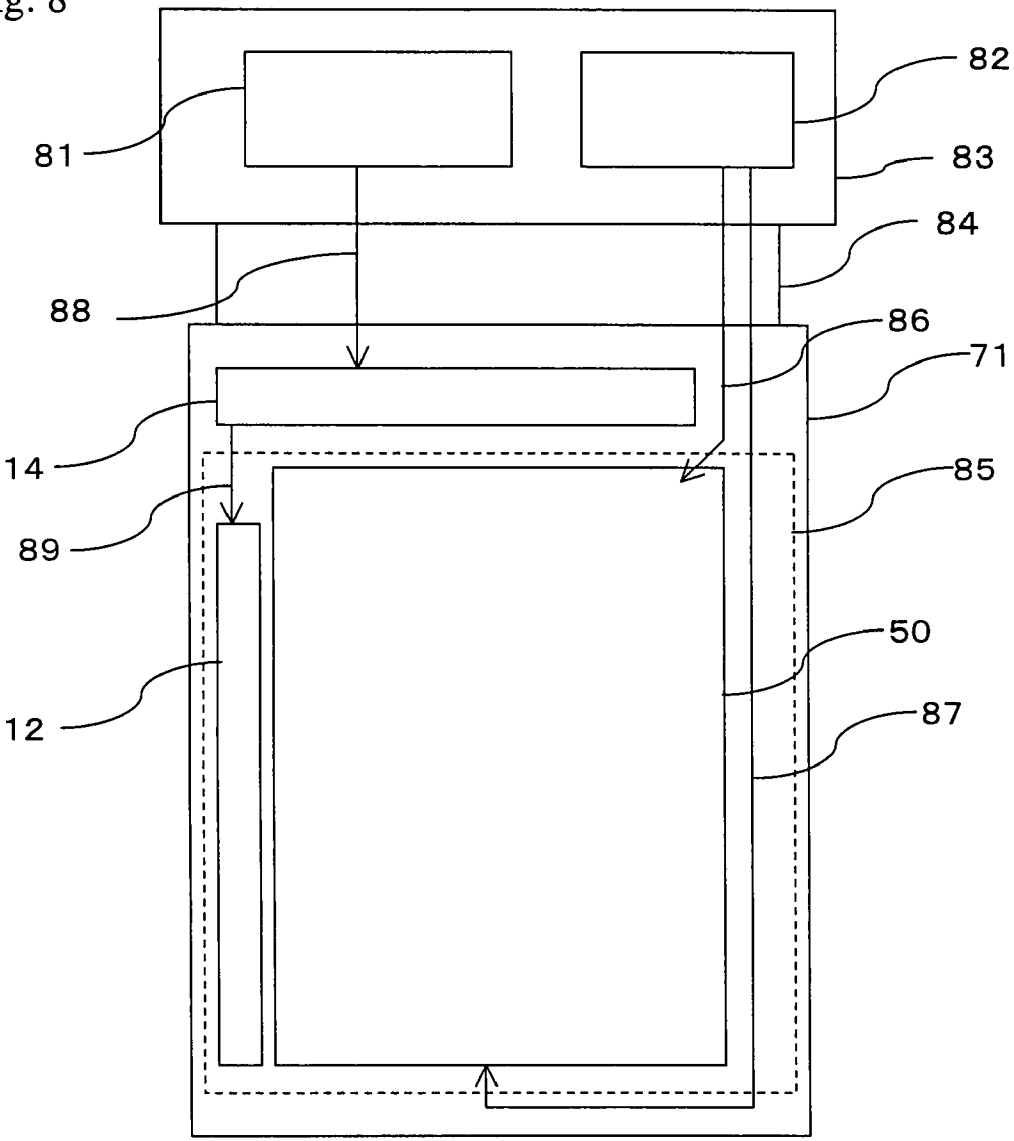
FIG. 8 is a block diagram of a display apparatus according to the present invention.

FIG. 8 is a block diagram of signal and voltage supplies on a display apparatus according to the present invention or a block diagram of the display apparatus. Signals (power supply wiring, data wiring, etc.) are supplied from the control IC 81 to a source driver circuit 14*a* via a flexible board 84.

In FIG. 8, a control signal for the gate driver circuit 12 is generated by the control IC, level-shifted by the source driver circuit 14, and applied to the gate driver circuit 12. Since drive voltage of the source driver circuit 14 is 4 to 8 (V), the control signal with an amplitude of 3.3 (V) outputted from the control IC 81 can be converted into a signal with an amplitude of 5 (V) which can be received by the gate driver circuit 12.

In FIG. 8 and the like, what is denoted by reference numeral 14 has been described as a source driver, but instead of being a mere driver, it may incorporate a power circuit, buffer circuit (including a circuit such as a shift register), data conversion circuit, latch circuit, command decoder, shifting circuit, address conversion circuit, image memory, etc. Needless to say, a three-side free configuration or other configuration, drive system, etc. described with reference to FIG. 9 and the like are also applicable to the configuration described with reference to FIG. 8 and the like.

Figure 9:
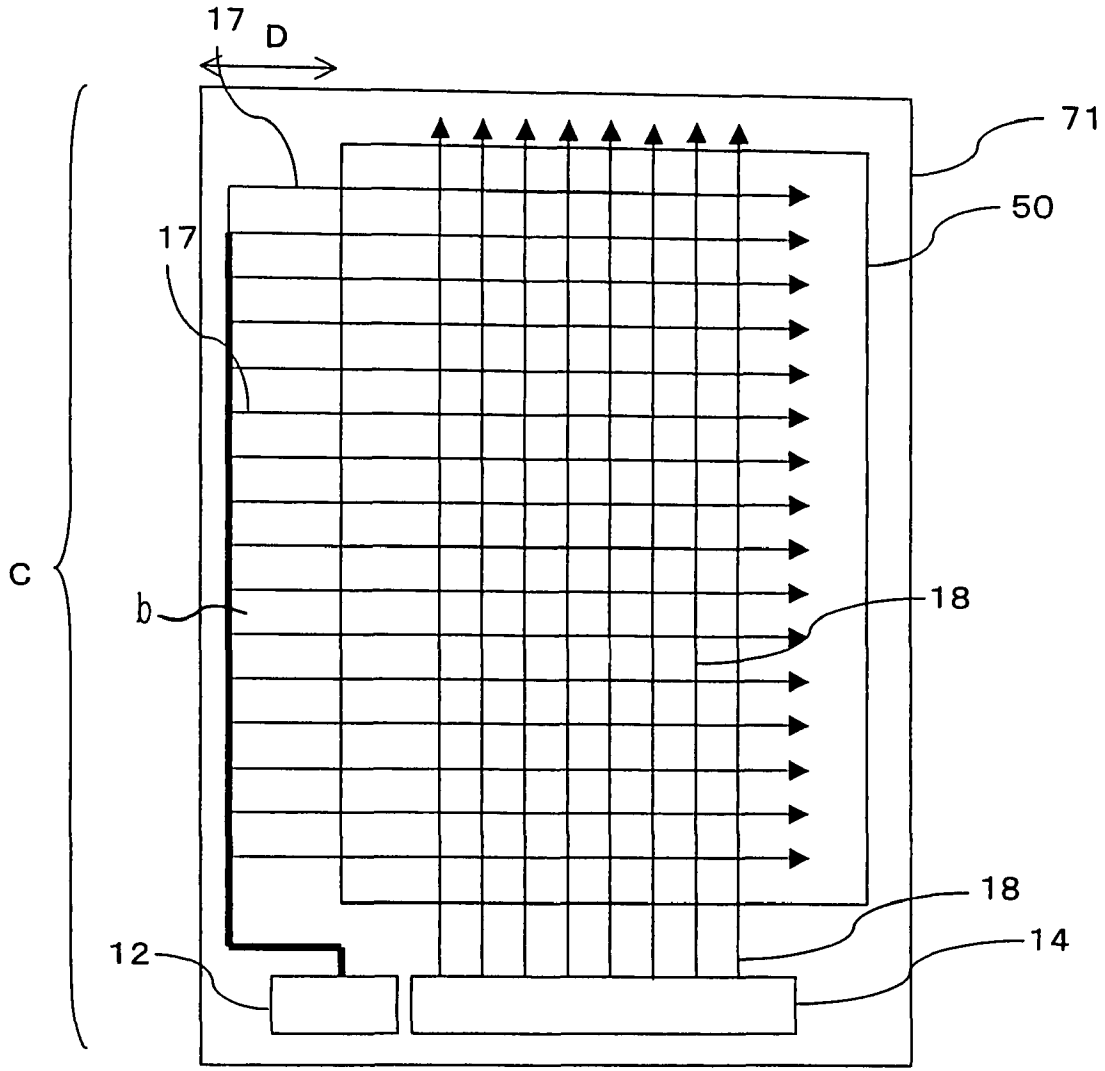
FIG. 9 is a block diagram of a display apparatus according to the present invention.

When the display panel is used for information display apparatus such as a cell phone, it is preferable to mount (form) the source driver IC (circuit) 14 and gate driver IC (circuit) 12 on one side of the display panel as shown in FIG. 9 (incidentally, a configuration in which driver ICs (circuits) are mounted (formed) on one side of a display panel is referred to as a three-side free configuration (structure). Conventionally, the gate driver IC 12 is mounted on an X side of a display area and a source driver IC 14 is mounted on a Y side). This makes it easy in the design to center the center line of a display screen 50 on the display apparatus and mount the driver ICs. Using the three-side free configuration, the gate driver circuit may be produced by high-temperature polysilicon technology, low-temperature polysilicon technology or the like (i.e., at least one of the source driver circuit 14 and gate driver circuit 12 may be formed directly on the array board 71 by polysilicon technology).

Incidentally, the three-side free configuration includes not only a configuration in which ICs are placed or formed directly on the array board 71, but also a configuration in which a film (TCP, TAB, or other technology) with a source driver IC (circuit) 14 and gate driver IC (circuit) 12 mounted are pasted on one side (or almost one side) of the array board 71. That is, the three-side free configuration includes configurations and arrangements in which two sides are left free of ICs and all similar configurations.

If the gate driver circuit 12 is placed beside the source driver circuit 14 as shown in FIG. 9, the gate signal line 17 must be formed along the side C.

Incidentally, the thick solid line in FIG. 9, etc. indicates gate signal lines 17 formed in parallel. Thus, as many gate signal lines 17 as there are scanning signal lines are formed in parallel in part b (bottom of the screen) while a single gate signal line 17 is formed in part a (top of the screen).

Spacing between the gate signal lines 17 formed on the side C is from 5 μm to 12 μm (both inclusive) If it is less than 5 μm, parasitic capacitance will cause noise on adjacent gate signal lines. It has been shown experimentally that parasitic capacitance has significant effects when the spacing is 7 μm or less. Furthermore, when the spacing is less than 5 μm, beating noise and other image noise appear intensely on the display screen. In particular, noise generation differs between the right and left sides of the screen and it is difficult to reduce the beating noise and other image noise. When the spacing exceeds 12 μm, bezel width D of the display panel becomes too large to be practical.

To reduce the image noise, a ground pattern (conductive pattern which has been fixed at a constant voltage or set generally at a stable potential) can be placed under or above the gate signal lines 17. Alternatively, a separate shield plate (shield foil: a conductive pattern which has been fixed at a constant voltage or set generally at a stable potential) may be placed on the gate signal lines 17.

The gate signal lines 17 on the side C in FIG. 9 may be formed of ITO electrodes. However, to reduce resistance, preferably they are formed by laminating ITO and thin metal films. Also preferably they are formed of metal films. When using an ITO laminate, a titanium film is formed on the ITO, and a thin aluminum film or aluminum-molybdenum alloy film is formed on it. Alternatively, a chromium is formed on the ITO. For metal films, thin aluminum films or chromium films are used. This also applies to other examples of the present invention.

Incidentally, although it has been stated with reference to FIG. 9 and the like that the gate signal lines 17 are placed on one side of the display area, this is not restrictive and they may be placed on both sides. For example, the gate signal line 17*a* may be placed (formed) on the right side of the display screen 50 while the gate signal line 17*b* may be placed (formed) on the left side of the display screen 50. This also applies to other examples.

Also, the source driver IC 14 and gate driver IC 12 may be integrated into a single chip. Then, it suffices to mount only one IC chip on the display panel. This also reduces implementation costs. Furthermore, this makes it possible to simultaneously generate various voltages for use in the single-chip driver IC.

Incidentally, although it has been stated that the source driver IC 14 and gate driver IC 12 are made of silicon or other semiconductor wafers and mounted on the display panel, this is not restrictive. Needless to say, they may be formed directly on the display panel 71 using low-temperature polysilicon technology or high-temperature polysilicon technology.

Although it has been stated that pixels are of the three primary colors of R, G, and B, this is not restrictive. They may be of three colors of cyan, yellow, and magenta. They may be of two colors of B and yellow. Of course, they may be monochromatic. Alternatively, they may be of six colors of R, G, B, cyan, yellow, and magenta or of five colors of R, G, B, cyan, and magenta. These are natural colors which provide an expanded color reproduction range, enabling good display. Thus, the EL display apparatus according to the present invention is not limited to those which provide color display using the three primary colors of R, G, and B.

Mainly three methods are available to colorize an organic EL display panel. One of them is a color conversion method. It suffices to form a single layer of blue as a light-emitting layer. The remaining green and red colors needed for full color display can be produced from the blue color through color conversion. Thus, this method has the advantage of eliminating the need to paint the R, G, and B colors separately and prepare organic EL materials for the R, G, and B colors. The color conversion method does not lower yields unlike the multi-color painting method. Any of the three methods can be applied to the EL display panel of the present invention.

Also, in addition to the three primary colors, white light-emitting pixels may be formed. The white light-emitting pixels can be created (formed or constructed) by laminating R, G, and B light-emitting structures. A set of pixels consists of pixels for the three primary colors RGB and a white light-emitting pixel 16W. Forming the white light-emitting pixels makes it easier to express peak brightness of white, and thus possible to implement bright image display.

Even when using a set of pixels for the three primary colors RGB, it is preferable to vary pixel electrode areas for the different colors. Of course, an equal area may be used if luminous efficiencies of the different colors as well as color purity are well balanced. However, if one or more colors are poorly balanced, preferably the pixel electrodes (light-emitting areas) are adjusted. The electrode area for each color can be determined based on current density. That is, when white balance is adjusted in a color temperature range of 7000 K (Kelvin) to 12000 K (both inclusive), difference between current densities of different colors should be within ±30%. More preferably, the difference should be within +15%. For example, if current densities are around 100 A/square meter, all the three primary colors should have a current density of 70 A/square meter to 130 A/square meter (both inclusive) More preferably, all the three primary colors should have a current density of 85 A/square meter to 115 A/square meter (both inclusive).

The EL element 15 is a self-luminous element. When light from this self-luminous element enters a transistor serving as a switching element, a photoconductive phenomenon occurs. The photoconductive phenomenon is a phenomenon in which leakage (off-leakage) increases due to photoexcitation when a switching element such as a transistor is off.

To deal with this problem, the present invention forms a shading film under the gate driver circuit 12 (source driver circuit 14 in some cases) and under the pixel transistor 11. The shading film is formed of thin film of metal such as chromium and is from 50 nm to 150 nm thick (both inclusive). A thin film will provide a poor shading effect while a thick film will cause irregularities, making it difficult to pattern the transistor 11A1 in an upper layer.

In the case of the driver circuit 12 and the like, it is necessary to reduce penetration of light not only from the topside, but also from the underside. This is because the photoconductive phenomenon will cause malfunctions. If cathode electrodes are made of metal films, the present invention also forms a cathode electrode on the surface of the driver 12 and the like and uses it as a shading film.

However, if a cathode electrode is formed on the driver 12, electric fields from the cathode electrode may cause driver malfunctions or place the cathode electrode and driver circuit in electrical contact. To deal with this problem, the present invention forms at least one layer of organic EL film, and preferably two or more layers, on the driver circuit 12 simultaneously with the formation of organic EL film on the pixel electrode.

If a short circuit occurs between terminals of one or more transistors 11 or between a transistor 11 and signal line in the pixel, the EL element 15 may become a bright spot which remains illuminated constantly. The bright spot is visually conspicuous and must be turned into a black spot (turned off) The pixel 16 which corresponds to the bright spot is detected and the capacitor 19 is irradiated with laser light to cause a short circuit across the capacitor. As a result, the capacitor 19 can no longer hold electric charges, and thus the transistor 11*a* can be stopped from passing current. It is desirable to remove that part of a cathode film which will be irradiated with laser light to prevent the laser irradiation from causing a short circuit between a terminal electrode of the capacitor 19 and the cathode film.

Figure 45:
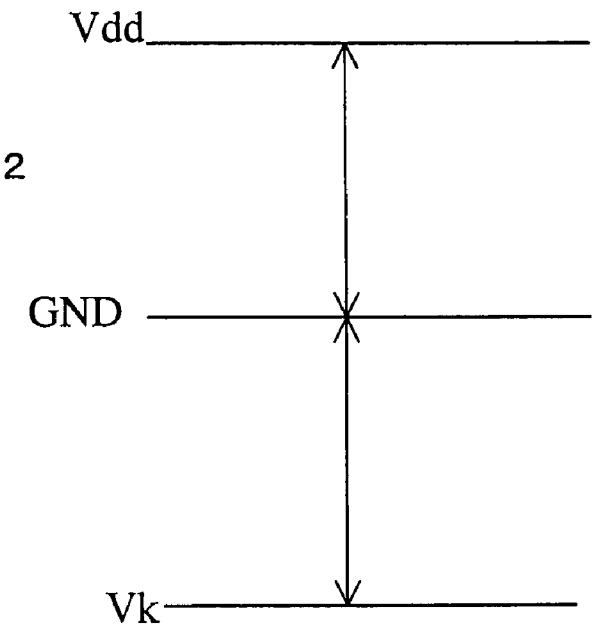
FIG. 45 is an explanatory diagram illustrating a drive method of a display apparatus according to the present invention.
Figure 45:
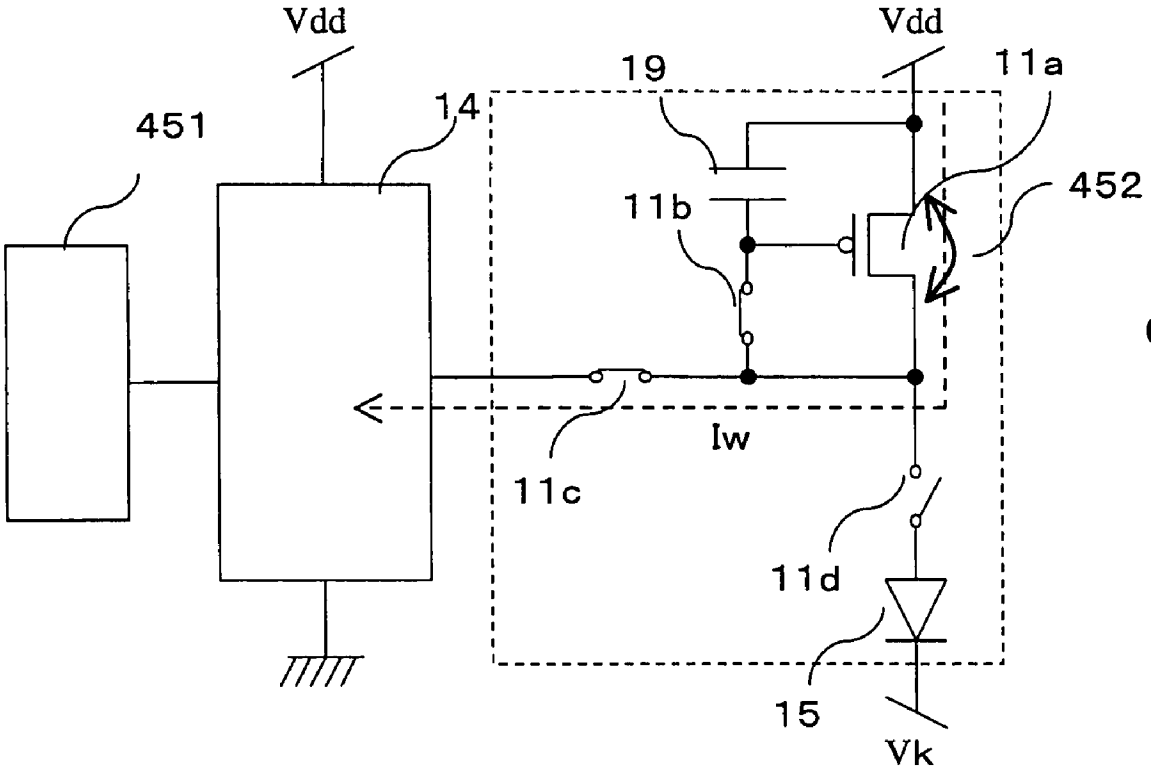

Flaws in a transistor 11 in the pixel 16 will affect the source driver IC 14 and the like. For example, if a source-drain (SD) short circuit 452 occurs in the driver transistor 11*a* in FIG. 45, a Vdd voltage of the panel is applied to the source driver IC 14. Thus, preferably the power supply voltage of the source driver IC 14 is kept equal to or higher than the power supply voltage Vdd of the panel. Preferably, the reference voltage used by the source driver IC 14 can be adjusted with an electronic regulator 451.

If an SD short circuit 452 occurs in the transistor 11*a*, an excessive current flows through the EL element 15. In other words, the EL element 15 remains illuminated constantly (becomes a bright spot). The bright spot is conspicuous as a defect. For example, if a source-drain (SD) short circuit occurs in the transistor 11*a* in FIG. 45, current flows constantly from the Vdd voltage to the EL element 15 (when the transistor 11*d* is on) regardless of the magnitude of gate (G) terminal voltage of the transistor 11*a*. Thus, a bright spot results.

On the other hand, if an SD short circuit occurs in the transistor 11*a* and if the transistor 11*c* is on, the Vdd voltage is applied to the source signal line 18 and to the source driver circuit 14. If the power supply voltage of the source driver circuit 14 is not higher than Vdd, voltage resistance may be exceeded, causing the source driver circuit 14 to rupture. Thus, it is preferable that the power supply voltage of the source driver circuit 14 is equal to or higher than the Vdd voltage (the higher voltage of the panel).

An SD short circuit of the transistor 11*a* may go beyond a point defect and lead to rupture of the source driver circuit of the panel. Also, the bright spot is conspicuous, which makes the panel defective. Thus, it is necessary to turn the bright spot into a black spot by cutting the wiring which connects between the transistor 11 and EL element 15. Preferably an optical means such as laser light is used to cut the wiring.

A drive method according to the present invention will be described below. As shown in FIG. 1, the gate signal line 17*a* conducts when the row remains selected (since the transistor 11 in FIG. 1 is a P-channel transistor, the gate signal line 17*a* conducts when it is in low state) and the gate signal line 17*b* conducts when the row remains non-selected.

Parasitic capacitance (not shown) is present in the source signal line 18. The parasitic capacitance is caused by the capacitance at the junction of the source signal line 18 and gate signal line 17, channel capacitance of the transistors 11*b* and 11*c*, etc.

The time t required to change the current value of the source signal line 18 is given by t=C·V/I, where C is stray capacitance, V is a voltage of the source signal line, and I is a current flowing through the source signal line. Thus, if the current value can be increased ten fold, the time required to change the current value can be reduced nearly tenfold. This also means that the current value can be changed to a predetermined value even if the parasitic capacitance of the source signal line 18 is increased tenfold. Thus, to apply a predetermined current value during a short horizontal scanning period, it is useful to increase the current value.

When input current is increased tenfold, output current is also increased tenfold, resulting in a tenfold increase in the EL brightness. Thus, to obtain predetermined brightness, a light emission period is reduced tenfold by reducing the conduction period of the transistor 11*d* in FIG. 1 tenfold compared to a conventional conduction period. Incidentally, the tenfold increases/decreases are cited as an example to facilitate understanding and are not meant to be restrictive.

Thus, in order to charge and discharge the parasitic capacitance of the source signal line 18 sufficiently and program a predetermined current value into the transistor 11*a* of the pixel 16, it is necessary to output a relatively large current from the source driver circuit 14. However, when such a large current is passed through the source signal line 18, its current value is programmed into the pixel and a current larger than the predetermined current flows through the EL element 15. For example, if a 10 times larger current is programmed, naturally a 10 times larger current flows through the EL element 15 and the EL element 15 emits 10 times brighter light. To obtain predetermined emission brightness, the time during which the current flows through the EL element 15 can be reduced tenfold. This way, the parasitic capacitance can be charged/discharged sufficiently from the source signal line 18 and the predetermined emission brightness can be obtained.

Incidentally, although it has been stated that a 10 times larger current value is written into the pixel transistor 11*a* (more precisely, the terminal voltage of the capacitor 19 is set) and that the conduction period of the EL element 15 is reduced to 1/10, this is only exemplary. In some cases, a 10 times larger current value may be written into the pixel transistor 11*a* and the conduction period of the EL element 15 may be reduced to 1/5. On the other hand, a 10 times larger current value may be written into the pixel transistor 11*a* and the conduction period of the EL element 15 may be halved.

The present invention is characterized in that the write current into a pixel is set at a value other than a predetermined value and that a current is passed through the EL element 15 intermittently. For ease of explanation, it has been stated herein that an N times larger current is written into the pixel transistor 11 and the conduction period of the EL element 15 is reduced to 1/N. However, this is not restrictive. Needless to say, N1 times larger current may be written into the pixel transistor 11 and the conduction period of the EL element 15 may be reduced to 1/N2 (N1 and N2 are different from each other).

In white raster display, it is assumed that average brightness over one field (frame) period of the display screen 50 is B0. This drive method performs current (voltage) programming in such a way that the brightness B1 of each pixel 16 is higher than the average brightness B0. Also, a non-display area 52 appears during at least one field (frame) period. Thus, in the drive method according to the present invention, the average brightness over one field (frame) period is lower than B1.

Incidentally, the non-display area 52 and display area 53 are not necessarily spaced equally. For example, they may appear at random (provided that the display period or non-display period makes up a predetermined value (constant ratio) as a whole). Also, display periods may vary among R, G, and B. That is, display periods of R, G, and B or non-display period can be adjusted to a predetermined value (constant ratio) in such a way as to obtain an optimum white balance.

To facilitate explanation of the drive method according to the present invention, it is assumed that "1/N" means reducing 1F (one field or one frame) to 1/N. Needless to say, however, it takes time to select one pixel row and to program current values (normally, one horizontal scanning period (1 H)) and error may result depending on scanning conditions.

For example, the EL element 15 may be illuminated for 1/5 of a period by programming the pixel 16 with an N=10 times larger current. The EL element 15 illuminates 10/5=2 times more brightly. It is also possible to program an N=2 times larger current into the pixel 16 and illuminate the EL element 15 for 1/4 of the period. The EL element 15 illuminates 2/4=0.5 time more brightly. In short, the present invention achieves display other than constant display (1/1, i.e., non-intermittent display) by using a current other than an N=1 time current for current programming. Also, the drive system turns off the current supplied to the EL element 15, at least once during one frame (or one field) period. Also, the drive system at least achieves intermittent display by programming the pixel 16 with a current larger than a predetermined value.

A problem with an organic (inorganic) EL display is that it uses a display method basically different from that of an CRT or other display which presents an image as a set of displayed lines using an electron gun. That is, the EL display holds the current (voltage) written into a pixel for 1F (one field or one frame) period. Thus, a problem is that displaying moving pictures will result in blurred edges.

According to the present invention, current is passed through the EL element 15 only for a period of 1F/N, but current is not passed during the remaining period (1F(N−1)/N). Let us consider a situation in which the drive system is implemented and one point on the screen is observed. In this display condition, image data display and black display (non-illumination) are repeated every 1F. That is, image data is displayed intermittently in the temporal sense. When moving picture data are displayed intermittently, a good display condition is achieved without edge blur. In short, movie display close to that of a CRT can be achieved.

The drive method according to the present invention implements intermittent display. However, the intermittent display can be achieved by simply turning on and off the transistor 11*d* on a 1-H cycle. Consequently, a main clock of the circuit does not differ from conventional ones, and thus there is no increase in the power consumption of the circuit. Liquid crystal display panels need an image memory in order to achieve intermittent display. According to the present invention, image data is held in each pixel 16. Thus, the present invention requires no image memory for intermittent display.

The present invention controls the current passed through the EL element 15 by simply turning on and off the switching transistor 11*d*, the transistor 11*e*, and the like. That is, even if the current Iw flowing through the EL element 15 is turned off, the image data is held as it is in the capacitor 19. Thus, when the transistor 11*d* is turned on the next time, the current passed through the EL element 15 has the same value as the current flowing through the EL element 15 the previous time. Even to achieve black insertion (intermittent display such as black display), the present invention does not need to speed up the main clock of the circuit. Also, it does not need to elongate a time axis, and thus requires no image memory. Besides, the EL element 15 responds quickly, requiring a short time from application of current to light emission. Thus, the present invention is suitable for movie display, and by using intermittent display, it can solve a problem with conventional data-holding display panels (liquid crystal display panels, EL display panels, etc.) in displaying moving pictures.

Furthermore, in a large display apparatus, if increased wiring length of the source signal line 18 results in increased parasitic capacitance in the source signal line 18, this can be dealt with by increasing the value of N. When the value of programming current applied to the source signal line 18 is increased N times, the conduction period of the gate signal line 17*b* (the transistor 11*d*) can be set to 1F/N. This makes it possible to apply the present invention to television sets, monitors, and other large display apparatus.

The drive method according to the present invention will be described with reference to drawings in more detail below. The parasitic capacitance of the source signal line 18 is generated by the coupling capacitance with adjacent source signal lines 18, buffer output capacitance of the source driver IC (circuit) 14, cross capacitance between the source signal line 18 and gate signal line 17, etc. This parasitic capacitance is normally 10 pF or larger. In the case of voltage driving, since voltage is applied to the source signal line 18 from the source driver IC 14 at low impedance, more or less large parasitic capacitance does not disturb driving.

However, in the case of current driving, especially image display at the black level, the pixel capacitor 19 needs to be programmed with a minute current of 20 nA or less. Thus, if parasitic capacitance larger than a predetermined value is generated, the parasitic capacitance cannot be charged and discharged during the time when one pixel row is programmed (normally within 1 H, but not limited to 1 H because two pixel rows may be programmed simultaneously). If the parasitic capacitance cannot be charged and discharged within a period of 1 H, sufficient current cannot be written into the pixel, resulting in inadequate resolution.

In the pixel configuration in FIG. 1, the programming current Iw flows through the source signal line 18 during current programming as shown in FIG. 3(*a*). The current Iw flows through the transistor 11*a* and voltage is set (programmed) in the capacitor 19 in such a way as to maintain the current Iw. At this time, the transistor 1*d* is open (off).

During a period when the current flows through the EL element 15, the transistors 11*c* and 11*b* turn off and the transistor 11*d* turns on as shown in FIG. 3(*b*). Specifically, a turn-off voltage (Vgh) is applied to the gate signal line 17*a*, turning off the transistors 11*b* and 11*c*. On the other hand, a turn-on voltage (Vgl) is applied to the gate signal line 17*b*, turning on the transistor 11*d*.

Figure 12:
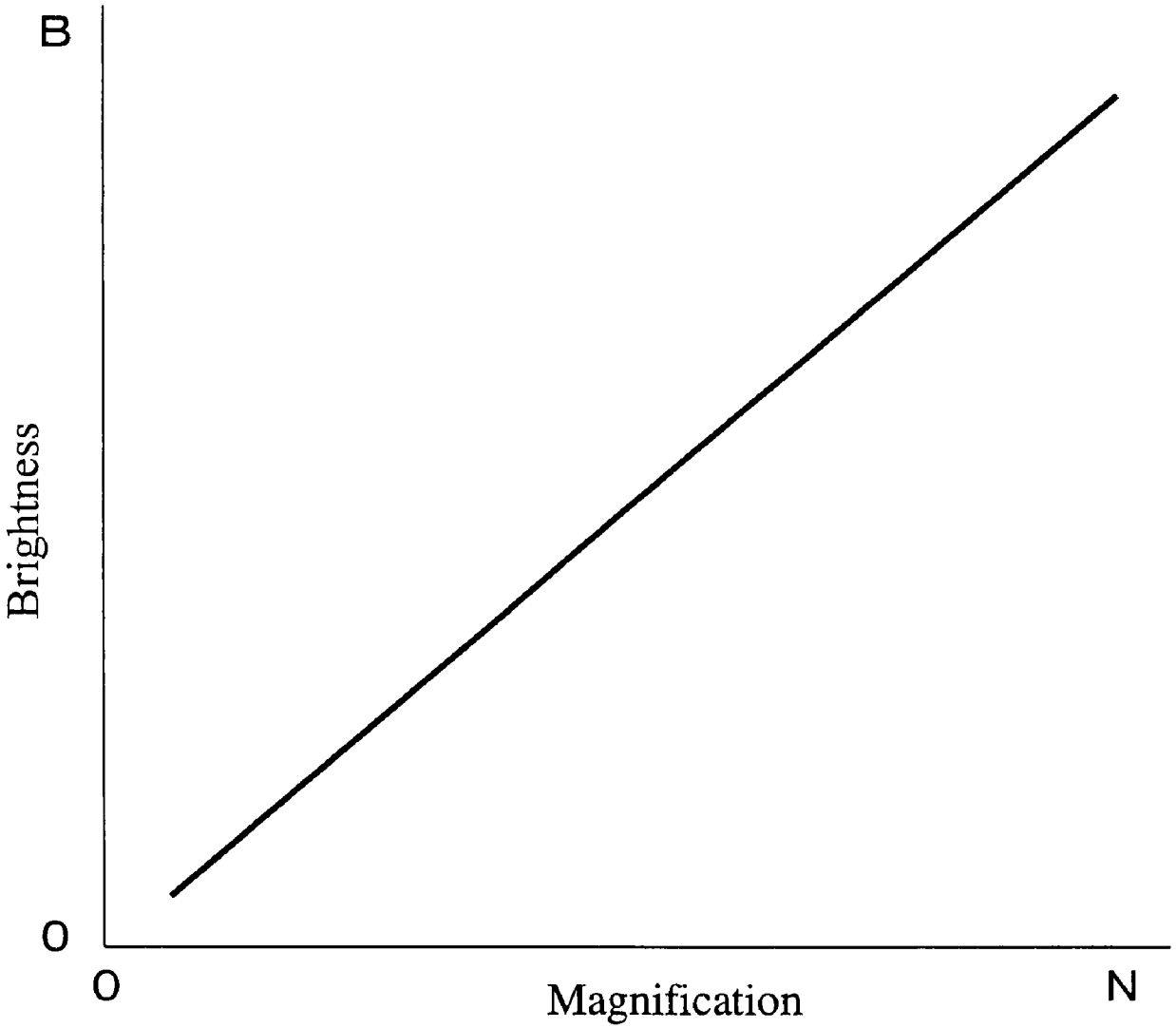
FIG. 12 is an explanatory diagram illustrating a display panel according to the present invention.

Suppose a current I1 is N times the current which should normally flow (a predetermined value), the current flowing through the EL element 15 in FIG. 3(*b*) is also Iw. Thus, the EL element 15 emits light 10 times more brightly that a predetermined value. In other words, as shown in FIG. 12, the larger the magnification N, the higher the display brightness B of the pixel 16. Thus, the magnification N and the brightness of the pixel 16 are proportional to each other.

If the transistor 11*d* is kept on for a period 1/N the period during which it is normally kept on (approximately 1F) and is kept off during the remaining period (N−1)/N, the average brightness over the 1F equals predetermined brightness. This display condition closely resembles the display condition under which a CRT is scanning a screen with an electronic gun. The difference is that 1/N of the entire screen illuminates (where the entire screen is taken as 1) (in a CRT, what illuminates is one pixel row—more precisely, one pixel).

Figure 13B:
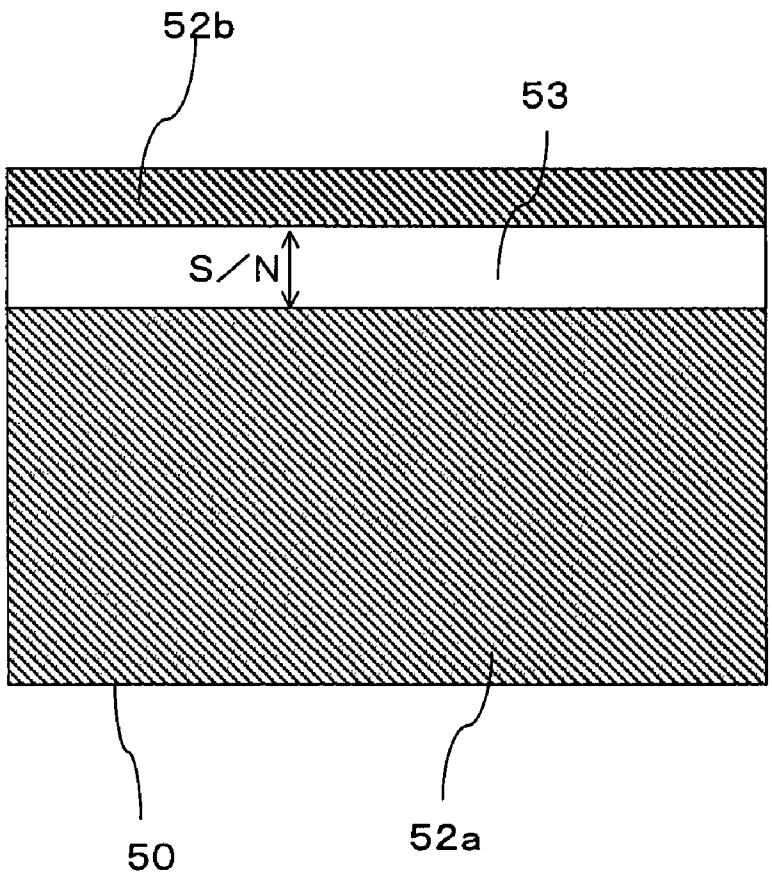
FIG. 13 is an explanatory diagram illustrating a drive method of a display apparatus according to the present invention.
Figure 13A:
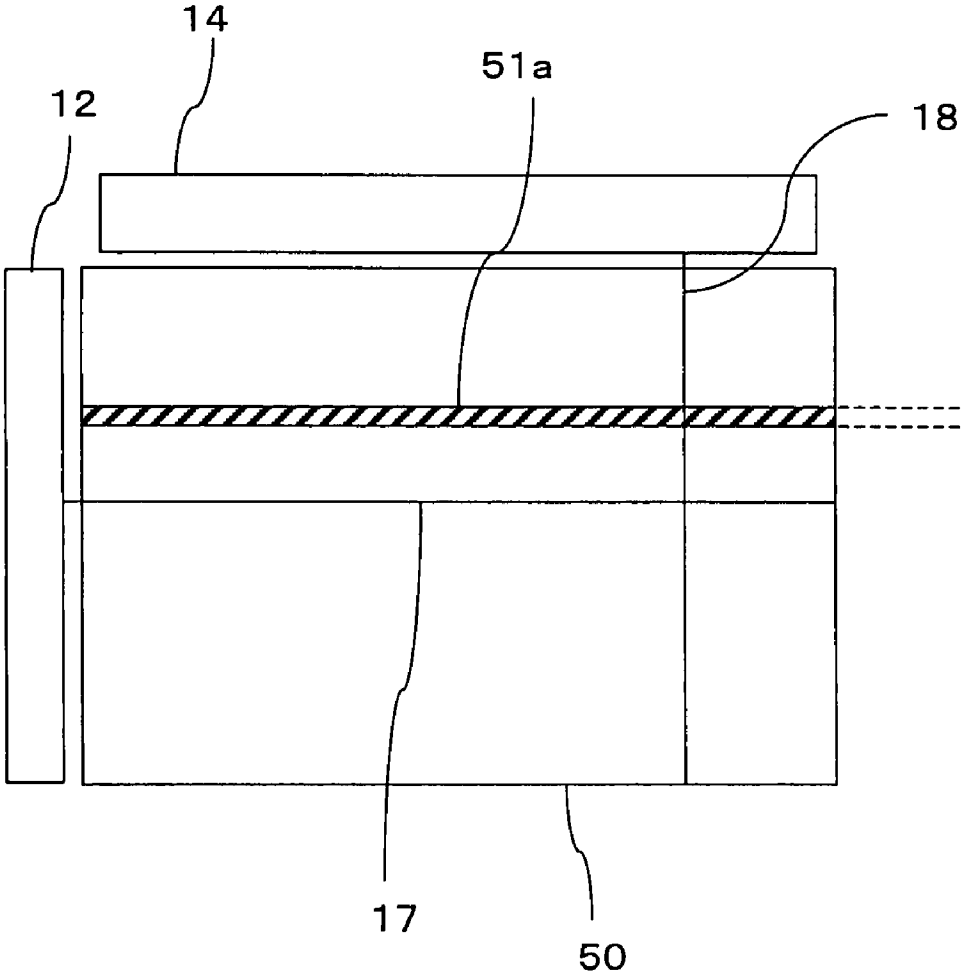

According to the present invention, 1F/N of the image display area 53 moves from top to bottom of the screen 50 as shown in FIG. 13(*b*). According to the present invention, current flows through the EL element 15 only for the period of 1F/N, but current does not flow during the remaining period (1F(N−1) /N). Thus, the pixel is displayed intermittently. However, due to an afterimage, the entire screen appears to be displayed uniformly to the human eye.

Incidentally, as shown in FIG. 13, the write pixel row 51*a* is non-illuminated 52*a*. However, this is true only to the pixel configurations in FIGS. 1, 2, etc. In the pixel configuration of a current mirror shown in FIG. 38, etc., the write pixel row 51*a* may be illuminated. However, description will be given herein citing mainly the pixel configuration in FIG. 1 for ease of explanation. A drive method which involves driving a pixel intermittently by programming it with a current larger than the predetermined drive current Iw shown in FIGS. 13, 16, etc. is referred to as N-fold pulse driving.

In this display condition, image data display and black display (non-illumination) are repeated every 1F. That is, image data is displayed at intervals (intermittently) in the temporal sense. Liquid crystal display panels (EL display panels other than that of the present invention), which hold data in pixels for a period of 1F, cannot keep up with changes in image data during movie display, resulting is blurred moving pictures (edge blur of images). Since the present invention displays images intermittently, it can achieve a good display condition without edge blur of images. In short, movie display close to that of a CRT can be achieved.

Incidentally, to drive the pixel 16 as shown in FIG. 13, it is necessary to be able to separately control the current programming period of the pixel 16 (in the configuration shown in FIG. 1, the period during which the turn-on voltage Vgl is applied to the gate signal line 17*a*) and the period when the EL element 15 is under on/off control (in the pixel configuration shown in FIG. 1, the period during which the turn-on voltage Vgl or turn-off voltage Vgh is applied to the gate signal line 17*b*). Thus, the gate signal line 17*a* and gate signal line 17*b* must be separated.

For example, when only a single gate signal line 17 is laid from the gate driver circuit 12 to the pixel 16, the drive method according to the present invention can not be implemented using a configuration in which logic (Vgh or Vgl) applied to the gate signal line 17 is applied to the transistor 11*b* and the logic applied to the gate signal line 17 is converted (Vgh or Vgl) by an inverter and applied to the transistor 11*d*. Thus, the present invention requires a gate driver circuit 12*a* which operates the gate signal line 17*a* and gate driver circuit 12*b* which operates the gate signal line 17*b*.

Besides, the drive method according to the present invention provides a non-illuminated display even with the pixel configuration shown in FIG. 1 during periods other than the current programming period (1 H).

Figure 14:
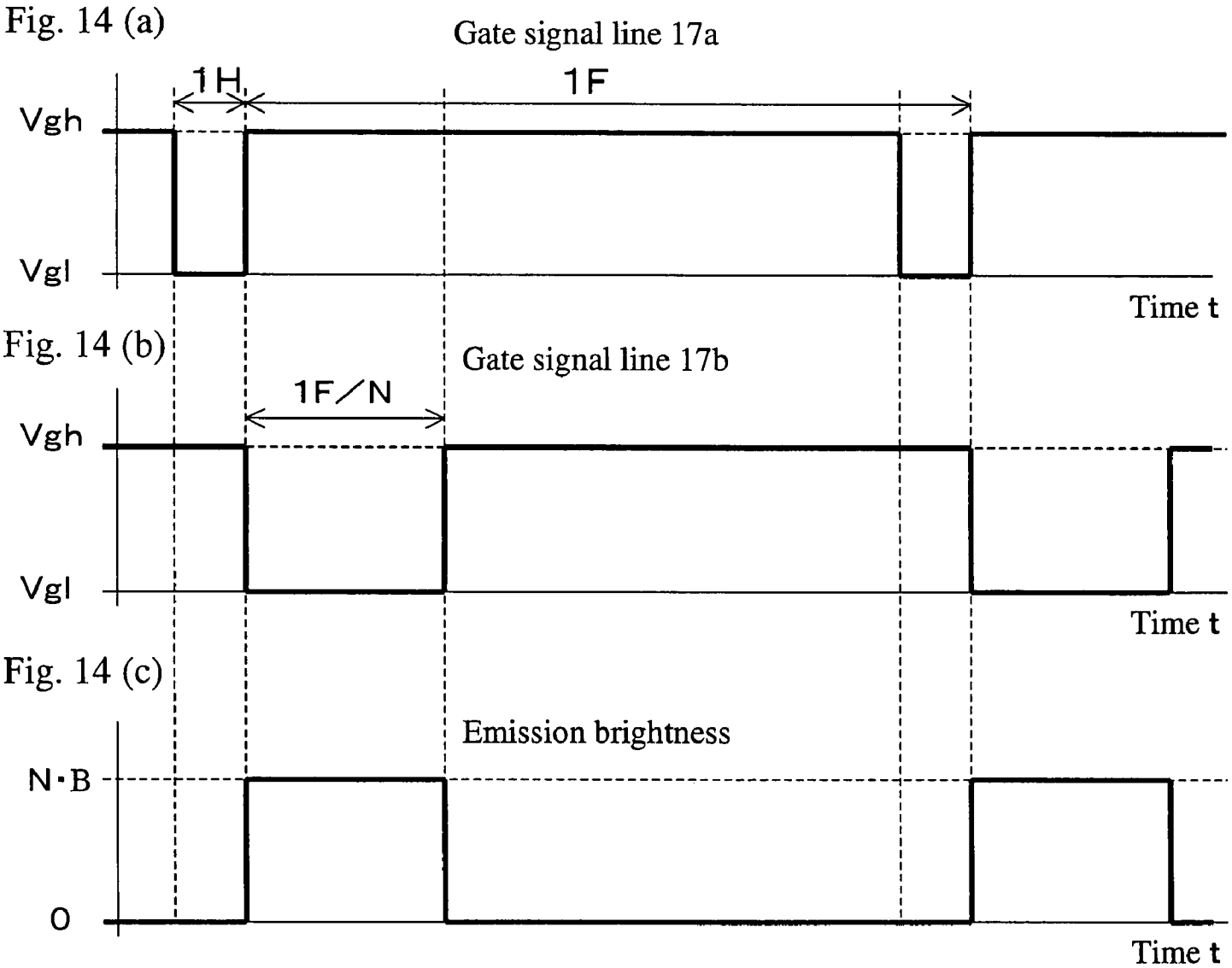
FIG. 14 is an explanatory diagram illustrating a drive method of a display apparatus according to the present invention.

A timing chart of the drive method shown in FIG. 13 is illustrated in FIG. 14. The pixel configuration referred to in the present invention and the like is the one shown in FIG. 1 unless otherwise stated. As can be seen from FIG. 14, in each selected pixel row (the selection period is designated as 1 H), when a turn-on voltage (Vgl) is applied to the gate signal line 17*a* (see FIG. 14(*a*)), a turn-off voltage (Vgh) is applied to the gate signal line 17*b* (see FIG. 14(*b*)). During this period, current does not flow through the EL element 15 (non-illumination mode). In a non-selected pixel row, a turn-on voltage (Vgl) is applied to the gate signal line 17*b* and a turn-off voltage (Vgh) is applied to the gate signal line 17*a*. During this period, current flows through the EL element 15 (illumination mode). In the illumination mode, the EL element 15 illuminates at a brightness (NB) N times the predetermined brightness and the illumination period is 1F/N. Thus, the average display brightness of the display panel over 1F is given by (N·B)×(1/N)=B (the predetermined brightness).

Figure 15:
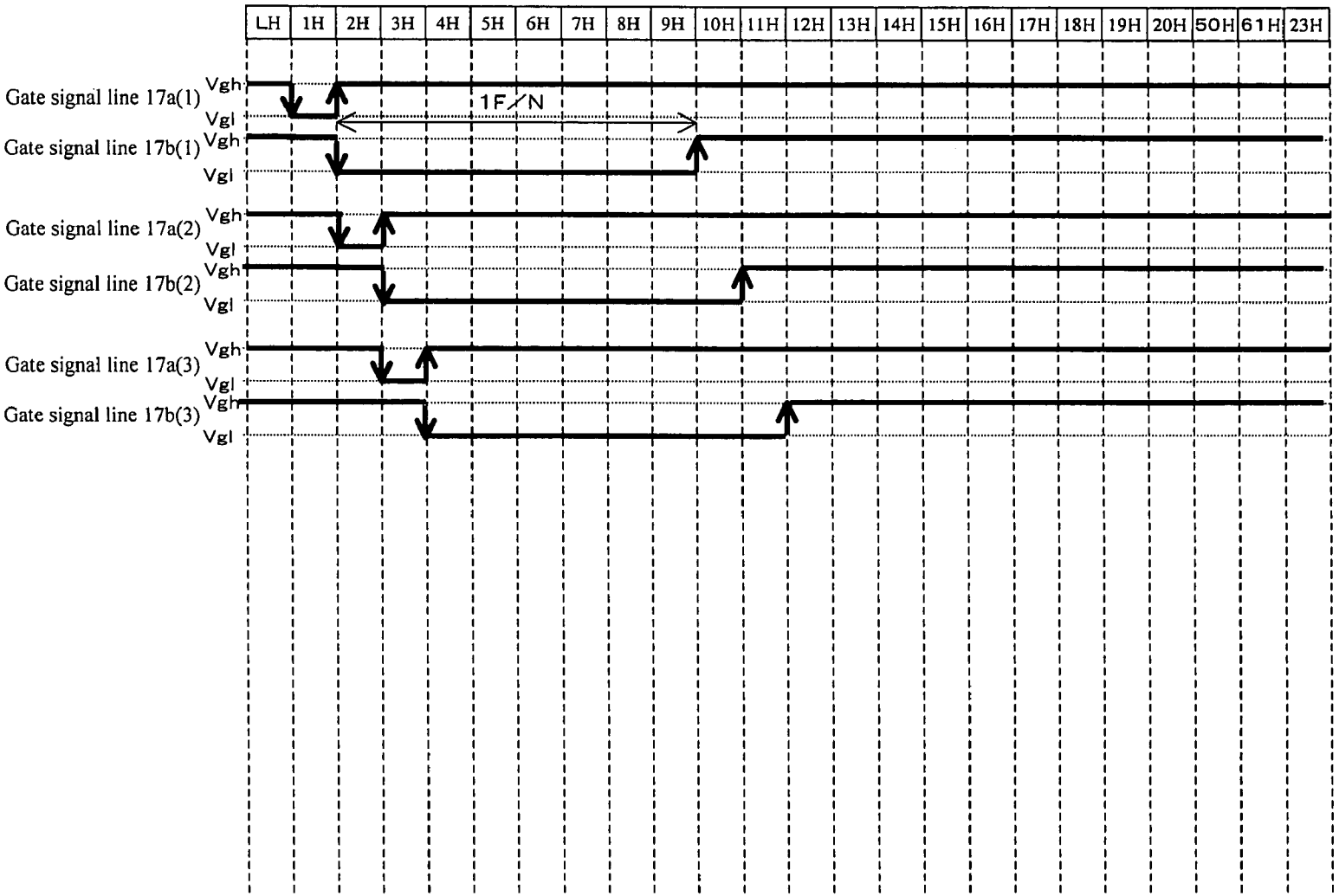
FIG. 15 is an explanatory diagram illustrating a drive method of a display apparatus according to the present invention.

FIG. 15 shows an example in which operations shown in FIG. 14 are applied to each pixel row. The figure shows voltage waveforms applied to the gate signal lines 17. Waveforms of the turn-off voltage are denoted by Vgh (high level) while waveforms of the turn-on voltage are denoted by Vgl (low level). The subscripts such as (1) and (2) indicate selected pixel row numbers.

In FIG. 15, a gate signal line 17*a*(1) is selected (Vgl voltage) and a programming current flows through the source signal line 18 in the direction from the transistor 11*a* in the selected pixel row to the source driver circuit 14. The programming current is N times larger than a predetermined value (for ease of explanation, it is assumed that N=10. Of course, since the predetermined value is a data current for use to display images, it is not a fixed value unless in the case of white raster display). Therefore, the capacitor 19 is programmed so that a 10 times larger current will flow through the transistor 11*a*. When the pixel row (1) is selected, in the pixel configuration shown in FIG. 1, a turn-off voltage (Vgh) is applied to the gate signal line 17*b*(1) and current does not flow through the EL element 15.

After 1 H, a gate signal line 17*a*(2) is selected (Vgl voltage) and a programming current flows through the source signal line 18 in the direction from the transistor 11*a* in the selected pixel row to the source driver circuit 14. The programming current is N times larger than a predetermined value (for ease of explanation, it is assumed that N=10). Therefore, the capacitor 19 is programmed so that 10 times larger current will flow through the transistor 11*a*. When the pixel row (2) is selected, in the pixel configuration shown in FIG. 1, a turn-off voltage (Vgh) is applied to the gate signal line 17*b*(2) and current does not flow through the EL element 15. However, since a turn-off voltage (Vgh) is applied to the gate signal line 17*a*(1) and a turn-on voltage (Vgl) is applied to the gate signal line 17*b*(1) of the pixel row (1), the EL element 15 illuminates.

After the next 1 H, a gate signal line 17*a*(3) is selected, a turn-off voltage (Vgh) is applied to the gate signal line 17*b*(3), and current does not flow through the EL element 15 in the pixel row (3). However, since a turn-off voltage (Vgh) is applied to the gate signal lines 17*a*(1) and (2) and a turn-on voltage (Vgl) is applied to the gate signal lines 17*b*(1) and (2) in the pixel rows (1) and (2), the EL element 15 illuminates.

Through the above operation, images are displayed in sync with a synchronization signal of 1 H. However, with the drive method in FIG. 15, a 10 times larger current flows through the EL element 15. Thus, the display screen 50 is 10 times brighter. Of course, it goes without saying that for display at a predetermined brightness in this state, the programming current can be reduced to 1/10. However, a 10 times smaller current will cause a shortage of write current due to parasitic capacitance. Thus, the basic idea of the present invention is to use a large current for programming, insert a non-display area 52, and thereby obtain a predetermined brightness.

Incidentally, the drive method according to the present invention causes a current larger than a predetermined current to flow through the EL element 15, and thereby charges and discharges the parasitic capacitance of the source signal line 18 sufficiently. That is, there is no need to pass an N times larger current through the EL element 15. For example, it is conceivable to form a current path in parallel with the EL element 15 (form a dummy EL element and use a shield film to prevent the dummy EL element from emitting light) and divide the flow of current between the EL element 15 and the dummy EL element. For example, when a signal current is 0.2 μA, a programming current is set to 2.2 μA and the current of 2.2 μA is passed through the transistor 11*a*. Then, the signal current of 0.2 μA may be passed through the EL element 15 and 21A may be passed through the dummy EL element, for example. That is, the dummy pixel row 271 in FIG. 27 remains selected constantly. Incidentally, the dummy pixel row is either kept from emitting light or hidden from view by a shield film or the like even if it emits light.

With the above configuration, by increasing the current passed through the source signal line 18N times, it is possible to pass an N times larger current through the driver transistor 11*a* and pass a current sufficiently smaller than the N times larger current through the EL element 15. As shown in FIG. 5, this method allows the entire display screen 50 to be used as the image display area 53 without a non-display area 52.

FIG. 13(*a*) shows writing into the display screen 50. In FIG. 13(*a*), reference numeral 51*a* denotes a write pixel row. A programming current is supplied to the source signal line 18 from the source driver IC 14. In FIG. 13 and the like, there is one pixel row into which current is written during a period of 1 H, but this is not restrictive. The period may be 0.5 H or 2 Hs. Also, although it has been stated that a programming current is written into the source signal line 18, the present invention is not limited to current programming. The present invention may also use voltage programming (FIG. 46, etc.) which writes voltage into the source signal line 18.

In FIG. 13(*a*), when the gate signal line 17*a* is selected, the current to be passed through the source signal line 18 is programmed into the transistor 11*a*. At this time, a turn-off voltage is applied to the gate signal line 17*b*, and current does not flow through the EL element 15. This is because when the transistor 11*d* is on on the EL element 15, a capacitance component of the EL element 15 is visible from the source signal line 18 and the capacitance prevents sufficient current from being programmed into the capacitor 19. Thus, to take the configuration shown in FIG. 1 as an example, the pixel row into which current is written is a non-illuminated area 52 as shown in FIG. 13(*b*).

Suppose an N times larger current is used for programming (it is assumed that N=10 as described above), the screen becomes 10 times brighter. Thus, 90% of the display screen 50 can be constituted of the non-illuminated area 52. Thus, for example, if the number of horizontal scanning lines in the screen display area is 220 (S=220) in compliance with QCIF, 22 horizontal scanning lines can compose a display area 53 while 220−22=198 horizontal scanning lines can compose a non-display area 52. Generally speaking, if the number of horizontal scanning lines (number of pixel rows) is denoted by S, S/N of the entire area constitutes a display area 53, which is illuminated N times more brightly. Then, the display area 53 is scanned in the vertical direction of the screen. Thus, S (N−1)/N of the entire area is a non-illuminated area 52. The non-illuminated area presents a black display (is non-luminous). Also, the non-luminous area 52 is produced by turning off the transistor 11*d*. Incidentally, although it has been stated that the display area 53 is illuminated N times more brightly, naturally the value of N is adjusted by brightness adjustment and gamma adjustment.

In the above example, if a 10 times larger current is used for programming, the screen becomes 10 times brighter and 90% of the display screen 50 can be constituted of the non-illuminated area 52. However, this does not necessarily mean that R, G, and B pixels constitute the non-illuminated area 52 in the same proportion. For example, 1/8 of the R pixels, 1/6 of the G pixels, and 1/10 of the B pixels may constitute the non-illuminated area 52 with different colors making up different proportions. It is also possible to allow the non-illuminated area 52 (or illuminated area 53) to be adjusted separately among R, G, and B. For that, it is necessary to provide separate gate signal lines 17*b* for R, G, and B. However, allowing R, G, and B to be adjusted separately makes it possible to adjust white balance, making it easy to adjust color balance for each gradation (see FIG. 41).

As shown in FIG. 13(*b*), pixel rows including the write pixel row 51*a* compose a non-illuminated area 52 while an area of S/N (1F/N in the temporal sense) above the write pixel row 51*a* compose a display area 53 (when write scans are performed from top to bottom of the screen. When the screen is scanned from bottom to top, the areas change places). Regarding the display condition of the screen, a strip of the display area 53 moves from top to bottom of the screen.

In FIG. 13, one display area 53 moves from top to bottom of the screen. At a low frame rate, the movement of the display area 53 is recognized visually. It tends to be recognized easily especially when a user closes his/her eyes or moves his/her head up and down.

Figure 16:
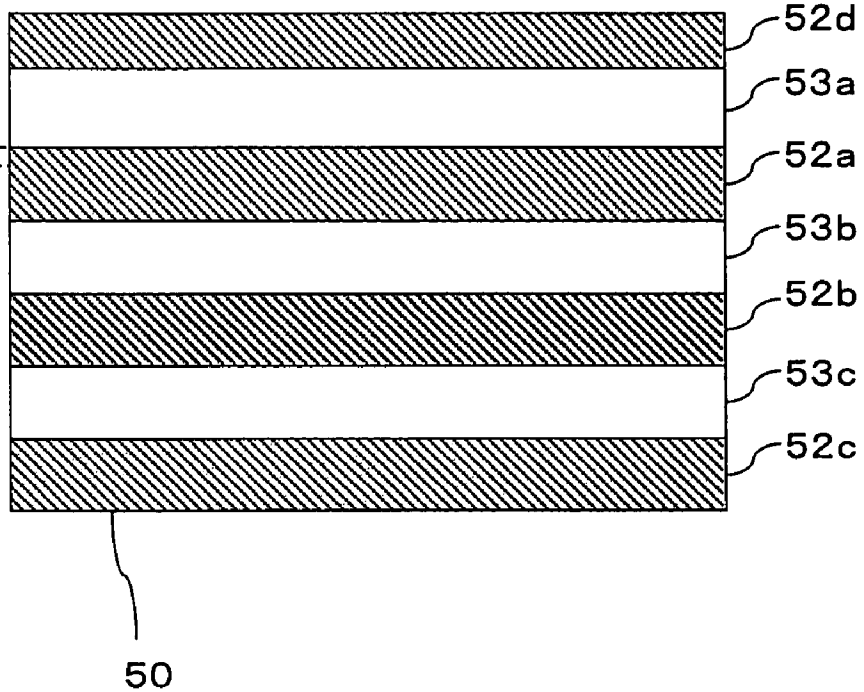
FIG. 16 is an explanatory diagram illustrating a drive method of a display apparatus according to the present invention.
Figure 16:
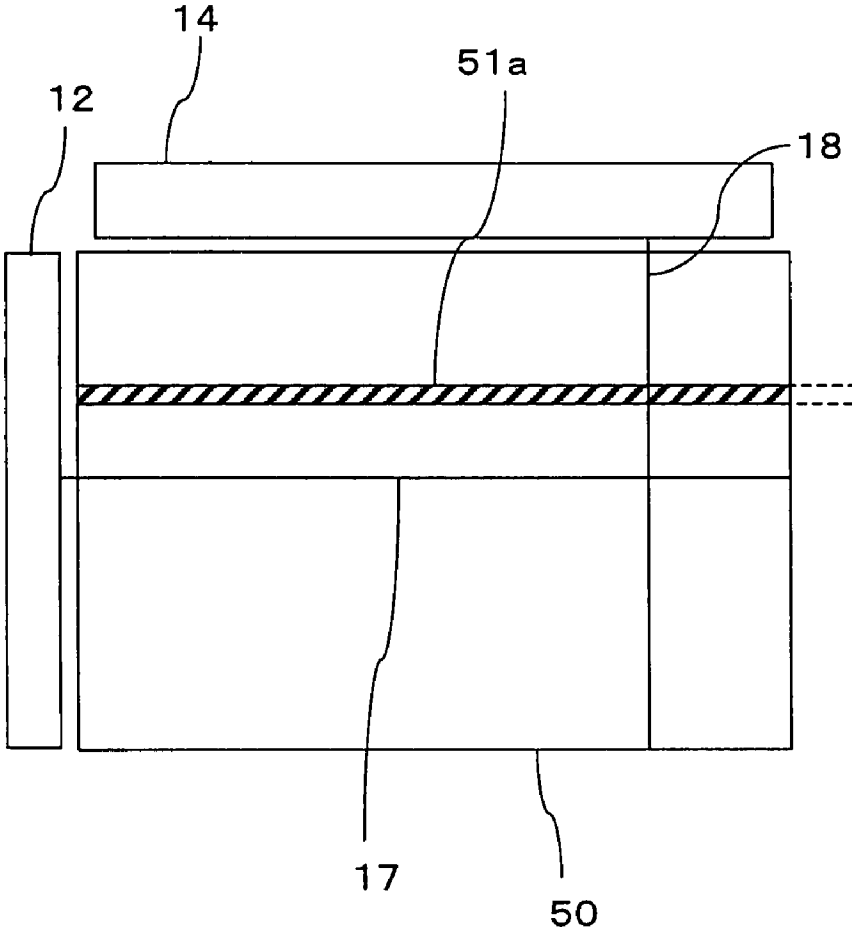

To deal with this problem, the display area 53 can be divided into a plurality of parts as shown in FIG. 16. If the total area of the divided display area is S (N−1)/N, the brightness is equal to the brightness in FIG. 13. Incidentally, there is no need to divide the display area 53 equally. Also, there is no need to divide the non-display area 52 equally.

Dividing the display area 53 reduces flickering of the screen. Thus, a flicker-free good image display can be achieved. Incidentally, the display area 53 may be divided more finely. However, the more finely the display area 53 is divided, the poorer the movie display performance becomes.

Figure 17:
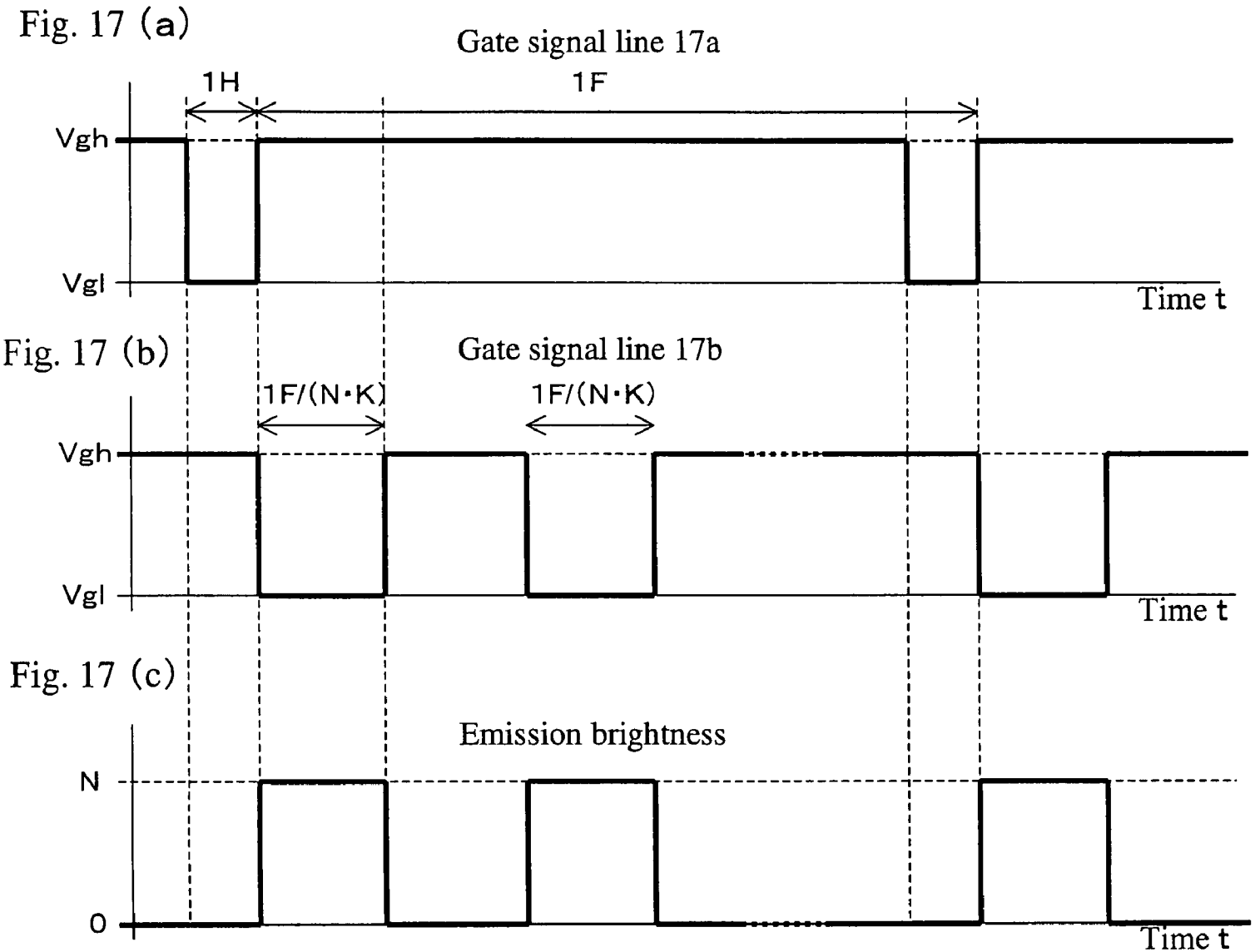
FIG. 17 is an explanatory diagram illustrating a drive method of a display apparatus according to the present invention.

FIG. 17 shows voltage waveforms of gate signal lines 17 and emission brightness of the EL element. As can be seen from FIG. 17, a period (1F/N) during which the gate signal line 17*b* is set to Vgl is divided into a plurality of parts (K parts). That is, a period of 1F/(K·N) during which the gate signal line 17*b* is set to Vgl repeats K times. This reduces flickering and implements image display at a low frame rate. Preferably, the number of divisions is variable. For example, when the user presses a brightness adjustment switch or turns a brightness adjustment knob, the value of K may be changed in response. Also, the user may be allowed to adjust brightness. Alternatively, the value of K may be changed manually or automatically depending on images or data to be displayed.

Incidentally, although it has been stated with reference to FIG. 17 and the like that a period (1F/N) during which the gate signal line 17*b* is set to Vgl is divided into a plurality of parts (K parts) and that a period of 1F/(KN) during which the gate signal line 17*b* is set to Vgl repeats K times, this is not restrictive. A period of 1F/(KN) may be repeated L (L≠K) times. In other words, the present invention displays the display screen 50 by controlling the period (time) during which current is passed through the EL element 15. Thus, the idea of repeating the 1F/(K·N) period L (L≠K) times is included in the technical idea of the present invention. Also, by varying the value of L, the brightness of the display screen 50 can be changed digitally. For example, there is a 50% change of brightness (contrast) between L=2 and L=3. Also, when dividing the image display area 53, the period when the gate signal line 17*b* is set to Vg1 does not necessarily need to be divided equally.

In the example described above, the display screen 50 is turned on and off (illuminated and non-illuminated) as the current delivered to the EL element 15 is switched on and off. That is, approximately equal current is passed through the transistor 11*a* multiple times using electric charges held in the capacitor 19. The present invention is not limited to this. For example, the display screen 50 may be turned on and off (illuminated and non-illuminated) by charging and discharging the capacitor 19.

Figure 18:
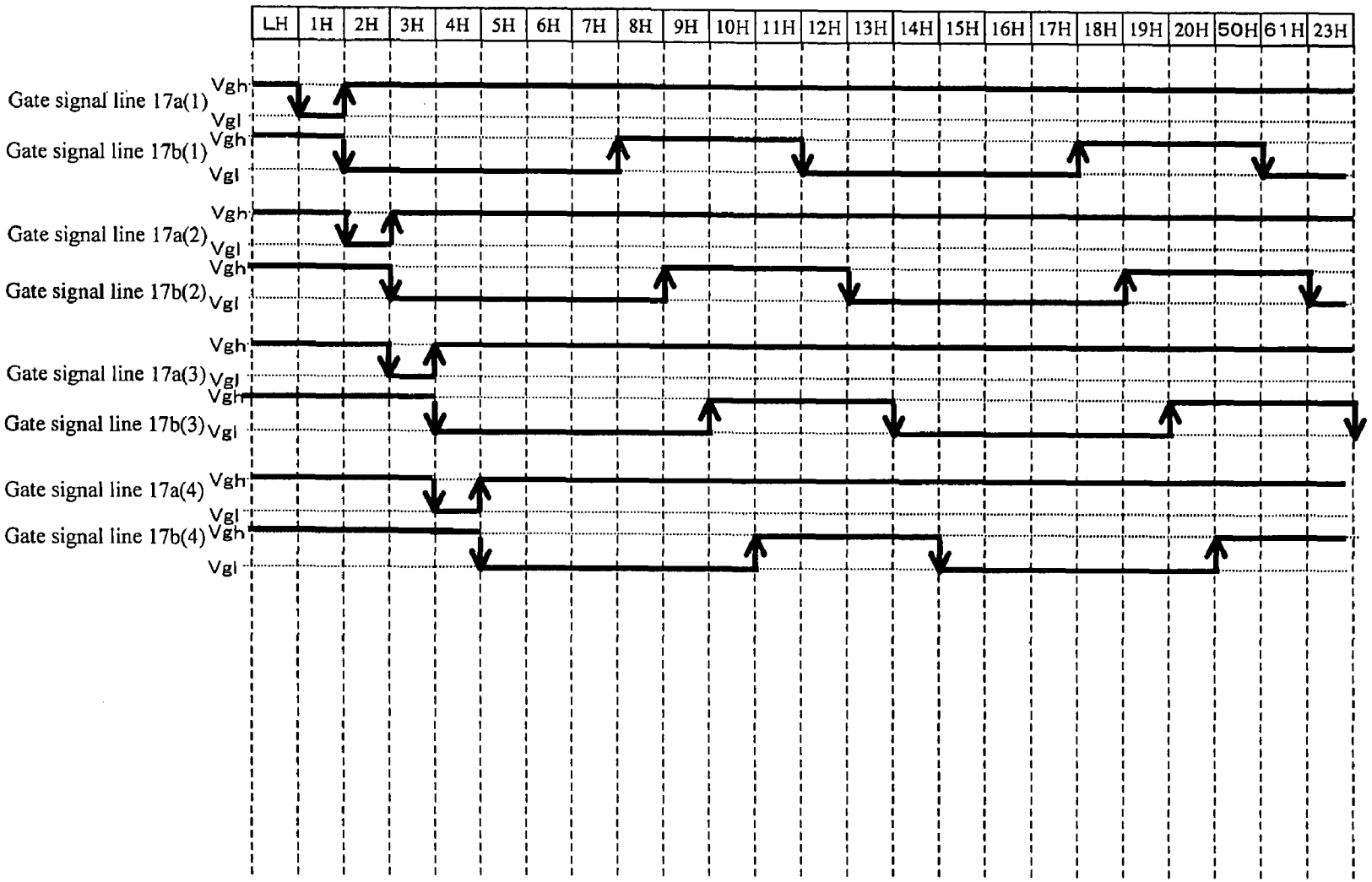
FIG. 18 is an explanatory diagram illustrating a drive method of a display apparatus according to the present invention.

FIG. 18 shows voltage waveforms applied to gate signal lines 17 to achieve the image display condition shown in FIG. 16. FIG. 18 differs from FIG. 15 in the operation of the gate signal line 17*b*. The gate signal line 17*b* is turned on and off (Vgl and Vgh) as many times as there are screen divisions. FIG. 18 is the same as FIG. 15 in other respects, and thus description thereof will be omitted.

Since black display on EL display apparatus corresponds to complete non-illumination, contrast does not lower unlike in the case of intermittent display on liquid crystal display panels. Also, with the configurations in FIGS. 1, 2, 32, 43, and 117, intermittent display can be achieved by simply turning on and off the transistor 11*d*. With the configurations in FIGS. 38, 51, and 115, intermittent display can be achieved by simply turning on and off the transistor element 11*e*. In FIG. 113, intermittent display can be achieved by controlling the switching circuit 1131. In FIG. 114, intermittent display can be achieved by turning on and off the transistor 11*g*. This is because image data is stored in the capacitor 19 (the number of gradations is infinite because analog values are used). That is, the image data is held in each pixel 16 for a period of 1F. Whether to deliver a current which corresponds to the stored image data to the EL element 15 is controlled by controlling the transistors 11*d* and 11*e*.

Thus, the drive method described above is not limited to a current-driven type and can be applied to a voltage-driven type as well. That is, in a configuration in which the current passed through the EL element 15 is stored in each pixel, intermittent driving is implemented by switching on and off the current path between the driver transistor 11 and EL element 15.

It is important to maintain terminal voltage of the capacitor 19 in order to reduce flickering and power consumption. This is because any change (charge/discharge) in the terminal voltage of the capacitor 19 during one field (frame) period causes changes in the screen brightness, resulting in flickering at lower frame rates. The current passed through the EL element 15 by the transistor 11*a* must be higher than 65%. More specifically, if the initial current written into the pixel 16 and passed through the EL element 15 is taken as 100%, the current passed through the EL element 15 just before it is written into the pixel 16 in the next frame (field) must not fall below 65%.

With the pixel configuration shown in FIG. 1, there is no difference in the number of transistors 11 in a single pixel between when an intermittent display is created and when an intermittent display is not created. That is, leaving the pixel configuration as it is, proper current programming is achieved by removing the effect of parasitic capacitance of the source signal line 18. Besides, movie display close to that of a CRT is achieved.

Also, since the operation clock of the gate driver circuit 12 is significantly slower than the operation clock of the source driver circuit 14, there is no need to upgrade the main clock of the circuit. Besides, the value of N can be changed easily.

Incidentally, the image display direction (image writing direction) may be from top to bottom of the screen in the first field (frame), and from bottom to top of the screen in the second field (frame). That is, an upward direction and downward direction may be repeated alternately.

Alternatively, it is possible to use a downward direction in the first field (frame), turn the entire screen into black display (non-display) once, and use an upward direction in the second field (frame). It is also possible to turn the entire screen into black display (non-display) once.

Incidentally, although top-to-bottom and bottom-to-top writing directions on the screen are used in the drive method described above, this is not restrictive. It is also possible to fix the writing direction on the screen to a top-to-bottom direction or bottom-to-top direction and move the non-display area 52 from top to bottom in the first field, and from bottom to top in the second field. Alternatively, it is possible to divide a frame into three fields and assign the first field to R, the second field to G, and the third field to B so that three fields compose a single frame. It is also possible to display R, G, and B in turns by switching among them every horizontal scanning period (1 H) (see FIGS. 125 to 132 and their description). The items mentioned above also apply to other examples of the present invention.

The non-display area 52 need not be totally non-illuminated. Weak light emission or dim image display will not be a problem in practical use. It should be regarded to be an area which has a lower display brightness than the image display area 53. Also, the non-display area 52 may be an area which does not display one or two colors out of R, G, and B. Also, it may be an area which displays one or two colors among R, G, and B at low brightness.

Basically, if the brightness of the display area 53 is kept at a predetermined value, the larger the display area 53, the brighter the display screen 50. For example, when the brightness of the image display area 53 is 100 (nt), if the percentage of the display screen 50 accounted for by the display area 53 changes from 10% to 20%, the brightness of the screen is doubled. Thus, by varying the proportion of the display area 53 in the entire screen 50, it is possible to vary the display brightness of the screen. The display brightness of the screen 50 is proportional to the ratio of the display area 53 to the screen 50.

The size of the display area 53 can be specified freely by controlling data pulses (ST2) sent to the shift register circuit 61. Also, by varying the input timing and period of the data pulses, it is possible to switch between the display condition shown in FIG. 16 and display condition shown in FIG. 13. Increasing the number of data pulses in one IF period makes the screen 50 brighter and decreasing it makes the screen 50 dimmer. Also, continuous application of the data pulses brings on the display condition shown in FIG. 13 while intermittent application of the data pulses brings on the display condition shown in FIG. 16.

FIG. 19(*a*) shows a brightness adjustment scheme used when the display area 53 is continuous as in FIG. 13. The display brightness of the screen 50 in FIG. 19(*a*1) is the brightest, the display brightness of the screen 50 in FIG. 19(*a*2) is the second brightest, and display brightness of the screen 50 in FIG. 19(*a*3) is the dimmest. FIG. 19(*a*) is most suitable for movie display.

Changes from FIG. 19(*a*1) to FIG. 19(*a*3) (or vice versa) can be achieved easily by controlling the shift register circuit 61 and the like of the gate driver circuit 12 as described above. In this case, there is no need to vary the Vdd voltage in FIG. 1. That is, the brightness of the screen 50 can be varied without changing the power supply voltage. Also, in the process of change from FIG. 19(*a*1) to FIG. 19(*a*3), the gamma characteristics of the screen do not change at all. Thus, the contrast and gradation characteristics of the display screen are maintained regardless of the brightness of the screen 50. This is an effective feature of the present invention.

In brightness adjustment of a conventional screen, low brightness of the screen 50 results in poor gradation performance. That is, even if 64 gradations can be displayed in a high-brightness display, in most cases, less than half the gradations can be displayed in a low-brightness display. In contrast, the drive method according to the present invention does not depend on the display brightness of the screen and can display up to 64 gradations, which is the highest.

FIG. 19(*b*) shows a brightness adjustment scheme used when the display areas 53 are scattered as in FIG. 16. The display brightness of the screen 50 in FIG. 19(*b*1) is the brightest, the display brightness of the screen 50 in FIG. 19(*b*2) is the second brightest, and display brightness of the screen 50 in FIG. 19(*b*3) is the dimmest. Changes from FIG. 19(*b*1) to FIG. 19(*b*3) (or vice versa) can be achieved easily by controlling the shift register circuit 61 of the gate driver circuit 12 and the like as described above. By scattering the display areas 53 as shown in FIG. 19(*b*), it is possible to eliminate flickering even at a low frame rate.

To eliminate flickering at an even lower frame rate, the display areas 53 can be scattered more finely as shown in FIG. 19(*c*). However, this lowers movie display performance. Thus, the drive method in FIG. 19(*a*) is suitable for moving pictures. The drive method in FIG. 19(*c*) is suitable when it is desired to reduce power consumption by displaying still pictures. Switching from FIG. 19(*a*) to FIG. 19(*c*) can be done easily by controlling the shift register circuit 61.

Mainly, N=two times, N=4 times, etc. are used in the above example. Needless to say, however, the present invention is not limited to integral multiples. It is not limited to a value equal to or larger than N=two, either. For example, less than half the screen 50 may be a non-display area 52 at a certain time point. A predetermined brightness can be achieved if a current Iw 5/4 a predetermined value is used for current programming and the EL element is illuminated for 4/5 of 1F.

The present invention is not limited to the above. For example, a current Iw 10/4 a predetermined value may be used for current programming to illuminate the EL element for 4/5 of 1F. In this case, the EL element illuminates at twice a predetermined brightness. Alternatively, a current Iw 5/4 a predetermined value may used for current programming to illuminate the EL element for 2/5 of 1F. In this case, the EL element illuminates at 1/2 the predetermined brightness. Also, a current Iw 5/4 a predetermined value may be used for current programming to illuminate the EL element for 1/1 of 1F. In this case, the EL element illuminates at 5/4 the predetermined brightness.

Thus, the present invention controls the brightness of the display screen by controlling the magnitude of programming current and illumination period IF. Also, by illuminating the EL element for a period shorter than the period of 1F, the present invention can insert a non-display area 52, and thereby improve movie display performance. By illuminating the EL element constantly for the period of 1F, the present invention can display a bright screen.

If pixel size is A square mm and predetermined brightness of white raster display is B (nt), preferably programming current I (μA) (programming current outputted from the source driver circuit 14) or the current written into the pixel satisfies:

$$(A\times B)/20 \leqq I \leqq (A\times B)$$

This provides good light emission efficiency and solves a shortage of write current.

More preferably, the programming current I (μA) falls within the range:

$$(A\times B)/10 \leqq I \leqq (A\times B)$$

Figure 20A:
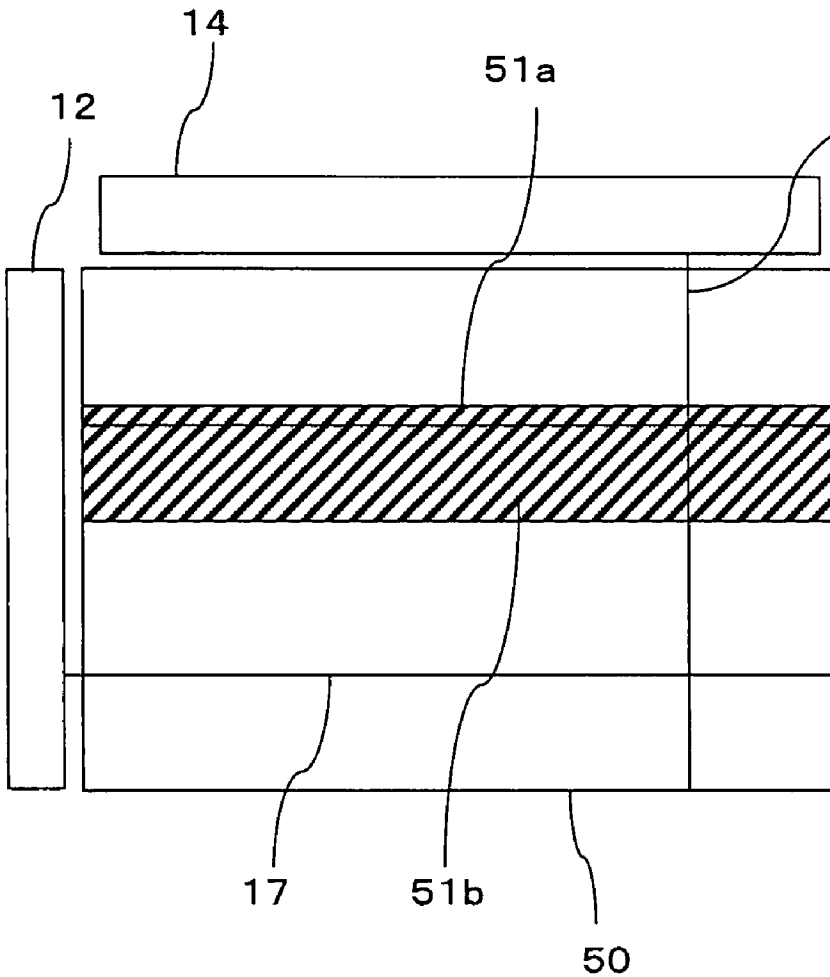
FIG. 20 is an explanatory diagram illustrating a drive method of a display apparatus according to the present invention.
Figure 20B:
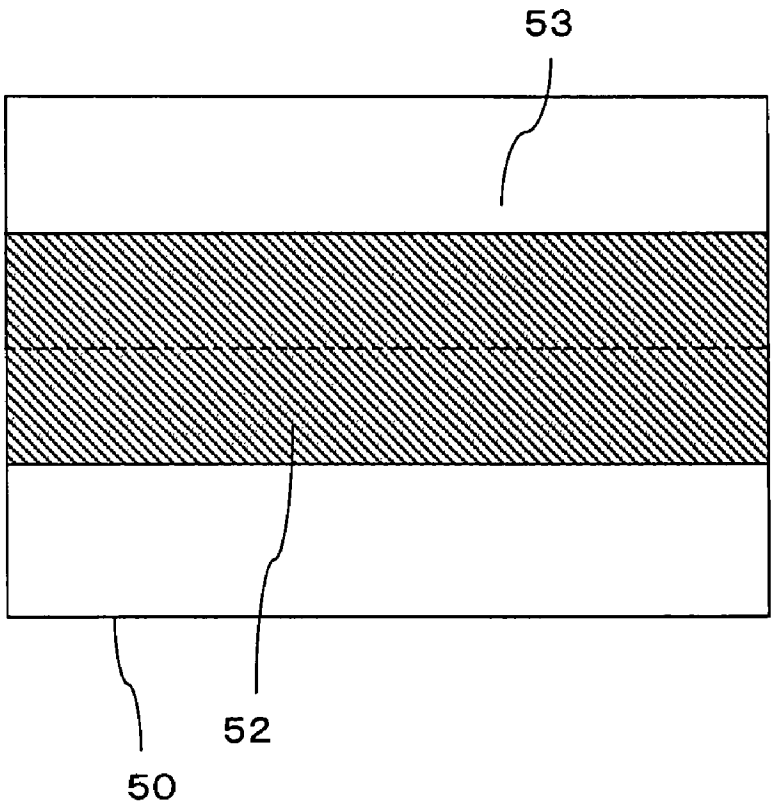

FIG. 20 is an explanatory diagram illustrating another example of increasing the current flowing through a source signal line 18. This method selects a plurality of pixel rows simultaneously, charges and discharges parasitic capacitance and the like of the source signal line 18 using the total current flowing through the plurality of pixel rows, and thereby eases a shortage of write current greatly. Since a plurality of pixel rows are selected simultaneously, drive current per pixel can be reduced. Thus, it is possible to reduce the current flowing through the EL element 15. For ease of explanation, it is assumed that N=10 (the current passed through the source signal line 18 is increased tenfold).

According to the invention described with reference to FIG. 20, M pixel rows are selected simultaneously. A current N times larger than a predetermined current is applied to the source signal line 18 from the source driver IC 14. A current N/M times larger than the current passed through the EL element 15 is programmed into each pixel. As an example, to illuminate the EL element 15 at a predetermined emission brightness, current is passed through the EL element 15 for a duration of M/N the duration of one frame (one field) (M/N is used for ease of explanation and is not meant to be restrictive. As described earlier, it can be specified freely depending on the brightness of the screen 50). This makes it possible to charge and discharge parasitic capacitance of the source signal line 18 sufficiently, resulting in a sufficient resolution at the predetermined emission brightness.

Current is passed through the EL element 15 only for a period M/N the frame (field) period, but current is not passed during the remaining period (1F(N−1) M/N). In this display condition, image data display and black display (non-illumination) are repeated every 1F. That is, image data is displayed at intervals (intermittently) in the temporal sense. This achieves a good display condition without edge blur of images. Also, since the source signal line 18 is driven by an N times larger current, it is not affected by parasitic capacitance. Thus, this method can accommodate high-resolution display panels.

Figure 21:
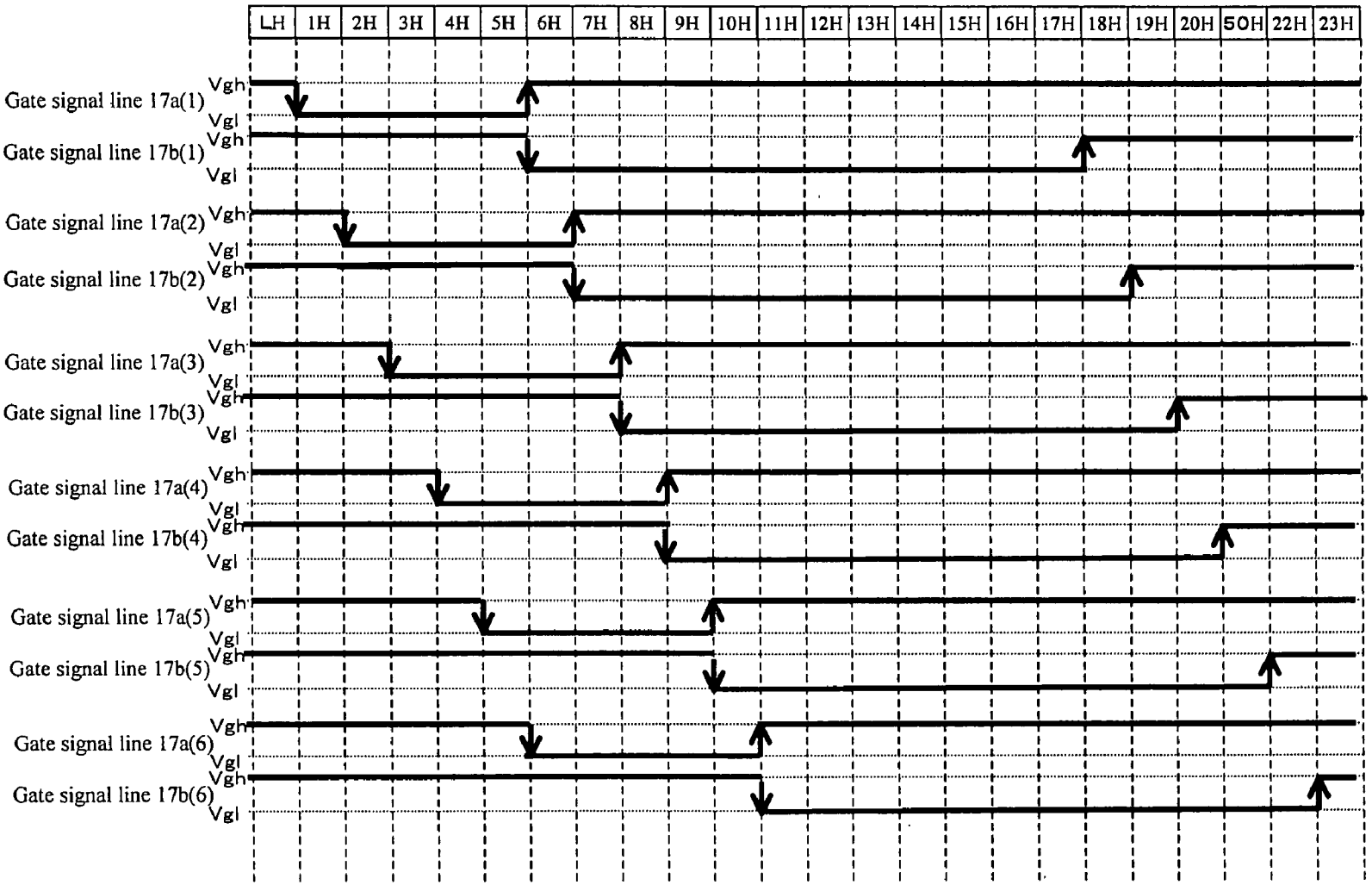
FIG. 21 is an explanatory diagram illustrating a drive method of a display apparatus according to the present invention.

FIG. 21 is an explanatory diagram illustrating drive waveforms used to implement the drive method shown in FIG. 20. Waveforms of the turn-off voltage are denoted by Vgh (H level) while waveforms of the turn-on voltage are denoted by (L level). The subscripts (such as (1), (2), and (3)) indicate pixel row numbers. Incidentally, the number of rows is 220 in the case of a QCIF display panel, and 480 in the case of a VGA display panel.

In FIG. 21, a gate signal line 17*a*(1) is selected (Vgl voltage) and a programming current flows through the source signal line 18 in the direction from the transistor 11*a* in the selected pixel row to the source driver circuit 14. For ease of explanation, it is assumed here that the write pixel row 51*a* is the (1)-th pixel row.

The programming current flowing through the source signal line 18 is N times larger than a predetermined value (for ease of explanation, it is assumed that N=10. Of course, since the predetermined value is a data current for use to display images, it is not a fixed value unless in the case of white raster display). It is also assumed that five pixel rows are selected simultaneously (M=5). Therefore, ideally the capacitor 19 of one pixel is programmed so that a twice (N/M=10/5=2) larger current will flow through the transistor 11*a*.

When the write pixel row is the (1)-th pixel row, the gate signal lines 17*a*(1), (2), (3), (4), and (5) are selected as shown in FIG. 21. That is, the switching transistors 11*b* and the transistors 11*c* in the pixel rows (1), (2), (3), (4), and (5) are on. Also, the gate signal lines 17*b* are 180 degrees out of phase with the gate signal lines 17*a*. Thus, the switching transistors 11*d* in the pixel rows (1), (2), (3), (4), and (5) are off and current does not flow through the EL elements 15 in the corresponding pixel rows. That is, the EL elements 15 are in non-illumination mode 52.

Ideally, the transistors 11*a* in the five pixels deliver a current of Iw×2 each to the source signal line 18 (i.e., a current of Iw×2×N=Iw×2×5=Iw×10 flows through the source signal line 18. Thus, if a predetermined voltage Iw flows when the N-fold pulse driving according to the present invention is not used, a current 10 times larger than Iw flows through the source signal line 18).

Through the above operation (drive method), the capacitor 19 of each pixel 16 is programmed with a twice larger current. For ease of understanding, it is assumed here that the transistors 11*a* have equal characteristics (Vt and S value) Since five pixel rows are selected simultaneously (M=5), five driver transistors 11*a* operate. That is, 10/5=2 times larger current flows through the transistor 11*a* per pixel. The total programming current of the five transistors 11*a* flows through the source signal line 18. For example, if a current conventionally written into the write pixel row 51*a* is Iw, a current of Iw×10 is passed through the source signal line 18. The write pixel rows 51*b* into which image data is written later than the write pixel row (1) are auxiliary pixel rows used to increase the amount of current delivered to the source signal line 18. However, there is no problem because regular image data is written into the write pixel rows 51*b* later.

Thus, the four pixel rows 51*b* provide the same display as the pixel row 51*a* during a period of 1 H. Consequently, at least the write pixel row 51*a* and the pixel rows 51*b* selected to increase current are in non-display mode 52. However, in the pixel configuration of a current mirror, such as shown in FIG. 38, or pixel configuration for voltage programming, the pixel rows may be in display mode.

After 1 H, the gate signal line 17*a* (1) becomes deselected and a turn-on voltage (Vgl) is applied to the gate signal line 17*b*. At the same time, the gate signal line 17*a*(6) is selected (Vgl voltage) and a programming current flows through the source signal line 18 in the direction from the transistor 11*a* in the selected pixel row (6) to the source driver circuit 14. Through this operation, regular image data is held in the pixel row (1).

After the next 1 H, the gate signal line 17*a*(2) becomes deselected and a turn-on voltage (Vgl) is applied to the gate signal line 17*b*. At the same time, the gate signal line 17*a*(7) is selected (Vgl voltage) and a programming current flows through the source signal line 18 in the direction from the transistor 11*a* in the selected pixel row (7) to the source driver circuit 14. Through this operation, regular image data is held in the pixel row (2). The entire screen is redrawn as it is scanned by shifting pixel rows one by one through the above operations.

With the drive method in FIG. 20, since each pixel is programmed with a twice larger current, ideally the emission brightness of the EL element 15 of each pixel is two times higher. Thus, the brightness of the display screen is twice higher than a predetermined value. To equalize this brightness with the predetermined brightness, an area which includes the write pixel rows 51 and which is half as large as the display screen 50 can be turned into a non-display area 52 as illustrated in FIG. 16.

As is the case with FIG. 13, when one display area 53 moves from top to bottom of the screen as shown in FIG. 20, the movement of the display area 53 is recognized visually if a low frame rate is used. It tends to be recognized easily especially when the user closes his/her eyes or moves his/her head up and down.

Figure 22B:
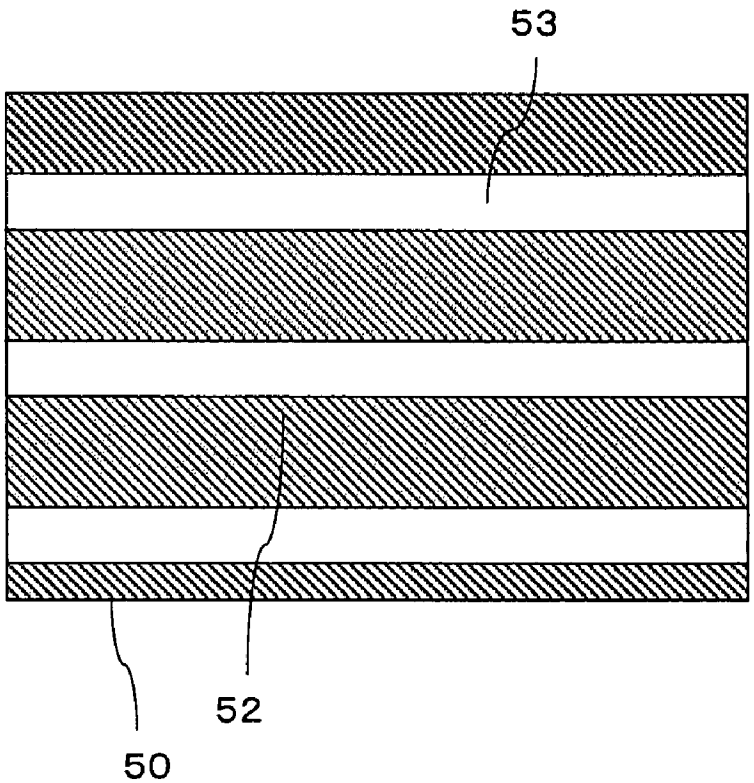
FIG. 22 is an explanatory diagram illustrating a drive method of a display apparatus according to the present invention.
Figure 22A:
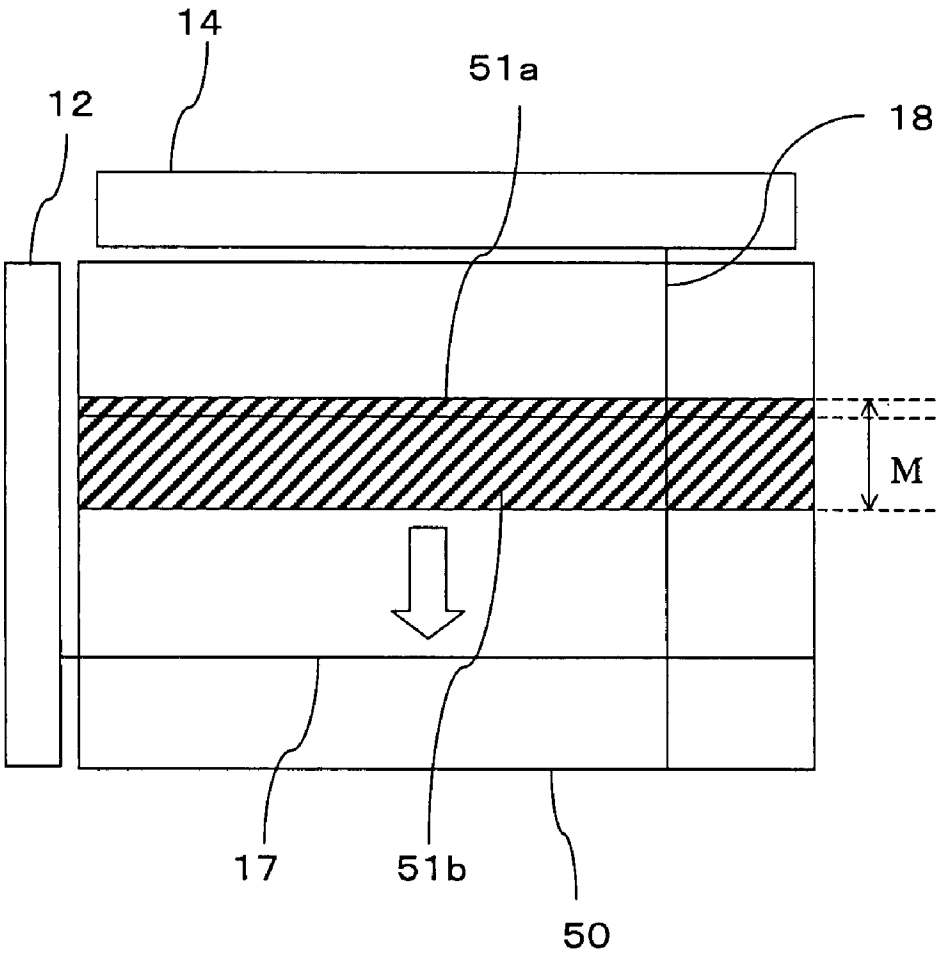

To deal with this problem, the display area 53 can be divided into a plurality of parts as illustrated in FIG. 22. If the total area of the divided non-display area 52 is S(N−1)/N, the brightness is equal to the brightness of the undivided display area.

Figure 23:
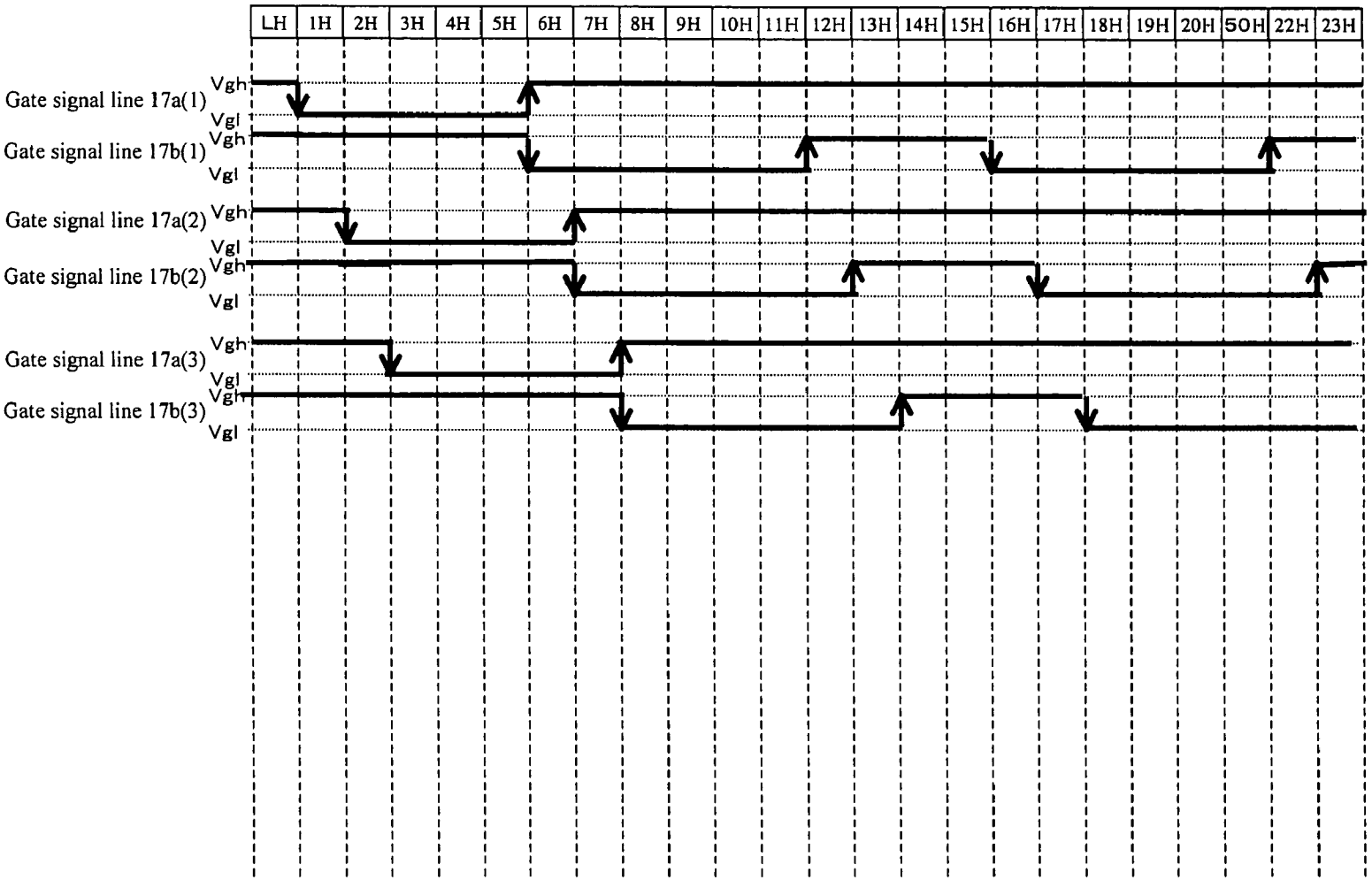
FIG. 23 is an explanatory diagram illustrating a drive method of a display apparatus according to the present invention.

FIG. 23 shows voltage waveforms applied to gate signal lines 17. FIG. 21 differs from FIG. 23 basically in the operation of the gate signal line 17*b*. The gate signal line 17*b* is turned on and off (Vgl and Vgh) as many times as there are screen divisions. FIG. 23 is the same as FIG. 21 in other respects, and thus description thereof will be omitted.

As described above, dividing the display area 53 reduces flickering of the screen. Thus, a flicker-free good image display can be achieved. Incidentally, the display area 53 may be divided more finely. The more finely the display area 53 is divided, the less flickering occurs. Since the EL element 15 is highly responsive, even if it is turned on and off at intervals shorter than 5 μsec, there is no lowering of the display brightness.

With the drive method according to the present invention, the EL element 15 can be turned on and off by turning on and off a signal applied to the gate signal line 17*b*. Thus, the drive method according to the present invention can perform control using a low frequency on the order of KHz. Also, it does not need an image memory or the like in order to insert a black screen (insert a non-display area 52). Thus, the drive circuit or method according to the present invention can be implemented at low costs.

Figure 24A:
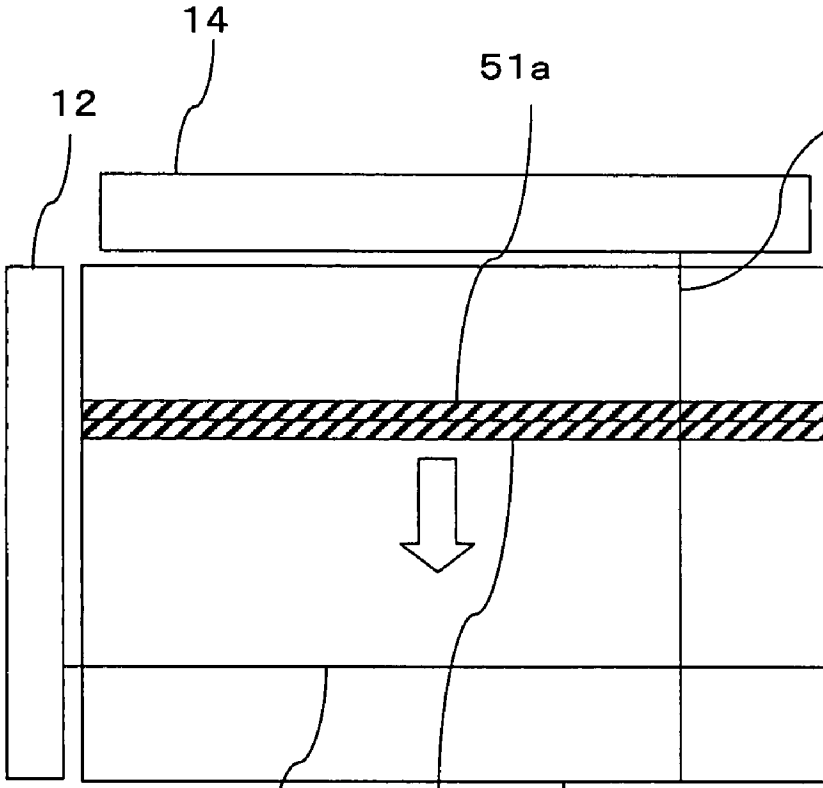
FIG. 24 is an explanatory diagram illustrating a drive method of a display apparatus according to the present invention.
Figure 24B:
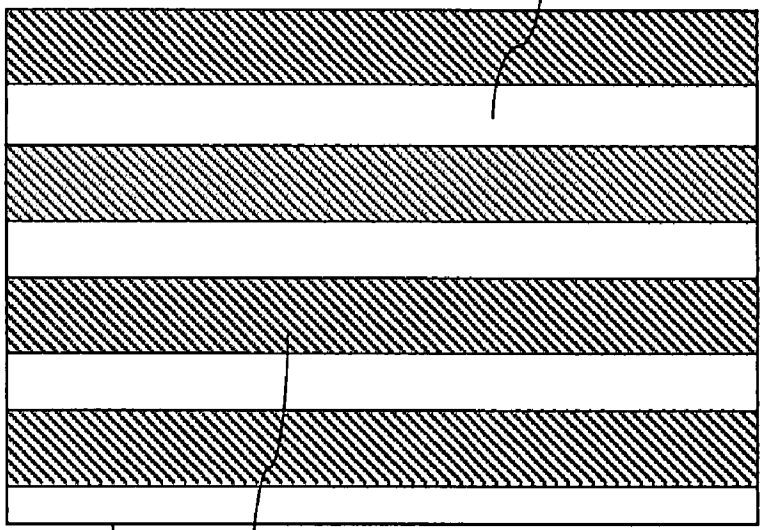

FIG. 24 shows a case in which two pixel rows are selected simultaneously. It was found that on a display panel formed by low-temperature polysilicon technology, a method in which two pixel rows were selected simultaneously provided uniform display on a practical level. Probably this is because driver transistors 11*a* in adjacent pixels had very similar characteristics. In laser annealing, good results were obtained when laser stripes were irradiated in parallel with the source signal line 18.

This is because that part of a semiconductor film which is annealed simultaneously has uniform characteristics. That is, the semiconductor film is created uniformly within an irradiation range of laser stripes and the Vt and mobility of the transistors which use the semiconductor film are almost uniform. Thus, if a striped laser shot is moved in parallel with the source signal line 18, pixels (a pixel column, i.e., pixels arranged vertically on the screen) along the source signal line 18 take on almost equal characteristics. Therefore, if a plurality of pixel rows are turned on simultaneously for current programming, the current obtained by dividing the programming current by the number of selected pixels are programmed almost uniformly into the pixels This makes it possible to program a current close to a target value and achieve uniform display. Thus, the direction of a laser shot and the drive method described with reference to FIG. 24 and the like have a synergistic effect.

As described above, if the direction of a laser shot is made to coincide approximately with the direction of the source signal line 18 (see FIG. 7), the characteristics of the pixel transistors 11*a* arranged vertically become almost uniform, making it possible to do proper current programming (even if the characteristics of the pixel transistors 11*a* arranged horizontally are not uniform). The above operation is performed in sync with 1 H (one horizontal scanning period) by shifting selected pixel rows one by one or by shifting two or more selected pixel rows at once.

Incidentally, as described with reference to FIG. 8, the direction of the laser shot does not always need to be parallel with the direction of the source signal line 18. This is because even if the laser shot is directed at angles to the source signal line 18, pixel transistors 11*a* placed along one source signal line 18 can be made to take on almost equal characteristics. Thus, directing a laser shot in parallel with the source signal line 18 means bringing a pixel vertically adjacent to an arbitrary pixel along the source signal line 18 into a laser irradiation range. Besides, a source signal line 18 generally constitutes wiring which transmits programming current or voltage used as a video signal.

Incidentally, in the examples of the present invention a write pixel row is shifted every 1 H, but this is not restrictive. Pixel rows may be shifted every 2 Hs (two pixel rows at a time). Also, more than two pixel rows may be shifted at a time. Also, pixel rows may be shifted at desired time intervals or every second pixel may be shifted.

The shifting interval may be varied according to locations on the screen. For example, the shifting interval may be decreased in the middle of the screen, and increased at the top and bottom of the screen. For example, a pixel row may be shifted at intervals of 200 μsec. in the middle of the screen 50, and at intervals of 100 μsec. at the top and bottom of The screen 50. This increases emission brightness in the middle of the screen 50 and decreases it around the perimeters (at the top and bottom of the screen 50). Needless to say, the shifting interval is varied smoothly among the top, middle, and bottom of the screen 50 to avoid brightness contours.

Incidentally, the reference voltage of the source driver circuit 14 may be varied with the scanning location on the screen 50 (see FIG. 146, etc.). For example, a reference current of 10 μA is used in the middle of the screen 50 and a reference current of 5 μA is used at the top of the screen 50. Varying a reference current in this way corresponding to a location in the screen 50, increases emission brightness in the middle of the screen 50 and decreases it around the perimeters (at the top and bottom of the screen 50). Needless to say, the reference current is varied smoothly among the top, middle, and bottom of the screen 50 to avoid brightness contours.

Also, it goes without saying that images may be displayed by combining a drive method which varies the pixel-row shifting interval with the location on the screen and a drive method which varies the reference voltage with the location on the screen 50.

The shifting interval may be varied on a frame-by-frame basis. Also, it is not strictly necessary to select consecutive pixel rows. For example, every second pixel row may be selected.

Specifically, a possible drive method involves selecting the first and third pixel rows in the first horizontal scanning period, the second and fourth pixel rows in the second horizontal scanning period, the third and fifth pixel rows in the third horizontal scanning period, and the fourth and sixth pixel rows in the fourth horizontal scanning period. Of course, a drive method which involves selecting the first, third, and fifth pixel rows in the first horizontal scanning period also belongs to the technical category of the present invention. Also, one in every few pixel rows may be selected.

Figure 32:
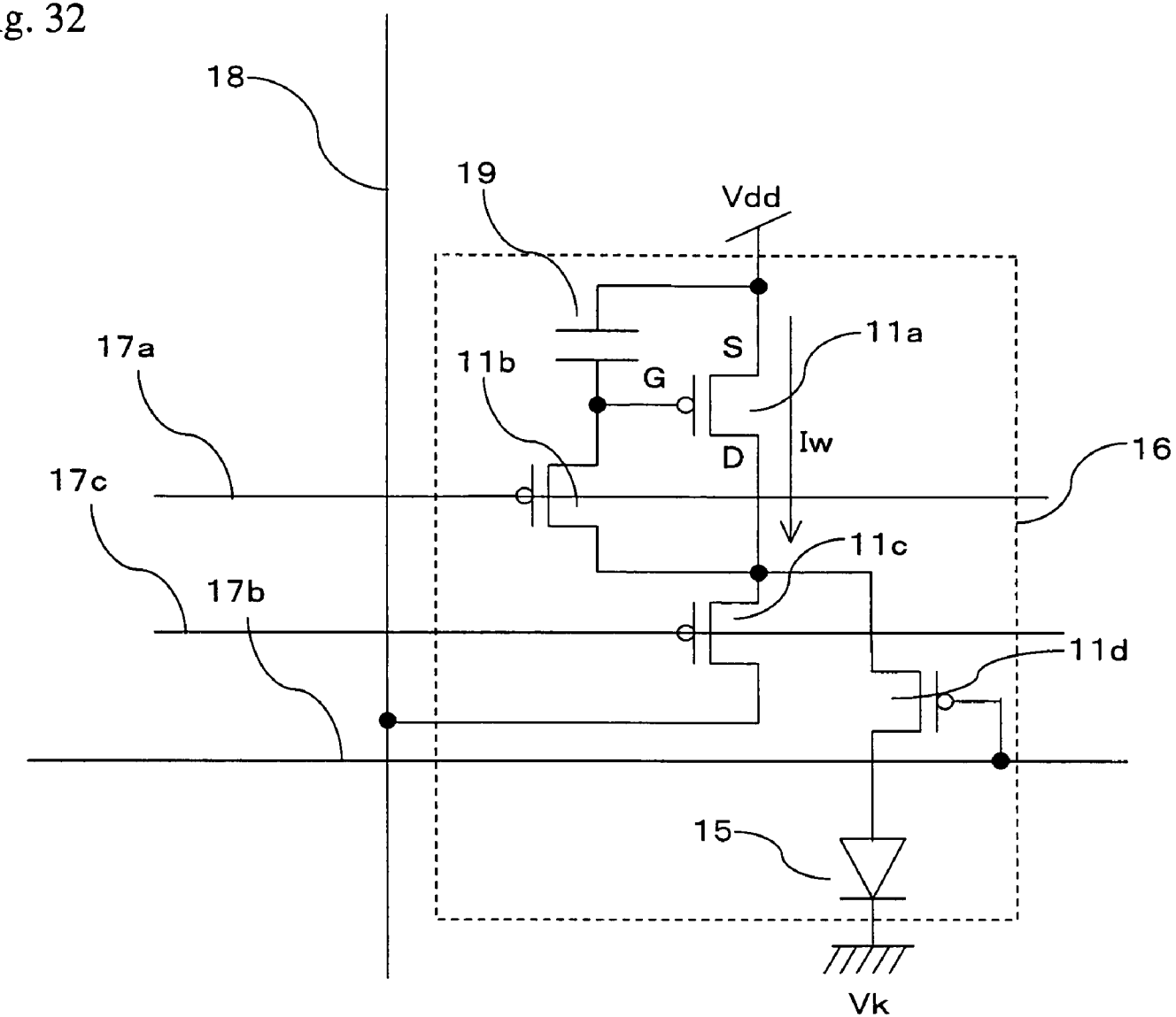
FIG. 32 is an explanatory diagram illustrating a drive method of a display apparatus according to the present invention.
Figure 50:
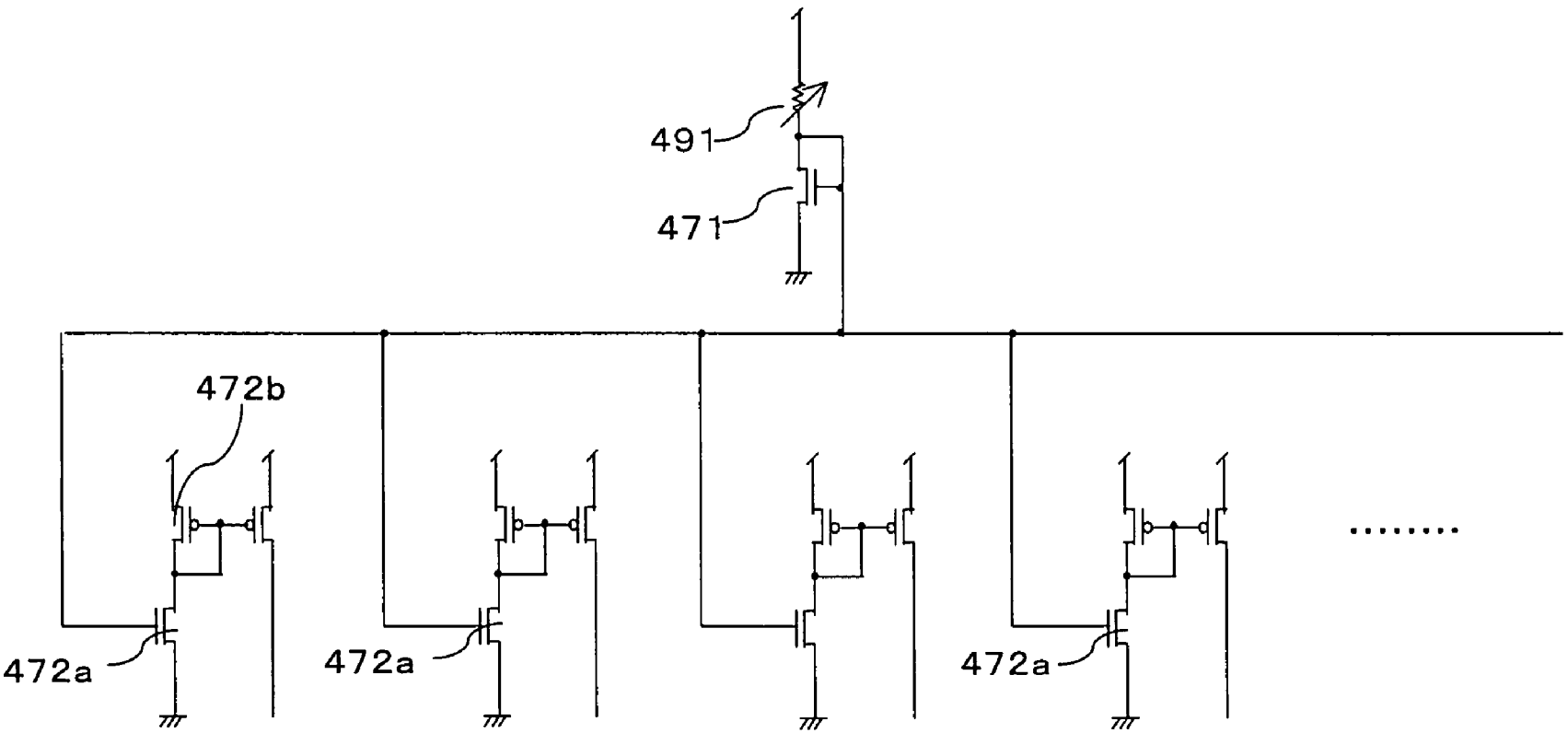
FIG. 50 is an explanatory diagram illustrating a drive circuit according to the present invention.

Incidentally, the combination of the direction of a laser shot and selection of multiple pixel rows is not limited to the pixel configurations in FIGS. 1, 2, and 32, but it is also applicable to other current-driven pixel configurations such as the current-mirror pixel configurations in FIGS. 38, 42, 50, etc. Also, it can be applied to voltage-driven pixel configurations in FIGS. 43, 51, 54, 46, etc. This is because as long as transistors in upper and lower parts of the pixel have equal characteristics, current programming can be performed properly using the voltage value applied to the same source signal line 18.

Figure 25:
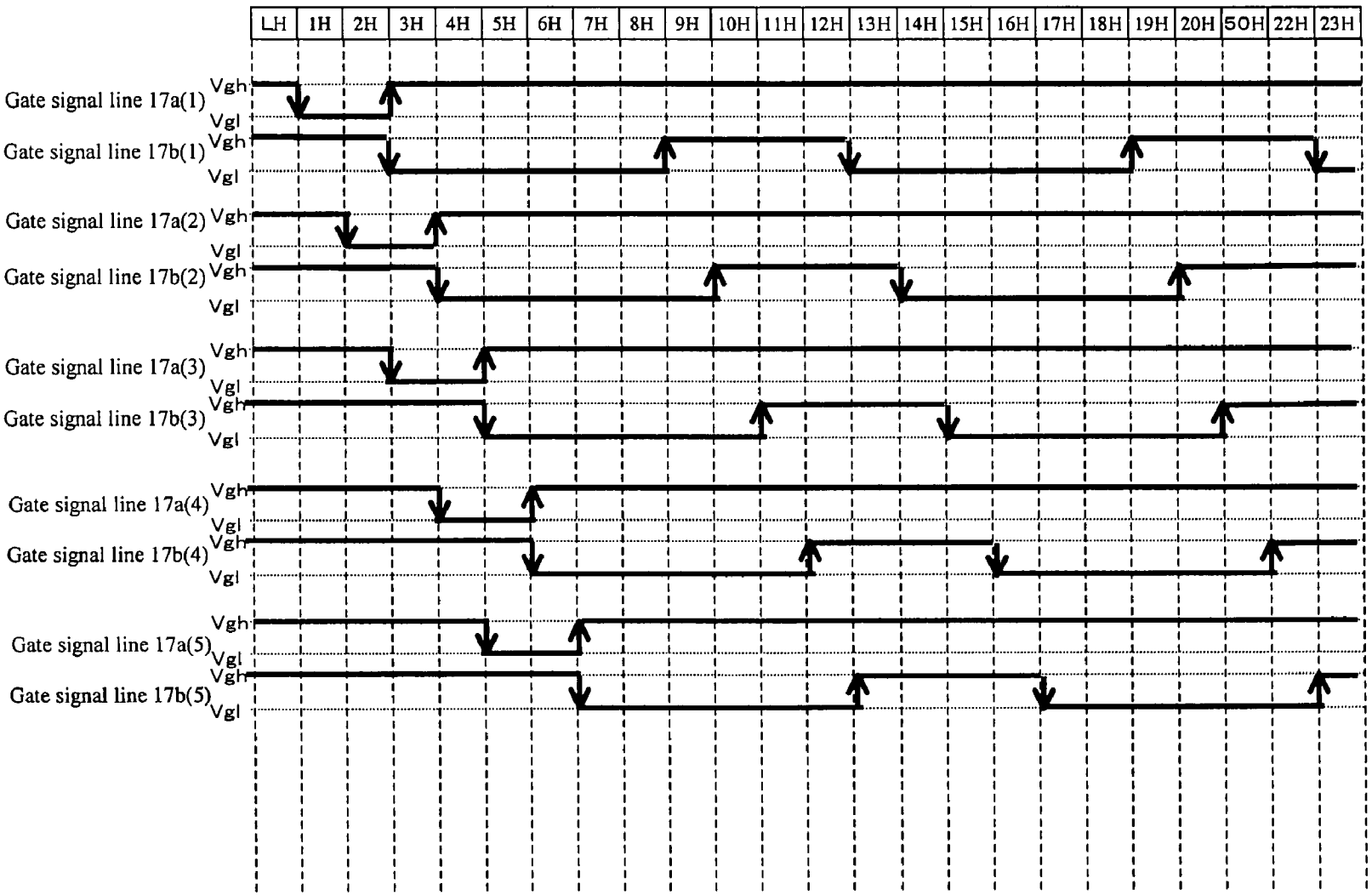
FIG. 25 is an explanatory diagram illustrating a drive method of a display apparatus according to the present invention.

In FIG. 24, when the write pixel row is the (1)-th pixel row, the gate signal lines 17*a*(1) and (2) are selected (see FIG. 25). That is, the switching transistors 11*b* and the transistors 11*c* in the pixel rows (1) and (2) are on. Thus, at least the switching transistors 11*d* in the pixel rows (1) and (2) are off and current does not flow through the EL elements 15 in the corresponding pixel rows. That is, the EL elements 15 are in non-illumination mode 52. Incidentally, in FIG. 24, the display area 53 is divided into five parts to reduce flickering.

Ideally, the transistors 1*a* in the two pixel rows deliver a current of Iw×5 each to the source signal line 18 (when N=10. Since K=2, a current of Iw×K×5=Iw×10 flows through the source signal line 18). Then, the capacitor 19 of each pixel 16 is programmed with a 5 times larger current.

Since two pixel rows are selected simultaneously (K=2), two driver transistors 11*a* operate. That is, 10/2=5 times larger current flows through the transistor 11*a* per pixel. The total programming current of the two transistors 1*a* flows through the source signal line 18.

For example, if the current written into the write pixel row 51*a* is Id, a current of Iw×10 is passed through the source signal line 18. There is no problem because regular image data is written into the write pixel row 51*b* later. The pixel row 51*b* provides the same display as the pixel row 51*a* during a period of 1 H. Consequently, at least the write pixel row 51*a* and the pixel row 51*b* selected to increase current are in non-display mode 52.

After the next 1 H, the gate signal line 17*a*(1) becomes deselected and a turn-on voltage (Vgl) is applied to the gate signal line 17*b*. At the same time, the gate signal line 17*a*(3) is selected (Vgl voltage) and a programming current flows through the source signal line 18 in the direction from the transistor 11*a* in the selected pixel row (3) to the source driver circuit 14. Through this operation, regular image data is held in the pixel row (1).

After the next 1 H, the gate signal line 17*a*(2) becomes deselected and a turn-on voltage (Vgl) is applied to the gate signal line 17*b*. At the same time, the gate signal line 17*a*(4) is selected (Vgl voltage) and a programming current flows through the source signal line 18 in the direction from the transistor 11*a* in the selected pixel row (4) to the source driver circuit 14. Through this operation, regular image data is held in the pixel row (2). The entire screen is redrawn as it is scanned by shifting pixel rows one by one through the above operations (of course, two or more pixel rows may be shifted simultaneously. For example, in the case of pseudo-interlaced driving, two pixel rows will be shifted at a time. Also, from the viewpoint of image display, the same image may be written into two or more pixel rows).

As in the case of FIG. 16, with the drive method in FIG. 24, since each pixel is programmed with a five times larger current (voltage), ideally the emission brightness of the EL element 15 is five times higher. Thus, the brightness of the display area 53 is five times higher than a predetermined value. To equalize this brightness with the predetermined brightness, an area which includes the write pixel rows 51 and which is 1/5 the display screen 50 can be turned into a non-display area 52.

Figure 26:
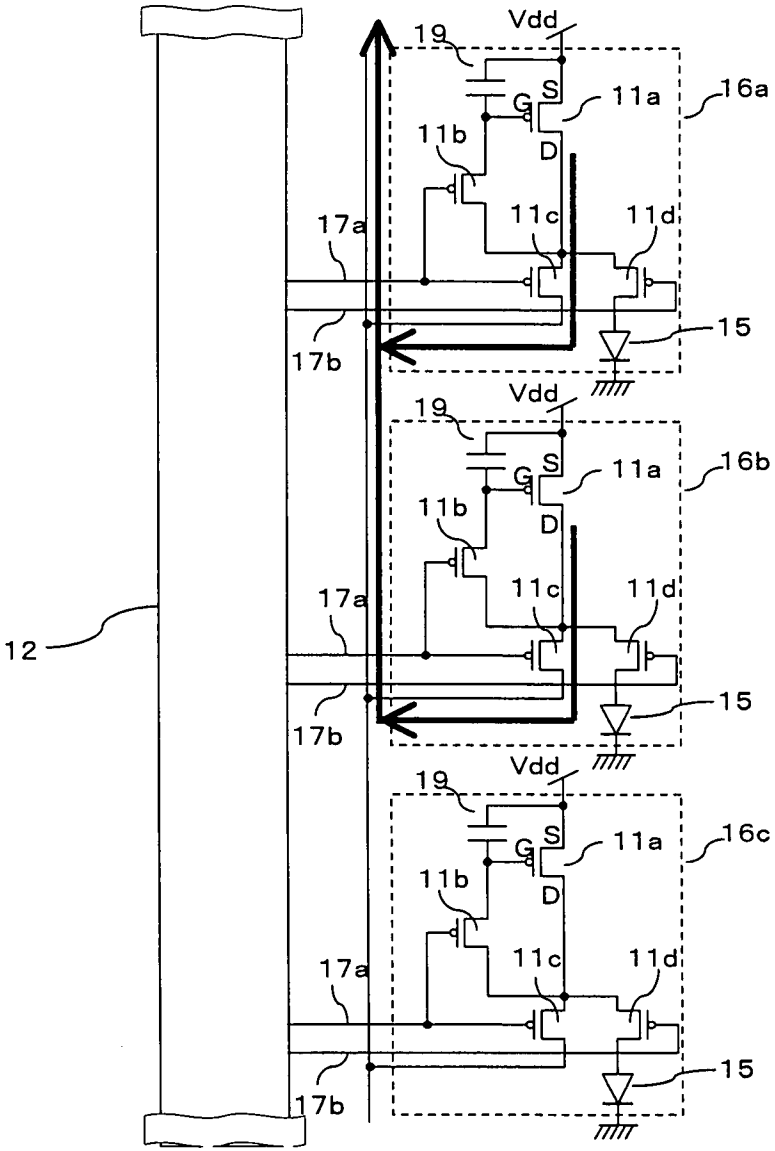
FIG. 26 is an explanatory diagram illustrating a drive method of a display apparatus according to the present invention.

As shown in FIG. 27, two write pixel rows 51 (51*a* and 51*b*) are selected in sequence from the upper side to the lower side of the screen 50 (see also FIG. 26. Pixels 16*a* and 16*b* are selected in FIG. 26). However, at the bottom of the screen, there does not exist 51*b* although the write pixel row 51*a* exists. That is, there is only one pixel row to be selected. Thus, the current applied to the source signal line 18 is all written into the write pixel row 51*a*. Consequently, twice as large a current as usual is written into the write pixel row 51*a*.

To deal with this problem, the present invention forms (places) a dummy pixel row 271 at the bottom of the screen 50, as shown in FIG. 27(*b*). Thus, after the pixel row at the bottom of the screen 50 is selected, the final pixel row of the screen 50 and the dummy pixel row 271 are selected. Consequently, a prescribed current is written into the write pixel row in FIG. 27(*b*).

Incidentally, although the dummy pixel row 271 is illustrated as being adjacent to the top end or bottom end of the display screen 50, this is not restrictive. It may be formed at a location away from the display screen 50. Besides, the dummy pixel row 271 does not need to contain a switching transistor 11*d* or EL element 15 such as those shown in FIG. 1. This reduces the size of the dummy pixel row 271.

Figure 28:
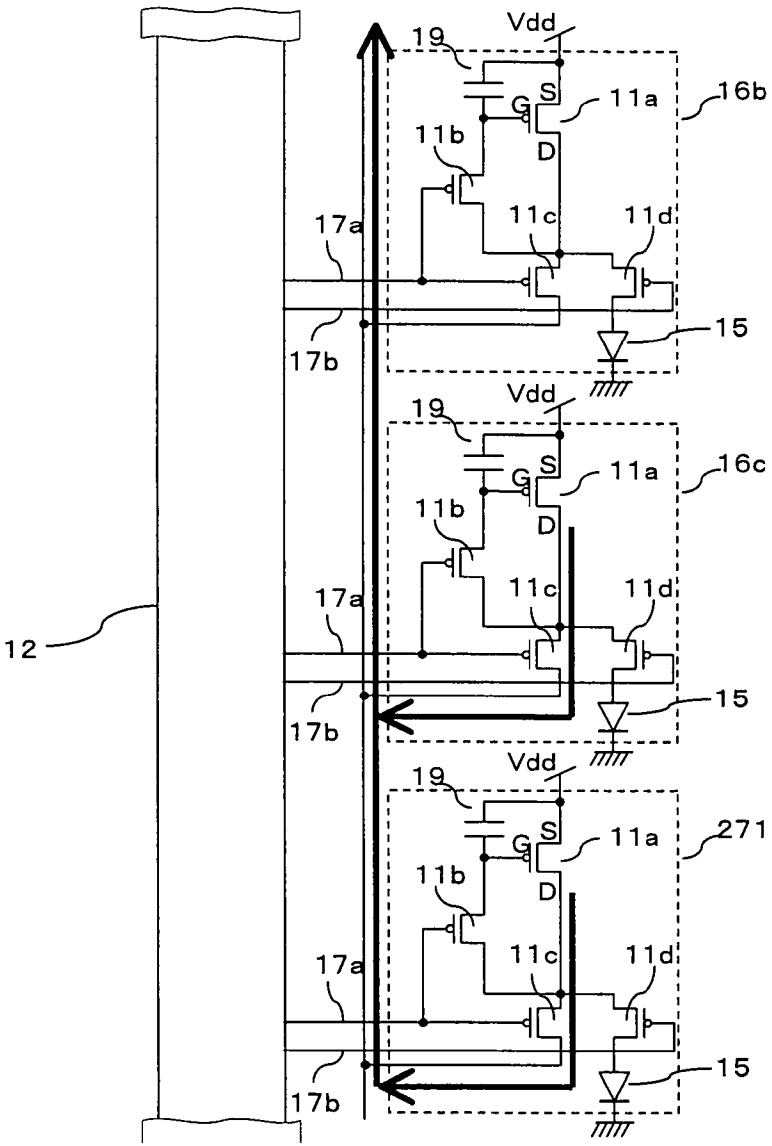
FIG. 28 is an explanatory diagram illustrating a drive method of a display apparatus according to the present invention.

FIG. 28 shows a mechanism of how the state shown in FIG. 27(*b*) takes place. As can be seen from FIG. 28, after the pixel 16*c* at the bottom of the screen 50 is selected, the final pixel row (dummy pixel row) 271 of the screen 50 is selected. The dummy pixel row 271 is placed outside the screen 50. That is, the dummy pixel row (dummy pixel) 271 does not illuminate, is not illuminated, or is hidden even if illuminated. For example, contact holes between the pixel electrode 105 and transistor 11 are eliminated, no EL film is formed on the dummy pixel row 271, or the like. Also, an insulating film may be formed on the pixel electrode 105 of the dummy pixel row 271.

Figure 29B:
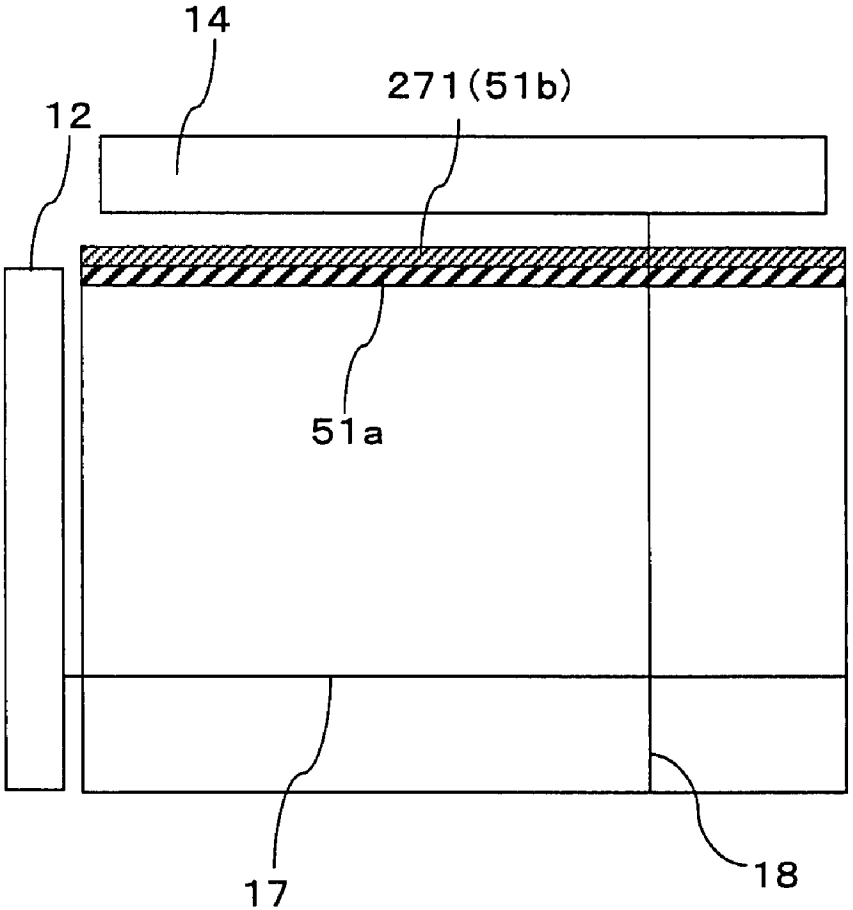
FIG. 29 is an explanatory diagram illustrating a drive method of a display apparatus according to the present invention.
Figure 29A:
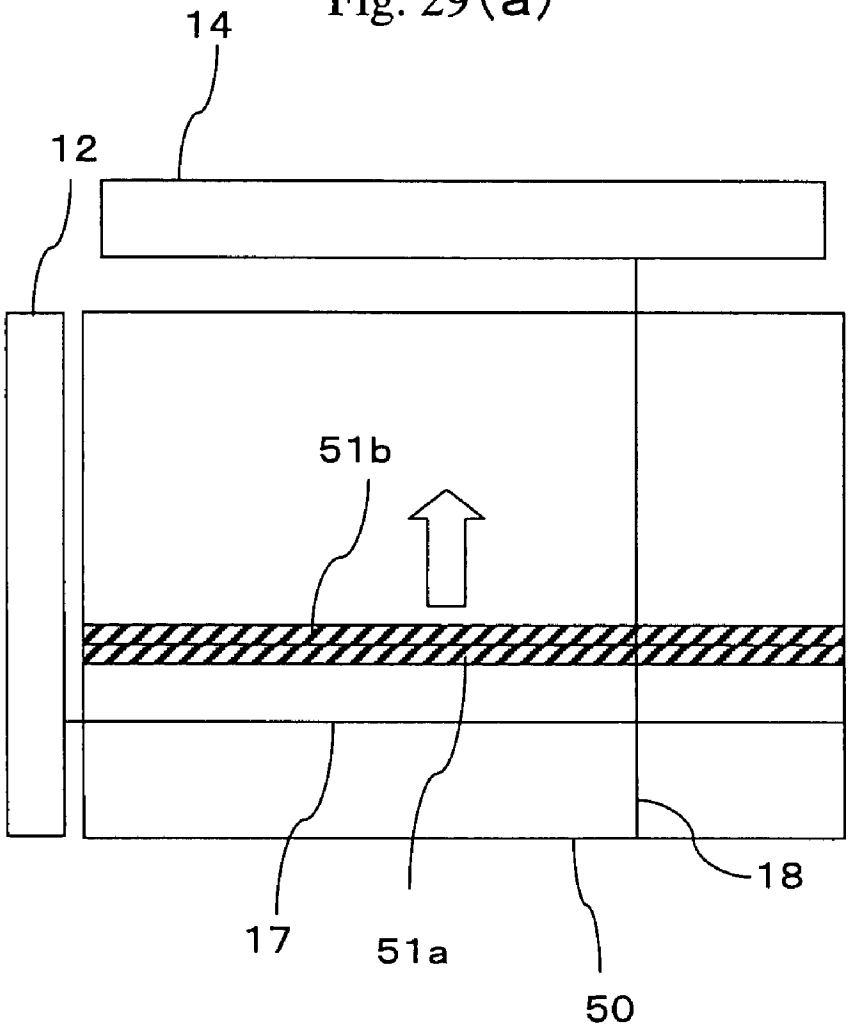

Although it has been stated with reference to FIG. 27 that the dummy pixel (row) 271 is provided (formed or placed) at the bottom of the screen 50, this is not restrictive. For example when the screen is scanned from bottom to top (inverse scanning) as shown in FIG. 29(*a*), a dummy pixel row 271 should also be formed at the top of the screen 50 as shown in FIG. 29(*b*). That is, dummy pixel rows 271 are formed (placed) both at the top and bottom of the screen 50. This configuration accommodates in verses canning of the screen as well. Two pixel rows are selected simultaneously in the example described above.

The present invention is not limited to this. For example, five pixel rows may be selected simultaneously (see FIG. 23). When five pixel rows are selected simultaneously, four dummy pixel rows 271 should be formed. That is, the number of dummy pixel rows 271 equals the number of pixel rows selected simultaneously minus one. However, this is true only when the selected pixel rows are shifted one by one. When two or more pixel rows are shifted at a time, (M−1)×L dummy pixel rows should be formed, where M is the number of pixels selected and L is the number of pixel rows shifted at a time.

The dummy pixel row configuration or dummy pixel row driving according to the present invention uses one or more dummy pixel rows. Of course, it is preferable to use the dummy pixel row driving and N-fold pulse driving in combination.

In the drive method which selects two or more pixel rows at a time, the larger the number of pixel rows selected simultaneously, the more difficult it becomes to absorb variations in the characteristics of the transistors 11*a*. However, the current programmed into one pixel increases with decreases in the number M of pixel rows selected simultaneously, resulting in a large current flowing through the EL element 15, which in turn makes the EL element 15 prone to degradation.

FIG. 30 shows how to solve this problem. The basic concept behind FIG. 30 is to use a method of selecting a plurality of pixel rows simultaneously during 1/2 H (1/2 of a horizontal scanning period) as described with reference to FIGS. 22 and 29 and to use a method of selecting one pixel row in the latter 1/2 H (1/2 of the horizontal scanning period) as described with reference to FIGS. 5 and 13. This combination makes it possible to absorb variations in the characteristics of the transistors 11*a* and achieve high speed and uniform surfaces. Incidentally, although the period of 1/2 H is used for ease of understanding, this is not restrictive. The first period may be 1/4 H and the second period may be 3/4 H.

Referring to FIG. 30, for ease of understanding, it is assumed that five pixel rows are selected simultaneously in the first period and that one pixel row is selected in the second period. First, as shown in FIG. 30(*a*1), in the first period (first 1/2 H), five pixel rows are selected simultaneously. This operation has been described with reference to FIG. 22, and thus description thereof will be omitted. As an example, it is assumed that the current passed through the source signal line 18 is 25 times as large as a predetermined value. Thus, the transistor 11*a* in the pixel 16 (in the pixel configuration in FIG. 1) is programmed with a five times larger current (25/5 pixel rows=5). Since the current is 25 times larger, the parasitic capacitance generated in the source signal line 18 and the like is charged and discharged in an extremely short period. Consequently, the potential of the source signal line 18 reaches a target potential in a short period of time and the terminal voltage of the capacitor 19 of each pixel 16 is programmed to pass a 25 times larger current. The 25 times larger current is applied in the first 1/2 H (1/2 of the horizontal scanning period).

Naturally, since the same image data is written into the five write pixel rows, the transistors 11*d* in the five write pixel rows are turned off in order not to display the image. Thus, the display condition is as shown in FIG. 30(*a*2).

In the next 1/2 H period, one pixel is selected for current (voltage) programming. The condition is as shown in FIG. 30(*b*1). Current (voltage) programming is performed so as to pass a five times larger current through the write pixel row 51*a* as in the first period. Equal current is passed in FIG. 30(*a*1) and FIG. 30(*b*1) to reach a target current more quickly by decreasing the changes in the terminal voltage of the programmed capacitor 19.

Specifically, in FIG. 30(*a*1), current is passed through a plurality of pixels, approaching an approximate target value quickly. In this first stage, since a plurality of transistors 11*a* are programmed, variations in the transistors cause error with respect to the target value. In the second stage, only a pixel row where data will be written and held is selected and complete programming is performed by changing the value of current from the approximate target value to a predetermined target value.

Incidentally, scanning of the non-illuminated area 52 from top to bottom of the screen and scanning of the write pixel rows 51*a* from top to bottom of the screen are performed in the same manner as in examples in FIG. 13 and the like, and thus description thereof will be omitted.

Figure 31:
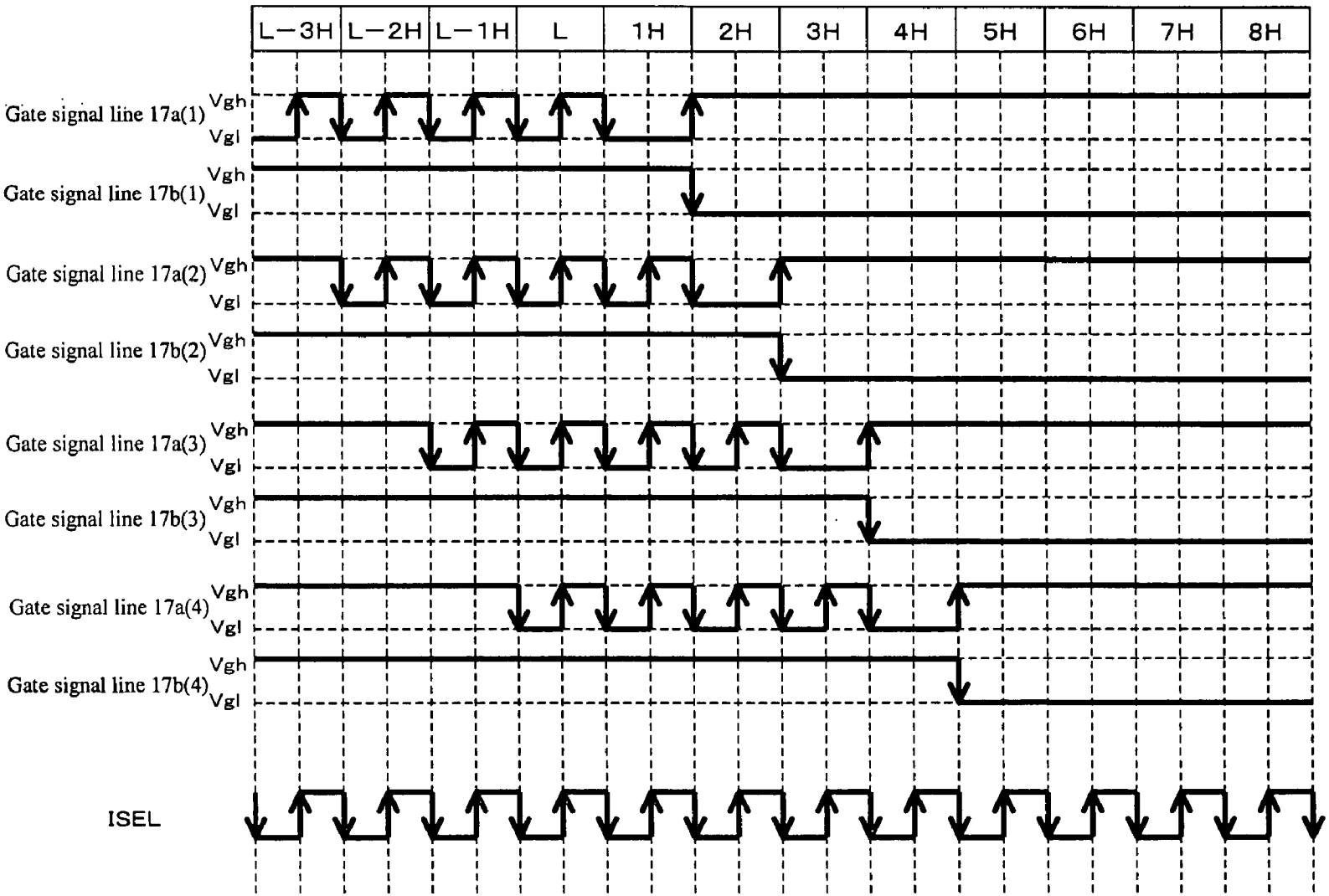
FIG. 31 is an explanatory diagram illustrating a drive method of a display apparatus according to the present invention.

FIG. 31 shows drive waveforms used to implement the drive method shown in FIG. 30. As can be seen from FIG. 31, 1 H (one horizontal scanning period) consists of two phases. An ISEL signal is used to switch between the two phases. The ISEL signal is illustrated in FIG. 31.

First, the ISEL signal will be described. The driver circuit 14 which performs operations shown in FIG. 30 comprises a current output circuit A and current output circuit B. Each of the current output circuits consists of a D/A circuit which converts 8-bit gradation data from digital to analog, an operation amplifier, etc. In the example in FIG. 30, the current output circuit A is configured to output 25 times larger current. On the other hand, the current output circuit B is configured to output 5 times larger current. Outputs from the current output circuit A and current output circuit B are controlled by a switch circuit formed (placed) in a current output section through the ISEL signals and are applied to the source signal line 18. Such current output circuits are placed on each source signal line 18.

When the ISEL signal is low, the current output circuit A which outputs 25 times larger current is selected and current from the source signal line 18 is absorbed by the source driver IC 14 (more precisely, the current is absorbed by the current output circuit A formed in the source driver IC 14). The magnification (such as ×25 or ×5) of the current from the current output circuits can be adjusted easily using a plurality of resisters and an analog switch.

As shown in FIG. 30, when the write pixel row is the (1)-th pixel row (see the 1 H column in FIG. 31), the gate signal lines 17*a*(1), (2), (3), (4), and (5) are selected (in the case of configuration shown in FIG. 1). That is, the switching transistors 11*b* and the transistors 11*c* in the pixel rows (1), (2), (3), (4), and (5) are on. Besides, since ISEL is low, the current output circuit A which outputs 25 times larger current is selected and connected to the source signal line 18. Also, a turn-off voltage (Vgh) is applied to the gate signal line 17*b*. Thus, the switching transistors 11*d* in the pixel rows (1), (2), (3), (4), and (5) are off and current does not flow through the EL elements 15 in the corresponding pixel rows. That is, the EL elements 15 are in non-illumination mode 52.

Ideally, the transistors 11*a* in the five pixels deliver a current of Iw×2 each to the source signal line 18. Then, the capacitor 19 of each pixel 16 is programmed with a five times larger current. For ease of understanding, it is assumed here that the transistors have equal characteristics (Vt and S value).

Since five pixel rows are selected simultaneously (K=5), five driver transistors 11*a* operate. That is, 25/5=5 times larger current flows through the transistor 11*a* per pixel. The total programming current of the five transistors 11*a* flows through the source signal line 18. For example, if the current written into the write pixel row 51*a* by a conventional drive method is Iw, a current of Iw×25 is passed through the source signal line 18. The write pixel rows 51*b* into which image data is written later than the write pixel row (1) are auxiliary pixel rows used to increase the amount of current delivered to the source signal line 18. However, there is no problem because regular image data is written into the write pixel rows 51*b* later.

Thus, the pixel rows 51*b* provide the same display as the pixel row 51*a* during a period of 1 H. Consequently, at least the write pixel row 51*a* and the pixel rows 51*b* selected to increase current are in non-display mode 52.

In the next 1/2 H period (1/2 of the horizontal scanning period), only the write pixel row 51*a* is selected. That is, only the (1)-th pixel row is selected. As can be seen from FIG. 31, a turn-on voltage (Vgl) is applied only to the gate signal line 17*a*(1) and a turn-off voltage (Vgh) is applied to the gate signal lines 17*a*(2), (3), (4), and (5). Thus, the transistor 11*a* in the pixel row (1) is in operation (supplying current to the source signal line 18), but the switching transistors 11*b* and the transistors 11*c* in the pixel rows (2), (3), (4), and (5) are off. That is, they are non-selected.

Besides, since ISEL is high, the current output circuit B which outputs 5 times larger current is selected and connected to the source signal line 18. Also, a turn-off voltage (Vgh) is applied to the gate signal line 17*b*, which is in the same state as during the first 1/2 H. Thus, the switching transistors 11*d* in the pixel rows (1), (2), (3), (4), and (5) are off and current does not flow through the EL elements 15 in the corresponding pixel rows. That is, the EL elements 15 are in non-illumination mode 52.

Thus, each transistor 11*a* in the pixel row (1) deliver a current of Iw×5 to the source signal line 18. Then, the capacitor 19 in pixel row (1) is programmed with a 5 times larger current.

In the next horizontal scanning period, the write pixel row shifts by one. That is, the pixel row (2) becomes the current write pixel row. During the first 1/2 H period, when the write pixel row is the (2)-th pixel row, the gate signal lines 17*a*(2), (3), (4), and (5) and (6) are selected. That is, the switching transistors 11*b* and the transistors 11*c* in the pixel rows (2), (3), (4), (5), and (6) are on. Besides, since ISEL is low, the current output circuit A which outputs 25 times larger current is selected and connected to the source signal line 18. Also, a turn-off voltage (Vgh) is applied to the gate signal line 17*b*.

Thus, the switching transistors 11*d* in the pixel rows (2), (3), (4), (5), and (6) are off and current does not flow through the EL elements 15 in the corresponding pixel rows. That is, the EL elements 15 are in non-illumination mode 52. On the other hand, since Vgl voltage is applied to the gate signal line 17*b*(1) of the pixel row (1), the transistor 11*d* is on and the EL element 15 in the pixel row (1) illuminates.

Since five pixel rows are selected simultaneously (K=5), five driver transistors 11*a* operate. That is, 25/5=5 times larger current flows through the transistor 11*a* per pixel. The total programming current of the five transistors 11*a* flows through the source signal line 18.

In the next 1/2 H period (1/2 of the horizontal scanning period), only the write pixel row 51*a* is selected. That is, only the (2)-th pixel row is selected. As can be seen from FIG. 31, a turn-on voltage (Vgl) is applied only to the gate signal line 17*a*(2) and a turn-off voltage (Vgh) is applied to the gate signal lines 17*a* (3), (4), (5), and (6).

Thus, the transistors 11*a* in the pixel rows (1) and (2) are in operation (the pixel row (1) supplies current to the EL element 15 and the pixel row (2) supplies current to the source signal line 18), but the switching transistors 11*b* and the transistors 11*c* in the pixel rows (3), (4), (5), and (6) are off. That is, they are non-selected.

Besides, since ISEL is high, the current output circuit B which outputs 5 times larger current is selected and the current output circuit B is connected to the source signal line 18. Also, a turn-off voltage (Vgh) is applied to the gate signal line 17*b*, which is in the same state as during the first 1/2 H. Thus, the switching transistors 11*d* in the pixel rows (2), (3), (4), (5), and (6) are off and current does not flow through the EL elements 15 in the corresponding pixel rows. That is, the EL elements 15 are in non-illumination mode 52.

Thus, each transistor 11*a* in the pixel row (1) deliver a current of Iw×5 to the source signal line 18. Then, the capacitor 19 in each pixel row (1) is programmed with a 5 times larger current. The entire screen is drawn as the above operations are performed in sequence.

The drive method described with reference to FIG. 30 selects G pixel rows (G is 2 or larger) in the first period and does programming in such a way as to pass N times larger current through each pixel row. In the second period, the drive method selects B pixel rows (B is smaller than G, but not smaller than 1) and does programming in such a way as to pass an N times larger current through the pixels.

Another scheme is also available. It selects G pixel rows (G is 2 or larger) in the first period and does programming in such a way that the total current in all the pixel rows will be an N times larger current. In the second period, this scheme selects B pixel rows (Bis smaller than G, but not smaller than 1) and does programming in such a way that the total current in the selected pixel rows (the current in the one pixel row if one pixel row is selected) will be an N times larger current. For example, in FIG. 30(*a*1), five pixel rows are selected simultaneously and a twice larger current is passed through the transistor 11*a* in each pixel. Thus, 5×2=10 times larger current flows through the source signal line 18. In the second period, one pixel row is selected in FIG. 30(*b*1). A 10 times larger current is passed through the transistor 11*a* in this pixel.

Incidentally, although a plurality of pixel rows are selected simultaneously in a period of 1/2 H and a single pixel row is selected in a period of 1/2 H in FIG. 31, this is not restrictive. A plurality of pixel rows may be selected simultaneously in a period of 1/4 H and a single pixel row may be selected in a period of 3/4 H. Also, the sum of the period in which a plurality of pixel rows are selected simultaneously and the period in which a single pixel row is selected is not limited to 1 H. For example, the total period may be 2 Hs or 1.5 Hs.

In FIG. 30, it is also possible to select two pixel rows simultaneously in the second period after selecting five pixel rows simultaneously in the first 1/2 H. This can also achieve a practically acceptable image display.

In FIG. 30, pixel rows are selected in two stages—five pixel rows are selected simultaneously in the first 1/2 H period and a single pixel row is selected in the second 1/2 H period, but this is not restrictive. For example, it is also possible to select five pixel rows simultaneously in the first stage, select two of the five pixel rows in the second stage, and finally select one pixel row in the third stage. In short, image data may be written into pixel rows in two or more stages.

In the example described above, pixel rows are selected one by one and programmed with current, or two or more pixel rows are selected at a time and programmed with current. However, the present invention is not limited to this. It is also possible to use a combination of the two methods according to image data: the method of selecting pixel rows one by one and programming them with current and the method of selecting two or more pixel rows at a time and programming them with current.

Now, interlaced driving according to the present invention will be described below. FIG. 133 shows a configuration of the display panel according to the present invention which performs the interlaced driving. In FIG. 133, the gate signal lines 17*a* of odd-numbered pixel rows are connected to a gate driver circuit 12*a*1. The gate signal lines 17*a* of even-numbered pixel rows are connected to a gate driver circuit 12*a*2. On the other hand, the gate signal lines 17*b* of the odd-numbered pixel rows are connected to a gate driver circuit 12*b*1. The gate signal lines 17*b* of the even-numbered pixel rows are connected to a gate driver circuit 12*b*2.

Thus, through operation (control) of the gate driver circuit 12*a*1, image data in the odd-numbered pixel rows are rewritten in sequence. In the odd-numbered pixel rows, illumination and non-illumination of the EL elements are controlled through operation (control) of the gate driver circuit 12*b*1. Also, through operation (control) of the gate driver circuit 12*a*2, image data in the even-numbered pixel rows are rewritten in sequence. In the even-numbered pixel rows, illumination and non-illumination of the EL elements are controlled through operation (control) of the gate driver circuit 12*b*2.

FIG. 134(*a*) shows operating state in the first field of the display panel. FIG. 134(*b*) shows operating state in the second field of the display panel. Incidentally, for ease of understanding, it is assumed that one frame consists of two fields. In FIG. 134, the oblique hatching which marks the gate driver circuits 12 indicates that the gate driver circuits 12 are not taking part in data scanning operation. Specifically, in the first field in FIG. 134(*a*), the gate driver circuit 12*a*1 is operating for write control of programming current and the gate driver circuit 12*b*2 is operating for illumination control of the EL element 15. In the second field in FIG. 134(*b*), the gate driver circuit 12*a*2 is operating for write control of programming current and the gate driver circuit 12*b*1 is operating for illumination control of the EL element 15. The above operations are repeated within the frame.

FIG. 135 shows image display status in the first field. FIG. 135(*a*) illustrates write pixel rows (locations of odd-numbered pixel rows programmed with current (voltage)). The location of the write pixel row is shifted in sequence: FIG. 135(*a*1)→(*a*2) 43 (*a*3). In the first field, odd-numbered pixel rows are rewritten in sequence (image data in the even-numbered pixel rows are maintained). FIG. 135(*b*) illustrates display status of odd-numbered pixel rows. Incidentally, FIG. 135(*b*) illustrates only odd-numbered pixel rows. Even-numbered pixel rows are illustrated in FIG. 135(*c*). As can be seen from FIG. 135(*b*), the EL elements 15 of the pixels in the odd-numbered pixel rows are non-illuminated. On the other hand, the even-numbered pixel rows are scanned in both display area 53 and non-display area 52 as shown in FIG. 135(*c*) (N-fold pulse driving).

FIG. 136 shows image display status in the second field. FIG. 136(*a*) illustrates write pixel rows (locations of odd-numbered pixel rows programmed with current (voltage)). The location of the write pixel row is shifted in sequence: FIG. 136(*a*1)→(*a*2)→(*a*3). In the second field, even-numbered pixel rows are rewritten in sequence (image data in the odd-numbered pixel rows are maintained). FIG. 136(*b*) illustrates display status of odd-numbered pixel rows. Incidentally, FIG. 136(*b*) illustrates only odd-numbered pixel rows. Even-numbered pixel rows are illustrated in FIG. 136(*c*). As can be seen from FIG. 136(*b*), the EL elements 15 of the pixels in the even-numbered pixel rows are non-illuminated. On the other hand, the odd-numbered pixel rows are scanned in both display area 53 and non-display area 52 as shown in FIG. 136(*c*) (N-fold pulse driving).

In this way, interlaced driving can be implemented easily on an EL display panel. Also, N-fold pulse driving eliminates shortages of write current and blurred moving pictures. Besides, current (voltage) programming and illumination of EL elements 15 can be controlled easily and circuits can be implemented easily.

Incidentally, the drive method according to the present invention is not limited to those shown in FIGS. 135 and 136. For example, a drive method shown in FIG. 137 is also available. Whereas in FIGS. 135 and 136, the odd-numbered pixel rows or even-numbered pixel rows being programmed belong to a non-display area 52 (non-illumination or black display), the example in FIG. 137 involves synchronizing the gate driver circuits 12*b*1 and 12*b*2 which control illumination of the EL elements 15. Needless to say, however, the write pixel row 51 being programmed with current (voltage) belongs to a non-display area (there is no need for this in the case of the current-mirror pixel configuration in FIG. 38). In FIG. 137, since illumination control is common to the odd-numbered pixel rows and even-numbered pixel rows, there is no need to provide two gate driver circuits: 12*b*1 and 12*b*2. The gate driver circuit 12*b* alone can perform illumination control.

The drive method in FIG. 137 uses illumination control for both odd-numbered pixel rows and even-numbered pixel rows. However, the present invention is not limited to this. FIG. 138 shows an example in which illumination control varies between odd-numbered pixel rows and even-numbered pixel rows. In FIG. 138, the illumination mode (display area 53 and non-display area 52) of odd-numbered pixel rows and illumination mode of even-numbered pixel rows have opposite patterns. Thus, display area 53 and non-display area 52 have the same size. However, this is not restrictive.

Also, in FIGS. 136 and 135, it is not strictly necessary that all the pixel rows in the odd-numbered pixel rows or even-numbered pixel rows should be non-illuminated.

In the above example, the drive method programs pixel rows with current (voltage) one at a time. However, the drive method according to the present invention is not limited to this. Needless to say, two pixel rows (a plurality of pixel rows) may be programmed with current (voltage) simultaneously as shown in FIG. 139 (see also FIG. 27 and its description) FIG. 139(*a*) shows an example concerning odd-numbered fields while FIG. 139(*b*) shows an example concerning an even-numbered fields. In odd-numbered fields, combinations of two pixel rows (1, 2), (3, 4), (5, 6), (7, 8), (9, 10), (11, 12), . . . , (n, n+1) are selected in sequence and programmed with current (where n is an integer not smaller than 1). In even-numbered fields, combinations of two pixel rows (2, 3), (4, 5), (6, 7), (8, 9), (10, 11), (12, 13), . . . , (n+1, n+2) are selected in sequence and programmed with current (where n is an integer not smaller than 1).

By selecting a plurality of pixel rows in each field and programming them with current, it is possible to increase the current to be passed through the source signal line 18, and thus write black properly. Also, by shifting combinations of pixel rows selected in odd-numbered fields and even-numbered fields at least by one pixel row, it is possible to increase the resolution of images.

Although in the example in FIG. 139, two pixel rows are selected in each field, this is not restrictive and three pixel rows may be selected. In this case, the three pixel rows selected in both odd-numbered fields and even-numbered fields may be shifted by either one pixel row or two pixel rows. Also, four or more pixel rows may be selected in each field. Besides, as shown in FIGS. 125 to 132, one frame may be composed of three or more field.

Also, although in the example in FIG. 139, two pixel rows are selected simultaneously, this is not restrictive. It is possible to divide 1 H into a first 1/2 H and second 1/2 H and perform current programming in odd-numbered fields by selecting the first pixel row in the first 1/2 H of the first 1 H and selecting the second pixel row in the second 1/2 H of the first 1 H, selecting the third pixel row in the first 1/2 H of the second 1 H and selecting the fourth pixel row in the second 1/2 H of the second 1 H, selecting the fifth pixel row in the first 1/2 H of the third 1 H and selecting the sixth pixel row in the second 1/2 H of the third 1 H, and so on.

In even-numbered fields, current programming can be performed by selecting the second pixel row in the first 1/2 H of the first 1 H and selecting the third pixel row in the second 1/2 H of the first 1 H, selecting the fourth pixel row in the first 1/2 H of the second 1 H and selecting the fifth pixel row in the second 1/2 H of the second 1 H, selecting the sixth pixel row in the first 1/2 H of the third 1 H and selecting the seventh pixel row in the second 1/2 H of the third 1 H, and so on.

Again, although in the above example, two pixel rows are selected in each field, this is not restrictive and three pixel rows may be selected. In this case, the three pixel rows selected in both odd-numbered fields and even-numbered fields may be shifted by either one pixel row or two pixel rows. Also, four pixel rows may be selected in each field.

The N-fold pulse driving method according to the present invention uses the same waveform for the gate signal lines 17*b* of different pixel rows and applies current by shifting the pixel rows at 1 H intervals. The use of such scanning makes it possible to shift illuminating pixel rows in sequence with the illumination duration of the EL elements 15 fixed to 1F/N. It is easy to shift pixel rows in this way while using the same waveform for the gate signal lines 17*b* of the pixel rows. It can be done by simply controlling data ST1 and ST2 applied to the shift register circuits 61*a* and 61*b* in FIG. 6. For example, if Vgl is output to the gate signal line 17*b* when input ST1 is low and Vgh is output to the gate signal line 17*b* when input ST1 is high, ST2 applied to the shift register circuit 61*b* can be set low for a period of 1F/N and set high for the remaining period. Then, inputted ST2 can be shifted using a clock CLK2 synchronized with 1 H.

Incidentally, the EL elements 15 must be turned on and off at intervals of 0.5 msec or longer. Short intervals will lead to insufficient black display due to persistence of vision, resulting in blurred images and making it look as if the resolution has lowered. This also represents a display state of a data holding display. However, increasing the on/off intervals to 100 msec will cause flickering. Thus, the on/off intervals of the EL elements must be not shorter than 0.5 msec and not longer than 100 msec. More preferably, the on/off intervals should be from 2 msec to 30 msec (both inclusive). Even more preferably, the on/off intervals should be from 3 msec to 20 msec (both inclusive).

As also described above, an undivided black screen 52 achieves good movie display, but makes flickering of the screen more noticeable. Thus, it is desirable to divide the black insert into multiple parts. However, too many divisions will cause moving pictures to blur. The number of divisions should be from 1 to 8 (both inclusive). More preferably, it should be from 1 to 5 (both inclusive).

Incidentally, it is preferable that the number of divisions of a black screen can be varied between still pictures and moving pictures. When N=4, 75% is occupied by a black screen and 25% is occupied by image display. When the number of divisions is 1, a strip of black display which makes up 75% is scanned vertically. When the number of divisions is 3, three blocks are scanned, where each block consists of a black screen which makes up 25% and a display screen which makes up 25/3 percent. The number of divisions is increased for still pictures and decreased for moving pictures. The switching can be done either automatically according to input images (detection of moving pictures) or manually by the user. Alternatively, the switching can be done according to input content such as video on the display apparatus.

For example, for wallpaper display or an input screen on a cell phone, the number of divisions should be 10 or more (in extreme cases, the display may be turned on and off every 1 H). When displaying moving pictures in NTSC format, the number of divisions should be from 1 to 5 (both inclusive). Preferably, the number of divisions can be switched in three or more steps; for example, 0, 2, 4, 8 divisions, and so on Preferably, the ratio of the black screen to the entire display screen should be from 0.2 to 0.9 (from 1.2 to 9 in terms of N) both inclusive when the area of the entire screen is taken as 1. More preferably, the ratio should be from 0.25 to 0.6 (from 1.25 to 6 in terms of N) both inclusive. If the ratio is 0.20 or less, movie display is not improved much. When the ratio is 0.9 or more, the display part becomes bright and its vertical movements become liable to be recognized visually.

Also, preferably, the number of frames per second is from 10 to 100 (10 Hz to 100 Hz) both inclusive. More preferably, it is from 12 to 65 (12 Hz to 65 Hz) both inclusive. When the number of frames is small, flickering of the screen becomes conspicuous while too large a number of frames makes writing from the source driver circuit 14 and the like difficult, resulting in deterioration of resolution.

Figure 43:
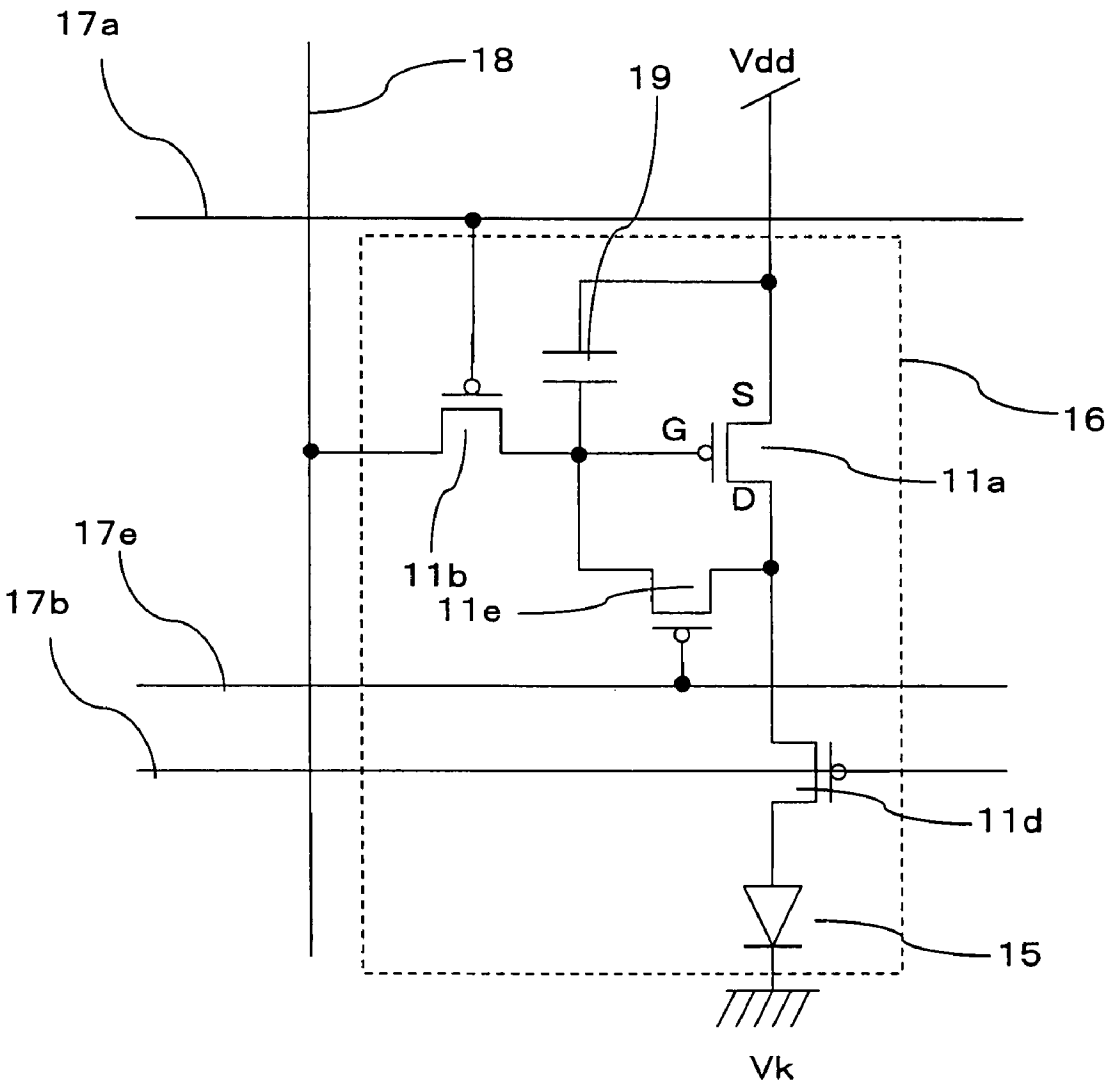
FIG. 43 is a block diagram of a pixel in a display panel according to the present invention.
Figure 51:
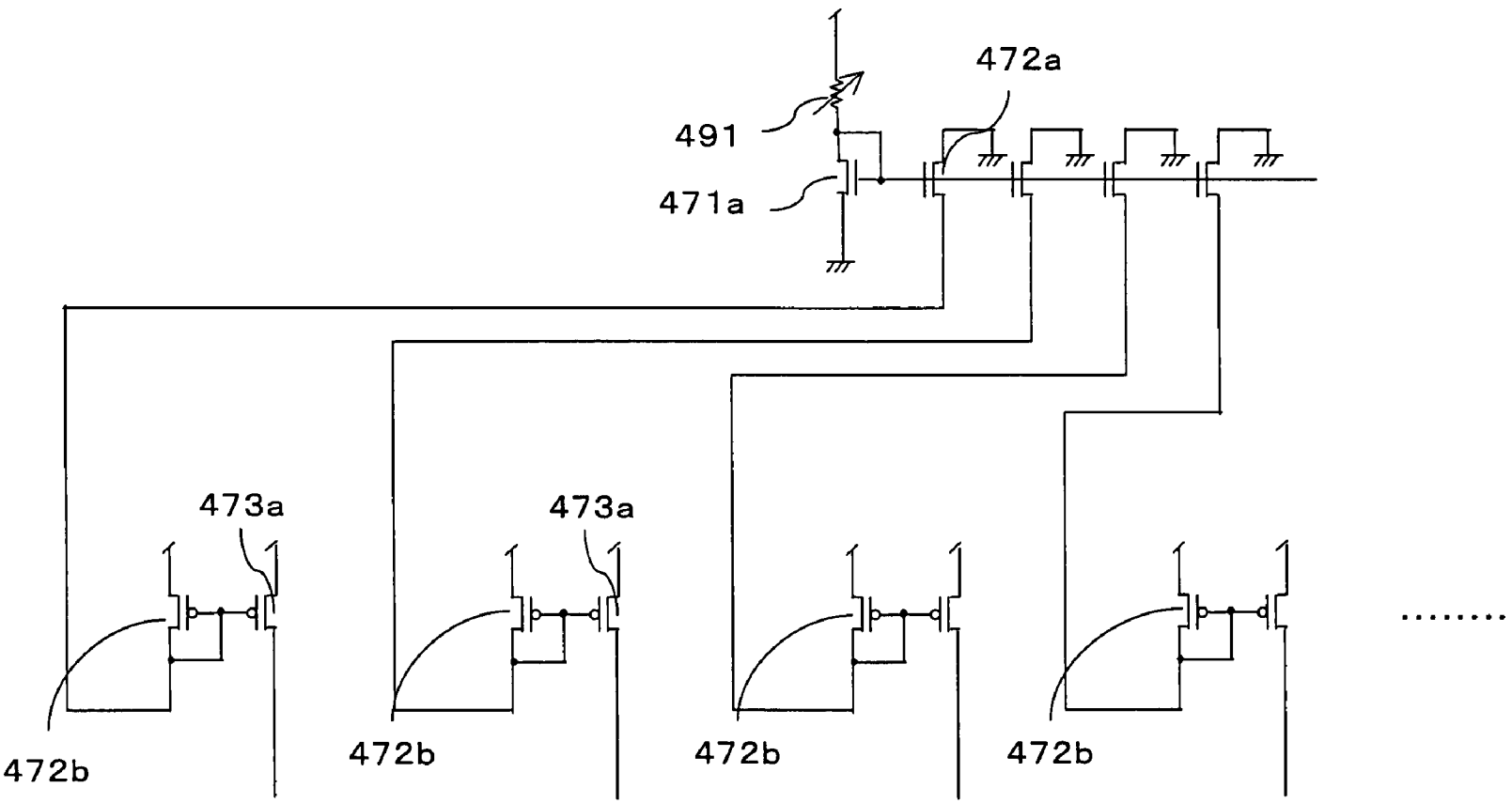
FIG. 51 is an explanatory diagram illustrating a drive circuit according to the present invention.
Figure 54:
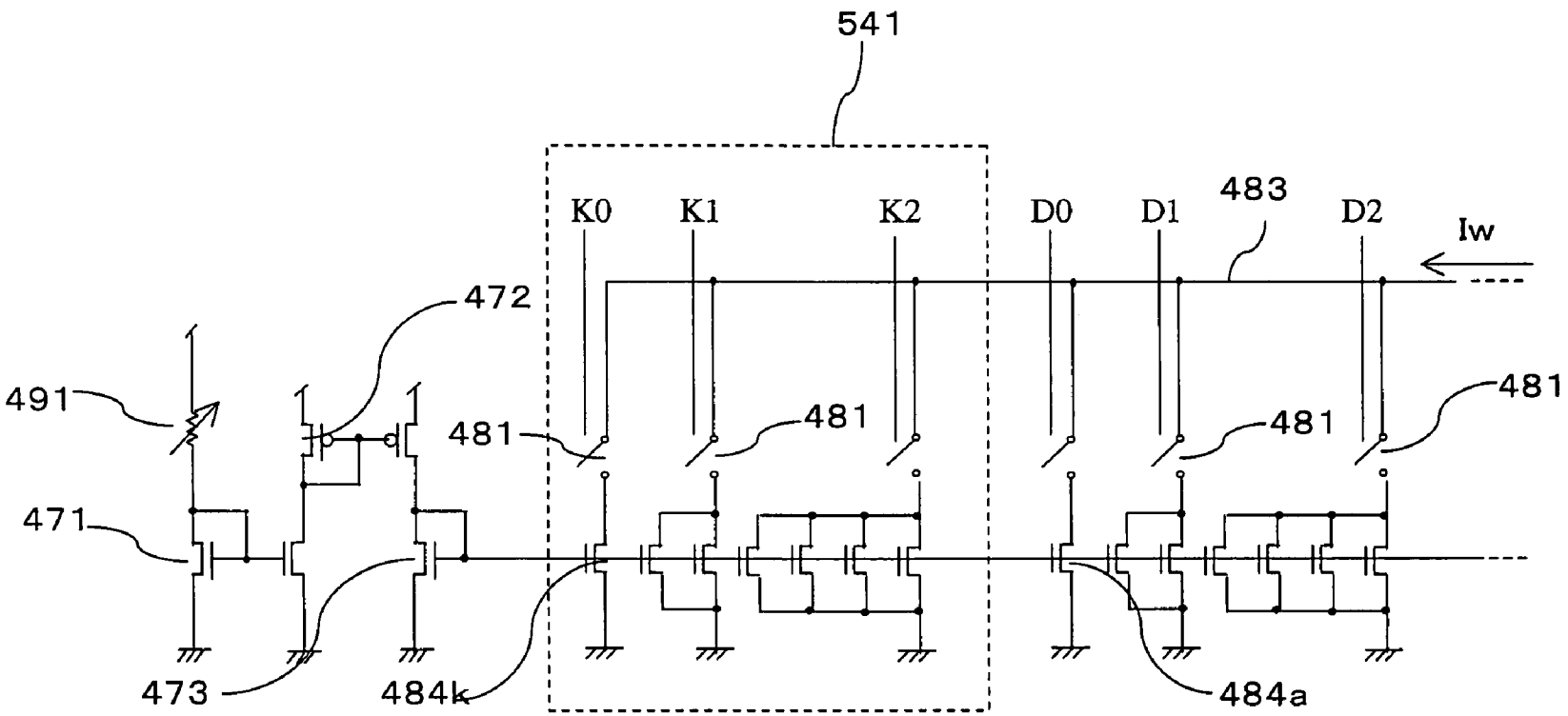
FIG. 54 is an explanatory diagram illustrating a drive circuit according to the present invention.

Needless to say, the above items also apply to the pixel configurations for current programming in FIG. 38 and the like as well as to the pixel configurations for voltage programming in FIGS. 43, 51, 54, and the like. This can be accomplished through on/off control of the transistor 11*d* in FIG. 38, transistor 11*d* in FIG. 43, and transistor 11*e* in FIG. 115. In this way, by turning on and off the wiring which delivers current to the EL elements 15, the N-fold pulse driving according to the present invention can be implemented easily.

Also, the gate signal line 17*b* may be set to Vgl for a period of 1F/N anytime during the period of 1F (not limited to 1F. Any unit time will do). This is because a predetermined brightness is obtained by turning off the EL element 15 for a predetermined period out of a unit time. However, it is preferable to set the gate signal line 17*b* to Vgl and illuminate the EL element 15 immediately after the current programming period (1 H). This will reduce the effect of retention characteristics of the capacitor 19 in FIG. 1.

Also, preferably the number of screen divisions is configured to be variable. For example, when the user presses a brightness adjustment switch or turns a brightness adjustment knob, the value of K may be changed in response. Alternatively, the value of K may be changed manually or automatically depending on images or data to be displayed.

In this way, the mechanism for changing the value of K (the number of divisions of the image display part 53) can be implemented easily. This can be achieved by simply making the time to change ST (when to set ST low during 1F) adjustable or variable.

Incidentally, although it has been stated with reference to FIG. 16 and the like that a period (1F/N) during which the gate signal line 17*b* is set to Vgl is divided into a plurality of parts (K parts) and that a period of 1F/(K·N) during which the gate signal line 17*b* is set to Vgl repeats K times, this is not restrictive. A period of 1F/(KN) may be repeated L (L≠K) times. In other words, the present invention displays the display screen 50 by controlling the period (time) during which current is passed through the EL element 15. Thus, the idea of repeating the 1F/(K·N) period L (L≠K) times is included in the technical idea of the present invention. Also, by varying the value of L, the brightness of the display screen 50 can be changed digitally. For example, there is a 50% change of brightness (contrast) between L=2 and L=3. The control described here is also applicable to other examples of the present invention (of course, it is applicable to what is described later herein). These are also included in the N-fold pulse driving according to the present invention.

The above examples involve placing (forming) the transistor 11*d* serving as a switching element between the EL element 15 and driver transistor 11*a* and turning on and off the screen 50 by controlling the transistor 11*d*. This drive method eliminates shortages of write current in black display condition during current programming and thereby achieves proper resolution or black display. That is, in current programming, it is important to achieve proper black display. The drive method described next achieves proper black display by resetting the driver transistor 11*a*. This example will be described below with reference to FIG. 32.

The pixel configuration in FIG. 32 is basically the same as the one shown in FIG. 1. With the pixel configuration in FIG. 32, a programmed Iw current flows through the EL element 15, illuminating the EL element 15. By being programmed, the driver transistor 11*a* retains a capability to pass current. The drive system shown in FIG. 32 resets (turns off) the transistor 11*a* using this capability to pass current. Hereinafter, this drive system will be referred to as reset driving.

To implement reset driving using the pixel configuration shown in FIG. 1, the transistors 11*b* and 11*c* must be able to be switched on and off independently of each other. Specifically, as illustrated in FIG. 32, it is necessary to be able to independently control the gate signal line 17*a* (gate signal line WR) used for on/off control of the transistor 11*b* and the gate signal line 17*c* (gate signal line EL) used for on/off control of the transistor 11*c*. The gate signal lines 17*a* and 17*c* can be controlled using two independent shift registers 61 as illustrated in FIG. 6.

Preferably, the drive voltage should be varied between the gate signal line 17*a* which drives the transistor 11*b* and the gate signal line 17*b* which drives the transistor 11*d* (when the pixel configuration in FIG. 1 is used). The amplitude value (difference between turn-on voltage and turn-off voltage) of the gate signal line 17*a* should be smaller than the amplitude value of the gate signal line 17*b*.

Too large an amplitude value of the gate signal line 17 will increase penetration voltage between the gate signal line 17 and pixel 16, resulting in an insufficient black level. The amplitude of the gate signal line 17*a* can be controlled by controlling the time when the potential of the source signal line 18 is not applied (or is applied (during selection)) to the pixel 16. Since changes in the potential of the source signal line 18 are small, the amplitude value of the gate signal line 17*a* can be made small.

On the other hand, the gate signal line 17*b* is used for on/off control of EL. Thus, its amplitude value becomes large. For this, output voltage is varied between the shift register circuits 61*a* and 61*b*. If the pixel is constructed of P-channel transistors, approximately equal Vgh (turn-off voltage) is used for the shift register circuits 61*a* and 61*b* while Vgl (turn-on voltage) of the shift register circuit 61*a* is made lower than Vgl (turn-on voltage) of the shift register circuit 61*b*.

Figure 33:
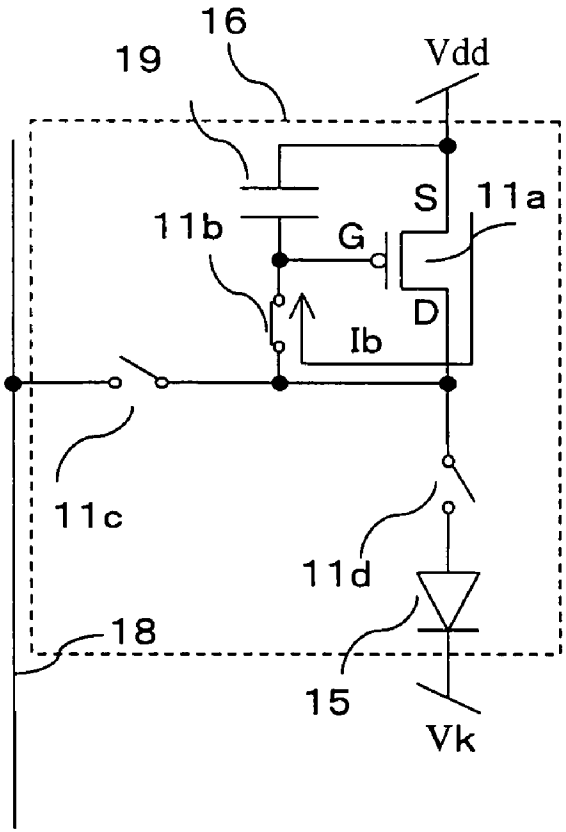
FIG. 33 is an explanatory diagram illustrating a drive method of a display apparatus according to the present invention.
Figure 33:
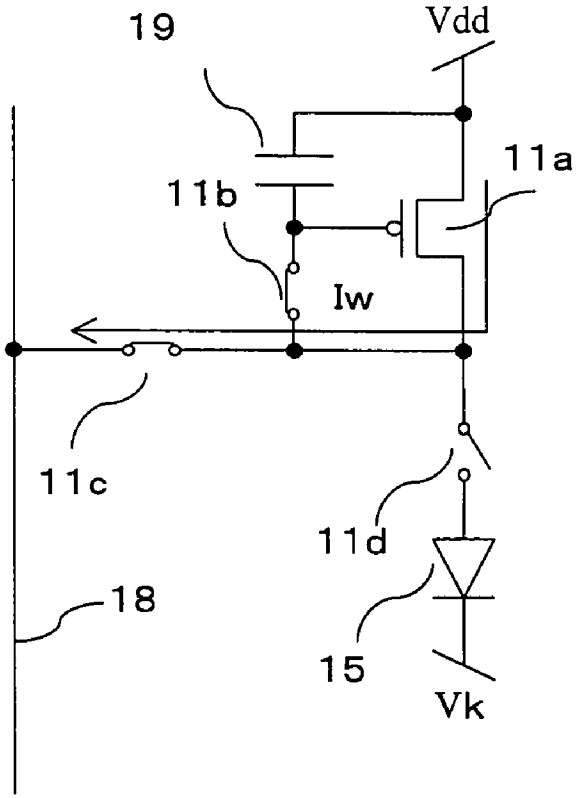
Figure 33:
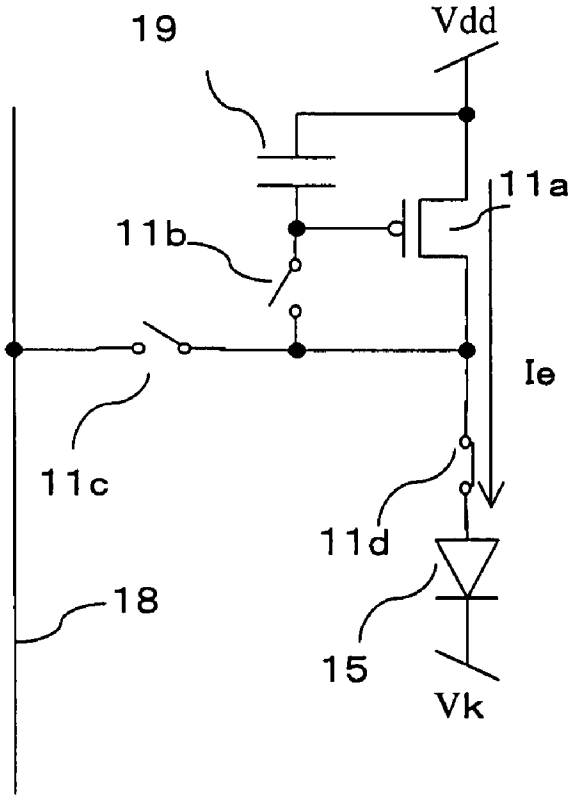

Reset driving will be described below with reference to FIG. 33. FIG. 33 is a diagram illustrating a principle of reset driving. First, as illustrated in FIG. 33(*a*), the transistors 11*c* and 11*d* are turned off and the transistor 11*b* is turned on. As a result, the drain (D) terminal and gate (G) terminal of the driver transistor 11*a* are short-circuited, allowing a current Ib to flow. Generally, the transistor 11*a* has been programmed with current in the previous field (frame). In this state, as the transistor 11*d* is turned off and the transistor 11*b* is turned on, the drive current Ib flows through the gate (G) terminal of the transistor 11*a*. Consequently, the gate (G) terminal and drain (D) terminal of the transistor 11*a* have the same potential, resetting the transistor 11*a* (to a state in which no current flows).

Incidentally, before the operation in FIG. 33(*a*), it is preferable to turn off the transistors 11*b* and 11*c*, turn on the transistor 11*d*, and pass current through the driver transistor 11*a*. Preferably, this operation should be completed in a minimum time. Otherwise, there is a fear that a current will flow through the EL element 15, illuminating the EL element 15, and thereby lowering display contrast. Preferably, the operating time here is from 0.1% to 10% of 1 H (one horizontal scanning period) both inclusive. More preferably, it is from 0.2% to 2% or from 0.2 μsec to 5 μsec (both inclusive). Also, this operation (the operation to be performed before the operation in FIG. 33(*a*)) may be performed on all the pixels 16 of the screen at once. This operation will lower the drain (D) terminal voltage of the driver transistor 11*a*, making it possible to pass the current Ib smoothly in the state shown in FIG. 33(*a*). Incidentally, the above items also apply to other reset driving according to the present invention.

As the operation time of FIG. 33(*a*) becomes longer, a larger Ib current tends to flow, reducing the terminal voltage of the capacitor 19. Thus, the operation time of FIG. 33(*a*) should be fixed. It has been shown experimentally and analytically that preferably the operation time in FIG. 33(*a*) is from 1 H to 5 Hs (both inclusive).

Preferably, this period should be varied among R, G, and B pixels. This is because EL material varies among different colors and rising voltage varies among different EL materials. Optimum periods suitable for EL materials should be specified separately for the R, G, and B pixels. Although it has been stated that the period should be from 1 H to 5 Hs (both inclusive) in this example, it goes without saying that the period may be 5 Hs or longer in the case of a drive system which mainly concerns black insertion (writing of a black screen). Incidentally, the longer the period, the better the black display condition of pixels.

A state shown in FIG. 33(*b*) occurs during a period of 1 H to 5 Hs (both inclusive) after the state in FIG. 33(*a*). FIG. 33(*b*) shows a state in which the transistors 11*c* and 11*b* are on and the transistor 11*d* is off. This is a state in which current programming is being performed, as described earlier. Specifically, a programming current Iw is output (or absorbed) from the source driver circuit 14 and passed through the driver transistor 11*a*. The potential of the gate (G) terminal of the driver transistor 11*a* is set so that the programming current Iw flows (the set potential is held in the capacitor 19).

If the programming current Iw is 0 A, the transistor 11*a* is held in the state in FIG. 33(*a*) in which it does not pass current, and thus a proper black display is achieved. Also, when performing current programming for white display in FIG. 33(*b*), the current programming is started from offset voltage of completely black display even if there are variations in the characteristics of driver transistors in pixels. Thus, the time required to reach a target current value becomes uniform according to gradations. This eliminates gradation errors due to variations in the characteristics of the transistors 11*a*, making it possible to achieve proper image display.

After the programming in FIG. 33(*b*), the transistors 11*b* and 11*c* are turned off in sequence and the transistor 11*d* is turned on to deliver the programming current Iw (=Ie) to the EL element 15 from the driver transistor 11*a*, and thereby illuminate the EL element 15. What is shown in FIG. 33(*c*) has already been described with reference to FIG. 1 and the like, and thus detailed description thereof will be omitted.

The drive system (reset driving) described with reference to FIG. 33 consists of a first operation of disconnecting the driver transistor 11*a* from the EL element 15 (so that no current flows) and shorting between the drain (D) terminal and gate (G) terminal of the driver transistor (or between the source (S) terminal and gate (G) terminal, or generally speaking, between two terminals including the gate (G) terminal of the driver transistor) and a second operation of programming the driver transistor with current (voltage) after the first operation. At least the second operation is performed after the first operation. Incidentally, for reset driving, the transistors 11*b* and 11*c* must be able to be controlled independently as shown in FIG. 32.

In image display mode (if instantaneous changes can be observed), the pixel row to be programmed with current is reset (black display mode) and is programmed with current after 1H (also in black display mode because the transistor 11*d* is off) Next, current is supplied to the EL element 15 and the pixel row illuminates at a predetermined brightness (at the programmed current) That is, the pixel row of black display moves from top to bottom of the screen and it should look as if the image were rewritten at the location where the pixel row passed by.

Incidentally, although it has been stated that current programming is performed 1 H after a reset, this period may be approximately 5 Hs or shorter. This is because it takes a relatively long time for the reset in FIG. 33(*a*) to be completed. If this period is 5 Hs, five pixel rows will be displayed in black (six pixel rows including the pixel row going through current programming).

Also, the number of pixel rows which are reset at a time is not limited to one, and two or more pixel rows may be reset at a time. It is also possible to reset and scan two or more pixel rows at a time by overlapping some of them. For example, if four pixel rows are reset at a time, pixel rows (1), (2), (3), and (4) are reset in the first horizontal scanning period (1 unit), pixel rows (3), (4), (5), and (6) are reset in the second horizontal scanning period, pixel rows (5), (6), (7), and (8) are reset in the third horizontal scanning period, and pixel rows (7), (8), (9), and (10) are reset in the fourth horizontal scanning period. Incidentally the drive operations in FIGS. 33(*b*) and 33(*c*) are naturally carried out in sync with the drive operation in FIG. 33(*a*).

Needless to say, the drive operation in FIGS. 33(*b*) and 33(*c*) may be performed after resetting all the pixels in the screen simultaneously or during scanning. Also, it goes without saying that pixel rows may be reset (at intervals of one or more pixel rows) in interlaced driving mode (scanning at intervals of one or more pixel rows). Also, pixel rows may be reset at random. The reset driving according to the present invention involves operating pixel rows (i.e., controlling the vertical direction of the screen). However, the concept of reset driving does not limit control directions to the pixel row direction. For example, it goes without saying that reset driving may be performed in the direction of pixel columns.

Incidentally, the reset driving in FIG. 33 can achieve better image display if combined with the N-fold pulse driving according to the present invention or with interlaced driving. Particularly, the configuration in FIG. 22 can easily implement intermittent N/K-fold pulse driving (this driving method provides two or more illuminated areas in a screen and can be implemented easily by turning on and off the transistor 11*d* by controlling the gate signal line 17*b*: this has been described earlier), and thus can achieve proper image display without flickering.

Needless to say, more excellent image display can be achieved by combining with precharge driving or the like described later. Thus, it goes without saying that reset driving can be performed in combination with other examples according to the present invention.

Figure 34:
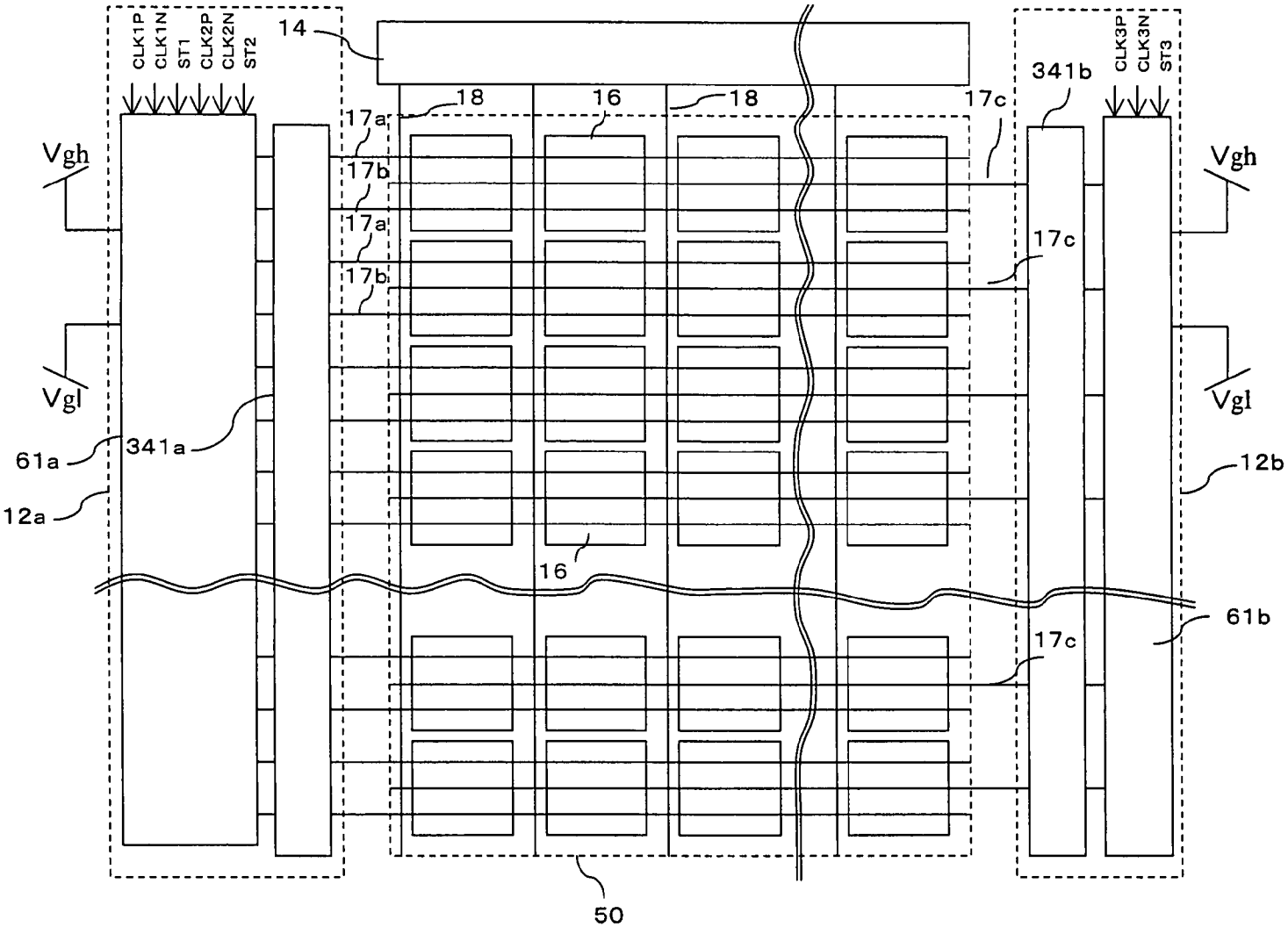
FIG. 34 is a block diagram of a display apparatus according to the present invention.

FIG. 34 is a block diagram of a display apparatus which implement reset driving. The gate driver circuit 12*a* controls the gate signal line 17*a* and gate signal line 17*b* in FIG. 32. By the application of on/off voltages to the gate signal line 17*a*, the transistor 11*b* is turned on and off. Also, by the application of on/off voltages to the gate signal line 17*b*, the transistor 11*d* is turned on and off. The gate driver circuit 12*b* controls the gate signal line 17*c* in FIG. 32. By the application of on/off voltages to the gate signal line 17*c*, the transistor 11*c* is turned on and off.

Thus, the gate signal line 17*a* is controlled by the gate driver circuit 12*a* while the gate signal line 17*c* is controlled by the gate driver circuit 12*b*. This makes it possible to freely specify the time to turn on the transistor 11*b* and reset the driver transistor 11*a* as well as the time to turn on the transistor 11*c* and program the driver transistor 11*a* with current. Other parts of the configuration are the same as or similar to those described earlier, and thus description thereof will be omitted.

Figure 35:
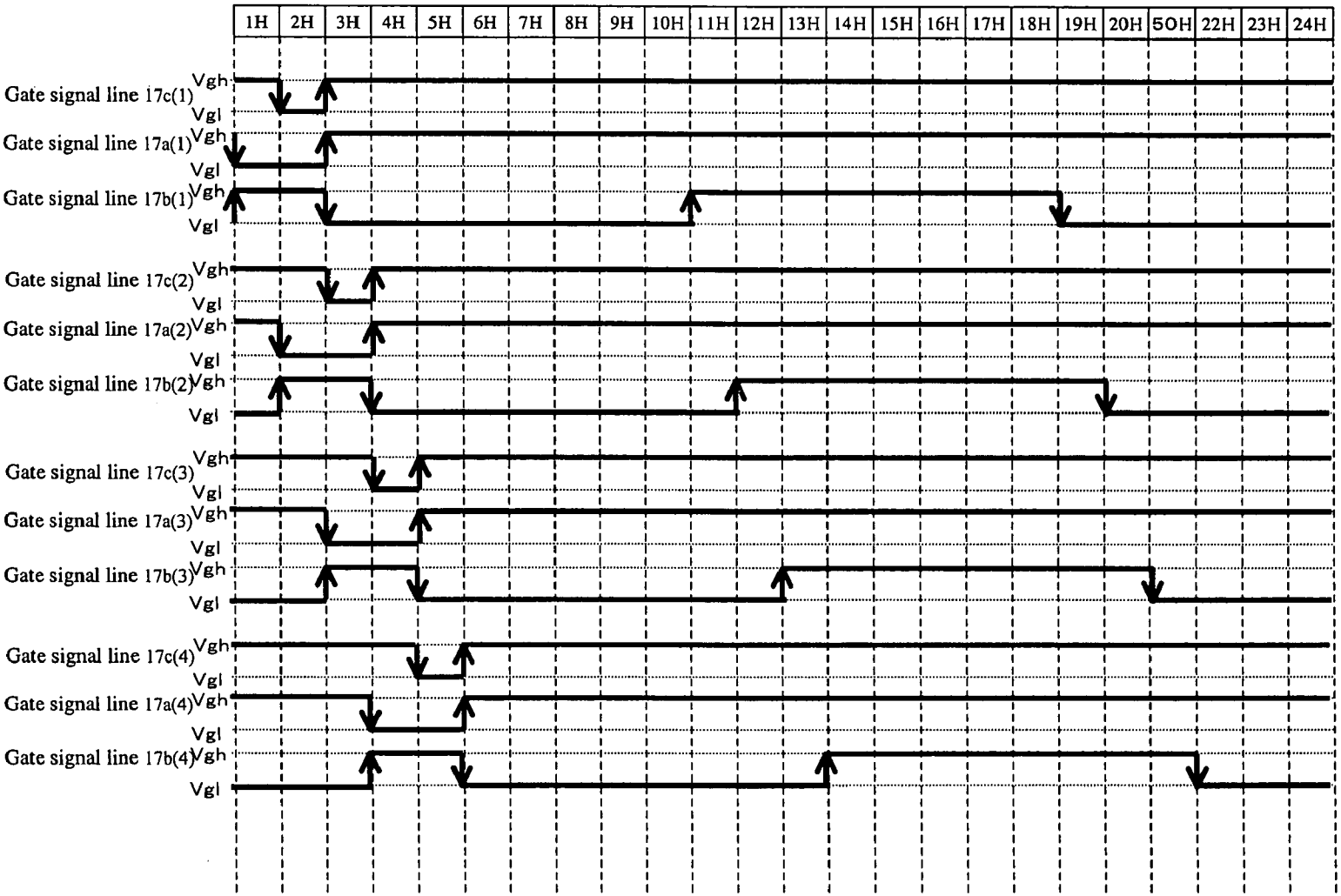
FIG. 35 is an explanatory diagram illustrating a drive method of a display apparatus according to the present invention.

FIG. 35 is a timing chart of reset driving. While a turn-on voltage is applied to the gate signal line 17*a* to turn on the transistor 11*b* and reset the driver transistor 11*a*, a turn-off voltage is applied to the gate signal line 17*b* to keep the transistor 11*d* off. This creates the state shown in FIG. 32(*a*). A current Ib flows during this period.

Although in the timing chart shown in FIG. 35, the reset time is 2 Hs (when a turn-on voltage is applied to the gate signal line 17*a* and the transistor 11*b* is turned on), this is not restrictive. The reset time may be longer than 2 Hs. If a reset can be performed very quickly, the reset time may be less than 1 H.

The duration of the reset period can be changed easily using a DATA (ST) pulse period inputted in the gate driver circuit 12. For example, if DATA inputted in an ST terminal is set high for a period of 2 Hs, the reset period outputted for each gate signal line 17*a* is 2 Hs. Similarly, if DATA inputted in the ST terminal is set high for a period of 5 Hs, the reset period outputted for each gate signal line 17*a* is 5 Hs.

After a reset period of 1 H, a turn-on voltage is applied to the gate signal line 17*c*(1) of the pixel row (1). As the transistor 11*c* turns on, the programming current Iw applied to the source signal line 18 is written into the driver transistor 11*a* via the transistor 11*c*.

After current programming, a turn-off voltage is applied to the gate signal line 17*c* of the pixel row (1), the transistor 11*c* is turned off, and the pixel disconnected from the source signal line. At the same time, a turn-off voltage is also applied to the gate signal line 17*a* and the driver transistor 11*a* exits the reset mode (incidentally, the use of the term "current-programming mode" is more appropriate than the term "reset mode" to refer to this period). On the other hand, a turn-on voltage is applied to the gate signal line 17*b*, the transistor 11*d* is turned on, and the current programmed into the driver transistor 11*a* flows through the EL element 15. What has been said about the pixel row (1) similarly applies to the pixel row (2) and subsequent pixel rows. Also, their operation is obvious from FIG. 35. Thus, description of (2) and subsequent pixel rows will be omitted.

Figure 36:
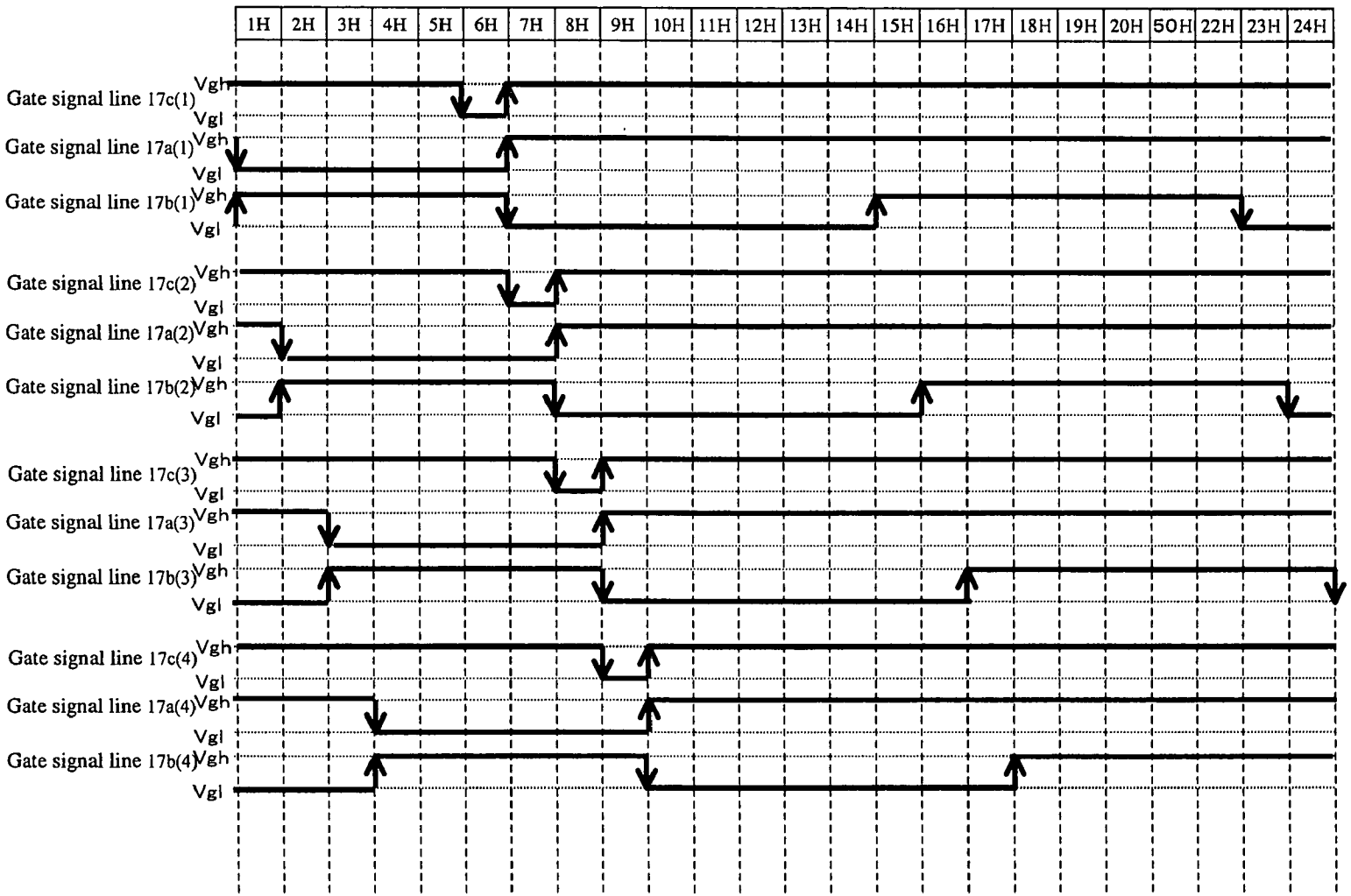
FIG. 36 is an explanatory diagram illustrating a drive method of a display apparatus according to the present invention.

In FIG. 35, the reset period has been 1 H. FIG. 36 shows an example in which the reset period is 5 Hs. The duration of the reset period can be changed easily using the DATA (ST) pulse period inputted in the gate driver circuit 12. FIG. 36 shows an example in which DATA inputted in the ST1 terminal of the gate driver circuit 12*a* is set high for a period of 5 Hs and the reset period outputted for each gate signal line 17*a* is 5 Hs. The longer the reset period, the more completely the reset is performed, resulting in a proper black display. However, display brightness is decreased accordingly.

In FIG. 36, the reset period has been 5 Hs. Besides, the reset mode is continuous. However, the reset mode need not necessarily be continuous. For example, the signal outputted from each gate signal line 17*a* may be turned on and off every 1 H. Such on/off operation can be achieved easily by operating an enable circuit (not shown) formed in the output stage of the shift register or controlling the DATA (ST) pulses inputted in the gate driver circuit 12.

Figure 37:
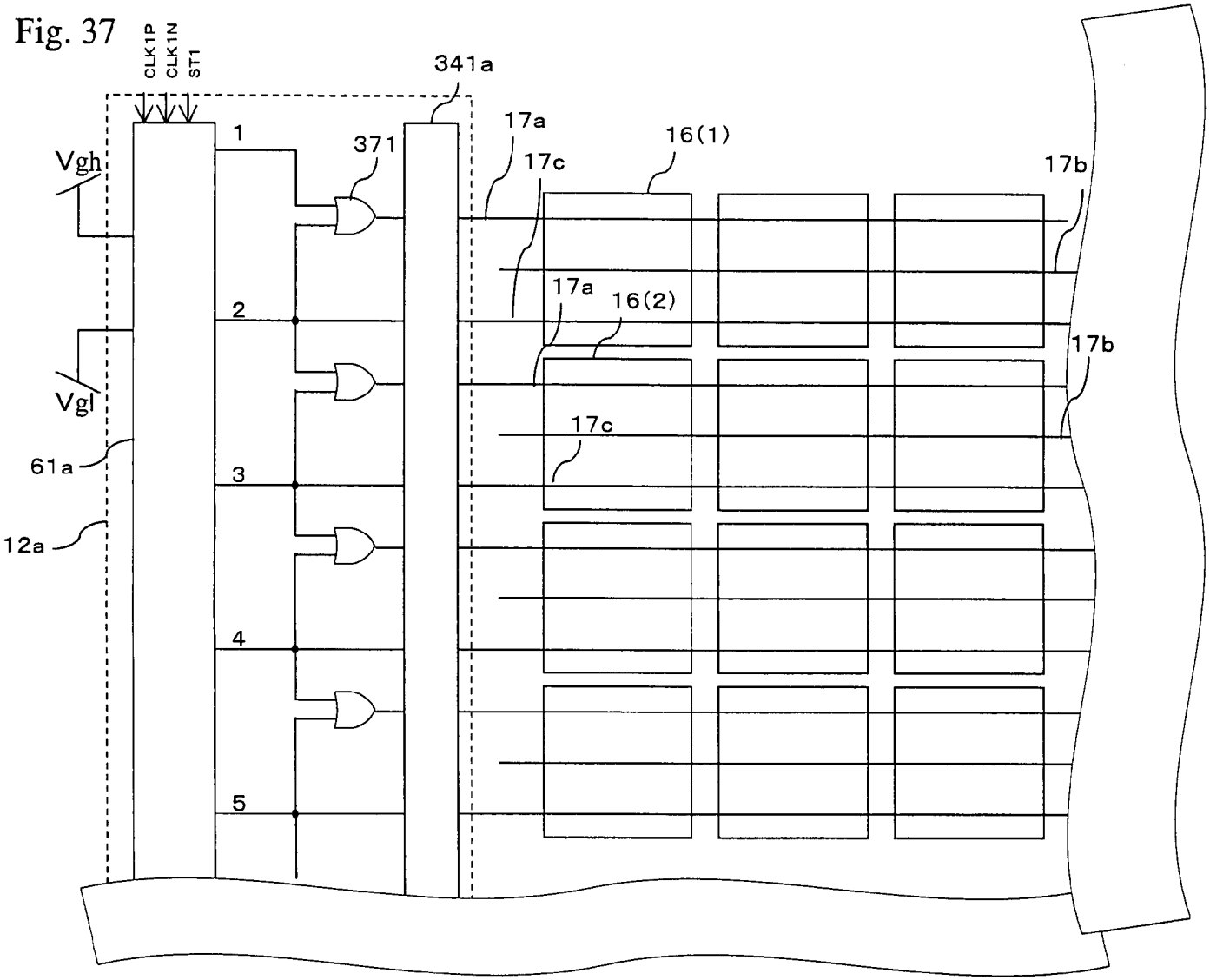
FIG. 37 is a block diagram of a display apparatus according to the present invention.

In the circuit configuration shown in FIG. 34, the gate driver circuit 12*a* requires at least two shift register circuits (one for the gate signal line 17*a*, the other for the gate signal line 17*b*). This presents a problem of an increased circuit scale of the gate driver circuit 12*a*. FIG. 37 shows an example in which the gate driver circuit 12*a* has only one shift register. A timing chart of output signals resulting from operation of the circuit in FIG. 37 is shown in FIG. 35. Note that the gate signal lines 17 coming out of the gate driver circuits 12*a* and 12*b* are denoted by different symbols between FIGS. 35 and 37.

As can be seen from the fact that an OR circuit 371 is included in FIG. 37, the output of each gate signal line 17*a* is ORed with the output from the preceding stage to the shift register circuit 61*a*. That is, the gate signal line 17*a* outputs a turn-on voltage for a period of 2 Hs. On the other hand, the gate signal line 17*c* outputs the output of the shift register circuit 61*a* as it is. Thus, a turn-on voltage is applied for a period of 1 H.

For example, if the shift register circuit 61*a* outputs a high-level signal second, a turn-on voltage is output to the gate signal lines 17*c* of the pixel 16(1), which now is in a state of being programmed with current (voltage). At the same time, a turn-on voltage is also output to the gate signal lines 17*a* of the pixel 16 (2), turning on the transistor 11*b* of the pixel 16(2) and resetting the driver transistor 11*a* of the pixel 16(2).

Similarly, if the shift register circuit 61*a* outputs a high-level signal third, a turn-on voltage is output to the gate signal lines 17*c* of the pixel 16(2), which now is in a state of being programmed with current (voltage). At the same time, a turn-on voltage is also output to the gate signal lines 17*a* of the pixel 16(3), turning on the transistor 11*b* of the pixel 16(3) and resetting the driver transistor 11*a* of the pixel 16(3). Thus, the gate signal lines 17*a* outputs turn-on voltages for a period of 2 Hs, and the gate signal lines 17*c* receive a turn-on voltage for a period of 1 H.

In programming mode, since the transistors 11*b* and 11*c* turn on simultaneously (FIG. 33(*b*)), if the transistor 11*c* turns off before the transistor 11*b* during transition to non-programming mode (FIG. 33(*c*), the reset mode in FIG. 33(*b*) occurs. To prevent this situation, the transistor 11*c* must be turned off after the transistor 11*b*. For that, a turn-on voltage needs to be applied to the gate signal line 17*a* earlier than the gate signal line 17*c*.

Figure 39A:
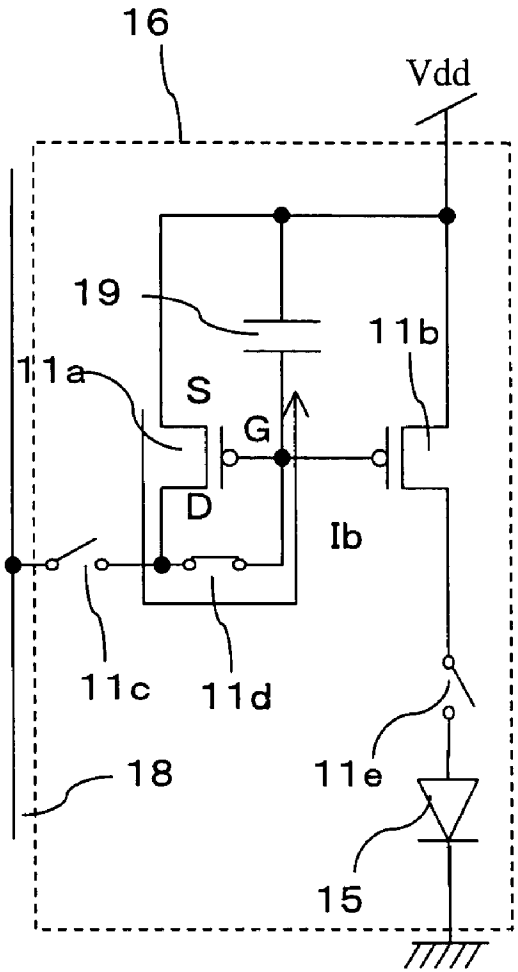
FIG. 39 is an explanatory diagram illustrating a drive method of a display apparatus according to the present invention.
Figure 39B:
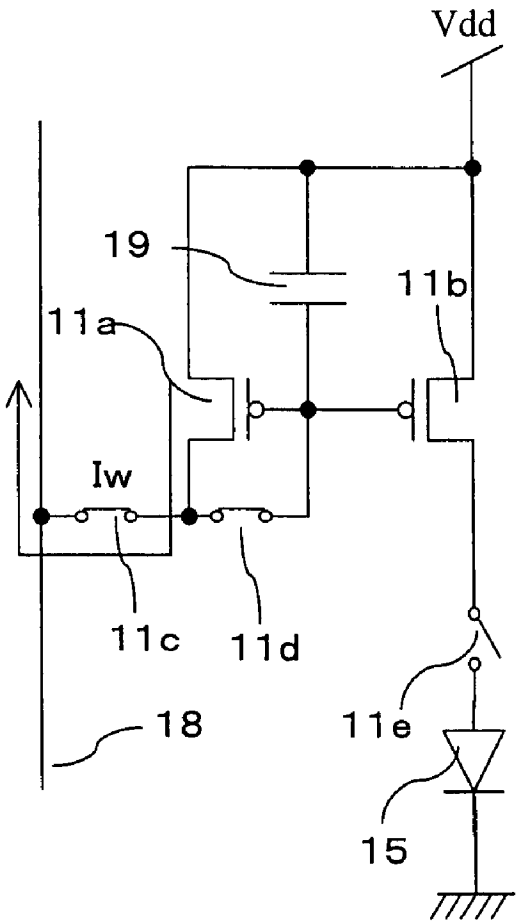
Figure 39C:
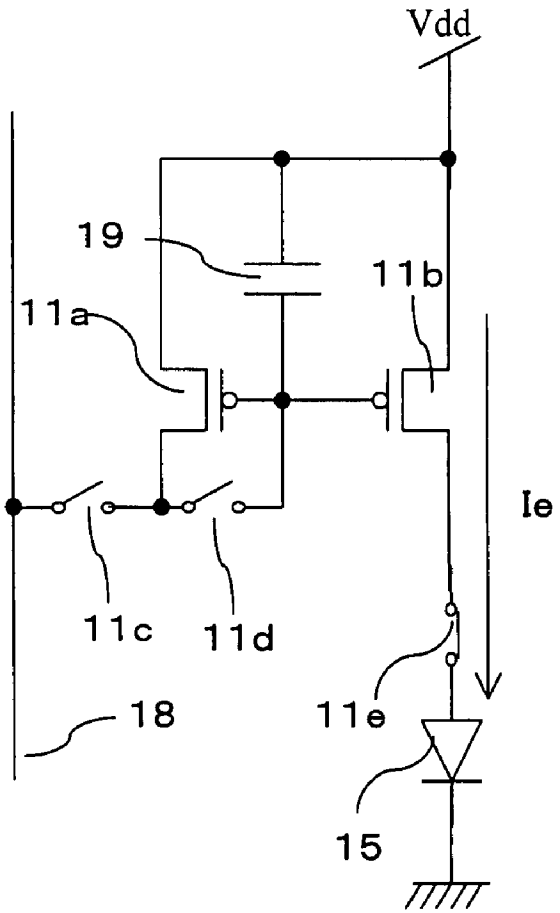

The above example concerns the pixel configuration in FIG. 32 (basically, in FIG. 1). However, the present invention is not limited to this. For example, it is also applicable to current-mirror pixel configurations such as the one shown in FIG. 38. Incidentally, in FIG. 38, by turning on and off the transistor 11*e*, N-fold pulse driving illustrated in FIGS. 13, 15, etc. can be implemented. FIG. 39 is an explanatory diagram illustrating an example employing the current-mirror pixel configuration shown in FIG. 38. Reset driving in the current-mirror pixel configuration will be described below with reference to FIG. 39.

As shown in FIG. 39(*a*), the transistors 11*c* and 11*e* are turned off and the transistor 11*d* is turned on. Then, the drain (D) terminal and gate (G) terminal of the current-programming transistor 11*a* are short-circuited and a current Ib flows between them as shown in the figure. Generally, the transistor 11*b* has been programmed with current in the previous field (frame) and is capable of passing current (this is natural because the gate potential is held in the capacitor 19 for a period of 1F and image is displayed. However, current does not flow during a completely black display). In this state, as the transistor 11*e* is turned off and the transistor 11*d* is turned on, the drive current Ib flows through the gate (G) terminal of the transistor 11*a* (gate (G) terminal and the drain (D) terminal are short-circuited). Consequently, the gate (G) terminal and drain (D) terminal of the transistor 11*a* have the same potential, resetting the transistor 11*a* (to a state in which no current flows). Since the driver transistor 11*b* shares a common gate (G) terminal with the current-programming transistor 11*a*, the driver transistor 11*b* is also reset.

The reset mode (in which no current flows) of the transistors 11*a* and 11*b* is equivalent to a state in which a offset voltage is held in voltage offset canceling mode described with reference to FIG. 51 and the like. That is, in the state in FIG. 39(*a*), the offset voltage is held between the terminals of the capacitor 19 (the offset voltage is a starting voltage at which a current starts to flow: when a voltage equal to or larger than the starting voltage is applied, a current flows through the transistor 11). The offset voltage varies with the characteristics of the transistors 11*a* and 11*b*. Thus, in FIG. 39(*a*), a state in which the transistors 11*a* and 11*b* do not pass current is maintained in the capacitor 19 in each pixel (the transistors 11*a* and 11*b* pass a black display current close to zero, i.e., they have been reset to the starting voltage at which a current starts to flow).

In FIG. 39(*a*), as the reset period becomes longer, a larger Ib current tends to flow, reducing the terminal voltage of the capacitor 19, as in the case of FIG. 33(*a*). Thus, the operation time in FIG. 39(*a*) should be fixed. It has been shown experimentally and analytically that preferably the operation time in FIG. 39(*a*) is from 1 H to 10 Hs (ten horizontal scanning periods) both inclusive. More preferably, it should be from 1 H to 5 Hs or from 20 μsec to 2 msec (both inclusive). This also applies to the drive system in FIG. 33.

As in the case of FIG. 33(*a*), if the reset mode in FIG. 39(*a*) is synchronized with the current-programming mode in FIG. 39(*b*), there is no problem because the period from the reset mode in FIG. 39(*a*) to the current-programming mode in FIG. 39(*b*) is fixed (constant). That is, preferably the period from the reset mode in FIG. 33(*a*) or FIG. 39(*a*) to the current-programming mode in FIG. 33(*b*) or FIG. 39(*b*) should be from 1 H to 10 Hs (ten horizontal scanning periods) both inclusive. More preferably, it should be from 1 H to 5 Hs or from 20 μsec to 2 msec (both inclusive). If this period is short, the driver transistors 11*a* are not reset completely. If it is too long, the driver transistor 11 is turned off completely, which means that much time is required for current programming. Also, the brightness of the screen 50 is decreased.

After the state in FIG. 39(*a*), a state shown in FIG. 39(*b*) occurs. FIG. 39(*b*) shows a state in which the transistors 11*c* and 11*d* are turned on and the transistor 11*e* is turned off. This is a state in which current programming is being performed. Specifically, a programming current Iw is output (absorbed) from the source driver circuit 14 and passed through the current programming transistor 11*a*. The potential of the gate (G) terminal of the driver transistor 11*a* is set in the capacitor 19 so that the programming current Iw will flow.

If the programming current Iw is 0 A (black display) the transistor 11*b* is held in the state in FIG. 39(*a*) in which it does not pass current, and thus proper black display is achieved. Also, when performing current programming for white display in FIG. 39(*b*), the current programming is started from offset voltage of completely black display even if there are variations in the characteristics of driver transistors in pixels (the offset voltage is a starting voltage at which a current specified according to the characteristics of each driver transistor starts to flow). Thus, the time required to reach a target current value becomes uniform according to gradations. This eliminates gradation errors due to variations in the characteristics of the transistor 11*a* or 11*b*, making it possible to achieve proper image display.

After the current programming in FIG. 39(*b*), the transistors 11*c* and 11*d* are turned off in sequence and the transistor 11*e* is turned on to deliver the programming current Iw (=Ie) to the EL element 15 from the driver transistor 11*b*, and thereby illuminate the EL element 15. What is shown in FIG. 39(*c*) has already been described, and thus detailed description thereof will be omitted.

The drive system (reset driving) described with reference to FIGS. 33 and 39 consists of a first operation of disconnecting the driver transistor 11*a* or 11*b* from the EL element 15 (using the transistor 11*e* or 11*d* so that no current flows) and shorting between the drain (D) terminal and gate (G) terminal of the driver transistor (or between the source (S) terminal and gate (G) terminal, or generally speaking, between two terminals including the gate (G) terminal of the driver transistor) and a second operation of programming the driver transistor with current (voltage) after the first operation.

At least the second operation is performed after the first operation. Incidentally, the operation of disconnecting the driver transistor 11*a* or 11*b* from the EL element 15 in the first operation is not absolutely necessary. The drain (D) terminal and gate (G) terminal of the driver transistor are short-circuited in the first operation without disconnecting the driver transistor 11*a* or 11*b* from the EL element 15, nothing more than some variations in reset mode may result. Whether to omit disconnection should be determined by considering the characteristics of the transistors in the constructed array.

The current-mirror pixel configuration in FIG. 39 provides a drive method which resets the current-programming transistor 11*a*, and consequently resets the driver transistor 11*b*.

With the current-mirror pixel configuration in FIG. 39, it is not always necessary to disconnect the driver transistor 11*b* from the EL element 15 in reset mode. Thus, the following operations are performed: a first operation of shorting between the drain (D) terminal and gate (G) terminal of the current-programming transistor a (or between the source (S) terminal and gate (G) terminal, or generally speaking, between two terminals including the gate (G) terminal of the current-programming transistor or between two terminals including the gate (G) terminal of the driver transistor) and a second operation of programming the current-programming transistor with current (voltage) after the first operation. At least the second operation is performed after the first operation.

In image display mode (if instantaneous changes can be observed), the pixel row to be programmed with current is reset (black display mode) and is programmed with current after a predetermined H. The pixel row of black display moves from top to bottom of the screen and it should look as if the image were rewritten at the location where the pixel row passed by.

Although the above example has been described mainly in relation to pixel configuration for current programming, the reset driving according to the present invention can also be applied to pixel configuration for voltage programming. FIG. 43 is an explanatory diagram illustrating a pixel configuration (panel configuration) according to the present invention used to perform reset driving in a pixel configuration for voltage programming.

In the configuration shown in FIG. 43, a transistor 11*e* which resets a driver transistor 11*a* has been formed. When a turn-on voltage is applied to a gate signal line 17*e*, the transistor 11*e* turns on, causing a short circuit between the gate (G) terminal and drain (D) terminal of the driver transistor 11*a*. Also a transistor 11*d* which cuts off a current path between the EL element 15 and driver transistor 11*a* has been formed. The reset driving according to the present invention in a pixel configuration for voltage programming will be described below with reference to FIG. 44.

Figure 44A:
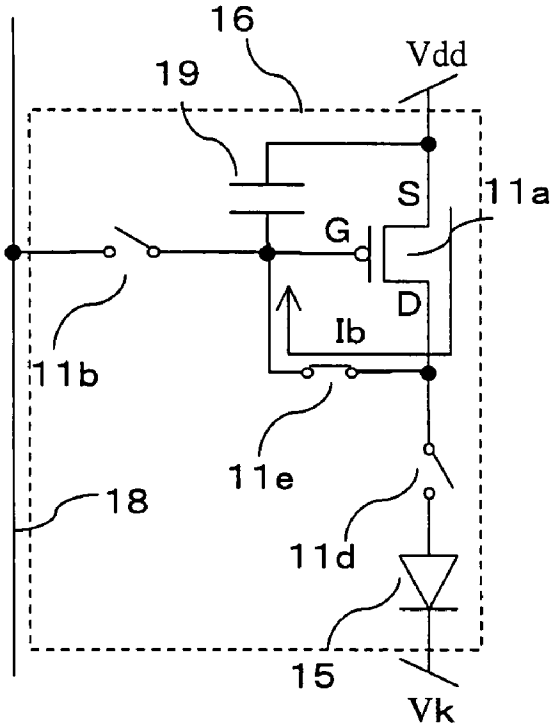
FIG. 44 is an explanatory diagram illustrating a drive method of a display apparatus according to the present invention.
Figure 44B:
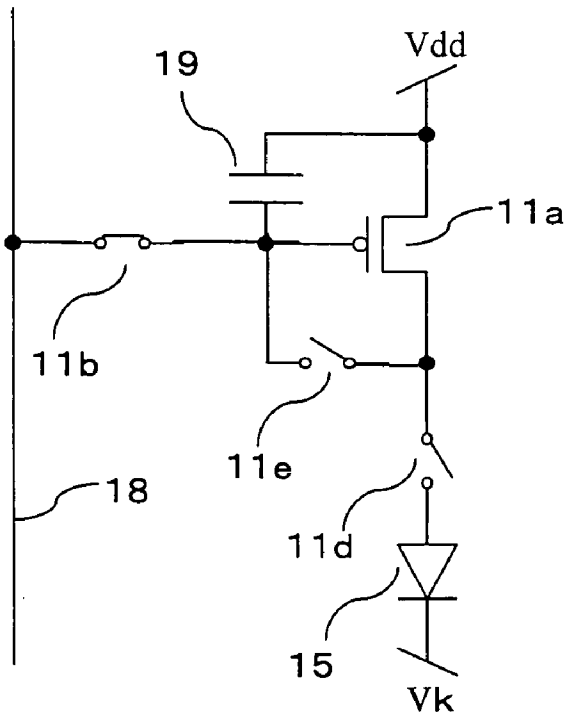
Figure 44C:
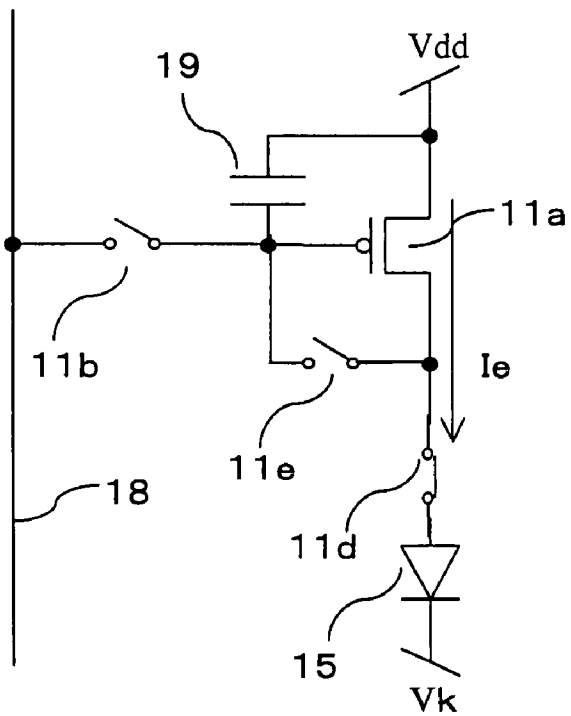

As illustrated in FIG. 44(*a*), the transistors 11*b* and 11*d* are turned off and the transistor 11*e* is turned on. The drain (D) terminal and gate (G) terminal of the driver transistor 11*a* are short-circuited and a current Ib flows as shown in the figure. Consequently, the gate (G) terminal and drain (D) terminal of the transistor 11*a* have the same potential, resetting the transistor 11*a* (to a state in which no current flows). Before resetting the transistor 11*a*, the transistor 11*d* is turned on, the transistor 11*e* is turned off, and current is passed through the transistor 11*a* in sync with an HD synchronization signal as described with reference to FIG. 33 or 39. Then the operation shown in FIG. 44(*a*) is performed.

Incidentally, in the pixel configuration for voltage programming, as the reset period becomes longer, a larger Ib current tends to flow, reducing the terminal voltage of the capacitor 19, as in the case of pixel configuration for current programming. Thus, the operation time in FIG. 44(*a*) should be fixed. Preferably, the operation time should be from 0.2 H to 5 Hs (five horizontal scanning periods) both inclusive. More preferably, it should be from 0.5 H to 4 Hs or from 2 μsec to 400 μsec (both inclusive).

Besides, it is preferable that the gate signal line 17*e* should be shared with the gate signal line 17*a* in a preceding stage. That is the gate signal line 17*e* should be shorted to the gate signal line 17*a* in the pixel row in the preceding stage. This configuration is referred to as a preceding-stage gate control system. Incidentally, the stage-stage gate control system uses waveforms of gate signal lines of a pixel row selected one or more Hs before the pixel row of interest. Thus, this system is not limited to the previous pixel row. For example, the driver transistor 11*a* of the pixel row of interest may be reset using the waveforms of gate signal lines two pixel rows ahead.

The stage-stage gate control system will be described more concretely. Suppose, the pixel row of interest is the (N)-th pixel row whose gate signal lines are 17*e*(N) and 17*a*(N) The preceding pixel row selected 1 H before is assumed to be the (N−1)-th pixel row whose gate signal lines are 17*e*(N−1) and 17*a* (N−1). The pixel row selected 1 H after the pixel row of interest is assumed to be the (N+1)-th pixel row whose gate signal lines are 17*e*(N+1) and 17*a*(N+1).

In the (N−1)-th H-period, as a turn-on voltage is applied to the gate signal line 17*a*(N−1) of the (N−1)-th pixel row, a turn-on voltage is also applied to the gate signal line 17*e*(N) of the (N)-th pixel row. This is because the gate signal line 17*e* (N) and the gate signal line 17*a* (N−1) of the pixel row in the preceding stage are shorted. Consequently, the pixel transistor 11*b*(N−1) in the (N−1)-th pixel row is turned on and the voltage applied to the source signal line 18 is written into the gate (G) terminal of the driver transistor 11*a* (N−1). At the same time, the pixel transistor 11*e* (N) in the (N)-th pixel row is turned on, the gate (G) terminal and drain (D) terminal of the driver transistor 11*a*(N) are shorted, and the driver transistor 11*a*(N) is reset.

In the (N)-th H-period which follows the (N−1)-th H-period, as a turn-on voltage is applied to the gate signal line 17*a*(N) of the (N)-th pixel row, a turn-on voltage is also applied to the gate signal line 17*e*(N+1) of the (N+1)-th pixel row. Consequently, the pixel transistor 11*b* (N) in the (N)-th pixel row is turned on and the voltage applied to the source signal line 18 is written into the gate (G) terminal of the driver transistor 11*a* (N). At the same time, the pixel transistor 11*e*(N+1) in the (N+1)-th pixel row is turned on, the gate (G) terminal and drain (D) terminal of the driver transistor 11*a* (N+1) are shorted, and the driver transistor 11*a*(N+1) is reset.

Similarly, in the (N+1)-th period which follows the (N)-th H-period, as a turn-on voltage is applied to the gate signal line 17*a* (N+1) of the (N+1)-th pixel row, a turn-on voltage is also applied to the gate signal line 17*e*(N+2) of the (N+2)-th pixel row. Consequently, the pixel transistor 11*b*(N+1) in the (N+1)-th pixel row is turned on and the voltage applied to the source signal line 18 is written into the gate (G) terminal of the driver transistor 11*a*(N+1). At the same time, the pixel transistor 11*e*(N+2) in the (N+2)-th pixel row is turned on, the gate (G) terminal and drain (D) terminal of the driver transistor 11*a* (N+2) are shorted, and the driver transistor 11*a*(N+2) is reset.

According to the above-described stage-stage gate control system of the present invention, the driver transistor 11*a* is reset for a period of 1 H, and then voltage (current) programming is performed.

As in the case of FIG. 33(*a*), if the reset mode in FIG. 44(*a*) is synchronized with the voltage-programming mode in FIG. 44(*b*), there is no problem because the period from the reset mode in FIG. 44(*a*) to the current-programming mode in FIG. 44(*b*) is fixed (constant). If this period is short, the driver transistors 11 are not reset completely. If it is too long, the driver transistor 11*a* is turned off completely, which means that much time is required for current programming. Also, the brightness of the screen 50 is decreased.

After the state in FIG. 44(*a*), a state shown in FIG. 44(*b*) occurs. FIG. 44(*b*) shows a state in which the transistor 11*b* is turned on and the transistors 11*e* and 11*d* are turned off. This state in FIG. 44(*b*), is a state in which voltage programming is being performed. Specifically, a programming voltage is output from the source driver circuit 14 and written into the gate (G) terminal of the driver transistor 11*a* (the potential of the gate (G) terminal of the driver transistor 11*a* is set in the capacitor 19). Incidentally, in the case of voltage programming, it is not always necessary to turn off the transistor 11*d* during voltage programming. Besides, the transistor 11*e* is not necessary if there is no need to combine with the N-fold driving shown in FIG. 13, 15, or the like or perform intermittent N/K-fold pulse driving (this driving method provides two or more illuminated areas in a screen and can be implemented easily by turning on and off the transistor 11*e*). Since this has been described earlier, description thereof will be omitted.

When performing voltage programming for white display using the configuration shown in FIG. 43 or drive method shown in FIG. 44, the voltage programming is started from offset voltage of completely black display even if there are variations in the characteristics of driver transistors in pixels (the offset voltage is a starting voltage at which a current specified according to the characteristics of each driver transistor starts to flow). Thus, the time required to reach a target current value becomes uniform according to gradations. This eliminates gradation errors due to variations in the characteristics of the transistor 11*a*, making it possible to achieve proper image display.

After the voltage programming in FIG. 44(*b*), the transistor 11*d* is turned off and the transistor 11*d* is turned on to deliver the programming current to the EL element 15 from the driver transistor 11*a*, and thereby illuminate the EL element 15, as shown in FIG. 44(*c*).

As described above, the reset driving according to the present invention using the voltage programming shown in FIG. 43 consists of a first operation of turning on the transistor 11*d*, turning off the transistor 11*e*, and passing current through the transistor 11*a* in sync with the HD synchronization signal; a second operation of disconnecting the transistor 11*a* from the EL element 15 and shorting between the drain (D) terminal and gate (G) terminal of the driver transistor 11*a* (or between the source (S) terminal and gate (G) terminal, or generally speaking, between two terminals including the gate (G) terminal of the driver transistor); and a third operation of programming the driver transistor 11*a* with voltage after the above operations.

In the above example, the transistor 11*d* is turned on and off to control the current delivered from the driver transistor 11*a* (in the case of configuration shown in FIG. 1) to the EL element 15. To turn on and off the transistor 11*d*, the gate signal line 17*b* needs to be scanned, for which the shift register circuit 61 (the gate driver circuit 12) is required. However, shift register circuits 61 are large in scale and the use of a shift register circuit 61 for the gate signal line 17*b* makes it impossible to reduce bezel width. A system described with reference to FIG. 40 solves this problem.

Incidentally, although the pixel configuration for current programming illustrated in FIG. 1 and the like is mainly described herein by way of examples, the present invention is not limited to this and it goes without saying that the present invention can also be applied to other configuration for current programming (current-mirror pixel configuration) described with reference to FIG. 38 and the like. Also, the technical concept of turning on and off elements as a block can also be applied to the pixel configuration for voltage programming in FIG. 41 and the like.

Figure 40:
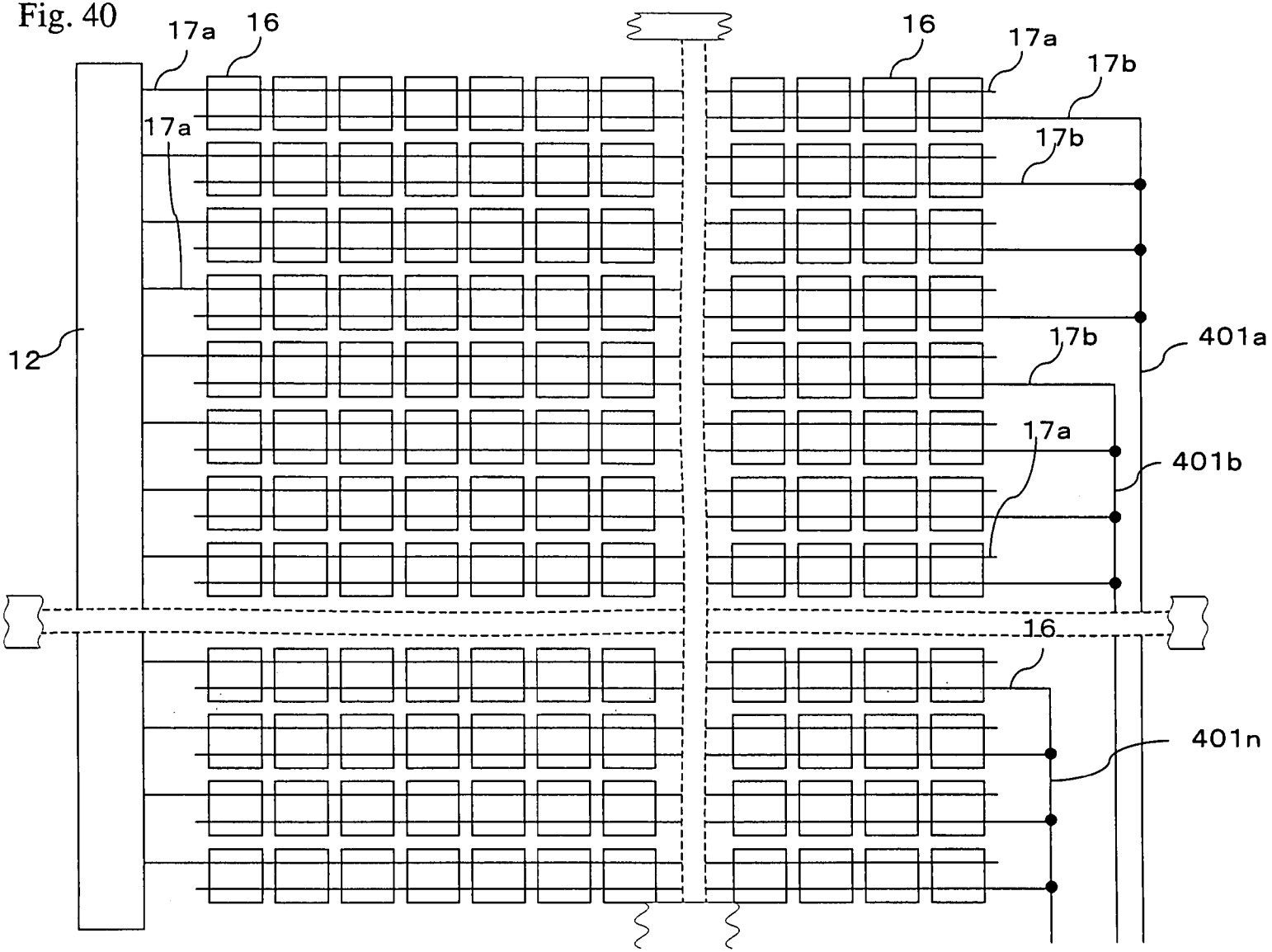
FIG. 40 is a block diagram of a display apparatus according to the present invention.

FIG. 40 shows an example of a block driving system. For ease of understanding, it is assumed that a gate driver circuit 12 is formed directly on an array board 71 or that a silicon chip, gate driver IC 12, is mounted on an array board 71. Source driver circuits 14 and source signal lines 18 are omitted to avoid complicating the drawing.

In FIG. 40, gate signal lines 17*a* are connected to the gate driver circuit 12. On the other hand, gate signal lines 17*b* are connected to illumination control lines 4*b*1. In FIG. 40, four gate signal lines 17*b* are connected to one illumination control line 401.

Incidentally, although four gate signal lines 17*b* are grouped into a block here, this is not restrictive and it goes without saying that more than four gate signal lines 17*b* may be grouped into a block. Generally, it is preferable to divide the screen 50 into five or more parts. More preferably, the screen 50 should be divided into ten or more parts. Even more preferably, the screen 50 should be divided into twenty or more parts. A small number of divisions will make flickering conspicuous. Too large a number of divisions will increase the number of illumination control lines 401, making it difficult to lay out the illumination control lines 401.

Thus, in the case of a QCIF display panel, which has 220 vertical scanning lines, at least 220/5=44 or more lines should be grouped into a block. More preferably, 220/10=22 or more lines should be grouped into a block. However, if odd-numbered rows and even-numbered rows are grouped into two different blocks, there is not much flickering even at a low frame rate, and thus the two blocks are sufficient.

In the example shown in FIG. 40, the current flowing through the EL elements 15 are turned on and off on a block-by-block basis by the application of either a turn-on voltage (Vgl) or turn-off voltage (Vgh) to illumination control lines 401*a*, 401*b*, 401*c*, 401*d*, . . . , 401*n* in sequence.

Incidentally, in the example in FIG. 40, the gate signal lines 17*b* do not intersect the illumination control lines 401. Thus, there can be no defect in which a gate signal line 17*b* would become short-circuited with an illumination control line 401. Also, since there is no capacitive coupling between gate signal lines 17*b* and illumination control lines 401, capacitive load of capacitance is very small when the gate signal lines 17*b* are viewed from the illumination control lines 401. This makes it easy to drive the illumination control lines 401.

The gate driver circuit 12 is connected with the gate signal lines 17*a*. When a turn-on voltage is applied to gate signal lines 17*a*, the appropriate pixel rows are selected and the transistors 11*b* and 11*c* in the selected pixel rows are turned on. Then, currents (voltage) applied to the source signal lines 18 are programmed into the capacitors 19 in the pixels. On the other hand, the gate signal lines 17*b* are connected with the gate (G) terminals of the transistors 11*d* in the pixels. Thus, when a turn-on voltage (Vgl) is applied to the illumination control lines 401, current paths are formed between the driver transistors 11*a* and EL elements 15. When a turn-off voltage (Vgh) is applied, the anode terminals of the EL elements 15 are opened.

Preferably, control timing of turn-on/turn-off voltages applied to the illumination control lines 401 and a pixel row selection voltage (Vgl) outputted to the gate signal lines 17*a* by the gate driver circuit 12 are synchronized with one horizontal scanning clock (1 H). However, this is not restrictive.

The signals applied to the illumination control lines 401 simply turn on and off the current delivered to the EL elements 15. They do not need to be synchronized with image data outputted from the source driver circuits 14. This is because the signals applied to the illumination control lines 401 are intended to control the current programmed into the capacitors 19 in the pixels 16. Thus, they do not always need to be synchronized with the pixel row selection signal. Even when they are synchronized, the clock is not limited to a 1-H signal and may be a 1/2-H or 1/4-H signal.

Even in the case of the current-mirror pixel configuration shown in FIG. 38, the transistors 11*e* can be turned on and off if the gate signal lines 17*b* are connected to the illumination control lines 401. Thus, block driving can be implemented.

Incidentally, in FIG. 32, by connecting the gate signal lines 17*a* to the illumination control lines 401 and performing resets, it is possible to implement block driving. In other words, the block driving according to the present invention is a drive method which puts a plurality of pixel rows in non-illumination (black display) mode simultaneously using one control line.

In the above example, one selection gate signal line is placed (formed) per pixel row. The present invention is not limited to this and a selection gate signal line may be placed (formed) for two or more pixel rows.

Figure 41:
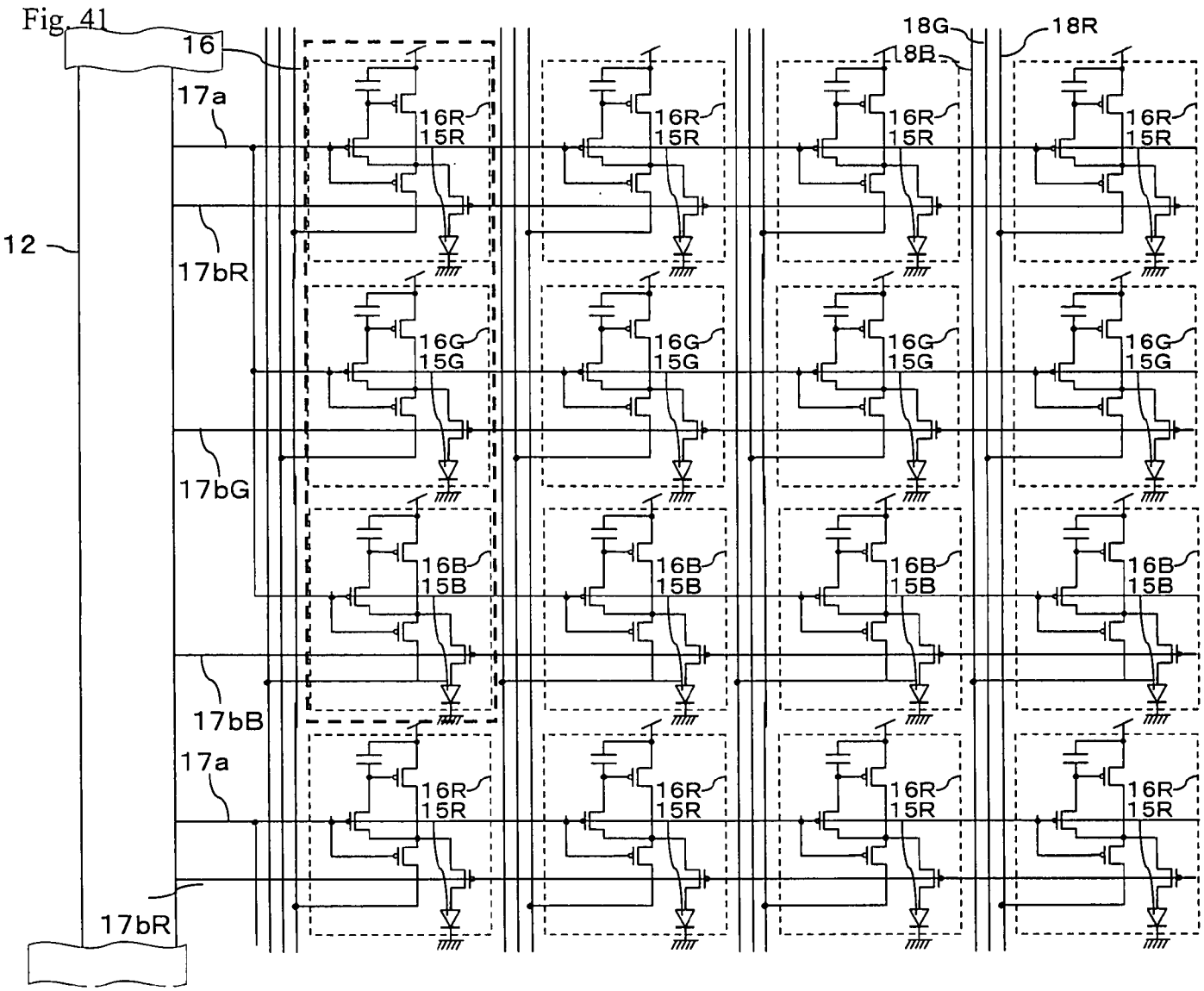
FIG. 41 is a block diagram of a display apparatus according to the present invention.

FIG. 41 shows such an example. Incidentally, for ease of explanation, the pixel configuration in FIG. 1 is employed mainly. In FIG. 41, the gate signal line 17*a* for pixel row selection selects three pixels (16R, 16G, and 16B) simultaneously. Reference character R is intended to indicate something related to a red pixel, reference character G indicates something related to a green pixel, and reference character B indicates something related to a blue pixel.

Thus, when the gate signal line 17*a* is selected, the pixels 16R, 16G, and 16B are selected and get ready to write data. The pixel 16R writes data into a capacitor 19R via a source signal line 18R, the pixel 16G writes data into a capacitor 19G via a source signal line 18G, and the pixel 16B writes data into a capacitor 19B via a source signal line 18B.

The transistor 11*d* of the pixel 16R is connected to a gate signal line 17*b*R, the transistor 11*d* of the pixel 16G is connected to a gate signal line 17*b*G, and the transistor 11*d* of the pixel 16B is connected to a gate signal line 17*b*B. Thus, an EL element 15R of the pixel 16R, EL element 15G of the pixel 16G, and EL element 15B of the pixel 16B can be turned on and off separately. Illumination times and illumination periods of the EL element 15R, EL element 15G, and EL element 15B can be controlled separately by controlling the gate signal line 17*b*R, gate signal line 17*b*G, and gate signal line 17*b*B.

To implement this operation, in the configuration in FIG. 6, it is appropriate to form (place) four shift register circuits: a shift register circuit 61 which scans the gate signal line 17*a*, shift register circuit 61 which scans the gate signal line 17*b*R, shift register circuit 61 which scans the gate signal line 17*b*G, and shift register circuit 61 which scans the gate signal line 17*b*B.

Incidentally, although it has been stated that a current N times larger than a predetermined current is passed through the source signal line 18 and that a current N times larger than a predetermined current is passed through the EL element 15 for a period of 1/N, this cannot be implemented in practice. Actually, signal pulses applied to the gate signal line 17 penetrate into the capacitor 19, making it impossible to set a desired voltage value (current value) on the capacitor 19. Generally, a voltage value (current value) lower than a desired voltage value (current value) is set on the capacitor 19. For example, even if 10 times larger current value is meant to be set, only approximately 5 times larger current value is set on the capacitor 19. For example, even if N=10 is specified, N=5 times larger current actually flows through the EL element 15. Thus, this method sets an N times larger current value to pass a current proportional or corresponding to the N-fold value through the EL element 15. Alternatively, this drive method applies a current larger than a desired value to the EL element 15 in a pulsed manner.

This method performs current (voltage) programming so as to obtain desired emission brightness of the EL element by passing a current larger than a desired value intermittently through the driver transistor 11*a* (in the case of FIG. 1) (i.e., a current which will give brightness higher than the desired brightness if passed through the EL element 15 continuously).

Preferably, N-channel transistors are used as the switching transistors 11*b* and 11*c*, etc. in FIG. 1 and the like. This will reduce penetration voltage reaching the capacitor 19. Also, since off-leakage of the capacitor 19 is reduced, this method can be applied to a 10-Hz or lower frame rate.

Depending on pixel configuration, if the penetration voltage tends to increase the current flowing through the EL element 15, white peak voltage will increase, increasing perceived contrast in image display. This provides for a good image display.

Conversely, it is also useful to use P-channel transistors as the switching transistors 11*b* and 11*c* in FIG. 1 to cause penetration, and thereby obtain a proper black display. When the P-channel transistor 11*b* turns off, the voltage goes high (Vgh), shifting the terminal voltage of the capacitor 19 slightly to the Vdd side. Consequently, the voltage at the gate (G) terminal of the transistor 11*a* rises, resulting in more intense black display. Also, the current used for first gradation display can be increased (a certain base current can be delivered up until gradation 1), and thus shortages of write current can be eased during current programming.

Figure 125:
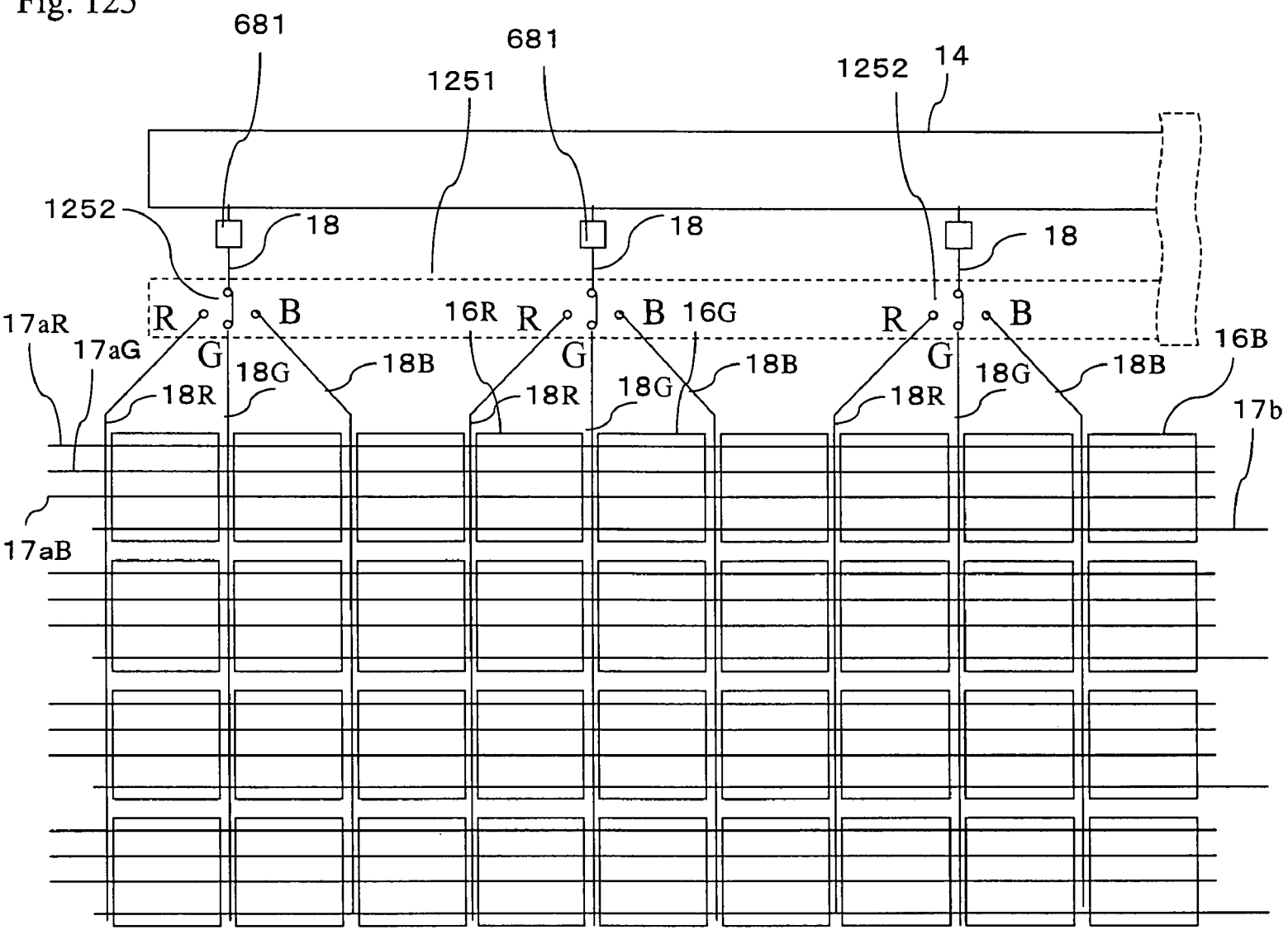

Another drive method according to the present invention will be described below with reference to drawings. FIG. 125 is an explanatory diagram illustrating a display panel which performs sequential driving according to the present invention. A source driver circuit 14 outputs R, G, and B data to connection terminals 618 by switching among them. Thus, the source driver circuit 14 only needs 1/3 as many output terminals as in FIG. 48.

Signals outputted from the source driver circuit 14 to the connection terminals 681 are allocated to 18R, 18G, and 18B by an output switching circuit 1251. The output switching circuit 1251 is formed directly on an array board 71 by polysilicon technology or amorphous silicon technology. Alternatively, it may be formed with silicon chips and mounted on the array board 71 by COG, TAB, or COF technology. Also, the output switching circuit 1251 may be incorporated into the source driver circuit 14 as a sub-circuit of the source driver circuit 14.

If a changeover switch 1252 is connected to an R terminal, the output signal from the source driver circuit 14 is applied to the source signal line 18R. If the changeover switch 1252 is connected to a G terminal, the output signal from the source driver circuit 14 is applied to the source signal line 18G. If the changeover switch 1252 is connected to a B terminal, the output signal from the source driver circuit 14 is applied to the source signal line 18B.

Figure 126:
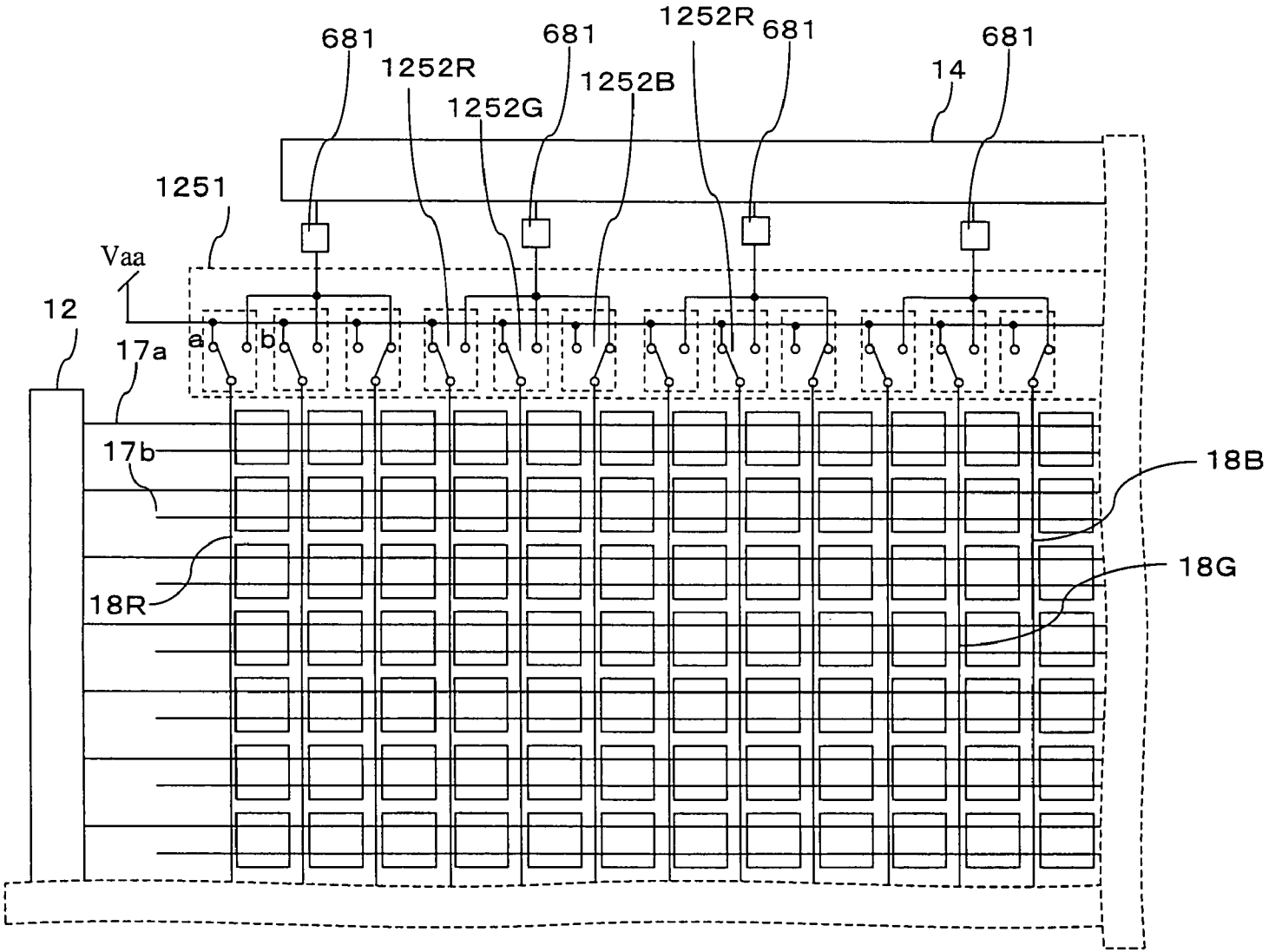

Incidentally, in the configuration in FIG. 126, when the changeover switch 1252 is connected to the R terminal, the G terminal and B terminal of the changeover switch are open. Thus, the current entering the source signal lines 18G and 18B is 0 A. Consequently, the pixels 16 connected to the source signal lines 18G and 18B provide a black display.

When the changeover switch 1252 is connected to the G terminal, the R terminal and B terminal of the change over switch are open. Thus, the current entering the source signal lines 18R and 18B is 0 A. Consequently, the pixels 16 connected to the source signal lines 18R and 18B provide a black display.

In the configuration in FIG. 126, when the changeover switch 1252 is connected to the B terminal, the R terminal and G terminal of the changeover switch are open. Thus, the current entering the source signal lines 18R and 18G is 0 A. Consequently, the pixels 16 connected to the source signal lines 18R and 18G provide a black display.

Basically, if one frame consists of three fields, R image data is written in sequence into the pixels 16 in the screen 50 in the first field. In the second field, G image data is written in sequence into the pixels 16 in the screen 50. In the third field, B image data is written in sequence into the pixels 16 in the screen 50.

Thus, R data→G data→B data→R data→G data→B data→R data→ . . . are rewritten in sequence in the appropriate fields to implement sequential driving. Description of how N-fold pulse driving is performed by turning on and off the switching transistor 11*d* as shown in FIG. 1 has been given with reference to FIGS. 5, 13, 16, etc. Needless to say, such a drive method can be combined with sequential driving. Of course, it goes without saying that other drive methods according to the present invention can be combined with sequential driving.

In the above example, it has been stated that when image data is written into the R pixel 16, black data is written into the G pixel and B pixel, that when image data is written into the G pixel 16, black data is written into the R pixel and B pixel, and that when image data is written into the B pixel 16, black data is written into the R pixel and G pixel. The present invention is not limited to this.

For example, when image data is written into the R pixel 16, the G pixel and B pixel may retain the image data rewritten in the previous field. This can make the screen 50 brighter. When image data is written into the G pixel 16, the R pixel and B pixel may retain the image data rewritten in the previous field. When image data is written into the B pixel 16, the G pixel and R pixel may retain the image data rewritten in the previous field.

In order to retain image data in pixels other than the color pixel being rewritten, the gate signal line 17*a* can be controlled separately for the R, G, and B pixels. For example, as illustrated in FIG. 125, a gate signal line 17*a*R can be designated as a signal line which turns on and off the transistors 11*b* and 11*c* of the R pixel, a gate signal line 17*a*G can be designated as a signal line which turns on and off the transistors 11*b* and 11*c* of the G pixel, and a gate signal line 17*a*B can be designated as a signal line which turns on and off the transistors 11*b* and 11*c* of the B pixel. On the other hand, the gate signal line 17*b* can be designated as a signal line which commonly turns on and off the transistors 11*d* of the R, G, and B pixels.

With the above configuration, when the source driver circuit 14 outputs R image data and the changeover switch 1252 is set to an R contact, a turn-on voltage can be applied to the gate signal line 17*a*R and a turn-off voltage can be applied to the gate signal lines aG and aB. Thus, the R image data can be written into the R pixel 16 and the G pixel 16 and R pixel 16 can retain the image data of the previous field.

When the source driver circuit 14 outputs G image data in the second field and the changeover switch 1252 is set to a G contact, a turn-on voltage can be applied to the gate signal line 17*a*G and a turn-off voltage can be applied to the gate signal lines aR and aB. Thus, the G image data can be written into the G pixel 16 and the R pixel 16 and B pixel 16 can retain the image data of the previous field.

When the source driver circuit 14 outputs B image data in the third field and the changeover switch 1252 is set to a B contact, a turn-on voltage can be applied to the gate signal line 17*a*B and a turn-off voltage can be applied to the gate signal line aR and aG. Thus, the B image data can be written into the B pixel 16 and the R pixel 16 and G pixel 16 can retain the image data of the previous field.

In the example shown in FIG. 125, the gate signal lines 17*a* are placed (formed) in such a way as to turns on and off the transistors 11*b* of the R, G, and B pixels 16 separately. However, the present invention is not limited to this. For example, a gate signal line 17*a* common to the R, G, and B pixels 16 may be formed of placed as illustrated in FIG. 126.

In relation to the configuration in FIG. 125 and the like, it has been stated that when the R source signal line is selected by the changeover switch 1252, the G and B source signal lines are open. However, the open state is an electrically floating state and is not desirable.

FIG. 126 shows a configuration in which measures are taken to eliminate such floating state. A terminal a of a changeover switch 1252 of an output switching circuit 1251 is connected to a Vaa voltage (voltage for black display) A terminal b is connected to an output terminal of the source driver circuit 14. The changeover switch 1252 is installed for each of the R, G, and B pixels.

In the state shown in FIG. 126, a changeover switch 1252R is connected to a Vaa terminal. Thus, the Vaa voltage (voltage for black display) is applied to the source signal line 18R. A changeover switch 1252G is connected to a Vaa terminal. Thus, the Vaa voltage (voltage for black display) is applied to the source signal line 18G. A changeover switch 1252B is connected to the output terminal of the source driver circuit 14. Thus, a B image signal is applied to the source signal line 18B.

In the above state, the B pixel is being rewritten and a black display voltage is applied to the R pixel and G pixel. As the changeover switches 1252 are controlled in the above manner, an image composed of the pixels 16 are rewritten. Incidentally, control of the gate signal lines 17*b* is the same as in the examples described above, and thus detailed description thereof will be omitted.

In the above example, the R pixel 16 is rewritten in the first field, the G pixel 16 is rewritten in the second field, and the B pixel 16 is rewritten in the third field. That is, the color of the pixel rewritten changes every field. The present invention is not limited to this. The color of the pixel rewritten may be changed every horizontal scanning period (1 H). For example, a possible drive method involves rewriting the R pixel in the first H, the G pixel in the second H, the B pixel in the third H, the R pixel in the fourth H, and so on. Of course, the color of the pixel rewritten may be changed every two horizontal scanning periods or every 1/3 field.

Figure 127A:
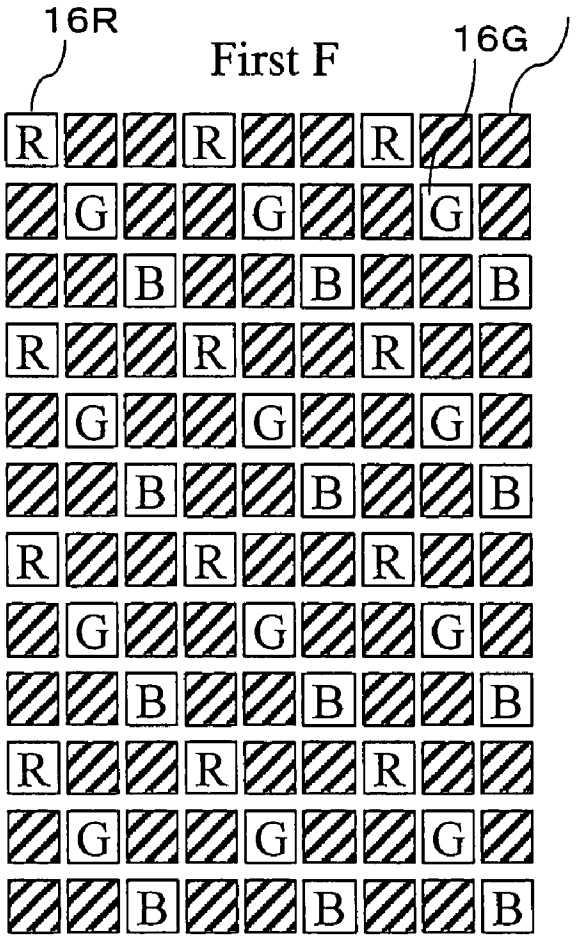
Figure 127B:
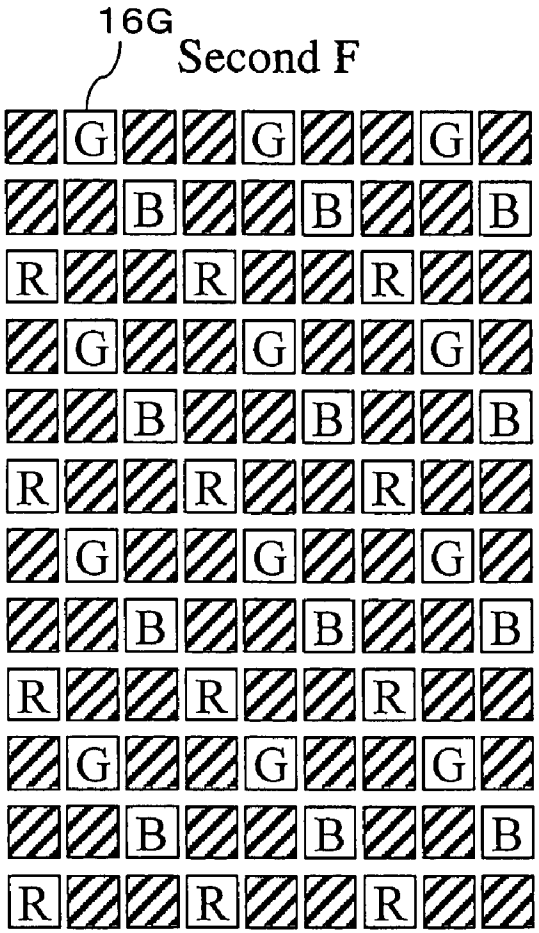
Figure 127C:
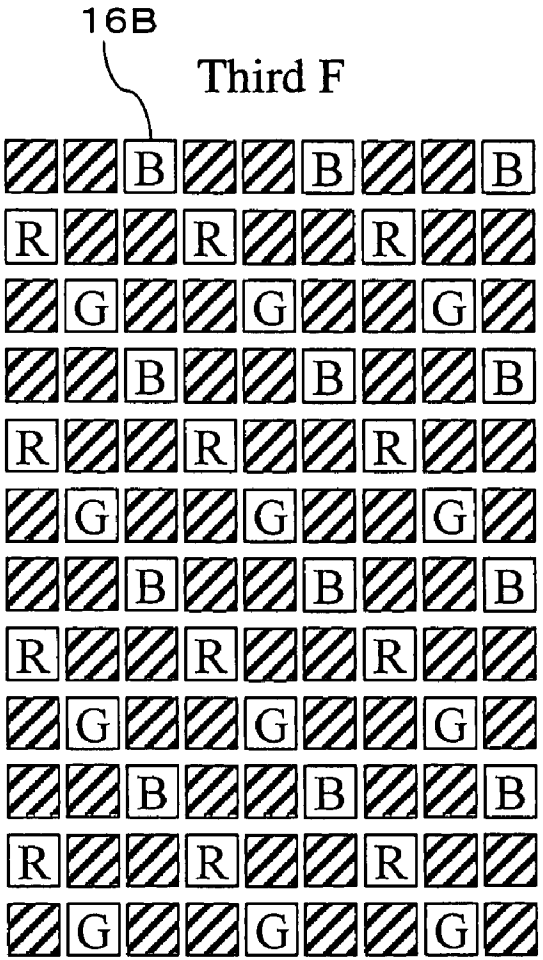

FIG. 127 shows an example, in which the color of the pixel rewritten changes every 1 H. Incidentally, in FIGS. 127 to 129, the oblique hatching indicates that the pixels 16 either retain image data from the previous field instead of being rewritten or are displayed in black. Of course, the black display of the pixels and retention of image data from the previous field may be repeated alternately.

Needless to say, in the drive system in FIGS. 125 to 129, it is also possible to use the N-fold pulse driving in FIG. 13 or simultaneous M-row driving. FIGS. 125 to 129 show writing of pixels 16. Although illumination control of the EL elements 15 is not described, it goes without saying that this example can be used in combination with examples described earlier or later. Of course, this drive method can be combined with the configuration which involves formation of the dummy pixel rows 271 described with reference to FIG. 27 and a drive method which uses the dummy pixel rows.

One frame need not necessarily consist of three fields and may consist of two fields or four or more fields. In one example illustrated herein, one frame consists of two fields and the R and G pixels out of the three primary RGB colors are rewritten in the first field and the B pixel is rewritten in the second field. In another example illustrated herein, one frame consists of four fields and the R pixel out of the three primary RGB colors is rewritten in the first field, the G pixel is rewritten in the second field, and the B pixel is rewritten in the third and fourth field. In these sequences, white balance can be achieved more efficiently if the luminous efficiencies of the R, G, and B EL elements 15 are taken into consideration.

In the above example, the R pixel 16 is rewritten in the first field, the G pixel 16 is rewritten in the second field, and the B pixel 16 is rewritten in the third field. That is, the color of the pixel rewritten changes every field.

According to the example shown in FIG. 127, in the first field, an R pixel is rewritten in the first H, a G pixel is rewritten in the second H, a B pixel is rewritten in the third H, an R pixel is rewritten in the fourth H, and so on. Of course, the color of the pixel rewritten may be changed every two or more horizontal scanning periods or every 1/3 field.

According to the example shown in FIG. 127, in the first field, an R pixel is rewritten in the first H, a G pixel is rewritten in the second H, a B pixel is rewritten in the third H, and an R pixel is rewritten in the fourth H. In the second field, a G pixel is rewritten in the first H, a B pixel is rewritten in the second H, an R pixel is rewritten in the third H, and a G pixel is rewritten in the fourth H. In the third field, a B pixel is rewritten in the first H, an R pixel is rewritten in the second H, a G pixel is rewritten in the third H, and a B pixel is rewritten in the fourth H.

Thus, by rewriting the R, G, and B pixels in each field arbitrarily or with some regularity, it is possible to prevent separation among the R, G, and B colors. Also, flickering is reduced.

Figure 128A:
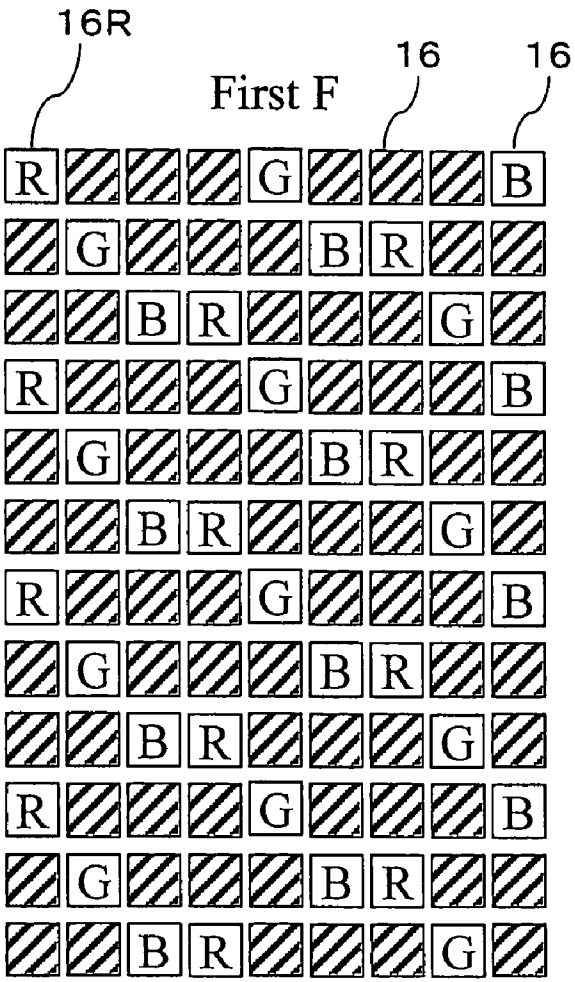
Figure 128B:
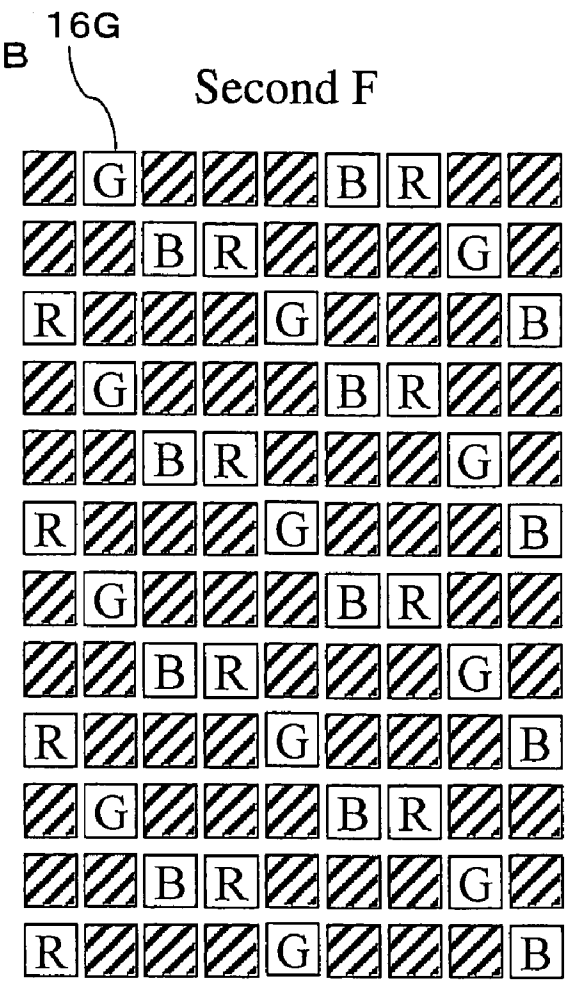
Figure 128C:
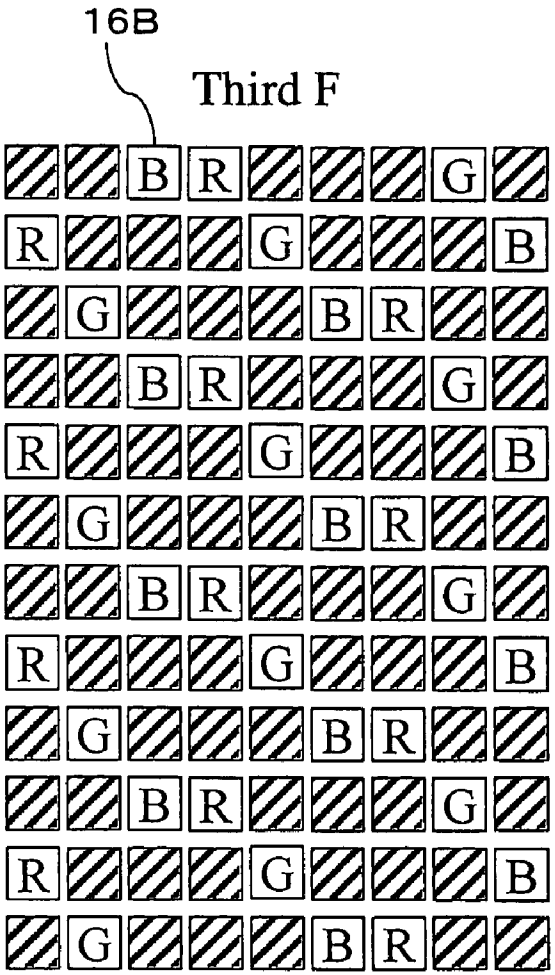

In FIG. 128, a plurality of pixel 16 colors are rewritten every 1 H. In FIG. 127, in the first field, the pixel 16 rewritten in the first H is an R pixel, the pixel 16 rewritten in the second H is a G pixel, the pixel 16 rewritten in the third H is a B pixel, the pixel 16 rewritten in the fourth H is an R pixel.

In FIG. 128, positions of the different-colored pixels rewritten are changed every 1 H. By assigning R, G, and B pixels to different fields (needless to say, this may be done with some regularity) and rewriting them in sequence, it is possible to prevent separation among the R, G, and B colors as well as to reduce flickering.

Incidentally, even in the example in FIG. 128, the R, G, and B pixels should have the same illumination time or luminous intensity in each picture element, which is a set of R, G, and B pixels. Needless to say, this is also done in the examples in FIGS. 126, 127, and the like to avoid color irregularities.

Figure 129A:
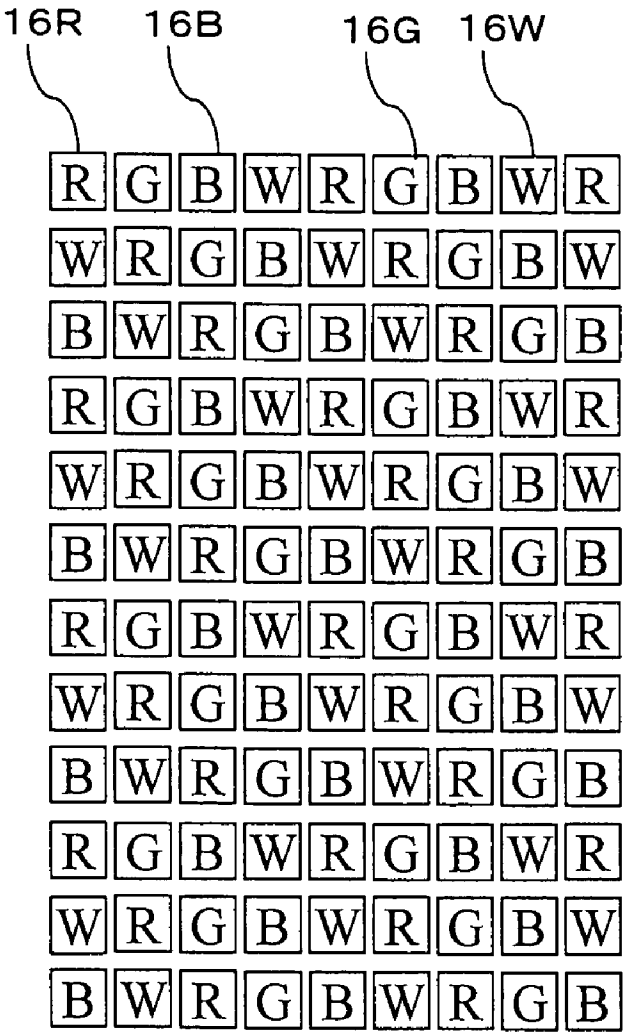
Figure 129B:
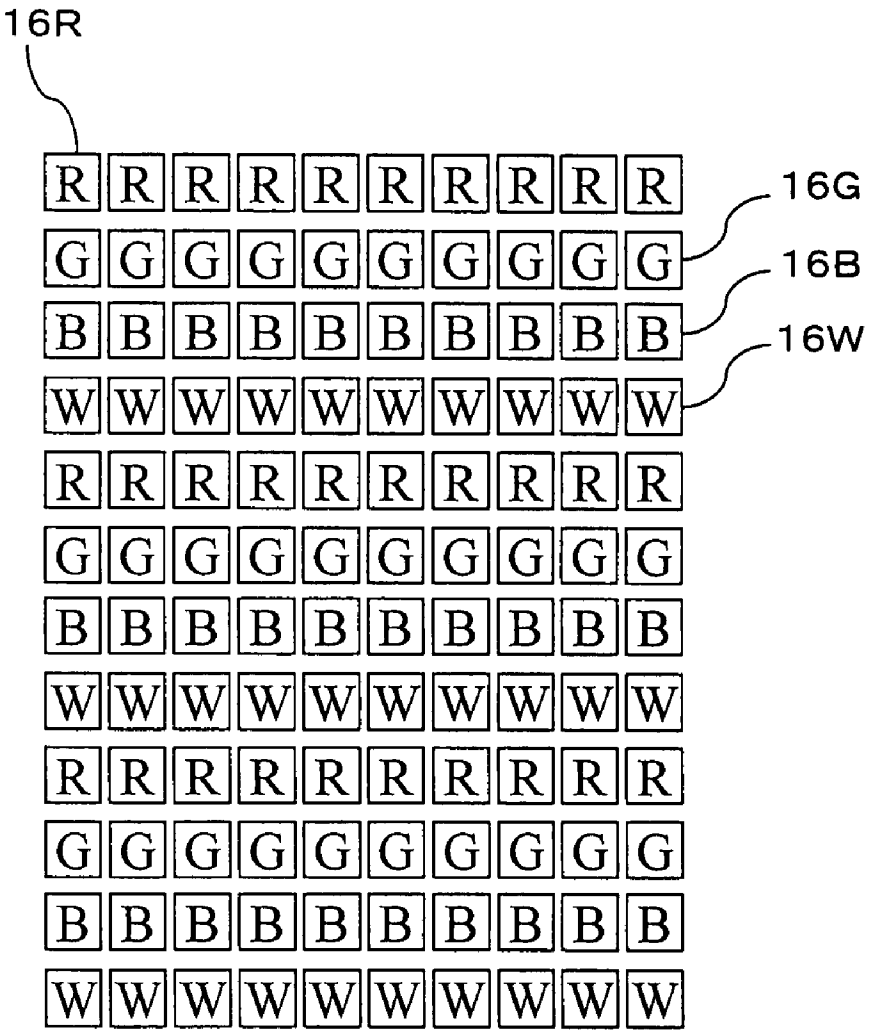

As shown in FIG. 128, in order to rewrite pixels of different colors in each H (three colors—R, G, and B—are rewritten in the first H in the first field in FIG. 128), in FIG. 125, the source driver circuit 14 can be configured to output image signals of arbitrary colors (or colors determined with some regularity) to the terminals and the changeover switches 1252 can be configured to connect to the R, G, and B contacts arbitrarily (or with some regularity) The panel in an example in FIG. 129 has W (white) pixels 16W in addition to the three primary colors RGB. By forming or placing pixels 16W, it is possible to achieve peak brightness of colors properly as well as to achieve a high brightness-display. FIG. 129(*a*) shows an example in which R, G, B, and W pixels 16 are formed in each pixel row. FIG. 129(*b*) shows an example in which R, G, B, and W pixels are placed in turns in different pixel rows.

Needless to say, the drive method in FIG. 129 can incorporate the drive methods in FIGS. 127, 128, etc. Also, it goes without saying that N-fold pulse driving, simultaneous M-row driving, etc. can be incorporated. These matters can easily be implemented by those skilled in the art based on this specification, and thus description thereof will be omitted.

Incidentally, for ease of explanation, it is assumed that the display panel according to the present invention has the three primary colors RGB, but this is not restrictive. The display panel may have cyan, yellow, and magenta in addition to R, G, and B, or it may have any one of R, G, and B or any two of R, G, and B.

Also, although it has been stated that the sequential driving system handles R, G, and Bin each field, it goes without saying that the present invention is not limited to this. Besides, the examples in FIGS. 125 to 129 illustrate how image data is written into pixels 16. They do not illustrate (although, of course, they are related to) a method of displaying images by operating the transistors 11*d* and passing current through the EL elements 15 unlike in FIG. 1. In the configuration shown in FIG. 1, current is passed through the EL elements 15 by controlling the transistors 11*d*.

Also, the drive methods in FIGS. 127, 128, etc. can display RGB images in sequence by controlling the transistors 11*d* (in the case of FIG. 1). For example, in FIG. 130(*a*) an R display area 53R, G display area 53G, and B display area 53B are scanned from top to bottom (or from bottom to top) of the screen during one frame (one field) period. The remaining area becomes a non-display area 52. That is, intermittent driving is performed.

Figure 130B:
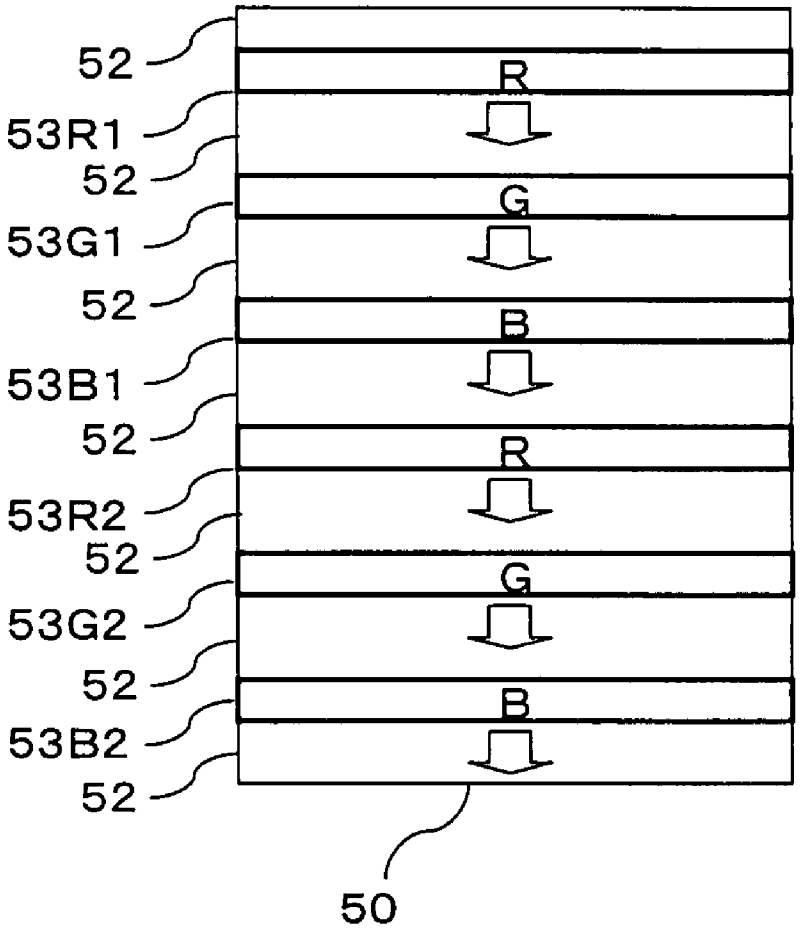
Figure 130A:
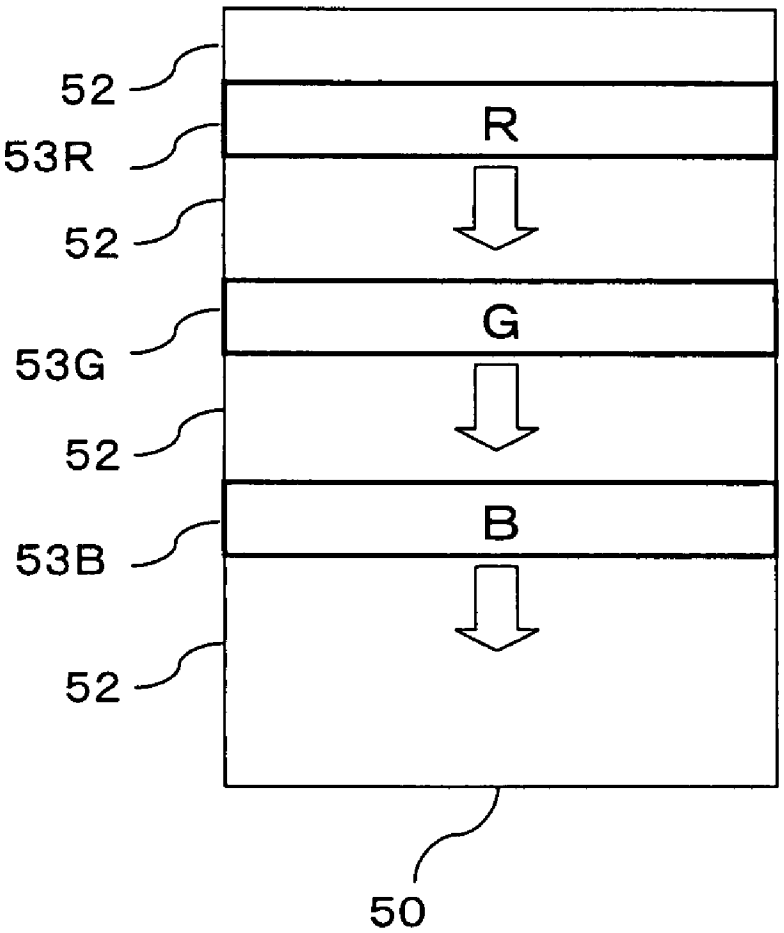

FIG. 130(*b*) shows an example in which a plurality of RGB display areas 53 are generated during one field (one frame) period. This drive method is analogous to the one shown in FIG. 16. Thus, it will require no explanation. In FIG. 130(*b*), by dividing the display area 53, it is possible to eliminate flickering even at a lower frame rate.

Figure 131B:
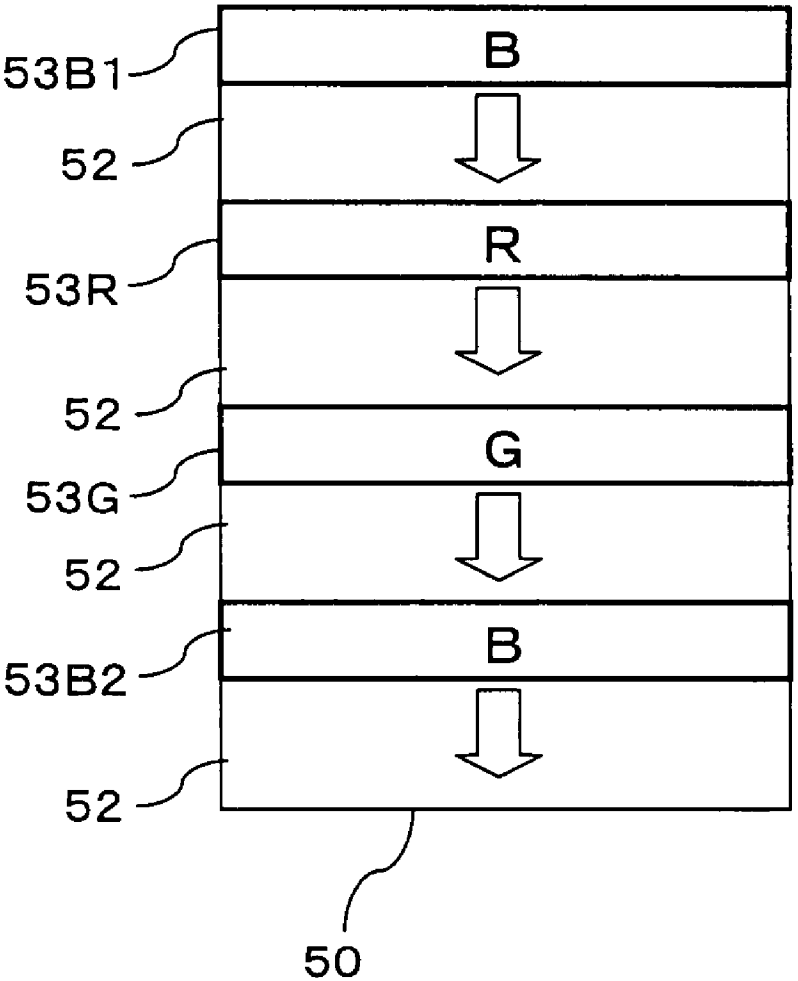
Figure 131A:
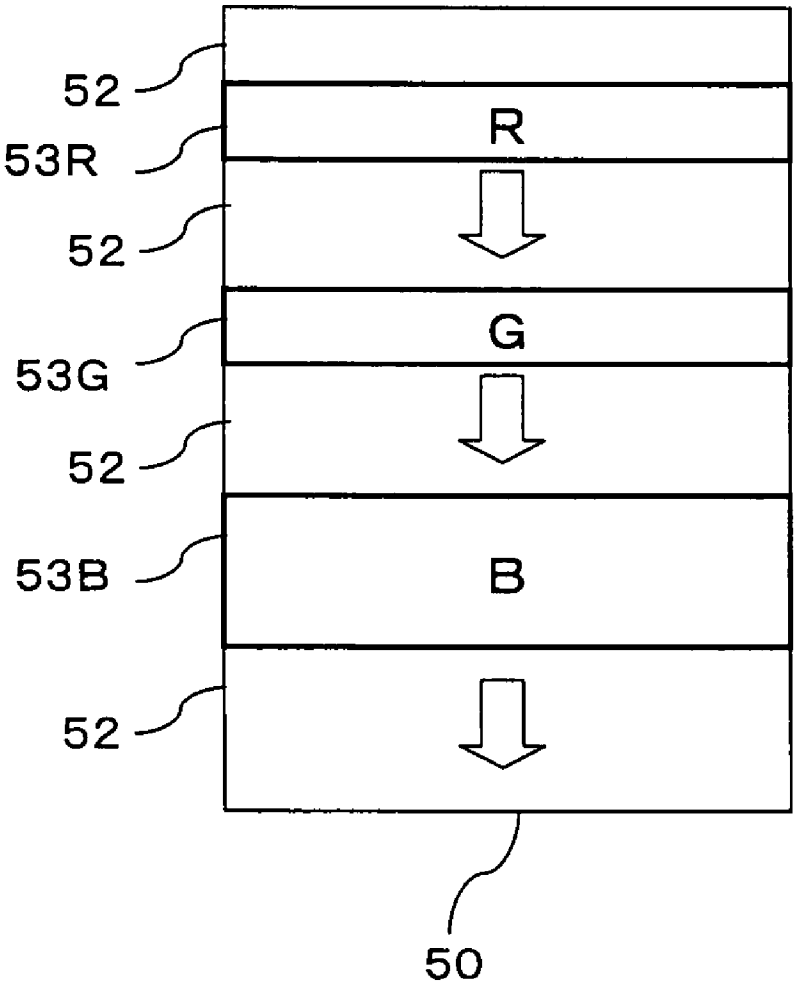

FIG. 131(*a*) shows a case in which R, G, and B display areas 53 have different sizes (needless to say, the size of a display area 53 is proportional to its illumination period). In FIG. 131(*a*), the R display area 53R and G display area 53G have the same size. The B display area 53B has a larger size than the G display area 53G. In an organic EL display panel, B often has a low light emission efficiency. By making the B display area 53B larger than the display areas 53 of other colors as shown in FIG. 131(*a*), it is possible to achieve a white balance efficiently.

FIG. 131(*b*) shows an example in which there are a plurality of B display periods 53B (53B1 and 53B2) during one field (one frame) period. Whereas FIG. 131(*a*) shows a method of varying the size of one B display area 53B to allow the white balance to be adjusted properly, FIG. 131(*b*) shows a method of displaying multiple B display areas 53B having the same surface area to achieve a proper white balance.

The drive system according to the present invention is not limited to either FIG. 131(*a*) or FIG. 131(*b*). It is intended to generate R, G, and B display areas 53 and create an intermittent display, and thereby correct blurred moving pictures and insufficient writing into the pixels 16. With the drive method in FIG. 16, independent display areas 53 for R, G, and B are not generated. R, G, and B are displayed simultaneously (it should be stated that a W display area 53 is presented). Incidentally, it goes without saying that FIG. 131(*a*) and FIG. 131(*b*) may be combined. For example, it is possible to combine the drive method of using display areas 53 of different sizes for R, G, and B in FIG. 131(*a*) with the drive method of generating multiple display areas 53 for R, G, or B in FIG. 131(*b*).

Incidentally, the drive method in FIGS. 130 and 131 is not limited to the drive methods in FIGS. 125 to 129 according to the present invention. Needless to say, with a configuration in which the currents flowing through the EL elements 15 (EL elements 15R, EL elements 15G, and EL elements 15B) are controlled separately for R, G, and B as shown in FIG. 41, the drive method in FIGS. 130 and 131 can be implemented easily. By applying turn-on/turn-off voltages to the gate signal line 17*b*R, it is possible to turn on and off the R pixel 16R. By applying turn-on/turn-off voltages to the gate signal line 17*b*G, it is possible to turn on and off the G pixel 16G. By applying turn-on/turn-off voltages to the gate signal line 17*b*B, it is possible to turn on and off the B pixel 16B.

The above driving can be implemented by forming or placing a gate driver circuit 12*b*R which controls the gate signal line 17*b*R, a gate driver circuit 12*b*G which controls the gate signal line 17*b*G, and a gate driver circuit 12*b*B which controls the gate signal line 17*b*B, as illustrated in FIG. 132. By driving the gate driver circuits 12*b*R, 12*b*G, and 12*b*B in FIG. 132 by the method described in FIG. 6 or the like, the drive method in FIGS. 130 and 131 can be implemented. Of course, it goes without saying that the drive methods in FIG. 16 and the like can be implemented using the configuration of the display panel in FIG. 132.

Also, with the configuration shown in FIGS. 125 to 128, the drive method in FIGS. 130 and 131 can be implemented using a gate signal line 17*b* common to the R, G, and B pixels without using a gate signal line 17*b*R which controls the EL elements 15R, a gate signal line 17*b*G which controls the EL elements 15G, and a gate signal line 17*b*B which controls the EL elements 15B as long as black image data can be written into pixels 16 other than the pixels 16 whose image data is rewritten.

It has been stated with reference to FIGS. 15, 18, 21, etc. that the gate signal line 17*b* (EL-side selection signal line) applies a turn-on voltage (Vgl) and turn-off voltage (Vgh) every horizontal scanning period (1 H). However, in the case of a constant current, light emission quantity of the EL elements 15 is proportional to the duration of the current. Thus the duration is not limited to 1 H.

To introduce a concept of output enable (OEV), the following provisions are made. By performing OEV control, turn-on and turn-off voltages (Vgl voltage and Vgh voltage) can be applied to the pixels 16 from the gate signal line 17*a* and 17*b* within one horizontal scanning period (1 H).

For ease of explanation, it is assumed that in the display panel according to the present invention, the pixel rows to be programmed with current are selected by the gate signal line 17*a* (in the case of FIG. 1). The output from the gate driver circuit 12*a* which controls the gate signal line 17*a* is referred to as a WR-side selection signal line. Also, it is assumed that EL elements 15 are selected by the gate signal line 17*b* (in the case of FIG. 1). The output from the gate driver circuit 12*b* which controls the gate signal line 17*b* is referred to as an EL-side selection signal line.

The gate driver circuits 12 are fed a start pulse, which is shifted as holding data in sequence within a shift register. Based on the holding data in the shift register of the gate driver circuit 12*a*, it is determined whether to output a turn-on voltage (Vgl) or turn-off voltage (Vgh) to the WR-side selection signal line. An OEV1 circuit (not shown) which turns off output forcibly is formed or placed in an output stage of the gate driver circuit 12*a*. When the OEV1 circuit is low, a WR-side selection signal which is an output of the gate driver circuit 12*a* is output as it is to the gate signal line 17*a*. The above relationship is illustrated logically in FIG. 224(*a*) (OR circuit). Incidentally, the turn-on voltage is set at logic level L (0) and the turn-off voltage is set at logic voltage H (1).

That is, when the gate driver circuit 12*a* outputs a turn-off voltage, the turn-off voltage is applied to the gate signal line 17*a*. When the gate driver circuit 12*a* outputs a turn-on voltage (logic low), it is ORed with the output of the OEV1 circuit by the OR circuit and the result is output to the gate signal line 17*a*. That is, when the OEV1 circuit is high, the turn-off voltage (Vgh) is output to the gate signal line 17*a* (see an exemplary timing chart in FIG. 176).

Based on holding data in a shift register of the gate driver circuit 12*b*, it is determined whether to output a turn-on voltage (Vgl) or turn-off voltage (Vgh) to the gate signal line 17*b* (EL-side selection signal line). An OEV2 circuit (not shown) which turns off output forcibly is formed or placed in an output stage of the gate driver circuit 12*b*. When the OEV2 circuit is low, an output of the gate driver circuit 12*b* is output as it is to the gate signal line 17*b*. The above relationship is illustrated logically in FIG. 176(*a*). Incidentally, the turn-on voltage is set at logic level L (0) and the turn-off voltage is set at logic voltage H (1).

That is, when the gate driver circuit 12*b* outputs a turn-off voltage (an EL-side selection signal is a turn-off voltage), the turn-off voltage is applied to the gate signal line 17*b*. When the gate driver circuit 12*b* outputs a turn-on voltage (logic low), it is ORed with the output of the OEV2 circuit by the OR circuit and the result is output to the gate signal line 17*b*. That is, when an input signal is high, the OEV2 circuit outputs the turn-off voltage (Vgh) to the gate driver signal line 17*b*. Thus, even if the EL-side selection signal from the OEV2 circuit is a turn-on voltage, the turn-off voltage (Vgh) is output forcibly to the gate signal line 17*b*. Incidentally, if an input to the OEV2 circuit is low, the EL-side selection signal is output directly to the gate signal line 17*b* (see the exemplary timing chart in FIG. 176).

Incidentally, screen brightness is adjusted under the control of OEV2. There are permissible limits to changes in screen brightness. FIG. 175 illustrates relationship between permissible changes (%) and screen brightness (nt) As can be seen from FIG. 175, relatively dark images have small permissible changes. Thus, in performing brightness adjustments of the screen 50 under the control of OEV2 or through duty cycle control, the brightness of the screen 50 should be taken into consideration. Permissible changes should be smaller when the screen is dark than when it is bright.

FIG. 140 shows 1/4-duty ratio driving. A turn-on voltage is applied to the gate signal line 17*b* (EL-side selection signal line) every 4 Hs and the locations to which the turn-on voltage is applied are scanned in sync with a horizontal synchronization signal (HD). Thus, the unit length of a conduction period is 1 H.

However, the present invention is not limited to this. The duration of the conduction period may be less than 1 H (1/2 H in FIG. 143) as shown in FIG. 143 or it may be equal to or more than 1 H. In short, the unit length of the conduction period is not limited to 1 H and a unit length other than 1 H can be generated easily using the OEV2 circuit formed or placed in the output stage of the gate driver circuit 12*b* (circuit which controls the gate signal line 17*b*). The OEV2 circuit is similar to the OEV1 circuit described earlier, and thus description thereof will be omitted.

In FIG. 141, the conduction period of the gate signal line 17*b* (EL-side selection signal line) does not have a unit length of 1 H. A turn-on voltage little shorter than 1 H is applied to the gate signal lines 17*b* (EL-side selection signal lines) in odd-numbered pixel rows. A turn-on voltage is applied to the gate signal lines 17*b* (EL-side selection signal lines) in even-numbered pixel rows for a very short period. The duration T1 of the turn-on voltage applied to the gate signal lines 17*b* (EL-side selection signal lines) in odd-numbered pixel rows plus the duration T2 of the turn-on voltage applied to the gate signal lines 17*b* (EL-side selection signal lines) in even-numbered pixel rows is designed to be 1 H. FIG. 141 shows a state of the first field.

In the second field which follows the first field, a turn-on voltage little shorter than 1 H is applied to the gate signal lines 17*b* (EL-side selection signal lines) in even-numbered pixel rows. A turn-on voltage is applied to the gate signal lines 17*b* (EL-side selection signal lines) in odd-numbered pixel rows for a very short period. The duration T1 of the turn-on voltage applied to the gate signal lines 17*b* (EL-side selection signal lines) in even-numbered pixel rows plus the duration T2 of the turn-on voltage applied to the gate signal lines 17*b* (EL-side selection signal lines) in odd-numbered pixel rows is designed to be 1 H.

The sum duration of turn-on voltage applications to gate signal lines 17*b* in a plurality of pixel rows may be designed to be constant. Alternatively, the illumination time of each EL element 15 in each pixel row in each field may be designed to be constant.

FIG. 142 shows a case in which the conduction period of the gate signal line 17*b* (EL-side selection signal line) is 1.5 Hs. The rise and fall of the gate signal line 17*b* at point A are designed to overlap. The gate signal line 17*b* (EL-side selection signal line) and source signal line 18 are coupled. Thus, any change in a waveform of the gate signal line 17*b* (EL-side selection signal line) penetrates to the source signal line 18. Consequently, any potential fluctuation in the source signal line 18 lowers accuracy of current (voltage) programming, causing irregularities in the characteristics of the driver transistors 11*a* to appear in the display.

Referring to FIG. 142, at point A, the voltage applied to the gate signal line 17B (EL-side selection signal line) (1) changes from turn-on voltage (Vgl) to turn-off voltage (Vgh). The voltage applied to the gate signal line 17B (EL-side selection signal line) (2) changes from turn-off voltage (Vgh) to turn-on voltage (Vgl). Thus, at point A, the signal waveform of the gate signal line 17B (EL-side selection signal line) (1) and the signal waveform of the gate signal line 17B (EL-side selection signal line) (2) cancel out each other. Consequently, even if the gate signal line 17B (EL-side selection signal line) and source signal line 18 are coupled, changes in the waveform of the gate signal line 17*b* (EL-side selection signal line) do not penetrate to the source signal line 18. This improves the accuracy of current (voltage) programming, resulting in a uniform image display.

Incidentally, in the example in FIG. 142, the conduction period is 1.5 Hs. However, the present invention is not limited to this. Needless to say, the duration of application of the turn-on voltage may be 1 H or less as illustrated in FIG. 144.

By adjusting the duration of application of the turn-on voltage to the gate signal line 17B (EL-side selection signal line), it is possible to adjust the brightness of the display screen 50 linearly. This can be done easily through control of the OEV2 circuit. Referring to FIG. 145, for example, display brightness in FIG. 145(*b*) is lower than in FIG. 145(*a*). Also, display brightness in FIG. 145(*c*) is lower than in FIG. 145(*b*).

Figure 109:
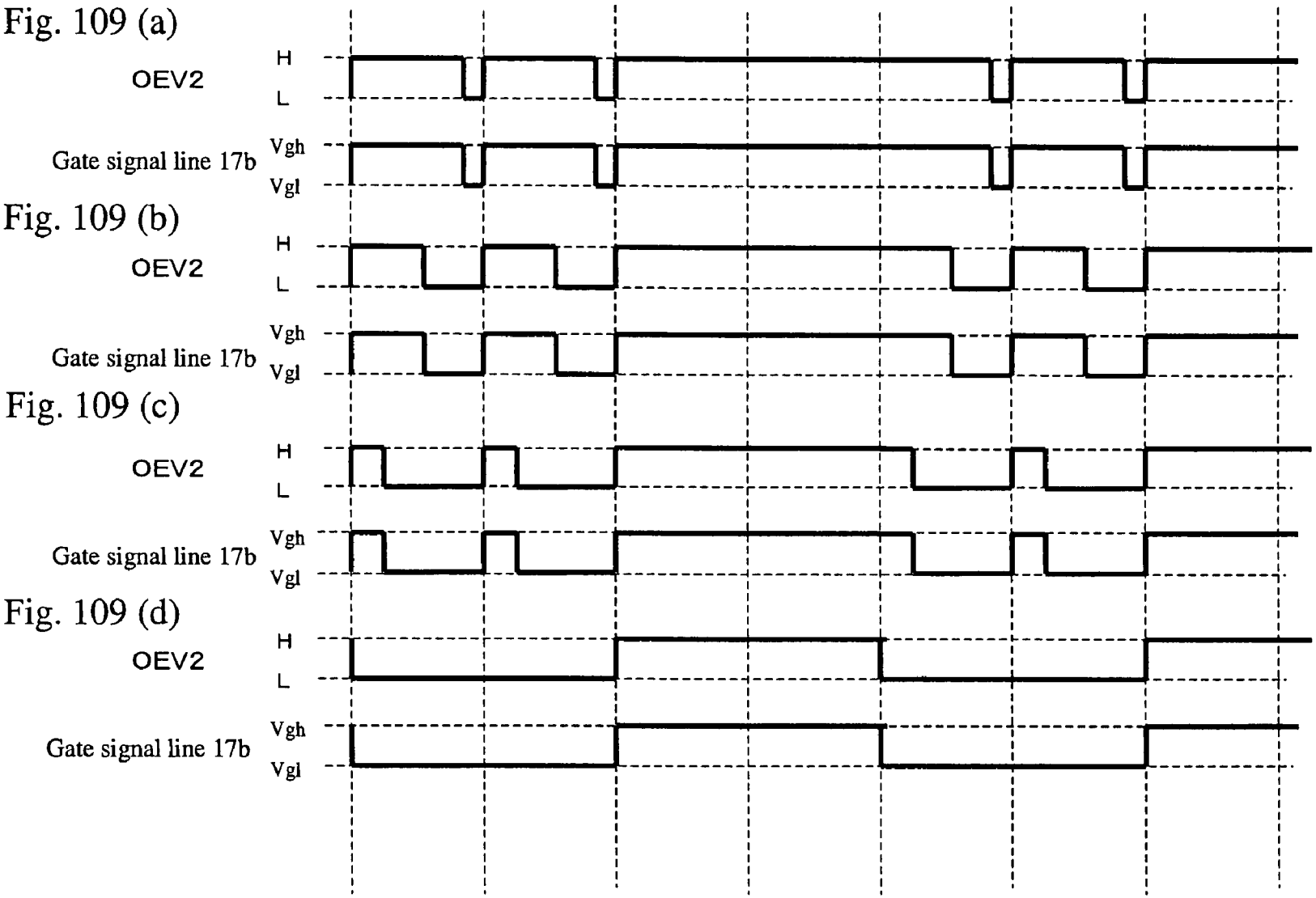
FIG. 109 is an explanatory diagram illustrating a drive method of a display panel according to the present invention.

FIG. 109 illustrates relationship between OEV2 and the signal waveform of the gate signal line 17*b*. In FIG. 109, the period during which OEV2 is low is the shortest in FIG. 109(*a*). Consequently, the turn-on voltage is applied to the gate signal line 17*b* for a short period of time, meaning that current flows through the EL element 15 for a short period of time. This results in a small duty ratio. In FIG. 109(*b*), the period during which OEV2 is low is longer. In FIG. 109(*c*) the period during which OEV2 is low is longer than in FIG. 109(*b*). Thus, the duty ratio in FIG. 109(*c*) is larger than in FIG. 109(*b*).

Incidentally, in the examples in FIGS. 109(*a*), 109(*b*) and 109(*c*), duty cycle control is performed in a period shorter than 1 H. However, the present invention is not limited to this. The unit duration of duty cycle control may be 1 H as shown in FIG. 109(*d*). FIG. 109(*d*) shows an example in which the duty ratio is 1/2.

The period during which OEV2 is low is the shortest in FIG. 109(*a*). Consequently, the turn-on voltage is applied to the gate signal line 17*b* for a short period of time, meaning that current flows through the EL element 15 for a short period of time. This results in a small duty ratio.

The period during which OEV2 is low is the shortest in FIG. 109(*a*). Consequently, the turn-on voltage is applied to the gate signal line 17*b* for a short period of time, meaning that current flows through the EL element 15 for a short period of time. This results in a small duty ratio.

As shown in FIG. 146, multiple sets of turn-on voltage and turn-off voltage may be applied in a period of 1 H. FIG. 146(*a*) shows an example in which six sets are applied. FIG. 146(*b*) shows an example in which three sets are applied. FIG. 146(*c*) shows an example in which one set is applied. In FIG. 146, display brightness is lower in FIG. 146(*b*) than in FIG. 146(*a*). It is lower in FIG. 146(*c*) than in FIG. 146(*b*). Thus, by controlling the number of conduction periods, display brightness can be adjusted (controlled) easily.

The current-driven source driver IC (circuit) 14 according to the present invention will be described below. The source driver IC according to the present invention is used to implement the drive methods and drive circuits according to the present invention described earlier. It is used in combination with drive methods, drive circuits, and display apparatus according to the present invention. Incidentally, although the source driver circuit will be described as an IC chip, this is not restrictive and the source driver circuit may be built on the array board 71 of the display panel using low-temperature polysilicon technology, amorphous silicon technology, or the like.

Figure 55:
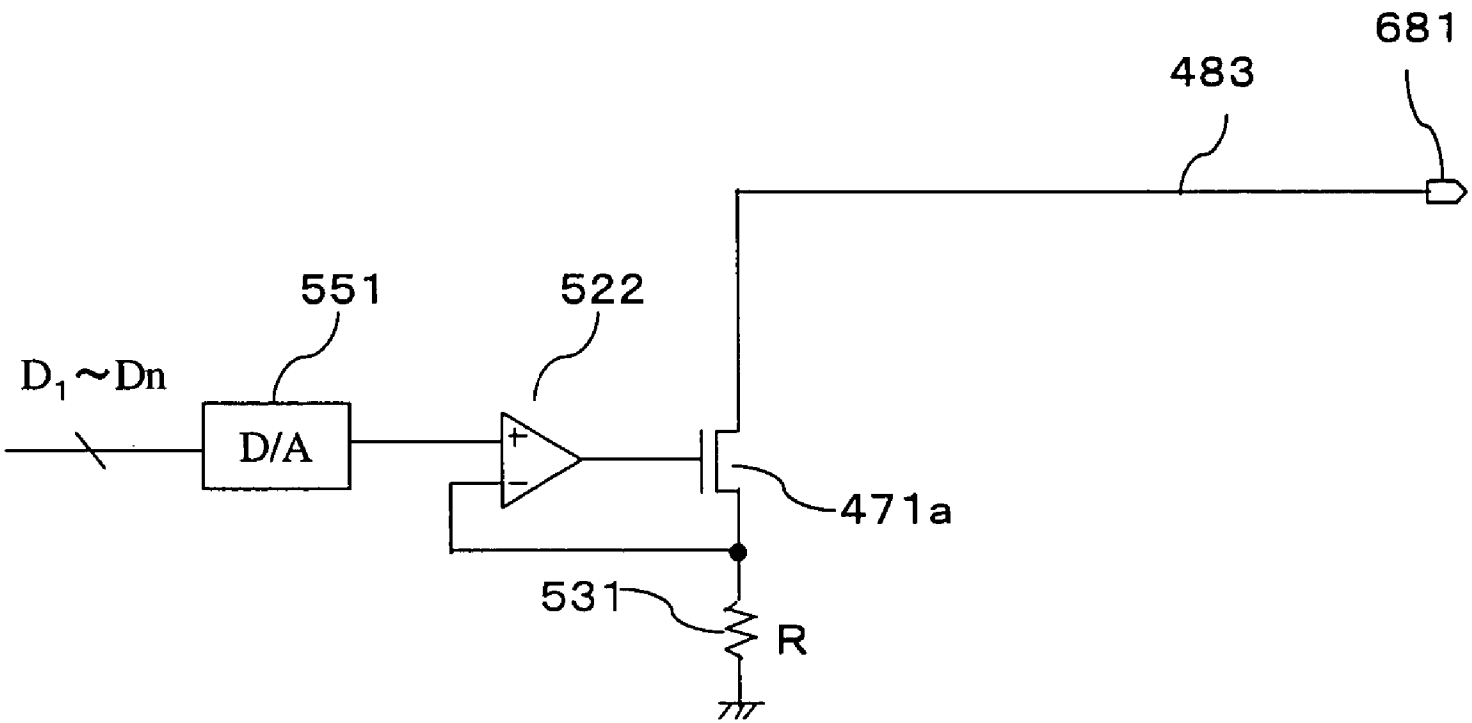
FIG. 55 is an explanatory diagram illustrating a drive circuit according to the present invention.

First, an example of a conventional current-driven source driver circuit is shown in FIG. 55, which provides a principle needed to describe current-driven source driver IC (source driver circuit) 14 according to the present invention.

In FIG. 55, reference numeral 551 denotes a D/A converter. The D/A converter 551 is fed an n-bit data signal and outputs an analog signal based on the inputted data. The analog signal enters an operational amplifier 552, which feeds into an N-channel transistor 471*a*. Current flowing through the N-channel transistor 471*a* flows to a resister 531. A terminal voltage of the register R provides a negative input to the operational amplifier 552. The voltage at the negative terminal equals the voltage at the positive terminal of the operational amplifier 552. Thus, the output voltage of the D/A converter 551 equals the terminal voltage of the resister 531.

If the resistance of the resister 531 is 1 MΩ and the output of the D/A converter 551 is 1 (V), a current of 1 (V)/1 MΩ=1 (μA) flows through the resister 531, forming a constant current circuit. Thus, analog output of the D/A converter 551 varies with the value of data signal, and a predetermined current flows through the resister 531 according to the analog output to provide a programming current Iw.

However, the D/A converter circuit 551 has a large circuit scale. So does the operational amplifier 552. Formation of the D/A converter circuit 551 and operational amplifier 552 in a single output circuit results in a huge source driver IC 14, which is practically impossible to build.

The present invention has been made in view of the above point. The source driver circuit 14 according to the present invention has a circuit configuration and layout configuration which reduces the scale of a current output circuit and minimizes variations in output current among current output terminals.

Figure 47:
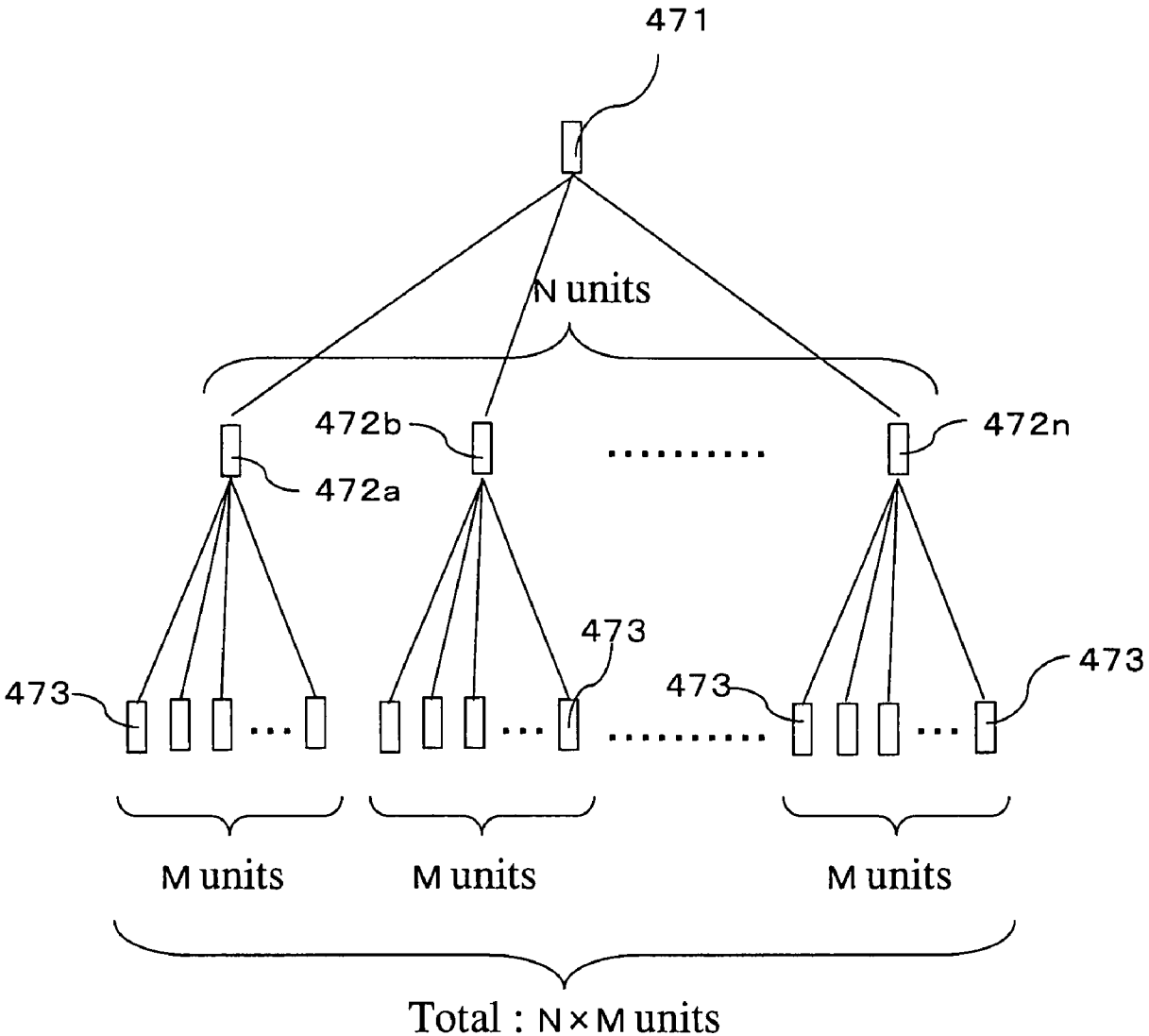
FIG. 47 is an explanatory diagram illustrating a drive circuit according to the present invention.

FIG. 47 is a block diagram showing a current-driven source driver IC (circuit) 14 according to one example of the present invention. FIG. 47 shows a multi-stage current mirror circuit comprising three-stage current sources (471, 472, 473).

In FIG. 47, the current value of the current source 471 in the first stage is copied by the current mirror circuit to N current sources 472 in the second stage (where N is an arbitrary integer). The current values of the second-stage current sources 472 are copied by the current mirror circuit to M current sources 473 in the third stage (where M is an arbitrary integer). Consequently, this configuration causes the current value of the first-stage current source 471 to be copied to N×M third-stage current sources 473.

For example, when driving the source signal lines 18 with one source driver IC 14, there are 176 outputs (because the source signal lines require a total of 176 outputs for R, G, and B). Here it is assumed that N=16 and M=11. Thus, 16×11=176 and the 176 outputs can be covered. In this way, by using a multiple of 8 or 16 for N or M, it becomes easier to lay out and design the current sources of the driver IC.

The current-driven source driver IC (circuit) 14 employing the multi-stage current mirror circuit according to the present invention can absorb variations in transistor characteristics because it has the second-stage current sources 472 in between instead of copying the current value of the first-stage current source 471 directly to N×M third-stage current sources 473 using the current mirror circuit.

In particular, the present invention is characterized in that a first-stage current mirror circuit (current source 471) and second-stage current mirror circuits (current sources 472) are placed close to each other. If a first-stage current source 471 are connected with third-stage current sources 473 (i.e., in the case of two-stage current mirror circuit), the third-stage current sources 473 connected to the first-stage current source are large in number, making it impossible to place the first-stage current source 471 and third-stage current sources 473 close to each other.

The source driver circuit 14 according to the present invention copies the current value of the first-stage current mirror circuit (current source 471) to the second-stage current mirror circuits (current sources 472), and the current values of the second-stage current mirror circuits (current sources 472) to the third-stage current mirror circuits (current sources 473). With this configuration, the second-stage current mirror circuits (current sources 472) connected to the first-stage current mirror circuit (current source 471) are small in number. Thus, the first-stage current mirror circuit (current source 471) and second-stage current mirror circuits (current sources 472) can be placed close to each other.

If transistors composing the current mirror circuits can be placed close to each other, naturally variations in the transistors are reduced, and so are variations in current values. The number of the third-stage current mirror circuits (current sources 473) connected to the second-stage current mirror circuits (current sources 472) are reduced as well. Consequently, the second-stage current mirror circuits (current sources 472) and third-stage current mirror circuits (current sources 473) can be placed close to each other.

That is, transistors in current receiving parts of the first-stage current mirror circuit (current source 471), second-stage current mirror circuits (current sources 472) and third-stage current mirror circuits (current sources 473) can be placed close to each other on the whole. In this way, transistors composing the current mirror circuits can be placed close to each other, reducing variations in the transistors and greatly reducing variations in current signals from output terminals.

In the present invention, the terms "current sources 471, 472, and 473" and "current mirror circuits" are used interchangeably. That is, current sources are a basic construct of the present invention and the current sources are embodied into current mirror circuits. Thus, a current source is not limited to a current mirror circuit and may be a constant current circuit consisting of a combination of a operational amplifier 552, transistor 471*a*, and register R.

Figure 48:
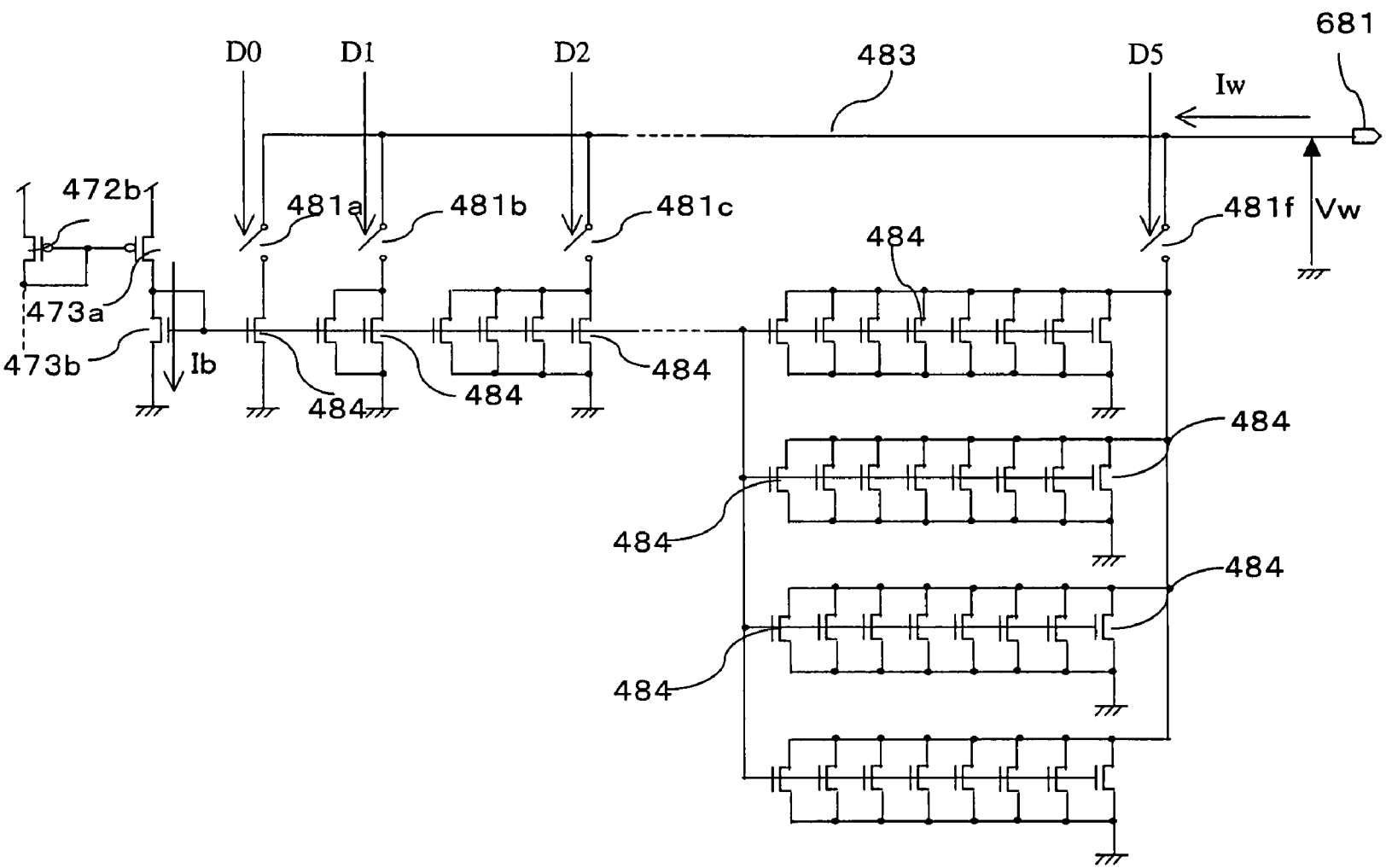
FIG. 48 is an explanatory diagram illustrating a drive circuit according to the present invention.

FIG. 48 is a structural drawing of a more concrete source driver IC (circuit) 14. It illustrates part of third current sources 473. This is an output part connected to one source signal line 18. It is composed of multiple current mirror circuits (unit transistors 484 (1 unit)) of the same size as a current mirror configuration in the final stage. Their number is bit-weighted according to the data size of image data.

Incidentally, the transistors composing the source driver IC (circuit) 14 according to the present invention are not limited to a MOS type and may be a bipolar type. Also, they are not limited to silicon semiconductors and may be gallium arsenide semiconductors. Also, they may be germanium semiconductors. Alternatively, they may be formed directly on a substrate-using low-temperature polysilicon technology, other polysilicon technology, or amorphous silicon technology.

FIG. 48 illustrates an example of the present invention which handles 6-bit digital input. Six bits are the sixth power of two, and thus provide a 64-gradation display. This source driver IC 14, when mounted on an array board, provides 64 gradations each of red (R), green (G), and blue (B), meaning 64×64×64=approximately 260,000 colors.

Sixty-four (64) gradations require 1 D0-bit unit transistor 484, two D1-bit unit transistors 484, four D2-bit unit transistors 484, eight D3-bit unit transistors 484, sixteen D4-bit unit transistors 484, and thirty-two D5-bit unit transistors 484 for a total of 63 unit transistors 484. Thus, the present invention produces one output using as many unit transistors 484 as the number of gradations (64 gradations in this example) minus 1. Incidentally, even if one unit transistor is divided into a plurality of sub-unit transistors, this simply means that a unit transistor is divided into sub-unit transistors, and makes no difference in the fact that the present invention uses as many unit transistors as the number of gradations minus 1.

In FIG. 48, D0 represents LSB input and D5 represents MSB input. When a D0 input terminal is high (positive logic) a switch 481*a* is closed (the switch 481*a* is an on/off means and may be constructed of a single transistor or may be an analog switch consisting of a P-channel transistor and N-channel transistor. Then, current flows to a current source (single-unit) 484 composing a current mirror. The current flows through internal wiring 483 in the IC 14. Since the internal wiring 483 is connected to the source signal line 18 via a terminal electrode of the IC 14, the current flowing through internal wiring 483 provides a programming current for the pixels 16.

For example, when a D1 input terminal is high (positive logic), a switch 481*b* is closed. Then, current flows to two current sources (single-unit) 484 composing a current mirror. The current flows through the internal wiring 483 in the IC 14. Since the internal wiring 483 is connected to the source signal line 18 via a terminal electrode of the IC 14, the current flowing through internal wiring 483 provides a programming current for the pixels 16.

The same applies to the other switches 481. When a D2 input terminal is high (positive logic), a switch 481*c* is closed. Then, current flows to four current sources (single-unit) 484 composing a current mirror. When a D5 input terminal is high (positive logic), a switch 481*f* is closed. Then, current flows to 32 (thirty-two) current sources (single-unit) 484 composing a current mirror.

In this way, based on external data (D0 to D5), current flows to the corresponding current sources (single-unit). That is, current flows to 0 to 63 current sources (single-unit) depending on the data.

Incidentally, for ease of explanation, it is assumed that there are 63 current sources for a 6-bit configuration, but this is not restrictive. In the case of 8-bit configuration, 255 unit transistors 484 can be formed (placed). For a 4-bit configuration, 15 unit transistors 484 can be formed (placed). The transistors 484 constituting the unit current sources have a channel width W and channel length L. The use of equal transistors makes it possible to construct output stages with small variations.

Besides, not all the unit transistors 484 need to pass equal current. For example, individual unit transistors 484 may be weighted. For example a current output circuit may be constructed using a mixture of single-unit unit transistors 484, double-sized unit transistors 484, quadruple-sized unit transistors 484, etc. However, if unit transistors 484 are weighted, the weighted current sources may not provide the right proportions, resulting in variations. Thus, even when using weighting, it is preferable to construct each current source from transistors each of which corresponds to a single-unit current source.

The unit transistor 484 should be equal to or larger than a certain size. The smaller the transistor size, the larger the variations in output current. The size of a transistor 484 is given by the channel length L multiplied by the channel width W. For example, if W=3 μm and L=4 μm, the size of the unit transistor 484 constituting a unit current source is W×L=12 square μm. It is believed that crystal boundary conditions of silicon wafers have something to do with the fact that a smaller transistor size results in larger variations. Thus, variations in output current of transistors are small when each transistor is formed across a plurality of crystal boundaries.

Figure 119:
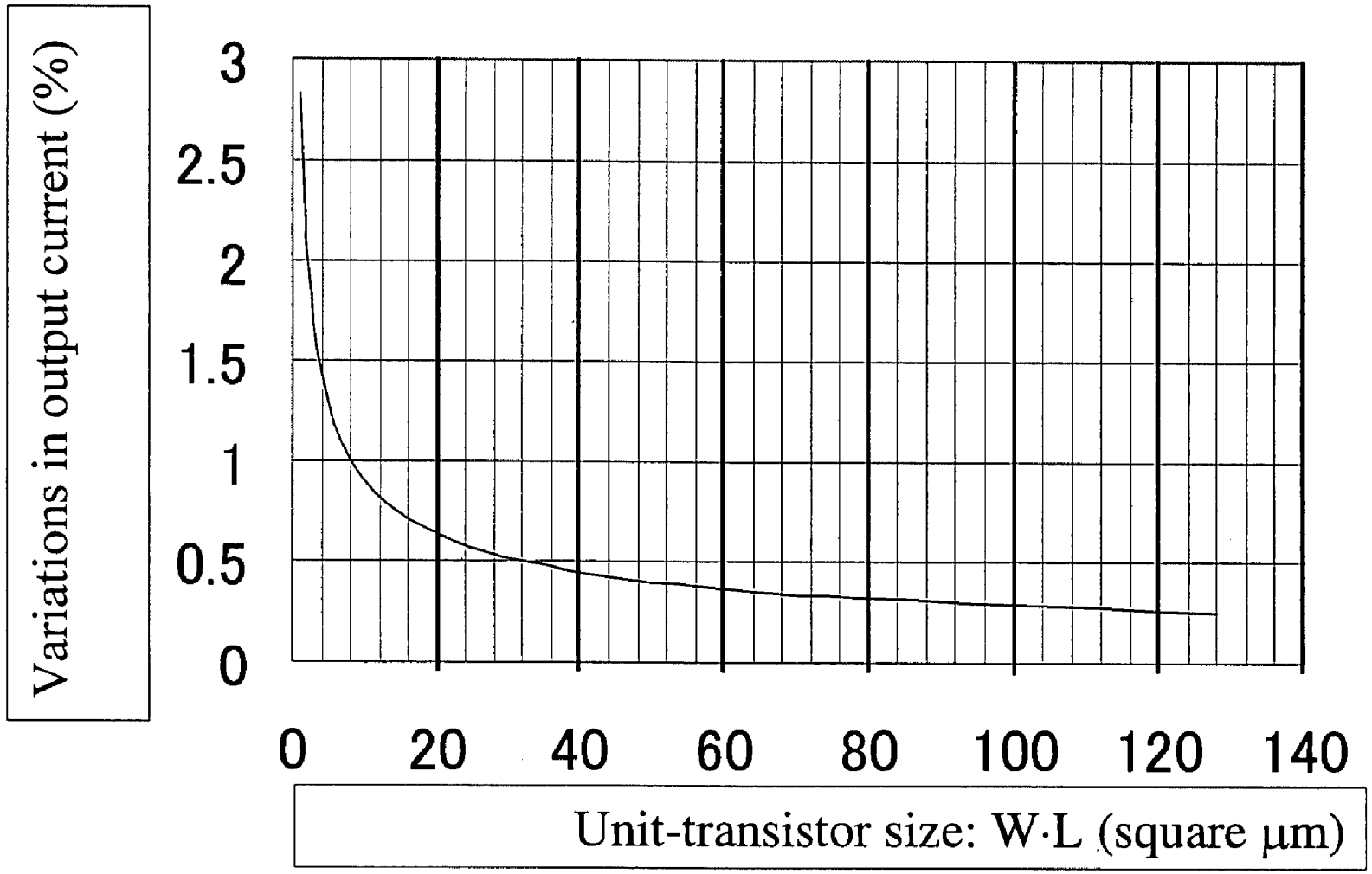
FIG. 119 is an explanatory diagram illustrating a drive circuit of a display apparatus according to the present invention.

Relationship between size of transistors and variations in output current is shown in FIG. 119. The horizontal axis of the graph in FIG. 119 represents transistor size (square μm). The vertical axis represents variations in output current in percentage terms. The variations (%) in output current here were determined using groups of 63 unit current sources (unit transistors) 484 formed on a wafer. Thus, although the horizontal axis of the graph represents the size of a transistor (size of a unit transistor 484) constituting one current source, since there are actually 63 transistors connected in parallel, the total area of the transistors is 63 times larger. However, FIG. 119 is based on the size of a unit transistor 484. Thus, FIG. 119 shows that variations in the output current of 63 unit transistors 484 with an area of 30 square μm each is 0.5%.

In the case of 64 gradations, 100/64=1.5%. Thus, the variations in the output current must be within 1.5%. From FIG. 119, it can been seen that in order for the variations to be within 1.5%, the size of the unit transistor must be equal to or larger than 2 square μm (in the case of 64 gradations, sixty-three 2-square μm unit transistors operate) On the other hand, there are limits to transistor size because larger transistors increase the size of an IC chip and there are limits to the width per one output. In this respect, the upper limit to the size of the unit transistor 484 is 300 square μm. Thus, in the case of 64 gradations, the size of the unit transistor 484 must be from 2 square μm to 300 square μm (both inclusive) In the case of 128 gradations, 100/128=1%. Thus, the variations in the output current must be within 1%. From FIG. 119, it can been seen that in order for the variations to be within 1%, the size of the unit transistor must be equal to or larger than 8 square μm. Thus, in the case of 128 gradations, the size of the unit transistor 484 must be from 8 square μm to 300 square μm (both inclusive).

Generally, if the number of gradations is K and the size of a unit transistor 484 is St (square μm), the following relationship should be satisfied:

$$40 \leqq K/\sqrt{(St)} \text{ and } St \leqq 300$$

More preferably, the following relationship should be satisfied:

$$120 \leqq K/\sqrt{(St)} \text{ and } St \leqq 300$$

In the above example 64 gradations are represented by 63 transistors. When representing 64 gradations by 127 unit transistors 484, the unit-transistor 484 size is the total size of two unit transistors 484. For example, in the case where 64 gradations are represented by 127 unit transistors 484, if the size of a unit transistor 484 is 10 square μm, the unit-transistor 484 size is given in FIG. 119 as 1×2=20. Similarly, in the case where 64 gradations are represented by 255 unit transistors 484, if the size of a unit transistor 484 is 10 square μm, the unit-transistor 484 size is given in FIG. 119 as 10×4=40.

It is necessary to take into consideration not only the size, but also the shape of the unit transistor 484. This is to reduce kink effect. A kink is a phenomenon in which current flowing through a unit transistor 484 changes when the voltage between the source (S) and drain (D) of the unit transistor 484 is varied with the gate voltage of the unit transistor 484 kept constant. In the absence of kink effect (in ideal state), the current flowing through the unit transistor 484 does not change even if the voltage applied between the source (S) and drain (D) of the unit transistor 484 is varied.

Kink effect occurs when the potential of the source signal lines 18 varies due to variations in Vt of driver transistors 11*a* shown in FIG. 1 and the like. The driver circuit 14 passes programming current through the source signal line 18 so that the programming current will flow through the driver transistor 11*a* of the pixel. The programming current causes changes in the gate terminal voltage of the driver transistor 11*a*, and consequently the programming current flows through the driver transistor 11*a*. As can be seen From FIG. 3, when a selected pixel 16 is in programming mode, the gate terminal voltage of the driver transistor 11*a* equals the potential of the source signal line 18.

Thus, the potentials of the source signal lines 18 vary due to variations in Vt of the driver transistors 11*a* in pixels 16. The potential of a source signal line 18 equals the source-drain voltage of the unit transistor 484 of the driver circuit 14. That is, variations in Vt of the driver transistors 11*a* in the pixels 16 cause the source-drain voltage applied to the unit transistors 484 to vary. Then, the source-drain voltage causes variations in the output voltage of the unit transistor 484 due to kinks.

Figure 123:
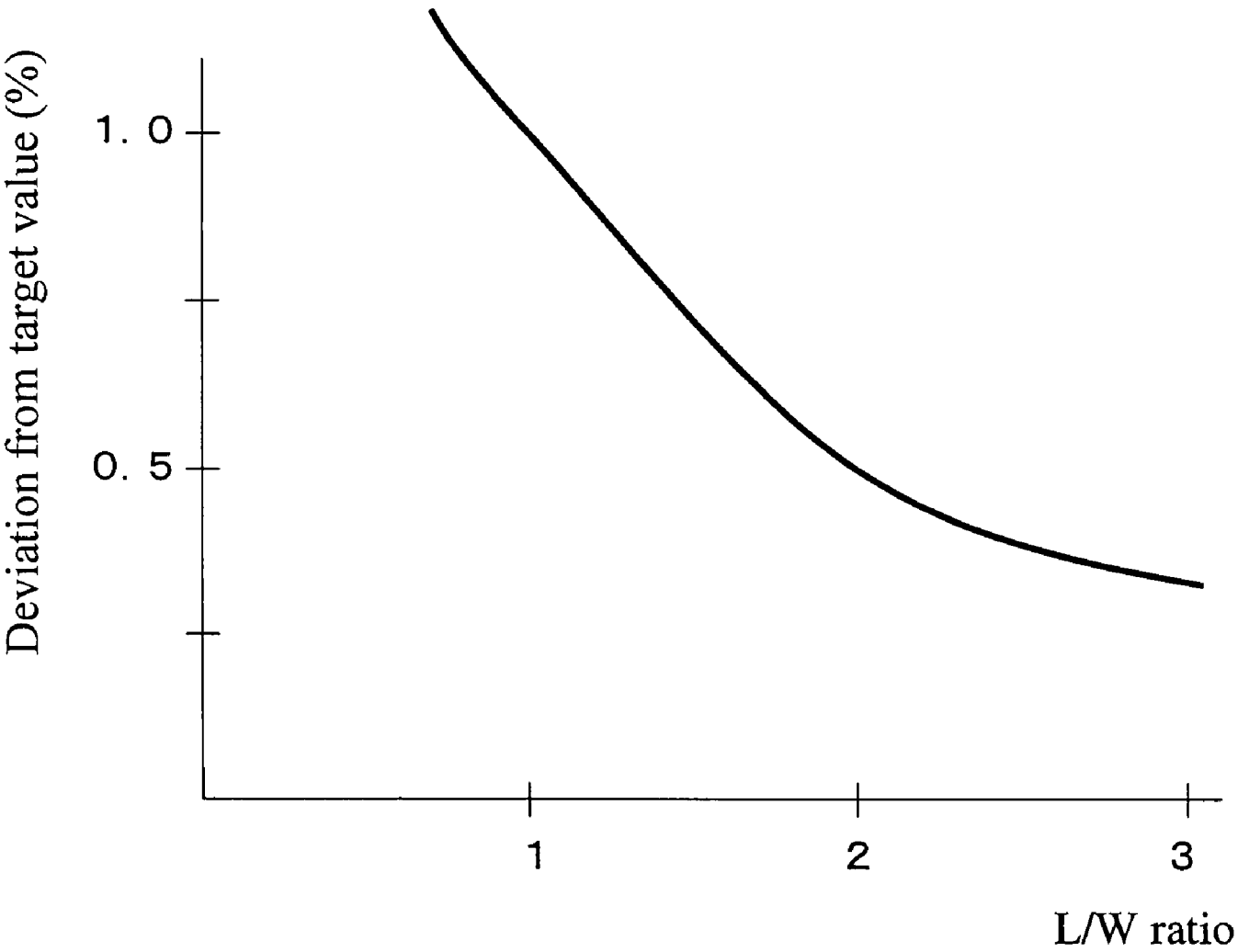

FIG. 123 is a graph showing deviation (variation) in L/W of unit transistors from a target value. When the L/W ratio of unit transistors is equal to smaller than 2, the deviation from the target value is large (the slope of the straight line is large). However, as L/W increases, the deviation from the target value tends to decrease. When L/W of unit transistors is equal to larger than 2, the deviation from the target value is small. Also, the deviation from the target value is 0.5% or less when L/W=2 or more. Thus, this value can be used for source driver circuits 14 to indicate accuracy of transistors. Incidentally, L is the channel length of the unit transistor 484 and W is the channel width of the unit transistor 484.

However, it is not that the channel length L of the unit transistor 484 can be increased indefinitely. The larger the channel length L, the larger the IC chip 14. Also, a large channel length L leads to increased gate terminal voltage in the unit transistor 484, increasing the power supply voltage required for the source driver IC 14. Increased power supply voltage involves the use of a highly voltage resistant IC process. A source driver IC 14 produced by a voltage resistant IC process leads to large variations in the output of the unit transistor 484 (see FIG. 121 and its description). Results of analysis indicate that preferably L/W should be 100 or less. More preferably, it should be 50 or less.

In view of the above circumstances, it is preferable that L/W of a unit transistor is two or more. Also, preferably L/W is 100 or less. More preferably, L/W is 40 or less.

Besides, L/W also depends on the number of gradations. If the number of gradations is small, there is no problem even if there are variations in the output current of the unit transistor 484 due to kink effect because there are large differences between gradations. However, in the case of a display panel with a large number of gradations, since there are small differences between gradations, even small variations in the output current of the unit transistor 484 due to kink effect will decrease the number of gradations.

Figure 120:
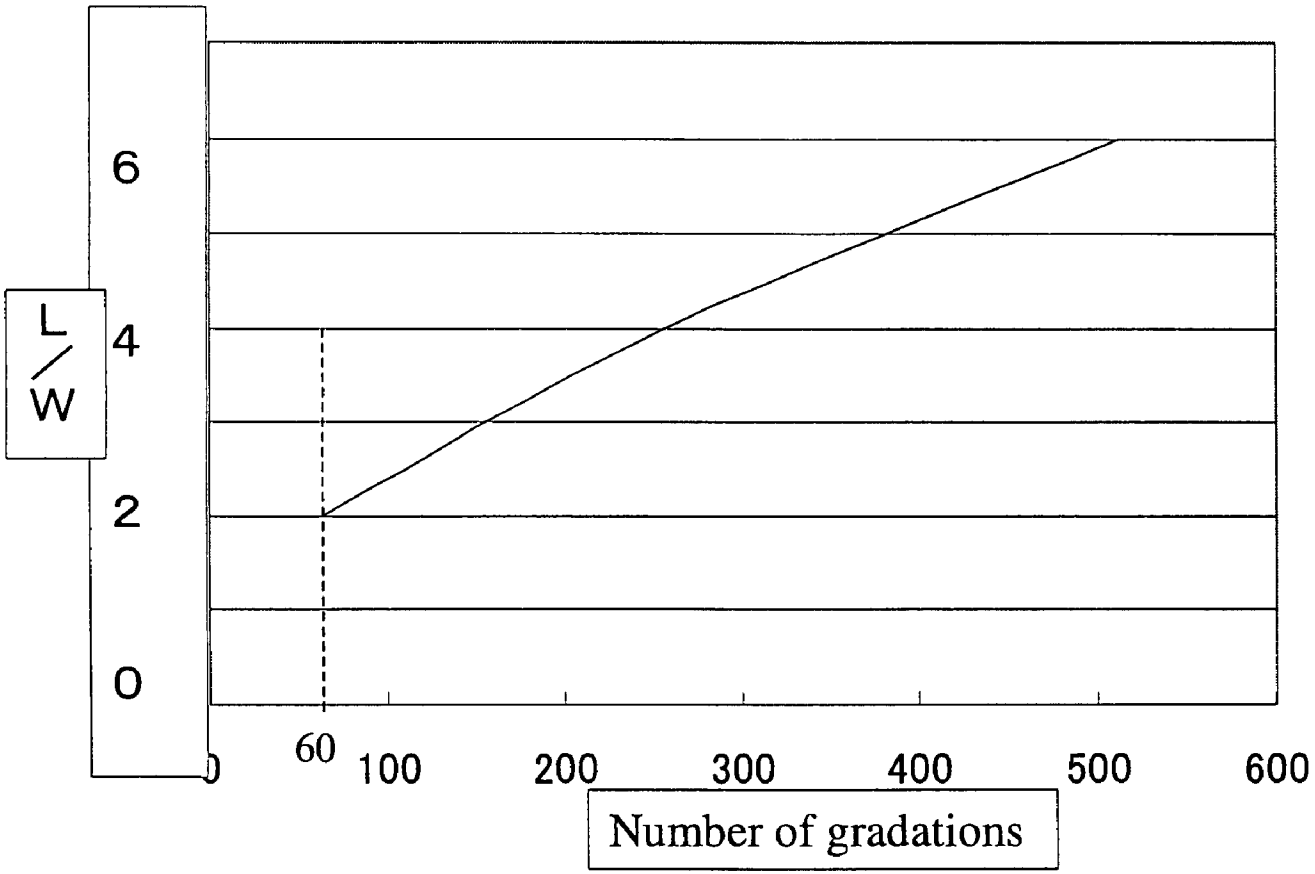

In view of the above circumstances, the driver circuit 14 according to the present invention is configured to satisfy the following relationship:

$$(\sqrt{(K/16)}) \leqq L/W \leqq \text{ and } (\sqrt{(K/16)}) \times 20$$

where K is the number of gradations, L is the channel length of the unit transistor 484, and W is the channel width of the unit transistor. This relationship is illustrated in FIG. 120. The area above the straight line in FIG. 120 is relevant to the present invention.

The variations in the output current of the unit transistor 484 also depend on the voltage resistance of the source driver IC 14. The voltage resistance of the source driver IC generally means the power supply voltage of the IC. For example, voltage resistance of 5 V means the use of the power supply voltage at a standard voltage of 5 V. Incidentally, IC voltage resistance can translate into maximum working voltage. Semiconductor IC makers have standardized voltage-resistance processes such as a 5-V voltage-resistance process and 10-V voltage-resistance process.

It is believed that film properties and film thickness of a gate insulating film of the unit transistor 484 have something to do with the fact that IC voltage resistance affects variations in the output current of the unit transistor 484. The transistors produced in a process with high IC voltage resistance have a thick gate insulating film. This is intended to avoid dielectric breakdown even under application of a high voltage. A thick gate insulating film makes its control difficult and increases variations in its film properties. This increases variations in the transistors. Also, the transistors produced in a high voltage-resistance process have low mobility. With low mobility, even slight changes in electrons injected into transistor gates cause changes in characteristics. This increases variations in the transistors. To reduce variations in the unit transistors 484, it is preferable to adopt an IC process with low IC voltage resistance.

Figure 121:
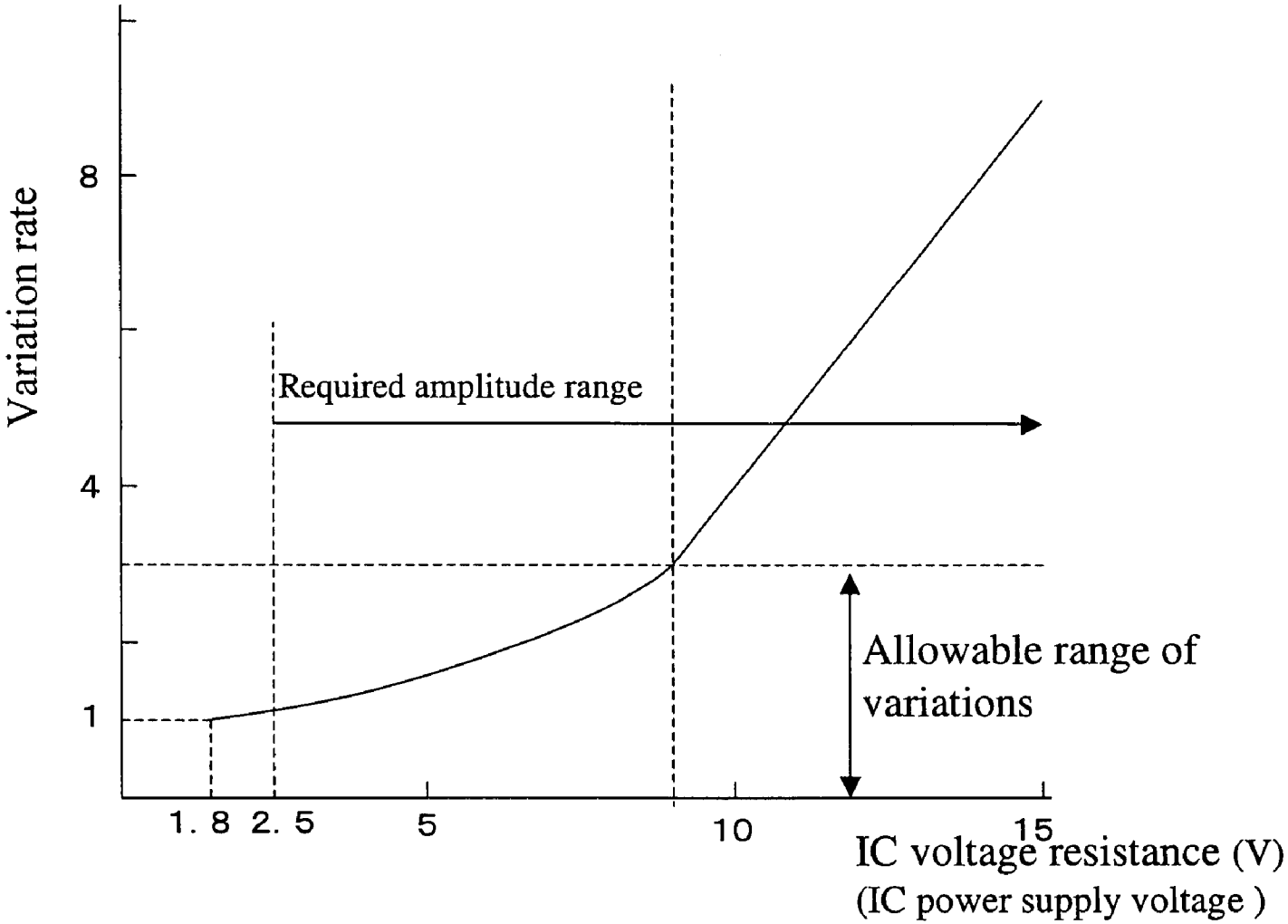

FIG. 121 illustrates relationship between IC voltage resistance and output variations of unit transistors 484. The variation rate on the vertical axis is based on the variation of unit transistors 484 produced in a 1.8-V voltage resistance process, which variation is taken to be 1. FIG. 121 shows output variations of unit transistors 484 which were produced in various IC voltage resistance processes and have a shape of L/W=12/6 (μm). A plurality of unit transistors 484 were produced in each IC voltage resistance process and variations in their output current were determined. The voltage resistance processes were composed discretely of 1.8-V voltage resistance, 2.5-V voltage resistance, 3.3-V voltage resistance, 5-V voltage resistance, 8-V voltage resistance, and 10-V voltage resistance, 15-V voltage resistance processes. However, for ease of explanation, variations in the transistors formed in the different voltage resistance processes are plotted on the graph and connected with straight lines.

As can be seen from FIG. 121, the variation rate (variations in the output current of the unit transistors 484) increases gradually up until an IC voltage resistance of 9 V. However, when the IC voltage resistance exceeds 10 V, the slope of the variation rate with respect to the IC voltage resistance becomes large.

In FIG. 121, the permissible limit to the variation rate is 3 for 64- to 256-gradation display. The variation rate varies with the area, L/W, etc. of the unit transistor 484. However, the variation rate with respect to the IC voltage resistance is hardly affected by the shape of the unit transistor 484. The variation rate tends to increase above an IC voltage resistance of 9 to 10 V.

On the other hand, the potential at an output terminal 681 in FIG. 48 varies with the programming current in the driver transistor 11*a* of the pixel 16. The gate terminal voltage of the driver transistor 11*a* is approximately equal to the potential of the source signal line 18. Also, the source signal line 18 and the output terminal 681 of the source driver IC (circuit) 14 are equal in potential. When the driver transistor 11*a* of the pixel 16 passes white raster (maximum white display) current, its gate terminal voltage is designated as Vw. When the driver transistor 11*a* of the pixel 16 passes black raster (completely black display) current, its gate terminal voltage is designated as Vb. The absolute value of Vw−Vb must be 2 V or larger. When the voltage Vw is applied to the output terminal 681, inter-channel voltage of the unit transistor 484 must be 0.5 V or higher.

Thus, a voltage of 0.5 V to ((Vw−Vb)+0.5) V is applied to the output terminal 681 (during current programming, the gate terminal voltage of the driver transistor 11*a* of the pixel 16 is applied to the output terminal 681, which is connected with the source signal line 18). Since Vw−Vb equals 2 V, a voltage of up to 2 V+0.5 V=2.5 V is applied to the output terminal 681. Thus, even if the output voltage (current) of the source driver IC 14 is based on a rail-to-rail circuit configuration (circuit configuration capable of outputting a voltage up to the IC power supply voltage), the IC voltage resistance must be 2.5V. The amplitude required by a terminal 741 is 2.5 V or more.

Thus, it is preferable to use a voltage resistance process in the range of 2.5-V to 10-V (both inclusive) for the source driver IC 14. More preferably, a voltage resistance process in the range of 3-V to 9-V (both inclusive) is used for the source driver IC 14.

Incidentally, it has been described that a voltage resistance process in the range of 2.5-V to 10-V (both inclusive) is used for the source driver IC 14. This voltage resistance is also applied to examples (e.g., a low-temperature polysilicon process) in which the source driver circuit 14 is formed directly on an array board 71. Working voltage resistance of a source driver circuit 14 formed directly on an array board 71 can be high and exceeds 15 V in some cases. In such cases, the power supply voltage used for the source driver circuit 14 may be substituted with the IC voltage resistance illustrated in FIG. 121. Also, the source driver IC 14 may have the IC voltage resistance substituted with the power supply voltage used.

Figure 122:
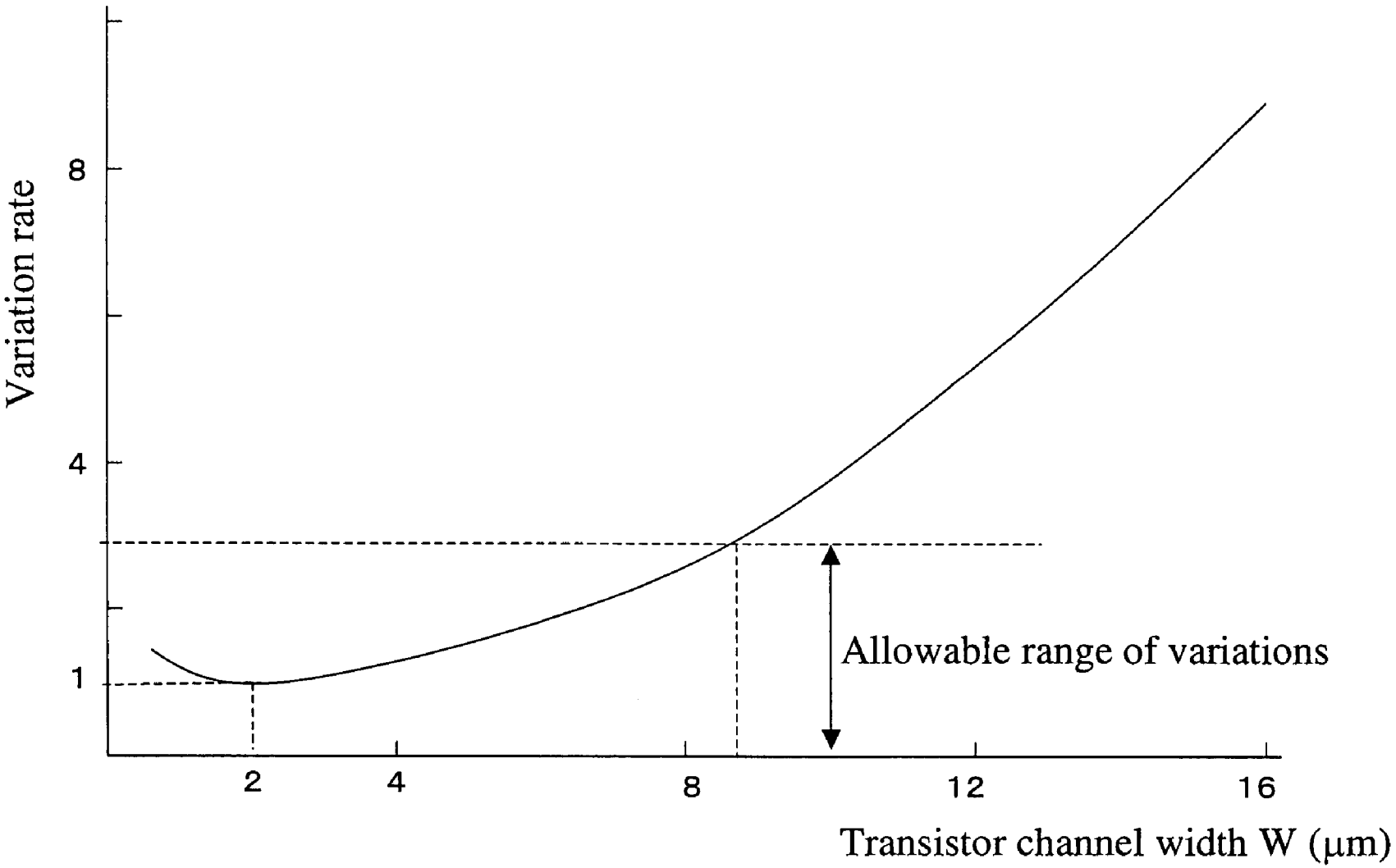

The area of a unit transistor 484 is correlated with the variations in its output current. FIG. 122 is a graph obtained by varying the transistor width W of a unit transistor 484 with the area of the unit transistor 484 kept constant. In F*igure* 122, the variation of the unit transistor 484 with a channel width W of 2 pm is taken as 1. The vertical axis of the graph represents a variation rate, where the variation which occurs when the channel width W is 2 μm is taken as 1.

As can be seen from FIG. 122, the variation rate increases gradually when W of the unit transistor 484 is from 2 μm to 9 or 10 μm. The increase in the variation rate tends to become large when W is 10 μm or more. Also, the variation rate tends to increase when the channel width W=2 μm or less.

In FIG. 122, the permissible limit to the variation rate is 3 for 64- to 256-gradation display. The variation rate varies with the shape of the unit transistor 484. However, the variation rate with respect to the channel width W resistance is hardly affected by the shape of the unit transistor 484.

Thus, preferably, the channel width W of the unit transistor 484 is from 2 μm to 10 μm (both inclusive). More preferably, the channel width W of the unit transistor 484 is from 2 μm to 9 μm (both inclusive). However, when the number of gradations is 64, a channel width W of 2 μm to 15 μm (both inclusive) is practically acceptable.

Figure 52:
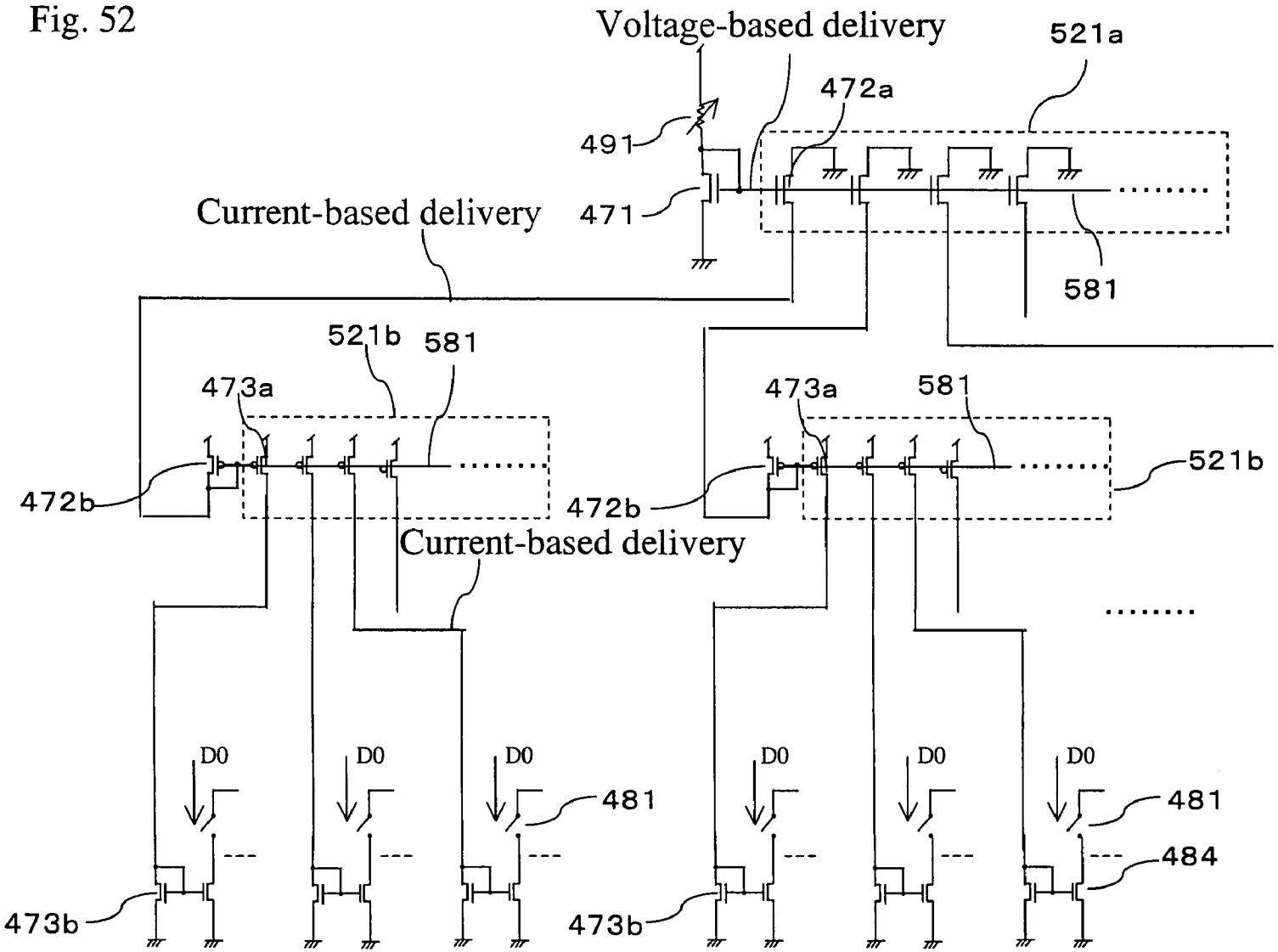
FIG. 52 is an explanatory diagram illustrating a drive circuit according to the present invention.

As illustrated in FIG. 52, current flowing through second-stage current mirror circuits 472*b* is copied to transistors 473*a* which compose third-stage current mirror circuits. If a current mirror ratio is 1, the current flows through transistors 473*b*. The current is copied to the unit transistor 484 in the final stage.

D0, which is provided by one unit transistor 484, provides the value of the current flowing through the unit transistor 473 of the final-stage current source. D1, which is provided by two unit transistors 484, provides a two times larger current value than the final-stage current source. D2, which is provided by four unit transistors 484, provides a four times larger current value than the final-stage current source; and D5, which is provided by 32 unit transistors 484, provides a 32 times larger current value than the final-stage current source. The above is based on the assumption that the mirror ratio of the final-stage current mirror circuits is 1.

Programming current Iw is output (drawn) to the source signal line via switches controlled by 6-bit image data consisting of D0, D1, D2, . . . , and D5. Thus, according to activation and deactivation of the 6-bit image data consisting of D0, D1, D2, . . . , and D5, currents 1 time, 2 times, 4 times, . . . and/or 32 times as large as the final-stage current source 473 are added and outputted to the output line. That is, according to activation and deactivation of the 6-bit image data consisting of D0, D1, D2, . . . , and D5, 0 to 63 times as large a current as the final-stage current source 473 is output from the output line (the current is drawn from the source signal line 18.

Figure 77:
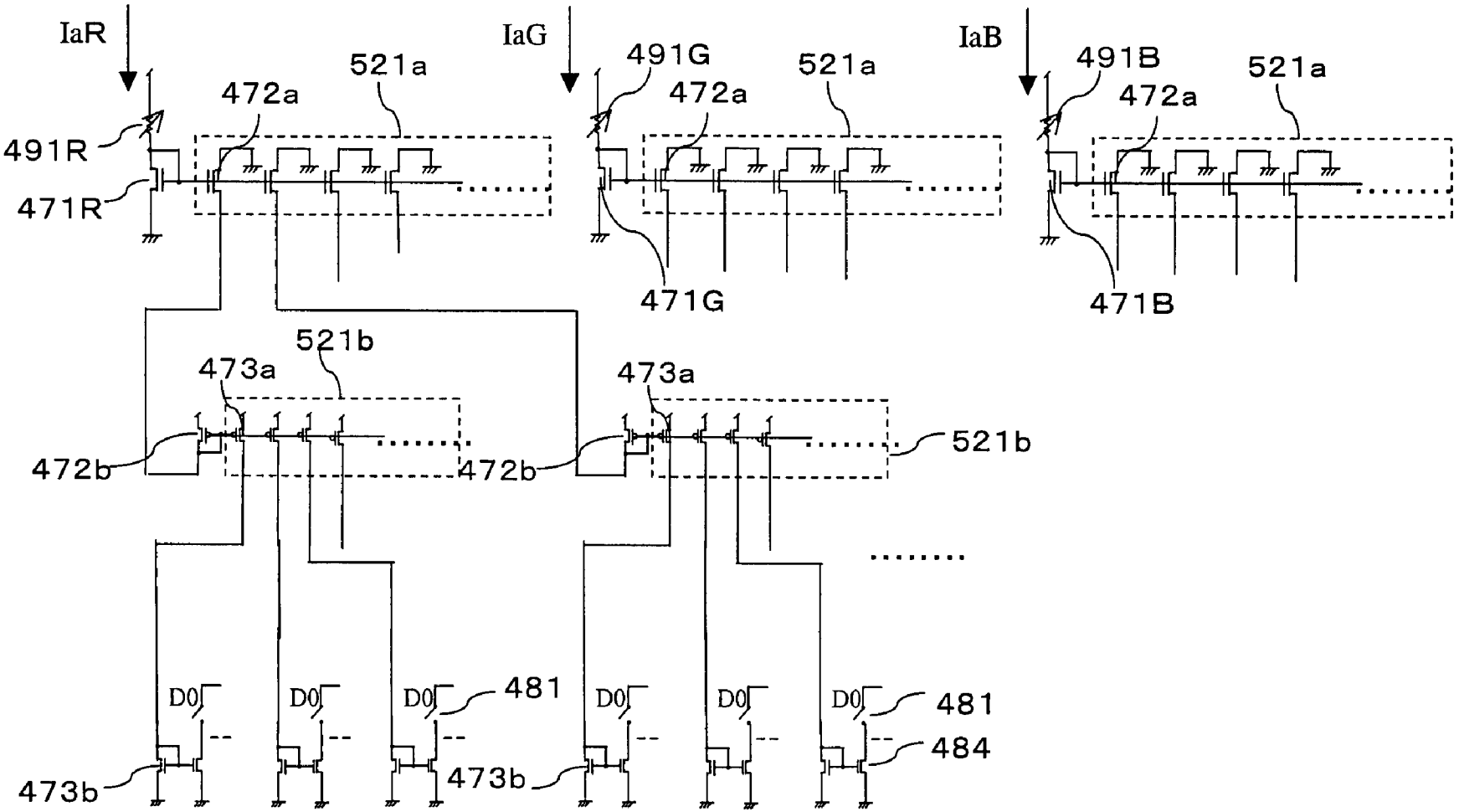
FIG. 77 is an explanatory diagram illustrating a drive circuit according to the present invention.

Actually, as illustrated in FIG. 77, in the source driver IC 14, reference currents (IaR, IaG, and IaB) for R, G, and B, respectively, can be adjusted by registers 491 (491R, 491G, and 491B). By adjusting the reference currents Ia, the white balance can be adjusted easily.

In order to achieve full-color display on an EL display panel, it is necessary to provide a reference current for each of R, G, and B. The white balance can be adjusted by controlling the ratios of the RGB reference currents. In the case of current driving as well as the present invention, the value of current passed by the unit transistor 484 is determined based on one reference current. Thus, the current passed by the unit transistor 484 can be determined by determining the magnitude of the reference current. Consequently, the white balance in every gradation can be achieved by setting a reference current for each of R, G, and B. The above matters work because the source driver circuit 14 produces current outputs varied in steps (is current-driven). Thus, the point is how the magnitude of the reference current can be set for each of R, G, and B.

The light emission efficiency of an EL element is determined by, or depends heavily on, the thickness of a film vapor-deposited or applied to the EL element. The film thickness is almost constant within each lot. Through lot control of the film thickness of the EL element 15, it is possible to determine relationship between the current passed through the EL element 15 and light emission efficiency. That is, the current value used for white balancing is fixed for each lot.

Figure 49:
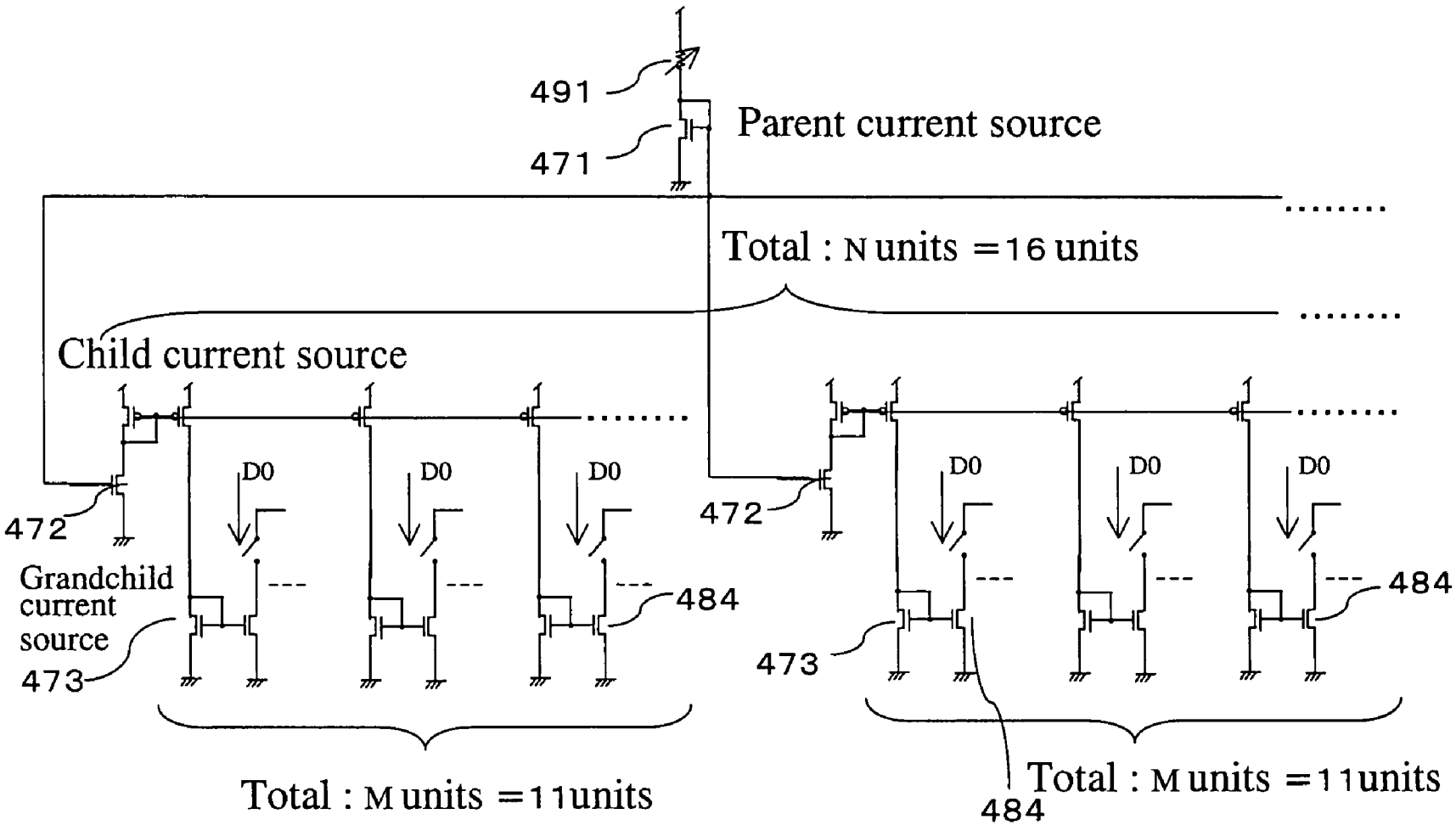
FIG. 49 is an explanatory diagram illustrating a drive circuit according to the present invention.

FIG. 49 is an exemplary circuit diagram showing 176 outputs (N×M=176) of a three-stage current mirror circuit. In FIG. 49, the current source 471 constituted of the first-stage current mirror circuit is referred to as a parent current source, the current sources 472 constituted of the second-stage current mirror circuits are referred to as child current sources, and the current sources 473 constituted of the third-stage current mirror circuits are referred to as grandchild current sources.

The use of an integral multiple for the third-stage current mirror circuits which are the final-stage current mirror circuits makes it possible to minimize variations in the 176 outputs and produce high-accuracy current outputs.

Incidentally, dense placement means placing the first current source 471 and the second current sources 472 (the current or voltage output and current or voltage input) at least within a distance of 8 mm. More preferably, they are placed within 5 mm. It has been shown analytically that when placed at this density, the current sources can fit into a silicon chip with little difference in transistor characteristics (Vt and mobility (μ)). Similarly, the second current sources 472 and third current sources 473 (the current output and current input) are placed at least within a distance of 8 mm. More preferably, they are placed within 5 mm. Needless to say, the above items also apply to other examples of the present invention.

The current or voltage output and current or voltage input mean the following relationships. In the case of voltage-based delivery shown in FIG. 50, the transistor 471 (the output) of the (I)-th current source and the transistor 472*a* (the input) of the (I+1)-th current source are placed close to each other. In the case of current-based delivery shown in FIG. 51, the transistor 471*a* (the output) of the (I)-th current source and the transistor 472*b* (the input) of the (I+1)-th current source are placed close to each other.

Incidentally, although it is assumed in FIGS. 49, 50, etc. that there is one transistor 471, this is not restrictive. For example, it is also possible to form a plurality of small sub-transistors 471 and connect the source or drain terminals of the sub-transistors with the register 491 to form a unit transistor 484. By connecting the plurality of small sub-transistors in parallel, it is possible to reduce variations of the unit transistor 484.

Similarly, although it is assumed that there is one transistor 472*a*, this is not restrictive. For example, it is also possible to form a plurality of small sub-transistors 472*a* and connect the gate terminals of the transistors 472*a* with the gate terminal of the transistor 471. By connecting the plurality of small transistors 472*a* in parallel, it is possible to reduce variations of the transistor 472*a*.

Thus, according to the present invention, the following configurations can be illustrated: a configuration in which one transistor 471 is connected with a plurality of transistors 472*a*, a configuration in which a plurality of transistors 471 are connected with one transistor 472*a*, and a configuration in which a plurality of transistors 471 are connected with a plurality of transistors 472*a*. These examples will be described in more detail below.

The above items also apply to a configuration of transistors 473*a* and 473*b* in FIG. 52 in FIG. 52. Possible configurations include a configuration in which one transistor 473*a* is connected with a plurality of transistors 473*b*, a configuration in which a plurality of transistors 473*a* are connected with one transistor 473*b*, and a configuration in which a plurality of transistors 473*a* are connected with a plurality of transistors 473*b*. By connecting the plurality of small transistors 473 in parallel, it is possible to reduce variations of the transistor 473.

The above items also apply to relationship between transistors 472*a* and 472*b* in FIG. 52. Also, preferably a plurality of transistors 473*b* are used in FIG. 48. Similarly, it is preferable to use plurality of transistors 473 in FIGS. 56 and 57.

Although it has been stated that the source driver IC 14 consists of a silicon chip, this is not restrictive. The source driver IC 14 may be constructed of another semiconductor chip formed on a gallium substrate or germanium substrate. Also, the unit transistor 484 may be a bipolar transistor, CMOS transistor, FET, Bi-CMOS transistor, or DMOS transistor. However, in terms of reducing variations in the output of the unit transistor 484, preferably a CMOS transistor is used for the unit transistor 484.

Preferably, the unit transistor 484 is an N-channel transistor. The unit transistor consisting of a P-channel transistor has 1.5 times larger output variations than the unit transistor consisting of an N-channel transistor.

Since it is preferable that the unit transistor 484 of the source driver IC 14 is an N-channel transistor, the programming current of the source driver IC 14 is a current drawn from the pixel 16. Thus, the driver transistor 11*a* of the pixel 16 is a P-channel transistor. The switching transistor 11*d* in FIG. 1 is also a P-channel transistor.

Thus, the configuration in which the unit transistor 484 in the output stage of the source driver IC (circuit) 14 is an N-channel transistor and the driver transistor 11*a* of the pixel 16 is a P-channel transistor is characteristic of the present invention. Incidentally, it is preferable that all the transistors (transistors 11*a*, 11*b*, 11*c*, and 11*d*) composing the pixel 16 are P-channel transistors. This eliminates the process of forming N-channel transistors, resulting in low costs and high yields.

Incidentally, although it has been stated that the unit transistor 484 is formed in the IC 14, this is not restrictive. The source driver circuit 14 may be formed by low-temperature polysilicon technology. In that case again, it is preferable that the unit transistors 484 in the source driver circuit 14 are N-channel transistors.

FIG. 51 shows an example of configuration for current-based delivery. FIG. 50 also shows an example of configuration for current-based delivery. FIGS. 50 and 51 are similar in terms of circuit diagrams and differ in layout configuration, i.e., wiring layout. In FIG. 50, reference numeral 471 denotes a first-stage N-channel current source transistor, 472*a* denotes a second-stage N-channel current source transistor, and 472*b* denotes a second-stage P-channel current source transistor.

In FIG. 51, reference numeral 471*a* denotes a first-stage N-channel current source transistor, 472*a* denotes a second-stage N-channel current source transistor, and 472*b* denotes a second-stage P-channel current source transistor.

In FIG. 50, the gate voltage of the first-stage current source consisting of a variable register 491 (used to vary current) and the N-channel transistor 471 is delivered to the gate of the N-channel transistor 472*a* of the second-stage current source. Thus, this is a layout configuration of a voltage-based delivery type.

In FIG. 51, the gate voltage of the first-stage current source consisting of a variable register 491 and the N-channel transistor 471*a* is applied to the gate of the N-channel transistor 472*a* of the adjacent second-stage current source, and consequently the value of the current flowing through the transistor is delivered to the P-channel transistor 472*b* of the second-stage current source. Thus, this is a layout configuration of a current-based delivery type.

Incidentally, although this example of the present invention focuses on relationship between the first current source and second current source for ease of explanation or understanding, this is not restrictive and it goes without saying that this example also applies (can be applied) to relationship between the second current source and third current source as well as relationship between other current sources.

In the layout configuration of the current mirror circuit of the voltage-based delivery type shown in FIG. 50, the N-channel transistor 471 of the first-stage current source and the N-channel transistor 472*a* of the second-stage current source composing the current mirror circuit are separated (or liable to get separated, to be precise), and thus the two transistors tend to differ in characteristics. Consequently, the current value of the first-stage current source is not transmitted correctly to the second-stage current source and there can be variations.

In contrast, in the layout configuration of the current mirror circuit of the current-based delivery type shown in FIG. 51, the N-channel transistor 471*a* of the first-stage current source and the N-channel transistor 472*a* of the second-stage current source composing the current mirror circuit are located adjacent to each other (easy to place adjacent to each other), and thus the two transistors hardly differ in characteristics. Consequently, the current value of the first-stage current source is transmitted correctly to the second-stage current source and there can be little variations.

In view of the above circumstances, it is preferable to use a layout configuration of the current-based delivery type instead of the voltage-based delivery type for the circuit configuration of the multi-stage current mirror circuit according to the present invention (the source driver IC (circuit) 14 of the current-based delivery type according to the present invention) in terms of reduced variations. Needless to say the above example can be applied to other examples of the present invention.

Incidentally, although delivery from the first-stage current source to the second-stage current source has been cited for the sake of explanation, the same applies to delivery from the second-stage current source to the third-stage current source, delivery from the third-stage current source to the fourth-stage current source, and soon. Also, it goes without saying that the present invention may adopt a single-stage current source configuration (see FIGS. 164, 165, 166, etc.)

FIG. 52 shows a current-based delivery version of three-stage current mirror circuit (three-stage current source) shown in FIG. 49 (which, therefore shows a circuit configuration of a voltage-based delivery type).

In FIG. 52, a reference current is created first by the variable register 491 and N-channel transistor 471. Incidentally, although it is stated that the reference current is adjusted by the variable register 491, actually the source voltage of the N-channel transistor 471 is set and regulated by an electronic regulator formed (or placed) in the source driver IC (circuit) 14. Alternatively, the reference current is adjusted by directly supplying the source terminal of the transistor 471 with current outputted from a current-type electronic regulator consisting of a large number of unit transistors (single-unit) 484 as shown in FIG. 48 (see FIG. 53).

The gate voltage of the first-stage current source constituted of the transistor 471 is applied to the gate of the N-channel transistor 472*a* of the adjacent second-stage current source, and the current consequently flowing through the transistor is delivered to the P-channel transistor 472*b* of the second-stage current source. Also, the gate voltage of the P-channel transistor 472*b* of the second-stage current source is applied to the gate of the N-channel transistor 473*a* of the adjacent third-stage current source, and the current consequently flowing through the transistor is delivered to the N-channel transistor 473*b* of the third-stage current source. A large number of unit transistors 484 are formed (placed) at the gate of the N-channel transistor 473*b* of the third-stage current source according to the required bit count as illustrated in FIG. 48.

Figure 53:
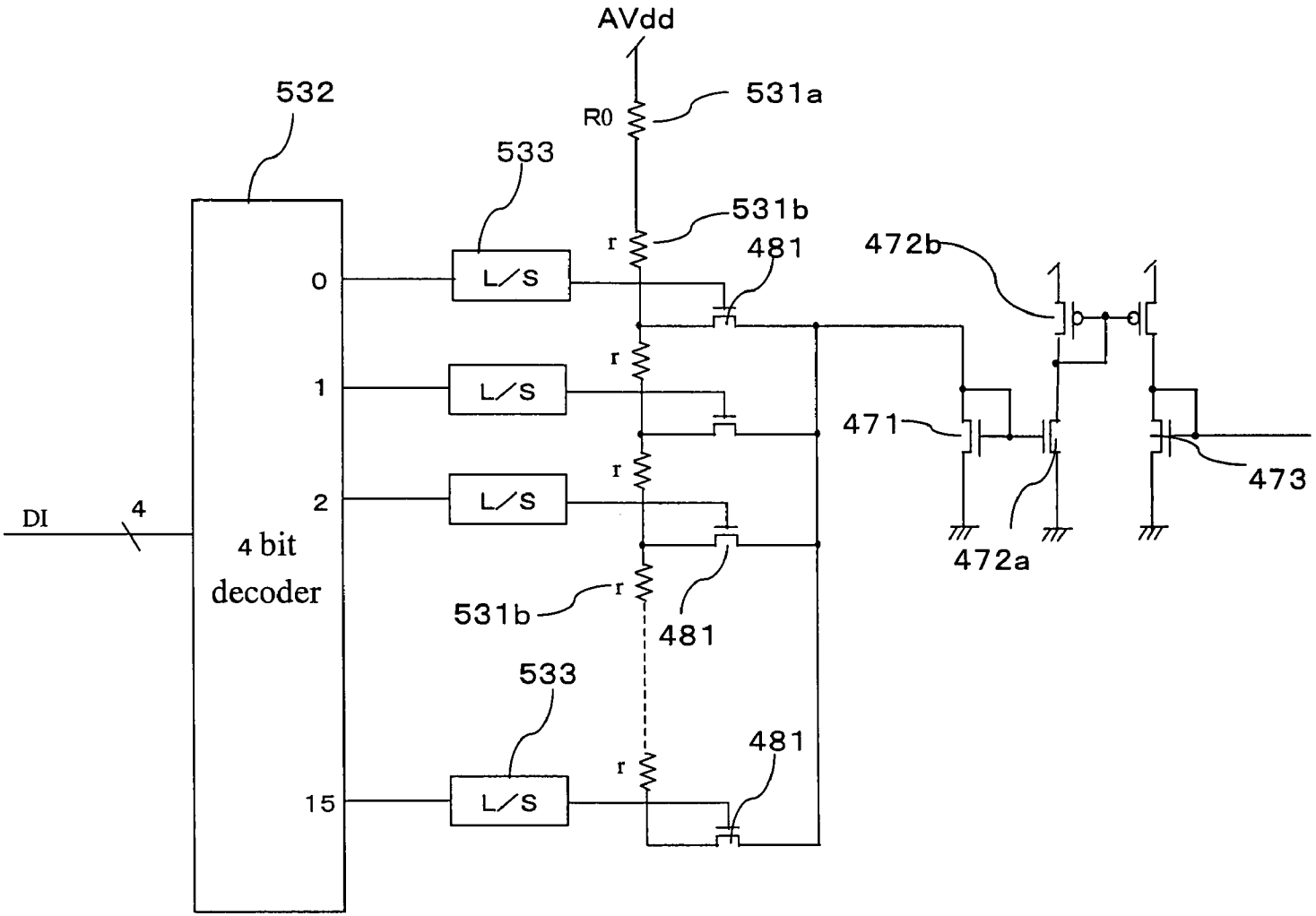
FIG. 53 is an explanatory diagram illustrating a drive circuit according to the present invention.

The configuration in FIG. 53 is characterized in that the first-stage current source 471 of the multi-stage current mirror circuit is equipped with a current-value adjustment element. This configuration allows output current to be controlled by varying the current value of the first-stage current source 471.

Variations in the Vt of transistors (variations in characteristics) are on the order of 100 mV within a wafer. However, variations in Vt of transistors formed within 100μ of each other should be 10 mV or less (actual measurement) That is, by configuring a current mirror circuit with transistors formed close to each other, it is possible to reduce variations in the output current of the current mirror circuit. This reduces variations in the output current among terminals of the source driver IC.

Incidentally, although variations in Vt are described as variations among transistors, variations among transistors are not limited to variations in Vt. However, since variations in Vt are a main cause of variations among transistors, it is assumed that the variations in Vt=the variations among transistors, for ease of understanding.

Figure 118:
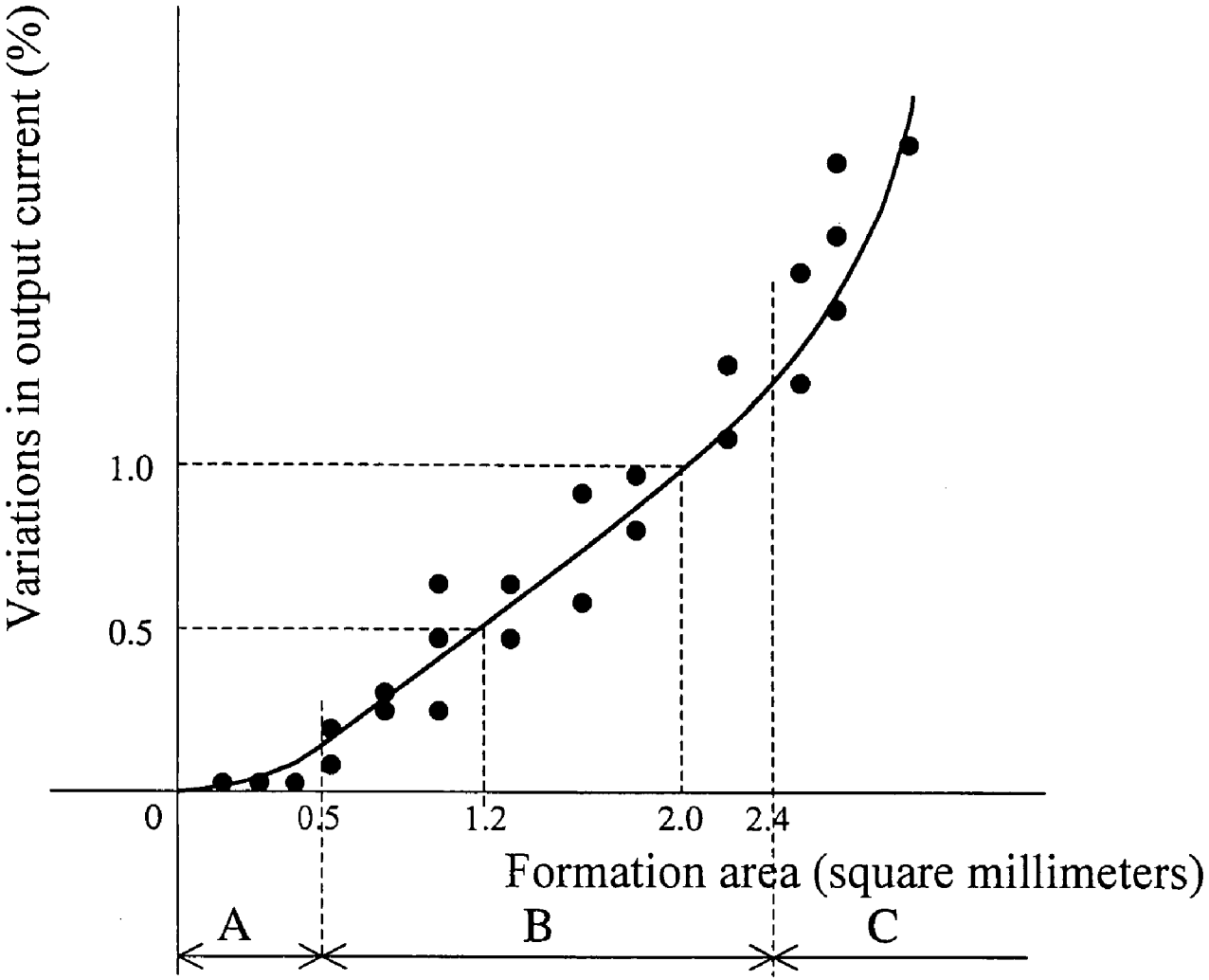
FIG. 118 is an explanatory diagram illustrating a drive circuit of a display apparatus according to the present invention.

FIG. 118 shows formation areas of transistors versus variations in the output current of unit transistors 484 based on measurement results. The variations in the output current are variations in current at a threshold voltage (Vt). Black dots indicate variations in the output current of evaluation sample transistors (10 to 200 in number) created in a formation area. There is almost no variation (output current variations only within a margin of error, meaning that a constant output current is produced) in the output current of transistors formed in area A (a formation area of 0.5 square millimeters or less) in FIG. 118. Conversely, in area C (a formation area of 2.4 square millimeters or more), variations in the output current with respect to the formation area tend to increase sharply. In area B (a formation area of 0.5 to 2.4 square millimeters), variations in the output current are almost proportional to the formation area.

However, the absolute value of output current varies from wafer to wafer. However, this problem can be dealt with by adjusting the reference voltage or setting it to a fixed value in the source driver circuit (IC) 14 of the present invention. Also, it can be dealt with (solved) by modifying the current mirror circuit ingeniously.

The present invention varies (controls) the amount of current flowing through the source signal line 18 by switching the number of currents flowing through the unit transistors 484 using input digital data (D). When the number of gradations is 64 or more, since 1/64=0.015, theoretically variations in output current should be within 1 to 2%. Incidentally, output variations within 1% are difficult to distinguish visually and output variations of 0.5% or below are impossible to distinguish (look uniform).

To keep output current variations (%) within 1%, the formation area of a transistor group (the transistors among which variations should be suppressed) should be kept within 2 square millimeters as indicated by the results shown in FIG. 118. More preferably, the output current variations (i.e., variations in the Vt of transistors) should be kept within 0.5%. That is, the formation area of a transistor group 521 can be kept within 1.2 square millimeters as indicated by the results shown in FIG. 118. Incidentally, the formation area is given by the vertical length multiplied by the horizontal length. For example, a formation area of 1.2 square millimeters results from 1 mm×1.2 mm.

The same applies to a set of unit transistors 484 (a block of 63 transistors 484 in the case of 64 gradations, see FIG. 48, etc.). The formation area of the set of unit transistors 484 should be kept within 2 square millimeters. More preferably, the formation area of the set of unit transistors 484 should be kept within 1.2 square millimeters.

Incidentally, the above applies to 8-bit (256 gradations) or larger data. For a smaller number of gradations, for example, in the case of 6-bit data (64 gradations), variations in output current may be somewhere around 2% (virtually no problem in terms of image display). In this case, the formation area of a transistor group 521 can be kept within 5 square millimeters. There is no need for the two transistor groups 521 (transistor groups 521*a* and 521*b* are shown in FIG. 52) to satisfy this condition. Effect of the present invention can be achieved if at least one of the transistor groups (one or more transistor groups 521 if there are more than three) satisfy the condition. Preferably, this condition should be satisfied for a lower level transistor group 521 (521*a* is higher than 521*b*). This will reduce image display problems.

In the source driver circuit (IC) 14 of the present invention, a plurality of current sources consisting of parent, child, and grandchild current sources are connected in multiple stages (of course there may be two stages consisting of parent and child current sources) and placed densely, as shown in FIG. 52. Current-based delivery is made between current sources (between the transistor groups 521). Specifically, transistors enclosed by dotted lines in FIG. 52 (transistor groups 521) are placed densely. The transistor groups 521 make voltage-based delivery between each other. The parent current source 471 and child current sources 472*a* are formed (placed) approximately in the center of the source chip. This makes it possible to relatively shorten the distance between the transistors 472*a* composing the child current sources placed on the left and right of the chip and the transistors 472*b* composing current child sources. That is, the top-level transistor group 521*a* is placed at the approximate center of the IC chip. Then, lower-level transistor groups 521*b* are placed on the left and right of the IC chip 14. Preferably, the transistors are placed, formed, or produced in such a way that approximately equal numbers of lower-level transistor groups 521*b* will be on the left and right of the IC chip 14. Incidentally, the above items are not limited to IC chips 14, but apply to source driver circuits 14 formed directly on array boards 71 using low-temperature polysilicon technology or high-temperature polysilicon technology. The same is true of the other items.

According to the present invention, one transistor group 521*a* is constructed, placed, formed, or built at the approximate center of the IC chip 14 and eight transistor groups 521*b* each are formed on the left and right of the chip (N=8+8, see FIG. 47). Preferably the child transistor groups 521*b* are arranged in such a way that their numbers will be equal on the left and right of the chip or that the difference between the number of the child transistor groups 521*b* formed or placed on the left with respect to the center of the chip where the parent is formed and the number of the child transistor groups 521*b* formed or placed on the right of the chip will be four or less. More preferably, the difference between the number of the child transistor groups 521*b* formed or placed on the left of the chip and the number of the child transistor groups 521*b* formed or placed on the right of the chip is one or less. The above items similarly apply to grandchild transistor groups (omitted in FIG. 52).

Voltage-based delivery (voltage connection) is made between the parent current source 471 and child current sources 472*a*. Consequently, tends to be affected by variations in the Vt of the transistors. Thus, the transistors in the transistor group 521*a* are placed densely. The formation area of the transistor group 521*a* is kept within 2 square millimeters. More preferably, it is kept within 1.2 square millimeters as shown in FIG. 118. If the number of gradations is 64 or less, of course, the formation area may be within 5 square millimeters.

Data is delivered between the transistor group 521*a* and child transistors 472*b* via current, and thus the current may flow some distance. Regarding the distance (e.g., between the output terminals of the higher-level transistor group 521*a* and input terminals of the lower-level transistor group 521*b*) the transistors 472*a* composing the second current sources (child) and the transistors 472*b* composing the second current sources (child) should be placed at least within 10 mm of each other as described above. Preferably, the transistors should be placed or formed within 8 mm. More preferably, they should be placed within 5 mm.

It has been shown analytically that differences in characteristics (Vt and mobility (μ)) of transistors placed in a silicon chip do not have much impact in the case of current-based delivery if the distance is within this range. Preferably, the above conditions are satisfied especially by lower-level transistor groups. For example, if the transistor group 521*a* is at the top level with the transistor groups 521*b* lying below it and transistor groups 521*c* lying further below them, the current-based delivery between the transistor groups 521*b* and transistor groups 521*c* should satisfy the above conditions. Thus, according to the present invention it is not always necessary that all the transistor groups 521 satisfy the above conditions. It is sufficient that at least a pair of transistor groups 521 satisfy the above conditions. This is because the lower the level, the more transistor groups 521 there are.

This similarly applies to the transistors 473*a* constituting the third (grandchild) current sources and transistors 473*b* constituting the third current sources. Needless to say, almost the same applies to voltage-based delivery.

The transistor groups 521*b* are formed, built, or placed in the left-to-right direction of the chip (in the longitudinal direction, i.e., at locations facing the output terminal 681). According to the present invention, the number M of the transistor groups 521*b* is 11 (see FIG. 47).

Voltage-based delivery (voltage connection) is made between the child current sources 472*b* and grandchild current sources 473*a*. Thus, the transistors in the transistor groups 521*b* are placed densely as is the case with the transistor group 521*a*. The formation area of the transistor group 521*b* should be within 2 square millimeters as shown in FIG. 118. More preferably, it should be within 1.2 square millimeters. However, even slight variations in the Vt of the transistors in the transistor groups 521*b* tend to appear on the screen. Thus, preferably the formation area should be area A (0.5 square millimeters or less) in FIG. 118.

Data is delivered between the grandchild transistors 473*a* and transistors 473*b* (current-based delivery), and thus the current may flow some distance in the transistor group 521*b*. The description of distances provided earlier applies here as well. The transistors 473*a* constituting the third (grandchild) current sources and transistors 473*b* constituting the second (grandchild) current sources should be placed within at least 8 mm of each other. More preferably, they should be placed within 5 mm.

FIG. 53 shows the current-value adjustment element constituted of an electronic regulator. The electronic regulator consists of a resister 531 (which is formed of polysilicon, controls current, and creates reference voltages), decoder circuit 532, level-shifter circuit 533, etc. Incidentally, the electronic regulator outputs current. A transistor 481 functions as an analog switch circuit.

Incidentally, in the source driver IC (circuit) 14, transistors may be referred to as current sources. This is because transistors function as current sources in current mirror circuits and the like composed of transistors.

Electronic regulators circuits are formed (or placed) according to the number of colors used by the EL display panel. For example, if the three primary colors RGB are used, preferably three electronic regulators are formed (or placed) corresponding to the colors so that the colors can be adjusted independently. However, if one color is used as a reference (is fixed), as many electronic regulators circuits as the number of colors minus 1 should be formed (or placed).

Figure 68:
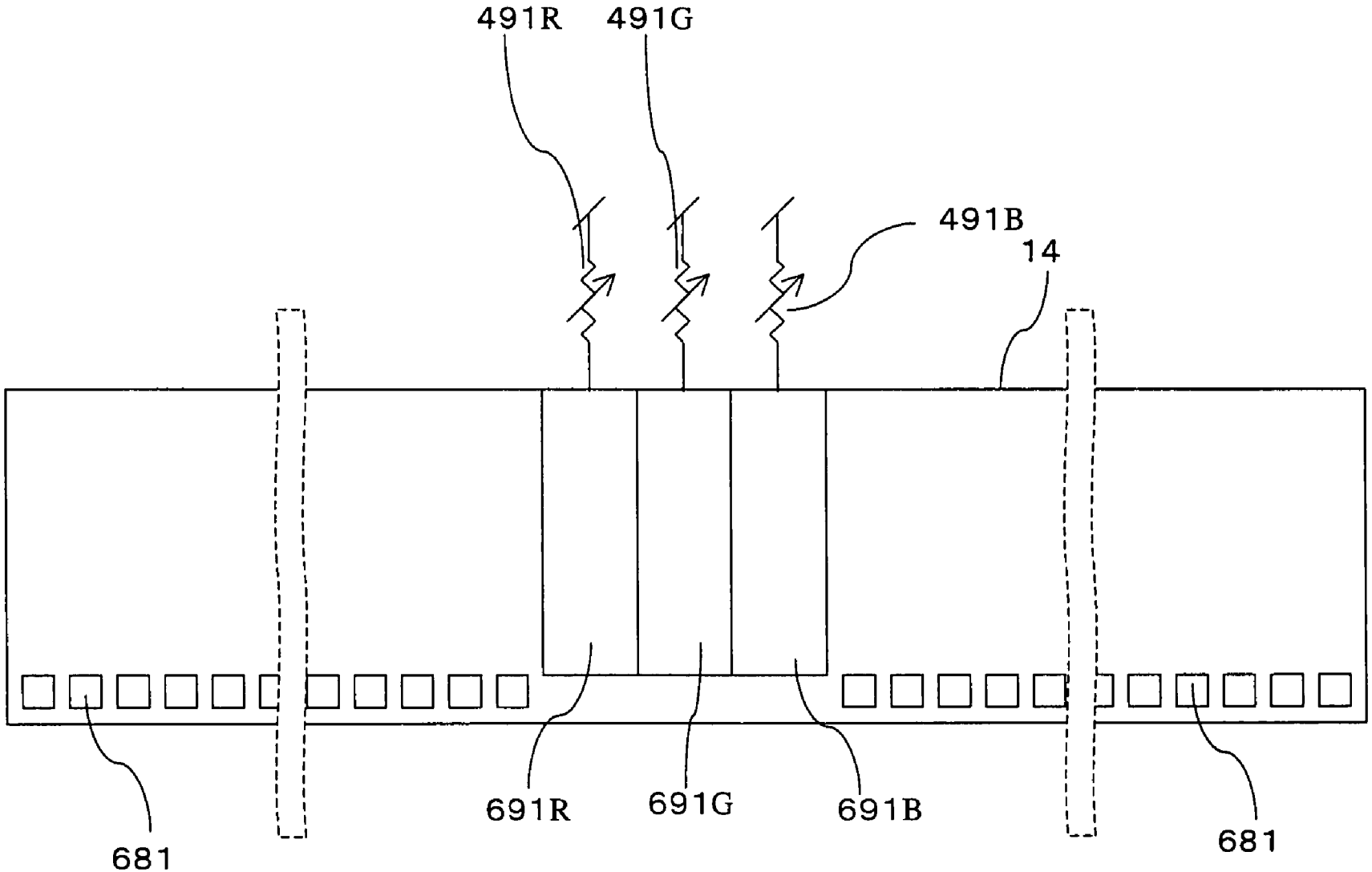
FIG. 68 is an explanatory diagram illustrating a drive circuit according to the present invention.

FIG. 68 shows a configuration in which resistive elements 491 are formed (or placed) to control reference voltages of the three primary colors RGB independently. Of course, it goes without saying that the resistive elements 491 may be substituted with electronic regulators. Also, resistive elements 491 may be built into the source driver IC (circuit) 14. Basic current sources including parent and child current sources such as the current source 471 and current sources 472 are placed densely with an output current circuit 654 in an area illustrated in FIG. 68. The dense placement reduces variations in outputs from the source signal lines 18. As illustrated in FIG. 68, by placing them in the output current circuit 691 at the center of the source driver IC (circuit) 14, it becomes easy to distribute current to the left and right of the source driver IC (circuit) 14 from the current source 471 and current sources 472, resulting in reduced output variations between the left and right sides (it is all right to place them in a reference current generator circuit or controller instead of the current output circuit. That is, 691 is an area where an output circuit is not formed).

However, it is not always necessary to place them in the output current circuit 654 at the center They may be placed at an end or both ends of the IC chip. Also, they may be formed or placed in parallel with the output current circuit 654.

It is not desirable to form a controller or output current circuit 654 in the center of the IC chip 14 because they are liable to be affected by Vt distribution of the unit transistors 484 in the IC chip 14 (the Vt of an wafer is distributed evenly in the wafer).

In the circuit configuration in FIG. 52, transistors 473*a* and transistors 473*b* are connected in a one-to-one relationship. In FIG. 51 again, transistors 472*a* and transistors 472*b* are connected in a one-to-one relationship.

However, if transistors are connected in a one-to-one relationship with other transistors, any variation in the characteristics (Vt, etc.) of a transistor will result in variations in the output of the corresponding transistor connected to it.

Figure 58:
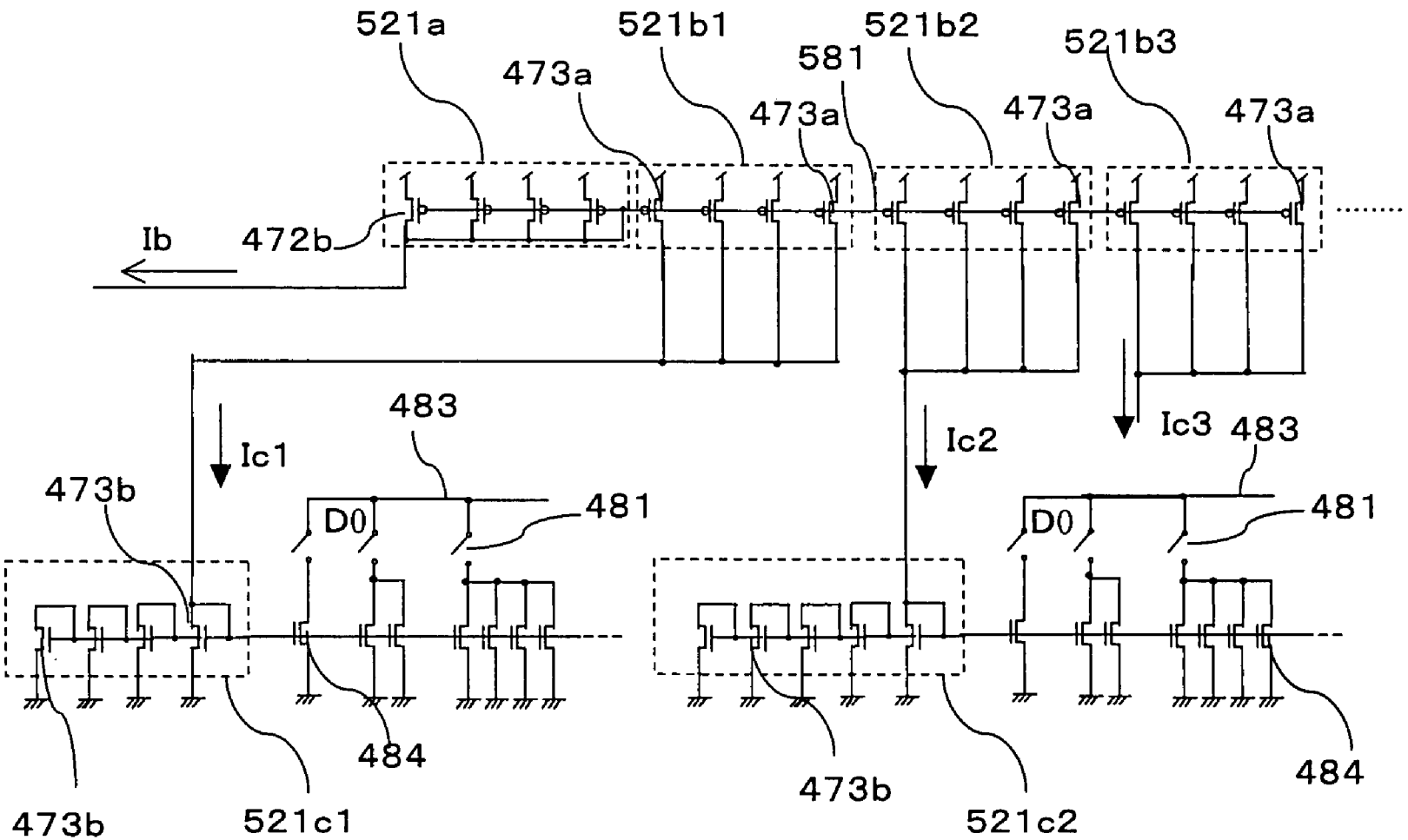
FIG. 58 is an explanatory diagram illustrating a drive circuit according to the present invention.

To solve this problem, an example with an appropriate configuration is shown in FIG. 58. In the configuration shown in FIG. 58, transmission transistor groups 521*b* (521*b*1, 521*b*2, and 521*b*3) each of which consists of four transistors 473*a* and transmission transistor groups 521*c* (521*c*1, 521*c*2, and 521*c*3) each of which consists of four transistors 473*b* are connected with each other. Although it has been stated that each of the transistor groups 521*b* and 521*c* consist of four transistors 473, this is not restrictive and may consist of less than four or more than four transistors. That is, a reference current Ib flowing through the transistors 473*a* is output from a plurality of transistors 473 which form a current mirror circuit together with the transistors 473*a* and the output current is received by a plurality of transistors 473*b*.

Preferably, the plurality of transistors 473*a* and plurality of transistors 473*b* are approximately equal in size and equal in number. Preferably, the unit transistors 484 (63 in number in the case of 64 gradations as in FIG. 48) each of which produces one output and the transistors 473*b* which compose a current mirror together with the unit transistors 484 are also approximately equal in size and equal in number. Specifically, the difference in size between the unit transistors 484 and transistors 473*b* are preferably within ±25%. The above configuration makes it possible to set a current mirror ratio accurately and reduce variations in output current. Incidentally, the area of a transistor is given by the product of the channel length L and channel width W of the transistor.

Preferably, the current flowing through the transistors 472*b* is equal to or more than five times a current Ic1 passed through the transistors 473*b*. This will stabilize the gate potential of the transistors 473*a* and suppress transient phenomena caused by output current.

Although it has been stated that the transmission transistor group 521*b*1 and transmission transistor group 521*b*2 are placed adjacent to each other and that each of them consists of four transistors 473*a* placed next to one another, this is not restrictive. For example, the transistors 473*a* of the transmission transistor group 521*b*1 and the transistors 473*a* of the transmission transistor group 521*b*2 may be placed or formed alternately. This will reduce variations in the output current (programming current) of each terminal.

The use of multiple transistors for current-based delivery makes it possible to reduce variations in output current of the transistor group as a whole and further reduce variations among the output current (programming current) of each terminal.

The total formation area of the transistors 473 composing a transmission transistor group 521 is an important item. Basically, the larger the total formation area of the transistors 473, the smaller the variations in output current (programming current flowing in from the source signal line 18). That is, the larger the formation area of the transmission transistor group 521 (the total formation area of the transistors 473), the smaller the variations. However, a larger formation area of the transistors 473 increases a chip area, increasing the price of the IC chip 14.

Incidentally, the formation area of a transmission transistor group 521 is the sum total of the formation areas of the transistors 473 composing the transmission transistor group 521. The area of a transistor is the product of the channel length Land channel width W of the transistor. Thus, if a transistor group 521 consists of ten transistors 473 whose channel length L is 10 μm and channel width W is 5 μm, the formation area Tm (square μm) of the transmission transistor group 521 is 10 μm×5 μm×10=500 (square μm).

The formation area of the transmission transistor group 521 should be determined in such a way as to maintain a certain relationship with the unit transistors 484. Also, the transmission transistor group 521*a* and transmission transistor group 521*b* should maintain a certain relationship.

Now, description will be given of the relationship between the formation area of the transmission transistor group 521 and the unit transistors 484. As also illustrated in FIG. 48, a plurality of unit transistors 484 are connected per one transistor 473*b*. In the case of 64 gradations, 63 unit transistors 484 correspond to one transistor 473*b* (configuration in FIG. 48). If the channel length L of the unit transistor 484 is 10 μm and channel width W of the unit transistor 473 is 10 μm, the formation area Ts (square μm) of the unit transistor group (63 unit transistors 484, in this example) is 10 μm ×10 μm×63 =6300 square μm.

The transistor 473*b* in FIG. 48 and transmission transistor groups 521*c* in FIG. 58 are relevant here. The formation area Ts of the unit transistor group and formation area Tm of the transmission transistor group 521*c* have the following relationship:

$$1/4 \leqq Tm/Ts \leqq 6$$

More preferably, the formation area Ts of the unit transistor group and formation area Tm of the transmission transistor group 521*c* have the following relationship:

$$1/2 \leqq Tm/Ts \leqq 4$$

By satisfying the above relationship, it is possible to reduce variations in the output current (programming current) of each terminal.

The formation area Tmm of the transmission transistor group 521*b* and formation area Tms of the transmission transistor group 521*c* have the following relationship:

$$1/2 \leqq Tmm/Tms \leqq 8$$

More preferably, the formation area Ts of the unit transistor group and formation area Tm of the transmission transistor group 521*c* have the following relationship:

$$1 \leqq Tm/Ts \leqq 4$$

By satisfying the above relationship, it is possible to reduce variations in the output current (programming current) of each terminal.

Suppose output current from the transistor group 521*b*1 is Ic1, output current from the transistor group 521*b*2 is Ic2, and output current from the transistor group 521*b*3 is Ic3. Then, the output currents Ic1, Ic2, and Ic3 must coincide. According to the present invention, since each transistor group 521 consists of multiple transistors 473, even if individual transistors 473 have variations, there is no variation in the output current Ic of the transistor group 521 as a whole.

Incidentally, the above example is not limited to three-stage current mirror connections (multi-stage current mirror connections) shown in FIG. 52. Needless to say, it is also applicable to single-stage current mirror connections. The example shown in FIG. 52 involves connecting the transistor groups 521*b* (521*b*1, 521*b*2, 521*b*3, . . . ) each of which consists of multiple transistors 473*a* with the transistor groups 521*c* (521*c*1, 521*c*2, 521*c*3, . . . ) each of which consists of multiple transistors 473*b*. However, the present invention is not limited to this. It is also possible to connect a single transistor 473*a* with the transistor groups 521*c* (521*c*1, 521*c*2, 521*c*3, . . . ) each of which consists of multiple transistors 473*b*, or to connect the transistor groups 521*b* (521*b*1, 521*b*2, 521*b*3, . . . ) each of which consists of multiple transistors 473*a* with one transistor 473*b*.

In FIG. 48, the switch 481*a* corresponds to the 0th bit, the switch 481*b* corresponds to the 1st bit, the switch 481*c* corresponds to the 2nd bit, . . . , and the switch 481*f* corresponds to the 5th bit. The 0th bit consists of one unit transistor, the 1st bit consists of two unit transistor, the 2nd bit consists of four unit transistor, . . . , and the 5th bit consists of thirty-two (32) unit transistor. For ease of explanation, it is assumed that the source driver circuit 14 is a 6-bit driver supporting 64-gradation display.

With the configuration of the source driver IC (circuit) 14 according to the present invention, the 1st bit outputs a twice larger programming current to the 0th bit, the 2nd bit outputs a twice larger programming current to the 1st bit, the 3rd bit outputs a twice larger programming current to the 2nd bit, the 4th bit outputs a twice larger programming current to the 3rd bit, the 5th bit outputs a twice larger programming current to the 4th bit. To put it in other words, each bit must be able to output twice as large programming current as the next lower-order bit.

Figure 60:
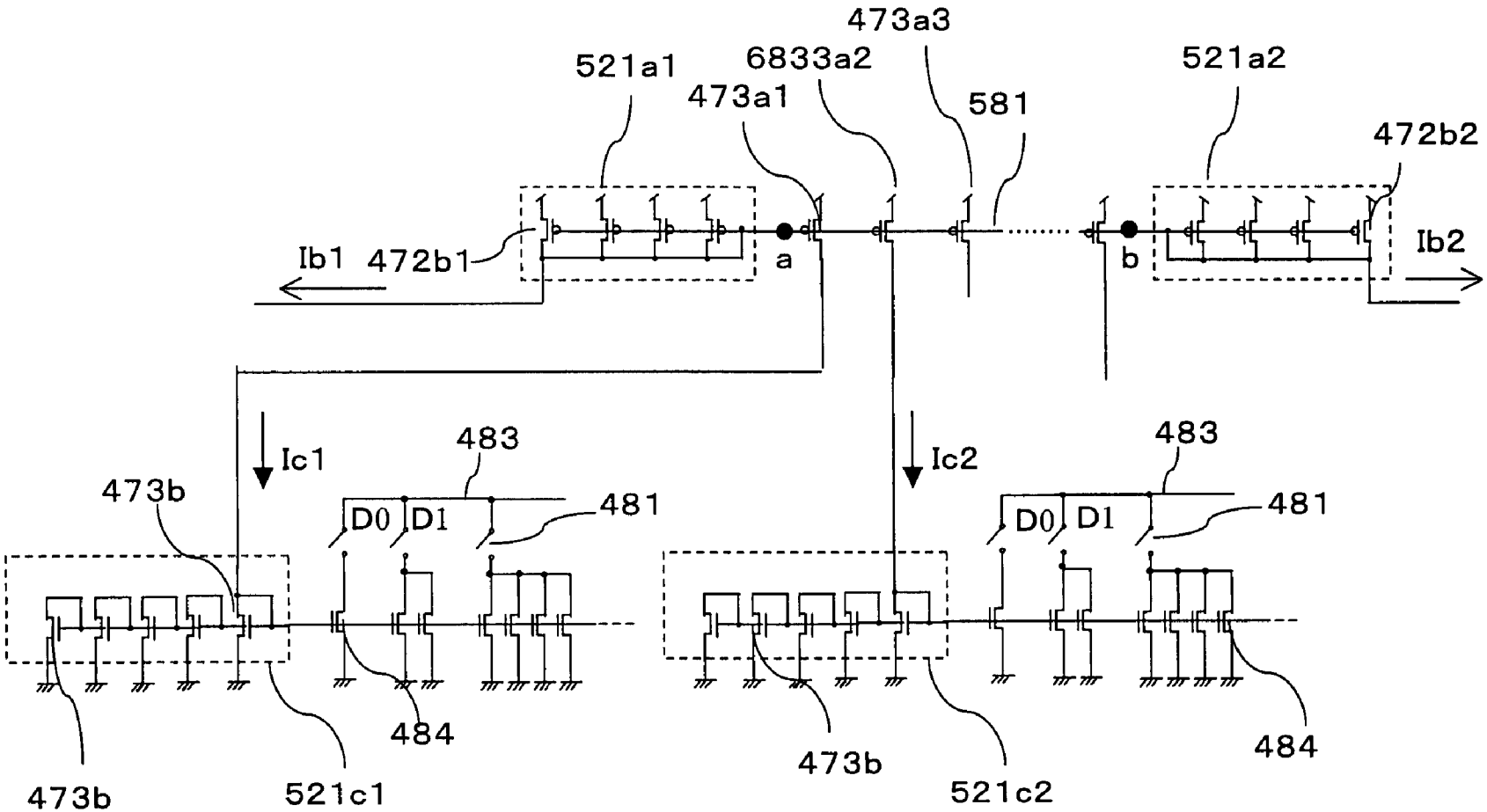
FIG. 60 is an explanatory diagram illustrating a drive circuit according to the present invention.

The configuration in FIG. 58 reduces variations in the output current of each terminal by making a plurality of transistors 473*b* receive output current from a plurality of transistors 473*a*. FIG. 60 shows a configuration which reduces variations in the output current of each terminal by supplying reference current from both sides of a transistor group. Multiple sources are provided for current Ib. Current Ib1 and current Ib2 have the same current value and the transistor which generates the current Ib1 and the transistor which generates the current Ib2 compose a current mirror circuit as a pair.

Thus, in this configuration, a plurality of transistors (current generating means) are formed, placed, or constructed to generate reference currents which prescribe output currents of the unit transistors 484. More preferably, output currents from the plurality of transistors are connected to current-receiving circuits such as transistors which compose current mirror circuits and the output currents of the unit transistors 484 are controlled by gate voltages generated by the plurality of transistors. Thus, this configuration contains a plurality of unit transistors 484 and a plurality of transistors 473*b* which compose current mirror circuits. FIG. 58 shows a transistor group consisting of 63 unit transistors 484 as well as five transistors composing current mirror circuits.

Preferably, the gate terminal voltage of the unit transistor 484 is set at 0.52 to 0.68 V (both inclusive) is a silicon IC chip is used. This range can reduce variations in the output current of the unit transistor 484. The above items similarly apply to other examples of the present invention in FIGS. 163, 164, 165, etc.

In FIG. 60, if the reference current Ib1 and reference current Ib2 are designed to be independently adjustable, voltages at point a and point b of a gate terminal 581 can be set freely. The adjustment of the reference currents Ib1 and Ib2 makes it possible to correct any slope of output current caused by difference in the Vt of unit transistors between the left and right sides of the IC chip 14.

Preferably, the currents generated by the transistors composing current mirror circuits are delivered by a plurality of transistors. Transistors formed in an IC chip 14 have variations in characteristics. To suppress variations in transistor characteristics, the size of the transistors can be increased. However, if transistor size is increased, the current mirror ratios of the current mirror circuits may deviate. To solve this problem, it is advisable to make current- or voltage-based delivery using a plurality of transistors. The use of multiple transistors decreases overall variations even if there are variations in the characteristics of individual transistors. This also improves the accuracy of current mirror ratios. All in all, the area of the IC chip is reduced as well.

In FIG. 58, the transistor group 521*a* and transistor groups 521*b* compose current mirror circuits. The transistor groups 521*a* consist of a plurality of transistors 472*b*. On the other hand, each of the transistor groups 521*b* consists of a plurality of transistors 473*a*. Similarly, each of the transistor groups 521*c* consists of a plurality of transistors 473*c*.

The transistor group 521*b*1, transistor group 521*b*2, transistor group 521*b*3, transistor group 521*b*4, and so on are composed of the same number of transistors 473*a*. Also, the total area of the transistors 473*a* is (approximately) equal among the transistor groups 521*b* (where the total area is the W and L sizes of the transistors 473*a* in each transistor group 521*b* multiplied by the number of the transistors 473*a*) The same applies to the transistor groups 521*c*.

Let Sc denote the total area of the transistors 473*b* in each transistor group 521*c* (where the total area is the W and L sizes of the transistors 473*b* in each transistor group 521*c* multiplied by the number of the transistors 473*b*). Also, let Sb dente the total area of the transistors 473*a* in each transistor group 521*b* (where the total area is the W and L sizes of the transistors 473*a* in each transistor group 521*b* multiplied by the number of the transistors 473*a*). Also, let Sa dente the total area of the transistors 472*b* in the transistor 521*a* (where the total area is the W and L sizes of the transistors 472*b* in the transistor group 521*a* multiplied by the number of the transistors 472*b*). Also, let Sd dente the total area of the unit transistors 484 per output (where the total area is the W and L sizes of the unit transistor 484 multiplied by 63).

Preferably, the total area Sc and the total area Sb are approximately equal. Also, it is preferably that the transistors 473*a* composing each transistor group 521*b* and the transistors 473*b* composing each transistor group 521*c* are equal in number. However, considering layout constraints on the IC chip 14, the transistors 473*a* composing each transistor group

521*b* may be made smaller in number and larger in size than the transistors 473*b* composing each transistor group 521*c*.

Figure 59:
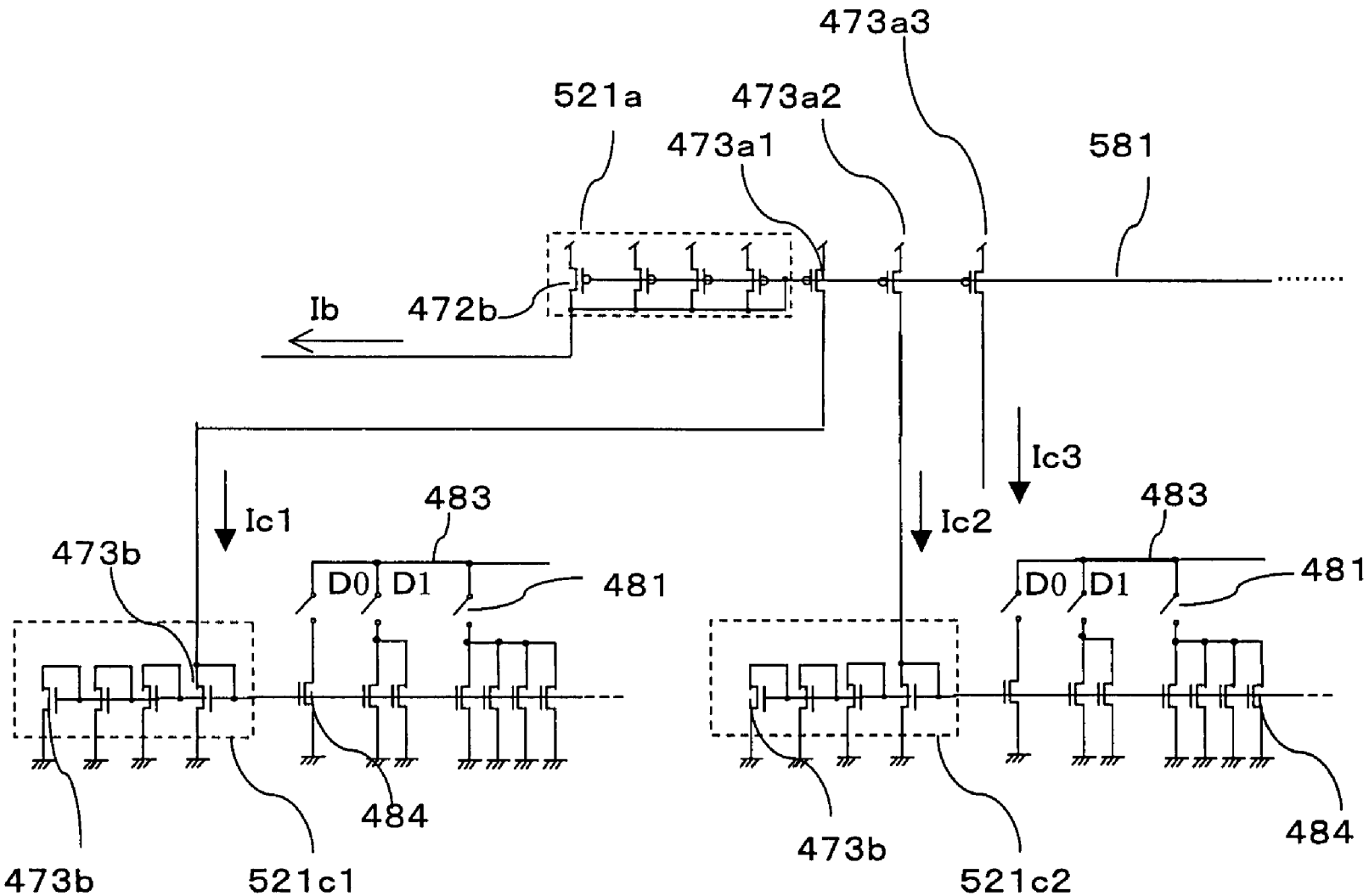
FIG. 59 is an explanatory diagram illustrating a drive circuit according to the present invention.

An example of the above configuration is shown in FIG. 59. The transistor group 521*a* consists of a plurality of transistors 472*b*. The transistor group 521*a* and transistors 473*a* compose a current mirror circuit. The transistors 473*a* generates current Ic. One transistor 473*a* drives a plurality of transistors 473*b* in a transistor group 521*c* (the current Ic from the single transistor 473*a* is shunted to the plurality of transistors 473*b*). Generally, the number of transistors 473*a* corresponds to the number of output circuits. For example, in a QCIF+ panel, there are 176 transistors 473*a* in each of R, G, and B circuits.

Figure 124:
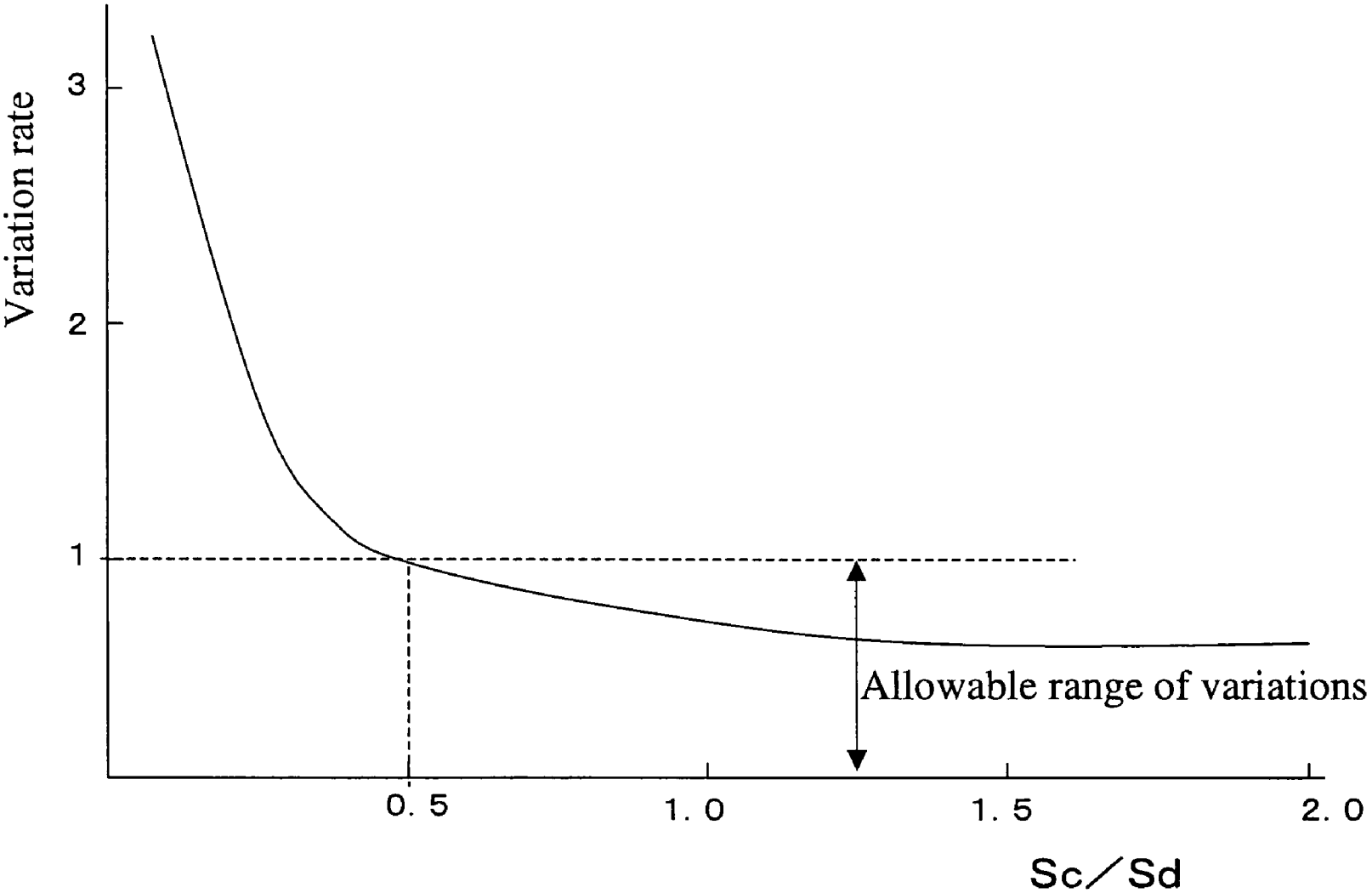

The relationship between the total area Sd and total area Sc is correlated with output variations. This correlation is shown in FIG. 124. For a variation rate and the like, refer to FIG. 121. The variation rate when total area Sd: total area Sc=2:1 (Sc/Sd=1/2) is taken as 1. As can bee seen from FIG. 124, a small Sc/Sd ratio results in a sharp deterioration in the variation rate. A poor variation rate results especially when Sc/Sd is 1/2 or less. Output variations decrease when Sc/Sd is 1/2 or above. The decrease is gradual. Output variations fall within an allowable range when Sc/Sd is around 1/2 or larger. In view of the above circumstances, it is preferable that $1/2 \leqq Sc/Sd$ is satisfied. However, a larger Sc means a larger IC chip. Thus, an upper limit of Sc/Sd=4 should be provided. That is, a relationship $1/2 \leqq Sc/Sd \leqq 4$ should be satisfied.

Incidentally, $A \geqq B$ means that A is equal to or larger than B. $A > B$ means that A is larger than B. $A \leqq B$ means that A is equal to or smaller than B. $A < B$ means that A is smaller than B.

Besides, preferably the total area Sd and total area Sc are approximately equal. Furthermore, preferably the number of the unit transistors 484 per output and the number of the transistors 473*b* in each transistor group 521*c* are equal. That is, in the case of 64 gradations, there are 63 unit transistors 484 per output. Thus, there are 63 transistors 473*b* in the transistor group 521*c*.

Also, preferably the transistor group 521*a*, transistor groups 521*b*, and the transistor groups 521*c* are composed of unit transistors 484 whose W/L ratio is within a factor of four. More preferably, they are composed of unit transistors 484 whose W/L ratio is within a factor of two. Even more preferably, they are composed of unit transistors 484 of the same size. That is, current mirror circuits and the output current circuit 654 are composed of transistors of approximately the same size.

The total area Sa should be larger than the total area Sb. Preferably, a relationship $200\,Sb \geqq Sa \geqq 4\,Sb$ is satisfied. Also, the total area Sa of the transistors 473*a* composing all the transistor groups 521*b* should be approximately equal to Sa.

Figure 61:
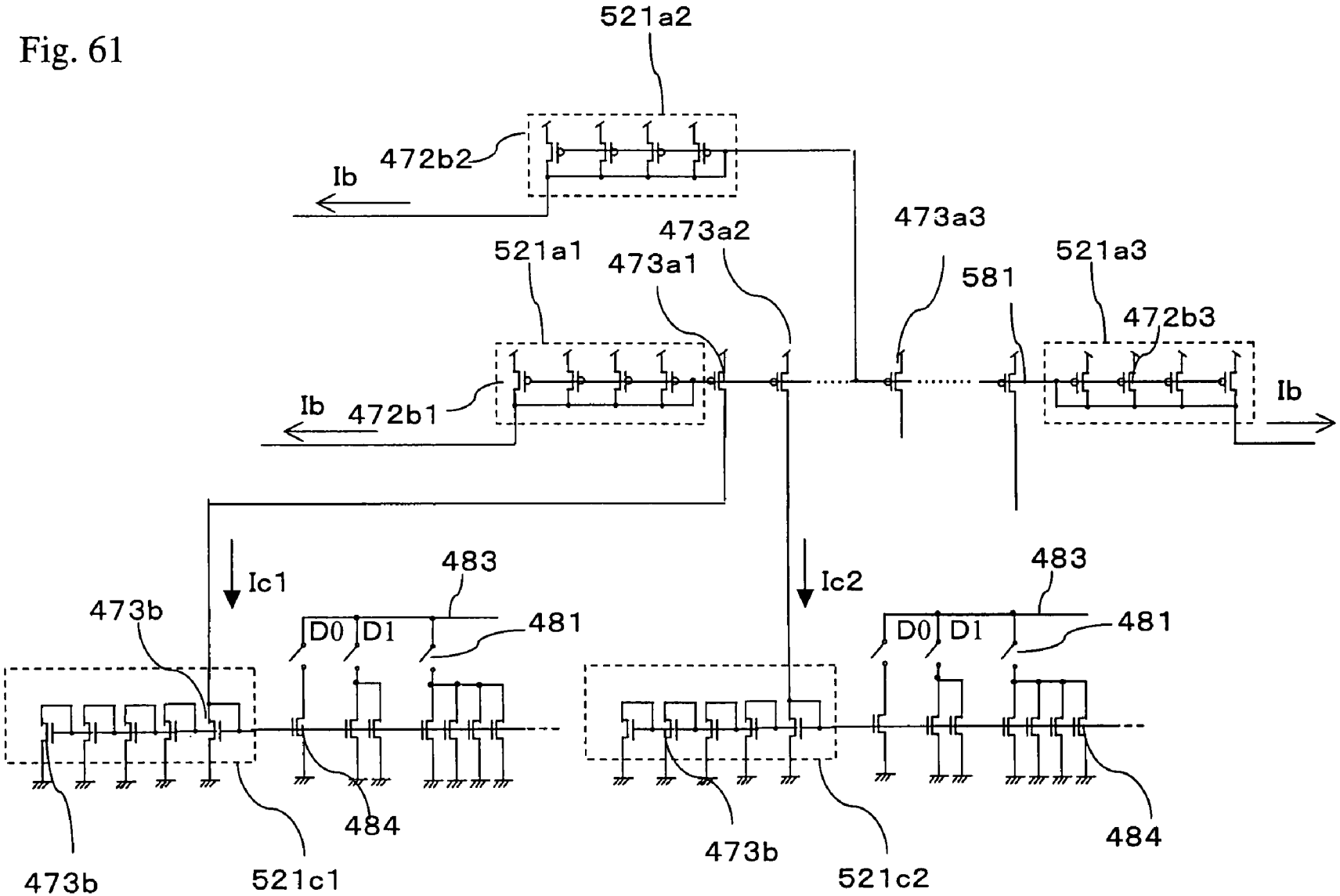
FIG. 61 is an explanatory diagram illustrating a drive circuit according to the present invention.

In the configuration shown in FIG. 60 and the like, a transistor or transistor group is placed at each end of the gate wiring 581. Thus, a total of two transistors or two transistor groups are placed at both ends of the gate wiring 581. However, the present invention is not limited to this. As illustrated in FIG. 61, a transistor or transistor group may be placed at the center or other location of the gate wiring 581. Three transistor groups 521*a* are formed in FIG. 61. The present invention is characterized in that a plurality of transistors or transistor groups 521 are formed on the gate wiring 581. The use of multiple transistors or transistor groups makes it possible to reduce the impedance of the gate wiring 581, resulting in improved stability.

Figure 62:
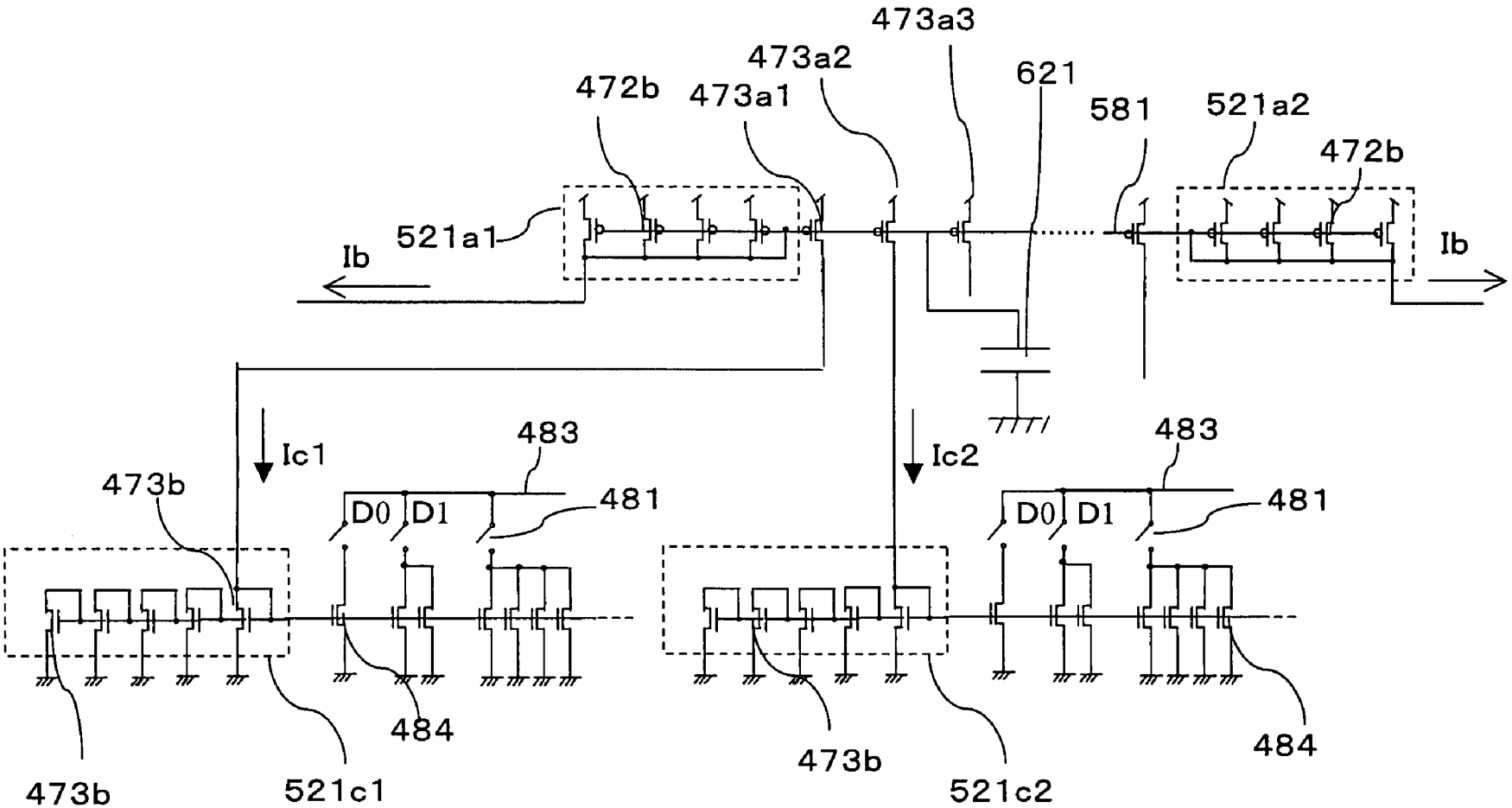
FIG. 62 is an explanatory diagram illustrating a drive circuit according to the present invention.

To further improve the stability, it is preferable to form or place a capacitor 661 on the gate wiring 581 as illustrated in FIG. 62. Alternatively, the capacitor 661 may be formed in the IC chip 14 or source driver circuit 14 or placed or mounted outside the chip as an external capacitor of the source driver IC 14. When mounting the capacitor 661 externally, a capacitor connection terminal is placed on an IC chip terminal.

The above example is configured to pass a reference current, copy the reference current using a current mirror circuit, and transmit the reference current to the unit transistor 484 in the final stage. When the image display is black display (complete black raster), current does not flow through any unit transistor 484 because every switch is open. Thus, 0 (A) current flows through the source signal line 18, consuming no power.

However, even during black raster display, reference currents flow. Examples include the current Ib and Ic in FIG. 63. They become reactive currents. Reference currents flow efficiently if configured to flow during current programming. Thus, the flow of reference current is limited during vertical and horizontal blanking periods of images. Also, the flow of reference current is limited during wait periods.

Figure 63:
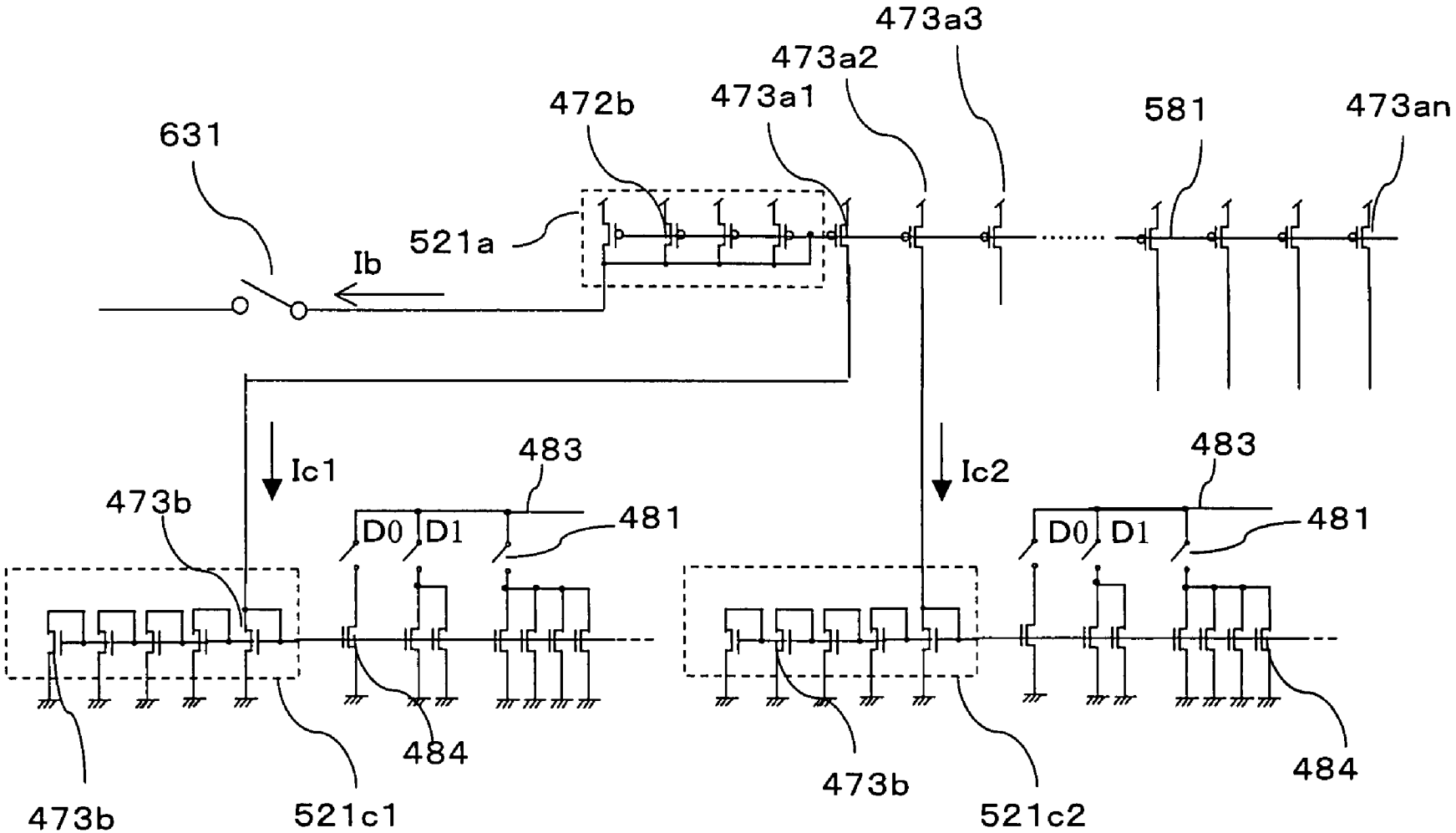
FIG. 63 is an explanatory diagram illustrating a drive circuit according to the present invention.

To prevent reference current from flowing, a sleep switch 631 can be opened as shown in FIG. 63. The sleep switch 631 is an analog switch. The analog switch is formed in the source driver circuit or source driver IC 14. Of course, the sleep switch 631 may be placed outside the source driver IC 14 and controlled.

When the sleep switch 631 is turned off, the reference current Ib stops flowing. Consequently, current does not flow through the transistors 473*a* in a transistor group 521*a*1, and the reference current Ic is also reduced to 0 A. Thus, current does not flow through the transistors 473*b* in a transistor group 521*c* either. This improves power efficiency.

Figure 64:
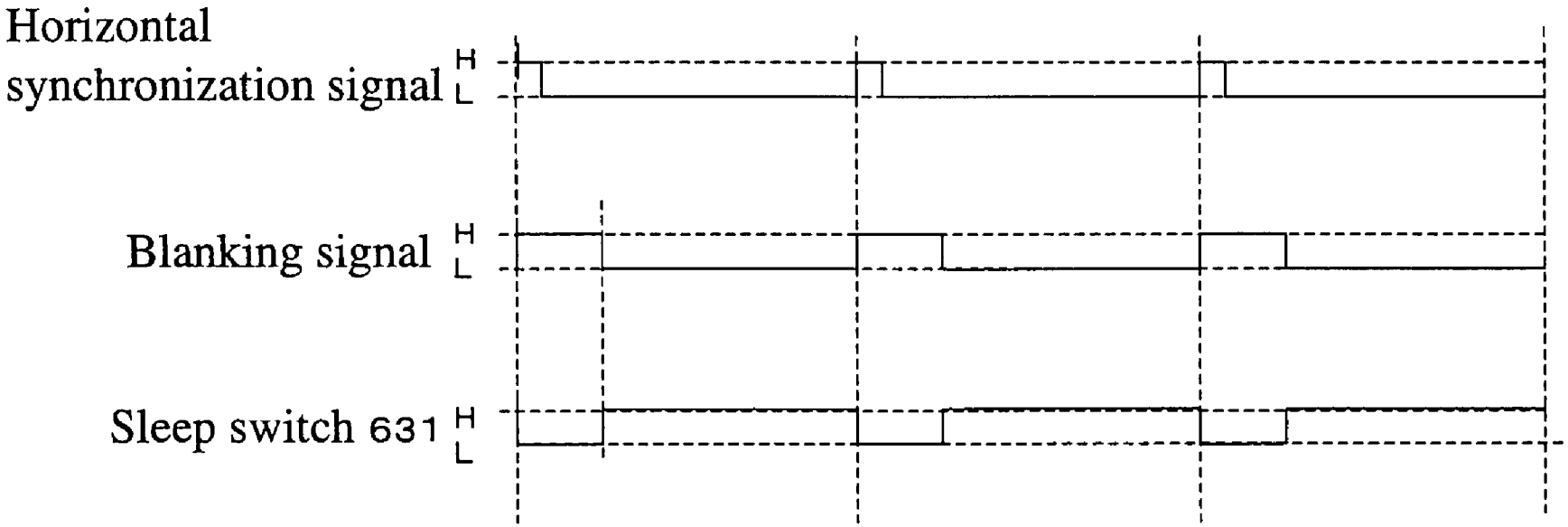
FIG. 64 is an explanatory diagram illustrating a drive circuit according to the present invention.

FIG. 64 is a timing chart. A blanking signal is generated in sync with a horizontal synchronization signal HD. The period when the blanking signal is high corresponds to a blanking period. When the blanking signal is low, a video signal is being applied. The sleep switch 631 is off (open) when the blanking signal is low, and on when the signal is high.

During a blanking period A when the sleep switch 631 is off, reference current does not flow. During a period D when the sleep switch 631 is on, the reference current flows.

Incidentally, on/off control of the sleep switch 631 may be performed according to image data. For example, when all image data in a pixel row is black image data (for a period of 1 H, the programming currents outputted to all source signal lines 18 are 0), the sleep switch 631 is turned off to stop reference currents (Ic, Ib, etc.) from flowing. Also, asleep switch may be formed or placed for each source signal line and be subjected to on/off control. For example, when an odd-numbered source signal line 18 is in black display mode (vertical black stripe display), the corresponding sleep switch is turned off.

FIGS. 52 and 77 are block diagrams of source driver circuits (ICs) 14 with a configuration of a current mirror with multi-stage connections. The present invention is not limited to multi-stage connection configuration such as the one shown in FIG. 52. It is also applicable to a source driver circuit with single stage connections. FIGS. 166 to 172 are block diagrams of source driver circuits (ICs) with a single stage connection.

With a source driver circuit with single stage connections, in particular, when images are displayed on a display panel, current applied to source signal lines 18 causes fluctuations in source signal line potential, which in turn cause the gate wiring 581 of the source driver IC 14 to swing. The swing is influenced by the power supply voltage of the source driver IC 14 because the power supply voltage swings to a maximum voltage. FIG. 163 shows a ratio of potential fluctuations of the gate wiring based on the value obtained when the power supply voltage of the source driver IC 14 is 1.8 V. The fluctuation ratio increases with increases in the power supply voltage of the source driver IC 14. An allowable range of fluctuation ratio is approximately 3. A higher fluctuation ratio will cause horizontal cross-talk. The fluctuation ratio with respect to the power supply voltage tends to increase when the power supply voltage of the IC is 10 to 12 V or higher. Thus, the power supply voltage of the source driver IC 14 should be 12 V or less.

On the other hand, in order for a driver transistor 11*a* switch from white-display current to black-display current, it is necessary to make a certain amplitude change to the potential of the source signal line 18. The required range of amplitude change is 2.5 V or more. It is lower than the power supply voltage because the output voltage of the source signal line 18 cannot exceed the power supply voltage.

Thus, the power supply voltage of the source driver IC 14 should be from 2.5 V to 12 V (both inclusive). The use of this range makes it possible to keep fluctuations in the gate wiring 581 within a stipulated range, eliminate horizontal cross-talk, and thus achieve proper image display.

Wiring resistance of the gate wiring 581 also presents a problem. In FIG. 167, the wiring resistance (Ω) of the gate wiring 581 is the resistance of the wiring throughout its length from transistor 473*b*1 to transistor 473*b*2 or the resistance of the gate wiring throughout its length. The magnitude of a transient phenomenon of the gate wiring 581 depends on one horizontal scanning period (1 H) as well because the shorter the period of 1 H, the larger the impact of the transient phenomenon. A larger wiring resistance (Ω) makes a transient phenomenon easier to occur. This phenomenon poses a problem especially for the configurations of single-stage current-mirror connections shown in FIGS. 166 to 172, in which the gate wiring 581 is long and connected with a large number of unit transistors 484.

FIG. 164 is a graph in which the horizontal axis represents the product (R·T) of wiring resistance (Ω) of the gate wiring 581 and 1-H period T (sec) while the vertical axis represents a fluctuation ratio. The fluctuation ratio is taken as 1 when R·T=100. As can be seen from FIG. 212, fluctuation ratio tends to grow larger when R·T is 5 or less. Fluctuation ratio also tends to grow larger when R·T is 1000 or more. Thus, it is preferable that R·T is from 5 to 100 (both inclusive).

In FIG. 167, the transistor 472*b* and two transistors 473*a* compose a current mirror circuit. The transistor 473*a*1 and transistor 473*a*2 are of the same size. Thus, current Ic passed by the transistor 473*a*1 and current Ic passed by the transistor 473*a*2 are identical.

In FIG. 167, the transistor groups 521*c* consisting of unit transistors 484 compose current mirror circuits together with the transistor 473*b*1 and transistor 473*b*2. There are variations in the output current of the transistor groups 521*c*. However, transistor groups 521 which compose a current mirror circuit in close vicinity to each other have their output current controlled accurately. The transistor 473*b*1 and transistor group 521*c*1 compose a current mirror circuit in close vicinity to each. Also, The transistor 473*b*2 and transistor group 521*cn* compose a current mirror circuit in close vicinity to each. If the current flowing through the transistor 473*b*1 and the current flowing through the transistor 473*b*2 are equal, the output current of the transistor group 521*c*1 and the output current of the transistor group 521*cn* are equal. If the current is generated in each IC chip accurately, the output currents of the transistor groups 521*c* at both ends of the output stage are equal in any IC chip. Thus, even if IC chips are cascaded, seams between ICs can be made inconspicuous.

As is the case with FIG. 62, a plurality of transistors 473*b* may be provided to form a transistor group 521*b*1 and transistor groups 521*b*2. Also, a plurality of transistors 473*a* may be provided to form a transistor group 521*a* as in FIG. 62.

Although it is shown in FIGS. 167 and 168 that the transistor 472*b* current is specified by the resistance R1, this is not restrictive. Electronic regulators 451*a* and 451*b* may be used as shown in FIG. 170. In the configuration shown in FIG. 170, the electronic regulators 451*a* and 451*b* can be operated independently. Thus, the values of the currents flowing through the transistors 472*a*1 and 472*a*2 can be changed. This makes it possible to adjust the slopes of the output currents in output stages 521*c* on the left and right sides of the chip. Incidentally, it is also possible to provide only one electronic regulator 451 as shown in FIG. 171 and use it to control two operational amplifiers 722. The sleep switch 631 has been described with reference to FIG. 63. Needless to say, a sleep switch may be placed or formed similarly as shown in FIG. 172.

The single-stage current-mirror configurations in FIGS. 166 to 172 contain very large numbers of unit transistors 484. Thus, an additional description will be given of the output stage of the source driver circuit 14. Incidentally, for ease of explanation, FIGS. 168 and 169 will be taken as an example. However, since the description concerns the number and total area of transistors 473*b* as well as the number and total area of unit transistors 484, it goes without saying that the description applies to other examples as well.

FIGS. 168 and 169, let Sb denote the total area of the transistors 473*b* in each transistor group 521*b* (where the total area is the W and L sizes of the transistors 473*b* in each transistor group 521*b* multiplied by the number of the transistors 473*b*). Incidentally, if transistor groups 521*b* are installed on the left and right of the gate wiring 581 as in FIGS. 168 and 169, the area is doubled. If there are two transistors, Sb equals the area of the transistor 473*b* multiplied by 2. If the transistor group 521*b* consists of a single transistor 473*b*, needless to say, Sb equals the size of the one transistor 473*b*.

Also, let Sc denote the total area of the unit transistors 484 in each transistor group 521*c* (where the total area is the W and L sizes of the transistors 484 in each transistor group 521*c* multiplied by the number of the transistors 484). It is assumed that the number of the transistor groups 521*c* is n. In the case of a QCIF+ panel, n is 176 (a reference current circuit is formed for each of R, G, and B).

In FIG. 165, the horizontal axis represents Sc×n/Sb and the vertical axis represents a fluctuation ratio. The fluctuation ratio in the best case is taken as 1. As illustrated in FIG. 165, the fluctuation ratio deteriorates with increases in Sc×n/Sb. A large value of Sc×n/Sb means that the total area of the unit transistors 484 in the transistor groups 521*c* is larger than the total area of the transistors 473*b* in the transistor groups 521*b* when the number n of output terminals is constant. In that case, the fluctuation ratio is unfavorable.

A small value of Sc×n/Sb means that the total area of the unit transistors 484 in the transistor groups 521*c* is smaller than the total area of the transistors 473*b* in the transistor groups 521*b* when the number n of output terminals is constant. In that case, the fluctuation ratio is small.

An allowable range of fluctuations corresponds to a value of Sc×n/Sb of 50 or less. When Sc×n/Sb is 50 or less, the fluctuation ratio falls within the allowable range and potential fluctuations of the gate wiring 581 is extremely small. This makes it possible to eliminate horizontal cross-talk, keep output variations within an allowable range, and thus achieve proper image display. It is true that the fluctuation ratio falls within the allowable range when Sc×n/Sb is 50 or less. However, decreasing Sc×n/Sb to 5 or less has almost no effect. On the contrary, Sb becomes large, increasing the chip area of the IC 14. Thus, preferably Sc×n/Sb to 5 should be from 5 to 50 (both inclusive).

If P-channel transistors are used as the transistors 11 of pixels 16, programming current flows in the direction from the pixels 16 to the source signal lines 18. Thus, N-channel transistors should be used as the unit transistors 484 of the source driver circuits 14 (see FIGS. 48 and 57). That is, the source driver circuits 14 should be configured in such a way as to draw the programming current Iw.

Thus, if the driver transistors 11*a* of the pixels 16 (in the case of FIG. 1) are P-channel transistors, the unit transistors 484 of the source driver circuits 14 must be N-channel transistors to ensure that the source driver circuits 14 will draw the programming current Iw. In order to form a source driver circuit 14 on an array board 71, it is necessary to use both mask (process) for N-channel transistors and mask (process) for P-channel transistors. Conceptually speaking, in the display panel (display apparatus) of the present invention, P-channel transistors are used for the pixels 16 and gate driver circuits 12 while N-channel transistors are used as the transistors of drawing current sources of the source drivers.

Thus, P-channel transistors are used as the transistors 11 of pixels 16 and for the gate driver circuits 12. This makes it possible to reduce the costs of the array boards 71. However, in the source driver circuits 14, unit transistors 484 must be N-channel transistors. Thus, the source driver circuits 14 can not be formed directly on array boards 71. Thus, the source driver circuits 14 are made of silicon chips and the like separately and mounted on the array board 71. In short, the present invention is configured to mount source driver circuits 14 (means of outputting programming current as video signals) externally.

Incidentally, although it has been stated that the source driver circuits 14 are made of silicon chips, this is not restrictive. For example, a large number of source driver circuits may be formed on a glass substrate simultaneously using low-temperature polysilicon technology or the like, cut off into chips, and mounted on an array board 71. Incidentally, although it has been stated that source driver circuits are mounted on an array board 71, this is not restrictive. Any form may be adopted as long as the output terminals 681 of the source driver circuits 14 are connected to the source signal lines 18 of the array board 71. For example, the source driver circuits 14 may be connected to the source signal lines 18 using TAB technology. By forming source driver circuits 14 on a silicon chip separately, it is possible to reduce variations in output current and achieve proper image display as well as to reduce costs.

The configuration in which P-channel transistors are used as selection transistors of pixels 16 and for gate driver circuits is not limited to organic EL or other self-luminous devices (display panels or display apparatus). For example, it is also applicable to liquid crystal display panels and FEDs (field emission displays).

If the switching transistors 11*b* and 11*c* of a pixel 16 are P-channel transistors, the pixel 16 becomes selected at Vgh, and becomes deselected at Vgl. As described earlier, when the gate signal line 17*a* changes from Vgl (on) to Vgh (off), voltage penetrates (penetration voltage). If the driver transistor 11*a* of the pixel 16 is a P-channel transistor, the penetration voltage restricts the flow of current through the transistor 11*a* in black display mode. This makes it possible to achieve a proper black display. The problem with the current-driven system is that it is difficult to achieve a black display.

According to the present invention, which uses P-channel transistors for the gate driver circuits 12, the turn-on voltage corresponds to Vgh. Thus, the gate driver circuits 12 match well with the pixels 16 constructed from P-channel transistors. Also, to improve black display, it is important that the programming current Iw flows from the anode voltage Vdd to the unit transistors 484 of the source driver circuits 14 via the driver transistors 11*a* and source signal lines 18, as is the case with the pixel 16 configuration shown in FIGS. 1, 2, 32, 113, and 116. Thus, a good synergistic effect can be produced if P-channel transistors are used for the gate driver circuits 12 and pixels 16, the source driver circuits 14 are mounted on the substrate, and N-channel transistors are used as the unit transistors 484 of the source driver circuits 14. Besides, unit transistors 484 constituted of N-channel transistors have smaller variations in output current than unit transistors 484 constituted of P-channel transistors. N-channel unit transistors 484 have 1/1.5 to 1/2 as large variations in output current as P-channel unit transistors 484 when they have the same area (W·L). For this reason, it is preferable that N-channel transistors are used as the unit transistors 484 of the source driver circuits 14.

The same applies to FIG. 42(*b*). FIG. 42(*b*) shows a configuration in which a programming current Iw flows from an anode voltage Vdd to the unit transistors 484 of a source driver circuit 14 via a programming transistor 11*a* and source signal line 18 rather than a configuration in which current flows into the unit transistors 484 of a source driver circuit 14 via a driver transistor 11*b*. Thus, as in the case of FIG. 1, a good synergistic effect can be produced if P-channel transistors are used for the gate driver circuits 12 and pixels 16, the source driver circuits 14 are mounted on the substrate, and N-channel transistors are used as the unit transistors 484 of the source driver circuits 14.

According to the present invention, the driver transistors 11*a* of the pixels 16 are P-channel transistors and the switching transistors 11*b* and 11*c* are P-channel transistors. Also, the unit transistors 484 in the output stages of the source driver circuits 14 are N-channel transistors. Besides, preferably P-channel transistors are used for the gate driver circuits 12.

Needless to say, a configuration in which P-channel and N-channel transistors are interchanged also works well. Specifically, the driver transistors 11*a* of the pixels 16 are N-channel transistors and the switching transistors 11*b* and 11*c* are N-channel transistors. Also, the unit transistors 484 in the output stages of the source driver circuits 14 are P-channel transistors. Besides, preferably N-channel transistors are used for the gate driver circuits 12. This configuration also belongs to the present invention.

Now, reference current circuits according to the present invention will be described below. As illustrated in FIG. 68, a reference current circuit 691 is formed (placed) for each of R, G, and B. Also, the reference current circuits 691R, 691G, and 691B are placed close to each other.

A regulator (electronic regulator) 491R for reference current adjustment is placed in a reference current circuit 691R for R, a regulator (electronic regulator) 491G for reference current adjustment is placed in a reference current circuit 691G for G, and a regulator (electronic regulator) 491B for reference current adjustment is placed in a reference current circuit 691B for B.

Figure 69:
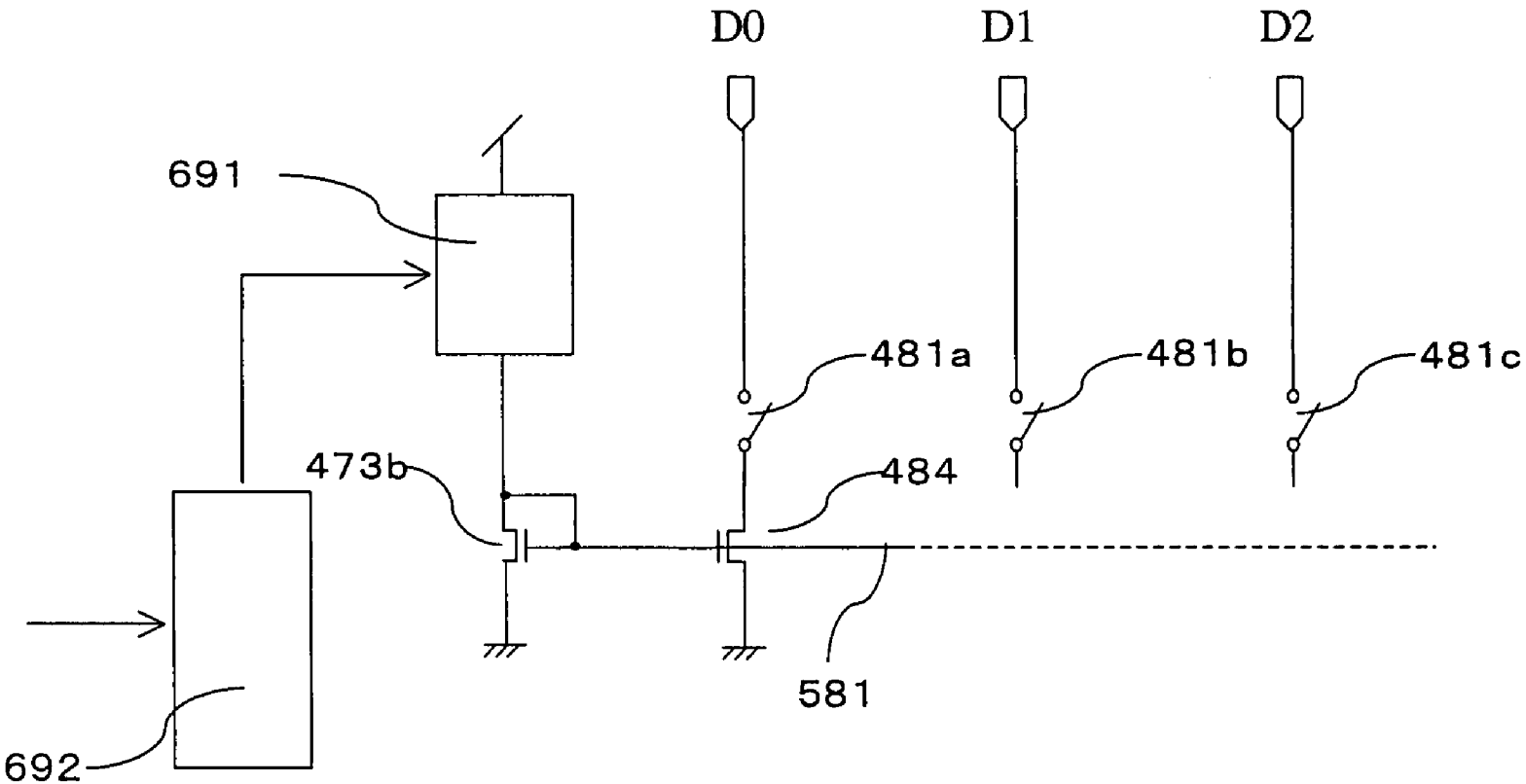
FIG. 69 is an explanatory diagram illustrating a drive circuit according to the present invention.

Preferably, the regulators 491 should be capable of accommodating temperature changes to compensate for temperature characteristics of the EL element 15. Also, as illustrated in FIG. 69, the reference current circuits 691 are controlled by current control circuits 692. By controlling (adjusting) the reference current, it is possible to vary unit current outputted from the unit transistors 484.

Output pads (output terminals) 681 are formed or placed on the output terminals of the IC chip and connected with the source signal lines 18 of the display panel. A bump is formed on the output pads 681 by a plating technique or ball bonding technique. The bump should be 10 to 40 μm high (both inclusive).

The bumps and the source signal lines 18 are connected electrically via a conductive bonding layer (not shown). The conductive bonding layer is made of a epoxy or phenolic base resin mixed with flakes of silver (Ag), gold (Au), nickel (Ni), carbon (C), tin oxide (SnO2), and the like, or made of a ultraviolet curing resin. The conductive bonding layer is formed on the bump by a transfer or other technique. Incidentally, the techniques for connecting the bumps or output pads 681 with the source signal lines 18 are not limited to those described above. Besides, a film carrier technique may be used instead of mounting the IC 14 on the array board. Also, polyimide films may be used for connection with the source signal lines 18.

Figure 70:
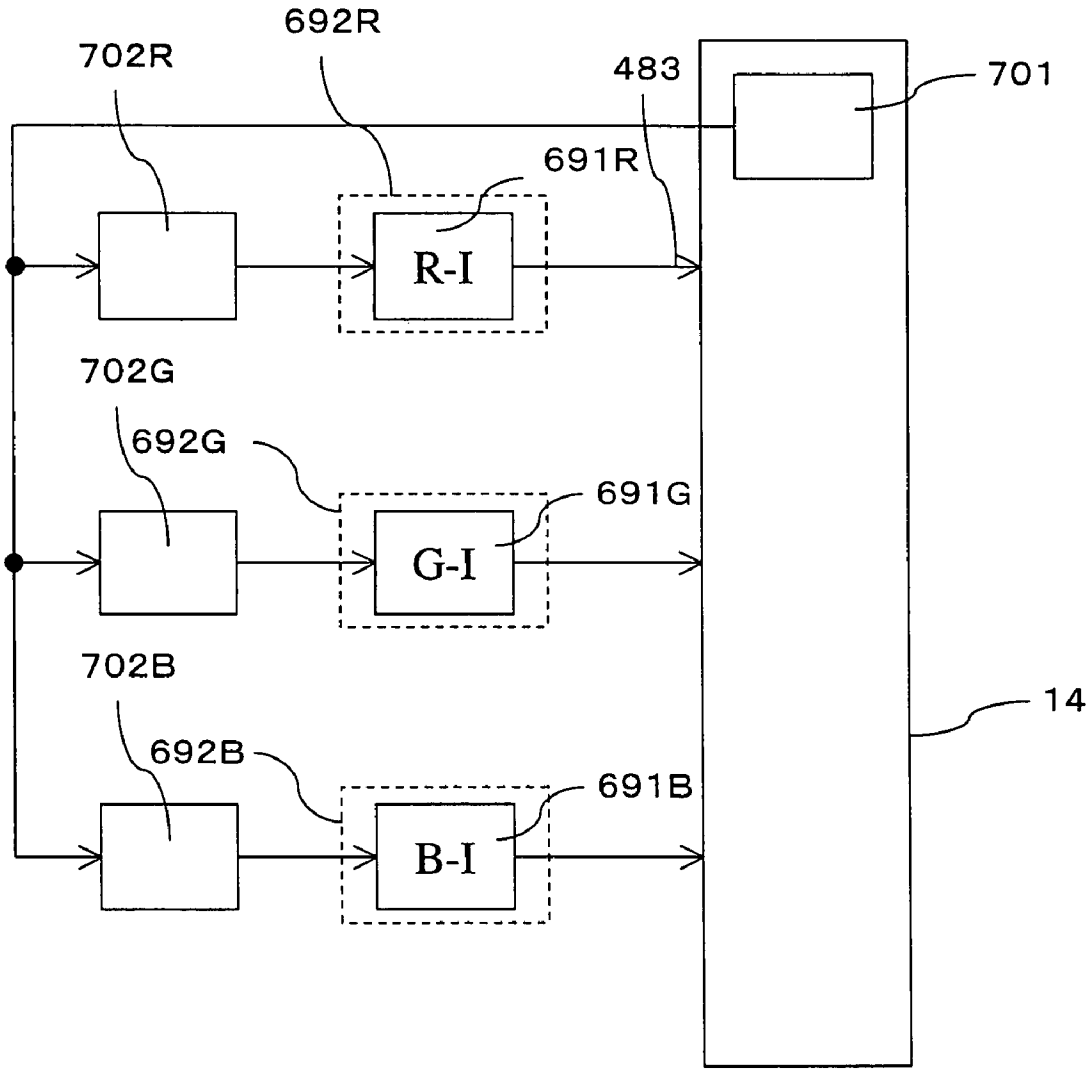
FIG. 70 is an explanatory diagram illustrating a drive circuit according to the present invention.

The present invention, which provides separate reference current circuits 691 for R, G, and B, makes it possible to adjust emission characteristics and temperature characteristics separately for R, G, and B, and thereby obtain an optimum white balance (see FIG. 70).

Next, a precharge circuit will be described. As described earlier, in the case of current driving, only a small current is written into pixels during black display. Consequently, if the source signal lines 18 or the like have parasitic capacitance, current cannot be written into the pixels 16 sufficiently during one horizontal scanning period (1 H). Generally, in current-driven light-emitting elements, black-level current is as weak as a few nA, and thus it is difficult to drive parasitic capacitance (load capacitance of wiring) which is assumed to measure tens of pF using the signal value of the black-level current. To solve this problem, it is useful to equalize the black-level current in the pixel transistors 11*a* (basically, the transistors 11*a* are off) with the potential level of the source signal lines 18 by applying a precharge voltage before writing image data into the source signal lines 18. In order to form (create) the precharge voltage, it is useful to output the black level at a constant voltage by decoding higher order bits of image data.

Figure 65:
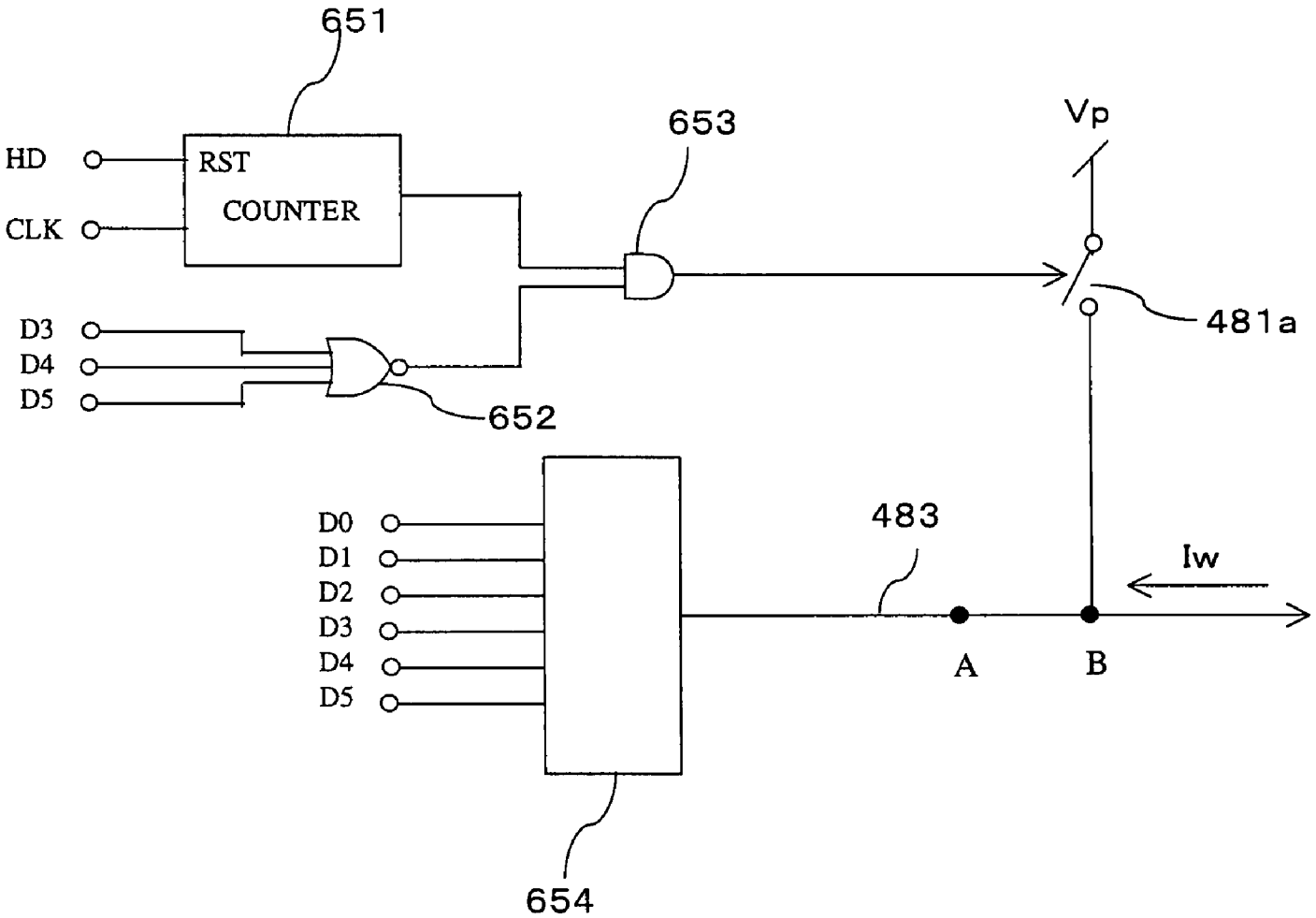
FIG. 65 is an explanatory diagram illustrating a drive circuit according to the present invention.

FIG. 65 shows an example of a current-output type source driver IC (circuit) 14 equipped with a precharge function according to the present invention. FIG. 65 shows a case in which the precharge function is provided in the output stage of a 6-bit constant-current output circuit. In FIG. 65, when the higher order three bits D3, D4, and D5 in image data D0 to D5 are all zero, a precharge control signal causes a NOR circuit 652 to decode the image signal, causes an AND circuit 653 to AND the results with an output from a counter circuit 651 of a dot clock CLK, and thereby causes a black level voltage Vp to be output for a fixed period, where the dot clock CLK is equipped with a reset function based on a horizontal synchronization signal HD. In the other cases, an output current from a current output stage 654 (specifically, configurations in FIGS. 48, 56, 57, etc.) is applied to the source signal lines 18 (programming current Iw is drawn from the source signal lines 18). When the image data is composed of the 0th to 7th gradations close to the black level, by writing a voltage which corresponds to the black level for a fixed period at the beginning of a horizontal period, the above configuration reduces the burden of current driving and makes up for insufficient writing. Incidentally, it is assumed that the 0th gradation corresponds to a completely black display while the 63rd gradation corresponds to a completely white display (in the case of 64-gradation display).

In FIG. 65, any precharge voltage supplied is applied to point B on internal wiring 483. Thus, it is applied to the current output stage 654 as well. However, since the current output stage 654 constitutes a constant-current circuit, it has high impedance. Thus, even if the precharge voltage is applied to the current output stage 654, there is no problem with circuit operation. Incidentally, to prevent the precharge voltage from being applied to the current output stage 654, a switch 655 can be installed by cutting the circuit at point A in FIG. 65 (see FIG. 66). This switch should be made to work in coordination with a precharge switch 481*a* such that it will be off when the precharge switch 481*a* is on.

Although precharging may be performed over the entire range of gradations, preferably precharging should be limited to a black display region. Specifically, precharging is performed by selecting gradations in a black region (low brightness, region, in which only a small (weak) current flows in the case of current driving) from write image data (hereinafter, this type of precharging will be referred to as selective precharging). If precharging is performed over the entire range of gradations, brightness lowers (a target brightness is not reached) in a white display region. Also, vertical streaks may be displayed in some cases.

Preferably, selective precharging is performed for 1/8 of all the gradations beginning with the 0th gradation (e.g., in the case of 64 gradations, image data is written after precharging for the 0th to 7th gradations). More preferably, selective precharging is performed for 1/16 of all the gradations beginning with the 0th gradation (e.g., in the case of 64 gradations, image data is written after precharging for the 0th to 3rd gradations).

A method which performs precharging by detecting only the 0th gradation is also effective in enhancing contrast, especially in black display. It achieves an extremely good black display. The method of performing precharging by extracting only the 0th gradation causes little harm to image display. Thus, it is most preferable to adopt this method as a precharging technique.

Incidentally, it is also useful to vary the precharge voltage and gradation range among R, G, and B because emission start voltage and emission brightness of EL elements 15 vary among R, G, and B. For example, selective precharging is performed for 1/8 of all the gradations beginning with the 0th gradation (e.g., in the case of 64 gradations, image data is written after precharging for the 0th to 7th gradations) in the case of R. In the case of other colors (G and B), selective precharging is performed for 1/16 of all the gradations beginning with the 0th gradation (e.g., in the case of 64 gradations, image data is written after precharging for the 0th to 3rd gradations). Regarding the precharge voltage, if 7 V is written into the source signal lines 18 for R, 7.5 V is written into the source signal lines 18 for the other colors (G and B). Optimum precharge voltage often varies with the production lot of the EL display panel. Thus, preferably precharge voltage can be adjustable with an external regulator. Such a regulator circuit can be implemented easily using an electronic regulator.

Incidentally, it is preferable that the precharge voltage is not higher than the anode voltage Vdd minus 0.5 V and not lower than the anode voltage Vdd minus 2.5 V in FIG. 1.

Even with methods which perform precharging only for the 0th gradation, it is useful to perform precharging selecting one or two colors from among R, G, and B. This will cause less harm to image display. It is also useful to perform precharging when the screen brightness is below a predetermined brightness or above a predetermined brightness. In particular, when the brightness of the screen 50 is low, black display is difficult. Precharge driving at low contrast such as 0-gradation precharging will improve perceived contrast of images.

It is preferable to provide several modes which can be switched by a command: including a 0th mode in which no precharging is performed, first mode in which precharging is performed only for the 0th gradation, second mode in which precharging is performed in the range of the 0th to 3rd gradations, third mode in which precharging is performed in the range of the 0th to 7th gradations, and fourth mode in which precharging is performed in the entire range of gradations. These modes can be implemented easily by constructing (designing) a logic circuit in the source driver circuit (IC) 14.

Figure 66:
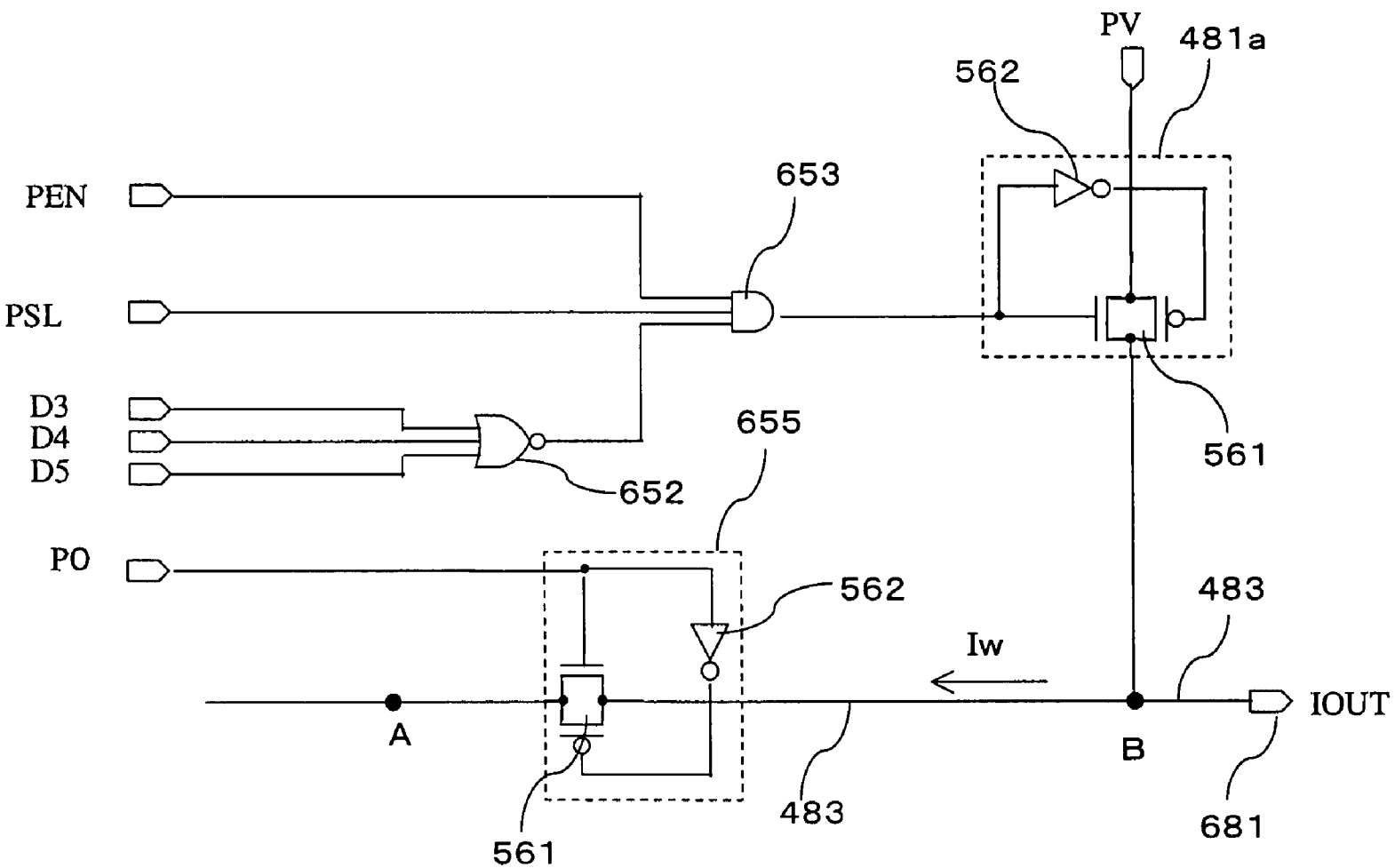
FIG. 66 is an explanatory diagram illustrating a drive circuit according to the present invention.

FIG. 66 is a diagram showing a concrete configuration of a selective precharging circuit. Reference character PV denotes an input terminal of precharge voltage. Separate precharge voltages are set for R, G, and B by external inputs or by an electronic regulator circuits. Incidentally, although it has been stated that separate precharge voltages are set for R, G, and B, this is not restrictive. Precharge voltages may be common to R, G, and B because they are correlated with the Vt of the driver transistors 11*a* of the pixels 16, which do not differ among R, G, and B. If the W/L ratio and the like of the driver transistors 11*a* of the pixels 16 are varied (designed differently) among R, G, and B, preferably the precharge voltage is adjusted to the different designs. For example, a larger channel length L of the driver transistor 11*a* lowers diode characteristics of the transistor 11*a* and increases the source-drain (SD) voltage. Thus, the precharge voltage should be set lower than the source potential (Vdd).

The precharge voltage PV is fed to an analog switch 561. To reduce on-resistance, the W (channel width) of the analog switch 561 should be 10 μm or above. However, it is set to 100 μm or below because too large W will increase parasitic capacitance as well. More preferably, the channel width W should be 15 to 60 μm (both inclusive).

Figure 79:
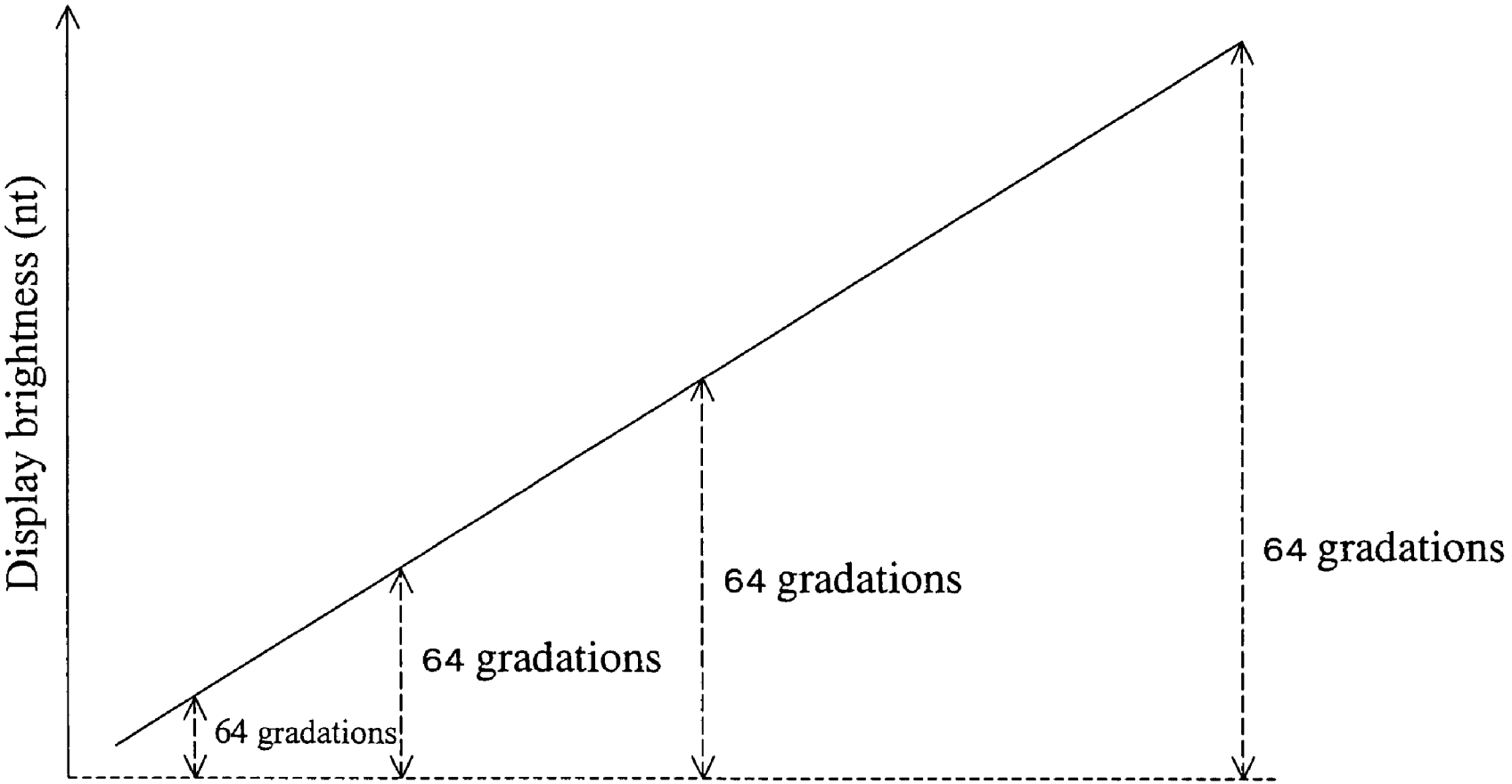
FIG. 79 is an explanatory diagram illustrating a drive method of a display apparatus according to the present invention.

Incidentally, although selective precharging may be performed for fixed gradations such as only the 0th gradation or a range of the 0th to 7th gradations, it may be performed automatically in any low gradation region specified (gradation 0 to gradation R1 or gradation R1−1 in FIG. 79). Specifically, if a low gradation region ranging from gradation 0 to gradation R1 is specified, selective precharging will be performed automatically in this range, and if a low gradation region ranging from gradation 0 to gradation R2 is specified, selective precharging will be performed automatically in this range.

The switch 481*a* is turned on and off according to applied signals. When the switch 481*a* is turned on, the precharge voltage PV is applied to the source signal line 18. Incidentally, the duration of application of the precharge voltage PV is set by a counter (not shown) formed separately. The counter is configurable by commands. Preferably, the application duration of the precharge voltage is from 1/100 to 1/5 of one horizontal scanning period (1 H) both inclusive. For example, if 1 H is 100 μsec, the application duration should be from 1 μsec to 20 sec (from 1/100 to 1/5 of 1 H) both inclusive. More preferably, it should be from 2 μsec to 10 μsec (from 2/100 to 1/10 of 1 H) both inclusive.

Figure 67:
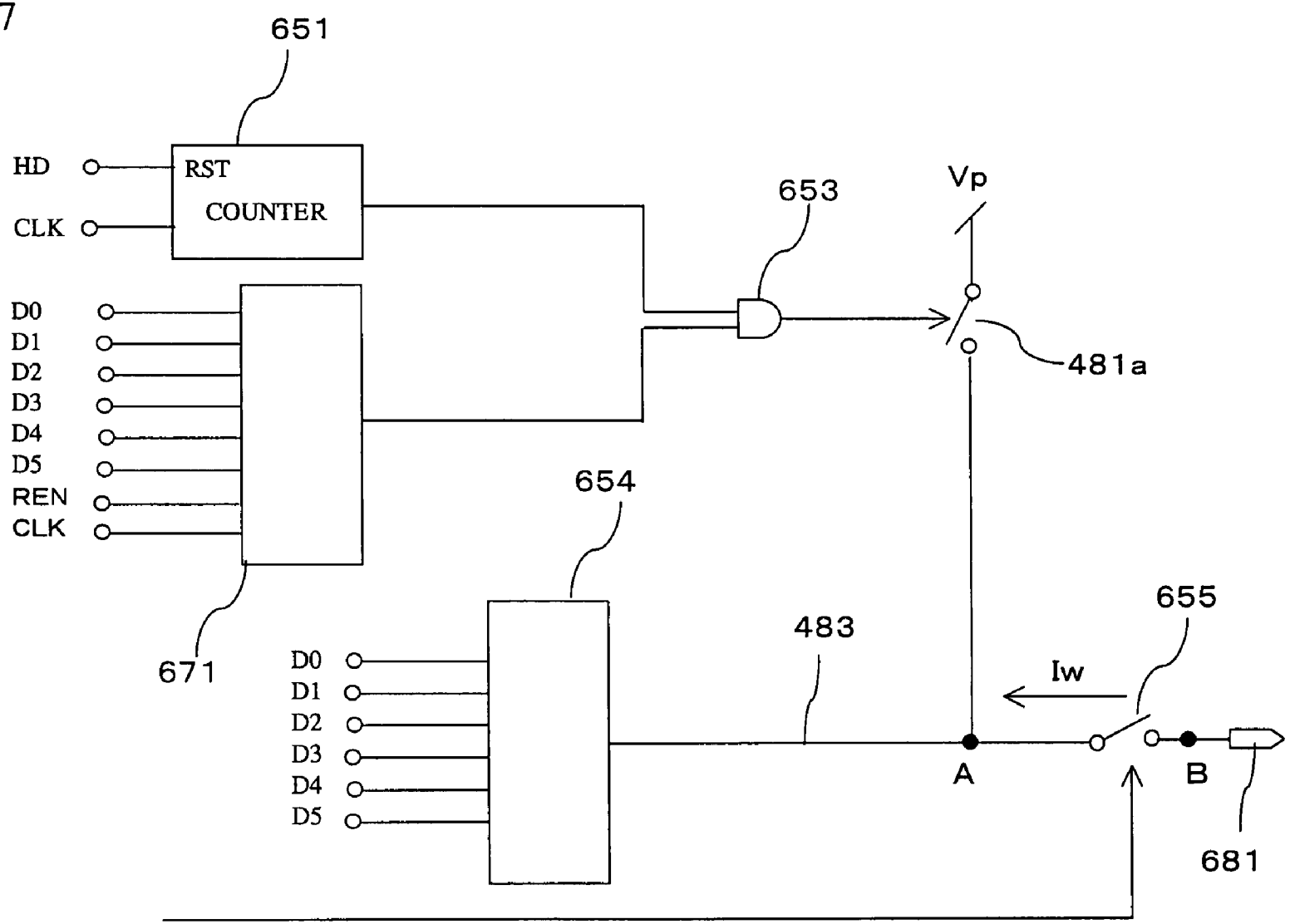
FIG. 67 is an explanatory diagram illustrating a drive circuit according to the present invention.

FIG. 67 shows a variation of FIG. 65 or 66. It shows a precharge circuit which determines whether to perform precharging according to input image data and controls precharging. For example, the precharge circuit can make a setting so as to perform precharging when image data contains only the 0th gradation, perform precharging when image data contains only the 0th and 1st gradations, or always perform precharging when the 0th gradation occurs and perform precharging when the 1st gradation occurs consecutively for a predetermined number of times.

FIG. 67 shows an example of a current-output type source driver IC (circuit) 14 equipped with a precharge function according to the present invention. FIG. 67 shows a case in which the precharge function is provided in the output stage of a 6-bit constant-current output circuit. In FIG. 67, a coincidence circuit 671 performs decoding according to image data D0 to D5 and determines whether to perform precharging using input in an REN terminal equipped with a reset function based on a horizontal synchronization signal HD and input in a dot clock CLK terminal. The coincidence circuit 671 has a memory and retains results of precharging in relation to image data for a few Hs or a few fields (frames). Also, it has capabilities to control precharging by determining whether to perform precharging, based on the retained data. For example, the coincidence circuit 671 can make settings so as to always perform precharging when the 0th gradation occurs and perform precharging when the 1st gradation occurs consecutively for 6 H (six horizontal scanning periods) or more. Also it can make settings so as to always perform precharging when the 0th or 1st gradation occurs and perform precharging when the 2nd gradation occurs consecutively for 3 Fs (three frame periods) or more.

The output from the coincidence circuit 671 and output from the counter circuit 651 are ANDed by the AND circuit 653, and consequently a black level voltage Vp is output for a predetermined period. In another case, the output current from the current output stage 654 described with reference to FIG. 52 and the like is applied to the source signal lines 18 (programming current Iw is drawn from the source signal lines 18). The other configuration is the same as or similar to those shown in FIGS. 65, 66, and the like, and thus description thereof will be omitted. Incidentally, although the precharge voltage is applied to point A in Figure A, needless to say, it may be applied to point B (see also FIG. 66).

Good results can also be obtained if the duration of application of the precharge voltage PV is varied using the image data applied to the source signal lines 18. For example, the application duration may be increased for the 0th gradation of completely black display, and made shorter for the 4th gradation. Also, good results can be obtained if the application duration is specified taking into consideration the difference between image data and image data to be applied 1 H later. For example, when writing a current into the source signal lines to put the pixels in black display mode 1 H after writing a current into source signal lines to put the pixels in white display mode, the precharge time should be increased. This is because a weak current is used for black display. Conversely, when writing a current into the source signal lines to put the pixels in white display mode 1 H after writing a current into source signal lines to put the pixels in black display mode, the precharge time should be decreased or precharging should be stopped. This is because a large current is used for white display.

It is also useful to vary the precharge voltage depending on the image data to be applied. This is because a weak current is used for black display and a large current is used for white display. Thus, it is useful to raise the precharge voltage (compared to Vdd. When P-channel transistors are used as pixel transistor 11*a*) in a low gradation region and lower the precharge voltage (when P-channel transistors are used as pixel transistor 11*a*) in a high gradation region.

For ease of understanding, description will be given below mainly with reference to FIG. 66. Needless to say, however, the items described below also apply to precharge circuits shown FIGS. 65 and 67.

When a programming current open terminal (PO terminal) is "0," the switch 655 is off, disconnecting an IL terminal and IH terminal from the source signal line 18 (an Iout terminal is connected with the source signal line 18). Thus, the programming current Iw does not flow to the source signal line 18. When the programming current Iw is applied to the source signal line, the PO terminal is "1," keeping the switch 655 on to pass the programming current Iw to the source signal line 18.

"0" is applied to the PO terminal to open the switch 655 when no pixel row in the display area is selected. The unit transistor 484 constantly draws current from the source signal line 18 based on input data (D0 to D5). This current flows into the source signal line 18 from the Vdd terminal of the selected pixel 16 via the transistor 11*a*. Thus, when no pixel row is selected, there is no path for current to flow from the pixel 16 to the source signal line 18. A period when no pixel row is selected occurs from the time when an arbitrary pixel row is selected to the time when the next pixel row is selected. Incidentally, the period during which no pixel (pixel row) is selected and there is no path for current to flow into (flow out into) the source signal line 18 is referred to as total non-selection period.

In this state, if the output terminal 681 is connected to the source signal line 18, current flows to activated unit transistors 484 (actually, what is activated are switches 481 controlled by data from the D0 to D5 terminals). Consequently, electric charges are discharged from the parasitic capacitance of the source signal line 18, lowering the potential of the source signal line 18 sharply. Then, it takes time for the current normally written into the source signal line 18 to restore the potential of the source signal line 18.

To solve this problem, the present invention applies "0" to the PO terminal during the total non-selection period to turn off the switch 655 in FIG. 66, and thereby disconnect the output terminal 681 from the source signal line 18. Consequently, no current flows from the source signal line 18 into the unit transistors 484, and thus the potential of the source signal line 18 does not change during the total non-selection period. In this way, by controlling the PO terminal during the total non-selection period and disconnecting current sources from the source signal line 18, it is possible to write current properly.

It is useful to add a (proper precharging) capability to stop precharging when a white display area (area with a certain brightness) (white area) and a black display area (area with brightness below a predetermined level) (black area) coexist in the screen and the ratio of the white area to the black area falls within a certain range because vertical streaks appear in this range. Conversely, precharging may be done in this range because images may act as noise when they move. Proper precharging can be implemented easily by counting (calculating) pixel data which correspond to the white area and black area using an arithmetic circuit.

It is also useful to vary precharge control among R, G, and B because emission start voltage and emission brightness of EL elements 15 vary among R, G, and B. For example, a possible method involves stopping or starting precharging for R when the ratio of a white area with a predetermined brightness to a black area with a predetermined brightness is 1 to 20 or above and stopping or starting precharging for G and B when the ratio of a white area with a predetermined brightness to a black area with a predetermined brightness is 1 to 16 or above. It has been shown experimentally and analytically that in an organic EL panel, preferably precharging should be stopped or started when the ratio of a white area with a predetermined brightness to a black area with a predetermined brightness is 1 to 100 or above (i.e., the black area is at least 100 times larger than the white area). More preferably, precharging should be stopped or started when the ratio of a white area with a predetermined brightness to a black area with a predetermined brightness is 1 to 200 or above (i.e., the black area is at least 200 times larger than the white area).

As shown in FIG. 1, when the driver transistor 11*a* of the pixel 16 and selection transistors (11*b* and 11*c*) are P-channel transistors, a penetration voltage is generated. This is because potential fluctuations of the gate signal line 17*a* penetrates to a terminal of the capacitor 19 via G-S capacitance (parasitic capacitance) of the selection transistors (11*b* and 11*c*). When the P-channel transistor 11*b* turns off, the voltage is set to Vgh. As a result, the terminal voltage of the capacitor 19 shifts slightly to the Vdd side. Consequently, the gate (G) terminal voltage of the transistor 11*a* rises creating a more intense black display. This results in a proper black display.

However, although a completely black display can be achieved in the 0th gradation, it is difficult to display the 1st gradation. In other cases, a large gradation jump may occur between the 0th and 1st gradations or less of insufficient contrast may occur in a particular gradation range.

To solve this problem, a configuration in FIG. 54 is available. This configuration is characterized by comprising a function to pad output current values. A main purpose of a padder circuit 541 is to make up for the penetration voltage. It can also be used to adjust black levels so that some current (tens of nA) will flow even if image data is at black level 0.

Basically, FIG. 54 is the same as FIG. 48 except that the padder circuit has been added (enclosed by dotted lines in FIG. 54) to the output stage. In FIG. 54, three bits (K0, K1, and K2) are used as current padding control signals. The three bits of control signals make it possible to add a current value 0 to 7 times larger than the current value of grandchild current sources to output current.

A basic overview of the source driver circuit (IC) 14 according to the present invention has been provided above. Now, the source driver circuit (IC) 14 according to the present invention will be described in more detail.

The current I (A) passed through the EL element 15 and emission brightness B (nt) have a linear relationship. That is, the current I (A) passed through the EL element 15 is proportional to the emission brightness B (nt). In current driving, each step (gradation step) is provided by current (unit transistor 484 (single-unit)).

Human vision with respect to brightness has square-law characteristics. In other words, quadratic brightness changes are perceived to be linear brightness changes. However, according to the relationship shown in FIG. 83, the current I (A) passed through the EL element 15 is proportional to the emission brightness B (nt) both in low brightness and high brightness regions. Thus, if brightness is varied step by step (at intervals of one gradation), brightness changes greatly in each step (less of shadow detail occurs) in a low gradation part (black area). In a high gradation part (white area), since brightness changes coincide approximately with a linear segment of a quadratic curve, the brightness is perceived to change at equal intervals. Thus, how to display a black display area, in particular, becomes a problem in current driving (in which each step is provided by an increment of current) (i.e., in a current-driven source driver circuit (IC) 14).

To solve this problem, the slope of output current is decreased in the low gradation region (from gradation 0 (complete black display) to gradation R1) and the slope of output current is increased in the high gradation region (from gradation R1 to the highest gradation R). That is, a current increment per gradation (in each step) is decreased in the low gradation region and a current increment per gradation (in each step) is increased in the high gradation region. By varying the amount of change in current between the low gradation region and high gradation region, it is possible to bring gradation characteristics close to a quadratic curve, and thus eliminate less of shadow detail in the low gradation region.

Incidentally, although two current slopes—in the low gradation region and high gradation region—are used in the above example, this is not restrictive. Needless to say, three or more slopes may be used. Needless to say, however, the use of two slopes simplifies circuit configuration. Preferably, a gamma circuit is capable of generating five or more slopes.

A technical idea of the present invention lies in the use of two or more values of current increment per gradation step in a current-driven source driver circuit (IC) and the like (basically, circuits which use current outputs for gradation display. Thus, display panels are not limited to the active-matrix type and include the simple-matrix type).

In EL and other current-driven display panels, display brightness is proportional to the amount of current applied. Thus, the source driver circuit (IC) 14 according to the present invention can adjust the brightness of the display easily by adjusting a reference current which provides a basis for a current flowing through one current source (one unit transistor) 484.

In EL display panels, light emission efficiency varies among R, G, and B and color purity deviates from that of the NTSC standard. Thus, to obtain an optimum white balance, it is necessary to optimize ratios among R, G, and B. For example the reference current for R is set to 2 μA, the reference current for G is set to 1.5 μA, and the reference current for B is set to 3.5 μA. Preferably, at least one reference current out of the reference currents for different colors can be changed, adjusted, or controlled.

In the case of current driving, the current I passed through the EL element and brightness have a linear relationship. To adjust white balance through a mixture of R, G, and B, it suffices to adjust the reference currents for R, G, and B at only one predetermined brightness. In other words, if the white balance is adjusted by adjusting the reference currents for R, G, and B at the predetermined brightness, basically a white balance can be achieved over the entire range of gradations. Thus, the present invention is characterized by comprising adjustment means of adjusting the reference currents for R, G, and B as well as a single-point polygonal or multi-point polygonal gamma curve generator circuit (generating means). The above is a circuit arrangement peculiar to current-controlled EL display panels.

The gamma circuit of the present invention increments, for example, 10 nA per gradation in a low gradation region (corresponding to the slope of a gamma curve in the low gradation region). In a high gradation region, it increments 50 nA per gradation (corresponding to the slope of a gamma curve in the high gradation region).

Incidentally, the ratio of the current increment per gradation in the high gradation region to the current increment per gradation in the low gradation region is referred to as a gamma current ratio. In this example, the gamma current ratio is 50 nA/10 nA=5. The gamma current ratio should be equal among R, G, and B. In other words, the current (programming current) flowing through the EL elements 15 is controlled with the gamma current ratio kept equal among R, G, and B.

Adjusting the gamma current ratio while keeping it equal among R, G, and B makes it easier to configure the circuit. Then it suffices to build, for each of R, G, and B, a constant-current circuit which generates a reference current to be applied to the low gradation part and constant-current circuit which generates a reference current to be applied to the high gradation part and build (place) a regulator which adjusts the current passed relatively through the constant-current circuits.

Figure 56:
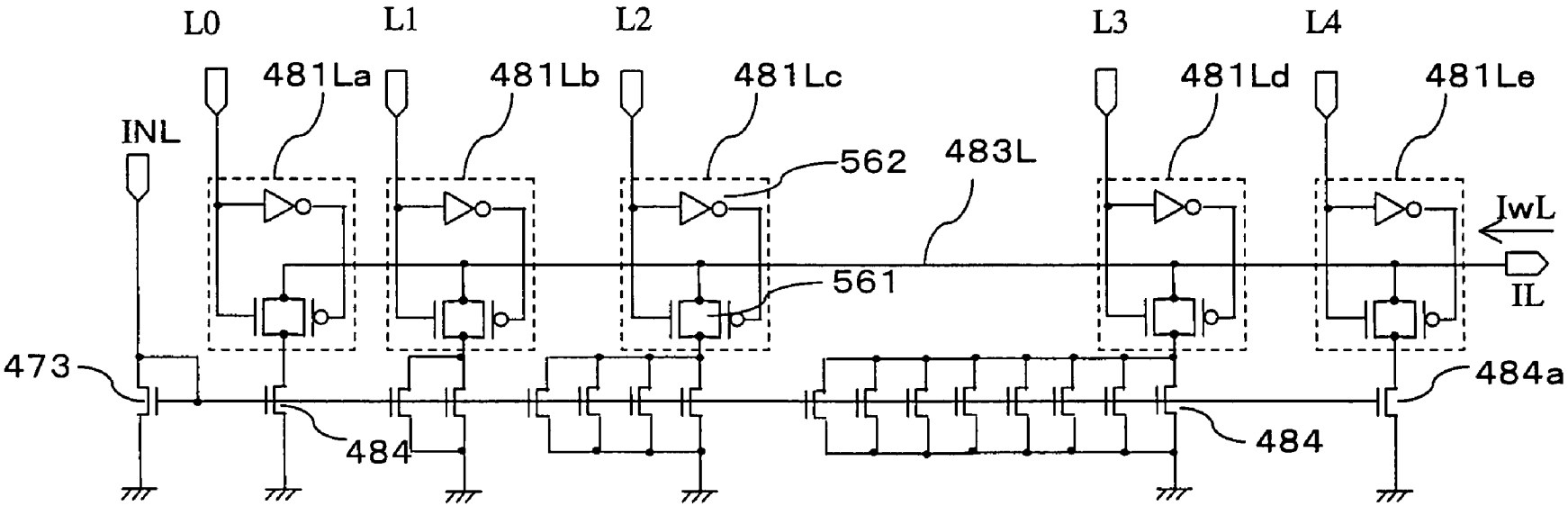
FIG. 56 is an explanatory diagram illustrating a drive circuit according to the present invention.
Figure 57:
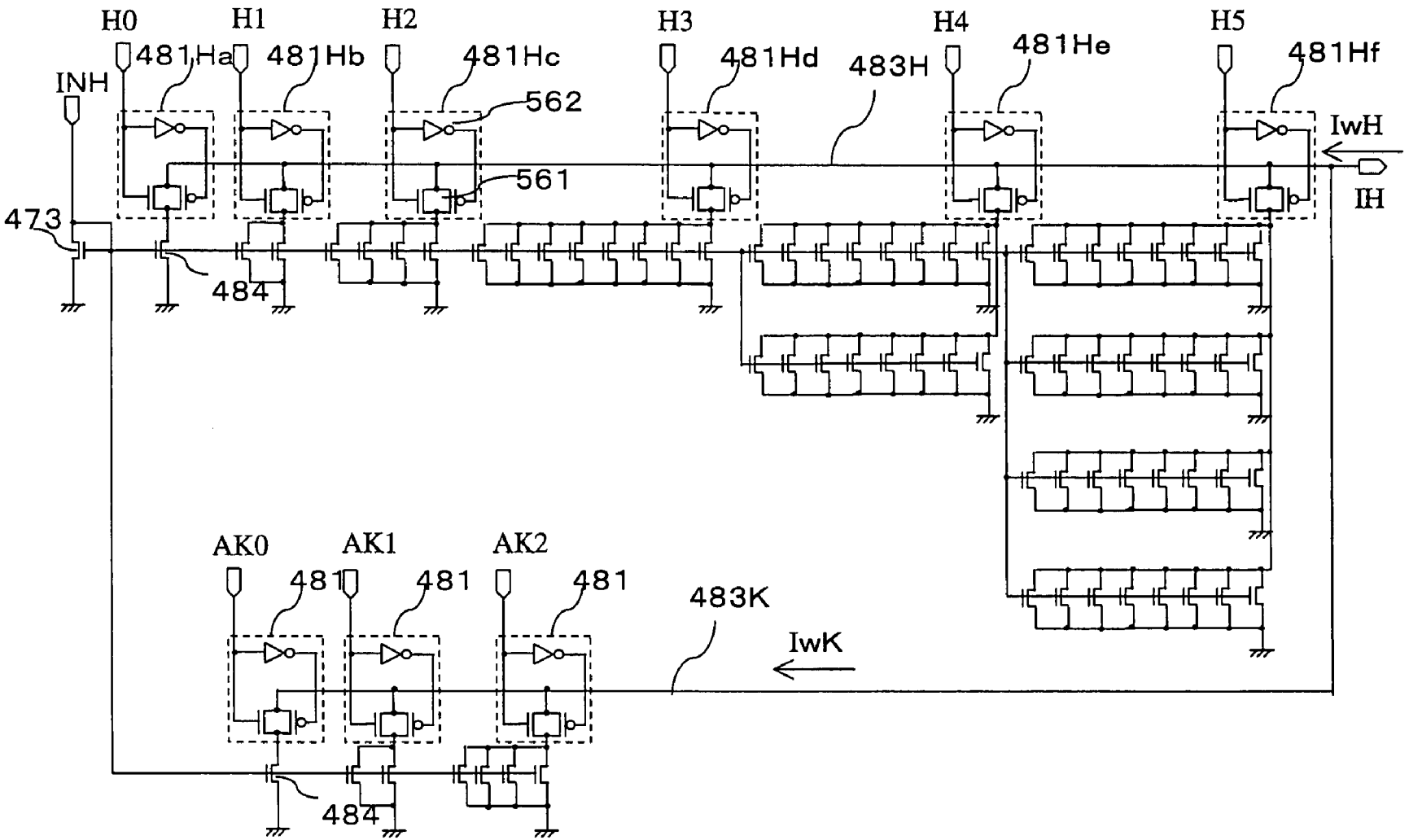
FIG. 57 is an explanatory diagram illustrating a drive circuit according to the present invention.

FIG. 56 is a block diagram showing a constant-current generating circuit portion for a low gradation part. FIG. 57 is a block diagram showing a constant-current generating circuit portion for a high gradation part and padder current circuit portion. As shown in FIG. 56, a reference current INL is applied to the low-current source circuit portion. Basically, this current serves as a unit current, the required number of unit transistors 484 operate according to input data L0 to L4, and the total current flows in a low-current portion as a programming current IwL.

Also, as shown in FIG. 57, a reference current INH is applied to the high-current source circuit portion. Basically, this current serves as a unit current, the required number of unit transistors 484 operate according to input data H0 to H5, and the total current flows in a high-current portion as a programming current IwH.

The same applies to the padder current circuit portion. As shown in FIG. 57, a reference current INH is applied. Basically, this current serves as a unit current, the required number of unit transistors 484 operates according to input data AK0 to AK2, and the total current flows as a current IwK which corresponds to a padding current.

The programming current Iw flowing to the source signal line 18 is given by Iw=IwH+IwL+IwK. The ratio of IwH to IwL, i.e., the gamma current ratio should satisfy the relationship described earlier.

As illustrated in FIGS. 56 and 67, the on/off switch 481 consists of an inverter 562 and an analog switch 561 which in turn consists of a P-channel transistor and N-channel transistor. This configuration can reduce on-resistance and minimize voltage drops between the unit transistor 484 and the source signal line 18. Needless to say, this also applies to other examples of the present invention.

Now, description will be given of the low-current circuit portion in FIG. 56 and high-current circuit portion in FIG. 57. The source driver circuit (IC) 14 according to the present invention consists of 5 bits—L0 to L4—in the low-current circuit portion and 6 bits—H0 to H5—in the high-current circuit portion. Incidentally, the data fed into the circuits consists of 6 bits D0 to D5 (64 gradations for each color). The 6-bit data is converted into 5-bit data—L0 to L4—and 6-bit data—H0 to H5—in the high-current circuit portion and the programming current Iw corresponding to image data is applied to the source signal line. That is the 6-bit data is converted into 11-bit data (=5+6). This makes it possible to form a high-accuracy gamma curve.

As described above, the 6-bit input data is converted into 11-bit data (=5+6). According to the present invention, the bit count (H) in the high-current region of the circuit is equal to the bit count of input data (D) while the bit count (L) in the low-current region of the circuit is equal to the bit count of input data (D) minus 1. Incidentally, the bit count (L) in the low-current region of the circuit may be the bit count of input data (D) minus 2. This configuration optimizes the gamma curve in the low-current region and gamma curve in the high-current region for image display on the EL display panel.

The gate driver circuit 12 is normally composed of N-channel and P-channel transistors. Preferably, however, it is composed solely of P-channel transistors because this will reduce the number of masks required for the production of arrays, improve production yields, and improve throughput. Thus, as illustrated in FIGS. 1, 2, and the like, P-channel transistors should be used for the pixels 16 as well as for the gate driver circuits 12. Ten masks are required when a gate driver circuit is composed of N-channel and P-channel transistors, but five masks are required when a gate driver circuit is composed solely of P-channel transistors.

However, if the gate driver circuit 12 and the like are composed solely of P-channel transistors, a level shifter circuit, which is composed of N-channel and P-channel transistors, cannot be formed on the array board 71.

Description will be given below of the gate driver circuit 12 according to the present invention, where the gate driver circuit 12, which is built into the array board 71, is composed solely of P-channel transistors. As described above, by using only P-channel transistors for the pixels 16 as well as for the gate driver circuits 12 (i.e., all the transistors formed on the array board 71 are P-channel transistors. To put it in other words, no N-channel transistor is used), it is possible to reduce the number of masks required for the production of arrays, improve production yields, and improve throughput. Also, it is possible to concentrate on improving the performance of the P-channel transistors, consequently making it easy to improve characteristics. For example, it is easier to lower Vt (threshold voltage) (bring the Vt closer to 0 V) and reduce variations in the Vt than in the case of CMOS structure (structure which employs both P-channel and N-channel transistors).

Examples of the present invention are described by citing mainly the pixel configuration in FIG. 1, but this is not restrictive. Needless to say, other pixel configurations may also be used. Also, the configuration and layout of the gate driver circuit 12 described below are not limited to self-luminous devices such as organic EL display panels. They can also be used for liquid crystal display panels, electromagnetic induction display panels, FEDs (field emission displays), etc. For example, liquid crystal display panels may employ the configuration or arrangement of the gate driver circuit 12 according to the present invention to control a pixel's selection switching element. If two phases of the gate driver circuits 12 are used, one phase may be used to select a pixel's switching element and the other phase may be connected to one terminal of a retention capacitance in the pixel. This scheme is referred to as independent CC driving. Needless to say, the configurations described with reference to FIGS. 71, 73, etc. can also be used not only for the gate driver circuit 12, but also for the shift register circuits of the source driver circuit 14.

Figure 71:
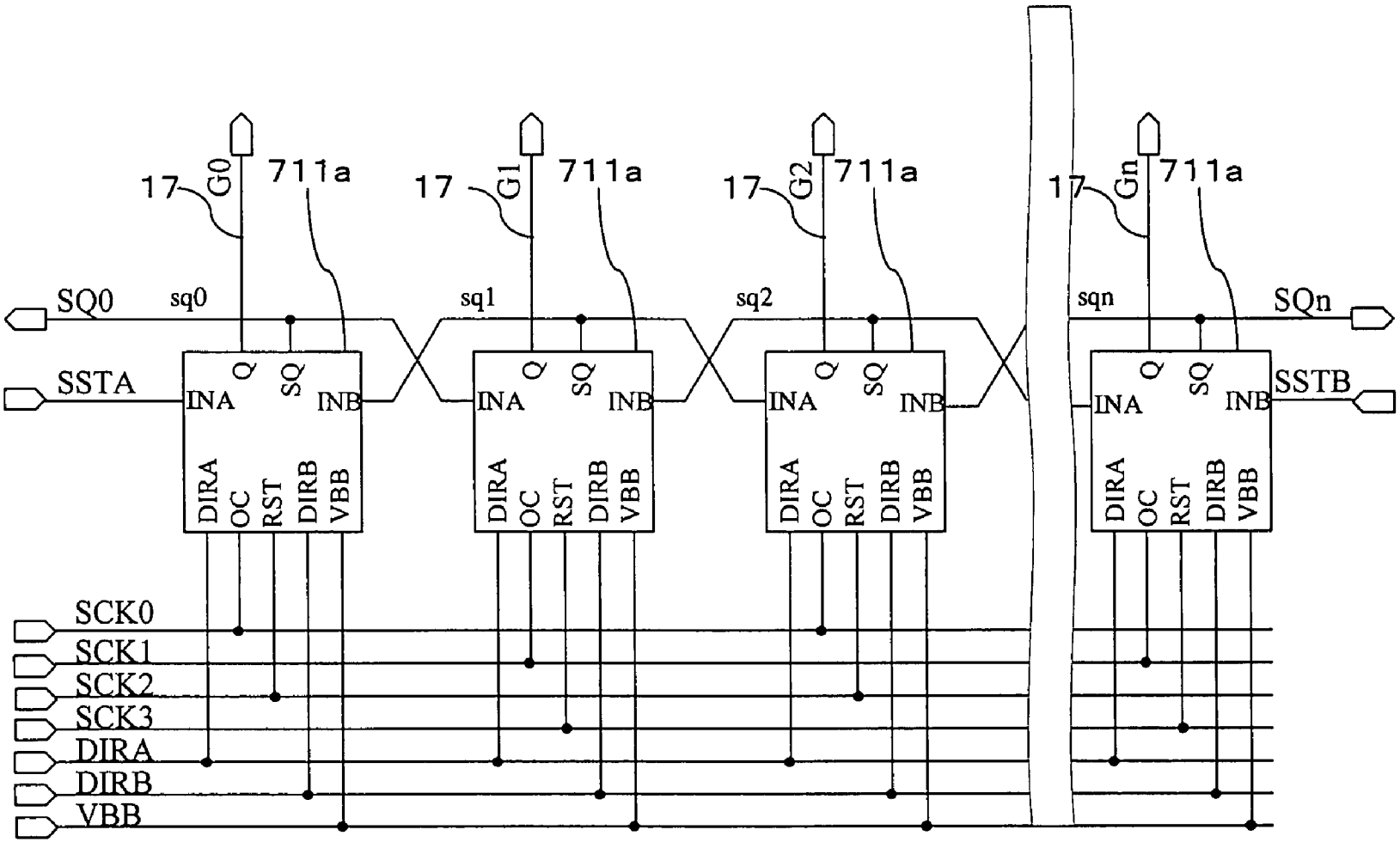
FIG. 71 is an explanatory diagram illustrating a drive circuit according to the present invention.

FIG. 71 is a block diagram of the gate driver circuit 12 according to the present invention. Although only four stages are illustrated for ease of explanation, basically there are as many unit gate output circuits 711 as there are gate signal lines 17.

As illustrated in FIG. 71, the gate driver circuits 12 (12*a* and 12*b*) according to the present invention comprise signal terminals: four clock terminals (SCK0, SCK1, SCK2, and SCK3), one start terminal (data signal SSTA), and two inverting terminals (DIRA and DIRB which apply signals 180 degrees out of phase with each other) which turn a shift direction upside down. They also comprise power supply terminals, including an L power supply terminal (VBB) and H power supply terminal (Vd).

If the pixels 16 are composed of P-channel transistors, they match well with the gate driver circuits 12 composed of P-channel transistors. The P-channel transistors (the transistors 11*b*, 11*c*, and 11*d* in the configuration shown in FIG. 1) turn on at L voltage. The gate driver circuits 12 also use the L voltage as a selection voltage. As can be seen also from the configuration in FIG. 73, gate drivers composed of P-channel transistors match well if the L level is used as a selection level. This is because the L level cannot be maintained for a long period. On the other hand, H voltage can be maintained for a long period.

If a P-channel transistor is used as the driver transistor (the transistor 11*a* in the configuration shown in FIG. 1) which supplies current to the EL element 15, the cathode of the EL element 15 can be formed into a solid electrode of a thin metal film. Also, current can be passed in the forward direction to the EL element 15 from the anode potential Vdd. Thus, preferably P-channel transistors are used as the transistors of the pixels 16 and the transistors of the gate driver circuits 12. Thus, the use of P-channel transistors as the transistors (driver transistors and switching transistors) of the pixels 16 according to the present invention and the transistors of the gate driver circuits 12 is not simply a design matter.

Incidentally, the level shifter (LS) circuit may be formed directly on the array board 71. That is, level shifter (LS) is constructed from both N-channel and P-channel transistors. A logic signal from a controller (not shown) is boosted by the level shifter (LS) circuit formed directly on the array board 71 so that it will match the logic level of the gate driver circuit 12 constructed from a P-channel transistor. The boosted logic voltage is applied to the gate driver circuit 12.

Incidentally, the level shifter circuit may be constructed from a silicon chip and mounted on the array board 71 using COG technology. Also, the source driver circuit 14 is constructed from a silicon chip and mounted on the array board 71 using COG technology. However, this is not restrictive and the source driver circuit 14 may be formed directly on the array board 71 using polysilicon technology.

If P-channel transistors are used as the transistors 11 of the pixel 16, the programming current flows out from the pixel 16 to the source signal line 18. Thus, the unit transistors (unit current sources) 484 (see FIGS. 56, 57, etc.) of the source driver circuit must be N-channel transistors. In other words, the source driver circuit 14 should be configured to draw the programming current Iw.

Thus, if the driver transistors 11*a* of the pixels 16 (in the case of FIG. 1) are P-channel transistors, the unit transistors 484 of the source driver circuits 14 must be N-channel transistors to ensure that the source driver circuits 14 will draw the programming current Iw. In order to form a source driver circuit 14 on an array board 71, it is necessary to use both mask (process) for N-channel transistors and mask (process) for P-channel transistors. Conceptually speaking, in the display panel (display apparatus) of the present invention, P-channel transistors are used for the pixels 16 and gate driver circuits 12 while N-channel transistors are used as the transistors of drawing current sources of the source drivers.

Thus, P-channel transistors are used as the transistors 11 of the pixels 16 and the transistors of the gate driver circuits 12. This makes it possible to reduce the costs of the array board 71. However, the unit transistors 484 of the source driver circuits 14 must be N-channel transistors. Consequently, the source driver circuit 14 cannot be formed directly on the array board 71. Thus, the source driver circuits 14 are made of silicon chips and the like separately and mounted on the array board 71. Incidentally, it is not always necessary to construct the source driver circuits 14 from silicon chips. For example, a large number of source driver circuits may be formed on a glass substrate simultaneously using low-temperature polysilicon technology or the like, cut off into chips, and mounted on an array board 71. Incidentally, although it has been stated that source driver circuits are mounted on an array board 71, this is not restrictive. Any form may be adopted as long as the output terminals 681 of the source driver circuits 14 are connected to the source signal lines 18 of the array board 71. For example, the source driver circuits 14 may be connected to the source signal lines 18 using TAB technology, By forming source driver circuits 14 on a silicon chip separately, it is possible to reduce variations in output current and achieve proper image display as well as to reduce costs.

The configuration in which P-channel transistors are used as selection transistors of pixels and for gate driver circuits is not limited to organic EL or other self-luminous devices (display panels or display apparatus). For example, it is also applicable to liquid crystal display panels and FEDs (field emission displays).

The inverting terminals (DIRA and DIRB) apply common signals to all the unit gate output circuits 711. As can be seen from an equivalent circuit diagram in FIG. 73, inverting terminals (DIRA and DIRB) are fed voltage values of opposite polarity. To reverse the scan direction of the shift register, the polarity of the voltage values fed into the inverting terminals (DIRA and DIRB) is reversed.

Incidentally, the circuit configuration in FIG. 71 contains four clock signal lines. Four is the optimum number according to the present invention. However, this is not restrictive and the present invention may use less than or more than four clock signal lines.

The clock signals (SCK0, SCK1, SCK2, and SCK3) are fed differently between adjacent unit gate output circuits 711. For example, in the unit gate output circuit 711*a*, OC is fed by the clock terminal SCK0 while RST is fed by the clock terminal SCK2. This is also the case with the unit gate output circuit 711*c*. However, in the unit gate output circuit 711*b* (the unit gate output circuit in the next stage) adjacent to the unit gate output circuit 711*a*, OC is fed by the clock terminal SCK1 while RST is fed by the clock terminal SCK3. In this way, every other unit gate output circuit 711 is fed by clock terminals in a different manner: OC is fed by SCK0 and RST is fed by SCK2, OC is fed by SCK1 and RST is fed by SCK3 in the next stage, OC is fed by SCK0 and RST is fed by SCK2 in the next stage, and so on.

Figure 72:
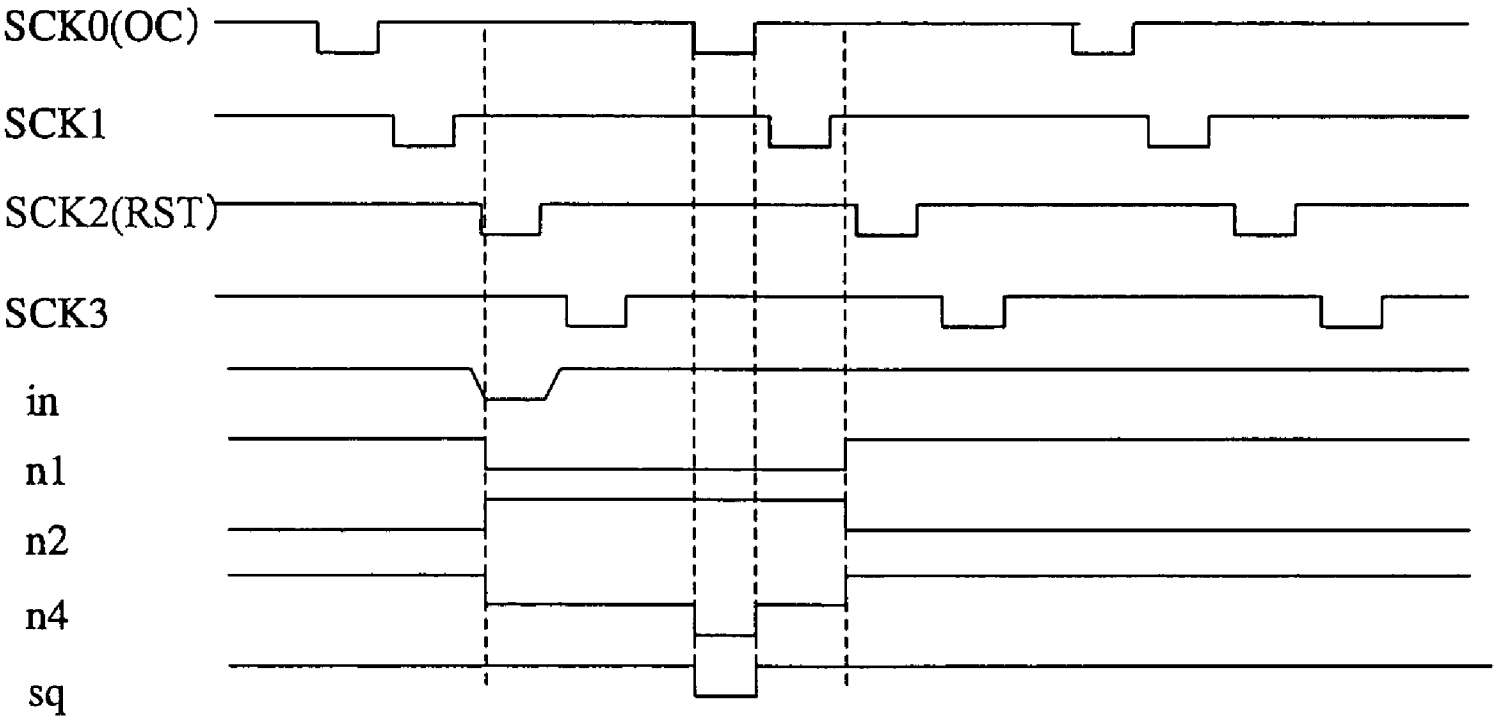
FIG. 72 is an explanatory diagram illustrating a drive circuit according to the present invention.
Figure 73:
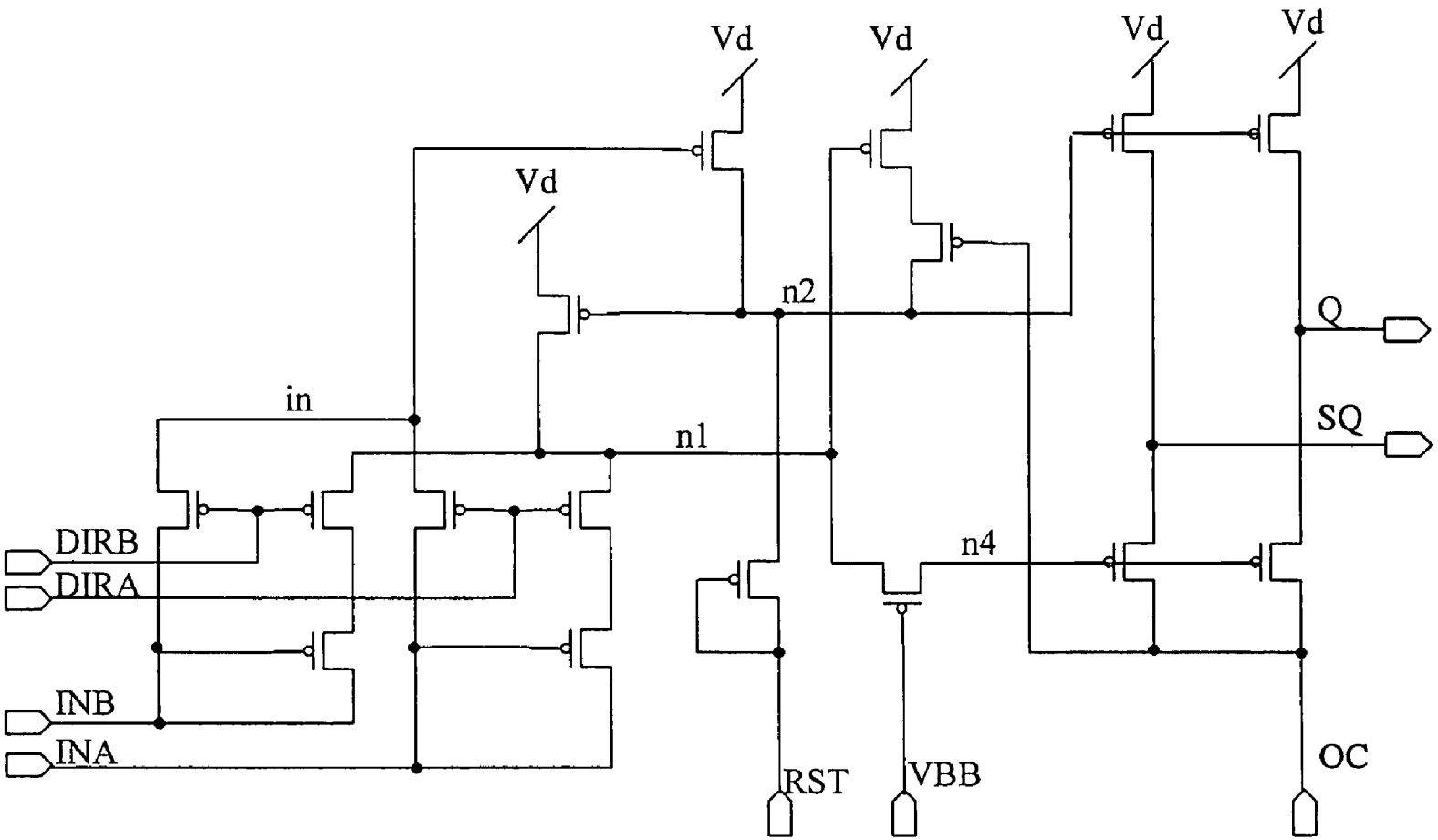
FIG. 73 is an explanatory diagram illustrating a drive circuit according to the present invention.
Figure 74:
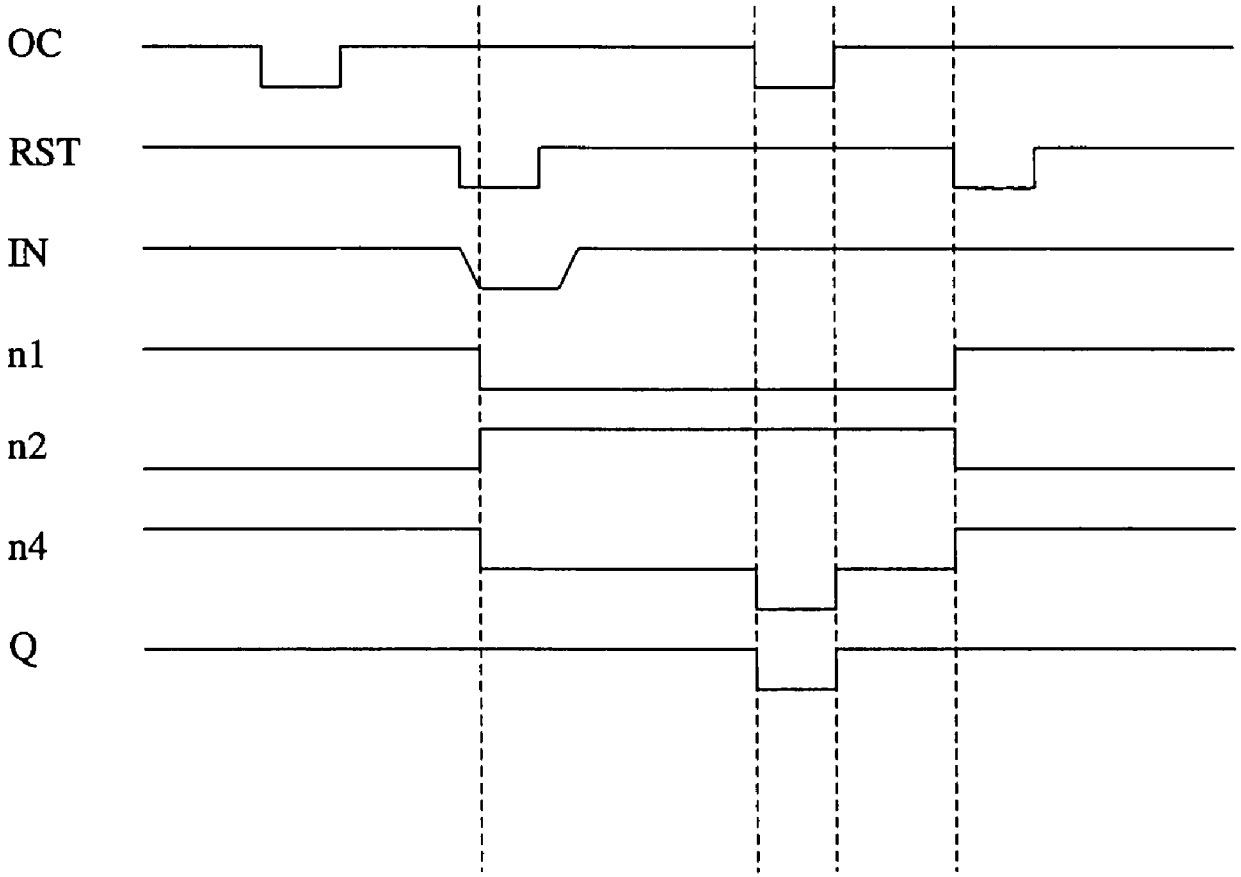
FIG. 74 is an explanatory diagram illustrating a drive circuit according to the present invention.

FIG. 73 shows a circuit configuration of the unit gate output circuit 711, which uses only P-channel transistors. FIG. 74 is a timing chart for use to explain the circuit configuration of FIG. 73. FIG. 72 is a timing chart of multiple stages in FIG. 73. Thus, by understanding FIG. 73, it is possible to understand overall operation. Rather than being explained in text, the operation can be understood with reference to the timing chart in FIG. 74 in conjunction with the equivalent circuit diagram in FIG. 73, and thus detailed description of transistor operation will be omitted.

When driver circuits are built solely of P-channel transistors, it is basically difficult to maintain the gate signal lines 17 at an H level (Vd voltage in FIG. 73). It is also difficult to maintain them at an L level (VBB voltage in FIG. 73) for a long period of time, but they can be kept adequately at the H level for a short period such as during selection of a pixel row.

If the switching transistors 11*b* and 11*c* of a pixel 16 are P-channel transistors, the pixel 16 becomes selected at Vgh, and becomes deselected at Vgl. As described earlier, when the gate signal line 17*a* changes from Vgl (on) to Vgh (off), voltage penetrates (penetration voltage). If the driver transistor 11*a* of the pixel 16 is a P-channel transistor, the penetration voltage restricts the flow of current through the transistor 11*a* in black display mode. This makes it possible to achieve a proper black display. The problem with the current-driven system is that it is difficult to achieve a black display. However, if P-channel transistors are used for the gate driver circuits 12, the turn-on voltage corresponds to Vgh. Thus, the gate driver circuits 12 match well with the pixels 16 constructed from P-channel transistors. Also, it is important that the programming current Iw flows from the anode voltage Vdd to the unit transistors 484 of the source driver circuits 14 via the driver transistors 11*a* and source signal lines 18, as is the case with the pixel 16 configuration shown in FIGS. 1, 2, 32, 113, and 116. Thus, a good synergistic effect can be produced if P-channel transistors are used for the gate driver circuits 12 and pixels 16, the source driver circuits 14 are mounted on the substrate, and N-channel transistors are used as the unit transistors 484 of the source driver circuits 14. Besides, unit transistors 484 constituted of N-channel transistors have smaller variations in output current than unit transistors 484 constituted of P-channel transistors.

The same applies to FIG. 42(*b*). FIG. 42(*b*) shows a configuration in which a programming current Iw flows from an anode voltage Vdd to the unit transistors 484 of a source driver circuit 14 via a programming transistor 11*a* and source signal line 18 rather than a configuration in which current flows into the unit transistors 484 of a source driver circuit 14 via a driver transistor 11*b*. Thus, as in the case of FIG. 1, a good synergistic effect can be produced if P-channel transistors are used for the gate driver circuits 12 and pixels 16, the source driver circuits 14 are mounted on the substrate, and N-channel transistors are used as the unit transistors 484 of the source driver circuits 14.

A signal fed to an IN terminal and the SCK clock fed to the RST terminal invert the state of n1 with respect to n2. Although n2 and n4 have potentials of the same polarity, the SCK clock fed to the OC terminal lowers the potential level of n4 further. In contrast, a Q terminal is kept at the L level for the same period (a turn-on voltage is output from the gate signal line 17). A signal outputted to an SQ terminal or the Q terminal is transferred to the unit gate output circuit 711 in the next stage.

Figure 75:
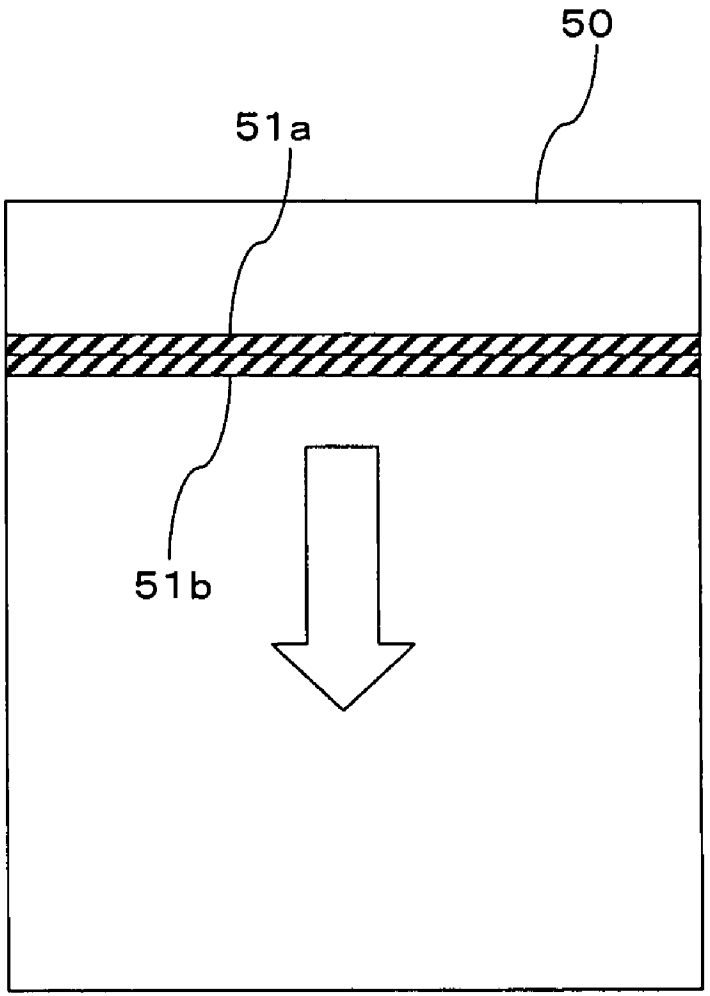
FIG. 75 is an explanatory diagram illustrating a drive method of a display apparatus according to the present invention.
Figure 75:
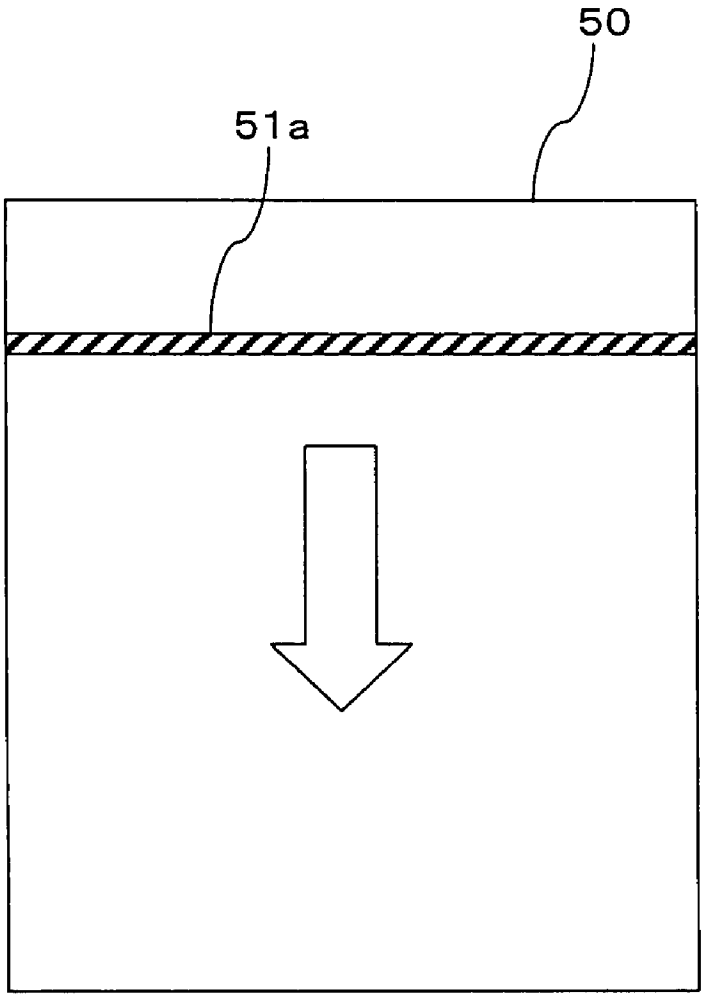

In the circuit configuration in FIGS. 71 and 73, by controlling the IN (INA and INB) terminals and the timings of signal application to clock terminals, it is possible to two modes using the same circuit configuration: a mode in which one gate signal line 17 is selected as shown in FIG. 75(*a*) and a mode in which two gate signal lines 17 are selected as shown in FIG. 75(*b*).

In the selection-side gate driver circuit 12*a*, FIG. 75(*a*) shows a drive mode in which pixel rows are selected one (51*a*) at a time (normal driving) shifting on a row-by-row basis. FIG. 75(*b*) shows a configuration in which two pixel rows are selected at a time. This drive mode corresponds to the driving for simultaneous selection of multiple pixel rows (51*a* and 51*b*) described with reference to FIGS. 27, 28, and 29 (configuration in which a dummy pixel row is used). Two adjacent rows are selected at a time shifting on a row-by-row basis. According to the drive method in FIG. 75(*b*) in particular, while the pixel row (51*a*) holds final video, the pixel row 51*b* is precharged. This makes the pixel 16 easier to write into. That is, the present invention can switch between two drive modes by manipulating signals applied to terminals.

Figure 76:
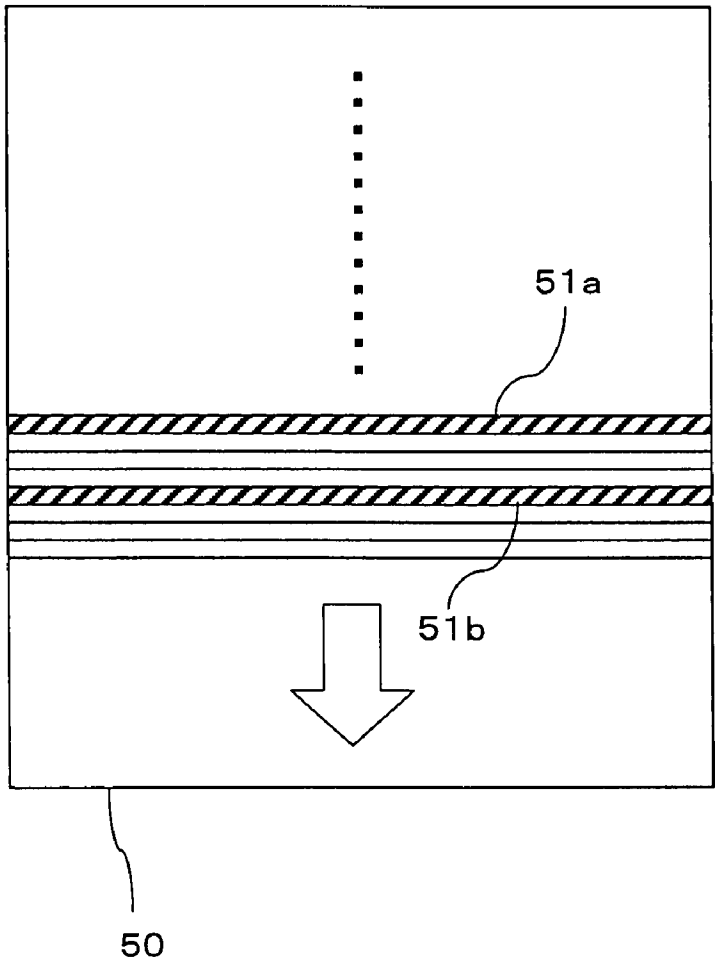
FIG. 76 is an explanatory diagram illustrating a drive method of a display apparatus according to the present invention.

Incidentally, although 75(*b*) shows a mode in which adjacent rows of pixels 16 are selected, it is also possible to select rows of pixels 16 other than adjacent pixel rows (FIG. 76 shows an example in which pixel rows three pixel rows apart are selected). In the configuration shown in FIG. 73, pixel rows are controlled in sets of four. Out of four pixel rows, it is possible to determine whether to select one pixel row or two consecutive pixel rows. The number of pixel rows in each set is restricted by the number of clocks (SCK), which is four in this case. If eight clocks (SCK) are used, pixel rows can be controlled in sets of eight.

Operation of the selection-side gate driver circuit 12*a* is shown in FIG. 75. In FIG. 75(*a*), one pixel row is selected at a time and selection position is shifted by one pixel row in sync with a horizontal synchronization signal. In FIG. 75(*b*), two pixel rows are selected at a time and selection position is shifted by one pixel row in sync with a horizontal synchronization signal.

With reference to drawings, description will be given below of a high-quality display method based on current driving (current programming). Current programming involves applying current signals to the pixels 16 and making the pixels 16 retain the current signals. Then the retained current is applied to the EL elements 15.

The EL elements 15 emit light in proportion to the applied current. That is, the emission brightness of the EL elements 15 has a linear relationship with programmed current. On the other hand, in the case of voltage programming, applied voltage is converted into current in the pixels 16. The voltage-current conversion is non-linear. Non-linear conversion involves a complicated control method.

In current programming, values of video data are converted directly into programming current linearly. To take a simple example, in the case of 64 gradation display, video data 0 is converted into a programming current Iw=0 μA and video data 63 is converted into a programming current Iw=6.3 μA (proportionality exists). Similarly, video data 32 is converted into a programming current Iw=3.2 μA and video data 10 is converted into a programming current Iw=1.0 μA. In short, video data are converted into programming current in direct proportion.

For ease of understanding, it has been stated that video data are converted into programming current in direct proportion. Actually, however, video data can be converted into programming current more easily. This is because according to the present invention, a unit current of the unit transistor 484 corresponds to video data 1 as illustrated in FIG. 48. Furthermore, the unit current can be adjusted easily to a desired value by adjusting reference current circuits. Besides, separate reference currents are provided for R, G, and B circuits and a white balance can be achieved over the entire gradation range by adjusting the R, G, and B reference current circuits. This is a result of synergy among current programming, the source driver circuits 14 of the present invention, and the configuration of the display panel.

EL display panels are characterized in that the emission brightness of the EL elements 15 has a linear relationship with programming current. This is a major feature of current programming. Thus, if the magnitude of the programming current is controlled, the emission brightness of the EL elements 15 can be adjusted linearly.

The relationship between the voltage applied to the gate terminal of the driver transistor 11*a* and the current passed through the driver transistor 11*a* is non-linear (often results in a quadratic curve). Therefore, in voltage programming, there is anon-linear relationship between programming voltage and emission brightness, making it extremely difficult to control light emission. In contrast, current programming makes light emission control extremely easy. In particular, with the configuration shown in FIG. 1, the programming current is theoretically equal to the current flowing through the EL element 15. This makes light emission control extremely easy to understand and easy to control. The N-fold pulse driving according to the present invention also excels in light emission control because the emission brightness can be determined by dividing the programming current by N. If pixels have a current-mirror configuration as in the case of FIG. 38, the driver transistor 11*b* and programming transistor 11*a* are different, which causes a deviation in the current mirror ratio, introducing an error factor into emission brightness. However, the pixel configuration in FIG. 1, in which the driver transistor and programming transistor are identical, is free of this problem.

The emission brightness of the EL element 15 changes in proportion to the amount of supplied current. The value of the voltage (anode voltage) applied to the EL element 15 is fixed. Therefore, emission brightness of the EL display panel is proportional to power consumption.

Thus, video data is proportional to programming current, which is proportional to the emission brightness of the EL element 15, which in turn is proportional to power consumption. Therefore, by performing logic processes on the video data, it is possible to control the power consumption (power), and emission brightness of the EL display panel. That is, by performing logic processes (addition, etc.) on the video data, it is possible to determine the brightness and power consumption of the EL display panel. This makes it extremely easy to prevent peak current from exceeding a set value.

In particular, the EL display panel of the present invention is a current-driven type. In addition, characteristic configuration makes it easy to control image display. There are two characteristic image display control method. One of them is reference current control. The other is duty cycle control. The reference current control and duty cycle control, when used singly or in conjunction, can achieve a wide dynamic range, high-quality display, and high contrast.

To begin with, regarding reference current control, the source driver circuit (IC) 14 is equipped with circuits which control RGB reference currents, as illustrated in FIG. 77. The magnitude of the programming current Iw flowing from the source driver circuit 14 to the unit transistors 484 depends on the number of the unit transistors 484.

The current outputted by one unit transistor 484 is proportional to the magnitude of the reference current. Thus, as the reference current is adjusted, the current outputted by one unit transistor 484 and the magnitude of the programming current are determined. The reference current and the output current of the unit transistor 484 have a linear relationship and the programming current and brightness have a linear relationship. Therefore, if the RGB reference currents and white balance are adjusted in white raster display, the white balance can be maintained for all gradations.

Incidentally, although the current mirrors in FIG. 77 have multi-stage connections, the present invention is not limited to this. Needless to say, even the single-stage source driver circuits (ICs) 14 shown in FIG. 166 to 170 can easily adjust reference currents and maintain white balance over all the gradations. Also, it goes without saying that the brightness of the EL display panel can be controlled through adjustment of the reference currents.

Figure 78:
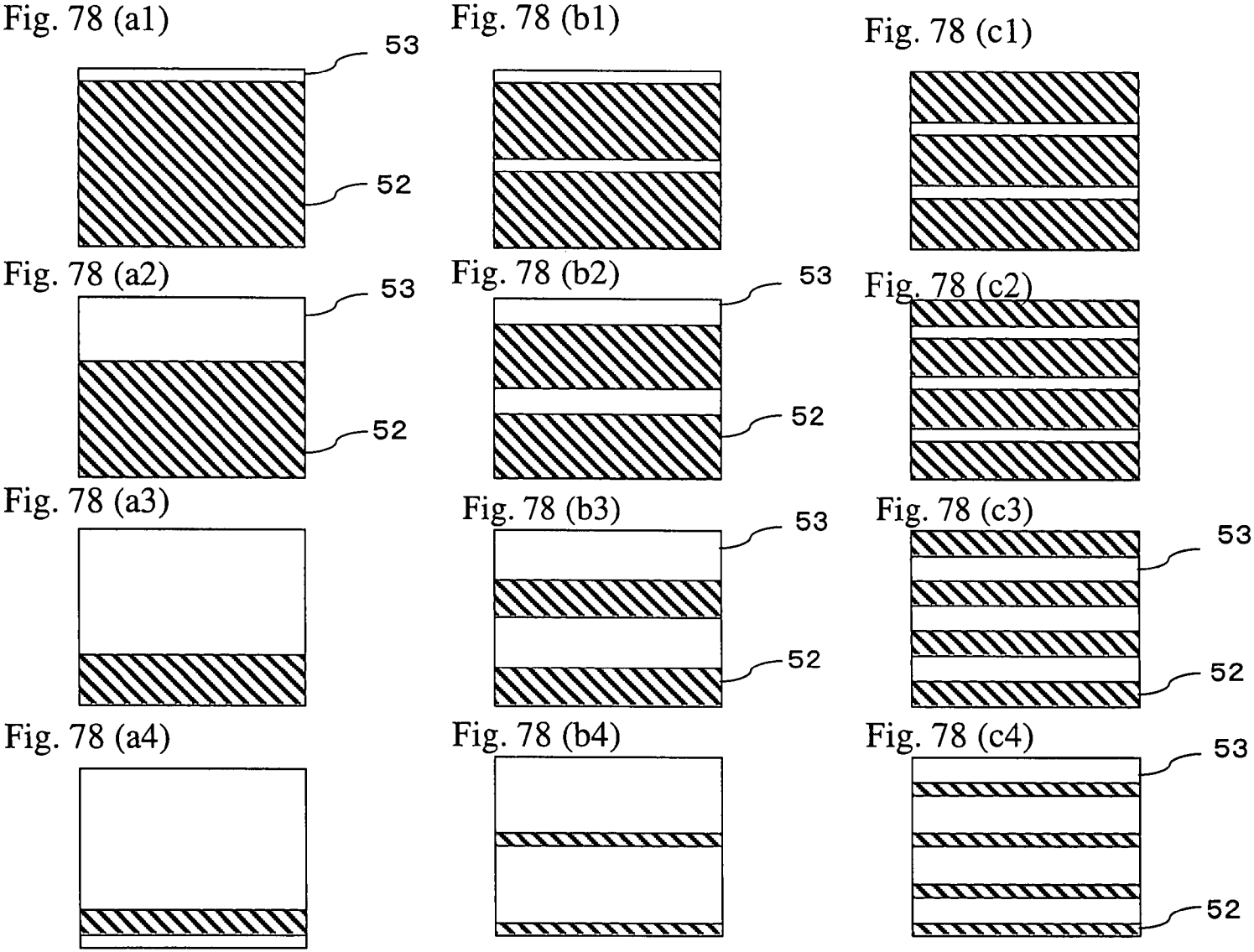
FIG. 78 is an explanatory diagram illustrating a drive method of a display apparatus according to the present invention.

FIG. 78 shows duty cycle control methods. FIG. 78(*a*) shows a method of inserting a non-display area 52 continuously. This method is suitable for movie display. The image in FIG. 78(*a*1) is the darkest and the image in FIG. 78(*a*4) is the brightest. The duty ratio can be changed easily through control of the gate signal line 17*b*. FIG. 78(*c*) shows a method of inserting a non-display area 52 by dividing it into multiple parts. This method is suitable especially for still picture display. The image in FIG. 78(*c*1) is the darkest and the image in FIG. 78(*c*4) is the brightest. The duty ratio can be changed easily through control of the gate signal line 17*b*. FIG. 78(*b*) shows something in between FIG. 78(*a*) and FIG. 78(*c*). Again, the duty ratio can be changed easily through control of the gate signal line 17*b*.

If the number of pixel rows is 220 and the duty ratio is 1/4, since 220/4=55, the brightness of the display area 53 can be varied from 1 to 55 (from brightness 1 to 55 times the brightness 1). Also, if the number of pixel rows is 220 and the duty ratio is 1/2, since 220/2=110, the brightness of the display area 53 can be varied from 1 to 110 (from brightness 1 to 110 times the brightness 1). Thus, the adjustable range of the brightness of the screen 50 is very wide (the dynamic range of image display is wide). Also, the number of gradations which can be expressed is the same at any brightness. For example, in the case of 64 gradation display, 64 gradations can be displayed whether the brightness of the screen 50 in white raster display is 300 nt or 3 nt.

As described earlier, the duty ratio can be changed easily through control of the start pulse applied to the gate driver circuit 126. Thus, it can be easily changed to any of various values, including 1/2, 1/4, 3/4, and 3/8.

Duty ratio driving based on a unit duration of one horizontal scanning period (1 H) can be achieved by the application of on/off signals to the gate signal line 17*b* in sync with a horizontal synchronization signal. However, duty cycle control can also be performed using a unit duration shorter than 1 H. Such drive methods are shown in FIGS. 145 and 146. Brightness (duty ratio) can be controlled in fine steps through OEV2-based control at intervals of 1 H or less (see also FIGS. 109 and 175 and their description).

Duty cycle control at intervals of 1 H or less should be performed when the duty ratio is 1/4. If the number of pixel rows is 200, the duty ratio is 55/220 or less. That is, the duty cycle control should be performed with a duty ratio in the range of 1/220 to 55/220. It should be performed when a single step causes a change of 1/20 (5%) or more. More preferably, fine duty ratio driving control should be performed using OEV2-based control even if a single change is 1/50 (2%) or less. That is, in the duty cycle control by means of the gate signal line 17*b*, if a single step produces a brightness change of 5% or more, OEV2-based control should be used to change brightness little by little in such a way as to keep the amount of single change within 5%. Preferably, this is done using a Wait function described with reference to FIG. 94.

In duty cycle control at a duty ratio of 1/4 and at intervals of 1 H or less, a single step produces a large change. Besides, even minute changes tend to be perceived visually due to halftone image display. Human vision has low detection capability with respect to brightness on a screen darker than a certain level. Also, it has low detection capability with respect to brightness changes on a screen brighter than a certain level. It is believed that this is because human vision has square-law characteristics.

FIG. 175 shows a graphic plot of a detection function against changes on a screen. The horizontal axis represents screen brightness (nt) while the vertical axis represents permissible change (%). The permissible change (%) represents tolerance limits to the rate of brightness change which results when the duty ratio is changed from an arbitrary value to the next value. However, the permissible change (%) depends heavily on image content (the rate of change, scene, etc.). Also, it tends to depend on individual capability for movie detection.

As can be seen from FIG. 174, when the brightness of the screen 50 is high, the permissible duty ratio change is large. When the brightness of the screen 50 is low, the permissible duty ratio change also tends to be large. However, in the case of halftone display, the tolerance limits in terms of the permissible change (%) are small. This is because in halftone images, even minute changes tend to be perceived visually.

To take an example, if the number of pixel rows in the panel is 200, duty cycle control is performed at intervals of 1 H or less using OEV2-based control at a duty ratio of 50/200 or less (from 1/200 to 50/200 both inclusive). When the duty ratio changes from 1/200 to 2/200, the difference between 1/200 and 2/200 is 1/200, meaning a 100% change. This change is fully perceived visually as flickering. Thus, the current supply to the EL elements 15 is controlled by OEV2-based control (see FIG. 175, etc.) at intervals of 1 H (one horizontal scanning period) or less. Incidentally, although it has been stated that duty cycle control is performed at intervals of 1 H or less, this is not restrictive. As can be seen from FIG. 19, the non-display area 52 is continuous. This means that control at intervals of 10.5 Hs is also included in the scope of the present invention. Thus, the present invention performs duty cycle control at intervals which is not limited to 1 H (and which may contain a decimal part).

When the duty ratio changes from 40/200 to 41/200, the difference between 40/200 and 41/200 is 1/200, meaning a (1/200)/(40/200) or 2.5% change. Whether this change is perceived visually as flickering is highly likely to depend on the brightness of the screen 50. However, the duty ratio of 40/200 means a halftone display, which is related to high visual sensitivity. Thus, it is desirable to control the current supply to the EL elements 15 by means of OEV2-based control (see FIG. 175, etc.) at intervals of 1 H (one horizontal scanning period) or less.

Thus, the drive method and display apparatus of the present invention generate at least the display mode shown in FIG. 19 for display images (the display area 53 may occupy the entire screen 50 (meaning a duty ratio of 1/1 depending on the brightness of the images)) in a display panel comprising means (e.g., the capacitor 19 in FIG. 1) of storing the values of current to be passed through the EL elements 15 in the pixels 16 and means (e.g., the pixel configuration in FIG. 1, 43, 113, 114, 117, or the like) of turning on and off the current paths between the driver transistors 11*a* and light-emitting elements (e.g., the EL elements 15). Also, in duty ratio driving (a drive method or drive mode in which at least part of the screen 50 is occupied by a non-display area 52) at a duty ratio not higher than a predetermined value, the drive method and display apparatus of the present invention control the brightness of the screen 50 by controlling the current passed through the EL elements 15 for a unit duration of one horizontal scanning period (period of 1 H) or less. This control uses OEV2-based control (for OEV2, see FIG. 175 and its description).

Duty cycle control based on a unit duration of other than 1 H should be performed when the duty ratio is 1/4. Conversely, when the duty ratio is not lower than a predetermined value, duty cycle control should be performed using a unit duration of 1 H or no OEV2-based control should be performed. Duty cycle control using a unit duration of other than 1 H should be performed when a single step causes a change of 1/20 (5%) or more. More preferably, fine duty ratio control driving should be performed using OEV2-based control even if a single change is 1/50 (2%) or less. Alternatively, it should be performed at a brightness 1/4 the maximum brightness of white raster.

The duty cycle control driving according to the present invention allows an EL display panel capable of, for example, 64-gradation display to maintain 64-gradation display regardless of the display brightness (nt) of the screen 50, as illustrated in FIG. 79. For example, even if the number of pixel rows is 220 and only one pixel row constitutes a display area 53 (is in display mode) (the duty ratio is 1/220), a 64-gradation display can be achieved. This is because images are written into one after another of pixel rows by the programming current Iw from the source driver circuits 14 and the images are displayed by one after another of the pixel rows.

Of course, when all the 220 pixel rows constitute a display area 53 (are in display mode) (the duty ratio is 220/220=1/1), a 64-gradation display can be achieved as well. This is because images are written into one after another of pixel rows by the programming current Iw from the source driver circuits 14 and the images carried by all the pixel rows are displayed at once by the gate signal lines 17*b*. Also, when only 20 pixel rows constitute a display area 53 (are in display mode) (the duty ratio is 20/220=1/11), a 64-gradation display can be achieved as well. This is because images are written into one after another of pixel rows by the programming current Iw from the source driver circuits 14 and the images are displayed as the 20 pixel rows are scanned one after another by the gate signal lines 17.

Since the duty cycle control driving according to the present invention controls the illumination time of the EL elements 15, there is a linear relationship between the duty ratio and screen 50 brightness. This makes it extremely easy to control image brightness, simplify signal processing circuits, and reduce costs. As shown in FIG. 77, the RGB reference currents are adjusted to achieve a white balance. In duty cycle control, since RGB brightness is controlled simultaneously, white balance is maintained at any gradation and at any screen 50 brightness.

Duty cycle control consists in varying the brightness of the screen 50 by varying the size of the display area 53 in relation to the screen 50. Naturally, current flows through the EL display panel in approximate proportion to the display area 53. Therefore, by determining the sum of video data, it is possible to calculate the total current consumption of the EL elements 15 of the display screen 50. Since the anode voltage Vdd of the EL elements 15 is a direct voltage and its value is fixed, if the total current consumption can be calculated, total power consumption can be calculated in real time according to image data. If the calculated total power consumption is expected to exceed prescribed maximum power, the RGB reference currents in FIG. 77 can be controlled through adjustment of a regulator circuit such as an electronic regulator.

Brightness is preset during white raster display in such a way as to minimized the duty ratio at this time. For example, the duty ratio is set to 1/8. The duty ratio is increased for natural images. The maximum duty ratio is 1/1. The duty ratio available when a natural image is displayed in only 1/100 of the screen 50 is taken as 1/1. The duty ratio is varied smoothly from 1/1 to 1/8 based on display condition of natural images.

Thus, as an example, the duty ratio is set to 1/8 during white raster display (a state in which 100% of the pixels are illuminated in white raster display) and is set to 1/1 when 1/100 of the pixels on the screen 50 are illuminated. The duty ratio can be calculated approximately using the formula: "the number of pixels"×"ratio of illuminated pixels"×"duty ratio."

If it is assumed for ease of explanation that the number of pixels is 100, the power consumption for white raster display is 100×1 (100%)×1/8 (duty ratio)=80. On the other hand, the power consumption for natural image display for which 1/100 of pixels illuminate is 100×1/100 (1%)×1/1 (duty ratio)=1. The duty ratio is varied smoothly from 1/1 to 1/8according to the number of illuminated pixels of images (actually, total current drawn by illuminated pixels=sum total of programming currents per frame) so that no flickering will occur.

Thus, the power consumption ratio for white raster display is 80 and the power consumption ratio for natural image display for which 1/100 of pixels illuminate is 1. Therefore, by presetting a brightness during white raster display in such away as to minimized the duty ratio at this time, it is possible to reduce the maximum current.

The present invention performs drive control using S×D, where S is the sum total of programming currents per screen and D is a duty ratio. Also, the present invention provides a drive method which maintains a relationship Sw×Dmin≧Ss×Dmax as well as a display apparatus which implements the drive method, where Sw is the sum total of programming currents for white raster display, Dmax is the maximum duty ratio (normally, the maximum duty ratio is 1/1), Dmin is the minimum duty ratio, and Ss is the sum total of programming currents for an arbitrary natural image.

Incidentally, it is assumed that the maximum duty ratio is 1/1. Preferably, the minimum duty ratio is 1/16 or above. That is, the duty ratio should be from 1/8tol/1 (both inclusive) Needless to say, it is not strictly necessary to use the duty ratio of 1/1. Preferably, the minimum duty ratio is 1/10 or above. To small a duty ratio makes flickering conspicuous as well as causes screen brightness to vary greatly with the image content, making the image hard to see.

As described earlier, programming current is proportional to video data. Thus, "the sum total of video data" is synonymous with "the sum total of programming currents." Incidentally, although it has been stated that the sum total of programming currents is determined over one frame (field) period, this is not restrictive. It is also possible to determine the sum total of programming currents (video data) by sampling pixels which add to programming currents at predetermined intervals or on a predetermined cycle during one frame (field) period. Alternatively, it is also possible to use the total sum before and after the frame (field) period to be controlled. Also, an estimated or predicted total sum may be used for duty cycle control.

Incidentally, it has been stated that the duty ratio D is used for control, the duty ratio is an illumination period of the EL element 15 (normally one field or one frame. In other words, this is generally a cycle or time during which image data of a given pixel is rewritten). Specifically, a duty ratio of 1/8 means that the EL element 15 illuminates for 1/8 of one frame period (1F/8). Thus, if the cycle/time during which the pixel 16 is rewritten is denoted by Tf and the illumination period of the pixel is denoted by Ta, the duty ratio is given by duty ratio=Ta/Tf.

Incidentally, although it has been stated that Tf denotes the cycle/time during which the pixel 16 is rewritten and that Tf is used as a reference, this is not restrictive. The duty cycle control driving according to the present invention does not need to complete in one frame or one field. That is, the duty cycle control may be performed using a few fields or few frame periods as one cycle (see FIG. 104, etc.). Thus, Tf is not limited to the cycle during which the pixel 16 is rewritten. It may be one frame/field or more. For example, if the illumination period Ta varies from field to field (or from frame to frame), the total illumination period Ta during a repetition cycle (period) Tf may be adopted. That is, average illumination time over a few fields or few frame periods may be used as Ta. The same applies to the duty ratio. If the duty ratio varies from field to field (or from frame to frame) the average duty ratio over a few frames (fields) may be calculated and used.

Thus, the present invention provides a drive method which maintains a relationship Sw×(Tas/Tf)≧Ss×(Tam/Tf) as well as a display apparatus which implements the drive method, where Sw is the sum total of programming currents for white raster display, Ss is the sum total of programming currents for an arbitrary natural image, Tas is the minimum illumination period, and Tam is the maximum illumination period (normally, Tam=Tf, and thus Tam/Tf=1).

As a method of controlling the brightness of the screen 50, the configuration described with reference to FIG. 77 and the like is available. To vary the screen brightness 50, this method adjusts reference current, thereby varying the current flowing through the unit transistor 484, and thereby adjusting the magnitude of the programming current. Incidentally, the method of adjusting reference current has been described with reference to FIG. 53 and the like.

Referring to FIG. 77, reference numeral 491R denotes a regulator used to control reference current for red (R). The term "regulator" is used for ease of understanding. Actually, this component is called an electronic regulator. It is configured to adjust reference current IaR for an R circuit linearly in 64 steps in response to a 6-bit digital signal from outside. By adjusting the reference current IaR, it is possible to linearly vary the current flowing through transistors 472*a* which constitutes a current mirror with a transistor 471R. This causes changes to the current flowing through the transistors 472*a* in a transistor group 521*a* and a transistor 472*b* which has received a current-based delivery from the transistors 472*a*. This in turn causes changes to transistors 473*a* in a transistor group 521*b* which constitutes a current mirror with the transistor 472*b*, resulting in changes to a transistor 473*b* which has received a current-based delivery from the transistors 473*a*. Thus, since the drive current (unit current) of the unit transistors 484 changes, the programming current can be changed. Incidentally, the same applies to reference current IaG for G and reference current IaB for B.

Although FIG. 77 shows a three-stage transistor connections consisting of a parent, children, and grandchildren, the present invention is not limited to this. Needless to say, the present invention is also applicable, for example, to a single-stage configuration in which a circuit which generates reference current is directly connected to unit transistors 484 as shown in FIGS. 166 to 170. That is, the present invention is a system which varies the brightness of the screen 50 using reference current or reference voltage in a circuit configuration in which programming current or programming voltage can be varied by a reference current or reference voltage.

As shown in FIG. 77, an (electronic) regulator 491 is formed for each of red (R), green (G), and blue (B) circuits. Thus, by regulating the regulators 491R, 491G, and 491B, it is possible to vary (control or adjust) the current on the unit transistors 484 connected to the respective regulators. Thus, white (W) balance can be adjusted easily through adjustment of the ratio among R, G, and B. Of course, if the RGB reference currents (currents which flow through transistors 472R, 472G, and 472B) have been adjusted at the factory, by separately installing an electronic regulator which can control the RGB electronic regulators (491R, 491G, and 491B) all at once, it is possible to adjust the white (W) balance as well. For example, in FIGS. 170 and 171, the value of resistance R1 is adjusted so as to achieve a white balance in the RGB circuits. In this state, if switches of the electronic regulator 451 in FIGS. 169 and 170 are operated commonly for R, G, and B, the screen brightness can be adjusted with the white balance maintained.

In this way, the drive method of reference current according to the present invention adjusts the values of RGB reference currents by achieving a white balance. Then, based on this state, the drive method adjusts the RGB reference currents at the same ratio. For that, the white balance is maintained.

Through the adjustment of the electronic regulators 491, the programming current can be varied linearly. Incidentally although the pixel configuration shown in FIG. 1 is cited as an example for ease of explanation, the present invention is not limited to this. Needless to say, other pixel configurations may be used as well.

As illustrated in, or described with reference to, FIG. 77, the programming current can be adjusted linearly through control of the reference current. This is because the output current of each unit transistor 484 changes. As the output current of the unit transistor 484 is varied, the programming current Iw changes as well. The larger the current (actually, the voltage which corresponds to the programming current) programmed into the capacitor 19 of a pixel, the larger the current flowing through the EL element 15. The current flowing through the EL element is linearly proportional to emission brightness. Thus, by varying the reference current, it is possible to vary the emission brightness of the EL element linearly.

The present invention controls screen brightness and the like using at least either the reference current control system described with reference to FIG. 77 or the duty cycle control system described with reference to FIG. 78. Preferably, both systems are used in combination.

Drive methods which employ the systems described with reference to FIGS. 77 and 78 will be described below in more detail. One object of the present invention is to place an upper limit on the current consumption of EL display panels. In EL display panels, there is proportionality between the current flowing through the EL element 15 and emission brightness. Thus, by increasing the current flowing through the EL element 5, the EL display panel can be made ever brighter. The current consumed (=current consumption) also increases in proportion to the brightness.

In the case of portable apparatus, there are limits to battery capacity and the like. Also, a power supply circuit increases in scale with increases in current consumption. Thus, it is necessary to place limits on current consumption. It is an object of the present invention to place such limits (peak current control).

Also, increasing image contrast improves display. By converting images into high-contrast images, it is possible to improves display. It is another object of the present invention to improve image display in this way. An invention which achieves the two objects (or one of them) will be referred to as AI driving.

First, for ease of explanation, it is assumed that an IC chip 14 of the present invention is compatible with 64-gradation display. To implement AI driving, it is desirable to extend a range of gradation representation. For ease of explanation, it is assumed that a source driver circuit (IC) 14 of the present invention is compatible with 64-gradation display and that image data consists of 256 gradations. The image data is gamma-converted to suit the gamma characteristics of the EL display apparatus. The gamma conversion expands 256 gradations into 1024 gradations. The gamma-converted image data goes through an error diffusion process or frame rate control (FRC) process to be compatible with the 64-gradation source data and then it is applied to the source driver circuit 14.

Figure 99:
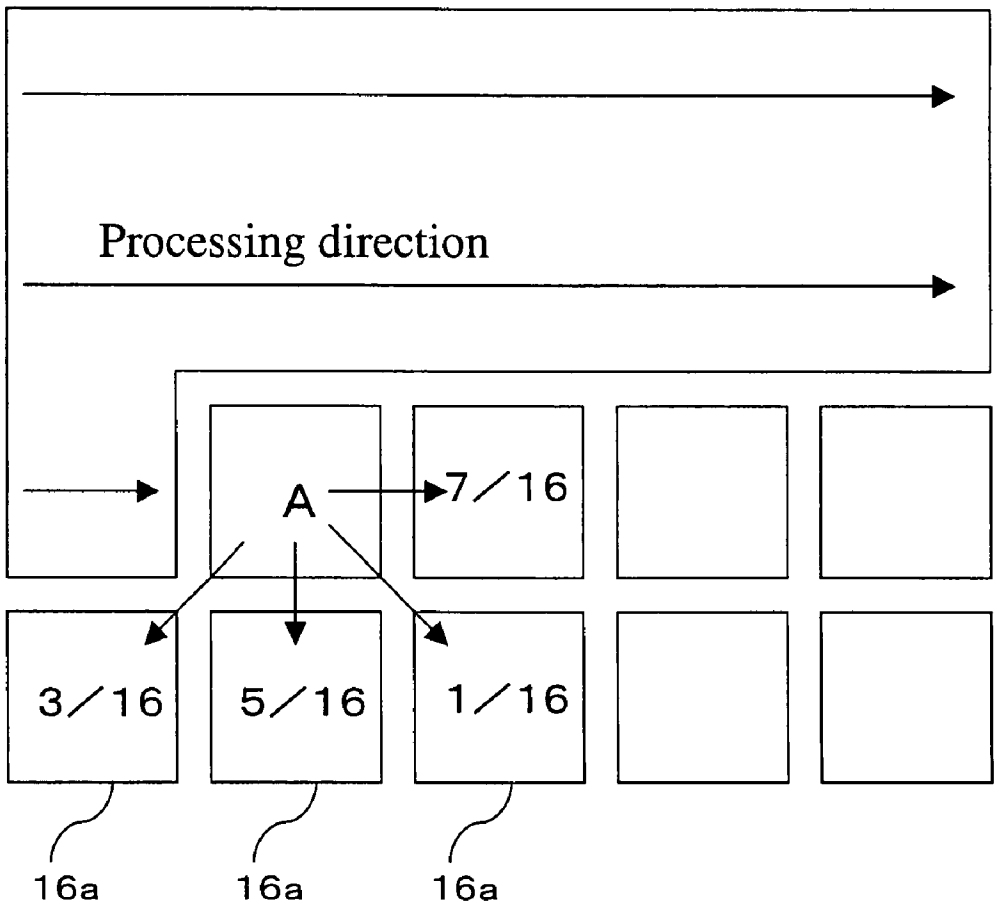
FIG. 99 is an explanatory diagram illustrating a drive circuit of a display apparatus according to the present invention.

The FRC achieves high-gradation display by superimposing image display on a frame-by-frame basis. As illustrated in FIG. 99, the error diffusion process scatters, for example image data of pixel A by 7/16 to the right, 3/16 to the lower left, 5/16 to the bottom, and 1/16 to the lower right with respect to a processing direction. The diffusion process achieves high-gradation display. This is a kind of area gradation.

Figure 80A:
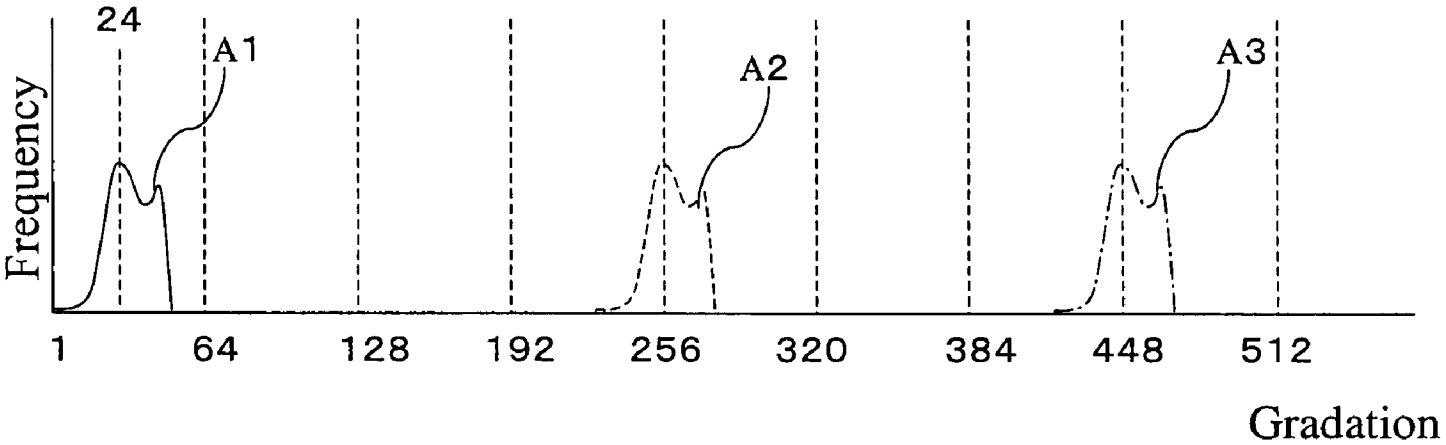
FIG. 80 is an explanatory diagram illustrating a drive method of a display apparatus according to the present invention.
Figure 80B:
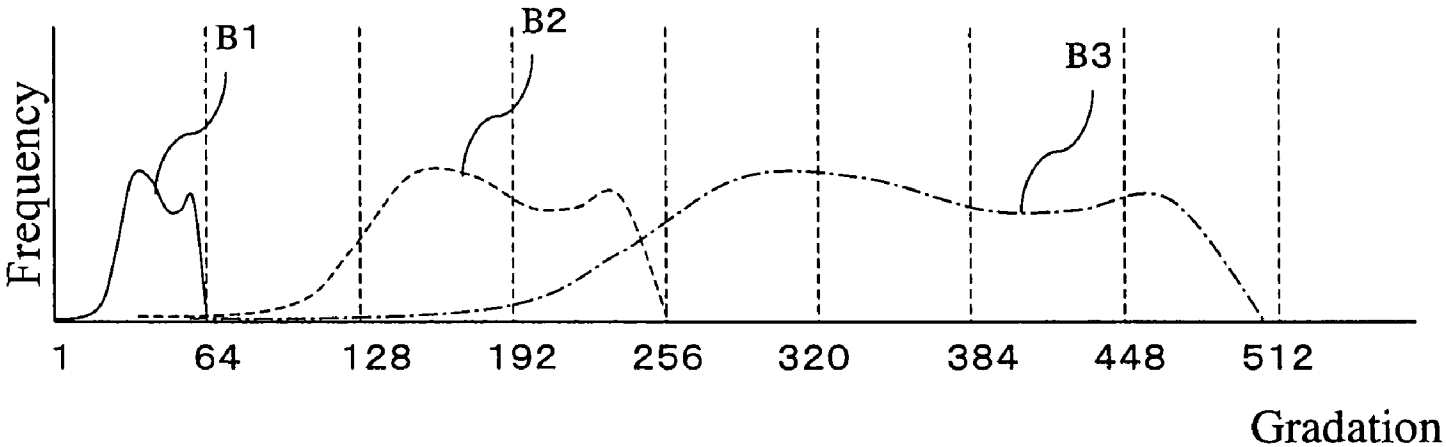
Figure 81A:
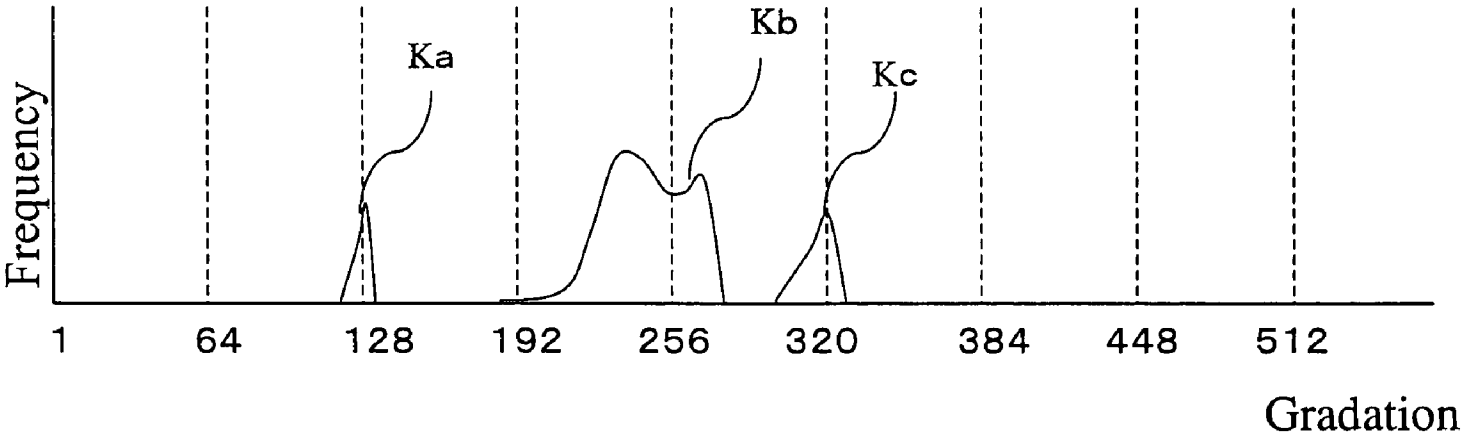
FIG. 81 is an explanatory diagram illustrating a drive method of a display apparatus according to the present invention.
Figure 81B:
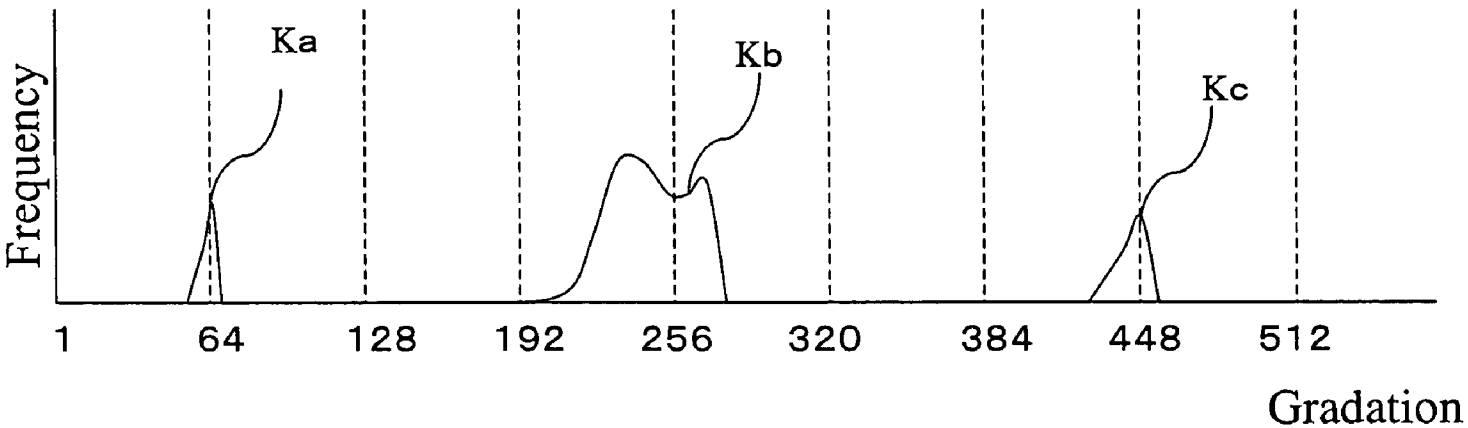

For ease of illustration, it is assumed in FIGS. 80 and 81 that 64-gradation display is converted into 512-gradation display. The error diffusion processing or frame rate control (FRC) is used for the conversion. However, the process in FIG. 80, may be interpreted as image brightness conversion rather than gradation conversion.

FIG. 80 illustrates an image conversion process based on the drive method according to the present invention. The horizontal axis in FIG. 80 represents gradation (number). The larger the gradation (number), the brighter the screen is. Conversely, the smaller the gradation (number), the darker the image is. The vertical axis represents frequency, i.e., the occurrence frequency of brightness of the pixels composing an image. For example, A1 in FIG. 80(*a*) shows that pixels with a brightness corresponding to the 32th gradation level occur most frequently in the image.

FIG. 80(*a*) shows an example in which display brightness is changed while maintaining the number of gradations. Suppose, A1 is an original image. The original image is expressed in approximately 64 gradations. A2 is an example in which the center of brightness is moved to the 256th gradation while maintaining the number of gradations. A3 is an example in which the center of brightness is moved to the 448th gradation while maintaining the number of gradations. Such conversion can be performed by adding data of a predetermined size to the image data.

However, the gradation conversion in FIG. 80(*a*) is difficult for the drive method according to the present invention to implement. The drive method according to the present invention performs gradation conversion shown in FIG. 80(*b*).

FIG. 80(*b*) is an enlargement of frequency distribution of the original image. Suppose, B1 is an original image. The original image is expressed in approximately 64 gradations. B2 is an example in which the original image is expressed in 256 gradations. The screen becomes brighter and the range of gradations is expanded. B3 is an example in which the range of gradations is further expanded to 512 gradations. The screen display becomes still brighter and the range of gradations is expanded.

The drive method according to the present invention can easily implement the gradation conversion in FIG. 80(*b*) by varying the reference current described with reference to FIG. 77, by varying (controlling) the duty ratio in FIG. 78, or by the combination of the methods in FIGS. 77 and 78. Image brightness can be controlled easily by reference current control or duty cycle control. For example, if the display condition represented by B2 in FIG. 80(*b*) exists when the duty ratio is 1/4, the display condition represented by B1 in FIG. 80(*b*) takes place when the duty ratio is changed to 1/16. If the duty ratio is changed to 1/2, the display condition represented by B3 in FIG. 80(*b*) takes place. The same applies to the reference current control. By doubling the magnitude of reference current or reducing it to a quarter, it is possible to create image display shown in FIG. 80(*b*)

The horizontal axis in FIG. 80(*b*) represents the number of gradations. The drive method according to the present invention does not increase the number of gradations. The drive method according to the present invention is characterized in that the number of gradations is maintained even if brightness changes. Specifically, the 64th gradation in B1 of FIG. 80(*b*) is converted into the 256th gradation in B2. However, the number of gradations in B2 is 64. The gradation range is extended to four times that of B1. The conversion from B1 to B2 is no other than dynamic conversion of image display. This is equivalent to implementation of high-gradation display. Thus, this makes it possible to achieve high-quality display.

Similarly, the 64th gradation in B1 of FIG. 80(*b*) is converted into the 512th gradation in B3. However, the number of gradations in B3 is 64. The gradation range is extended to eight times that of B1. The conversion from B1 to B3 is no other than dynamic conversion of image display.

The method in FIG. 80(*a*) can improve the brightness of the screen 50. However, the entire screen becomes whitish (poor display contrast). There are relatively small increases in current consumption (though current consumption increases in proportion to screen brightness). The method in FIG. 80(*b*) can improve the brightness of the screen 50 and increase a display range of gradations. Consequently, there is no degradation in image quality. However, current consumption increases greatly.

Assuming that the number of gradations is proportional to screen brightness and that the original image is expressed in 64 gradations, then "increase in the number of gradations (expansion of the dynamic range)"="increase in brightness." Thus, power consumption (current consumption) increases. To solve this problem, the present invention uses the reference current control system in FIG. 77, the duty cycle control system in FIG. 78, or a combination thereof.

If image data of one screen is generally large, the sum total of image data is large as well. Take as an example a white raster in 64-gradation display, since the white raster as image data is represented by 63, the sum total of image data is given by "the pixel count of the screen 50"×63. In the case of white display with the maximum brightness in 1/100 of the screen, the sum total of image data is given by "the pixel count of the screen 50"×1/100×63.

The present invention determines the sum total of image data or a value which allows the current consumption of the screen to be estimated, and performs duty cycle control or reference current control using the sum total or the value.

Incidentally, although the sum total of image data is determined above, this is not restrictive. For example, an average level of one frame of image data may be determined and used. In the case of an analog signal, the average level can be determined by filtering the analog image signal with a capacitor. Alternatively, it is possible to extract a direct current level from the analog image signal through a filter, subject the direct current level to A/D conversion, and use the result as the sum total of image data. In this case the image data may be referred to as an APL level.

Also, there is no need to add all the data composing an image on the screen 50. It is possible to pick up 1/W (w is larger than 1) of data on the screen 50 and determine the sum total of the data picked up.

For ease of explanation, it is assumed in the above case that the sum total of image data is determined. Calculation of the sum total of image data is often tantamount to determining the APL level of the image. Also, means of adding the sum total of image data digitally is available, and the above-mentioned sum total of image in a digital or analog fashion will be referred to as an APL level hereinafter for ease of explanation.

In the case of a white raster, since an image consists of 6 bits each of R, G, and B, the APL level is given by 63× pixel count (where 63 represents the data, which corresponds to the 63rd gradation, and the pixel count of a QCIF panel is 176×3×220). Thus, the APL level reaches its maximum. However, since the current consumption of the EL elements 15 vary among R, G, and B, preferably the image data should be calculated separately for R, G, and B.

Figure 84:
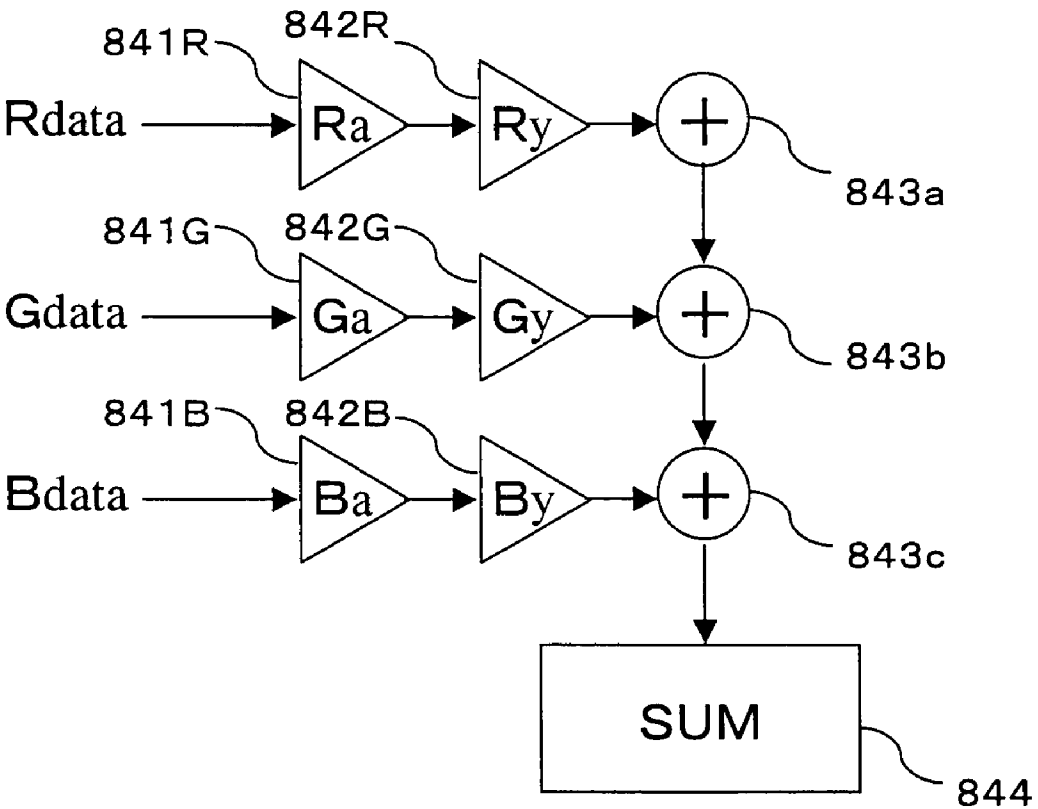
FIG. 84 is an explanatory diagram illustrating a drive circuit of a display apparatus according to the present invention.

To solve the above problem, an arithmetic circuit shown in FIG. 84 is used. In FIG. 84, reference numerals 841 and 842 denote multipliers, of which 841 is a multiplier used to weight emission brightness. Luminosity varies among R, G, and B. The ratio of NTSC-based luminosity among R, G, and B is R:G:B=3:6:1. Thus, the multiplier 841R for R multiplies R image data (Rdata) by 3, multiplier 841G for G multiplies G image data (Gdata) by 6, and multiplier 841B for B multiplies B image data (Bdata) by 1.

The light emission efficiency of the EL elements 15 varies among R, G, and B. The light emission efficiency of B is the lowest. The light emission efficiency of G is the next lowest. The light emission efficiency of R is good. Thus, the multipliers 842 weight data by the luminous efficiencies. The multiplier 842R for R multiplies the R image data (Rdata) by the light emission efficiency of R, multiplier 842G for G multiplies the G image data (Gdata) by the light emission efficiency of G, and multiplier 842B for B multiplies the B image data (Bdata) by the light emission efficiency of B.

The results produced by the multipliers 841 and 842 are added by an adder 843 and stored in a summation circuit 844. Then, the reference current control in FIG. 77 and duty cycle control in FIG. 78 are performed based on the results produced by the summation circuit 844.

The method in FIG. 84 allows a luminance signal (Y signal) to be subjected to duty cycle control and reference current control. However, duty control based on detection of the luminance signal (Y signal) may involve problems. For example, a blue back screen is a case in point. For a blue back screen, the EL panel consumes relatively large current. However, display brightness is low because of low luminosity of blue (B). Consequently, the sum total (APL level) of the luminance signal (Y signal) is calculated to be smaller, resulting in a high duty ratio. This causes flickering and the like.

To deal with this problem, it is recommendable to use the multipliers 841 in a pass-through mode. This makes it possible to find the sum total (APL level) based on current consumption. It is desirable to determine both the sum total (APL level) based on the luminance signal (Y signal) and sum total (APL level) based on current consumption and find a consolidated APL level taking both of them into consideration. Then, the duty cycle control and reference current control should be performed based on the consolidated APL level.

A black raster corresponds to the 0th gradation in the case of 64-gradation display, and thus the minimum APL level is 0. In drive methods in FIG. 80, power consumption (current consumption) is proportional to image data. Regarding image data, there is no need to count all the bits in the data on the screen 50. For example, if an image consists of 6-bit data, only the most significant bit (MSB) may be counted. In this case, 33 gradations are counted as 1. Thus, the APL level varies with the image data on the screen 50.

According to the present invention, either the duty cycle control in FIG. 78 or reference current control in FIG. 77 is performed depending on the APL level obtained.

For ease of understanding, description will be given citing concrete figures. However, this is virtual. In actual practice, control data and control directions must be determined through experiments and image evaluations.

Let us assume that the maximum current that can flow through an EL panel is 100 mA, that the sum total (APL level) in white raster display is 200 (no unit), and that a current of 200 mA will flow through the EL panel if the APL level of 200 is applied directly to the panel. Incidentally, when the APL level is 0, a zero (0 mA) current flows through the EL panel. Also, it is assumed that when the APL level is 100, the duty ratio is 1/2.

Thus, when the APL level is 100 or above, it is necessary to limit the current to 100 mA or below. The simplest way is to set the duty ratio to 1/2×1/2=1/4 when the APL level is 200 and set the duty ratio to 1/2 when the APL level is 100. When the APL level is between 100 and 200, the duty ratio should be controlled so as to fall within a range of 1/4 to 1/2. The duty ratio can be kept between 1/4 and 1/2 by controlling the number of gate signal lines 17*b* selected simultaneously by the EL-selection-side gate driver circuit 12*b*.

However, if duty cycle control is performed considering only the APL level, the average brightness (APL) of the screen 50 will vary with the image, causing flicker. To solve this problem, the APL level is retained for a period of at least 2 frames, preferably 10 frames, or more preferably 60 frames, and the duty ratio for duty cycle control is calculated using the data retained for this period. Also, it is preferable to extract characteristics of the screen 50 including its maximum brightness (MAX), minimum brightness (MIN), and brightness distribution (SGM) for use in the duty cycle control. Needless to say, the above items are also applicable to reference current control.

Also, it is important to do black stretching and white stretching based on the extracted image characteristics. Preferably, this is done taking into consideration the maximum brightness (MAX), minimum brightness (MIN), and brightness distribution (SGM). For example, in FIG. 81(*a*), central part Kb of the image data is distributed around the 256th gradation, high-brightness part Kc is distributed around the 320th gradation, and low-brightness part Ka is distributed around the 128th gradation.

FIG. 81(*b*) shows an example in which the image in FIG. 81(*a*) has undergone black stretching and white stretching. However, there is no need to perform both black stretching and white stretching at the same time. Only one of them will be sufficient. Also, the central part of the image (Kb in FIG. 81(*a*)) may be moved to the low-brightness part Ka or high-brightness part Kc. Information about such proper movements can also be obtained from the APL level, maximum brightness (MAX), minimum brightness (MIN), and brightness distribution (SGM). However, some information is obtained empirically because it is affected by human visibility. Thus, studies should be conducted through repeated experiments and image evaluations. However, image processing such as black stretching or white stretching can be performed easily because gamma curves can be determined based on computations or lookup tables. The processes in FIG. 81(*b*) enhance contrast, and thus help achieve proper image display.

Incidentally, the brightness of the screen 50 is varied by duty cycle control in the manner shown in FIG. 82. A drive method in FIG. 82(*a*) involves changing the display area 53 continuously. The screen 50 in FIG. 82(*a*1) is brighter than the screen 50 in FIG. 82 (*a*2). The screen 50 in FIG. 82(an) is the brightest. The drive method based on duty cycle control in FIG. 82(*a*) is suitable for movie display.

FIG. 82(*b*) shows a drive method which drives the display area 53 by dividing it. In FIG. 82(*b*1), two display areas 53 are generated at different locations on the screen 50. In FIG. 82(*b*2), two display areas 53 are generated at different locations on the screen 50 as in the case of FIG. 82(*b*1) but a pixel row has been added to one of the two display areas 53 (one of the display areas 53 contains one pixel row and the other contains two pixel rows). In FIG. 82(*b*3), two display areas 53 are generated at different locations on the screen 50 as in the case of FIG. 82(*b*2), but a pixel row has been added to one of the two display areas 53 (both display areas 53 contain two pixel rows). In this way, duty cycle control may be performed by scattering display areas 53. Generally, the drive method in FIG. 82(*b*) is suitable for still picture display.

In FIG. 82(*b*), display areas 53 are scattered to two locations for ease of drawing. Actually, display areas 53 are scattered to three or more locations.

Figure 83:
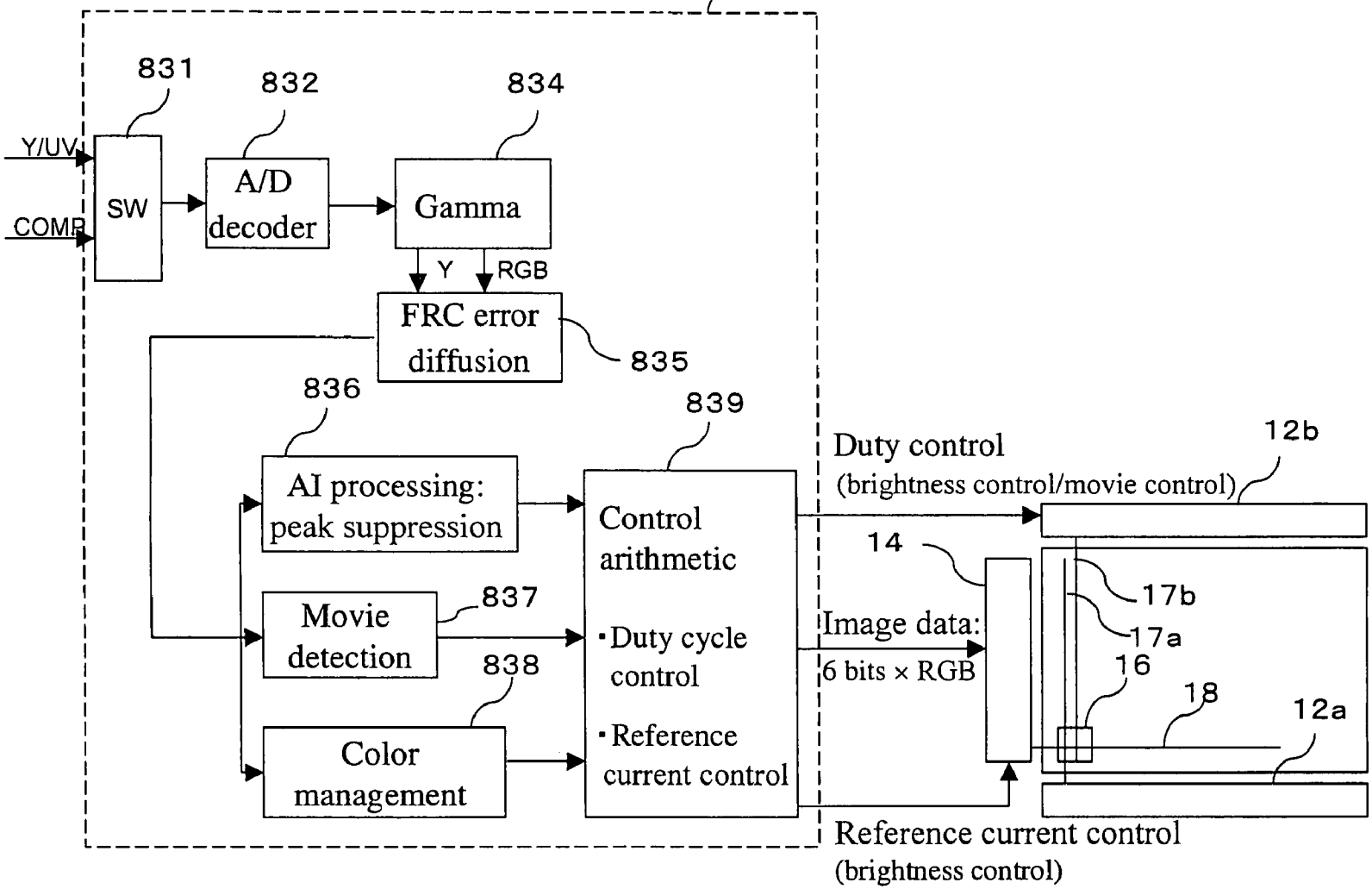
FIG. 83 is an explanatory diagram illustrating a drive circuit of a display apparatus according to the present invention.

FIG. 83 is a block diagram of a drive circuit according to the present invention. The drive circuit according to the present invention will be described below. The drive circuit in FIG. 83 is configured to receive input of a Y/UV video signal and composite (COMP) video signal. Of the two signals, the one to be input is selected by a switch circuit 831.

The video signal selected by the switch circuit 831 is subjected to decoding and A/D conversion by a decoder and A/D converter, and thereby converted into digital RGB image data. Each of the R, G, and B image data is 8-bit data. Also, the RGB image data go through gamma processing in a gamma circuit 834. At the same time, a luminance (Y) signal is determined. As a result of the gamma processing, each of the R, G, and B image data is converted into 10-bit data.

After the gamma processing, the image data are subjected to an FRC process or error diffusion process by a processing circuit 835. The RGB image data are converted into 6-bit data by the FRC process or error diffusion process. Then, the image data are subjected to an AI process of peak current process by an AI processing circuit 836. Also, movie detection is carried out by a movie detection circuit 837. At the same time, color management process is performed by a color management circuit 838.

Results of the processes performed by the AI processing circuit 836, movie detection circuit 837, and color management circuit 838 are sent to an arithmetic circuit 839 and converted by the arithmetic circuit 839 into data for use in control operations, duty cycle control, and reference current control. The resulting data are sent to the source driver circuit 14 and gate driver circuit 12 as control data.

The data for use in duty cycle control is sent to the gate driver circuit 12*b*, which performs duty cycle control. On the other hand, the data for use in duty cycle control is sent to the source driver circuit 14, which performs reference current control. The image data subjected to the gamma correction as well as to the FRC or error diffusion process are also sent to the source driver circuit 14.

The image data conversion in FIG. 81(*b*) should be performed by way of a gamma process in the gamma circuit 834. The gamma circuit 834 performs gradation conversion using multi-point polygonal gamma curves. 256-gradation image data are converted into 1024-gradation image data using multi-point polygonal gamma curves.

Figure 85:
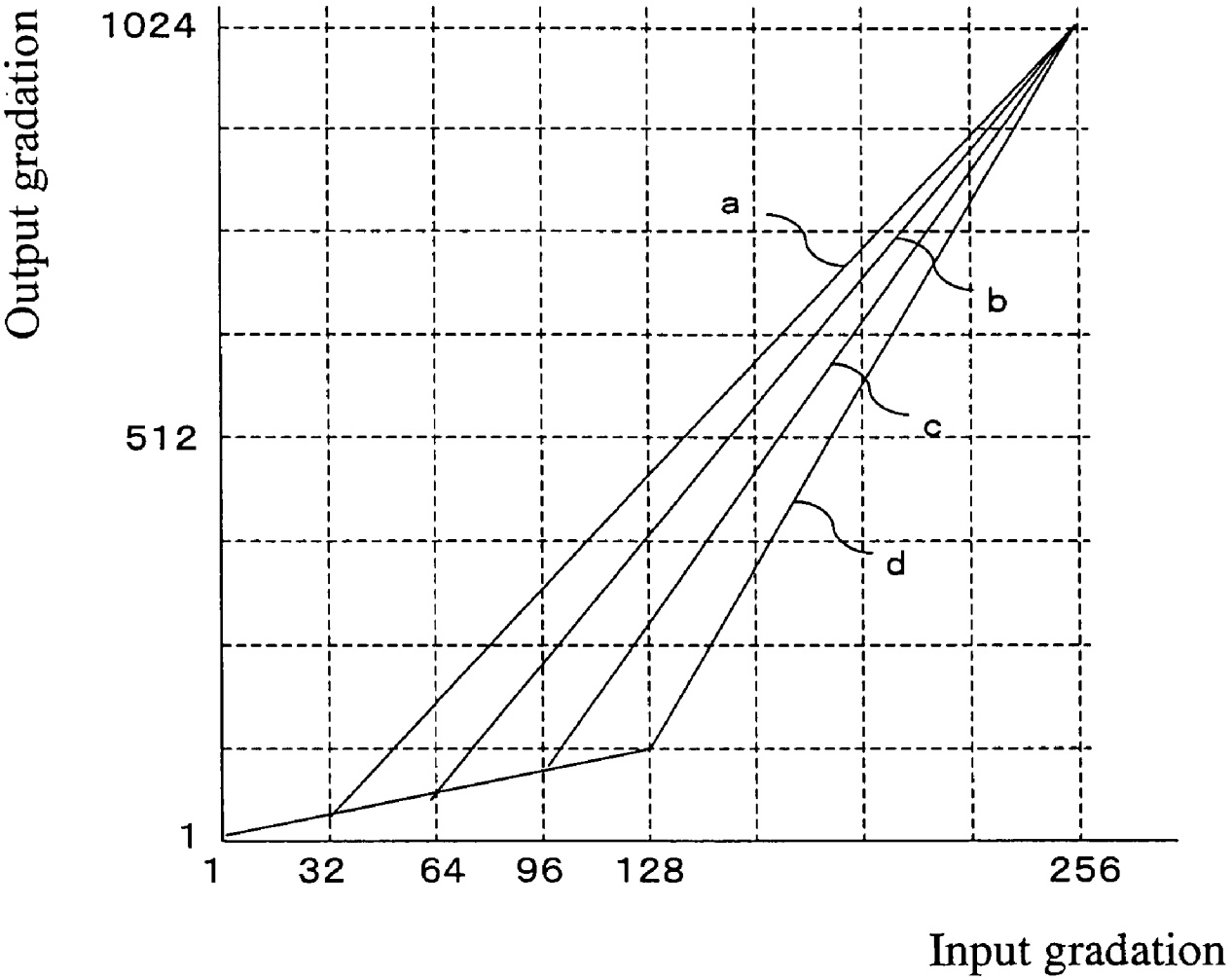
FIG. 85 is an explanatory diagram illustrating a drive circuit of a display apparatus according to the present invention.

Although it has been stated that the gamma circuit 834 performs a gamma process using multi-point polygonal gamma curves, this is not restrictive. Single-point polygonal gamma curves may be used for the gamma correction as shown in FIG. 85. Since hardware needed to generate single-point polygonal gamma curves is small in scale, costs of control ICs can be reduced.

Referring to FIG. 85, curve a represents polygonal gamma conversion in the 32nd gradation, curve b represents polygonal gamma conversion in the 64th gradation, curve c represents polygonal gamma conversion in the 96th gradation, and curve d represents polygonal gamma conversion in the 128th gradation. If image data are concentrated in high gradations, gamma curve d in FIG. 85 should be selected to increase the number of high gradations. If image data are concentrated in low gradations, gamma curve a in FIG. 85 should be selected to increase the number of low gradations. If image data are scattered, gamma curve b or c in FIG. 85 should be selected. Incidentally, although it has been stated in the above example that a gamma curve is selected, actually the gamma curve is generated by arithmetic operations rather than being selected.

Gamma curves are selected by taking into consideration the APL level, maximum brightness (MAX), minimum brightness (MIN), and brightness distribution (SGM). Also, duty cycle control and reference current control should be taken into consideration.

Figure 86:
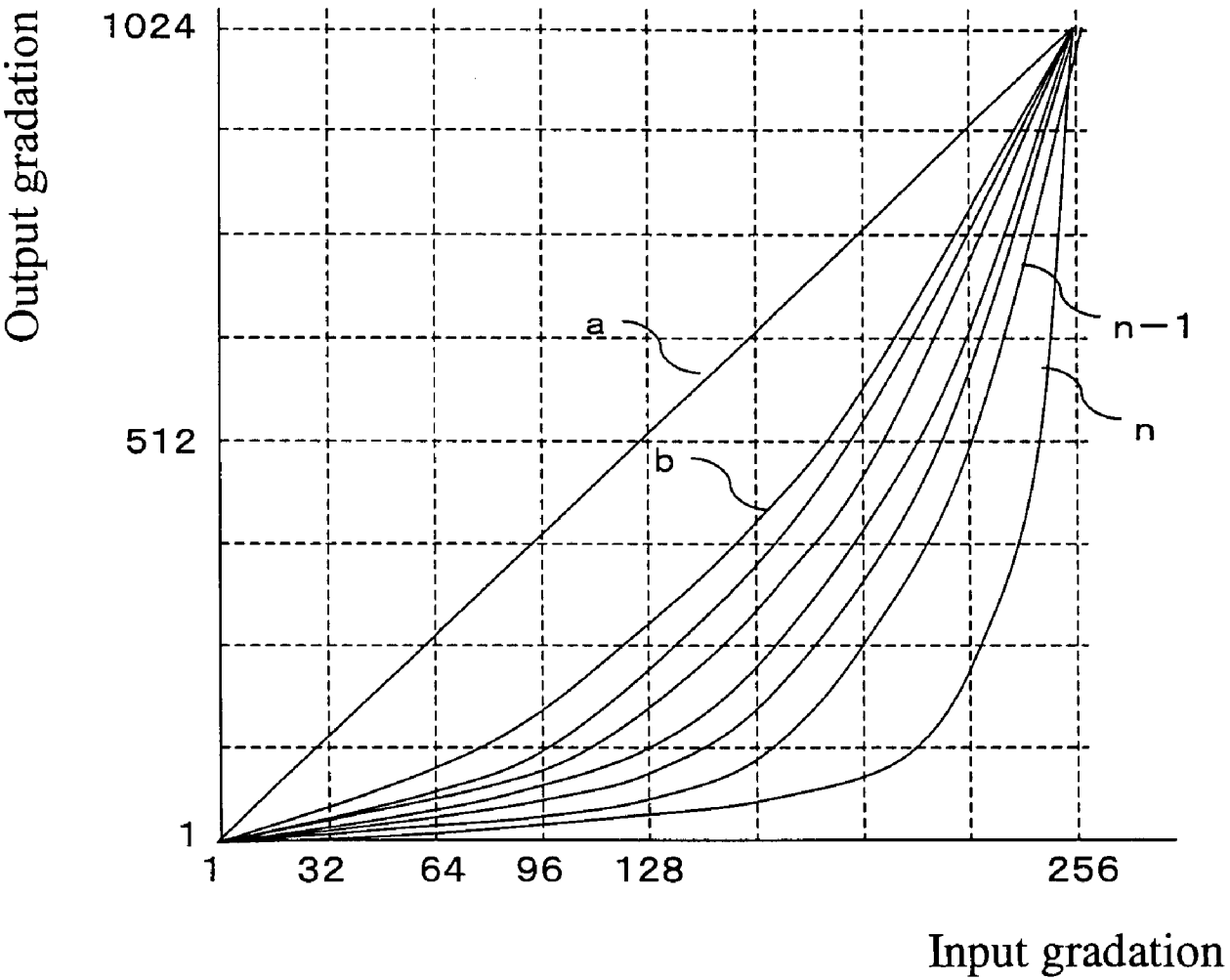
FIG. 86 is an explanatory diagram illustrating a drive circuit of a display apparatus according to the present invention.

FIG. 86 shows an example of multi-point polygonal gamma curves. If image data are concentrated in high gradations, gamma curve n in FIG. 86 should be selected to increase the number of high gradations. If image data are concentrated in low gradations, gamma curve a in FIG. 86 should be selected to increase the number of low gradations. If image data are scattered, gamma curves b to n−1 in FIG. 86 should be selected. Gamma curves are selected by taking into consideration the APL level, maximum brightness (MAX), minimum brightness (MIN), and brightness distribution (SGM). Also, duty cycle control and reference current control should be taken into consideration.

Figure 87:
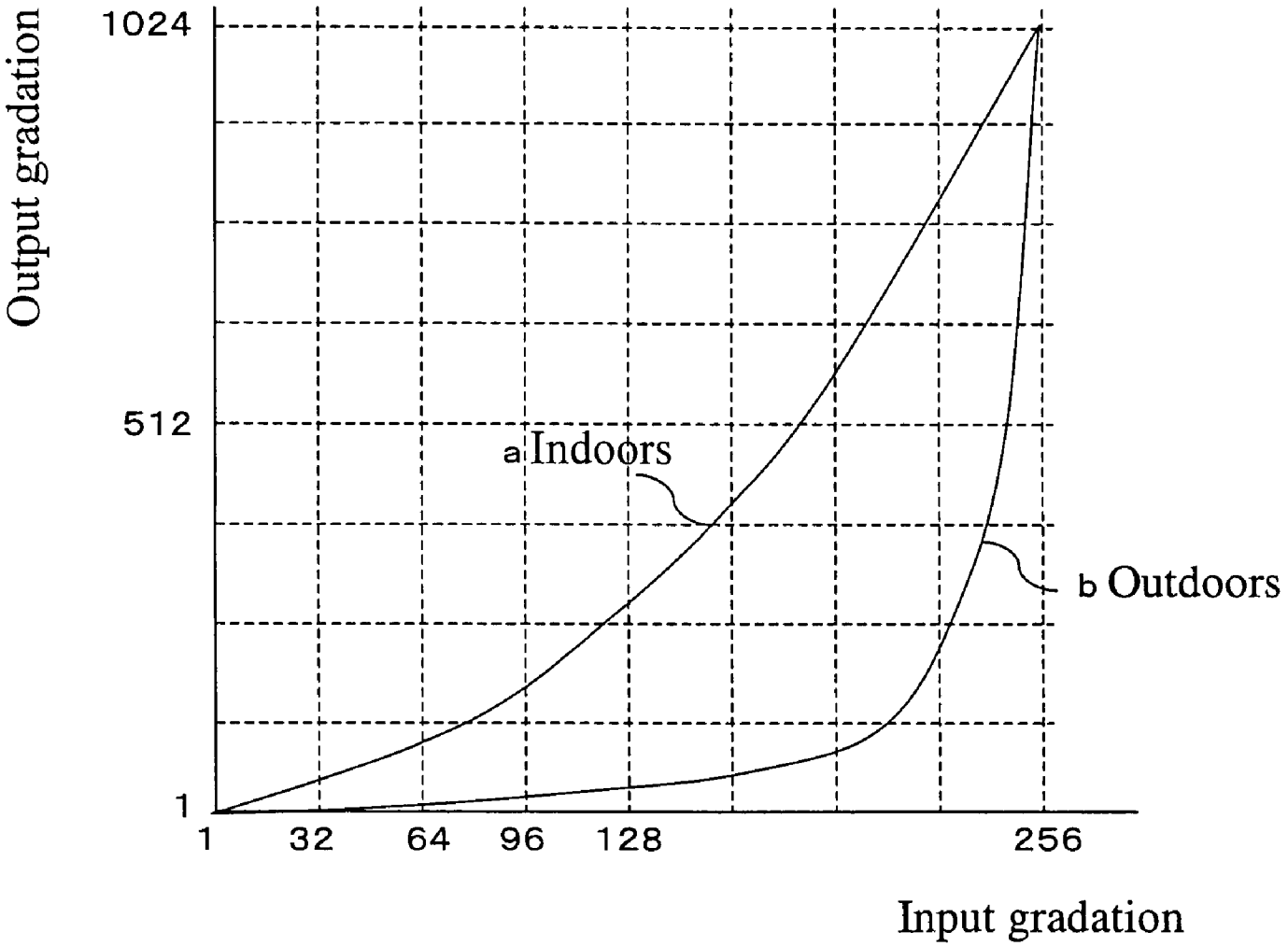
FIG. 87 is an explanatory diagram illustrating a drive circuit of a display apparatus according to the present invention.

It is also useful to vary gamma curves according to environment in which the display panel (display apparatus) is used. EL display panels, in particular, achieve proper image display, but do not provide visibility in low gradation part when used outdoors. This is because the EL display panels are self-luminous. So gamma curves may be varied as shown in FIG. 87. Gamma curve a is for indoor use while gamma curve b is for outdoor use. To switch between gamma curves a and b, the user operates a switch. Also, the gamma curves may be switched automatically by a photosensor which detects the brightness of extraneous light. Incidentally, although it has been stated that a gamma curves are switched, this is not restrictive. Needless to say, a gamma curve may be generated by calculation. In outdoor use, low gradation display part is not visible because of bright extraneous light. Thus, it is useful to select gamma curve b which suppresses the low gradation display part.

Figure 88:
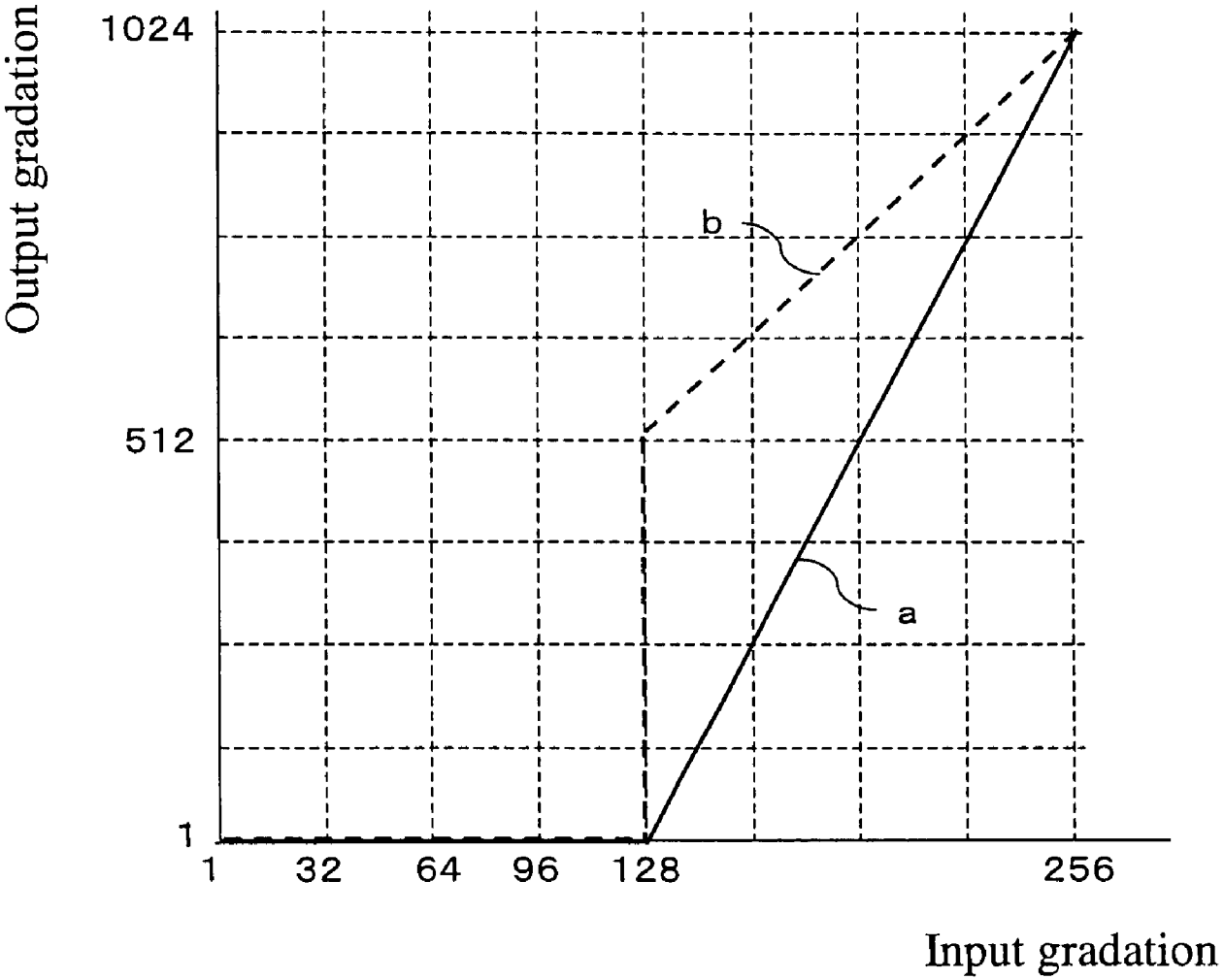
FIG. 88 is an explanatory diagram illustrating a drive circuit of a display apparatus according to the present invention.

In outdoor use, it is useful to generate gamma curves in the manner shown in FIG. 88. Output gradation of gamma curve a is set to 0 up to the 128th gradation. Gamma conversion is carried out beginning with the 128th gradation. In this way, by performing gamma conversion so as not to display low gradation part at all, it is possible to reduce power consumption. Also, gamma conversion may be performed in the manner indicated by gamma curve b in FIG. 88. Output gradation of the gamma curve in FIG. 88 is set to 0 up to the 128th gradation. Then, beginning with the 128th gradation, output gradation is set to 512 or higher. Gamma curve b in FIG. 88 displays high gradation part, reduces the number of output gradations, and thereby makes image display easy to view.

The drive method according to the present invention uses duty cycle control and reference current control to control image brightness and extend a dynamic range. Also, it achieves high-current display.

In liquid crystal display panels, white display and black display are determined by transmission of a backlight. Even if a non-display area 52 is generated on the screen 50 as in the case of the duty ratio driving according to the present invention, transmittance during black display is constant. Conversely, when a non-display area 52 is generated, white display brightness during one frame period lowers, resulting in reduced display contrast.

In EL display panels, zero (0) current flows through the EL elements 15 during black display. Thus, even if a non-display area 52 is generated on the screen 50 as in the case of the duty ratio driving according to the present invention, transmittance during black display is 0. A large non-display area 52 lowers white display brightness. However, since the brightness of black display is 0, the contrast is infinite. Thus, the duty ratio driving is the most suitable drive method for EL display panels. The above items also apply to reference current control. Even if the magnitude of reference current is changed, the brightness of black display is 0. A large reference current increases white display brightness. The reference current control also achieves proper image display.

Duty cycle control maintains the number of gradations and white balance over the entire range of gradations. Also, the duty cycle control allows the brightness of the screen 50 to be changed nearly ten-hold. Also, the change has a linear relationship with the duty ratio, and thus can be controlled easily. However, the duty cycle control is N-pulse driving, which means that large currents flow through the EL elements 15. Since large currents always flow through the EL elements regardless of the brightness of the screen 50, the EL elements 15 are prone to degradation.

Reference current control increases the amounts of reference current to increase screen brightness 50. Thus, large currents flow through the EL elements 15 only when the screen 50 is bright. Consequently, the EL elements 15 are less prone to degradation. A problem with the reference current control is that it tends to be difficult to maintain white balance when the reference current is varied.

The present invention uses both reference current control and duty cycle control. When the screen 50 is close to white raster display, display brightness and the like are controlled by varying the duty ratio with reference currents set to fixed values. When the screen 50 is close to black raster display, display brightness and the like are controlled by varying the reference currents with the duty ratio set to a fixed value.

The duty cycle control is performed when the ratio of total data to a maximum value is between 1/10 and 1/1, inclusive. More preferably, it is performed when the ratio of total data to the maximum value is between 1/100 and 1/1, inclusive. On the other hand, the reference current variation (output current variation of the unit transistor 484) is performed when the ratio of total data to the maximum value is between 1/10 and 1/1000, inclusive. More preferably, the reference current control is performed when the ratio of total data to the maximum value is between 1/100 and 1/2000, inclusive. Preferably, the duty cycle control and reference current control do not overlap. Incidentally, they do not overlap in FIG. 89, where the magnification of reference current is varied when the ratio of total data to the maximum value is 1/100 or less and the duty ratio is varied when the ratio of total data to the maximum value is 1/100 or more.

For ease of explanation, it is assumed here that the maximum value of the duty ratio is 1/1 while the minimum value is 1/8. It is assumed that the magnification of reference current is varied from 1 to 3 times. The sum of data is the sum total of the data on the screen 50. The maximum value (of the sum of data) is the sum total of image data in white raster display. Needless to say, there is no need to use the duty ratio of 1/1. The duty ratio of 1/1 is cited here as the maximum value. It goes without saying that the drive method according to the present invention may set the maximum duty ratio to 210/220 or the like. Incidentally, 220 is cited as an example of the number of pixel rows in a QCIF+display panel.

Preferably, the maximum value of the duty ratio is 1/1 and the minimum value is no smaller than 1/16. More preferably, the minimum value is no smaller than 1/10 to reduce flickering. Preferably, a variable range of the reference current is no larger than 4 times. More preferably, it is no larger than 2.5 times. Too large a magnification of the reference current will make the reference current generator circuit loose linearity, causing deviations in the white balance.

The statement that the ratio of total data (the sum of data) to the maximum value is 1/100 means, for example, 1/100 of a white window. In the case of natural images, this means a state in which the sum of pixel data used for image display is equivalent to 1/100 of a white raster display. Thus, one white luminescent spot in 100 pixels is also an example in which the ratio of total data to the maximum value equals 1/100.

Although it is described below that the maximum value is the sum of image data of a white raster, this is for ease of explanation. The maximum value is produced by an addition process or APL process of image data. Thus, the ratio of total data to the maximum value is a ratio to the maximum value of the image data of the image to be processed.

The sum of data may be calculated using either current consumption or brightness. Addition of brightness (image data) will be cited here for ease of explanation. Generally, addition of brightness (image data) is easier to process and can reduce the scale of controller IC hardware. Also, this method is free of flickering caused by duty cycle control and can provide a wide dynamic range.

Figure 89:
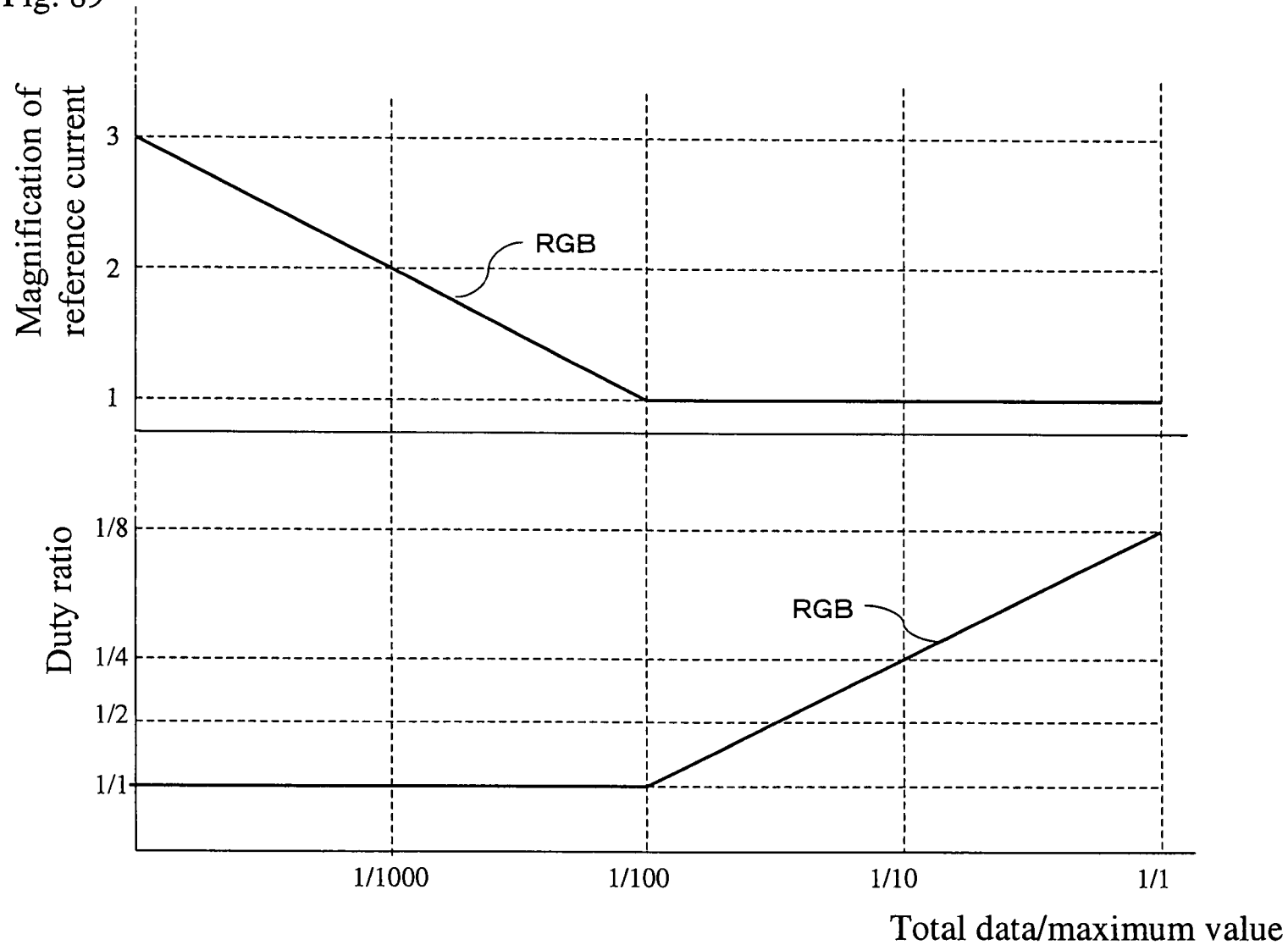
FIG. 89 is an explanatory diagram illustrating a drive circuit of a display apparatus according to the present invention.

FIG. 89 shows an example obtained as a result of the reference current control and duty cycle control according to the present invention. In FIG. 89, the magnification of reference current is varied up to 3 times when the ratio of total data to the maximum value is 1/100 or less. The duty ratio is varied from 1/1 to 1/8 when the ratio of total data to the maximum value is 1/100 or more. Thus, when the ratio of total data to the maximum value is between 1/1 and 1/10000, the duty ratio is varied 8 times and the reference current is varied 3 times for a total of 24-fold changes (8×3=24). Since both reference current control and duty cycle control vary screen brightness, a 24 times larger dynamic range is obtained.

When the ratio of total data to the maximum value is 1/1, the duty ratio is 1/8. Thus, the display brightness is 1/8 the maximum value. The value of 1/1 equals 1, which means white raster display. That is, during white raster display, the display brightness is reduced to 1/8 the maximum value. An image display area 53 makes up 1/8 of the screen 50 while a non-display area 52 makes up 7/8 of the screen 50. In an image with the ratio of total data to the maximum value being close to 1/1, most of the pixels 16 represent high gradations. In terms of a histogram, most of the data are distributed in a high gradation region. In this image display, the image is subject to blooming and lacks contrast. Thus, gamma curve n or similar curve in FIG. 86 is selected.

When the ratio of total data to the maximum value is 1/100, the duty ratio is 1/1. The entire screen 50 is occupied by a display area 53. Thus, N-pulse driving is not performed. The emission brightness of the EL elements 15 becomes the display brightness of the screen 50 directly. The screen presents almost black display with images displayed only in some part. An image display in which the ratio of total data to the maximum value is 1/100 is like a dark night sky in which the moon is out. In this display, if the duty ratio is changed to 1/1, the part which corresponds to the moon is displayed at 8 times the brightness of a white raster. This makes it possible to achieve an image display with a wide dynamic range. Since only 1/100 of the area is used for image display, even if the brightness of this area is increased 8-fold, the increase in power consumption is marginal.

In an image with the ratio of total data to the maximum value being close to 1/100, most of the pixels 16 represent low gradations. In terms of a histogram, most of the data are distributed in a low gradation region. In this image display, the image is subject to loss of shadow detail and lacks contrast. Thus, gamma curve b or similar curve in FIG. 86 is selected.

Thus, the drive method according to the present invention increases the multiplier x of gamma with increases in the duty ratio, and decreases the multiplier x of gamma with decreases in the duty ratio.

In FIG. 89, when the ratio of total data to the maximum value is 1/100 or less, the magnification of reference current is varied up to 3 times. When the ratio of total data to the maximum value is 1/100, the duty ratio is set to 1/1 to increase the screen brightness. As the ratio of total data to the maximum value gets smaller than 1/100, the magnification of reference current is increased. Thus, illuminating pixels 16 emits light more brightly. For example, an image display in which the ratio of total data to the maximum value is 1/1000 is like a dark night sky in which the stars are out. In this display, if the duty ratio is changed to 1/1, the parts which correspond to the stars are displayed at 16 (=8×2) times the brightness of a white raster. This makes it possible to achieve an image display with a wide dynamic range. Since only 1/1000 of the area is used for image display, even if the brightness of this area is increased 16-fold, the increase in power consumption is marginal.

In reference current control, it is difficult to maintain white balance. However, in an image of the dark sky with the stars, even if the white balance is deviated, the deviation is not perceived visually. Thus, the present invention, which performs reference current control in a range where the ratio of total data to the maximum value is very small, provides an appropriate drive method.

When the ratio of total data to the maximum value is 1/1000, the duty ratio is 1/1. The entire screen 50 is occupied by a display area 53. Thus, N-pulse driving is not performed. The emission brightness of the EL elements 15 becomes the display brightness of the screen 50 directly. The screen presents almost black display with images displayed only in some part.

In an image with the ratio of total data to the maximum value being close to 1/1000, most of the pixels 16 represent low gradations. In terms of a histogram, most of the data are distributed in a low gradation region. In this image display, the image is subject to loss of shadow detail and lacks contrast. Thus, gamma curve b or similar curve in FIG. 86 is selected.

Thus, the drive method according to the present invention increases the multiplier x of gamma with decreases in the reference current, and decreases the multiplier x of gamma with increases in the reference current.

Figure 90:
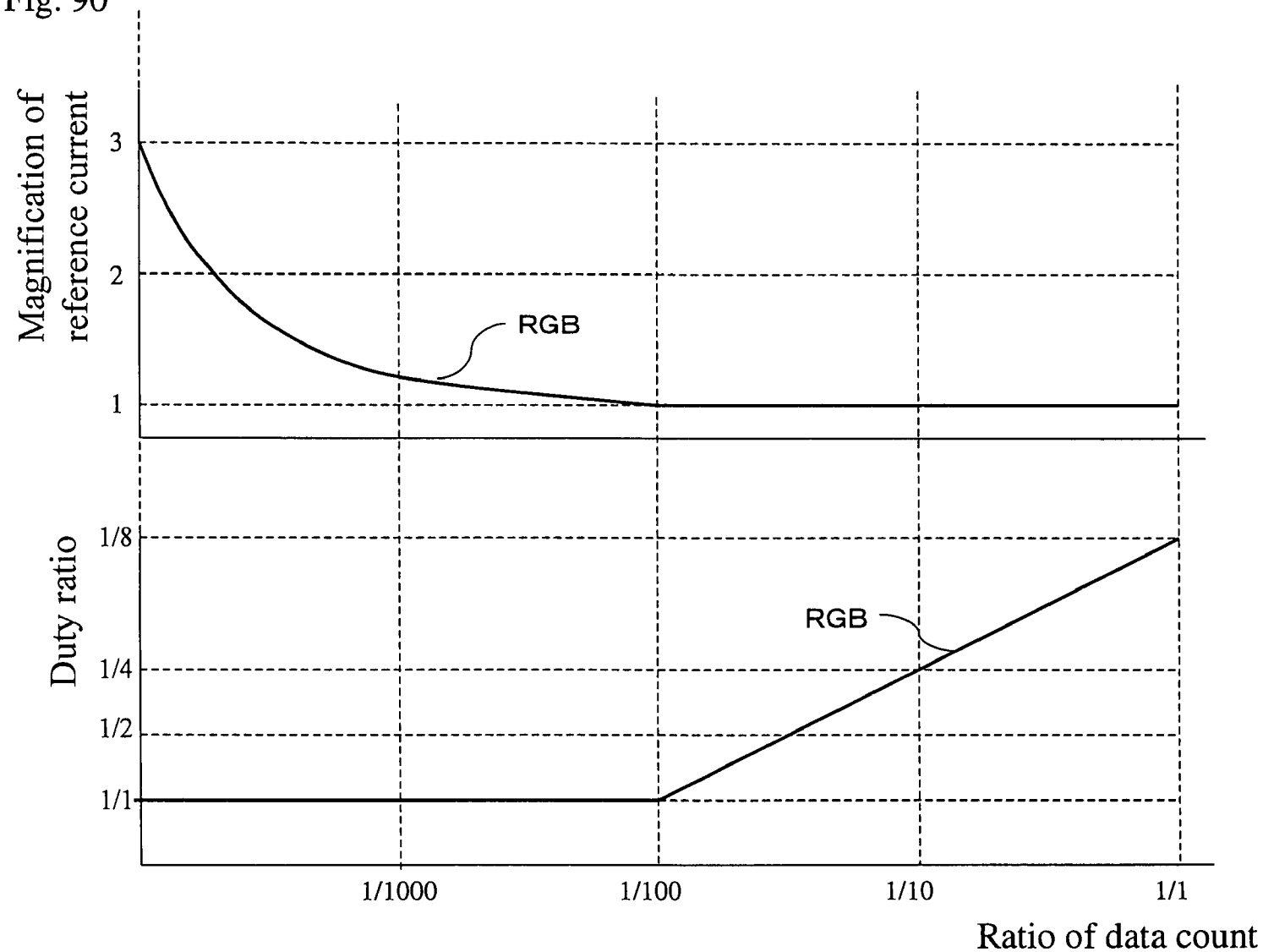
FIG. 90 is an explanatory diagram illustrating a drive circuit of a display apparatus according to the present invention.

In FIG. 89, changes in the reference current and duty ratio are illustrated linearly. However, the present invention is not limited to this. As illustrated in FIG. 90, the magnification of reference current and the duty ratio may be controlled curvilinearly. In FIGS. 89 and 90, since the ratio of total data to the maximum value in the horizontal axis is logarithmic, it is natural that the graphs of reference current control and duty cycle control are curvilinear. Preferably, the relationship between the ratio of total data to the maximum value and magnification of reference current as well as the relationship between the ratio of total data to the maximum value and duty cycle control are specified according to contents of image data, display condition of images, and external environment.

Figure 91:
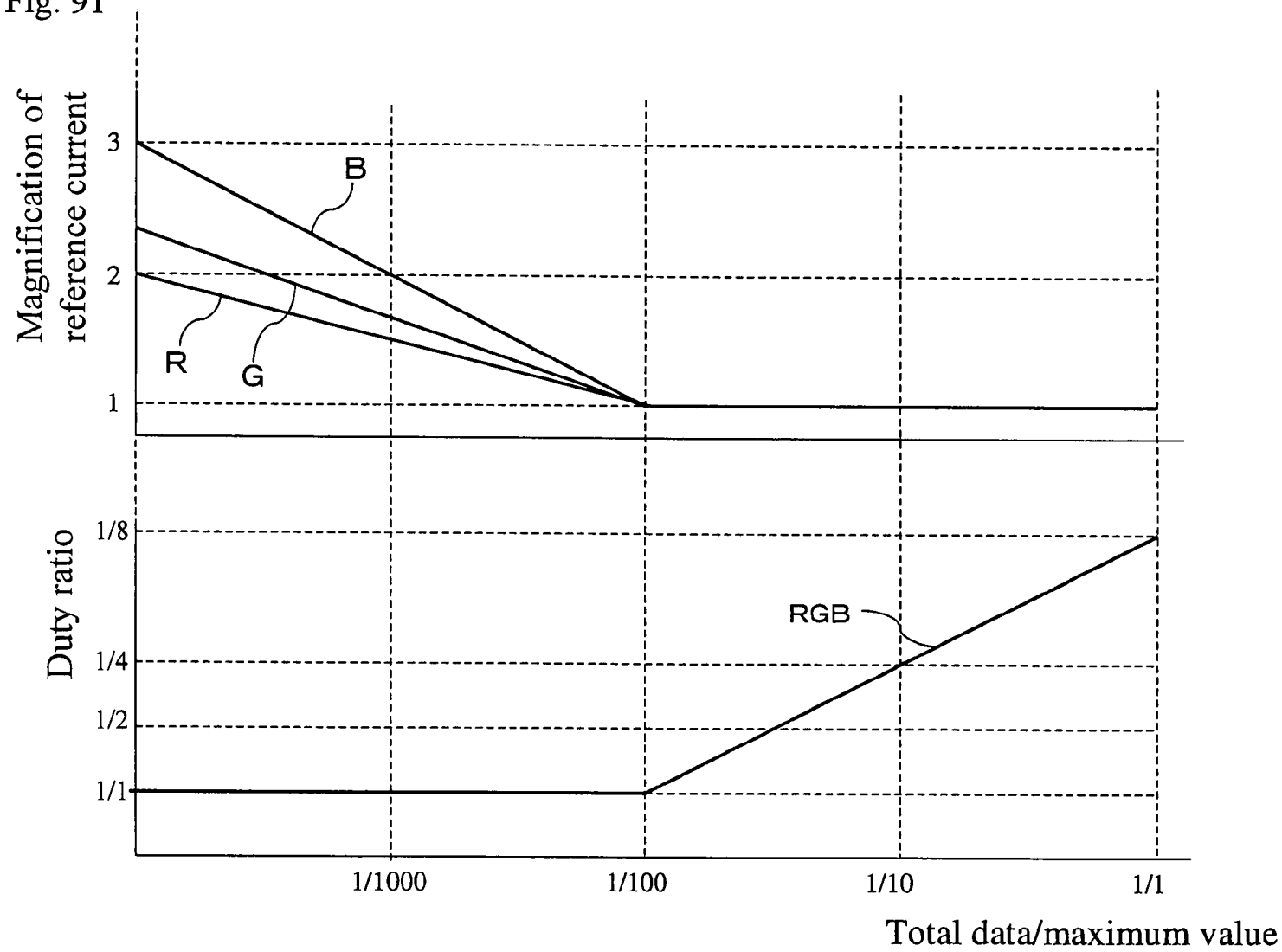
FIG. 91 is an explanatory diagram illustrating a drive circuit of a display apparatus according to the present invention.

FIGS. 89 and 90 show examples in which common duty cycle control and reference current control are performed for R, G, and B. However, the present invention is not limited to this. The slope of change in the magnification of reference current may be varied among R, G, and B as illustrated in FIG. 91, in which the slope of change in the magnification of reference current for blue (B) is the largest, the slope of change in the magnification of reference current for green (G) is the next largest, and the slope of change in the magnification of reference current for red (R) is the smallest. A large reference current increases the current flowing through the EL element 15. The light emission efficiency of the EL elements 15 varies among R, G, and B. A large current flowing through the EL element lowers light emission efficiency relative to applied current. This tendency is noticeable especially in the case of B. Consequently, white balance is upset unless the amounts of reference current are adjusted among R, G, and B. Thus, as shown in FIG. 91, if the magnification of reference current is increased (in an area where large currents flow through the EL elements 15 of R, G, and B), it is useful to vary the magnification of reference current among R, G, and B so that the white balance can be maintained. Preferably, the relationship between the ratio of total data to the maximum value and magnification of reference current as well as the relationship between the ratio of total data to the maximum value and duty cycle control are specified according to contents of image data, display condition of images, and external environment.

Figure 92:
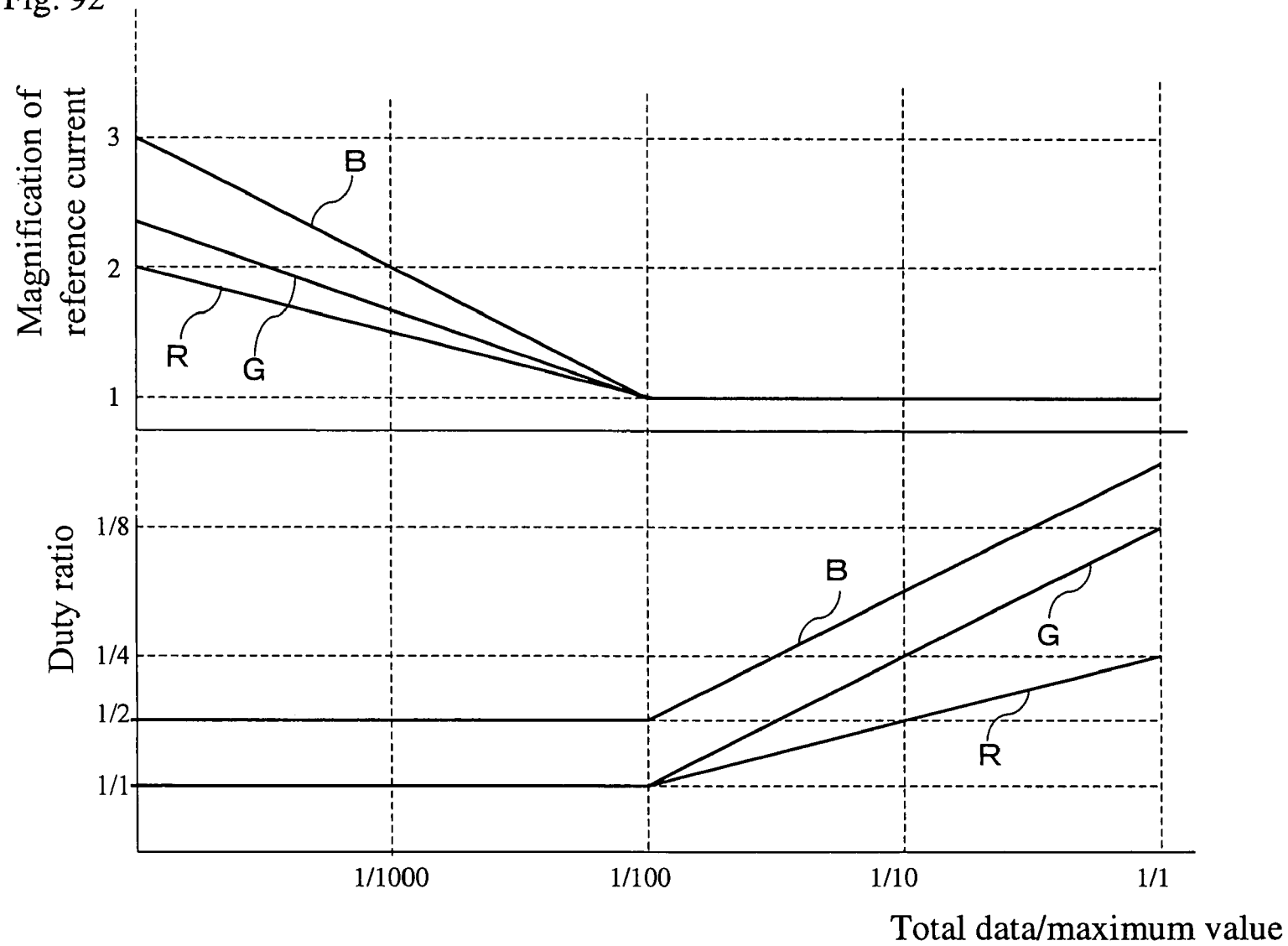
FIG. 92 is an explanatory diagram illustrating a drive circuit of a display apparatus according to the present invention.

FIG. 91 has been an example in which the magnification of reference current is varied among R, G, and B. In FIG. 92, duty cycle control is varied as well. When the ratio of total data to the maximum value is 1/100 or more, B and G have the same slope while R has a smaller slope. When the ratio of total data to the maximum value is 1/100 or less, G and R have a duty ratio of 1/1 while B has a duty ratio of 1/2. This drive method can be implemented using the drive methods described with reference to FIGS. 125 to 131. This drive method can optimize the RGB white balance. Preferably, the relationship between the ratio of total data to the maximum value and magnification of reference current as well as the relationship between the ratio of total data to the maximum value and duty cycle control are specified according to contents of image data, display condition of images, and external environment. Also, it is preferable that they can be set or adjusted freely by the user.

In FIGS. 89 to 91, either the magnification of reference current or the duty ratio is varied depending on whether the ratio of total data to the maximum value is below or above 1/100, as an example. Either the magnification of reference current or the duty ratio is varied depending on whether the ratio of total data to the maximum value takes a certain value so that the area in which the magnification of reference current is varied and the area in which the duty ratio is varied will not overlap. This makes it easy to maintain white balance. Specifically, the duty ratio is varied when the ratio of total data to the maximum value is larger than 1/100 and the reference current is varied when the ratio of total data to the maximum value is smaller than 1/100 so that the area in which the magnification of reference current is varied and the area in which the duty ratio is varied will not overlap. This method is characteristic of the present invention.

Incidentally, although it has been stated that the duty ratio is varied when the ratio of total data to the maximum value is larger than 1/100 and the reference current is varied when the ratio of total data to the maximum value is smaller than 1/100, the relationship may be reversed. That is, the duty ratio may be varied when the ratio of total data to the maximum value is smaller than 1/100 and the reference current may be varied when the ratio of total data to the maximum value is larger than 1/100. Also, the duty ratio may be varied when the ratio of total data to the maximum value is larger than 1/10, the reference current may be varied when the ratio of total data to the maximum value is smaller than 1/100, and the magnification of reference current and the duty ratio may be kept constant when the ratio of total data to the maximum value is between 1/100 and 1/10.

Figure 93:
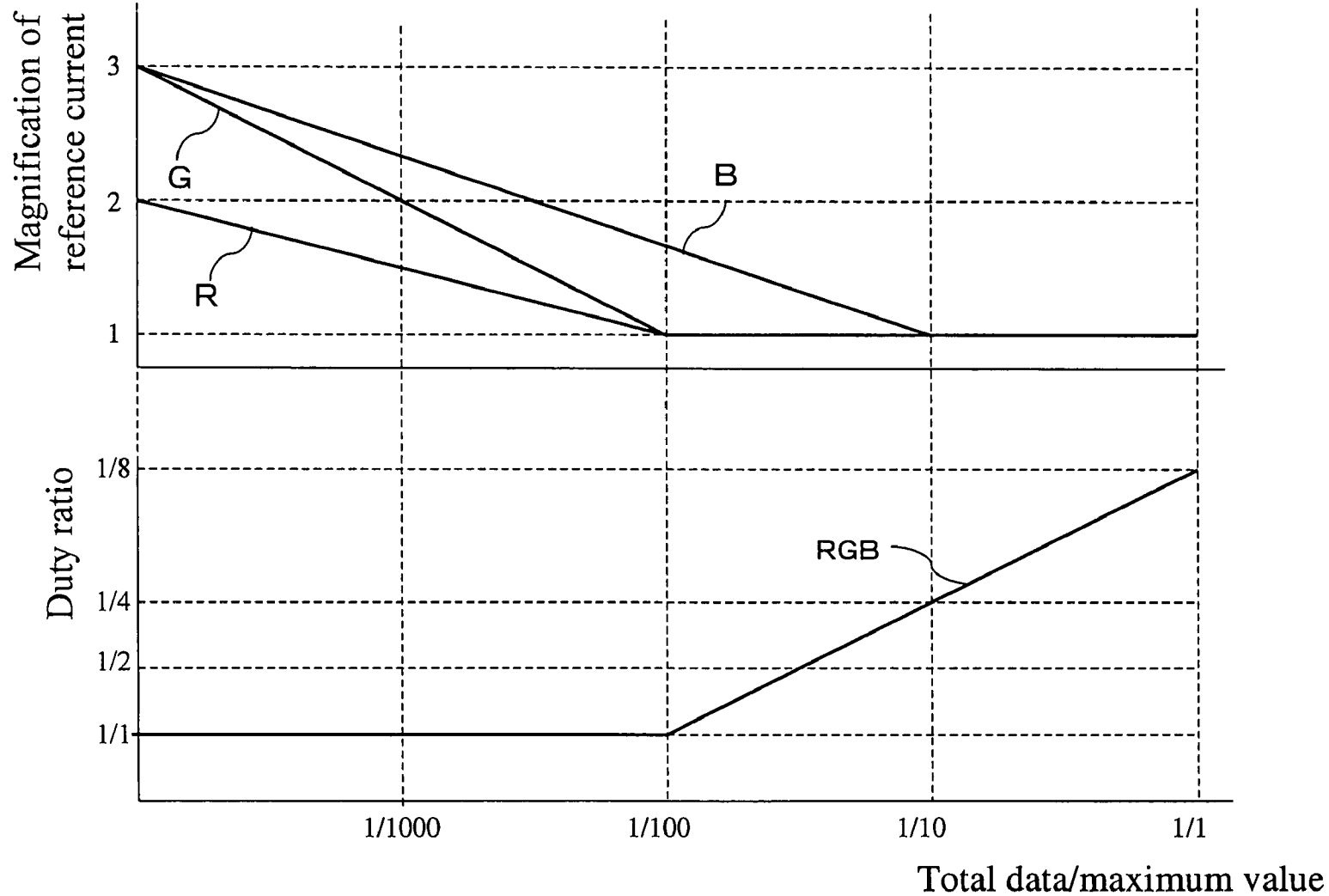
FIG. 93 is an explanatory diagram illustrating a drive circuit of a display apparatus according to the present invention.

In some cases, the present invention is not limited to the above methods. As illustrated in FIG. 93, the duty ratio may be varied when the ratio of total data to the maximum value is larger than 1/100 and the reference current for B may be varied when the ratio of total data to the maximum value is smaller than 1/10. Changes in the reference current for B and changes in the duty ratio for R, G, and B are overlapped.

If a bright screen and dark screen alternate quickly and the duty ratio is varied accordingly, flicker occurs. Thus, when the duty ratio is changed from one value to another, preferably hysteresis (time delay) is provided. For example, if a hysteresis period is 1 sec., even if the screen changes its brightness a plurality of times within the period of 1 sec., the previous duty ratio is maintained. That is, the duty ratio does not change.

The hysteresis time (time delay) is referred to as a Wait time. Also, the duty ratio before the change is referred to as a pre-change duty ratio and the duty ratio after the change is referred to as a post-change duty ratio.

If a small pre-change duty ratio changes its value, the change tends to cause flicker. A small pre-change duty ratio means a small sum of screen 50 data or a large black display part on the screen 50. Maybe the screen 50 presents intermediate gradations, resulting in high luminosity. Also, in an area with a small duty ratio, difference between pre-change and post-change duty ratios tends to be large. Of course, if there is a large difference of duty ratios, an OEV2 terminal should be used for control. However, there is a limit to OEV2 control. In view of the above circumstances, the wait time should be increased when a pre-change duty ratio is small.

If a small pre-change duty ratio changes its value, the change is less prone to cause flicker. A large pre-change duty ratio means a large sum of screen 50 data or a large white display part on the screen 50. Maybe the entire screen 50 presents a white display, resulting in low luminosity. In view of the above circumstances, the wait time may be short when a pre-change duty ratio is large.

Figure 94:
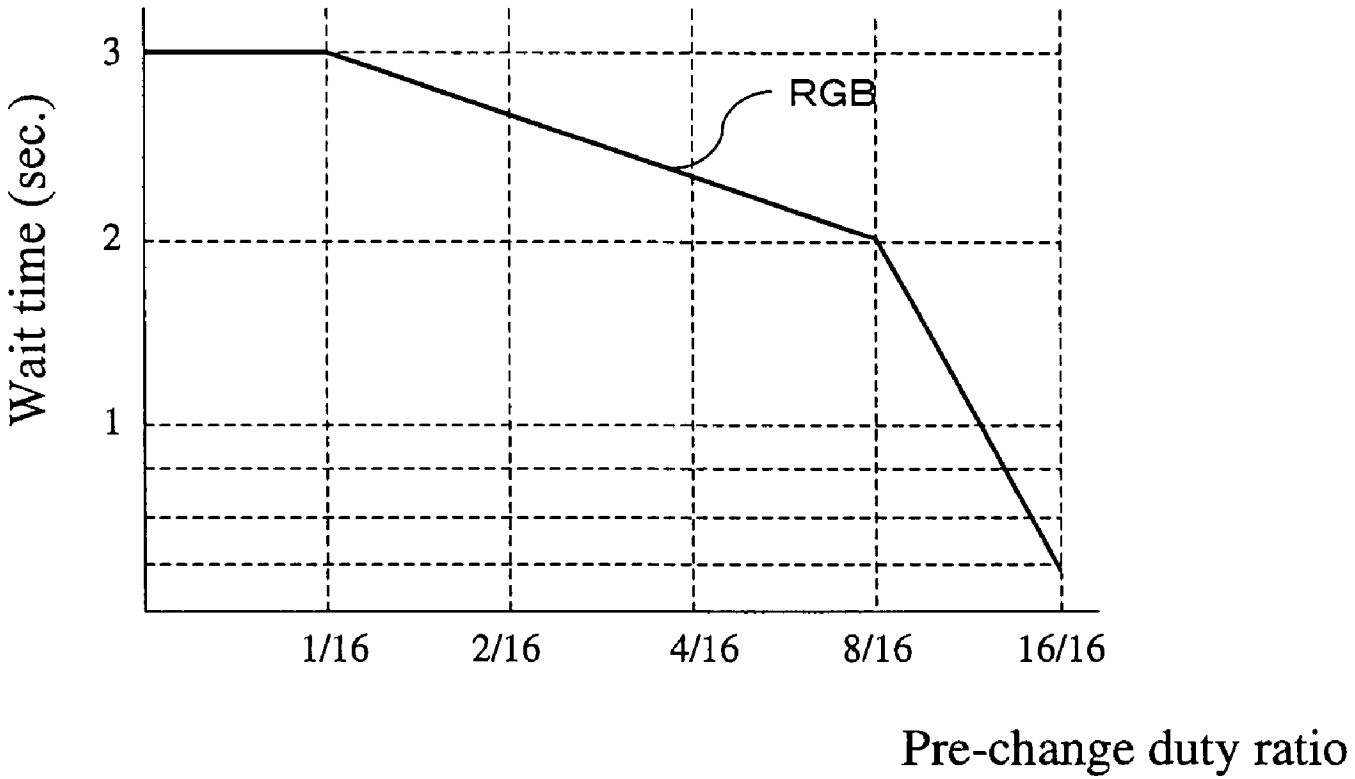
FIG. 94 is an explanatory diagram illustrating a drive circuit of a display apparatus according to the present invention.

The above relationship is shown in FIG. 94. The horizontal axis represents the pre-change duty ratio and the vertical axis represents the Wait time (seconds). When the duty ratio is 1/16 or less, the Wait time is as long as 3 seconds. When the duty ratio is between 1/16 and 8/16 (=1/2), the Wait time is varied between 3 seconds and 2 seconds depending on the duty ratio. When the duty ratio is between 8/16 and 16/16 (=1/1), the Wait time is varied between 2 seconds and 0 seconds depending on the duty ratio.

In this way, the duty cycle control according to the present invention varies the Wait time with the duty ratio. When the duty ratio is small, the Wait time is increased and when the duty ratio is large, the Wait time is decreased. That is, in a drive method which varies at least the duty ratio, a first pre-change duty ratio is smaller than a second pre-change duty ratio and the Wait time for the first pre-change duty ratio is set longer than the Wait time for the second pre-change duty ratio.

In the above example, the Wait time is controlled or prescribed based on the pre-change duty ratio. However, there is only a small difference between pre-change duty ratio and post-change duty ratio. Thus, in the above example, the term "pre-change duty ratio" may be replaced with the term "post-change duty ratio."

The above example has been described based on pre-change and post-change duty ratios. Needless to say, the Wait time is increased when there is a large difference between pre-change and post-change duty ratios. Also, it goes without saying that when there is a large duty ratio difference, an intermediate duty ratio should be provided between the pre-change and post-change duty ratios.

The duty cycle control method according to the present invention provides a long Wait time when there is a large difference between pre-change and post-change duty ratios. That is, it varies the Wait time depending on the difference between pre-change and post-change duty ratios. Also, it allows for a long Wait time when there is a large duty ratio difference.

Also, the duty ratio method according to the present invention provides an intermediate duty ratio before a post-change duty ratio when there is a large duty ratio difference.

In the example in FIG. 94, common Wait time is used for red (R), green (G), and blue (B). Needless to say, however, the present invention allows the Wait time to be varied among R, G, and B. This is because luminosity varies among R, G, and B. By specifying the Wait time according to luminosity, it is possible to achieve better image display.

Figure 96:
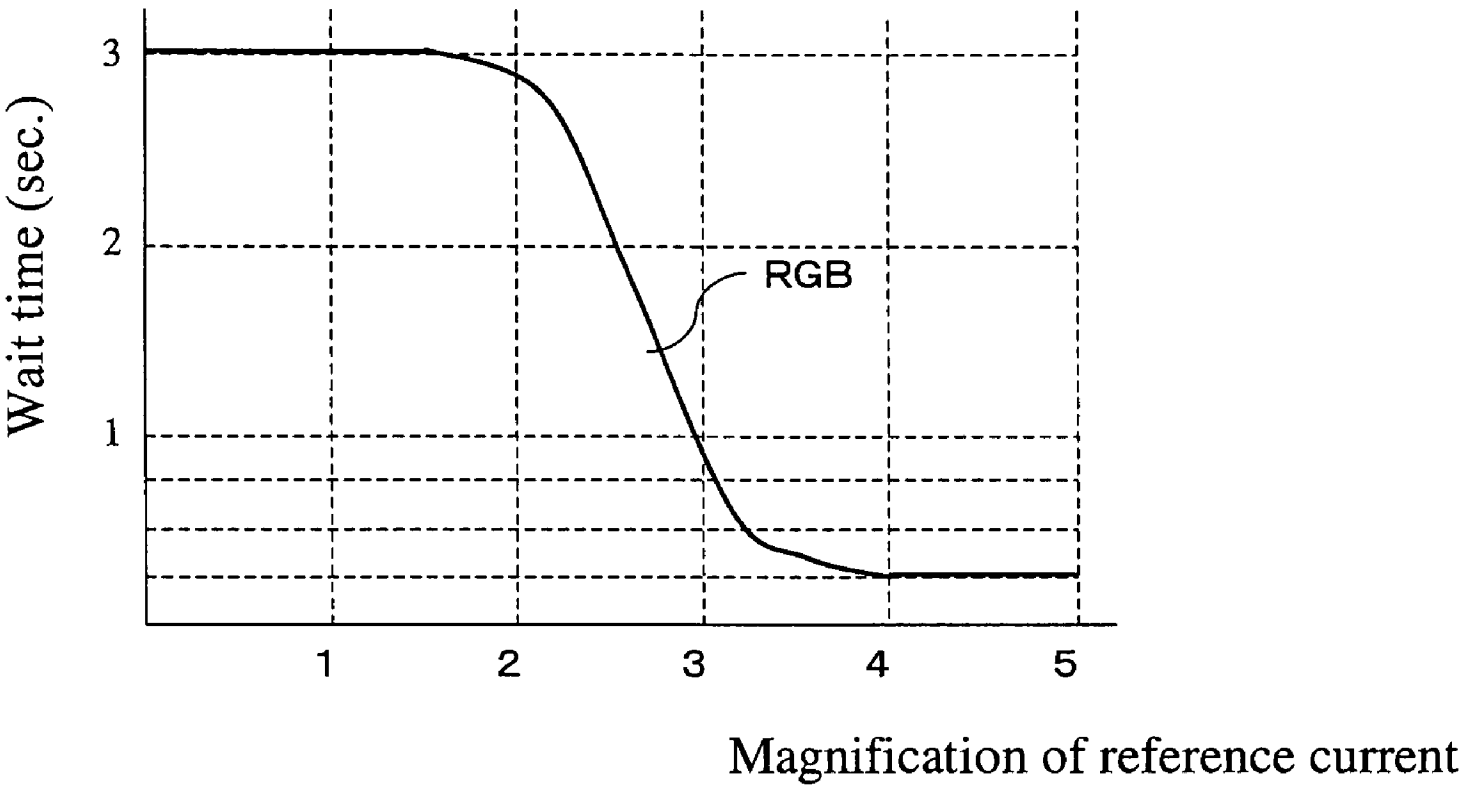
FIG. 96 is an explanatory diagram illustrating a drive circuit of a display apparatus according to the present invention.

The above example concerns duty cycle control. Preferably, Wait time is specified in reference current control as well. FIG. 96 shows an example.

A small reference current makes the screen 50 dark while a large reference current makes the screen 50 bright. In other words, a low magnification of reference current means an intermediate-gradation display mode. When the magnification of reference current is high, the screen 50 is in high-brightness mode. Thus, when the magnification of reference current is low, the Wait time should be increased because of high visibility of changes. On the other hand, when the magnification of reference current is high, the Wait time may be decreased because of low visibility of changes. Thus, the Wait time can be specified in relation to the magnification of reference current as illustrated in FIG. 96.

Figure 98:
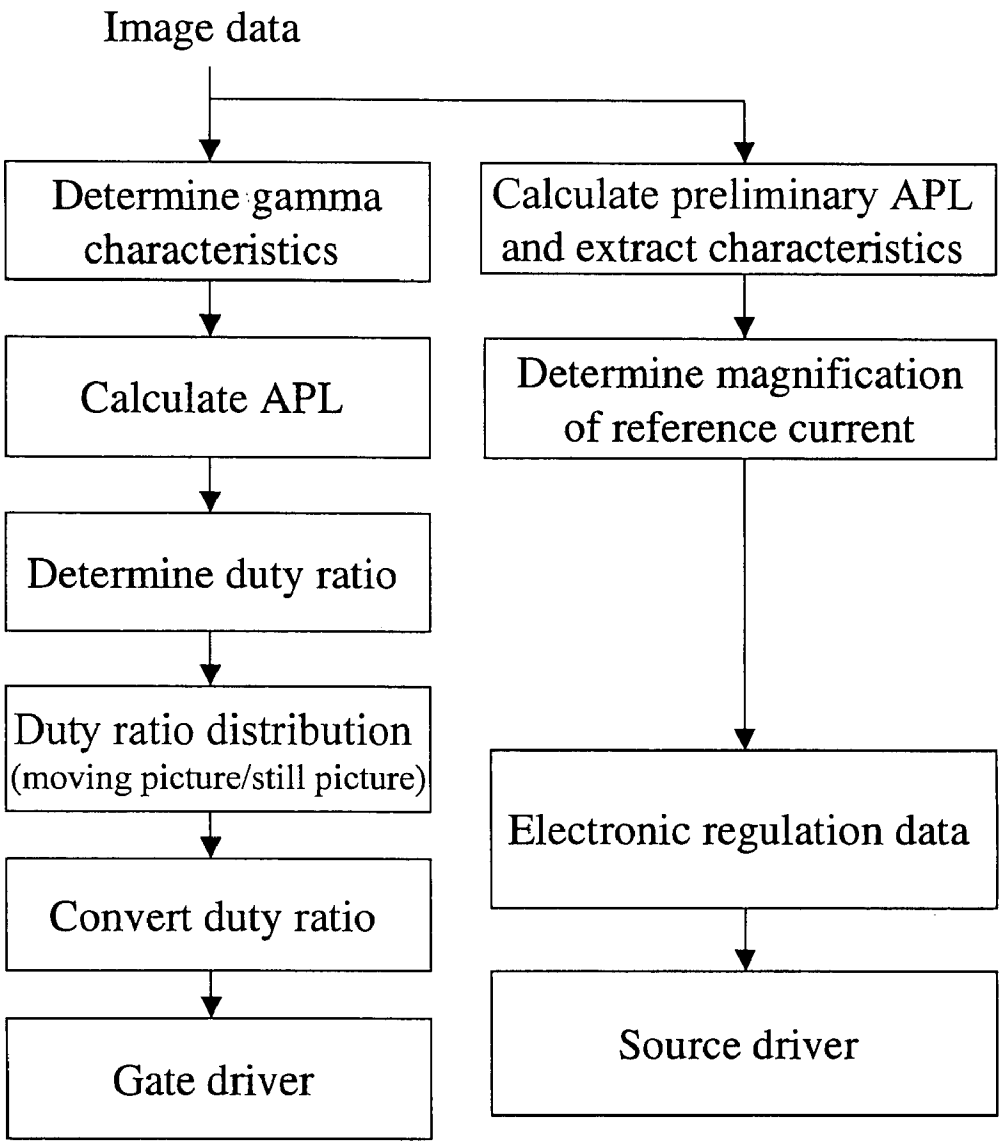
FIG. 98 is an explanatory diagram illustrating a drive circuit of a display apparatus according to the present invention.

The present invention calculates (detects) the sum of data or APL and performs duty cycle control and reference current control based on the resulting values. FIG. 98 is a flowchart showing how the duty ratio and the magnification of reference current are determined.

As illustrated in FIG. 98, an approximate APL (preliminary APL) is calculated based on inputted image data. The value and magnification of reference current are determined based on the APL. The determined reference current and its magnification are converted into electronic regulation data and applied to the source driver circuit 14.

On the other hand, image data is fed into a gamma processing circuit, where gamma characteristics are determined. An APL is calculated from the image data whose gamma characteristics have been determined. A duty ratio is determined from the calculated APL. Then, a duty pattern is determined depending on whether the image is a moving picture or still picture. The duty pattern represents distribution of a non-display area 52 and display area 53. In the case of a moving picture, an undivided non-display area 52 is inserted. In the case of a still picture, a divided non-display area 52 is inserted in a scattered manner. Thus, a still picture is converted into a distribution pattern which involves inserting a divided non-display area 52 in a scattered manner. A moving picture is converted into a distribution pattern which involves inserting an undivided non-display area 52. The resulting distribution pattern is applied as a start pulse ST (see FIG. 6) of the gate driver circuit 12*b*.

Figure 95:
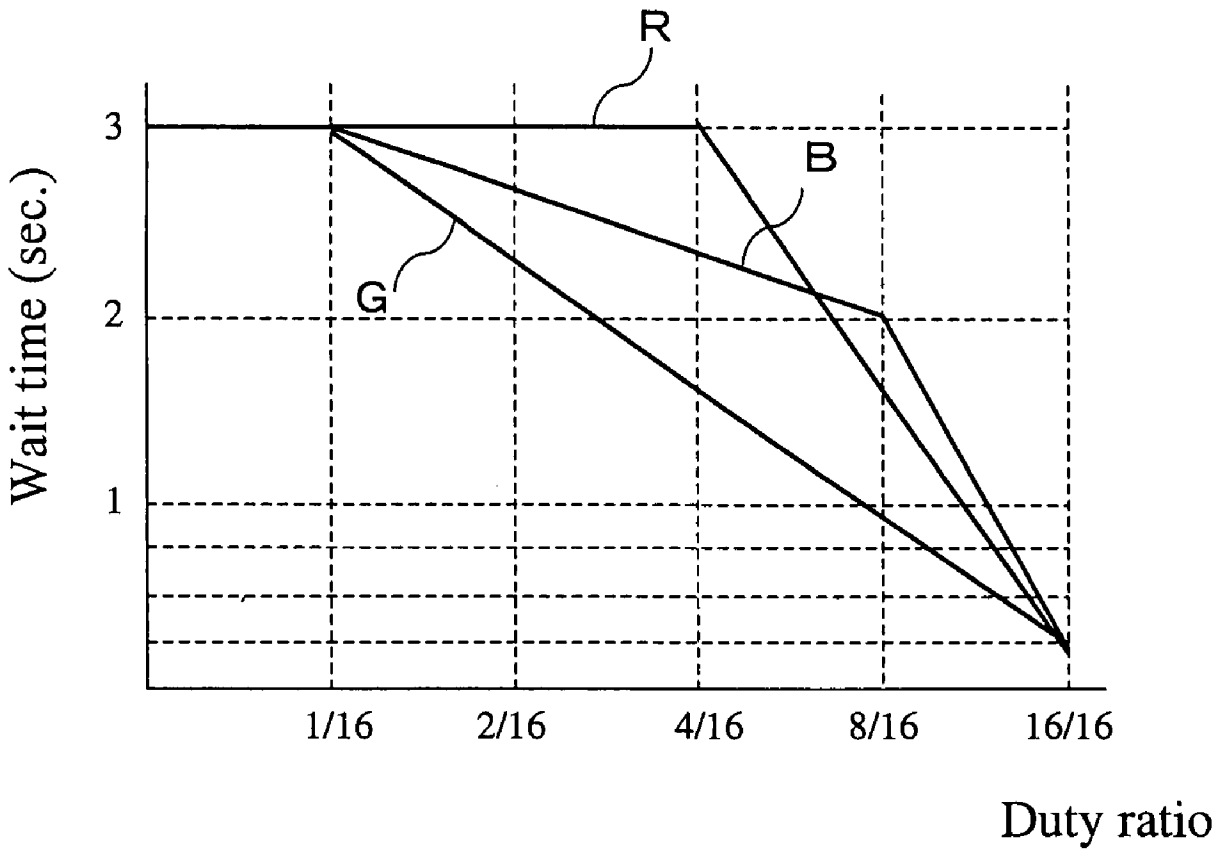
FIG. 95 is an explanatory diagram illustrating a drive circuit of a display apparatus according to the present invention.

With reference to FIGS. 94 and 95, description has been given of how Wait time is controlled according to the duty ratio. With reference to FIGS. 89 to 93, description has been given of how duty cycle control is performed according to the sum of data. FIG. 103 is a more detailed explanatory diagram showing how to perform duty cycle control and Wait time control. For ease of explanation, temporal factors and the like are expressed in a reduced form.

In FIG. 103, the top row contains the frame (field) number. The second row contains the APL level (sum of data). The third row contains the corresponding duty ratio calculated from the APL level. The bottom row contains the duty ratio (processed duty ratio) corrected for the Wait time. Thus, depending on the APL level of the frame, the corresponding duty ratio (in the third row) varies as follows: 8/64→9/64→9/64→10/64→9/64→10/64→11/64→11/64→12/64→14/64.

In contrast to the corresponding duty ratio, the processed duty ratio varies as follows, allowing for the Wait time: 8/64→8/64→9/64→9/64→9/64→10/64→10/64→11/64→12/64→12/64→ . . .

In FIG. 103, the corresponding duty ratios are corrected for the Wait time. The numerators of the processed duty ratios are integers (cf. in FIG. 107, numerators contain a decimal point). In FIG. 103, the duty ratios are varied smoothly so that no flicker will occur. In frame 3, 4, and 5 in FIG. 103, the corresponding duty ratio changes to 9/64, 10/64, and 9/64, respectively. The processed duty ratios after Wait time control are 9/64, 9/64, and 9/64 (a corrected value is indicated by dotted lines in frame 4). In frame 9, 10, and 11 in FIG. 103, the corresponding duty ratio changes to 12/64, 14/64, and 11/64, respectively. The processed duty ratios after Wait time control are 12/64, 12/64, and 11/64 (a corrected value is indicated by dotted lines in frame 10). In this way, hysteresis (a time delay or low-pass filter) is provided through Wait time control to prevent the duty ratio from changing even if the APL level changes sharply.

The duty cycle control described above does not need to complete in a single frame or single field. Duty cycle control may be performed at intervals of a few fields (few frames) In that case, an average duty ratio over a few fields (few frames) is used. Incidentally, when performing duty cycle control at intervals of a few fields (few frames), preferably each interval should contain not more than 6 fields (6 frames) A longer period may cause flicker. Also, the number of fields (frames) does not need to be an integer, and may be, for example, 2.5 frames (2.5 fields). That is, the present invention is not limited to a specific number of fields (frames) per period.

Figure 104:
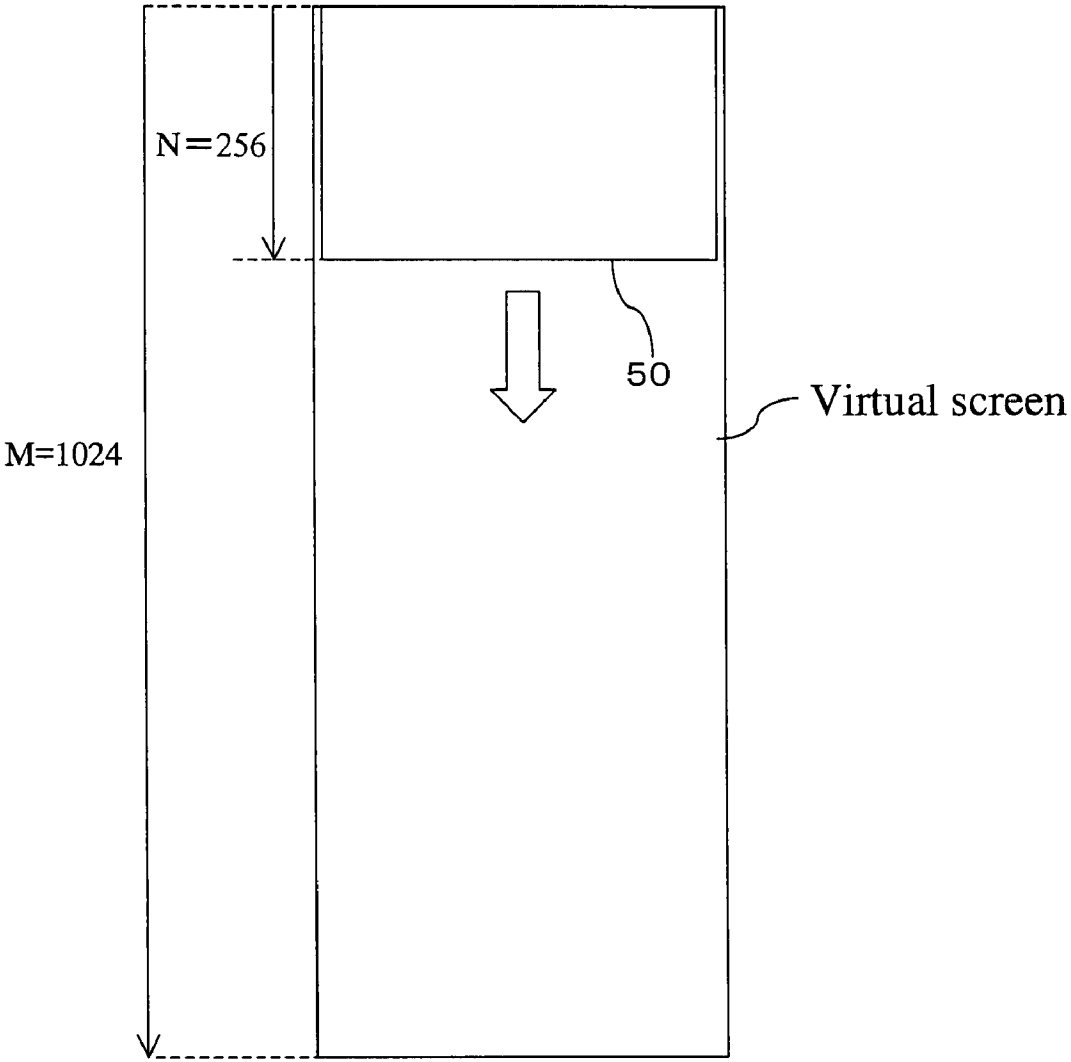
FIG. 104 is an explanatory diagram illustrating a drive method of a display panel according to the present invention.

FIG. 104 shows an example in which duty cycle control is performed at intervals of a few fields (few frames). FIG. 104 shows a concept of how to perform duty cycle control at intervals of a few fields (few frames). M corresponds to a period in which duty cycle control is performed. If one field (frame) consists of 256 pixel rows, M=1024 corresponds to four fields (four frames). That is, FIG. 104 shows an example in which duty cycle control is performed at intervals of four fields (four frames).

M indicates a data string retained in the shift register 61*b* of the gate driver circuit 12*b* (see FIG. 6). The retained data string contains data as to whether to apply a turn-on voltage or turn-off voltage to the gate signal line 17*b*. The average value of the retained data string represents a duty ratio. Needless to say, in FIG. 104, M may be equal to N. Also, it goes without saying that in some cases, duty cycle control may be performed by satisfying M<N.

For example, in a retained data string M=1024, if a turn-on voltage consists of 256 and a turn-off voltage consists of 768, the duty ratio is 256/1024=1/4. Incidentally, turn-on voltage data is retained in a cluster when a still picture is displayed and retained in a scattered manner when a moving picture is displayed.

That is, turn-on and turn-off voltage data strings are applied virtually to the gate signal line 17*b* of the EL display panel in sequence. As turn-on and turn-off voltages are applied in sequence, the EL display panel is displayed at a predetermined brightness under duty cycle control.

Figure 105:
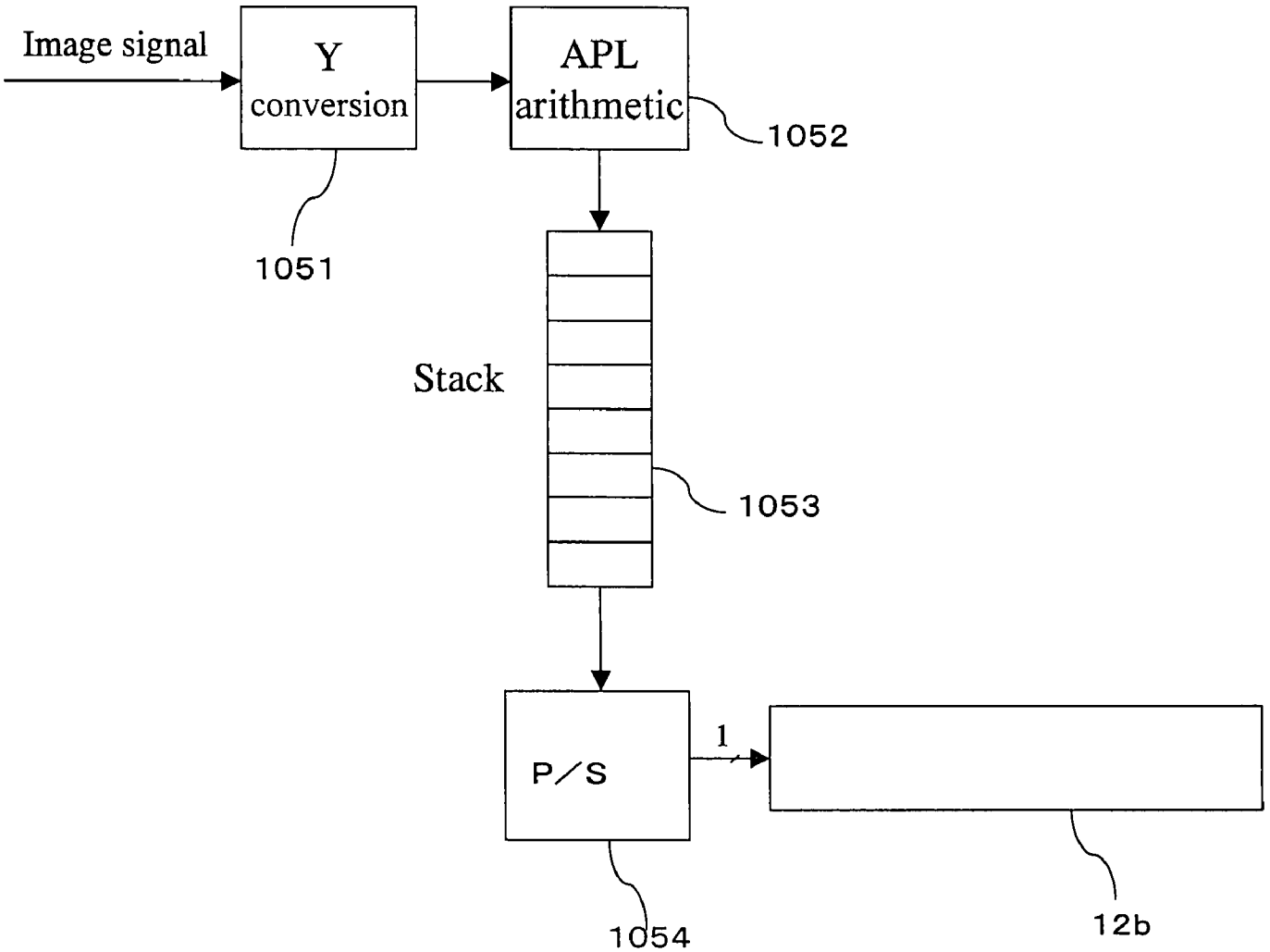
FIG. 105 is an explanatory diagram illustrating a drive method of a display panel according to the present invention.

FIG. 105 is a block diagram showing a circuit configuration used to implement the duty cycle control shown in FIG. 104. First, a video signal (image data) is converted into a luminance signal by a Y conversion circuit 1051. Then, an APL level (the sum of data or ratio of total data to the maximum value) is determined by an APL arithmetic circuit 1052. The duty ratio is calculated based on the APL level on a field-by-field (frame-by-frame) basis and results are stored in a stack 1053. The stack circuit 1053 has a first-in-first-out configuration. Incidentally, the duty ratio is corrected by Wait time control and stored in the stack circuit 1053. The duty ratio data stored in the stack circuit 1053 is applied as a start pulse ST (see FIG. 6) of the shift register 61*b* by a parallel/serial (P/S) conversion circuit 1054, and then turn-on and turn-off voltages of the gate signal line 17*b* are output form the gate driver circuit 12*b* according to the sequence of the applied data.

In the above example, duty cycle control is performed on a field-by-field basis or frame-by-frame basis. However, the present invention is not limited to this. For example, designating that 1 frame=4 fields, duty cycle control may be performed in units of multiple fields. By performing duty cycle control using multiple fields, it is possible to achieve smooth image display without flickering.

In FIG. 106, reference numeral 1-1 denotes the first field in the first frame, 1-2 denotes the second field in the first frame, 1-3 denotes the third field in the first frame, and 1-4 denotes the fourth field in the first frame. Reference numeral 2-1 denotes the first field in the second frame.

To change the duty ratio from 128/1024 to 132/1024, it is changed to 128/1024 in 1-1, 129/1024 in 1-2, 130/1024 in 1-3, 131/1024 in 1-4, and 132/1024 in 2-1. This makes it possible to change from 128/1024 to 132/1024 smoothly.

To change the duty ratio from 128/1024 to 130/1024, it is changed to 128/1024 in 1-1, 128/1024 in 1-2, 129/1024 in 1-3, 129/1024 in 1-4, and 130/1024 in 2-1. This makes it possible to change from 128/1024 to 130/1024 smoothly.

To change the duty ratio from 128/1024 to 136/1024, it is changed to 128/1024 in 1-1, 130/1024 in 1-2, 132/1024 in 1-3, 134/1024 in 1-4, and 136/1024 in 2-1. This makes it possible to change from 128/1024 to 136/1024 smoothly.

In field-based (frame-based) duty cycle control, the numerator of the duty ratio does not need to be an integer. For example, the numerator may contain a decimal fraction as shown in FIG. 107. This can be accomplished easily by controlling the OEV2 terminal. Also, the use of a duty ratio averaged over multiple frames (fields) will make numerators contain decimal fractions. Conversely, the denominator of a duty ratio may contain decimal fractions. In FIG. 107, the numerators are decimals such as 30.8 and 31.2. Incidentally, by using integers larger than certain values for numerators and denominators, it is possible to eliminate the need for decimal fractions.

Duty ratio patterns are varied between moving pictures and still pictures. If a duty ratio pattern is changed sharply, changes in the image may be perceived. Also, flicker may occur. This problem is caused by difference between duty ratios of moving pictures and still pictures. Moving pictures employ a duty pattern which involves inserting an undivided non-display area 52. Still pictures employ a duty pattern which involves inserting a divided non-display area 52 in a scattered manner. The surface ratio between non-display area 52 and screen area 50 provides the duty ratio. However, even if the duty ratio is the same, human visibility varies with the distribution of non-display areas 52. It is believed that human responsiveness to moving pictures plays a role here.

An intermediate moving picture has a distribution pattern midway between the distribution pattern of a moving picture and distribution pattern of a still picture. A plurality of modes may be prepared for intermediate moving pictures and one of a plurality of moving pictures may be selected according to a movie mode or still picture mode before change. The plurality of intermediate movie modes may include, for example, a distribution pattern close to that of movie display—such as a distribution pattern with a non-display area 52 divided into three parts—or conversely, a distribution pattern in which a divided non-display area is scattered widely as is the case with a still picture.

There are various still pictures: some are bright, others are dark. The same applies to moving pictures. Thus, the intermediate movie mode to change over to may be determined according to the mode before the change. In some cases, a change from a moving picture to a still picture may occur directly without going through an intermediate moving picture. For example, on a dark screen 50, a change from a movie display to a still picture display can take place directly without a feeling of strangeness. On the other hand, display modes may be switched via a plurality of intermediate movie displays. For example, it is possible to change from a duty ratio for a movie display, through a duty ratio for an intermediate movie display 1 and a duty ratio for an intermediate movie display 2, and to a duty ratio for a still picture display.

Figure 108A:
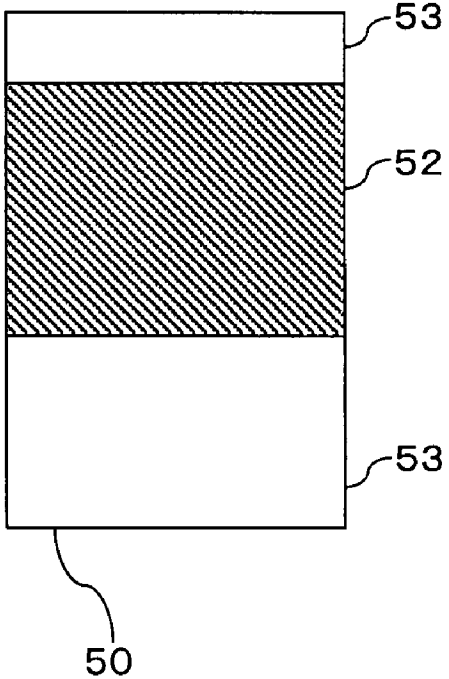
FIG. 108 is an explanatory diagram illustrating a drive method of a display panel according to the present invention.
Figure 108B:
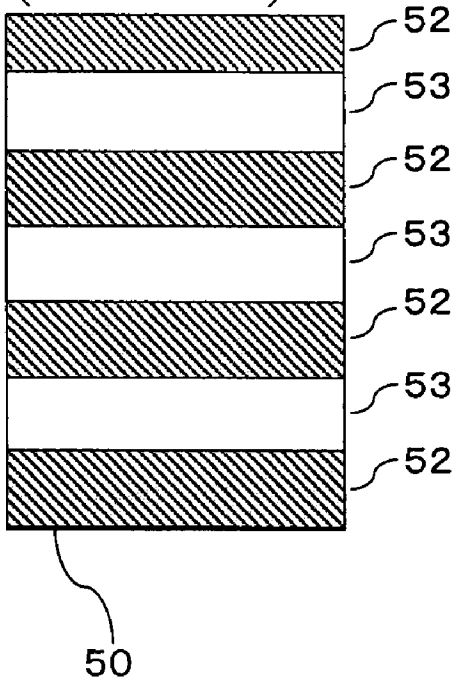
Figure 108C:
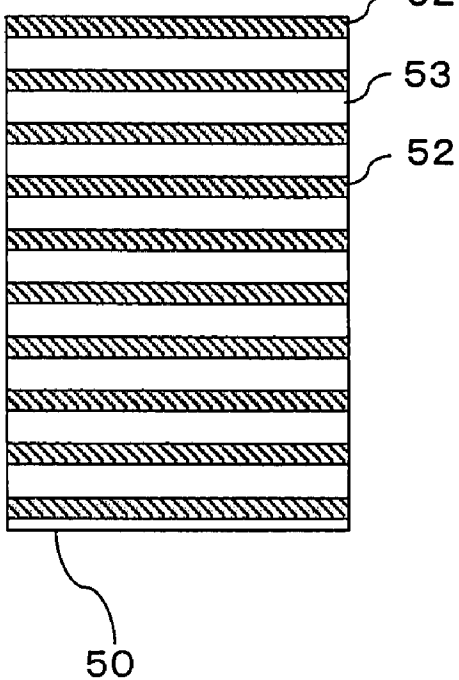

In FIG. 108, a change from a movie display to a still picture display occurs by way of an intermediate movie mode. Also, a change from a still picture display to a movie display occurs by way of an intermediate movie mode. Preferably a Wait time is provided in a change between different display modes.

FIG. 110 shows duty ratios and the number of divisions in movie display, still picture display, and intermediate movie display which change from one to another. In FIG. 110, a movie/still picture level of 0 indicates that image display is at a movie level, level 1 indicates that image display is in semi-movie (intermediate movie) mode, and level 2 indicates that image display is in still picture mode.

The number of divisions is the number of parts into which a non-display area 52 is divided. Number 1 indicates that an undivided non-display area 52 is inserted. Number 30 indicates that a non-display area 52 is inserted being divided into 30 parts. Similarly, number 50 indicates that a non-display area 52 is inserted being divided into 50 parts. The duty ratio represents a reduction rate of white display brightness as described earlier. For example, a duty ratio of 1/2 indicates a brightness 1/2 the maximum white brightness.

As illustrated in FIG. 110, a movie/still picture level changes by way of an intermediate movie (semi-movie) mode in a change from a moving picture to a still picture and in a change from a still picture to a moving picture.

Figure 111:
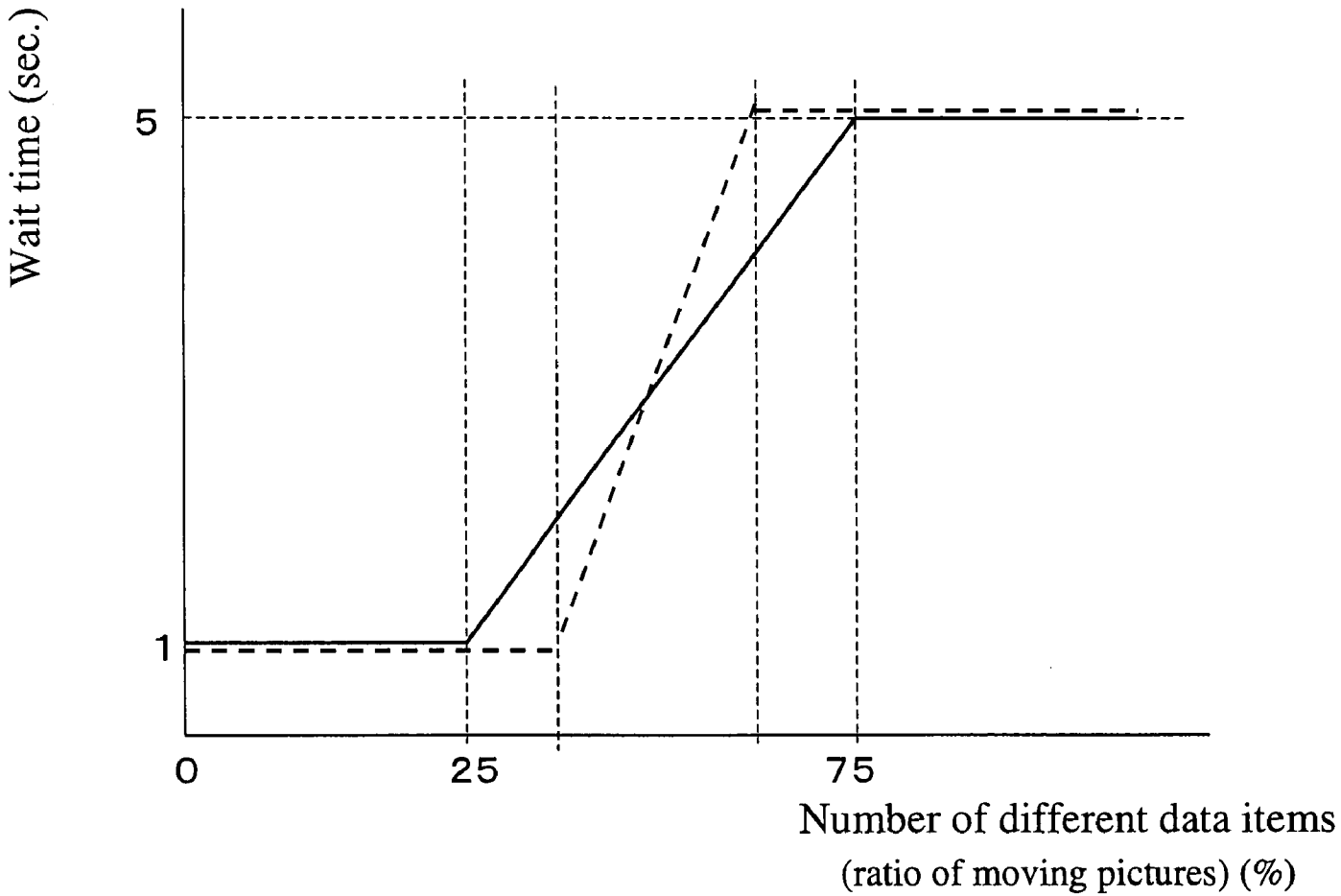
FIG. 111 is an explanatory diagram illustrating a drive method of a display panel according to the present invention.

Preferably, a Wait time is provided in a change from a moving picture to a still picture as shown in FIG. 111. It is recommended to determine the Wait time according to the ratio of moving pictures. "The number of different data items" on the horizontal axis in FIG. 111 indicates the ratio of moving pictures detected between a frame and the next frame. In other words, the horizontal axis represents the ratio of pixels which differ in image data between frames. Thus, the larger the value, the closer to a movie display. In FIG. 111, the closer to a movie display, the longer the Wait time.

Figure 112:
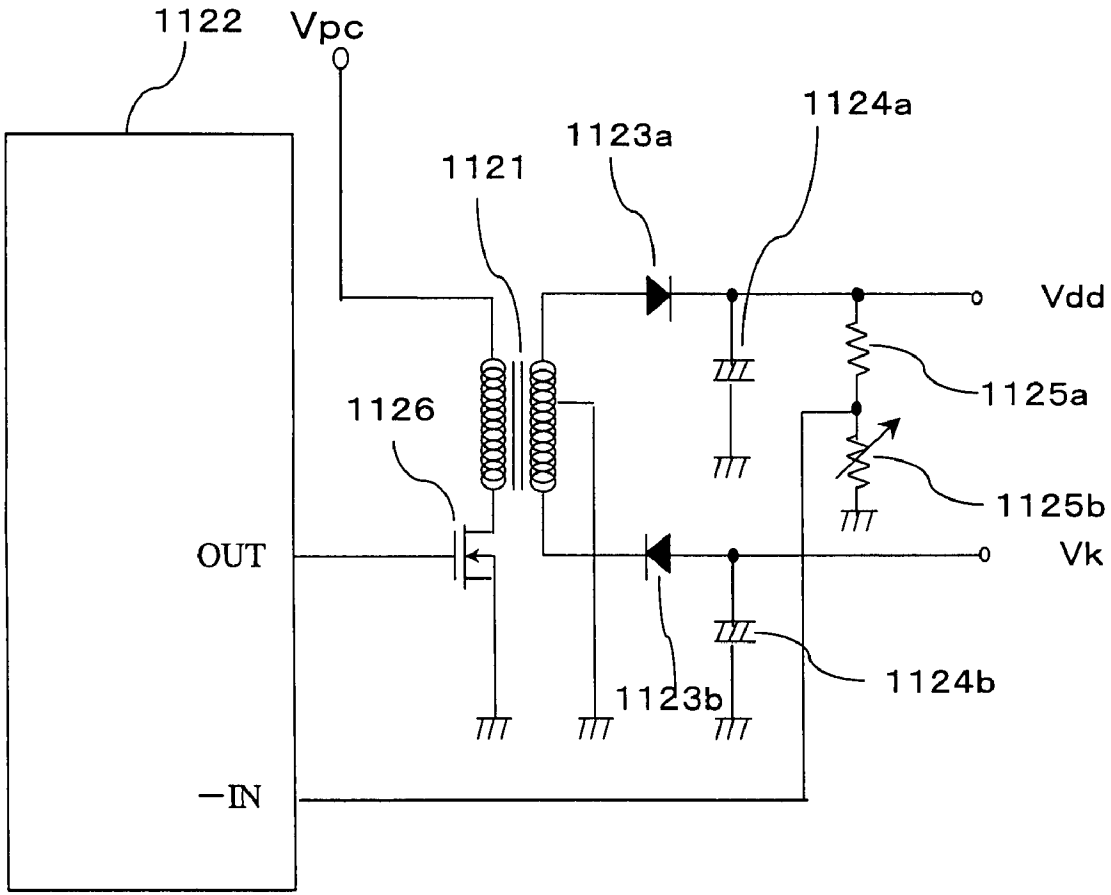
FIG. 112 is an explanatory diagram illustrating a drive circuit of a display apparatus according to the present invention.

To further describe duty cycle control, the organic EL display panel according to the present invention will be described. FIG. 112 is a block diagram of the power supply circuit according to the present invention. Reference numeral 1122 denotes a control circuit, which controls the midpoint potential of resistances 1125*a* and 1125*b* and outputs a gate signal of a transistor 1126. A power supply Vpc is applied to the primary side of a transformer 1121 and primary current is transmitted to the secondary side under on/off control of the transistor 1126. Reference numeral 1123 denotes a rectifying diode and 1124 denotes a smoothing capacitor.

Figures 97A, 97B, 97C, 97D:
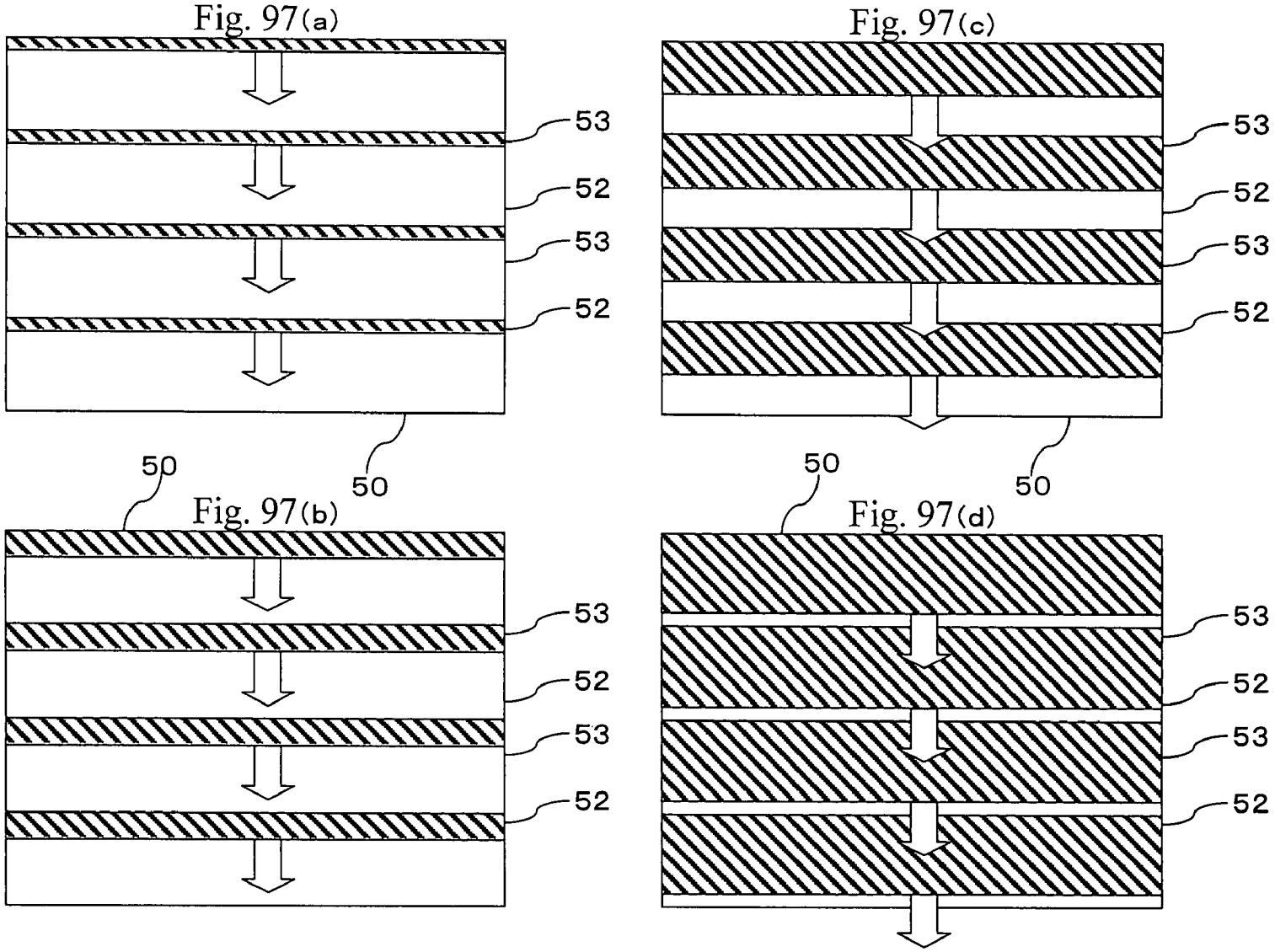
FIG. 97 is an explanatory diagram illustrating a drive circuit of a display apparatus according to the present invention.

The organic EL display panel has an EL element 15 formed (placed) between an anode Vdd and cathode Vk. It is supplied with an anode Vdd voltage and cathode Vk voltage from the power supply circuit in FIG. 112. When the EL element does not emit light, a zero (0) current flows between the anode and cathode. The duty cycle control according to the present invention applies turn-on and turn-off voltages to the gate signal line 17*b* per pixel row to control current for the EL element. The location of the gate signal line 17*b* to which the turn-on and turn-off voltages are applied is scanned. FIG. 97 shows an example in which a non-display area 52 is divided into four parts. The non-display areas 52 differ in size among FIG. 97(*a*), 97(*b*), 97(*c*), and 97(*d*). However, the non-display areas 52 are scanned (move) from top to bottom of the screen 50. Similarly, display areas 53 are also scanned from top to bottom of the screen 50. Current does not flow through the EL elements of the pixels 16 which correspond to the non-display areas 52. On the other hand, current flows through the EL elements 15 which correspond to the display areas 53.

Now, to describe a problem, a display pattern in which a non-display area 52 and display area 53 alternate every pixel row will be illustrated. This display mode is characterized by black and white horizontal stripes. Specifically, odd-numbered rows present white display while even-numbered rows present black display. This display pattern is referred to as horizontal stripe display.

Assuming that there are 220 pixel rows, description will be given of a process which takes place when the duty ratio is 110/220. The duty ratio of 110/220 means a condition in which a turn-on voltage and turn-off voltage are applied to gate signal lines 17*b* every other pixel row. The location of the gate signal line 17*b* to which a turn-on voltage or turn-off voltage is applied is scanned in sync with a horizontal synchronization signal. Thus, looking at the gate signal line 17*b* of a specific pixel row, a turn-on voltage and turn-off voltage are applied to the gate signal line 17*b* alternately in sync with a horizontal synchronization signal. Looking at the entire screen 50, a turn-on voltage is applied to even-numbered pixel rows. During this period, a turn-off voltage is applied to the odd-numbered pixel rows. After one horizontal scanning period, a turn-on voltage is applied to the odd-numbered pixel rows. During this period, a turn-off voltage is applied to the even-numbered pixel rows.

When odd-numbered pixel rows present white display and even-numbered pixel rows present horizontal stripe display, if a turn-on voltage is applied to the odd-numbered pixel rows, current flows to the display area from the power supply circuit. However, if a turn-on voltage is applied to the even-numbered pixel rows, current does not flow to the display area from the power supply circuit because the even-numbered pixel rows are in black display mode. Thus, the power supply circuit delivers and stops delivering current every other horizontal scanning period. This operation is not desirable for the power supply circuit because a transient phenomenon will occur in the power supply circuit and power supply efficiency will be lowered.

Figure 100B:
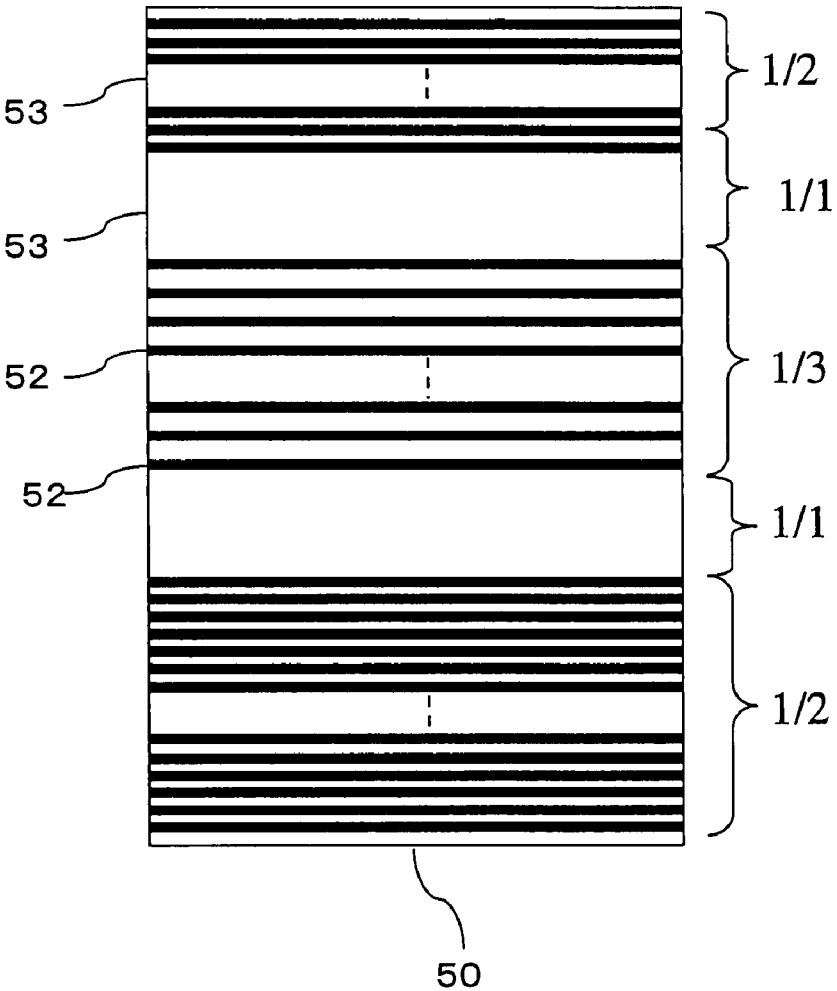
FIG. 100 is an explanatory diagram illustrating a drive method of a display panel according to the present invention.
Figure 100A:
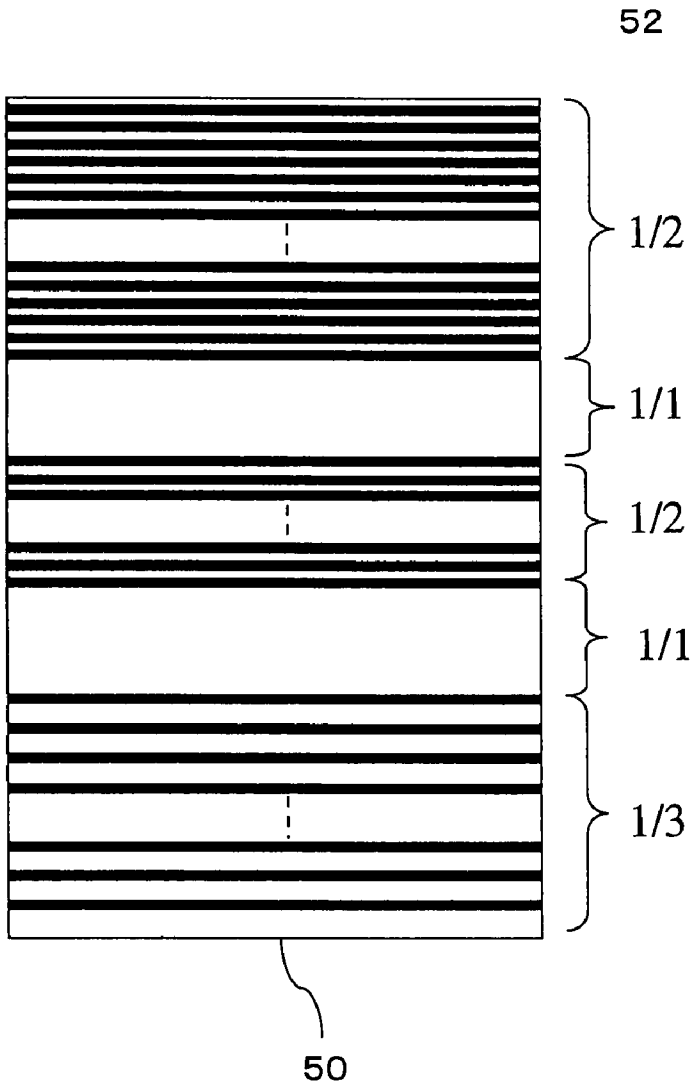

A drive method which solves the above problem is shown in FIG. 100. Instead of using a single duty ratio of 1/2, this method uses a plurality of duty ratios to drive the screen 50 so that current will flow constantly even in horizontal stripe display.

In FIGS. 100(*a*) and 100(*b*), duty ratios 1/2, 1/1, and 1/3 are used to achieve a duty ratio of 1/2 as a whole (when averaged over one frame period). In this way, by combining a plurality of duty ratios during one frame period, it is possible to avoid turning on and off output current from the power supply circuit even in horizontal stripe display. Orderly patterns such as horizontal stripes are displayed relatively frequently. In contrast, duty cycle control using a duty ratio pattern which makes non-display areas 52 spaced equally tends to burden the power supply circuit. Thus, it is preferable to use a plurality of duty ratio patterns simultaneously to drive the screen 50. Also, instead of using a single duty ratio pattern, it is preferable to obtain a predetermined duty ratio when duty ratios are averaged over a single frame or a few frames (fields) .

Incidentally, it goes without saying that the duty ratio patterns in FIG. 100 are scanned from top to bottom of the screen 50 as illustrated in FIG. 97. Also, although it has been stated that the duty cycle control according to the present invention moves the scanning location every pixel row in sync with a horizontal synchronization signal, this is not restrictive. The scanning location may be moved every few pixel row in sync with a horizontal synchronization signal. Also, the scan direction is not limited to the top-to-bottom direction of the screen 50. For example, it is also possible to scan the first field from top to bottom of the screen 50, and the second field from bottom to top of the screen 50.

Figure 101B:
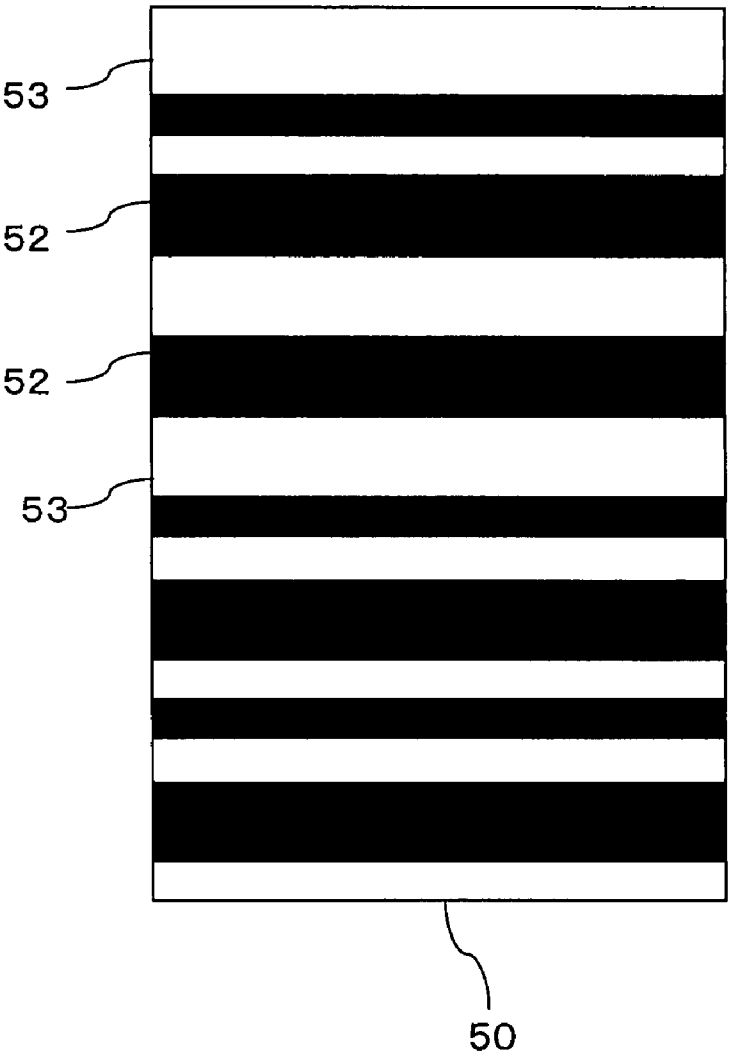
FIG. 101 is an explanatory diagram illustrating a drive method of a display panel according to the present invention.
Figure 101A:
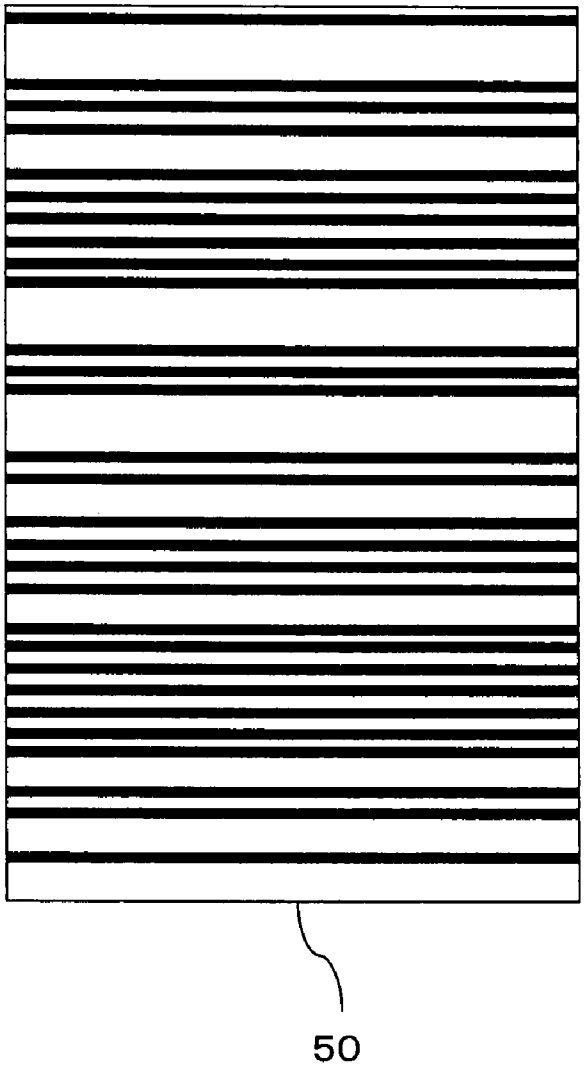

The drive method in FIG. 100 applies a turn-on voltage and turn-off voltage to the gate signal line 17*b* of each of discrete pixel rows. However, the present invention is not limited to this. FIG. 101(*a*) shows pixel rows driven by the method shown in FIG. 100. Similar screen 50 brightness can be achieved using the duty ratio patterns shown in FIG. 101(*b*), where a turn-on voltage or turn-off voltage is applied to consecutive pixel rows.

Figure 102B:
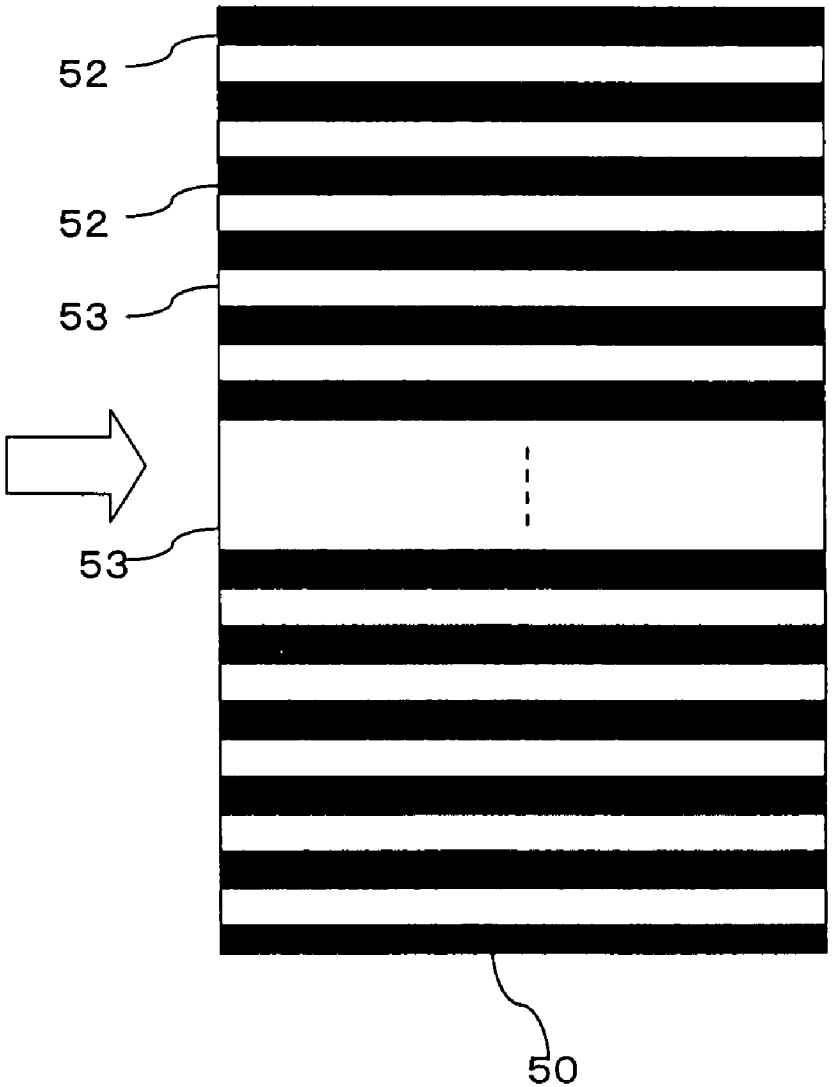
FIG. 102 is an explanatory diagram illustrating a drive method of a display panel according to the present invention.
Figure 102A:
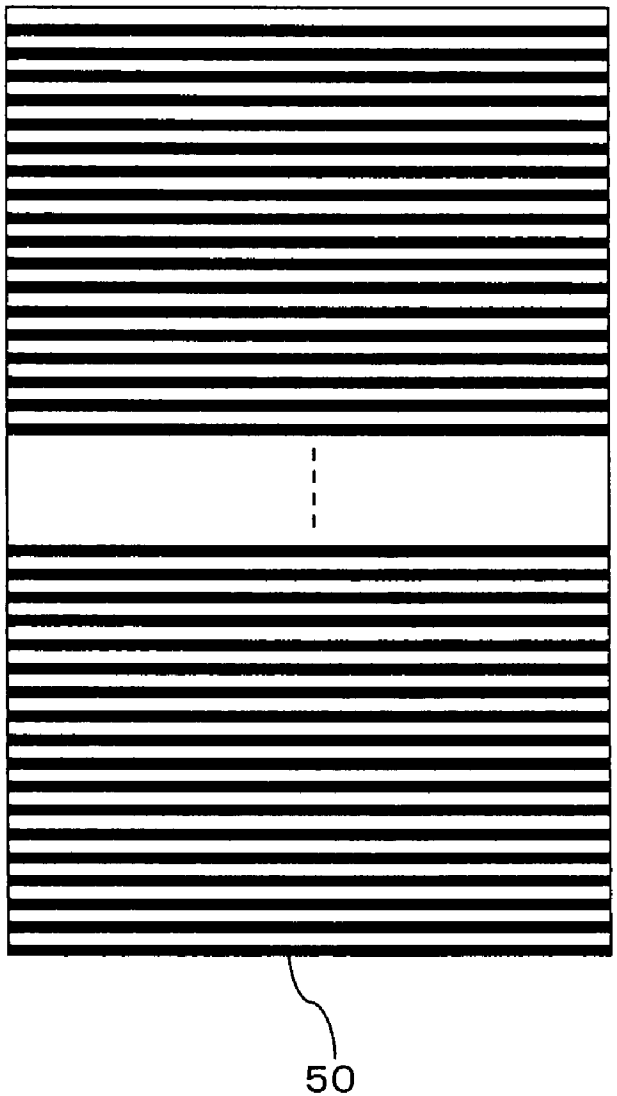

A great variety of duty ratio patterns can achieve the same screen 50 brightness. Some patterns contain a very large number of finely divided non-display areas 52 as illustrated in FIG. 102(*a*), others contain a small number of divided non-display areas 52 as illustrated in FIG. 102(*b*). The patterns in FIGS. 102(*a*) and 102(*b*) have the same duty ratio when the fractions are reduced to their lowest terms. Thus, the screens have the same brightness.

EL display panels have a problem of image burn-in due to degradation of EL elements 15. Fixed patterns, in particular, tend to cause image burn-in. The present invention is equipped with a sub-image display area 50*b* (sub-screen) to display fixed patterns. A display area 50*a* (main screen) is a movie display area which displays television images and the like.

In the organic EL display panel according to the present invention in FIG. 147, gate driver circuits 12 are shared by the sub-screen 50*b* and main screen 50*a*. It is assumed that the sub-screen 50*b* has 20 pixel rows or more. Thus, the screen 50 consists, for example, of 220 pixel rows of the main screen 50*a* and 24 pixel rows of the sub-screen 50*b*. Incidentally, the number of pixel rows is 176 each for R, G, and B.

The main screen 50*a* and sub-screen 50*b* may be separated distinctly as illustrated in FIG. 149. In the figure, a space BL is provided between the main screen 50*a* and sub-screen 50*b*. The space BL is an area where no pixel 16 is formed.

W/L (W is the channel width of the driver transistors and L is the channel length of the driver transistors) of the driver transistors 11*a* for the pixels in the main screen (main panel) and sub-screen (sub-panel) may be varied. Basically, W/L of the sub-screen (sub-panel) should be increased. Also, the size of pixels 16*a* in the main screen (main panel) 50*a* and the size of pixels 16*b* in the sub-screen (sub-panel) 50*b* may be varied. Also, the anode voltage Vdd or cathode voltage Vk applied to the sub-screen (sub-panel) 50*b* may be different from the anode or cathode voltage of the main screen (main panel) 50*a*.

When a sub-panel 71*b* and main panel 71*a* are superimposed as illustrated in FIG. 150(*b*), a cushioning sheet 1504 should be placed or formed between an encapsulation substrate 85*a* (encapsulation layer) and encapsulation substrate 85*b* (encapsulation layer). The cushioning sheet 1504 may be a plate or sheet made of metal such as a magnesium alloy or a plate or sheet made of resin such as polyester.

As also illustrated in FIG. 150, the sub-panel 71*b* may be provided separately to present the sub-screen 50*b*. A flexible board 84 is provided between the main panel 71*a* and sub-panel 71*b* to connect source signal lines 18*a* and 18*b* with each other. Connection wiring 1503 is formed in advance on the flexible board 84. At a termination of the signal line 18*a* is a analog switch group consisting of analog switches 1501. The analog switches 1501 control whether a current signal from a source driver circuit 14 is supplied to the sub-panel 71*b*.

A switch control wire 1502 is formed for on/off control of the analog switches 1501. Logic signals fed to the switch control wire 1502 control signal supply to the sub-panel, and consequently images are displayed.

Incidentally, instead of forming gate driver circuits or mounting gate driver IC chips in the sub-panel 71*b*, gate signal lines 17 may be formed on the WR side as described with reference to FIG. 9 and the illumination control lines 401 described with reference to FIG. 40 may be formed or placed.

Preferably, the analog switches 1501 are a CMOS type consisting of a combination of P-channel and N-channel transistors as described in FIG. 152. An inverter 1521 is placed on the switch control wire 1502 to turn on and off the analog switches 1501. Analog switches 1501*b* may be constituted of only P-channel transistors, as illustrated in FIG. 153.

A configuration shown in FIG. 154 may be used if the sub-panel 71*b* and main panel 71*a* differ in the number of source signal lines 18. Outputs of analog switches 1501*a* and 1501*b* are short-circuited and connected to the same terminal 1522*a*. Also, as illustrated in FIG. 155, the output of the analog switches 1501*b* may be connected to the voltage Vdd to prevent them from turning on. Besides, as illustrated in FIG. 156, analog switches 1501*a* (1501*a*1 and 1501*a*2) may be placed or formed at terminations of source signal lines 18 which do not need to be connected to the sub-panel 71*b*. A turn-off voltage is applied to the analog switches 1501*a* to prevent them from turning on.

Next, description will be given of examples of display devices according to the present invention which run the drive systems according to the present invention. FIG. 157 is a plan view of a cell phone which is an example of an information terminal. An antenna 1571, numeric keys 1572, etc. are mounted on a casing 1573. Reference numerals 1572 and the like denote a display color switch key, power key, and frame rate switch key.

The key 1572 may be configured to switch among color modes as follows: pressing it once enters 8-color display mode, pressing it again enters 4096-color display mode, and pressing it again enters 260,000-color display mode. The key is a toggle switch which switch among color display modes each time it is pressed. Incidentally, a display color change key may be provided separately. In that case, three (or more) keys 1572 are needed.

In addition to a push switch, the key 1572 may be a slide switch or other mechanical switch. Speech recognition may also be used for switching. For example, the switch may be configured such that display colors on the display screen 50 of the display panel will change as the user enters a color change command by speaking such as "high-definition display,"

"4096-color mode," or "low-color display mode" into the phone. This can be implemented easily using existing speech recognition technology.

Also, display colors may be switched electrically. It is also possible to employ a touch panel which allows the user to make a selection by touching a menu presented on the display part 50 of the display panel. Besides, display colors may be switched based on the number of times the switch is pressed or based on a rotation or direction as is the case with a click ball.

A key which changes frame rate or a key which switches between moving pictures and still pictures many be used in place of the display color switch key 1572. A key may switch two or more items at the same time: for example, among frame rates and between moving pictures and still pictures. Also, the key may be configured to change the frame rate gradually (continuously) when pressed and held. For that, among a capacitor C and a resistor R of an oscillator, the resistor R can be made variable or replaced with an electronic regulator. Alternatively, a trimmer capacitor may be used as a capacitor C of the oscillator. Such a key can also be implemented by forming a plurality of capacitors in a semiconductor chip, selecting one or more capacitors, and connecting the capacitors in parallel.

Furthermore, embodiments which use the EL display panel, EL display apparatus, or drive method according to the present invention will be described with reference to drawings.

FIG. 158 is a sectional view of a viewfinder according to an embodiment of the present invention. It is illustrated schematically for ease of explanation. Besides, some parts are enlarged, reduced, or omitted. For example, an eyepiece cover is omitted in FIG. 158. The above items also apply to other drawings.

Inner surfaces of a body 1573 are dark- or black-colored. This is to prevent stray light emitted from an EL display panel (EL display apparatus) 1574 from being reflected diffusely inside the body 1573 and lowering display contrast. A phase plate (λ/4) 108, polarizing plate 109, and the like are placed on an exit side of the display panel. This has also been described with reference to FIGS. 10 and 11.

An eye ring 1581 is fitted with a magnifying lens 1582. The observer focuses on a display image 50 on the display panel 1574 by adjusting the position of the eye ring 1581 in the body 1573.

If a convex lens 1583 is placed on the exit side of the display panel 1574 as required, principal rays entering the magnifying lens 1582 can be made to converge. This makes it possible to reduce the diameter of the magnifying lens 1582, and thus reduce the size of the viewfinder.

FIG. 159 is a perspective view of a video camera. A video camera has a taking (imaging) lens 1592 and a video camera body 1573. The taking lens 1592 and view finder 1573 are mounted back to back with each other. The viewfinder 1573 (see also FIG. 158) is equipped with an eyepiece cover. The observer views the image 50 on the display panel 1574 through the eyepiece cover.

The EL display panel according to the present invention is also used as a display monitor. The display screen 50 can pivot freely on a point of support 1591. The display screen 50 is stored in a storage compartment 1593 when not in use.

A switch 1594 is a changeover switch or control switch and performs the following functions. The switch 1594 is a display mode changeover switch. The switch 1594 is also suitable for cell phones and the like. Now the display mode changeover switch 1594 will be described.

The drive methods according to the present invention include the one that passes an N times larger current through EL elements 15 to illuminate them for a period equal to 1/M of 1F. By varying this illumination period, it is possible to change brightness digitally. For example, designating that N=4, a four times larger current is passed through the EL elements 15. If the illumination period is 1/M, by switching M among 1, 2, 3, and 4, it is possible to vary brightness from 1 to 4 times. Incidentally, M may be switched among 1, 1.5, 2, 3, 4, 5, 6, and so on.

The switching operation described above is used for cell phones, monitors, etc. which display the display screen 50 very brightly at power-on and reduce display brightness after a certain period to save power. It can also be used to allow the user to set a desired brightness. For example, the brightness of the screen is increased greatly outdoors. This is because the screen cannot be seen at all outdoors due to bright surroundings. However, the EL elements 15 deteriorate quickly under conditions of continuous display at high brightness. Thus, the screen 50 is designed to return to normal brightness in a short period of time if it is displayed very brightly. A button which can be pressed to increase display brightness should be provided, in case the user wants to display the screen 50 at high brightness again.

Thus, it is preferable that the user can change display brightness with the button switch 1594, that the display brightness can be changed automatically according to mode settings, or that the display brightness can be changed automatically by detecting the brightness of extraneous light. Preferably, display brightness settings such as 50%, 60%, 80%, etc. are available to the user.

Preferably, the display screen 50 employs Gaussian display. That is, the center of the display screen 50 is bright and the perimeter is relatively dark. Visually, if the center is bright, the display screen 50 seems to be bright even if the perimeter is dark. According to subjective evaluation, as long as the perimeter is at least 70% as bright as the center, there is not much difference. Even if the brightness of the perimeter is reduced to 50%, there is almost no problem. The self-luminous display panel according to the present invention generates a Gaussian distribution from top to bottom of the screen using the N-fold pulse driving described above (a method which passes an N times larger current through EL elements 15 to illuminate them for a period equal to 1/M of 1F).

Specifically, the value of M is increased in upper and lower parts of the screen and decreased in the center of the screen. This is accomplished by modulating the operating speed of a shift register of the gate driver circuits 12. The brightness at the left and right of the screen is modulated by multiplying video data by table data. By reducing peripheral brightness (at an angle of view of 0.9) to 50% through the above operation, it is possible to reduce power consumption by 20% compared to brightness of 100%. By reducing peripheral brightness (at an angle of view of 0.9) to 70%, it is possible to reduce power consumption by 15% compared to brightness of 100%.

Preferably a changeover switch is provided to enable and disable the Gaussian display. This is because the perimeter of the screen cannot be seen at all outdoors if the Gaussian display is used. Thus, it is preferable that the user can change display brightness with the button switch, that the display brightness can be changed automatically according to mode settings, or that the display brightness can be changed automatically by detecting the brightness of extraneous light. Preferably, display brightness settings such as 50%, 60%, 80%, etc. are available to the user.

Liquid crystal display panels generate a fixed Gaussian distribution using a backlight. Thus, they cannot enable and disable the Gaussian distribution. The capability to enable and disable Gaussian distribution is peculiar to self-luminous display devices.

A fixed frame rate may cause interference with illumination of an indoor fluorescent lamp or the like, resulting in flickering. Specifically, if the EL elements 15 operate on 60-Hz alternating current, a fluorescent lamp illuminating on 60-Hz alternating current may cause subtle interference, making it look as if the screen were flickering slowly. To avoid this situation, the frame rate can be changed. The present invention has a capability to change frame rates. Also, it allows the value of N or M to be changed in N-fold pulse driving (a method which passes an N times larger current through EL elements 15 to illuminate them for a period equal to 1/M of 1F).

The above capabilities are implemented by way of the switch 1594. The switch 1594 switches among the above capabilities when pressed more than once, following a menu on the screen 50.

Incidentally, the above items are not limited to cell phones. Needless to say, they are applicable to television sets, monitors, etc. Also, it is preferable to provide icons on the display screen to allow the user to know at a glance what display mode he/she is in. The above items similarly apply to the following.

The EL display apparatus and the like according to this embodiment can be applied not only to video cameras, but also to digital cameras such as the one shown in FIG. 160, still cameras, etc. The display apparatus is used as a monitor 50 attached to a camera body 1601. The camera body 1601 is equipped with a switch 1594 as well as a shutter 1603.

The display panel described above has a relatively small display area. However, with a display area of 30 inches or larger, the display screen 50 tends to flex. To deal with this situation, the present invention puts the display panel in a frame 1611 and attaches a fitting 1614 so that the frame 1611 can be suspended as shown in FIG. 161. The display panel is mounted on a wall or the like using the fitting 1614.

A large screen size increases the weight of the display panel. As a measure against this situation, the display panel is mounted on a stand 1613, to which a plurality of legs 1612 are attached to support the weight of the display panel.

The legs 1612 can be moved from side to side as indicated by A. Also, they can be contracted as indicated by B. Thus, the display apparatus can be installed even in a small space.

A television set in FIG. 161 has a surface of its screen covered with a protective film (or a protective plate). One purpose of the protective film is to prevent the surface of the display panel from breakage by protecting from being hit by something. An AIR coat is formed on the surface of the protective film. Also, the surface is embossed to reduce glare caused by extraneous light on the display panel.

A space is formed between the protective film and display panel by spraying beads or the like. Fine projections are formed on the rear face of the protective film to maintain the space between the protective film and display panel. The space prevents impacts from being transmitted from the protective film to the display panel.

Also, it is useful to inject an optical coupling agent into the space between the protective film and display panel. The optical coupling agent may be a liquid such as alcohol or ethylene glycol, a gel such as acrylic resin, or a solid resin such as epoxy. The optical coupling agent can prevent interfacial reflection and function as a cushioning material.

The protective film may be, for example, a polycarbonate film (plate), polypropylene film (plate), acrylic film (plate) polyester film (plate), PVA film (plate), etc. Besides, it goes without saying that an engineering resin film (ABS, etc.) may be used. Also, it may be made of an inorganic material such as tempered glass. Instead of using a protective film, the surface of the display panel may be coated with epoxy resin, phenolic resin, and acrylic resin 0.5 mm to 2.0 mm thick (both inclusive) to produce a similar effect. Also, it is useful to emboss surfaces of the resin.

It is also useful to coat surfaces of the protective film or coating material with fluorine. This will make it easy to wipe dirt from the surfaces with a detergent. Also, the protective film may be made thick and used for a front light as well as for the screen surface.

The display panel according to the example of the present invention may be used in combination with the three-side free configuration. The three-side free configuration is useful especially when pixels are built using amorphous silicon technology. Also, in the case of panels formed using amorphous silicon technology, since it is difficult to control variations in the characteristics of transistor elements during production processes, it is preferable to use the N-pulse driving, reset driving, dummy pixel driving, or the like according to the present invention. That is, the transistors 11 according to the present invention are not limited to those produced by polysilicon technology, and they may be produced by amorphous silicon technology. Thus, the transistors 11 composing the pixels 16 in the display panels according to the present invention may be formed by amorphous silicon technology. Needless to say the gate driver circuits 12 and source driver circuits 14 may also be formed or constructed by amorphous silicon technology.

Incidentally, the N-fold pulse driving (FIGS. 13, 16, 19, 20, 22, 24, 30, etc.) and the like according to the present invention are more effective for display panels which contain transistors 11 formed by low-temperature polysilicon technology than display panels which contain transistors 11 formed by amorphous silicon technology. This is because adjacent transistors, when formed by amorphous silicon technology, have almost equal characteristics. Thus, driving currents for individual transistors are close to a target value even if the transistors are driven by current obtained by addition (the N-fold pulse driving in FIGS. 22, 24, and 30, in particular, are effective for pixel configurations containing amorphous silicon transistors).

The duty cycle control driving, reference current control, N-fold pulse driving, and other drive methods and drive circuits according to the present invention described herein are not limited to drive methods and drive circuits for organic EL display panels. Needless to say they are also applicable to other displays such as field emission displays (FEDS) as shown in FIG. 173.

In an FED shown in FIG. 173, an electron emission protuberance 1733 (which corresponds to the pixel electrode 105 in FIG. 10) which emits electrons in a matrix is formed on an array board 71. A pixel contains a holding circuit 1734 (which corresponds to the capacitor in FIG. 1) which holds image data received from a video signal circuit 1732 (which corresponds to the source driver circuit 14 in FIG. 1). Also, control electrodes 1731 are placed in front of the electron emission protuberance 1733. Voltage signals are applied to the control electrodes 1731 by an on/off control circuit 1735 (which corresponds to the gate driver circuit 12 in FIG. 1).

The pixel configuration in FIG. 173 can perform N-fold pulse driving, duty cycle control driving, etc. if a peripheral circuit shown in FIG. 174 is added. An image data signal is applied to the source signal line 18 from the video signal circuit 1732. A pixel 16 selection signal is applied to a selection signal line 2173 by an on/off control circuit 1735*a*, and consequently pixels 16 are selected one after another and image data is written into them. Also, an on/off signal is applied to an on/off signal line 1742 by an on/off control circuit 1735*b*, and consequently the pixels of the FED are subjected to on/off control (duty cycle control).

The technical idea described in the example of the present invention can be applied to video cameras, projectors, 3D television sets, projection television sets, etc. It can also be applied to viewfinders, cell phone monitors, PHS, personal digital assistants and their monitors, and digital cameras and their monitors.

Also, the technical idea is applicable to electrophotographic systems, head-mounted displays, direct view monitors, notebook personal computers, video cameras, electronic still cameras. Also, it is applicable to ATM monitors, public phones, videophones, personal computers, and wristwatches and its displays.

Furthermore, it goes without saying that the technical idea can be applied to display monitors of household appliances, pocket game machines and their monitors, backlights for display panels, or illuminating devices for home or commercial use. Preferably, illuminating devices are configured such that color temperature can be varied. Color temperature can be changed by forming RGB pixels in stripes or in dot matrix and adjusting currents passed through them. Also, the technical idea can be applied to display apparatus for advertisements or posters, RGB traffic lights, alarm lights, etc.

Also, organic EL display panels are useful as light sources for scanners. An image is read with light directed to an object using an RGB dot matrix as a light source. Needless to say, the light may be monochromatic. Besides, the matrix is not limited to an active matrix and may be a simple matrix. The use of adjustable color temperature will improve imaging accuracy.

Also, organic EL display panels are useful as backlights of liquid crystal display panels. Color temperature can be changed and brightness can be adjusted easily by forming RGB pixels of an EL display panel (backlight) in stripes or in dot matrix and adjusting currents passed through them. Besides, the organic EL display panel, which provides a surface light source, makes it easy to generate Gaussian distribution that makes the center of the screen brighter and perimeter of the screen darker. Also, organic EL display panels are useful as backlights of field-sequential liquid crystal display panels which scan with R, G, and B lights in turns. Also, they can be used as backlights of liquid crystal display panels for movie display by inserting black even if the backlights are turned on and off.

Industrial Applicability

The source driver circuit of the present invention, in which transistors composing a current mirror are formed adjacent to each other, can reduce variations in output current caused by deviations in thresholds. Thus, it can reduce brightness irregularities of an EL display panel and has great practical effect.

Also, the display panels, display apparatus, etc. of the present invention offer distinctive effects, including high quality, high movie display performance, low power consumption, low costs, high brightness, etc., according to their respective configurations.

Incidentally, the present invention does not consume much power because it can provide power-saving information display apparatus. Also, it does not waste resources because it can reduce size and weight. Furthermore, it can adequately support high-resolution display panels. Thus, the present invention is friendly to both global environmental and space environment.

The invention claimed is:

1. A drive method of an EL display apparatus that comprises a display screen in which a plurality of pixels each of which includes an EL element are formed in a matrix and a switching element which turns on/off a current that flows in the EL element, the drive method comprising:

weighting image data with respect to a color of respective of the plurality of pixels, said image data generating a signal which is to be impressed to the respective pixels of the EL display apparatus, aggregating said weighted image data, and when results of said aggregating of said weighted image data are larger than a predetermined value, suppressing an amount of current that flows in the EL element by shortening a time period to pass the current during one frame period by controlling said switching element, displaying a non-display area on the display screen of the EL display apparatus, and shifting the non-display area on the display screen synchronizing with said one frame period.

2. An EL display apparatus including a display screen in which a plurality of pixels each of which includes an EL element are formed in a matrix, the EL display apparatus comprising:

a switching element which turns on/off a current that flows in the EL element;

a gate driver circuit that drives a gate signal line selecting a line of the pixels;

an aggregation circuit configured to weight image data with respect to color of respective of the plurality of pixels, said image data generating a signal which is to be impressed to the respective pixels of the EL display apparatus, and to aggregate the weighted image data; and a control circuit that controls a timing or a period to generate a start pulse signal for the gate driver circuit based on the aggregated image data, wherein the gate driver circuit drives the gate signal line according to the start pulse signal, generates a non-display area on the display screen by controlling said switching element, and shifts the non-display area in a scanning direction of the gate driver circuit.

3. The drive method of an EL display apparatus according to claim 1, wherein:

said EL display apparatus comprises a gate driver circuit that drives a gate signal line selecting a line of the pixels, the non-display area is generated in a belt-like form on the display screen of the EL display apparatus by the gate driving circuit driving the gate signal line; and the non-display area is shifted scanning direction of the gate driver circuit.

4. The drive method of an EL display apparatus according to claim 1, further comprising:

detecting brightness of outside the EL display apparatus;

generating a belt-like non-display area and a belt-like display area; and changing or adjusting a ratio of the belt-like non-display area and the belt-like display area according to an output value obtained by the detecting.

5. The EL display apparatus according to claim 2, further comprising:

a selection circuit formed on a substrate on which the EL elements are formed; and a source driver circuit, wherein the source driver circuit outputs a video signal of a first color or a video signal of a second color from a signal output terminal, the substrate includes source signal lines to supply the video signals of the source driver circuit to the EL elements, the selection circuit includes an input terminal to connect to the signal output terminal of the source driver circuit and a selection output terminal to connect to the source signal line, the selection circuit includes a plurality of combinations of one output terminal and a plurality of selection output terminals configured to connect to the one output terminal, and the selection circuit applies a video signal of the source driver circuit input to the input terminal of the selection circuit to the source signal line connected to the one or plural of selection output terminals that are selected from the plurality of the selection output terminals.

6. The EL display apparatus according to claim 2, further comprising a source driver circuit that applies a gradation signal to the EL elements, wherein the source driver circuit includes a voltage output circuit and a current output circuit.

7. The EL display apparatus according to claim 2, wherein brightness of the display screen is controlled by varying a ratio of the non-display area to the display screen.

8. The EL display apparatus according to claim 2, wherein the shifting the non-display area in the display screen is performed synchronizing with one flame period.

9. The EL display apparatus according to claim 2, wherein in the display screen, the plurality of pixels having a plurality of colors are formed in a matrix, and an area of an element of one color of the plurality of colors is different from an area of an element of the other colors.

10. The EL display apparatus according to claim 2, wherein the non-display area is divided into a plurality of parts.

11. The drive method of an EL display apparatus according to claim 1, wherein: a driver transistor for supplying current to said EL element is formed in said pixel of said EL display apparatus, and said driver transistor is a P-channel transistor.

12. The drive method of an EL display apparatus according to claim 1, wherein, said EL display apparatus further comprises;

a source driver circuit that applies an image signal and, a switch circuit arranged between an output terminal of said source driver circuit and source signal lines which said pixel is connected with, and wherein, said switch circuit impresses image signal which is output from said output terminal of said source driver circuit to selected source signal line.

13. The EL display apparatus according to claim 2, wherein: a driver transistor for supplying current to said EL element is formed in said pixel of said EL display apparatus, and said driver transistor is a P-channel transistor.

14. The EL display apparatus according to claim 2, further comprising:

a source driver circuit that applies an image signal and, a switch circuit arranged between an output terminal of said source driver circuit and source signal lines which said pixel is connected with, and wherein, said switch circuit impresses image signal which is output from said output terminal of said source driver circuit to selected source signal line.

* * * * *